US010357133B2

(12) United States Patent
Okada

(10) Patent No.: US 10,357,133 B2
(45) Date of Patent: Jul. 23, 2019

(54) BUTTOCKS WIPING DEVICE

(71) Applicant: FIVE CO., LTD., Osaka (JP)

(72) Inventor: Shoji Okada, Osaka (JP)

(73) Assignee: FIVE CO., LTD., Osaka (JP)

( * ) Notice: Subject to any disclaimer, the term of this patent is extended or adjusted under 35 U.S.C. 154(b) by 2 days.

(21) Appl. No.: 15/559,621

(22) PCT Filed: Mar. 22, 2016

(86) PCT No.: PCT/JP2016/059058

§ 371 (c)(1),
(2) Date: Sep. 19, 2017

(87) PCT Pub. No.: WO2016/152881

PCT Pub. Date: Sep. 29, 2016

(65) Prior Publication Data

US 2018/0064295 A1 Mar. 8, 2018

(30) Foreign Application Priority Data

Mar. 23, 2015 (JP) ..... 2015-060198
Mar. 26, 2015 (JP) ..... 2015-064975
Mar. 30, 2015 (JP) ..... 2015-069624
Apr. 10, 2015 (JP) ..... 2015-081214
(Continued)

(51) Int. Cl.
*A47K 7/08* (2006.01)
*A47K 7/04* (2006.01)
(Continued)

(52) U.S. Cl.
CPC ..... *A47K 7/08* (2013.01); *A47K 7/04* (2013.01); *A47K 10/34* (2013.01);
(Continued)

(58) Field of Classification Search
CPC . A47K 7/08; A47K 7/04; A47K 10/32; A47K 10/34; E03D 9/08
(Continued)

(56) References Cited

U.S. PATENT DOCUMENTS

2013/0191980 A1* 8/2013 Khiroya ..... A47K 13/005 4/237
2014/0096335 A1 4/2014 Okada
2017/0360263 A1* 12/2017 Okada ..... A47K 7/08

FOREIGN PATENT DOCUMENTS

CN 2682113 Y 3/2005
DE 251031 A 1/1911
(Continued)

OTHER PUBLICATIONS

International Search Report dated Jun. 21, 2016 filed in PCT/JP2016/059058.

*Primary Examiner* — Huyen D Le
(74) *Attorney, Agent, or Firm* — Rankin, Hill & Clark LLP

(57) ABSTRACT

The present invention relates to a buttocks wiping device 1 for wiping the buttocks with paper. The buttocks wiping device 1 includes a wiping arm 4 including a pressing unit 4*a* configured to press the paper against the buttocks, and a wiping arm drive unit 3 configured to cause the wiping arm 4 to move and perform wiping operation. The wiping arm drive unit 4 wipes, without attaching or inserting the paper to the pressing unit 4*a*, the buttocks with the paper being placed on the pressing unit 4*a*. Moreover, the buttocks wiping device 1 of the present invention includes a paper supply unit 17 configured to expose the paper. The wiping arm drive unit 4 drives the wiping arm such that the pressing unit 4*a* pushes up, from below, the paper exposed by a paper loading guide 17*c* of the paper supply unit 17.

22 Claims, 229 Drawing Sheets

(30) Foreign Application Priority Data

| | | |
|---|---|---|
| Apr. 14, 2015 | (JP) | 2015-082594 |
| Apr. 20, 2015 | (JP) | 2015-086230 |
| Apr. 23, 2015 | (JP) | 2015-088738 |
| Apr. 28, 2015 | (JP) | 2015-091844 |
| Jun. 8, 2015 | (JP) | 2015-116159 |
| Jun. 29, 2015 | (JP) | 2015-130340 |
| Sep. 7, 2015 | (JP) | 2015-176082 |
| Sep. 7, 2015 | (JP) | 2015-176160 |

(51) Int. Cl.
*A47K 10/34* (2006.01)
*A47K 13/10* (2006.01)
*E03D 9/08* (2006.01)

(52) U.S. Cl.
CPC ..... *A45D 2200/1027* (2013.01); *A47K 13/10* (2013.01); *E03D 9/08* (2013.01)

(58) Field of Classification Search
USPC ..... 4/661
See application file for complete search history.

(56) References Cited

FOREIGN PATENT DOCUMENTS

| | | | |
|---|---|---|---|
| JP | 49006751 | A2 | 1/1974 |
| JP | 4195076 | | 12/2008 |
| JP | 2009061126 | A2 | 3/2009 |
| JP | 2009263859 | A2 | 11/2009 |
| JP | 2011143233 | A2 | 7/2011 |
| JP | 2011144623 | A2 | 7/2011 |
| JP | 2011200627 | A2 | 10/2011 |
| JP | 2012172486 | A2 | 9/2012 |
| JP | 2013188301 | A2 | 9/2013 |
| JP | 2014064885 | A2 | 4/2014 |
| JP | 2014094261 | A2 | 5/2014 |
| JP | 2014207949 | A1 | 11/2014 |
| JP | 2014233309 | A2 | 12/2014 |
| JP | 2015104617 | A2 | 6/2015 |
| TW | 200533328 | A | 10/2005 |
| WO | 2005087067 | | 9/2005 |

* cited by examiner (a)

(b)

(c)

(a)

(b)

(a)

(b)

(a)

(b)

(a)

(b)

(a)

(b)

(a)

(b)

(c)

BUTTOCKS WIPING DEVICE

TECHNICAL FIELD

The present invention relates to a device for wiping the buttocks with paper.

BACKGROUND ART

A buttocks wiping device described in Patent Literature 1 is a device configured such that a toilet seat lifting/lowering device is used to provide a clearance between a toilet bowl and a toilet seat and such that a plurality of servomotors are used to wipe the buttocks by a wiping arm. The wiping arm of Patent Literature 1 is configured to wipe the buttocks with rolled paper being pinched by a pinching member (e.g., FIG. 8 of Patent Literature 1).

Patent Literature 2 discloses the embodiment (e.g., FIG. 7 of Patent Literature 2) for wiping the buttocks with special paper being pinched by a clip member and the embodiment (e.g., FIG. 18 of Patent Literature 2) for wiping the buttocks with special paper being inserted into a U-shaped cutout portion.

Patent Literatures 3 to 5 disclose various embodiments, and as in FIGS. 6E, 48, 79, 83 to 86, 117, etc., the embodiment for wiping the buttocks with paper being pinched by tip end portions of a wiping arm.

As illustrated in FIG. 15 etc., Patent Literature 6 also discloses the embodiment for wiping the buttocks with paper being pinched by tip end portions of a wiping arm.

As illustrated in FIG. 8, Patent Literature 7 also discloses the embodiment for wiping the buttocks with paper being pinched by tip end portions of a wiping arm.

As illustrated in FIG. 5, Patent Literature 8 also discloses the embodiment for wiping the buttocks with paper being pinched by tip end portions of a wiping arm.

As illustrated in FIG. 2 etc., Patent Literature 9 also discloses the embodiment for wiping the buttocks with paper being pinched by tip end portions of a wiping arm.

As illustrated in FIG. 1 etc., Patent Literature 10 also discloses the embodiment for wiping the buttocks with paper being pinched by tip end portions of a wiping arm.

As illustrated in FIG. 1 etc., Patent Literature 11 also discloses the embodiment for wiping the buttocks with paper being pinched by tip end portions of a wiping arm.

Patent Literature 12 discloses a device configured to wipe the buttocks with toilet paper winded around a roller.

Patent Literature 13 discloses a device configured to wipe the buttocks with toilet paper being pinched by wiping plates.

Patent Literature 14 discloses a device configured to wipe the buttocks with paper being pinched by a clip pad (c).

Patent Literature 15 discloses a device configured to wipe the buttocks with paper being pinched by a paper holder (11) of an artificial hand (10).

Conventional technologies as described above exist.

CITATION LIST

Patent Literature

Patent Literature 1: JP-A-2009-061126
Patent Literature 2: JP-A-2009-263859
Patent Literature 3: JP-A-2011-200627
Patent Literature 4: JP-A-2011-143233
Patent Literature 5: JP-A-2011-144623
Patent Literature 6: JP-A-2012-172486

Patent Literature 7: JP-A-2014-094261
Patent Literature 8: JP-A-2014-233309
Patent Literature 9: JP-A-2014-064885
Patent Literature 10: JP-A-2014-207949
Patent Literature 11: JP-A-2015-104617
Patent Literature 12: JP-A-2013-188301
Patent Literature 13: JP-A-S49-006751
Patent Literature 14: Chinese Utility Model Application Publication No. 2682113
Patent Literature 15: Taiwanese Patent Application Publication No. 200533328
Patent Literature 16: German Patent No. 251031

SUMMARY OF THE INVENTION

Problems to be Solved by the Invention

Any of these conventional buttocks wiping devices has not been manufactured or commercialized. For commercialization, various problems including not only operation as desired but also structure simplification, cost reduction, sanitation, usability, and easy maintenance need to be solved.

In the buttocks wiping device described in Patent Literature 1, the wiping arm needs to pinch the rolled paper, leading to a complicated structure for such pinching. Moreover, the wiping arm is driven by the plurality of servomotors, leading to a cost increase on that point. Further, the toilet seat lifting/lowering device needs to be used, leading a further cost increase. In addition, in the case of driving the wiping arm by the servomotors, maintenance is too technical, leading to a difficulty in practical use of the device.

An attempt has been made to provide the buttocks wiping device described in Patent Literature 2 together with a warm-water cleansing device. However, the warm-water cleansing device itself needs to be driven, and for this reason, this device requires further study for practical use. In terms of wiping, there is a probability that wiping is insufficient only by attachment of the special paper by means of the clip member as illustrated in FIG. 7 etc. of Patent Literature 2. Moreover, in FIG. 18 etc. of Patent Literature 2, the special paper which can be inserted into the U-shaped cutout portion needs to be prepared separately, and there is a probability that wiping is insufficient only by insertion of the special paper into the cutout portion as described in Patent Literature 2. That is, in the case of attaching the special paper to the clip member or inserting the special paper into the U-shaped cutout portion, a portion which is to contact the buttocks can be only on a plane, leading to the probability of not sufficiently performing wiping. As described above, the device of Patent Literature 2 not only leads to a structural problem due to installation together with the warm-water cleansing device, but also has not been improved to arrive at sufficient wiping. For this reason, this device requires further study. Thus, practical use of the device has not been realized yet.

The paper is firmly pinched by the wiping arm in the devices described in Patent Literatures 3 to 8, and therefore, the buttocks can be sufficiently wiped. The applicant of the present invention has actually manufactured some of the disclosed devices to check the feeling of wiping by such devices. However, for practical use, a wiping arm drive unit structure is complicated, and costs high. In addition, the structure of holding the paper by the wiping arm is a complicated structure such as use of a wire or shape-memory metal. This leads to problems that breakdown is easily caused and that it is difficult to perform maintenance. Thus, prototypes could be developed, but practical use of the devices cannot be realized.

The devices described in Patent Literatures 9 to 11 have a basic structure similar to those of the devices described in Patent Literatures 3 to 8, and are not dramatically-developed devices. In the devices described in Patent Literatures 9 to 12, a wiping arm drive unit structure is also complicated, and costs high. In addition, the structure of holding the paper by the wiping arm is a complicated structure such as use of a wire. This leads to problems that breakdown is easily caused and that it is difficult to perform maintenance.

The device described in Patent Literature 12 not only has a complicated structure, but also is configured such that wiping is performed using the roller from the back. Thus, there is a fundamental problem due to installation together with a toilet bowl, and this device requires still further study.

Patent Literature 13 also has a problem similar to that of Patent Literature 12.

In Patent Literature 14, there is no way to conveniently hang the paper down to the clip pad (c) one by one, and it must be said that this device is uncompleted as an invention. Moreover, a hole needs to be formed at a toilet bowl, and for this reason, this device is not realistic.

Patent Literature 15 discloses the device merely as an idea. It is assumed that a toilet bowl is below a toilet seat and that the artificial hand is to be exposed from the back of the toilet bowl. Thus, a hole also needs to be formed at the toilet bowl in the device of Patent Literature 15. It is unclear how to perform installation together with the toilet bowl, and it must be said that this device is uncompleted as an invention.

Moreover, the structure of the paper holder (11) is unclear, and it is unclear whether or not the paper is held as desired. Needless to say, this device is far from practical use.

In view of above, it is an objective of the present invention to provide a buttocks wiping device configured so that structure simplification, cost reduction, sanitation, usability, and easy maintenance can be realized and to provide a commercializable buttocks wiping device.

Solutions to the Problems

For solving the above-described problems, the present specification discloses the following aspects. The present invention relates to a buttocks wiping device for wiping the buttocks with a wiping material. The buttocks wiping device includes a wiping arm including a pressing unit configured to press the wiping material against the buttocks and a wiping arm drive unit configured to cause the wiping arm to move and perform wiping operation. The wiping arm drive unit moves, without attaching or inserting the wiping material to the pressing unit, the wiping arm with the wiping material being placed on the pressing unit, and the pressing unit has a curved shape.

In all of conventional Patent Literatures 1 and 3 to 15, the buttocks have been wiped with the paper being held. Thus, the mechanism for holding the paper is necessary. This leads to a complicated structure. In addition to the complicated structure, the portion for holding the paper is to contact the buttocks, and therefore, such a contact portion needs to be held in a sanitary manner. However, due to the mechanism configured to hold the paper, the contact portion needs to have a waterproof structure. In any of the conventional technologies, no sufficient study has been made on such a point. Patent Literature 2 discloses the device configured to wipe the buttocks with the special paper being pinched by the clip member or being inserted into the U-shaped cutout portion. However, a wiping portion is on the plane, and therefore, wiping cannot be sufficiently performed. In contrast, in the present invention, the wiping arm drive unit moves, without attaching or inserting the wiping material to the pressing unit, the wiping arm with the wiping material being placed on the pressing unit, and therefore, the mechanism for holding is not necessary. The structure is simplified, and as well the waterproof structure for the pressing unit needs not to be taken into consideration. Further, the pressing unit can be easily held in a sanitary manner by, e.g., whole-washing. Further, the pressing unit is in the curved shape along the shape of the buttocks. Thus, the pressing unit can contact the vicinity of the anus, leading to more sufficient wiping of the buttocks as compared to the device described in Patent Literature 2. With this structure, the buttocks wiping device can be provided, which is configured so that structure simplification, cost reduction, sanitation, usability, and easy maintenance can be realized.

Upon movement with the wiping material being placed on the pressing unit, the pressing unit may have, in the present invention, a surface exhibiting such friction that the wiping material does not drop, or have such a shape that the wiping material does not drop.

With this structure, dropping of the wiping material can be prevented without the wiping material being attached or inserted to the pressing unit.

Moreover, the present invention relates to a buttocks wiping device for wiping the buttocks with a wiping material. The buttocks wiping device includes a wiping arm including a pressing unit configured to press the wiping material against the buttocks, a wiping arm drive unit configured to cause the wiping arm to move and perform wiping operation, and a paper supply unit configured to expose the wiping material below the buttocks. The wiping arm drive unit drives the wiping arm such that the pressing unit pushes up, from below, the wiping material exposed by the paper supply unit.

As described above, the paper supply unit for exposing the wiping material below the buttocks is provided so that the wiping material can be reliably disposed below the buttocks. For example, in a case where the structure of not attaching or inserting the wiping material is employed for the pressing unit, there is a probability that the wiping material drops from the pressing unit upon movement of the wiping arm due to an unexpected situation. In a case where the pressing unit needs to move with the wiping material being placed on the pressing unit, a clearance corresponding to the wiping material needs to be provided between a raised portion and the pressing unit, for example. However, there is a probability that the wiping material hangs down from the pressing unit or warps up from the pressing unit. Such a clearance needs to have a margin. Moreover, there is a probability that the raised portion gets wet with dirty water, leading to insanitation due to, e.g., the dirty water adhering to the wiping material.

Even in the technique of moving the wiping arm with the wiping material being merely placed on the pressing unit, the objective of the present invention might be accomplished. However, there is a still problem that the probability of causing dropping or contamination of the wiping material upon movement cannot be fully denied. For this reason, in the present invention, a perceptional change leads to the idea of moving the wiping material separately from the wiping arm, and therefore, the buttocks are reliably wiped in such a manner that the pressing unit pushes up, from below, the wiping material disposed below the buttocks. With this structure, reliable wiping can be performed without the wiping material being held. Note that an idea underlying the invention described in the present specification is that the wiping material is held forcedly. Additionally, note that the invention described in the present specification has been made by such a perceptional change. Note that reconsidering the invention described in the present specification, the present invention can be also utilized for the buttocks wiping device configured to hold the paper. For this reason, various aspects of the invention described in the present specification should not be interpreted as being limited only to the buttocks wiping device configured not to hold the paper.

In the present invention, the paper supply unit includes a paper loading guide configured to place the wiping material, and exposes the wiping material below the buttocks in such a manner that the paper loading guide is exposed with the wiping material being placed on the paper loading guide.

The paper loading guide can reliably expose the wiping material below the buttocks.

In the present invention, after the wiping arm drive unit has caused the pressing unit to push up the wiping material, the paper supply unit returns the paper loading guide to a retracted position.

With this structure, the paper loading guide is returned to the retracted position upon wiping. Thus, the paper loading guide does not get dirty, and can be held in a sanitary manner.

In the present invention, the paper supply unit uses a rack-and-pinion mechanism to move the paper loading guide.

By the rack-and-pinion mechanism, the paper loading guide can be reliably exposed in a simple manner.

In the present invention, the paper supply unit includes a first movement mechanism configured to move the paper loading guide, and a second movement mechanism configured to move the first movement mechanism itself.

There is a probability that depending on the sizes of a toilet seat and a toilet bowl, a stroke is insufficient only by movement of the paper loading guide by means of the first movement mechanism. For this reason, the first movement mechanism itself is moved by the second movement mechanism. Thus, a region protruding to the side of the toilet seat can be reduced, and therefore, the stroke of the paper loading guide can be ensured. This contributes to size reduction of the buttocks wiping device.

In the present invention, the first movement mechanism uses the rack-and-pinion mechanism to move the paper loading guide, and the second movement mechanism uses the rack-and-pinion mechanism to move the first mechanism.

The first and second mechanisms form the rack-and-pinion mechanism so that the stroke can be ensured by a simple and reliable mechanism.

In the present invention, the first movement mechanism includes a motor configured to move the paper loading guide, and the second movement mechanism moves the first movement mechanism in association with rotation movement of the motor.

Movement by the first and second movement mechanisms can be realized by a single motor, leading to cost reduction.

In the present invention, the paper supply unit uses rotation of a screw shaft to move the paper loading guide.

By rotation of the screw shaft, the paper loading guide can be linearly moved. Thus, the paper loading guide can be reliably exposed below the buttocks.

In the present invention, the paper supply unit includes a paper supply roller configured to deliver the wiping material to the paper loading guide.

When the wiping material is delivered to the paper loading guide by means of the paper supply roller, the paper loading guide can be disposed below the toilet seat, for example. Moreover, the stroke of the paper loading guide can be small, leading to size reduction of the buttocks wiping device.

In the present invention, the buttocks wiping device further includes an automatic paper supply unit configured to set the wiping material onto the paper supply unit.

By use of the automatic paper supply unit for setting the wiping material onto the paper supply unit, the wiping material can be automatically supplied to the paper supply unit even in the case of a user with impairment in a hand.

In the present invention, the automatic paper supply unit cuts a long wiping material at a predetermined length, and sets the cut wiping material onto the paper supply unit.

The automatic paper supply unit can be implemented by a simple mechanism for cutting the long wiping material at the predetermined length.

In the present invention, the long wiping material is folded, and is housed in a paper stocker. The automatic paper supply unit cuts, at the predetermined length, the long wiping material housed in the paper stocker, and sets the cut wiping material onto the paper supply unit.

The long wiping material is folded and housed in the paper stocker so that the long wiping material can be not only housed compactly, but also a simple and reliable mechanism of the automatic paper supply unit can be provided. This contributes to practical use of the automatic paper supply unit.

In the present invention, the paper supply unit includes a paper supply sensor configured to detect whether or not the wiping material has been set.

The paper supply sensor can prevent malfunction that the paper loading guide moves despite the absence of the wiping material.

In the present invention, the paper supply unit includes a paper supply roller configured to deliver the wiping material, and a paper delivery sensor configured to detect whether or not the wiping material has been delivered from the paper supply roller.

The paper delivery sensor can prevent malfunction that the paper loading guide moves despite the absence of the wiping material.

In the present invention, the paper supply unit includes the paper supply sensor configured to detect whether or not the wiping material has been set. In a case where the paper delivery sensor does not detect delivery of the wiping material even after a lapse of a predetermined time after detection of the wiping material by the paper supply sensor, such a state is determined as an error.

When delivery of the wiping material is not detected even after a lapse of the predetermined time, there is a probability that the wiping material is jammed somewhere. For this reason, such a diagnosis function can be provided to notify such an error to the user, thereby clearing the error.

In the present invention, the paper supply unit includes a paper loading guide sensor configured to detect whether or not the wiping material is placed on the paper loading guide.

The paper loading guide sensor can prevent malfunction that the paper loading guide is exposed despite the absence of the wiping material.

In the present invention, the paper loading guide is returned to the retracted position in a case where the paper loading guide sensor detects that the wiping material is not placed.

For any reasons, there is a probability that the wiping material is detached from the paper loading guide in the course of exposure. When wiping is performed with the wiping material being detached, the pressing unit of the wiping arm directly contacts the buttocks. For this reason, in the case where the paper loading guide sensor detects, as described above, that the wiping material is not placed, the paper loading guide is returned to the retracted position so that such a situation can be avoided.

In the present invention, the paper loading guide has such a shape that the pressing unit can pass upward from below.

With such a shape, the pressing unit lifts the wiping material from the paper loading guide so that the wiping material can contact the buttocks.

When facing the toilet seat, the paper supply unit and the wiping arm drive unit are, in the present invention, on an identical side in the right-to-left direction or on opposite sides in the right-to-left direction.

As described above, a position relationship between the paper supply unit and the wiping arm drive unit is not specifically limited. As necessary, the position relationship may be properly designed according to, e.g., the shapes of the toilet seat and a warm-water cleansing device.

In the present invention, a plane including an opening for housing the paper supply unit is in a planer shape.

With the planer shape, the shape of an opening/closing unit can be simplified. This contributes to cost reduction of the buttocks wiping device.

In the present invention, the paper supply unit includes the paper supply roller configured to deliver the wiping material onto the paper loading guide, and a common motor is shared as a motor configured to expose the paper loading guide and a motor configured to rotate the paper supply roller.

Since the common motor is shared as the motor for the paper loading guide and the motor for the paper supply roller, a cost for a single motor can be reduced.

In the present invention, the paper supply unit exposes the paper loading guide by angular movement.

The method for exposing the paper loading guide includes not only exposure by linear movement but also exposure by angular movement. A proper exposure method can be selected as necessary. In the case of exposure by angular movement, it can be expected that a portion protruding to the side of the toilet bowl is reduced. This contributes to size reduction of the buttocks wiping device.

In the present invention, the paper supply unit includes, about a single shaft, a mechanism configured to angularly move the paper loading guide, and a mechanism configured to move the paper loading guide up and down.

Since the paper loading guide is, about the single shaft, moved angularly and moved up and down, the size of the buttocks wiping device can be not only reduced, but also the height of the paper loading guide can be adjusted. By adjustment of the height of the paper loading guide, contact of the paper loading guide with buttock muscles can be prevented even in a case where the buttock muscles are sagging from the toilet seat.

In the present invention, the paper supply unit uses, as the single shaft, a shaft provided with a screw groove and a spline shaft groove together, thereby performing angular movement and upper-to-lower movement of the paper loading guide.

Examples of the shaft provided with the screw groove and the spline shaft groove together include shafts in practical use, such as a ball screw spline. Desired angular movement and upper-to-lower movement can be realized with a reliable structure.

In the present invention, the paper supply unit is able to adjust the height of the paper loading guide by the mechanism for upper-to-lower movement.

In the present invention, the paper supply unit is able to adjust the height of the paper loading guide.

By adjustment of the height of the paper loading guide, contact of the paper loading guide with the buttock muscles can be prevented even in the case where the buttock muscles are sagging from the toilet seat.

In the present invention, the paper supply unit has a mechanism configured to adjust the height of the paper loading guide by rotation of the screw shaft.

Since the height of the paper loading guide is adjusted with a simple structure using rotation of the screw shaft, the cost of the buttocks wiping device can be reduced even with a height adjustment function.

In the present invention, the paper supply unit includes a movable portion configured to move together with the paper loading guide when the paper loading guide is exposed, and the paper loading guide is slidable on the movable portion.

The paper loading guide is slidable on the movable portion. Thus, even in a case where the stroke of the paper loading guide cannot be ensured, only the paper loading guide is, as in a drawer, slid on the movable portion so that the wiping material can be placed.

In the present invention, when the wiping arm is exposed, the wiping arm drive unit inclines the wiping arm downward such that the pressing unit is positioned below the paper loading guide.

By downward inclination of the wiping arm, the arrangement position of the paper loading guide can be lowered. Even for a user with buttock muscles sagging from the toilet bowl, contact of the paper loading guide with the user can be prevented.

In the present invention, the wiping arm drive unit includes a slidable movable portion, a sliding mechanism configured to slide the movable portion, a swingable portion fixed to the wiping arm and configured to slide in association with sliding of the movable portion, and a swinging mechanism configured to swing the swingable portion. The paper loading guide is attached to the movable portion, and is moved by the sliding mechanism.

With this structure, movement of the wiping arm and movement of the paper loading guide can be unified, and simplification of a drive mechanism can be expected.

In the present invention, a common motor is shared as a motor used for the sliding mechanism and a motor used for the swinging mechanism.

Thus, motor sharing can be realized as described above.

In the present invention, the wiping arm drive unit includes the slidable movable portion, the sliding mechanism configured to slide the movable portion, the swingable portion fixed to the wiping arm and configured to slide in association with sliding of the movable portion, and the swinging mechanism configured to swing the swingable portion. The paper supply unit includes a paper loading guide sliding mechanism separated from the movable portion and configured to slide the paper loading guide.

With this structure, only the paper supply unit can be moved separately from the movable portion. Thus, after the pressing unit has lifted the wiping material, only the paper loading guide can be retracted. Consequently, dropping of the wiping material after wiping is facilitated.

In the present invention, a common motor is shared as the motor used for the sliding mechanism, the motor used for the swinging mechanism, and a motor used for the paper loading guide sliding mechanism.

By employing such a mechanism, motor unification can be, in some cases, realized depending on a manufacturing cost. Moreover, significant cost reduction can be expected.

In the present invention, the paper supply unit includes the paper loading guide sliding mechanism configured to slide the paper loading guide.

The sliding mechanism can be employed as a section configured to move the paper loading guide.

In the present invention, the wiping arm drive unit includes the slidable movable portion, the sliding mechanism configured to slide the movable portion, the swingable portion fixed to the wiping arm and configured to slide in association with sliding of the movable portion, and the swinging mechanism configured to swing the swingable portion. The paper supply unit includes the paper loading guide swinging mechanism separated from the movable portion and configured to swing the paper loading guide.

The paper loading guide is swung so that the paper loading guide can face downward upon wiping. Thus, paper dropping is facilitated.

In the present invention, the paper supply unit includes a sensor configured to detect whether or not the paper loading guide has contacted the user, and in a case where the paper loading guide has contacted the user, stops or backwardly moves the paper loading guide.

In the case where the paper loading guide has contacted the user, such a structure avoids the processing from forcibly proceeding to the wiping operation.

The present invention relates to a paper supply device used for a buttocks wiping device for wiping the buttocks with a wiping material. The paper supply device is configured to expose the wiping material below a portion of the buttocks, the portion being to be wiped by a wiping arm configured to wipe the buttocks. The paper supply device further includes a paper loading guide configured to place the wiping material, and exposes the paper loading guide with the wiping material being placed on the paper loading guide.

The present specification also discloses the following aspects, and all of the aspects can contribute to practical use.

The present invention relates to a buttocks wiping device for wiping the buttocks with a wiping material. The buttocks wiping device includes a raised portion provided between a toilet bowl and a toilet seat, a wiping arm configured to use the wiping material to wipe the buttocks, and a wiping arm drive unit configured to cause the wiping arm to move and perform wiping operation. Part or entirety of the wiping arm drive unit is housed below the toilet seat in the raised portion.

Part or entirety of the wiping arm drive unit is housed in the raised portion, leading to size reduction of the entire device.

The present invention relates to a buttocks wiping device for wiping the buttocks with a wiping material. The buttocks wiping device includes a toilet seat, a wiping arm configured to use the wiping material to wipe the buttocks, and a wiping arm drive unit configured to cause the wiping arm to move and perform wiping operation. Part or entirety of the wiping arm drive unit is housed in the toilet seat.

Part or entirety of the wiping arm drive unit is housed in the toilet seat, leading to size reduction of the entire device.

The present invention relates to a buttocks wiping device for wiping the buttocks with a wiping material. The buttocks wiping device includes a wiping arm configured to use the wiping material to wipe the buttocks, and a wiping arm drive unit configured to cause the wiping arm to move and perform wiping operation. The wiping arm drive unit performs the wiping operation in such a manner that the wiping arm is angularly moved about a supporting point fixed at the side of a toilet seat such that a wiping portion of the wiping arm moves back and forth in the vicinity of the anus.

The wiping arm angularly moves about the supporting point fixed at the side of the toilet seat, leading to size reduction of the entire device.

For example, in comparison with the devices described in Patent Literatures 3 to 8 and 9 to 11, the wiping operation is performed in these devices by angular movement and exposure of the wiping arm after sliding. Thus, in the devices described in Patent Literatures 3 to 8, the motor for exposure is placed on the mechanism for sliding. The motor for exposure is configured to move on the mechanism for sliding. That is, only for the purpose of exposing the wiping arm, two motors including the motor for sliding and the motor for angular movement and exposure are provided. In addition, a crucial problem of the devices described in Patent Literatures 3 to 8 and 9 to 11 is that all of the motors are placed on the mechanism for sliding and the motor for moving the wiping arm up and down and the motor for rotating the wiping arm are placed on the motor for exposure by angular movement. That is, all of the motors are placed in series. Although multiaxial movement is realized, movement unnecessary for wiping of the buttocks is included. This is a primary cause for an increase in a cost and a device size. Needless to say, a motor generating a great torque needs to be used. Moreover, for realizing such complicated multiaxial movement, employment of a servomotor as the motor is more reliable. This also leads to a cost increase. Further, the wiping arm drive unit is provided at the side of the toilet seat. For this reason, the length of the wiping arm drive unit needs to be increased, and therefore, the motor generating the great torque is necessary.

In contrast, the structure has been fundamentally reviewed for the present invention. Thus, the motor for exposure is fixed, and the wiping arm is exposed by angular movement. Further, front-to-back wiping operation is also performed by means of the motor for exposure. When exposure and wiping can be realized by a single motor, more significant cost reduction can be realized by such a structure as compared to the conventional devices. Further, size reduction can be also realized.

The present invention relates to a buttocks wiping device including a wiping arm configured to wipe the buttocks with a wiping material. The wiping arm includes a wiping portion and a strut portion, and the strut portion is bent in advance.

With the strut portion bent in advance, the wiping portion can be held horizontal upon wiping. Moreover, the wiping portion can be moved to a higher position.

The present invention relates to a buttocks wiping device including a wiping arm configured to wipe the buttocks with a wiping material and a wiping arm drive unit configured to cause the wiping arm to move and perform wiping operation. The wiping arm drive unit has a mechanism configured to expose the wiping arm and move the wiping arm up and down by a single motor.

By the mechanism realizing exposure and upper-to-lower movement by the single motor, significant cost reduction and size reduction can be realized.

The present invention relates to a buttocks wiping device including a wiping arm configured to wipe the buttocks with a wiping material and a wiping arm drive unit configured to cause the wiping arm to move and perform wiping operation. The wiping arm drive unit includes, about a single shaft, a mechanism configured to angularly move the wiping arm and a mechanism configured to move the wiping arm up and down.

Angular movement and upper-to-lower movement about the single shaft are realized so that a common motor can be shared. This leads to significant cost reduction and size reduction.

In the present invention, the wiping arm drive unit uses, as the single shaft, a shaft provided with a screw groove and a spline shaft groove together, thereby performing angular movement and upper-to-lower movement of the wiping arm.

Such a shaft is in practical use as a ball screw spline, for example. This leads to reliable operation.

In the present invention, the wiping arm drive unit rotates a screw shaft to expose the wiping arm, and restricts movement of the wiping arm to move the wiping arm up and down along the screw shaft.

In the present invention, the wiping arm drive unit includes a restriction rod portion configured to restrict movement of the wiping arm, and a restriction rod drive unit configured to slide restriction rods.

In the present invention, the restriction rod portion includes the two restriction rods. Upon upper-to-lower movement of the wiping arm, the wiping arm is inserted between the two restriction rods, thereby moving up and down. The wiping arm is moved in such a manner that the wiping arm is slid on the two restriction rod portions with the wiping arm being inserted between the two restriction rod portions.

By such restriction, upper-to-lower movement and the wiping operation can be performed.

In the present invention, the mechanism for upper-to-lower movement by the wiping arm drive unit uses piston movement.

Needless to say, upper-to-lower movement can be performed by piston movement.

The present invention relates to a buttocks wiping device for wiping the buttocks with a wiping material. The buttocks wiping device includes a raised portion provided between a toilet bowl and a toilet seat, a wiping arm configured to use the wiping material to wipe the buttocks, and a wiping arm drive unit configured to cause the wiping arm to move and perform wiping operation. A wiping arm opening provided at the raised portion is provided with a dropping portion configured to contact the wiping material when the wiping arm is retracted.

For example, in the conventional devices described in Patent Literatures 3 to 8 and 9 to 11, the wiping arm is, for dropping the paper, rotated in an axial direction such that a tip end portion thereof faces downward. Thinking objectively, the paper can be, however, dropped without such a complicated mechanism. In the conventional devices described in Patent Literatures 3 to 8 and 9 to 11, such a thought is not taken into consideration at all, and desired operation is, in a direct way, realized merely using the plurality of motors. These devices have not been made based on an idea that use of the motors is avoided as much as possible for realizing operation. Thus, even if development is continued in the direction of the devices described in Patent Literatures 3 to 8 and 9 to 11, it is impossible to develop a device configured so that cost reduction and size reduction are realized with suitability for practical use and configured such that breakdown is less caused and maintenance is easily performed. It is vital for development of the buttocks wiping device to depart from the direction of the devices described in Patent Literatures 3 to 8 and 9 to 11. The present specification discloses various embodiments, and discloses, with flexible mindset, other embodiments than the direction of the devices described in Patent Literatures 3 to 8 and 9 to 11. The contents of description of the present specification is surely helpful in future development of the buttocks wiping device.

Specifically in the case of focusing on paper dropping, dropping can be performed even by a simple element such as the dropping portion. The present invention describes, throughout the present specification, that the attitude of simplifying elements as much as possible without reliance on motor driving in a case where these elements can be implemented using a simple mechanism is vital for cost reduction and size reduction. Since this invention is simple, a lack of the inventive step of the present invention tends to be argued against hindsight reasoning. However, as long as the present invention is not reviewed with sufficient understanding of a difficulty in arriving at such a perceptional change, the present invention is misjudged. A typical example is the dropping portion described herein. The dropping portion may be an originally-protruding portion or a portion configured to use, e.g., an electromagnetic solenoid to electrically protrude only for dropping the wiping material. With a pull-type electromagnetic solenoid, the dropping portion may be configured such that a rod-shaped member protrudes. With a swing-type electromagnetic solenoid, the dropping portion may be configured such that a plate-shaped member swings. The structure of the dropping portion is not limited.

The present invention relates to a buttocks wiping device including a wiping arm configured to wipe the buttocks with a wiping material and a wiping arm drive unit configured to cause the wiping arm to move and perform wiping operation. The wiping arm drive unit includes an exposure motor configured to expose the wiping arm through an opening of a toilet seat, and an upper-to-lower motor configured to move the wiping arm up and down upon exposure. The exposure motor is, without movement, fixed to the buttocks wiping device.

A point is that the exposure motor is fixed. In the conventional devices described in Patent Literatures 3 to 8 and 9 to 11, the mechanism for exposure is complicated. The wiping arm is slid by a slider once, and then, is exposed by angular movement. Since such operation is only for exposure of the wiping arm, all one have to do is exposure by the exposure motor as in the present invention. The present invention might be misjudged as long as the present invention is, without denying the inventive step of the present invention due to simplification, reviewed in terms of whether or not one has easily arrived at the present invention based on the conventional technologies.

In the present invention, the wiping arm drive unit uses rotation of the exposure motor to angularly move the upper-to-lower motor, thereby exposing the wiping arm.

By angular movement of the upper-to-lower motor, the wiping arm attached to the upper-to-lower motor is also angularly moved, and then, is exposed.

In the present invention, the wiping arm drive unit uses rotation of the exposure motor to slide the upper-to-lower motor, thereby exposing the wiping arm.

By sliding of the upper-to-lower motor, the wiping arm attached to the upper-to-lower motor is also slid, and then, is exposed.

In this aspect, the motor targeted for movement is only the upper-to-lower motor. A complicated mechanism that the plurality of motors move together as in the conventional devices of Patent Literatures 3 to 8 and 9 to 11 is not employed. Since the mechanism is simplified as described above, the present invention contributes to cost reduction, size reduction, easy maintenance, and less occurrence of breakdown.

The present invention relates to a buttocks wiping device including a wiping arm configured to wipe the buttocks with a wiping material and a wiping arm drive unit configured to cause the wiping arm to move and perform wiping operation. The wiping arm drive unit includes a sliding section configured to slide the wiping arm from a lateral side to a toilet seat opening when a toilet seat is viewed from the front, and an upper-to-lower motor attached to the sliding section to move the wiping arm up and down. The wiping arm is exposed in such a manner that the sliding section slides the upper-to-lower motor from the lateral side to the toilet seat opening.

In the present invention, exposure and upper-to-lower movement of the wiping arm are realized by sliding of the upper-to-lower motor, and therefore, wiping can be realized with a simple structure.

The present invention relates to a buttocks wiping device including a wiping arm configured to wipe the buttocks with a wiping material and a wiping arm drive unit configured to cause the wiping arm to move and perform wiping operation. A wiping portion of the wiping arm is held horizontal upon wiping.

Usually in the case of inclining the wiping arm upward, the wiping portion also inclines diagonally. When the wiping portion inclines diagonally, an area contacting the buttocks is small, leading to the probability of not sufficiently performing wiping. For this reason, in the present invention, the wiping portion of the wiping arm is held horizontal upon wiping, and therefore, the area contacting the buttocks is increased as much as possible. Consequently, wiping is sufficiently performed.

The present invention relates to a buttocks wiping device including a wiping arm configured to wipe the buttocks with a wiping material and a wiping arm drive unit configured to cause the wiping arm to move and perform wiping operation. A plane including an opening provided for housing the wiping arm is in a planer shape.

For waterproofing, an opening/closing unit is preferably provided at a wiping arm housing portion. However, when an opening of the opening/closing unit is in a curved shape, the structure of the opening/closing unit is inevitably complicated. For this reason, when the opening can be in the planer shape, the structure of the opening/closing unit can be simplified. Finally, cost reduction of the entire device can be realized.

The present invention relates to a buttocks wiping device including a wiping arm configured to wipe the buttocks with a wiping material and a wiping arm drive unit configured to cause the wiping arm to move and perform wiping operation. The wiping arm drive unit performs torque control or torque limitation for a motor configured to drive the wiping arm, thereby controlling the force of contact of the wiping arm with the buttocks.

Considering the feeling of wiping and safety, the force of contact of a wiping portion with the buttocks is preferably controlled. Contact with great fore might lead to an injury, and therefore, is not proper. Contact with small force might lead to unsatisfaction of wiping. For this reason, control is made by contact force control (controlling a torque to fall within a certain range) or contact force limitation (controlling the torque not to be equal to greater than an upper limit). This leads to improvement of the safety and the feeling of wiping.

The present invention relates to a buttocks wiping device for wiping the buttocks with a wiping material. The buttocks wiping device includes a raised portion provided between a toilet bowl and a toilet seat, a wiping arm configured to use the wiping material to wipe the buttocks, and a wiping arm drive unit configured to cause the wiping arm to move and perform wiping operation. Part or entirety of the wiping arm drive unit is housed below a warm-water cleansing device in the raised portion.

When part or entirety of the wiping arm drive unit can be housed below the warm-water cleansing device in the raised portion, the volume of a device portion protruding from the side of the toilet seat can be decreased. This leads to size reduction of the entire device.

The present invention relates to a buttocks wiping device including a wiping arm configured to wipe the buttocks with a wiping material and a wiping arm drive unit configured to cause the wiping arm to move and perform wiping operation. The wiping arm drive unit includes a slidable movable portion, a sliding mechanism configured to slide the movable portion, a swingable portion fixed to the wiping arm and configured to slide in association with sliding of the movable portion, and a swinging mechanism configured to swing the swingable portion.

In the present invention, the wiping arm is fixed to the swingable portion configured to slide in association with sliding of the movable portion. Moreover, the swingable portion can be swung by the swinging mechanism. Thus, the wiping arm can be exposed by the movable portion, and can be moved up and down by the swingable portion. Such a mechanism is not only a mechanism having not been conventionally provided at all, but also a mechanism useful for size reduction of the entire device and reliable wiping.

In the present invention, part or entirety of the movable portion, the sliding mechanism, the swingable portion, and the swinging mechanism is provided below the warm-water cleansing device, provided in the raised portion, or provided in the toilet seat.

This leads to size reduction of the entire device.

In the present invention, a common motor is shared as a motor used for the sliding mechanism and a motor used for the swinging mechanism.

In the case of using the movable portion, the sliding mechanism, the swingable portion, and the swinging mechanism as described above, such a structure can be implemented by, e.g., a linear drive mechanism combined with a sliding screw, a spline shaft, etc. Thus, the common motor can be shared by switching using an electromagnetic clutch etc., for example. As a result, this leads to cost reduction of the device.

In the present invention, a slide-type opening/closing unit configured to slide in association with sliding of the movable portion is provided.

With this structure, the opening/closing unit can be opened/closed by sliding together with sliding of the movable portion. Thus, it is not necessary to separately provide the mechanism for opening/closing. As a result, this leads to cost reduction of the device.

In the present invention, a hinge-type opening/closing unit is provided, and the movable portion includes a press-down portion configured to hold the hinge-type opening/closing unit in an opened state upon exposure of the wiping arm.

In the case of exposing the wiping arm by the movable portion, there is a probability that the hinge-type opening/closing unit perpendicular to the slide-type opening/closing unit is closed. For this reason, the press-down portion is provided at the movable portion, and therefore, it is not necessary to separately provide the mechanism for opening/closing the hinge-type opening/closing unit. As a result, this leads to cost reduction of the device.

The present invention relates to a buttocks wiping device including a wiping arm configured to wipe the buttocks with a wiping material and a wiping arm drive unit configured to cause the wiping arm to move and perform wiping operation. The wiping arm exhibits flexibility.

For example, when a strut portion or a wiping portion of the wiping arm can be flexible, the wiping arm can deform to fit the shape of the buttocks upon contact with the buttocks. Thus, the feeling of wiping is improved.

The present invention relates to a buttocks wiping device including a wiping arm configured to wipe the buttocks with a wiping material and a wiping arm drive unit configured to cause the wiping arm to move and perform wiping operation. A wiping portion of the wiping arm exhibits flexibility.

When the wiping portion of the wiping arm can be flexible, the wiping portion can deform to fit the shape of the vicinity of the anus. Thus, the feeling of wiping is improved.

The present invention relates to a buttocks wiping device including a wiping arm configured to wipe the buttocks with a wiping material and a wiping arm drive unit configured to cause the wiping arm to move and perform wiping operation. The buttocks wiping device further includes a paper supply unit having a roller configured to deliver the wiping material onto a wiping portion of the wiping arm.

When the wiping material can be delivered to the wiping portion by the roller, the wiping arm can be in such a state that the wiping arm is in a raised portion, for example. This leads to size reduction of the entire device.

In the present invention, the buttocks wiping device further includes an automatic paper supply unit configured to insert the wiping material into the paper supply unit.

With this structure, a user does not necessarily insert the wiping material into the paper supply unit, and therefore, convenience is improved.

In the present invention, the paper supply unit delivers the wiping material onto the wiping portion such that the wiping material hangs down in front of the wiping portion.

With this structure, the wiping material can be reliably placed on the wiping portion.

In the present invention, the paper supply unit includes a cutting unit configured to cut, at a predetermined length, a long wiping material delivered by the roller.

With this structure, the wiping material can be automatically supplied.

In the present invention, the paper supply unit further includes a movable delivery unit, and the delivery unit moves in association with rotation of the roller to place the wiping material onto the wiping portion.

With this structure, the wiping material can be automatically placed on the wiping portion.

The present invention relates to a buttocks wiping device including a wiping arm configured to wipe the buttocks with a wiping material and a wiping arm drive unit configured to cause the wiping arm to move and perform wiping operation. The buttocks wiping device further includes a negative pressure generation device configured to generate a negative pressure. A wiping portion of the wiping arm is provided with a hole communicating with the negative pressure generation device.

With this structure, the wiping material is sucked, and therefore, dropping of the wiping material from the wiping portion can be prevented.

The present invention relates to a buttocks wiping device including a wiping arm configured to wipe the buttocks with a wiping material and a wiping arm drive unit configured to cause the wiping arm to move and perform wiping operation. The buttocks wiping device further includes a positive pressure generation device configured to generate a positive pressure. A wiping portion of the wiping arm is provided with a hole communicating with the positive pressure generation device.

With this structure, the wiping material can be blown off by the positive pressure, and therefore, dropping of the wiping material is facilitated.

The present invention relates to a buttocks wiping device including a wiping arm configured to wipe the buttocks with a wiping material and a wiping arm drive unit configured to cause the wiping arm to move and perform wiping operation. The buttocks wiping device further includes a positive pressure generation device configured to generate a positive pressure. A wiping portion of the wiping arm communicates with the positive pressure generation device, and is expandable by the positive pressure from the positive pressure generation device.

With this structure, the wiping portion is expanded by the positive pressure so that an area contacting the buttocks can be increased. Thus, reliable wiping can be expected. In this case, the wiping portion is not always disposable, and the wiping material may be separately placed on the wiping portion. Moreover, the wiping portion may be disposable.

The present invention relates to a buttocks wiping device including a wiping arm configured to wipe the buttocks with a wiping material and a wiping arm drive unit configured to cause the wiping arm to move and perform wiping operation. The wiping arm drive unit includes a link mechanism configured to move the wiping arm.

By the link mechanism, the position of the wiping arm can be fine-adjusted.

In the present invention, the wiping arm includes an extendable portion coupled to a rotary shaft of an upper-to-lower motor configured to swing the wiping arm up and down and to the wiping arm, and the extendable portion extends/contracts according to the track of a free end of the link mechanism.

By use of the extendable portion and the link mechanism, the length of the wiping arm can be adjusted.

In the present invention, when a pressing unit moves upward, the extendable portion extends such that a wiping portion of the wiping arm moves straight up.

One of advantageous effects provided by use of the link mechanism is that the wiping portion can be moved straight up. This allows wiping at a center portion regardless of an individual difference in the position of the user's anus.

In the present invention, when the wiping arm is exposed or retracted, the extendable portion extends/contracts to perform position adjustment of the wiping portion of the wiping arm.

One of the advantageous effects provided by use of the link mechanism is that the wiping arm is extended/contracted so that the position of the wiping portion of the wiping arm can be adjusted. In a case where collision is caused due to a space upon retraction of the wiping arm, the wiping arm is, for retraction, slightly contracted by the link mechanism.

The present invention relates to a buttocks wiping device including a wiping arm configured to wipe the buttocks with a wiping material and a wiping arm drive unit configured to cause the wiping arm to move and perform wiping operation. In the wiping arm, a wiping portion for wiping the buttocks with the wiping material is swingably attached.

The wiping portion such as a pressing unit is swingably attached to the wiping arm. Thus, when the wiping portion contacts the buttocks, the wiping portion can be held horizontal, and the inclination angle of the wiping portion can be automatically adjusted according to the shape of the buttocks. This improves the feeling of wiping.

The present invention relates to a buttocks wiping device including a wiping arm configured to wipe the buttocks with a wiping material and a wiping arm drive unit configured to cause the wiping arm to move and perform wiping operation. The buttocks wiping device further includes a sterilization/cleansing arm configured to spray a sterilization and/or cleansing solution. The sterilization/cleansing arm is exposed separately from the wiping arm, and sterilize and/or cleanse a wiping portion of the wiping arm.

As described above, the sterilization/cleansing arm is used separately from the wiping arm, and therefore, the wiping portion is cleansed/sterilized after these two arms have been exposed. Thus, there is almost no need of consideration on waterproofing of a sterilization/cleansing device provided in a raised portion.

The present invention relates to a buttocks wiping device including a wiping arm configured to wipe the buttocks with a wiping material and a wiping arm drive unit configured to cause the wiping arm to move and perform wiping operation. The buttocks wiping device includes, at a lid of a toilet seat, a nozzle configured to spray a sterilization and/or cleansing solution.

With the nozzle provided at the lid of the toilet seat, it is not necessary to provide a cleansing/sterilization device in a raised portion or to use a sterilization/cleansing arm. Thus, sterilization/cleansing can be performed in an extremely-simple manner. As a result, this leads to cost reduction of the device.

The present invention relates to a buttocks wiping device including a wiping arm configured to wipe the buttocks with a wiping material and a wiping arm drive unit configured to cause the wiping arm to move and perform wiping operation. The buttocks wiping device further includes a raised portion provided between a toilet bowl and a toilet seat. A wiping portion of the wiping arm is housed in a sterilization and/or cleansing unit provided in the raised portion, and therefore, the wiping portion is sterilized and/or cleansed.

With this structure, the wiping portion can be sterilized/cleansed upon housing of the wiping arm, leading to improvement of convenience.

In the present invention, the sterilization and/or cleansing unit is configured to spray a sterilization and/or cleansing solution, and has such a shape that the sprayed sterilization and/or cleansing solution flows down to a toilet bowl side.

This allows the solution to naturally flow down, leading to enhancement of a waterproofing effect.

In the present invention, the wiping arm includes a defensive barrier configured to prevent the sterilization and/or cleansing solution from entering the wiping arm drive unit.

This enhances the waterproofing effect.

In the present invention, the sterilization and/or cleansing unit is detachable.

With this structure, the device for cleansing/sterilization can be optionally detached.

In the present invention, the sterilization and/or cleansing unit mixes the sterilization and/or cleansing solution accumulated in a tank with water from a tap water pipe, thereby spraying the resultant solution to the wiping portion.

By such mixing with the water, the tank for the sterilization and/or cleansing solution can be downsized, leading to size reduction of the entire device.

In the present invention, the sterilization and/or cleansing unit sprays the water from the tap water pipe to the wiping portion.

This allows cleansing with the water.

The present invention relates to a buttocks wiping device including a wiping arm configured to wipe the buttocks with a wiping material and a wiping arm drive unit configured to cause the wiping arm to move and perform wiping operation. In a case where a toilet seat is not lowered, the buttocks wiping device is not operated.

When the buttocks wiping device is driven with the toilet seat being lifted, it is dangerous because the wiping arm pushes a user with force more than necessary. For this reason, when the buttocks wiping device can be configured not to operate in the case where the toilet seat is not lowered, safety is enhanced.

The present invention relates to an automatic paper supply device used for a buttocks wiping device including a wiping arm configured to wipe the buttocks with a wiping material and a wiping arm drive unit configured to cause the wiping arm to move and perform wiping operation. The automatic paper supply device includes a paper stocker portion configured to house a long wiping material in a folded state, and a cutting unit configured to cut the long wiping material at a predetermined length.

When the long wiping material can be housed in the folded state, the wiping material can be compactly housed, leading to size reduction of the entire device.

The present invention relates to an automatic paper supply device used for a buttocks wiping device including a wiping arm configured to wipe the buttocks with a wiping material and a wiping arm drive unit configured to cause the wiping arm to move and perform wiping operation. The automatic paper supply device includes a paper stocker portion configured to house a stack of multiple wiping material pieces cut to a predetermined shape in advance, a paper feeding roller configured to deliver one of the wiping material pieces housed in the paper stocker portion, and a drive unit configured to upwardly move, by a single piece, the wiping material housed in the paper stocker portion.

The wiping material is soft, and for this reason, a design needs to be made to deliver a single piece. When the wiping material can be moved upward by a single piece as described above, only the uppermost piece can be reliably delivered. Thus, an automatic paper supply device suitable for practical use can be provided.

In the present invention, a slide is provided, which is configured to slide the wiping material delivered by the paper feeding roller to place the wiping material on a wiping portion of the wiping arm.

By the slide, the wiping material can be, after delivered, automatically placed on the wiping portion.

The present invention relates to an automatic paper supply device used for a buttocks wiping device including a wiping arm configured to wipe the buttocks with a wiping material and a wiping arm drive unit configured to cause the wiping arm to move and perform wiping operation. The automatic paper supply device includes a paper stocker portion configured to house a stack of multiple wiping material pieces cut to a predetermined shape in advance, and a paper feeding roller configured to deliver one of the wiping material pieces housed in the paper stocker portion.

When the paper feeding roller configured to deliver a single wiping material piece can be used, only the uppermost piece can be delivered. Thus, an inexpensive automatic paper supply device suitable for practical use can be provided.

In the present invention, the paper stocker portion has a friction plate provided below a leading end portion of the stack of multiple wiping material pieces.

Friction between the wiping material and the friction plate is greater than friction between adjacent ones of the wiping material pieces. Moreover, friction between the wiping material and the paper feeding roller is greater than friction between adjacent ones of the wiping material pieces. As a result, only the uppermost piece can be delivered by the paper feeding roller. Thus, an inexpensive automatic paper supply device suitable for practical use can be provided.

The present invention relates to an automatic paper supply device used for a buttocks wiping device including a wiping arm configured to wipe the buttocks with a wiping material and a wiping arm drive unit configured to cause the wiping arm to move and perform wiping operation. The automatic paper supply device includes a paper stocker portion configured to house a stack of multiple wiping material pieces cut to a predetermined shape in advance, and a holding unit configured to hold one of the wiping material pieces housed in the paper stocker portion.

The wiping material is soft, and for this reason, a design needs to be made to take out only a single piece. When the holding unit can be used as described above, only a single piece can be reliably taken out.

The present invention relates to a wiping arm used for a buttocks wiping device for wiping the buttocks with a wiping material. The wiping arm is formed by pressing a water-soluble or water-degradable material.

When the wiping arm can be formed by pressing the water-soluble or water-degradable material, the wiping arm is disposable. Thus, sanitation of a wiping portion of the wiping arm does not need to be taken into consideration.

In the present invention, the wiping arms can be stacked on each other in the upper-to-lower direction.

With this structure, the disposable wiping arms can be compactly housed, leading to size reduction of the entire device.

The present invention relates to a wiping material used for a buttocks wiping device. The buttocks wiping device has a pressing unit configured to press the wiping material against the buttocks. As viewed in the plan, the wiping material is larger than the pressing unit, and has a predetermined shape.

By use of such a wiping material, moisture etc. can be wiped in a sanitary manner across a wide area without the moisture etc. adhering to the pressing unit.

The present invention relates to a wiping material used for a buttocks wiping device. The buttocks wiping device has a pressing unit configured to press the wiping material against the buttocks. In a state in which multiple wiping material pieces are stacked on each other in the upper-to-lower direction, the wiping material pieces are at least partially joined together in the upper-to-lower direction.

The wiping material joined in the upper-to-lower direction can have a certain thickness, and can be provided at low cost. Thus, such a wiping material is useful.

The present invention relates to the method for manufacturing a wiping material used for a buttocks wiping device. The method includes the step of delivering rolled paper, the step of folding the delivered rolled paper, the step of cutting the rolled paper, and the step of joining the folded rolled paper.

A method in which the rolled paper is folded and joined as described herein is first conceivable as the method for manufacturing the wiping material. In the case of this method, the step of folding the rolled paper is necessary, but a manufacturing device itself can be downsized.

The present invention relates to the method for manufacturing a wiping material used for a buttocks wiping device. The method includes the step of stacking multiple pieces of rolled paper on each other, the step of joining the stack of rolled paper, and the step of cutting the stack of rolled paper.

In the wiping material manufacturing method described herein, the stack of multiple pieces of rolled paper is joined and cut, and therefore, a folding step is not necessary. A folding accuracy does not need to be taken into consideration, and therefore, high-accuracy manufacturing for wiping can be performed.

The present invention relates to the method for manufacturing a wiping material used for a buttocks wiping device. The method includes the step of stacking multiple pieces of rolled paper on each other, the step of bonding the stack of rolled paper, and the step of cutting the stack of rolled paper.

In the wiping material manufacturing method described herein, the stack of multiple pieces of rolled paper is bonded and cut, and therefore, a folding step is not necessary. A folding accuracy does not need to be taken into consideration, and therefore, high-accuracy manufacturing for wiping can be performed.

The present invention relates to the method for manufacturing a wiping material used for a buttocks wiping device. The method includes the step of stacking multiple wiping material pieces on each other, and the step of joining the stack of wiping material pieces.

In the wiping material manufacturing method described herein, the stack of multiple wiping material pieces is merely joined, and therefore, a folding step is not necessary. A folding accuracy does not need to be taken into consideration, and therefore, high-accuracy manufacturing for wiping can be performed.

The present invention relates to a buttocks wiping tool including a wiping arm configured to wipe the buttocks with a wiping material, and a wiping arm movement section for wiping operation performed in such a manner that a user exposes the wiping arm through a toilet bowl opening and moves the wiping arm up and down.

Although wiping is manually performed, the buttocks can be wiped in a simple manner by means of such a buttocks wiping tool. For example, in a case where when a caregiver wipes the buttocks of a nursing target such as a user having a difficulty in getting up one's backside, it is hard to lift the nursing target, the buttocks can be sufficiently wiped even by such a simple manual buttocks wiping tool.

The present invention relates to a wiping material used specially for any of the above-described buttocks wiping devices and the above-described buttocks wiping tool.

Other various solutions are also stated in the present specification.

Advantageous Effects of the Invention

When the wiping material is not attached or inserted to the wiping arm, the mechanism for such attachment or insertion is not necessary, and therefore, the buttocks wiping tool can be simplified by such a mechanism. This leads to cost reduction and easy maintenance. For example, the pressing unit may be configured to exhibit friction, or may be in a less-droppable shape.

In a case where the wiping arm is exposed with the wiping material being placed on the pressing unit, there is a probability that the wiping material is unexpectedly dropped or becomes unsanitary due to adhering of moisture etc. in the middle of exposure. However, when the paper supply unit configured to expose the wiping material below the buttocks can be used separately from the wiping arm such that the pressing unit pushes up the exposed wiping material from below, a situation where the wiping material is dropped in the middle of movement of the wiping arm or dirt adheres to the wiping material can be avoided. Thus, a sanitary user-friendly buttocks wiping device can be provided. Since a simple mechanism for exposing the paper loading guide can be used as the paper supply unit, entire device simplification, cost reduction, and easy maintenance can be realized.

Since part or entirety of the wiping arm drive unit is housed below the toilet seat in the raised portion, the size of the entire device can be reduced. Similarly, it is effective to house part or entirety of the wiping arm drive unit in the toilet seat.

The wiping arm drive unit angularly moves the wiping arm about the supporting point fixed at the side of the toilet seat such that the wiping portion of the wiping arm moves back and forth in the vicinity of the anus, thereby performing the wiping operation. Thus, exposure of the wiping arm and wiping can be realized by a simple mechanism. Consequently, the buttocks wiping device can be provided, which is configured so that structure simplification, cost reduction, usability, and easy maintenance can be realized.

Since the strut portion of the wiping arm is bent in advance, the wiping portion can be held horizontal upon wiping. Moreover, the wiping portion can be moved to a higher position. Thus, improvement of the feeling of wiping can be expected.

Since the wiping arm drive unit includes the mechanism configured to realize exposure and upper-to-lower movement of the wiping arm by the single motor, structure simplification and cost reduction can be expected.

Since the wiping arm drive unit includes, about the single shaft, the mechanism configured to angularly move the wiping arm and the mechanism configured to move the wiping arm up and down, structure simplification and cost reduction can be expected.

Since the dropping portion configured to contact the wiping material when the wiping arm is retracted is provided at the wiping arm opening provided at the raised portion, it is not necessary to separately provide the mechanism for dropping the wiping material. This can realize significant structure simplification, cost reduction, usability, and easy maintenance.

The wiping arm drive unit includes the exposure motor for exposing the wiping arm through the toilet seat opening, and the upper-to-lower motor for moving the wiping arm up and down upon exposure. The exposure motor is, without movement, fixed to the buttocks wiping device. This can realize structure simplification, cost reduction, usability, and easy maintenance.

The wiping arm drive unit includes the sliding section configured to slide the wiping arm from the lateral side to the toilet seat opening when the toilet seat is viewed from the front, and the upper-to-lower motor attached to the sliding section to move the wiping arm up and down. The wiping arm is exposed in such a manner that the sliding section slides the upper-to-lower motor from the lateral side to the toilet seat opening. This can realize structure simplification, cost reduction, usability, and easy maintenance.

The wiping portion of the wiping arm is held horizontal upon wiping, and therefore, the area of the wiping portion contacting the buttocks is increased. Consequently, wiping is sufficiently performed.

The plane including the opening provided for housing the wiping arm is in the planer shape. Thus, the structure of the opening/closing unit is simplified. As a result, the buttocks wiping device can be provided, which is configured so that structure simplification, cost reduction, sanitation, usability, and easy maintenance can be realized.

The wiping arm drive unit performs the torque control or the torque limitation for the motor configured to drive the wiping arm, thereby controlling the force of contact of the wiping portion with the buttocks. Thus, the feeling of wiping and safety can be improved.

Part or entirety of the wiping arm drive unit is housed below the warm-water cleansing device in the raised portion. Thus, the size of the entire device can be reduced.

The wiping arm drive unit includes the slidable movable portion, the sliding mechanism configured to slide the movable portion, the swingable portion fixed to the wiping arm and configured to slide in association with sliding of the movable portion, and the swinging mechanism configured to swing the swingable portion. Thus, the size of the entire device can be reduced while reliable wiping can be realized.

The strut portion of the wiping arm is configured flexible, or the wiping portion of the wiping arm is configured flexible. Thus, the feeling of wiping can be improved.

The roller configured to deliver the wiping material onto the wiping portion of the wiping arm is provided so that the wiping material can be delivered to the wiping portion. For example, the wiping arm can be in such a state that the wiping arm is in the raised portion, for example. This leads to size reduction of the entire device.

When the wiping material can be sucked by the negative pressure generation device, dropping of the wiping material from the wiping portion can be prevented. Moreover, when the wiping material can be blown off by the positive pressure generation device, the wiping material can be reliably dropped.

When the wiping portion configured to expand by the positive pressure generation device can be used, the area closely contacting the buttocks can be increased. Thus, reliable wiping can be expected. Moreover, the wiping portion can be configured disposable.

When the wiping arm drive unit can include the link mechanism for moving the wiping arm, the position of the wiping arm can be fine-adjusted. Thus, the wiping portion can be moved straight up, and the wiping arm can be contracted upon retraction.

The wiping portion such as the pressing unit is swingably attached to the wiping arm. Thus, when the wiping portion contacts the buttocks, the wiping portion can be held horizontal, and the inclination angle of the wiping portion can be automatically adjusted according to the shape of the buttocks. This improves the feeling of wiping.

The sterilization/cleansing arm is used separately from the wiping arm, and therefore, the wiping portion is cleansed/sterilized after these two arms have been exposed. Thus, there is almost no need of consideration on waterproofing of the sterilization/cleansing device provided in the raised portion. Moreover, when the nozzle can be provided at the lid of the toilet seat, it is not necessary to provide the cleansing/sterilization device in the raised portion or to use the sterilization/cleansing arm. Thus, sterilization/cleansing can be performed in an extremely-simple manner. Moreover, when the sterilization/cleansing unit can be provided in the raised portion, sterilization/cleansing can be performed upon retraction. This improves convenience.

When the buttocks wiping device can be configured not to operate in the case where the toilet seat is not lowered, safety is enhanced.

By the automatic paper supply device including the paper stocker portion configured to house the long wiping material in the folded state and the cutting unit configured to cut the long wiping material at the predetermined length, the wiping material can be compactly housed.

By the automatic paper supply device including the drive unit configured to upwardly move, by a single piece, the wiping material housed in the paper stocker portion, only the uppermost piece can be reliably fed. Thus, an automatic paper supply device suitable for practical use can be provided.

By the automatic paper supply device including the paper feeding roller configured to deliver one of the wiping material pieces housed in the paper stocker portion, only the uppermost piece can be fed. Thus, an inexpensive automatic paper supply device suitable for practical use can be provided.

By the automatic paper supply device including the holding unit configured to hold one of the wiping material pieces housed in the paper stocker portion, only the uppermost piece can be reliably fed. Thus, an automatic paper supply device suitable for practical use can be provided.

When the wiping arm formed by pressing the water-soluble or water-degradable material can be used, the wiping arm can be thrown away after use. Thus, sanitation does not need to be taken into consideration.

When the wiping material can be formed larger than the pressing unit and be formed to have the predetermined shape, the moisture etc. can be wiped in a sanitary manner across a wide area without the moisture etc. adhering to the pressing unit.

The wiping material joined in the upper-to-lower direction can have a certain thickness, and can be provided at low cost. Thus, such a wiping material is useful.

According to the wiping material manufacturing method of the present invention, a simple buttocks wiping device with a high dimension accuracy can be manufactured.

As described above, the aspects of the invention described in the present specification can be combined as necessary to provide the buttocks wiping device configured so that structure simplification, cost reduction, sanitation, usability, and easy maintenance can be realized and to provide the commercializable buttocks wiping device.

These objectives, features, aspects, and advantageous effects of the present invention and other objectives, features, aspects, and advantageous effects of the present invention will become more apparent from the following detailed description with reference to the attached drawings.

BRIEF DESCRIPTION OF THE DRAWINGS

FIG. 106B is a block diagram of a functional configuration of the buttocks wiping device 1;

FIG. 107 is a view when a wiping arm 4 is rotatable at a bending position 26;

Figure 108:
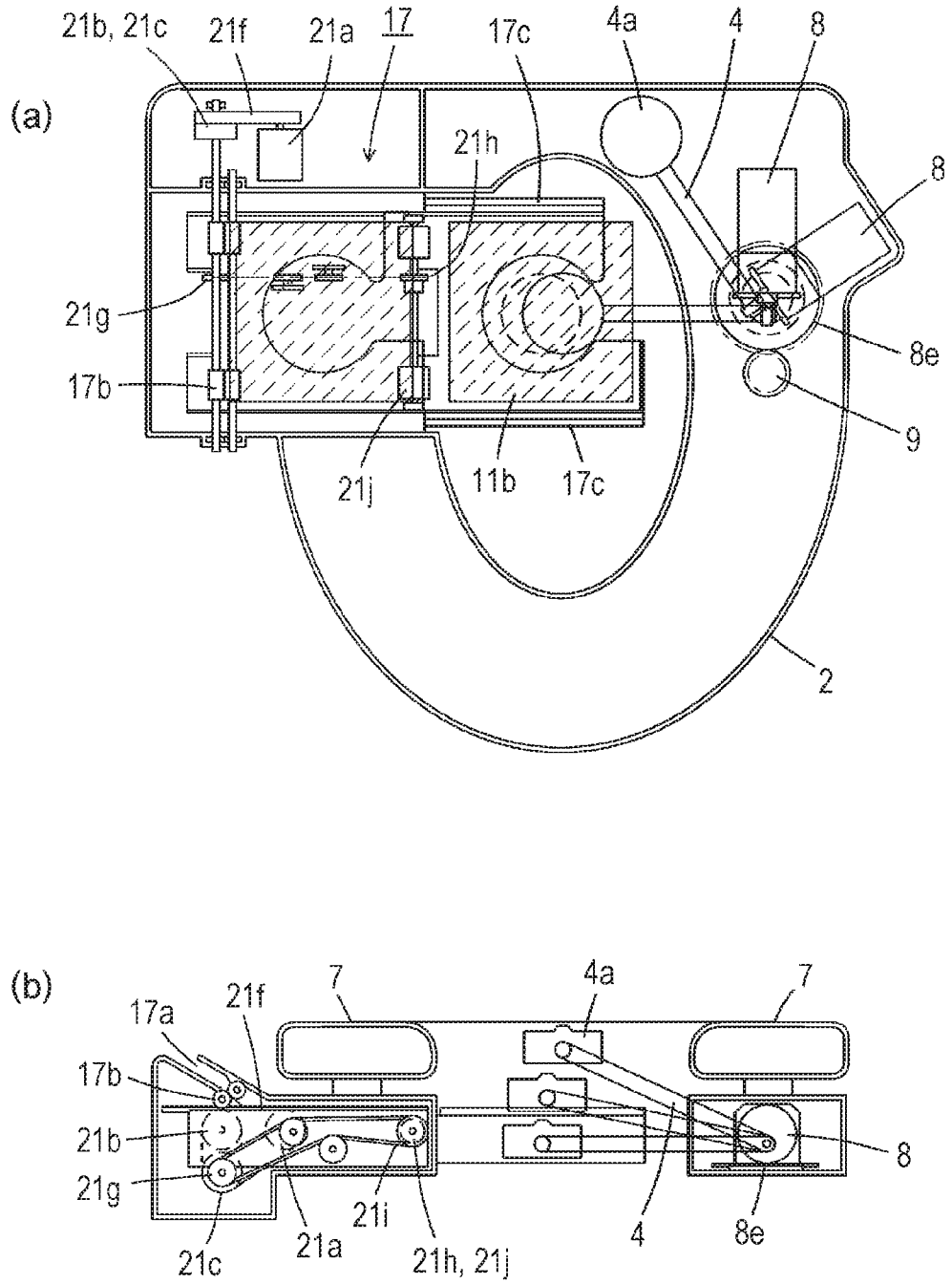
Figure 109:
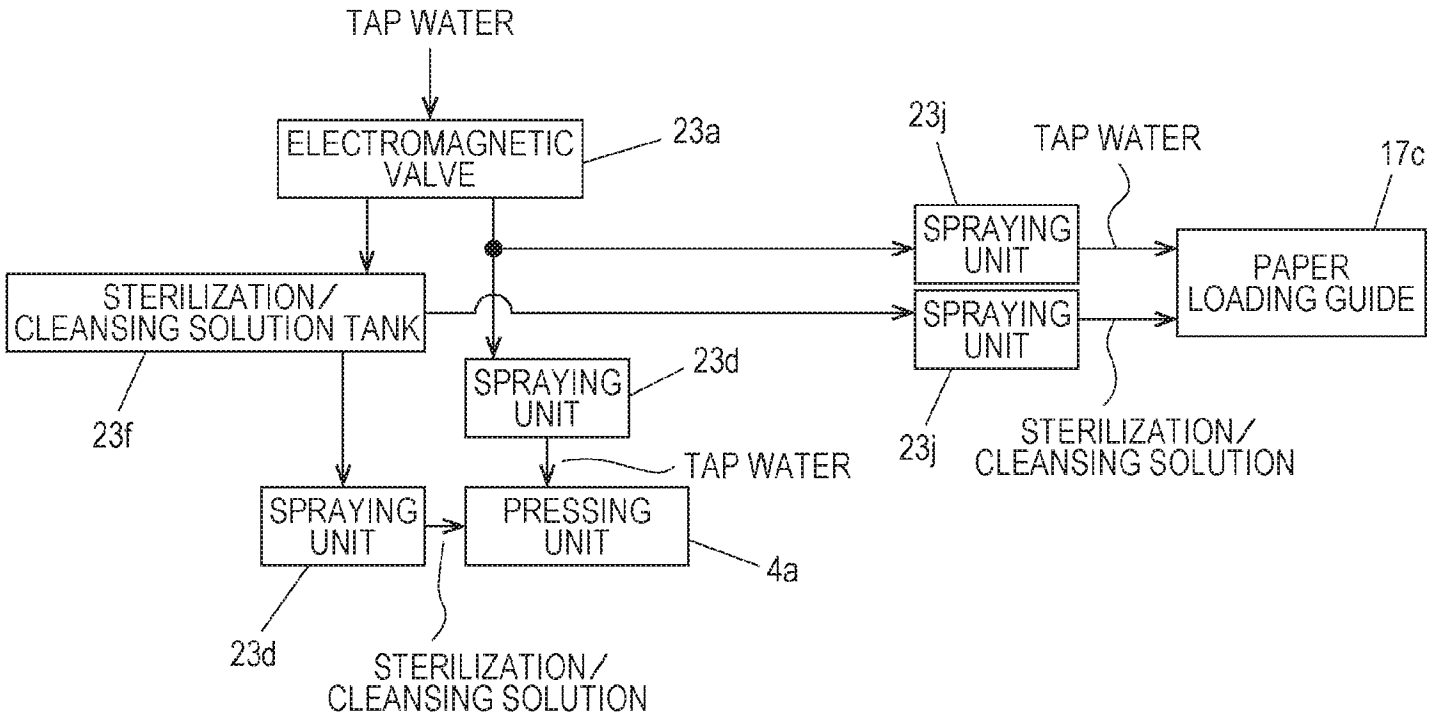
Figure 110:
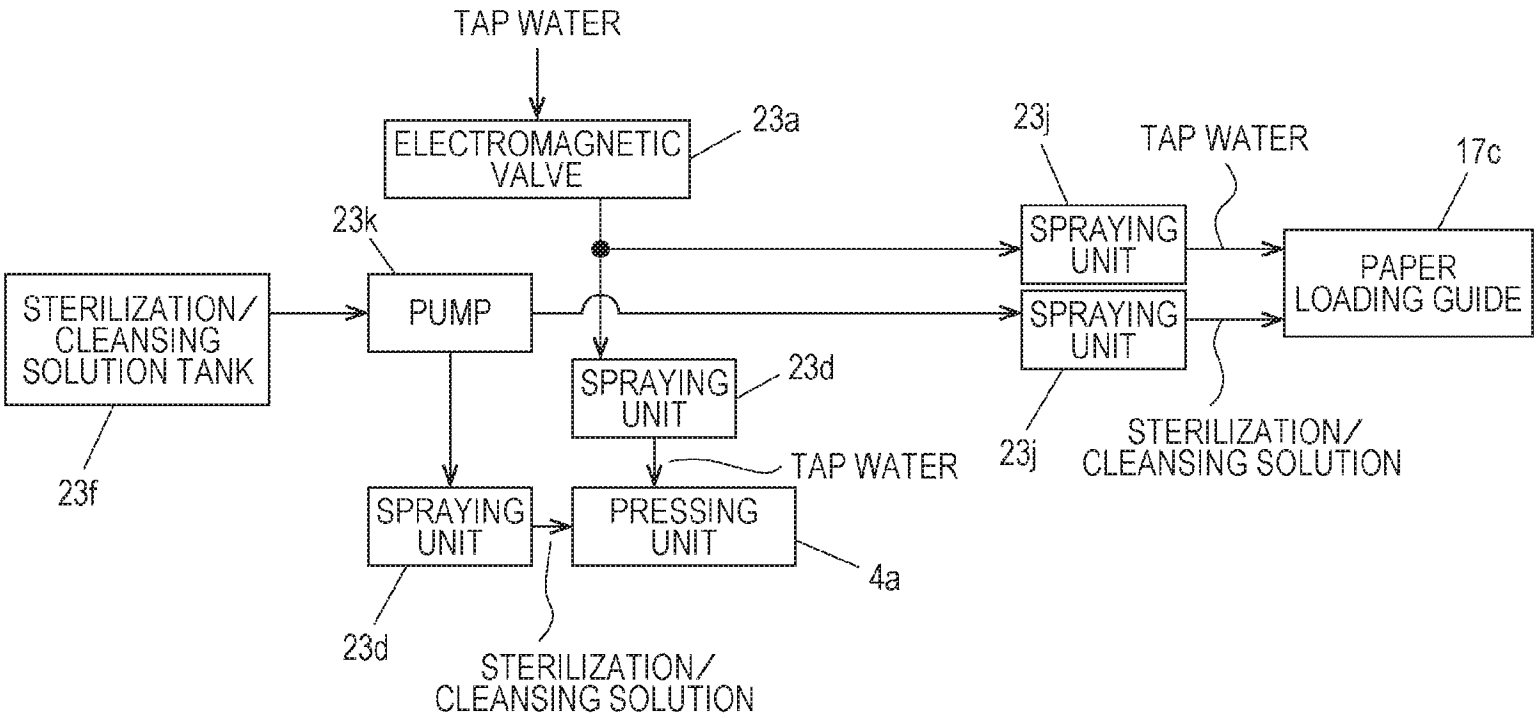
Figure 111:
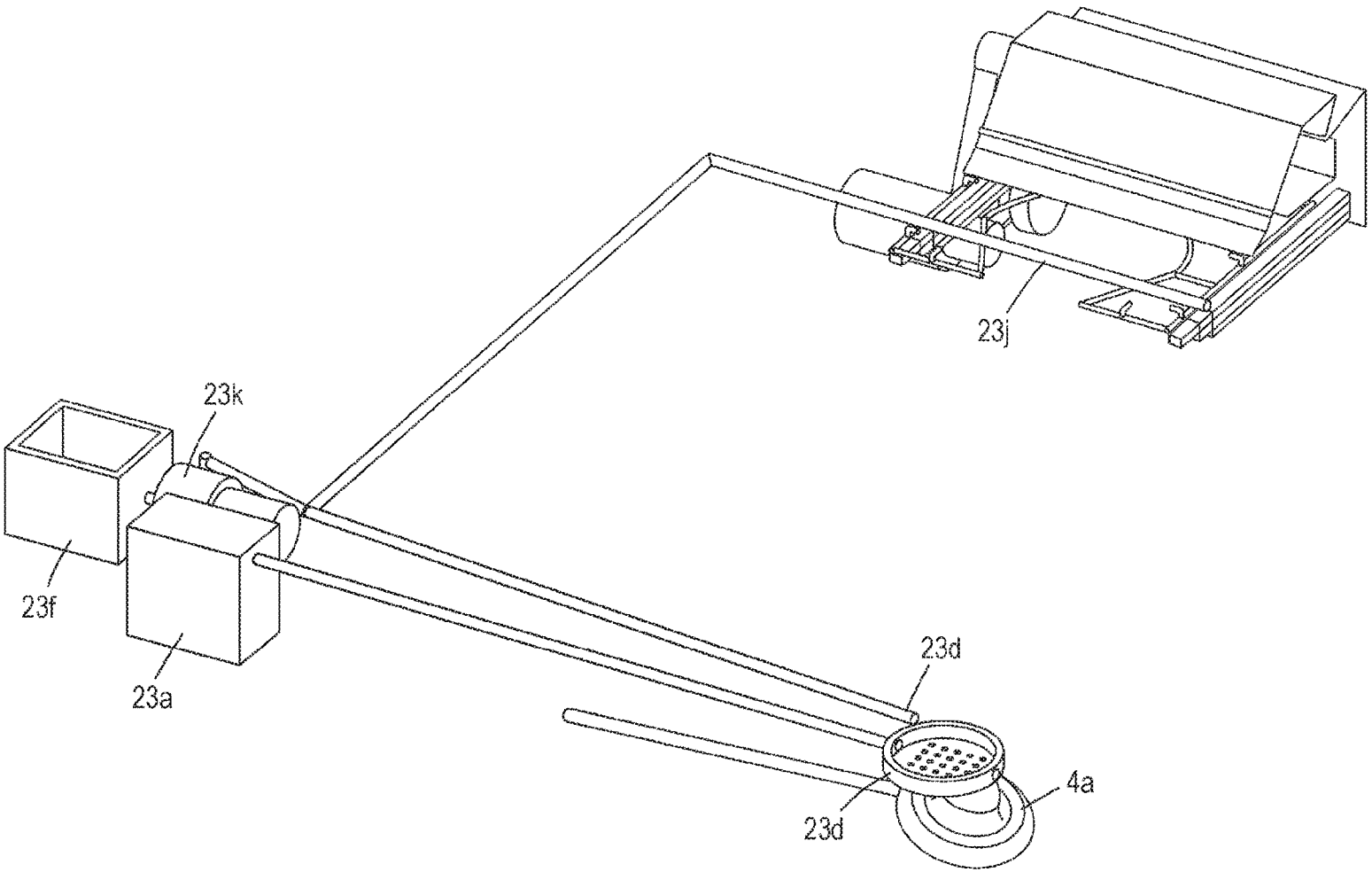
Figure 112:
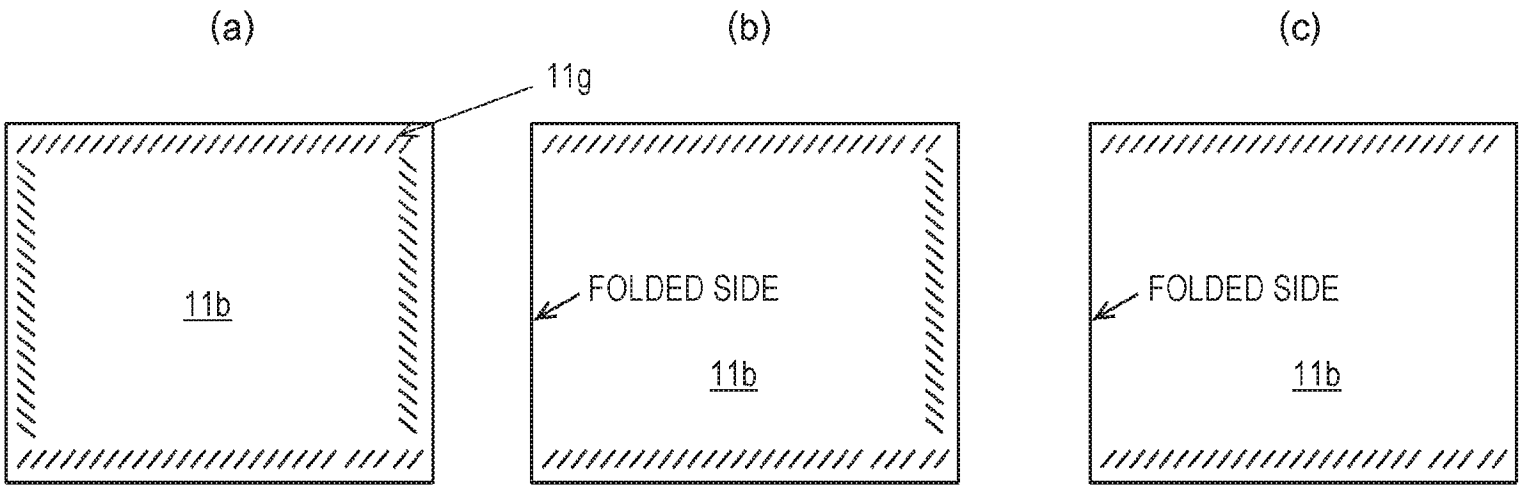

FIG. 108 is a view of a structure in a case where an exposure/upper-to-lower motor 18 used in the eleventh embodiment is changed to an upper-to-lower motor 8 and an exposure motor 9;

FIG. 109 is a block diagram of a system in a case where the pressure of tap water is utilized to spray a sterilization or cleansing solution;

FIG. 110 is a block diagram of a system in a case where a drive unit is used to spray the sterilization or cleansing solution;

FIG. 111 is a perspective view of a mechanism using the system illustrated in the block diagram of FIG. 110;

FIG. 112 is a view of an example of special paper 11*b* used for a paper loading guide 17*c;*

Figure 113:
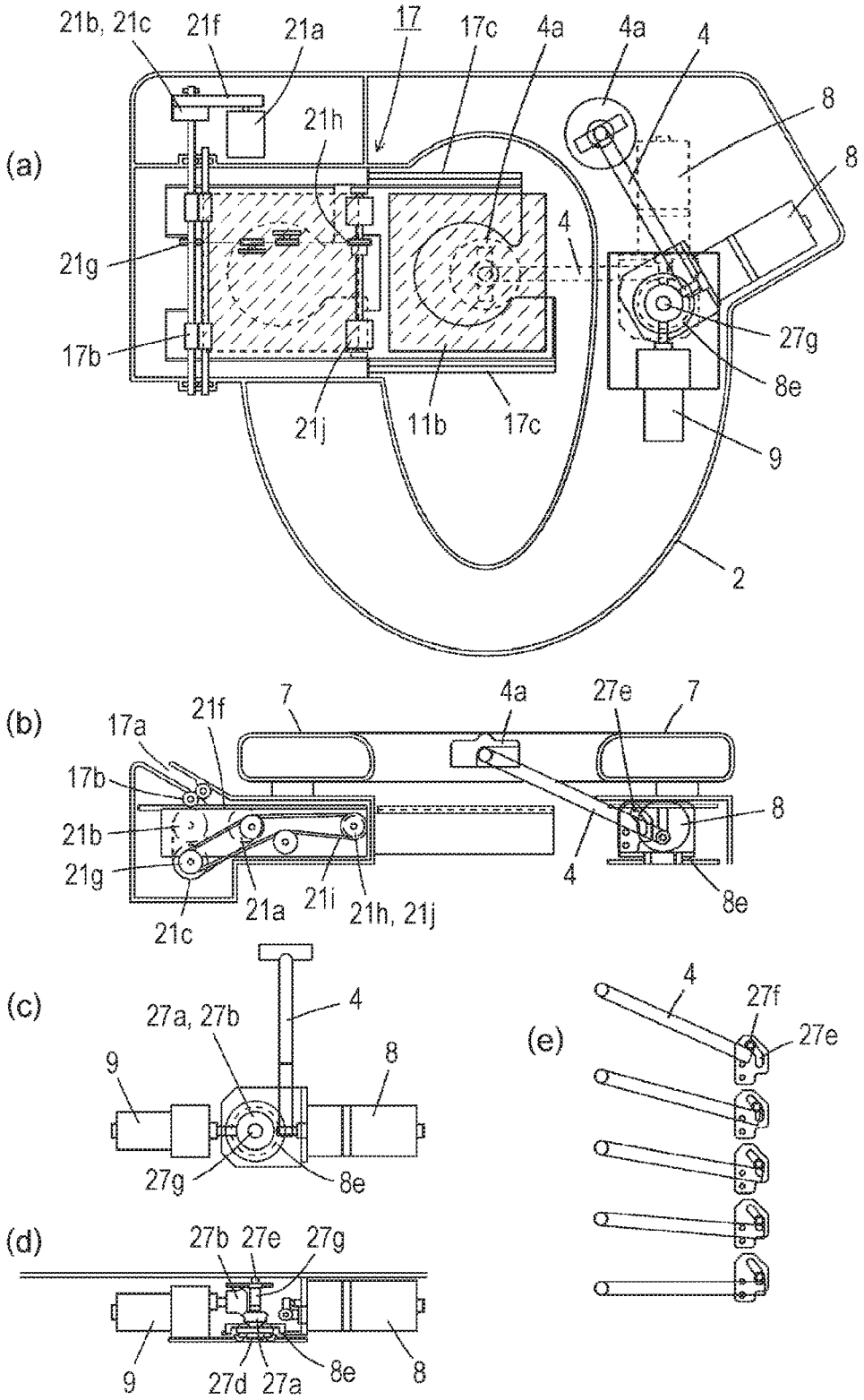
Figure 114:
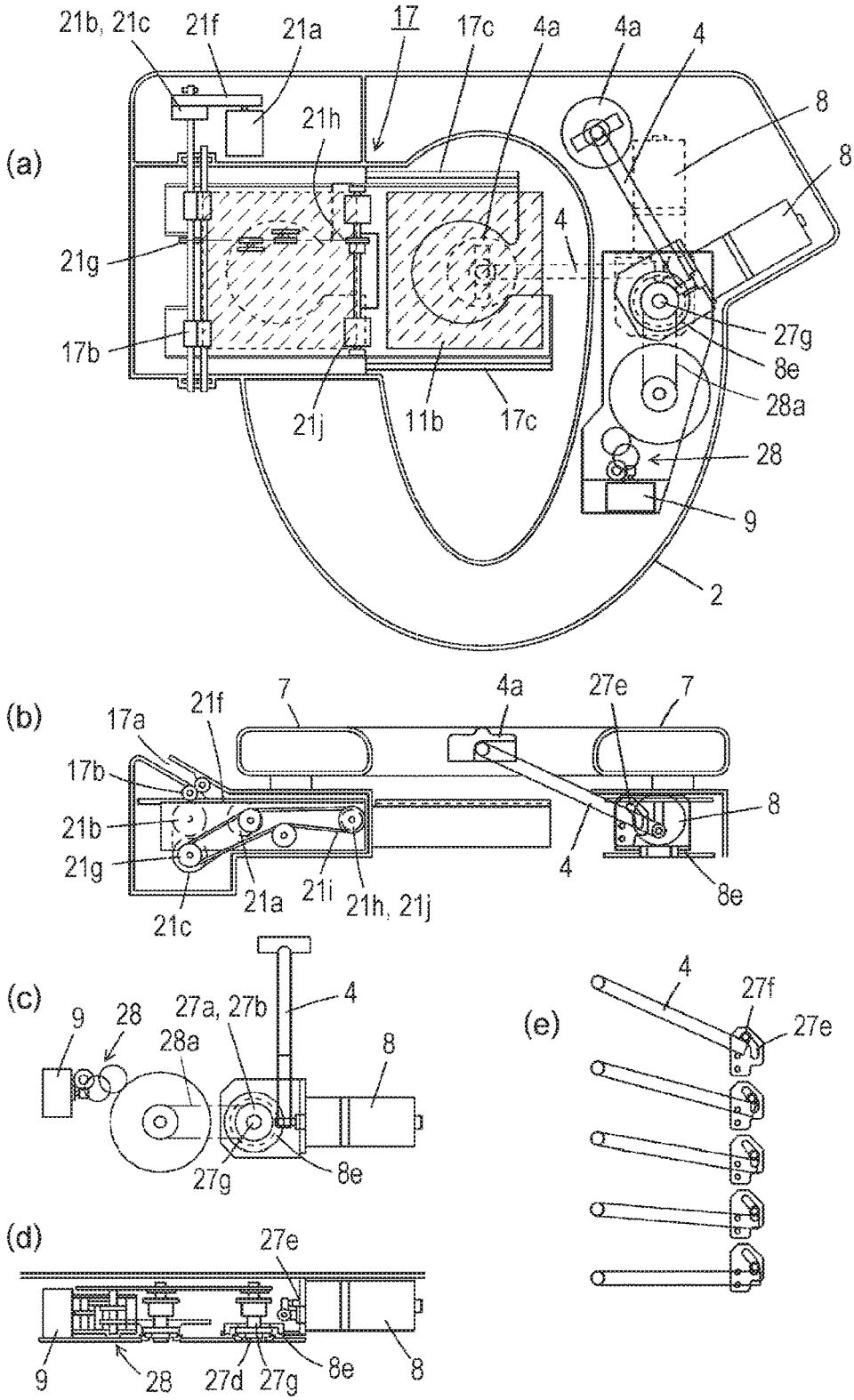
Figure 115:
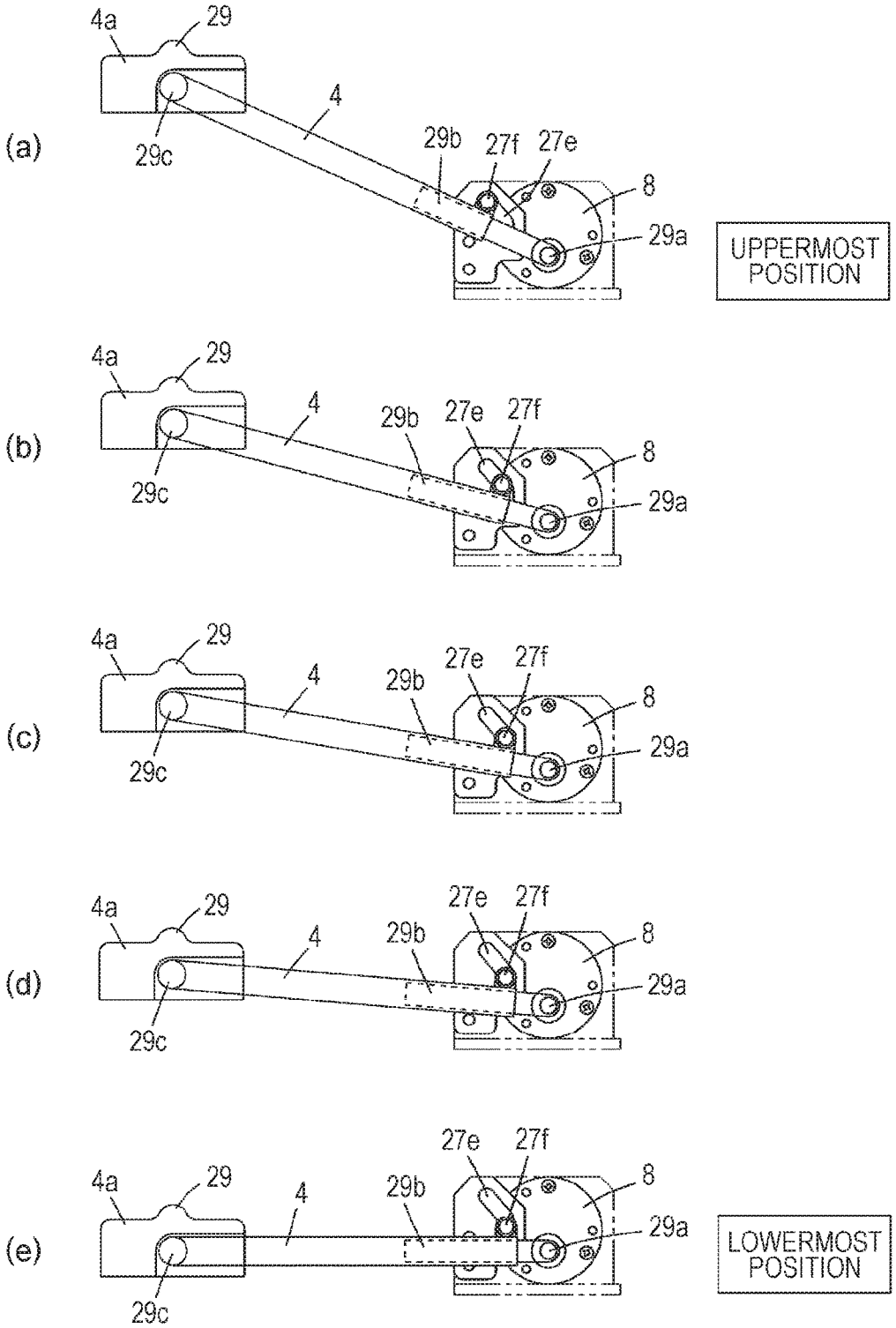
Figure 116:
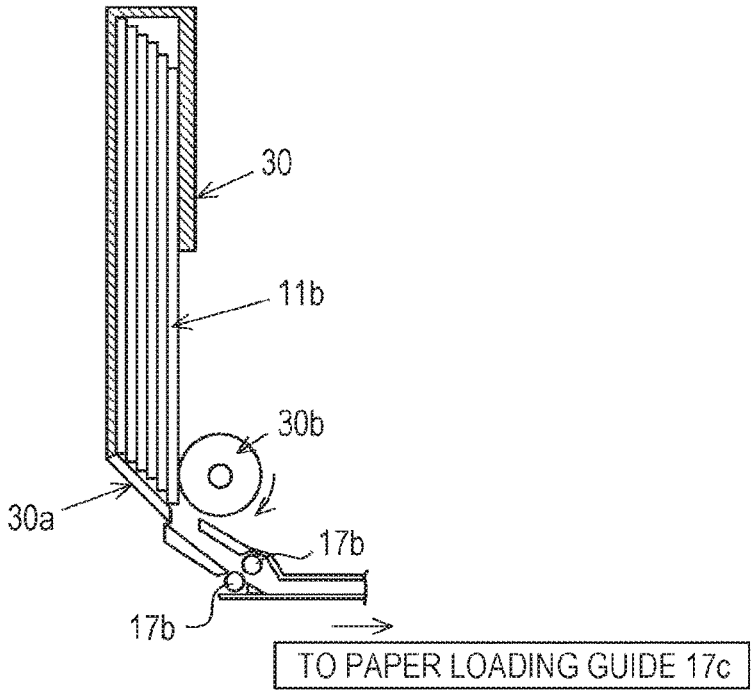
Figure 117:
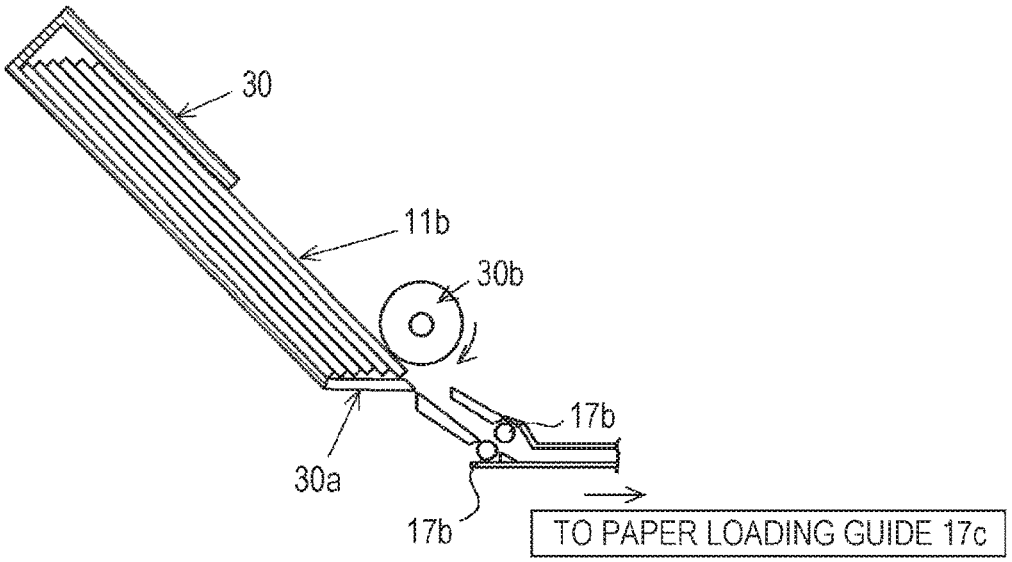
Figure 118:
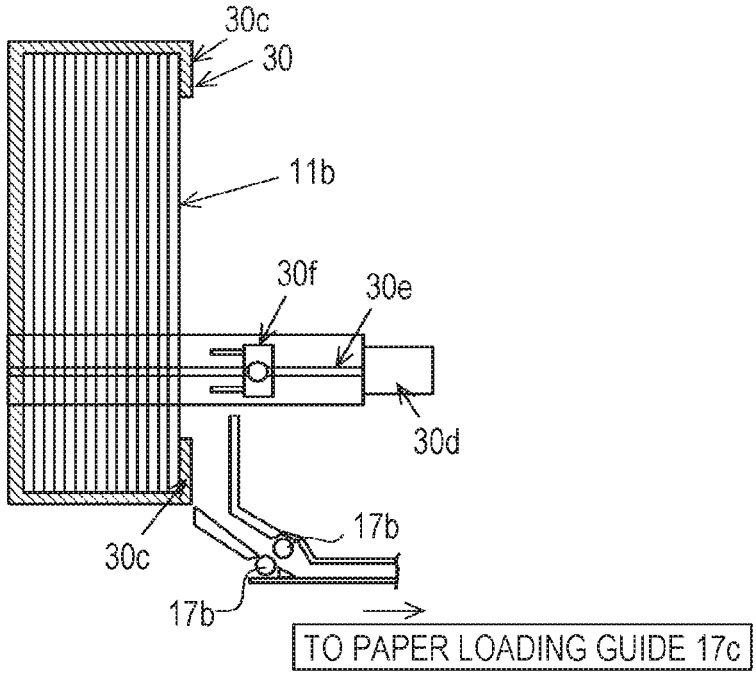
Figure 119:
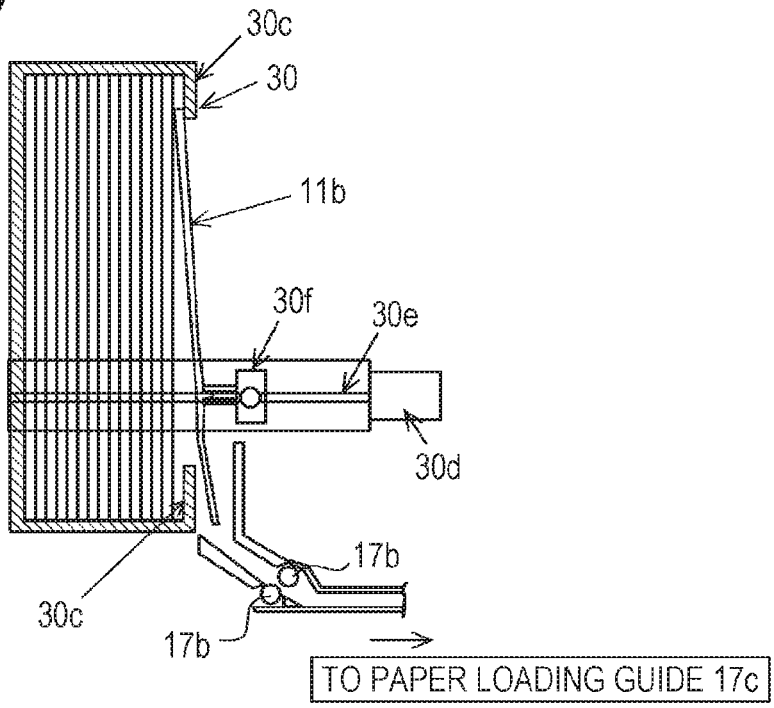
Figure 120:
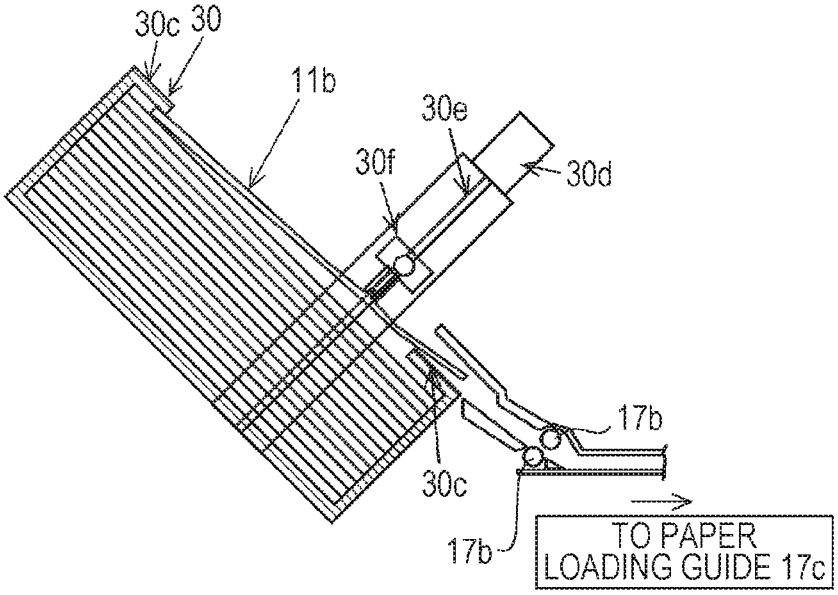
Figure 121:
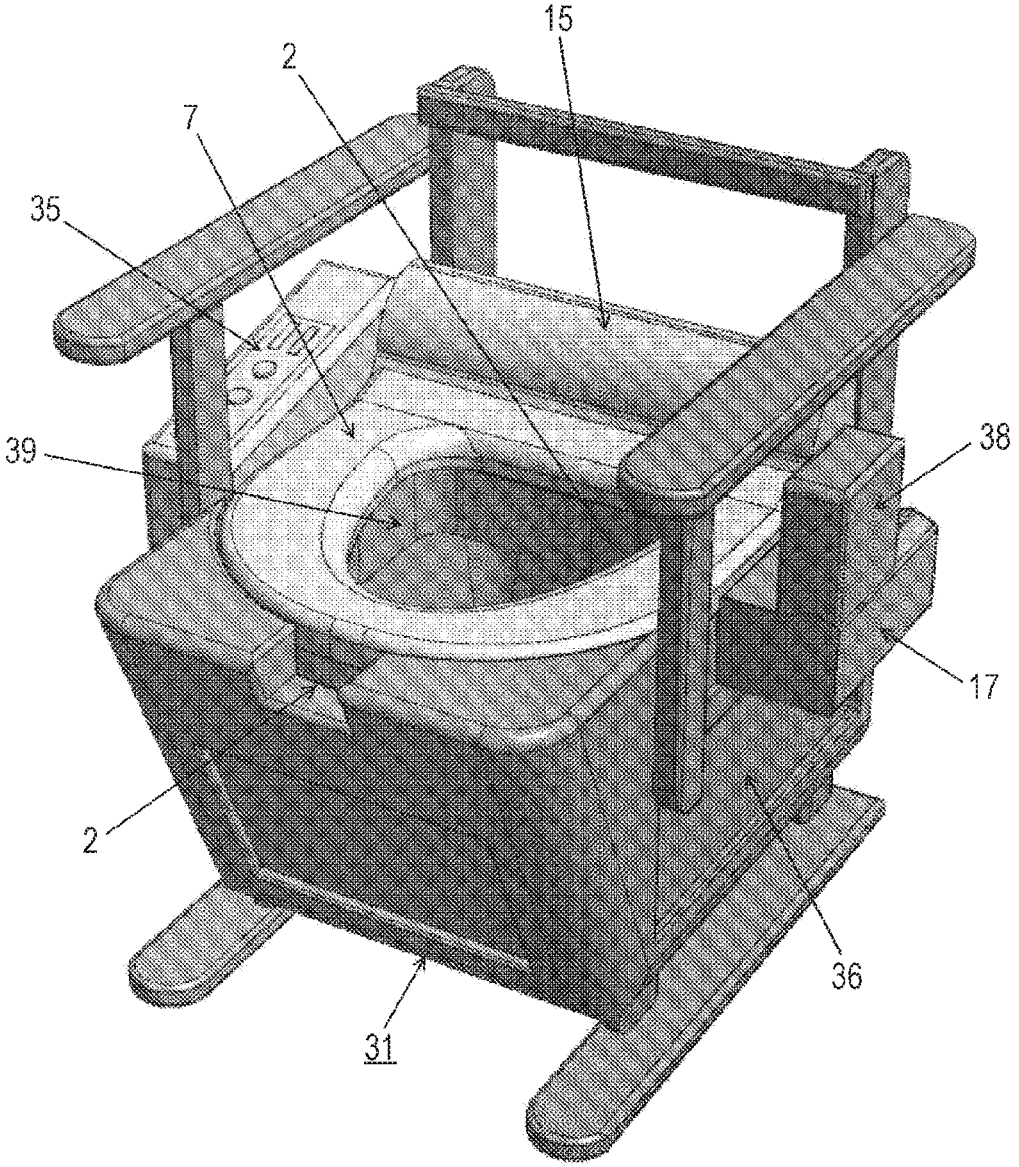
Figure 122:
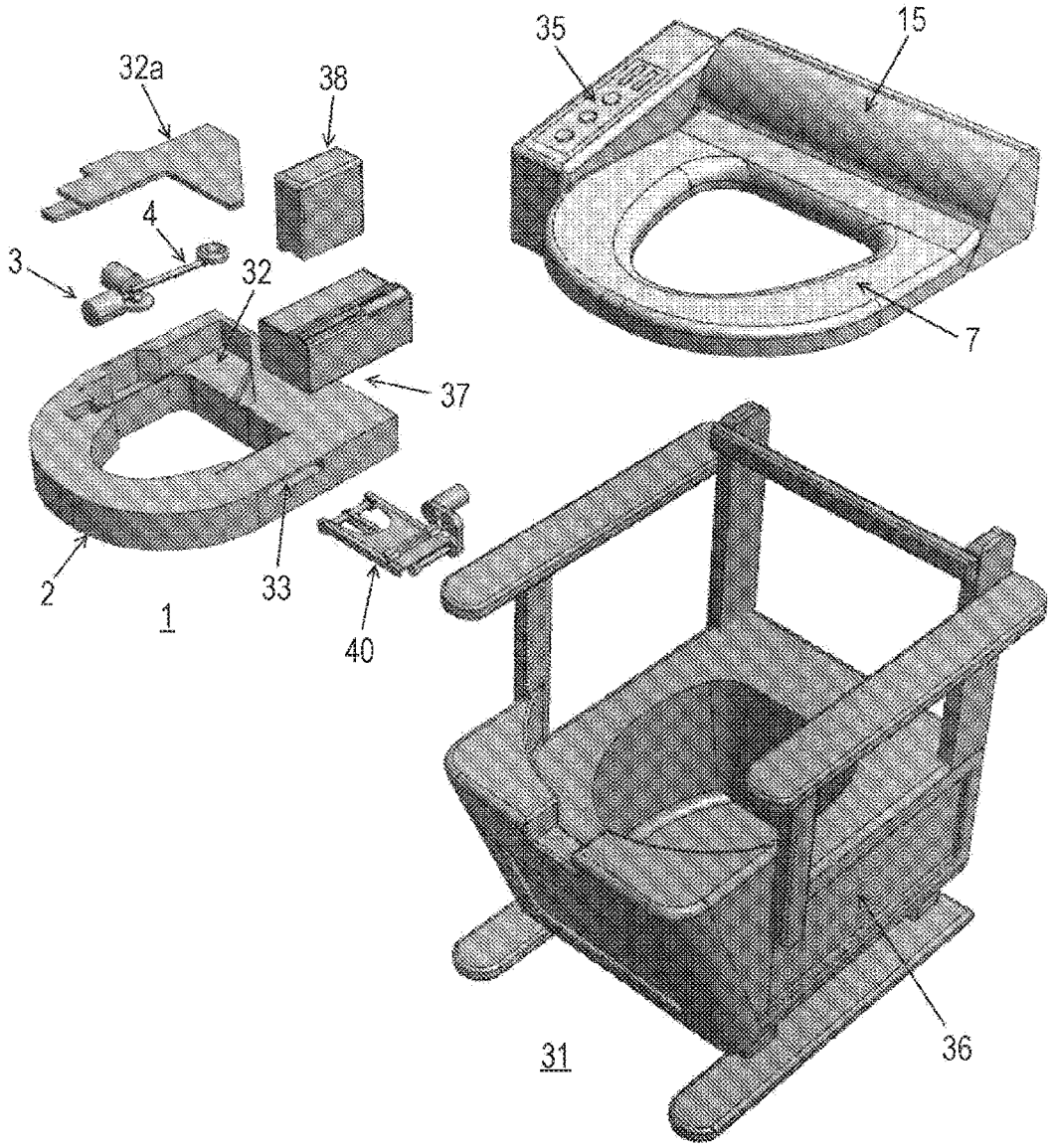
Figure 123:
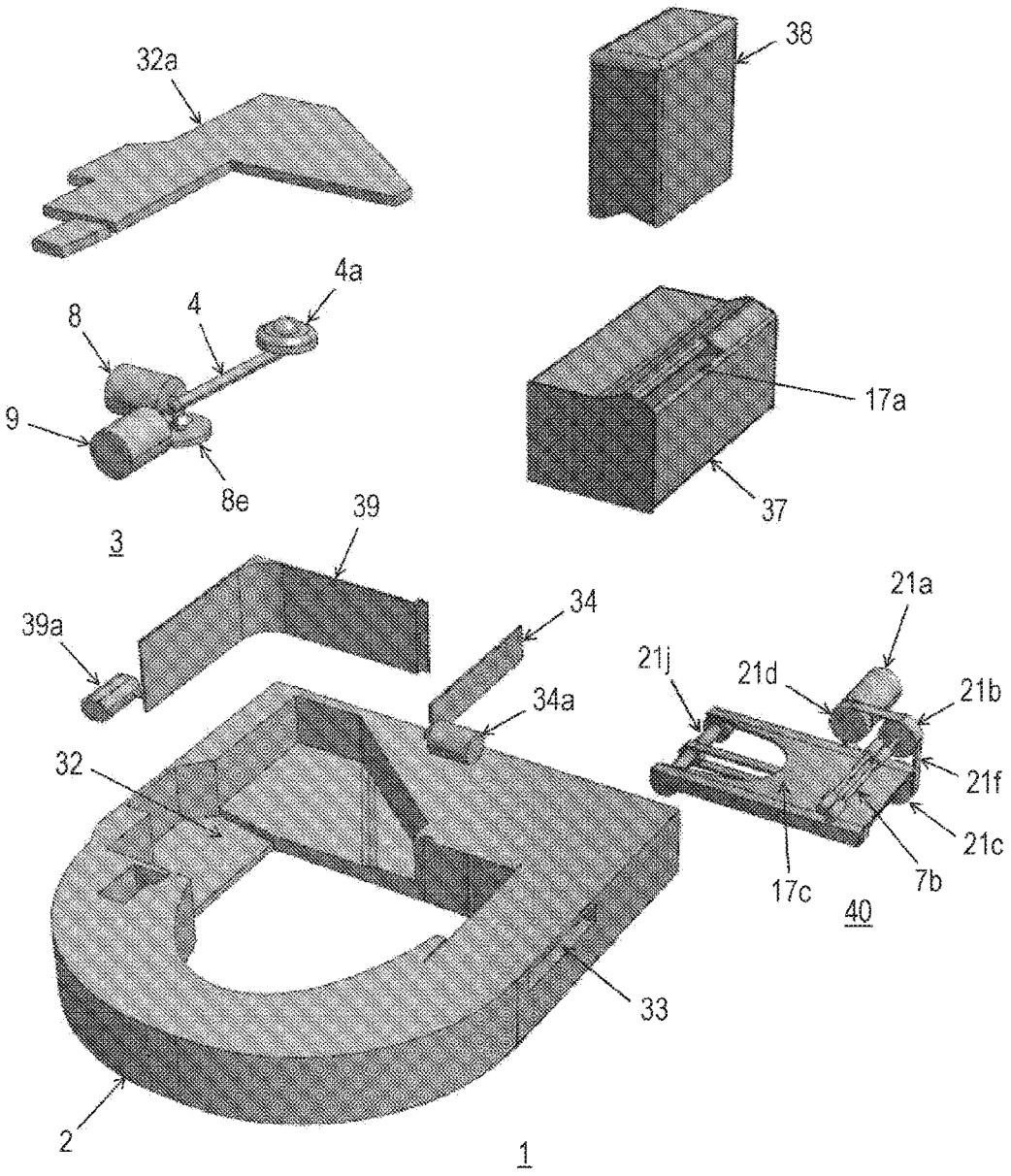
Figure 124:
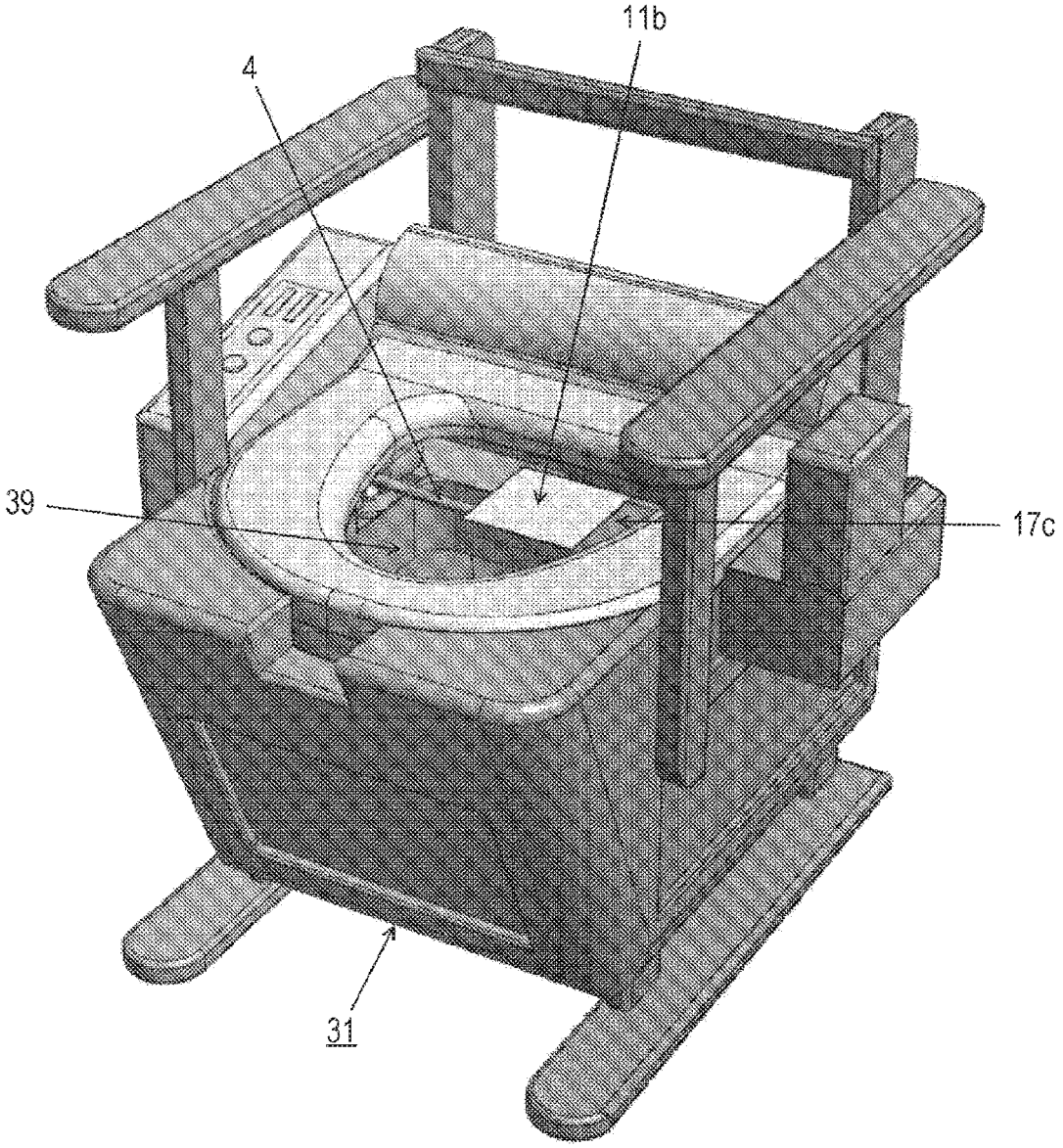
Figure 125:
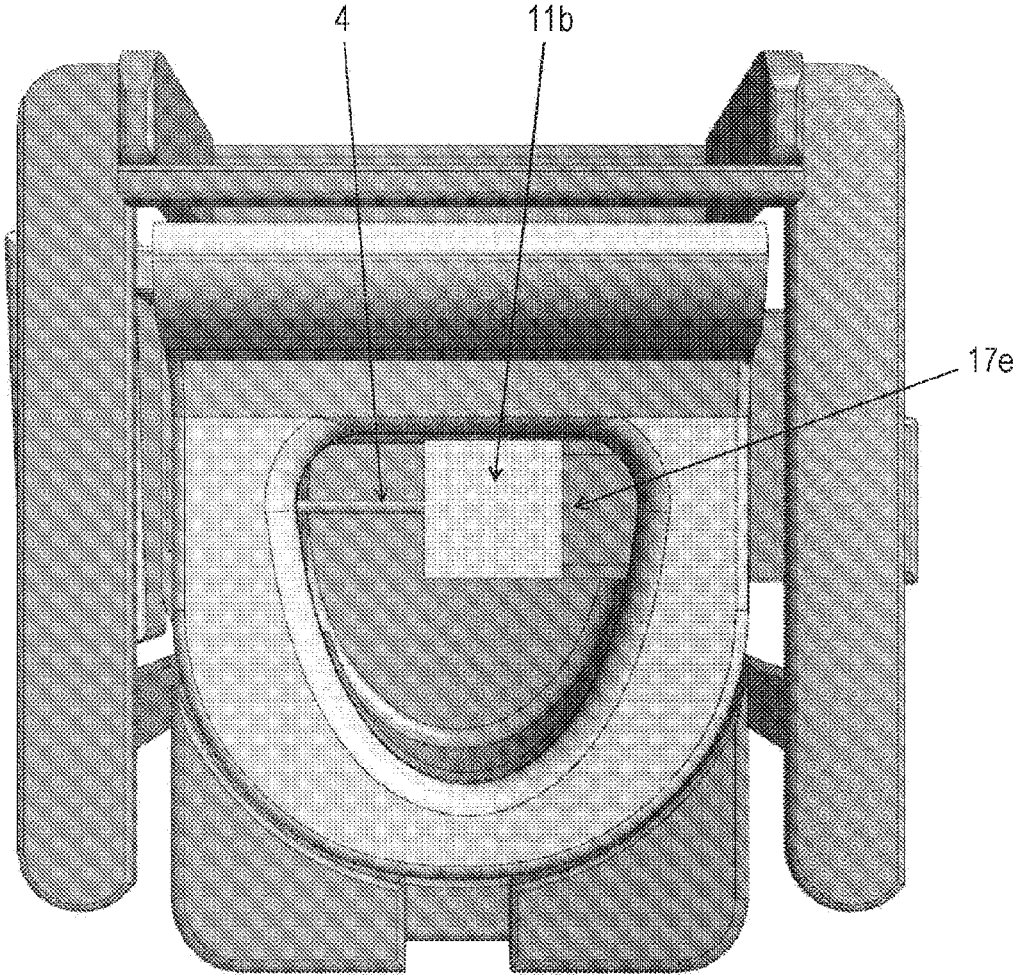
Figure 126:
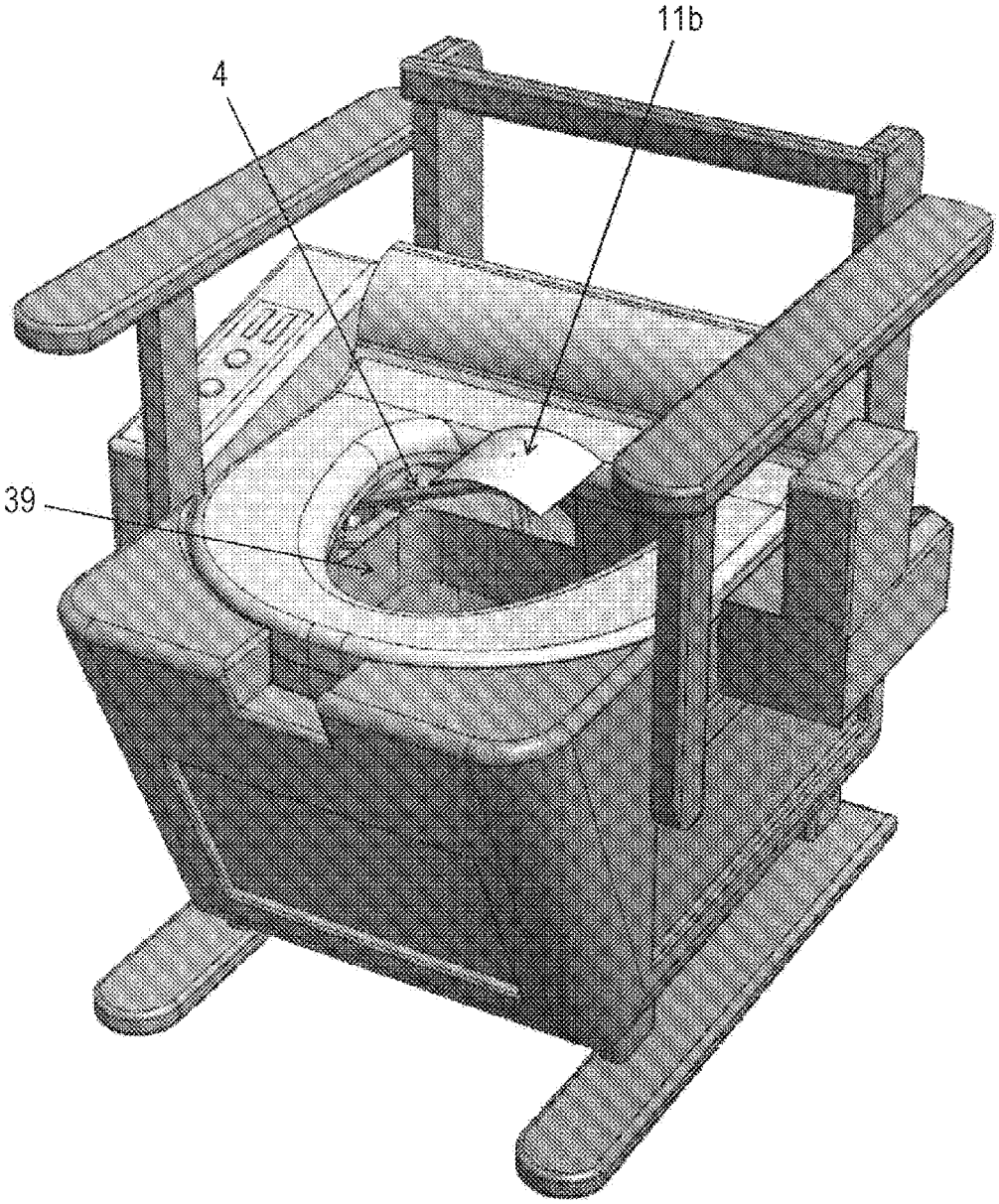
Figure 127:
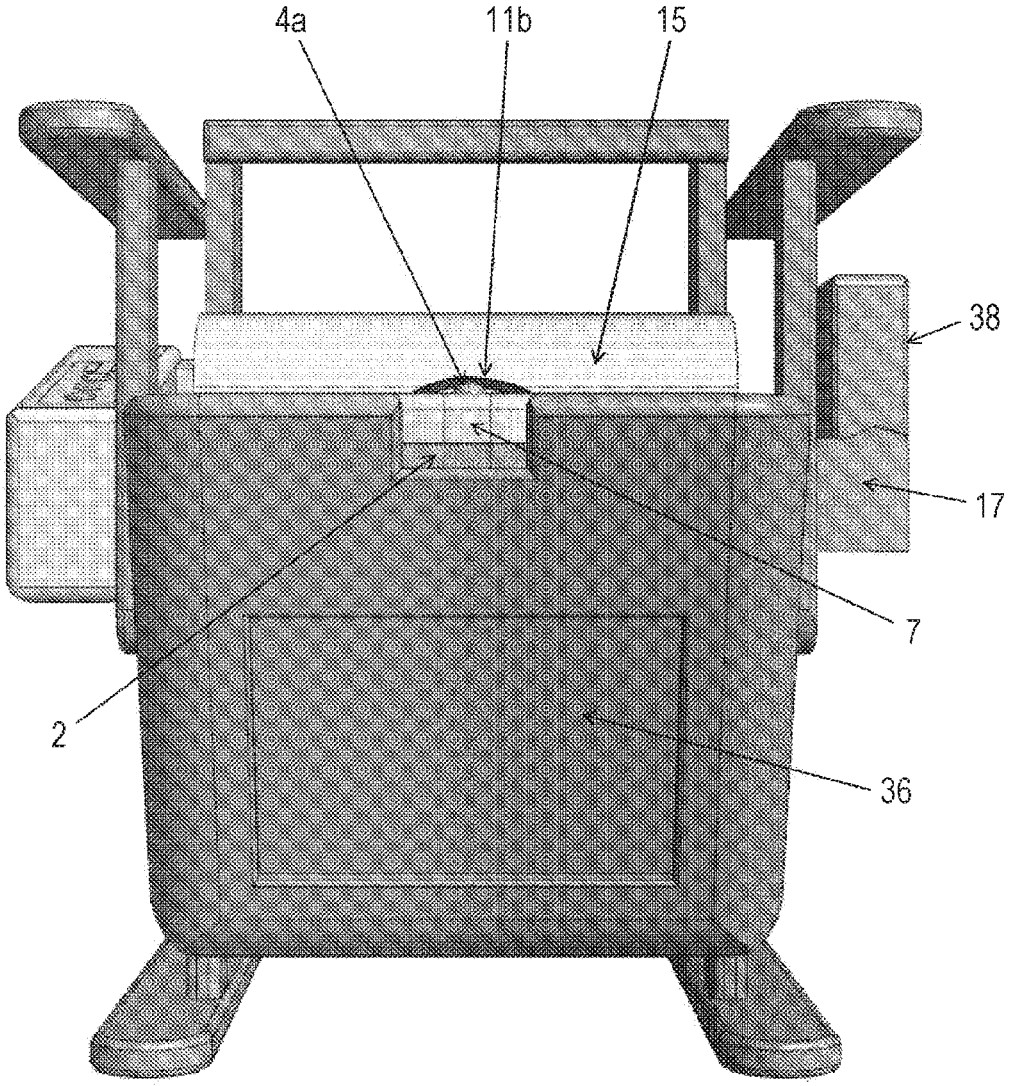
Figure 128:
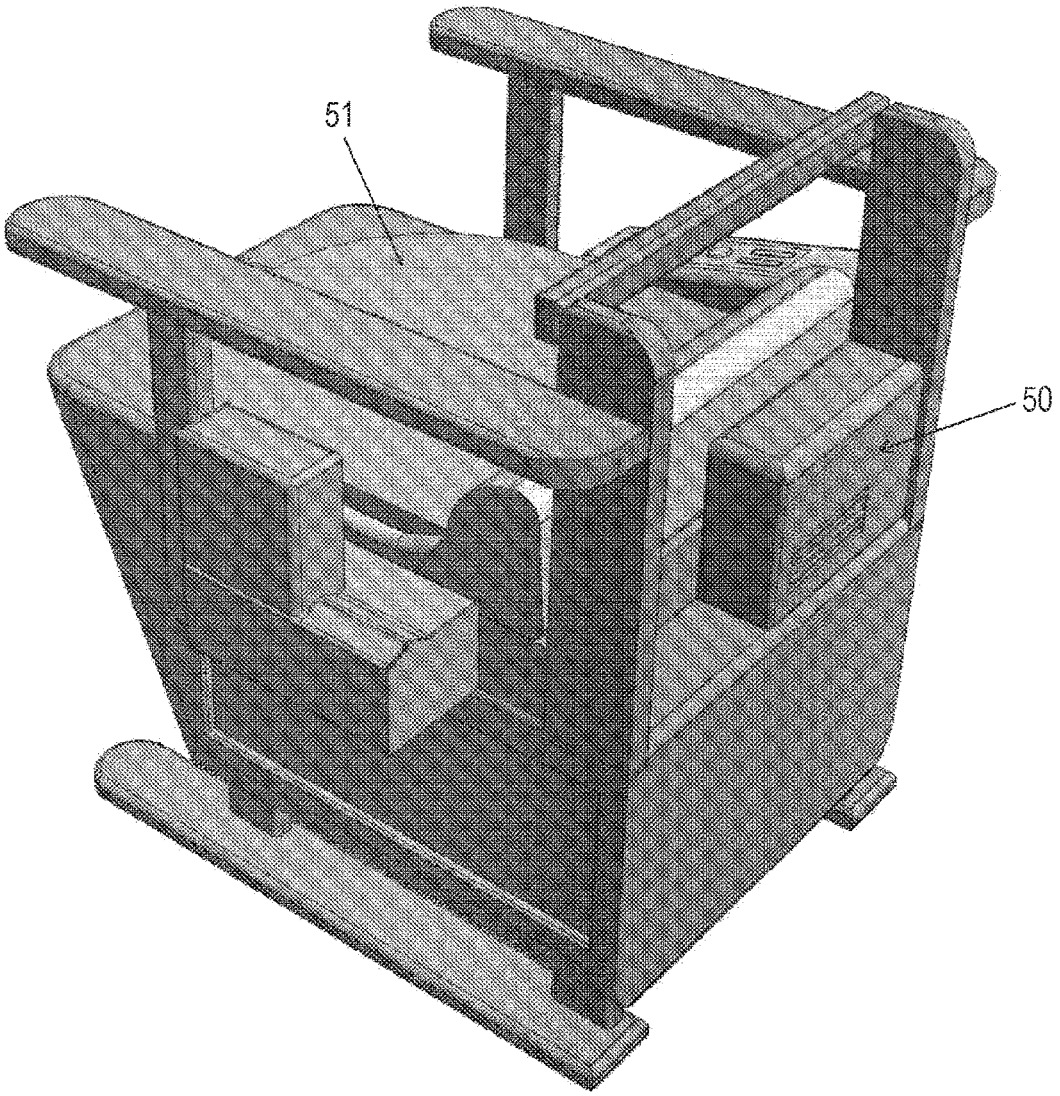
Figure 129:
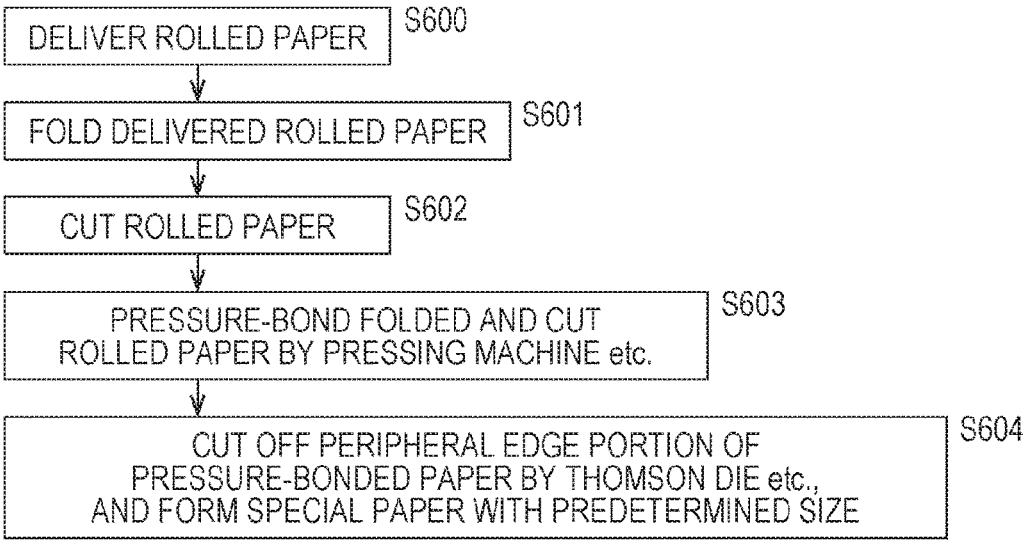
Figure 130:
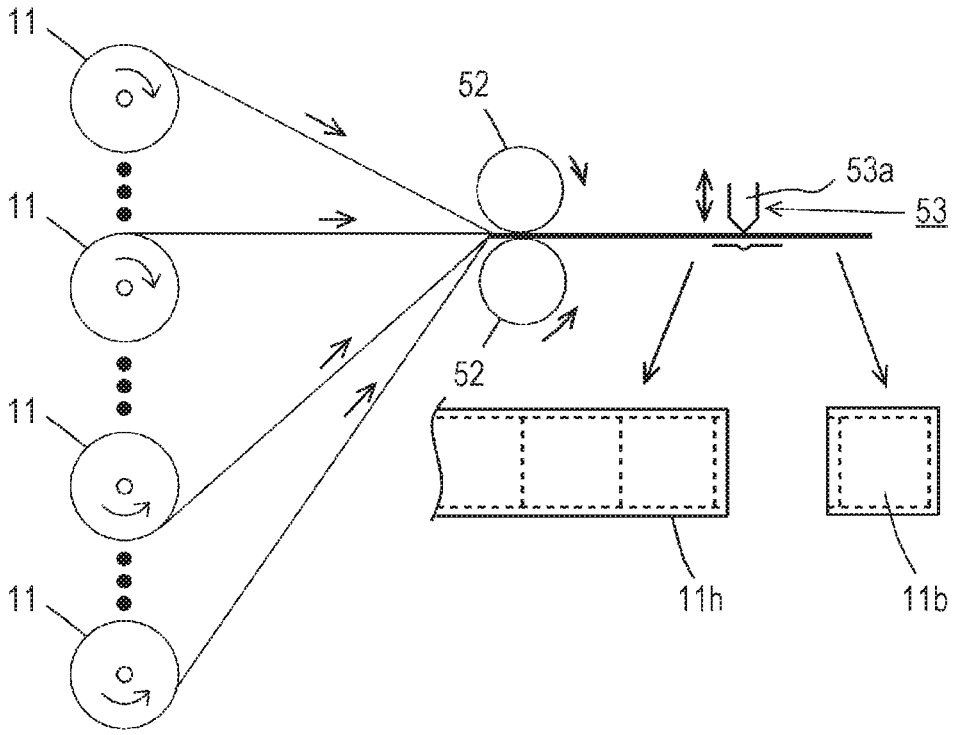
Figure 131:
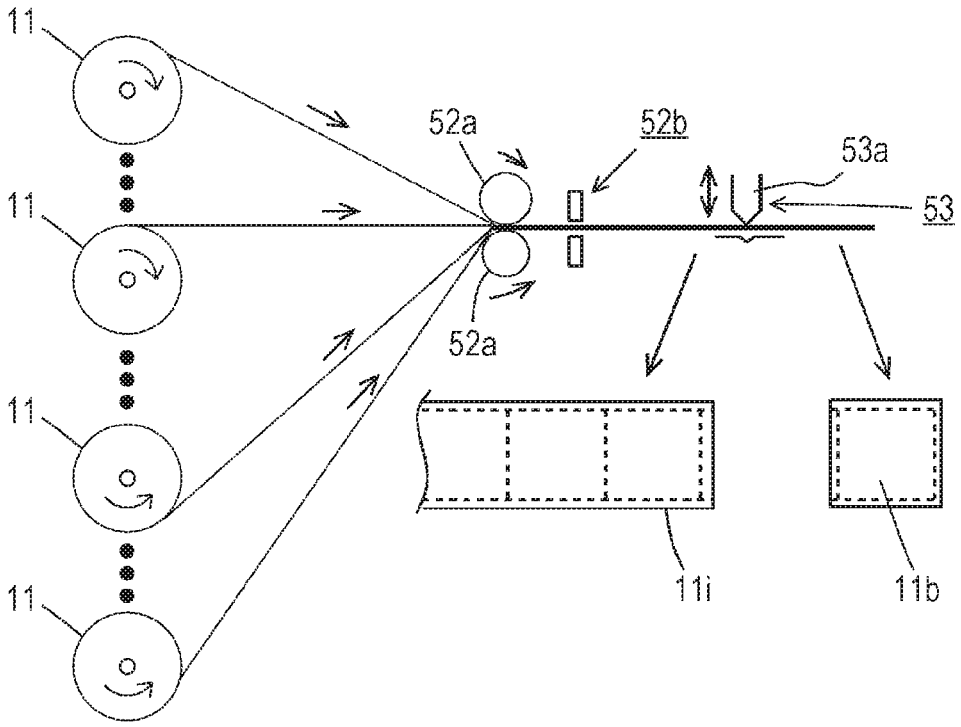
Figure 132A:
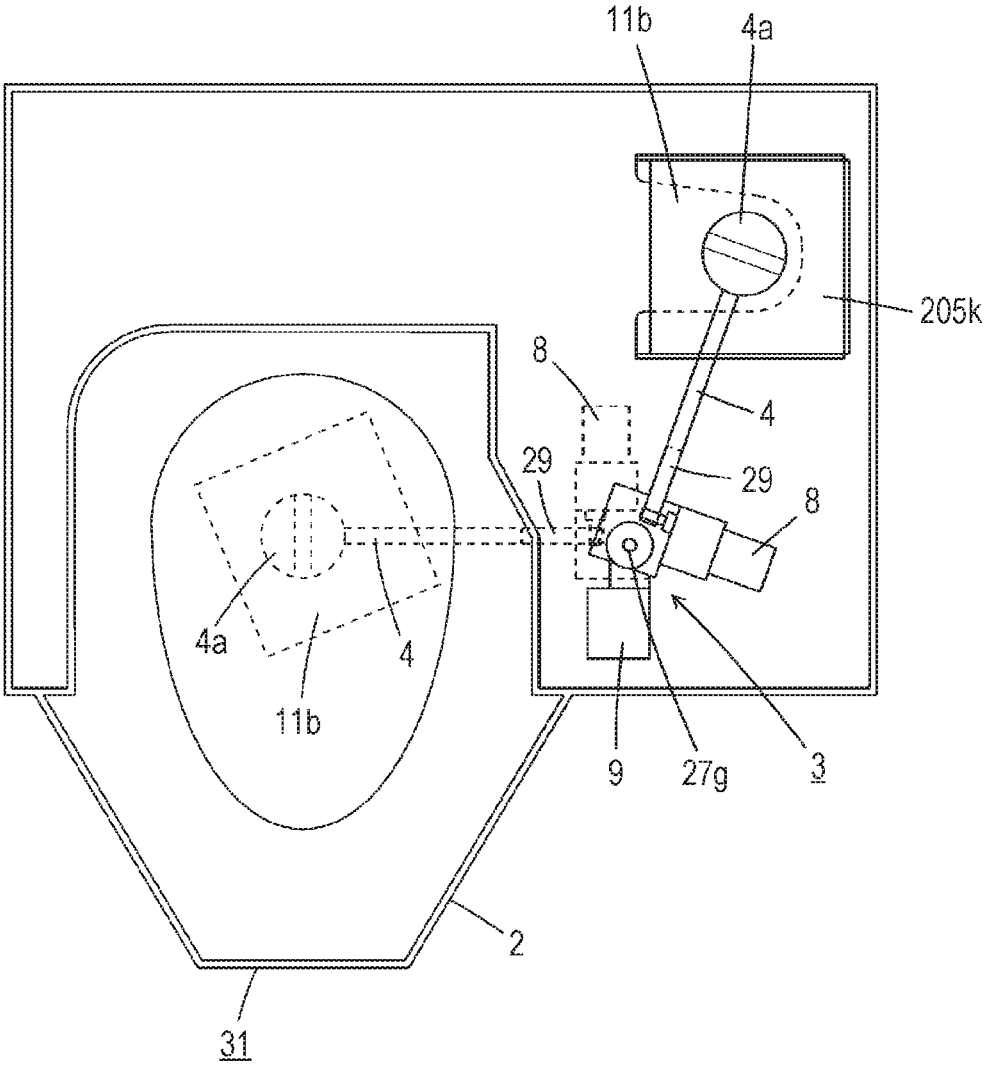
Figure 132B:
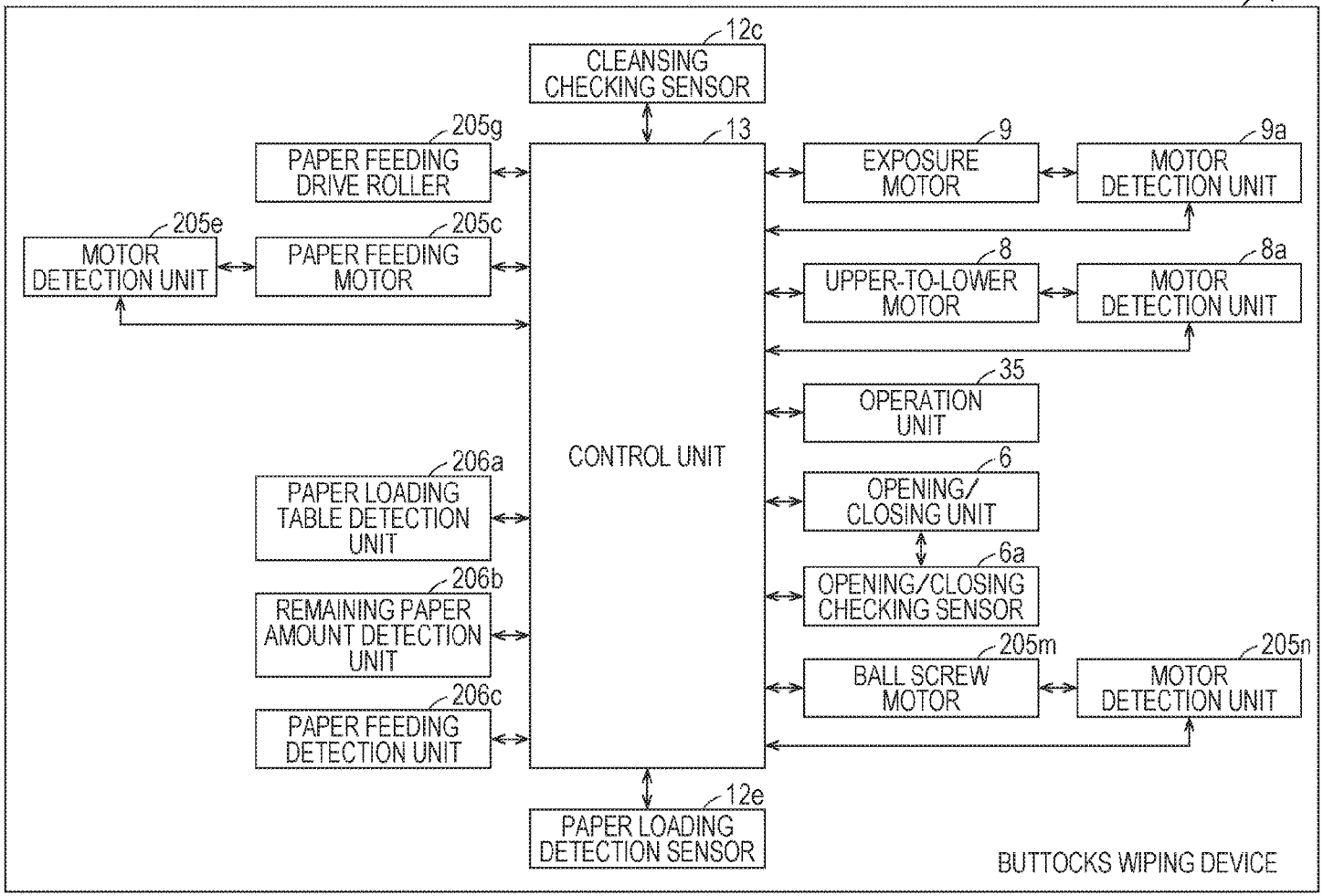
Figure 132C:
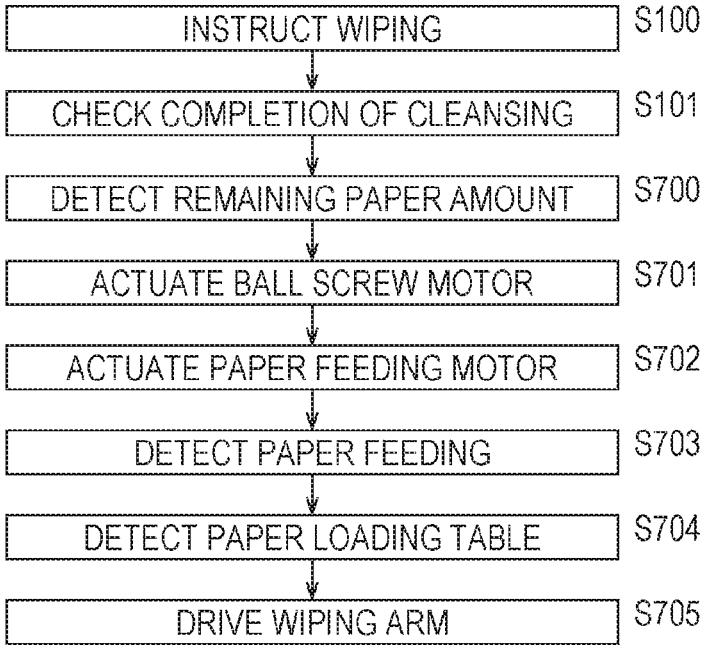
Figure 133:
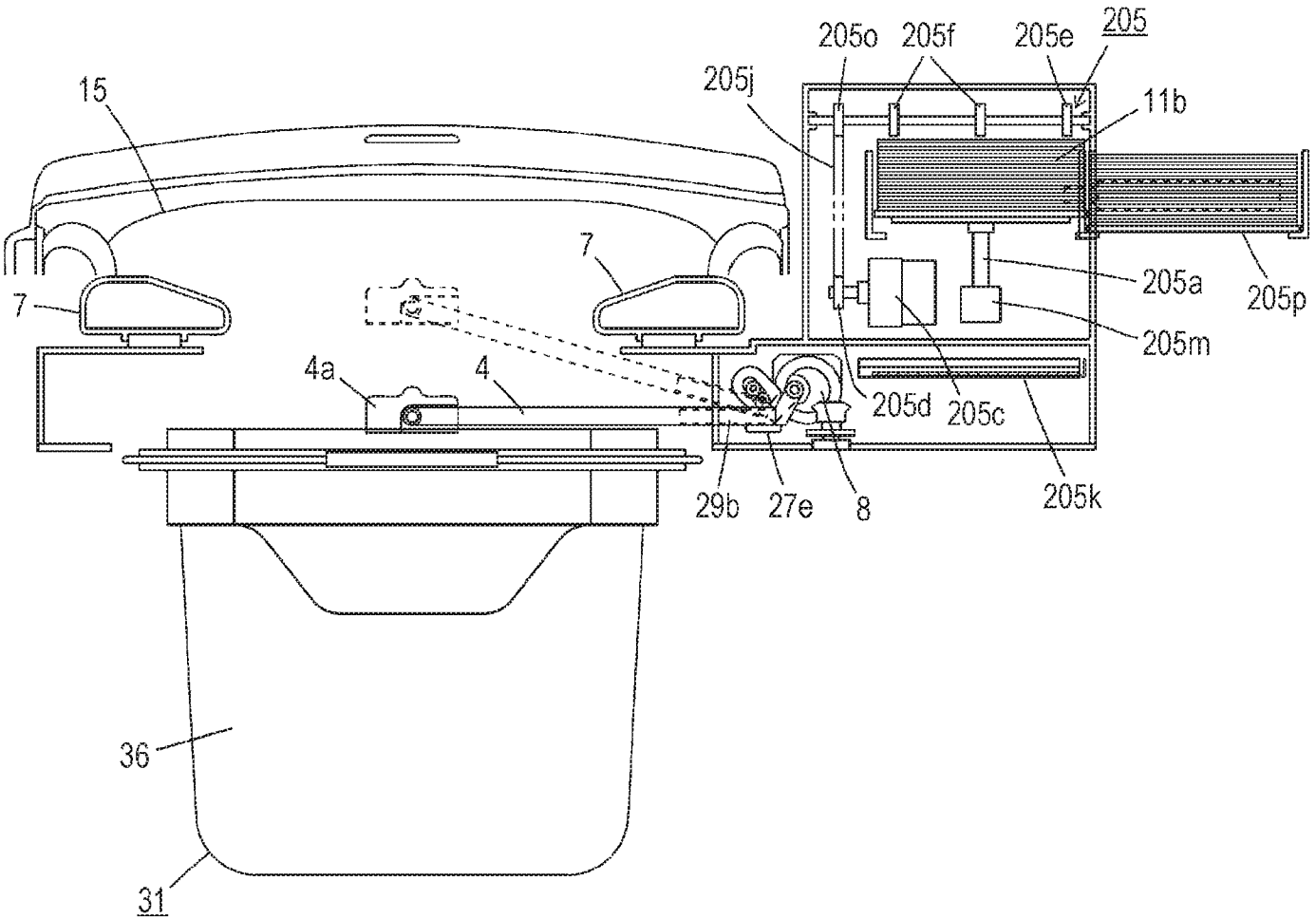
Figure 134:
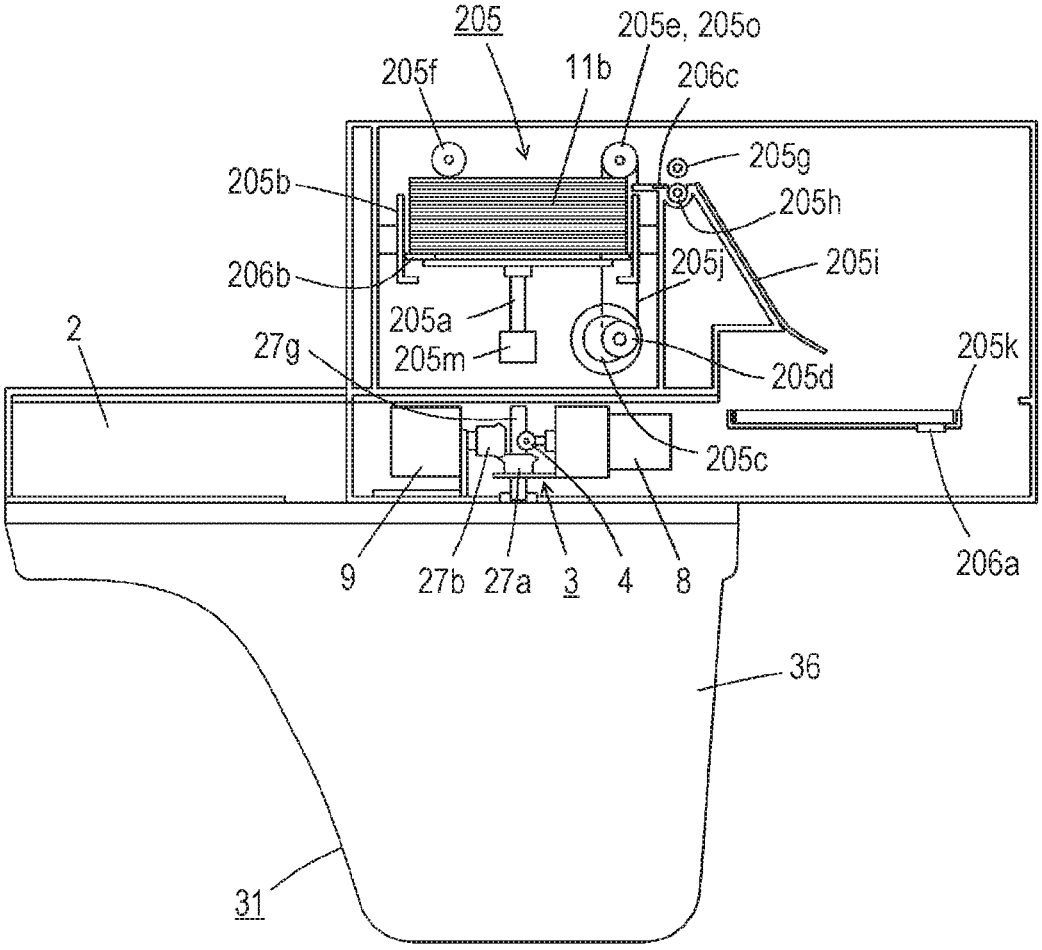
Figure 135A:
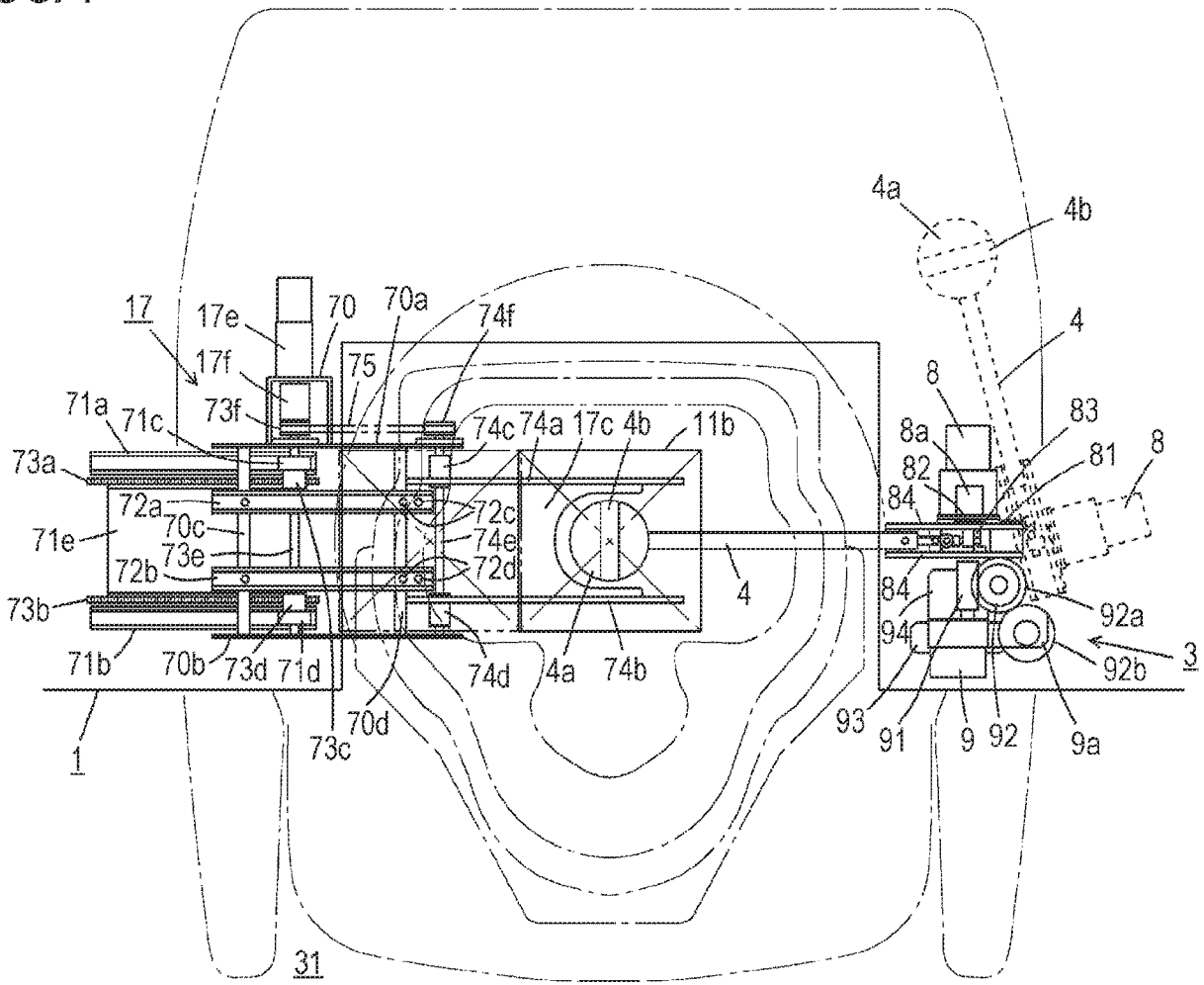
Figure 135B:
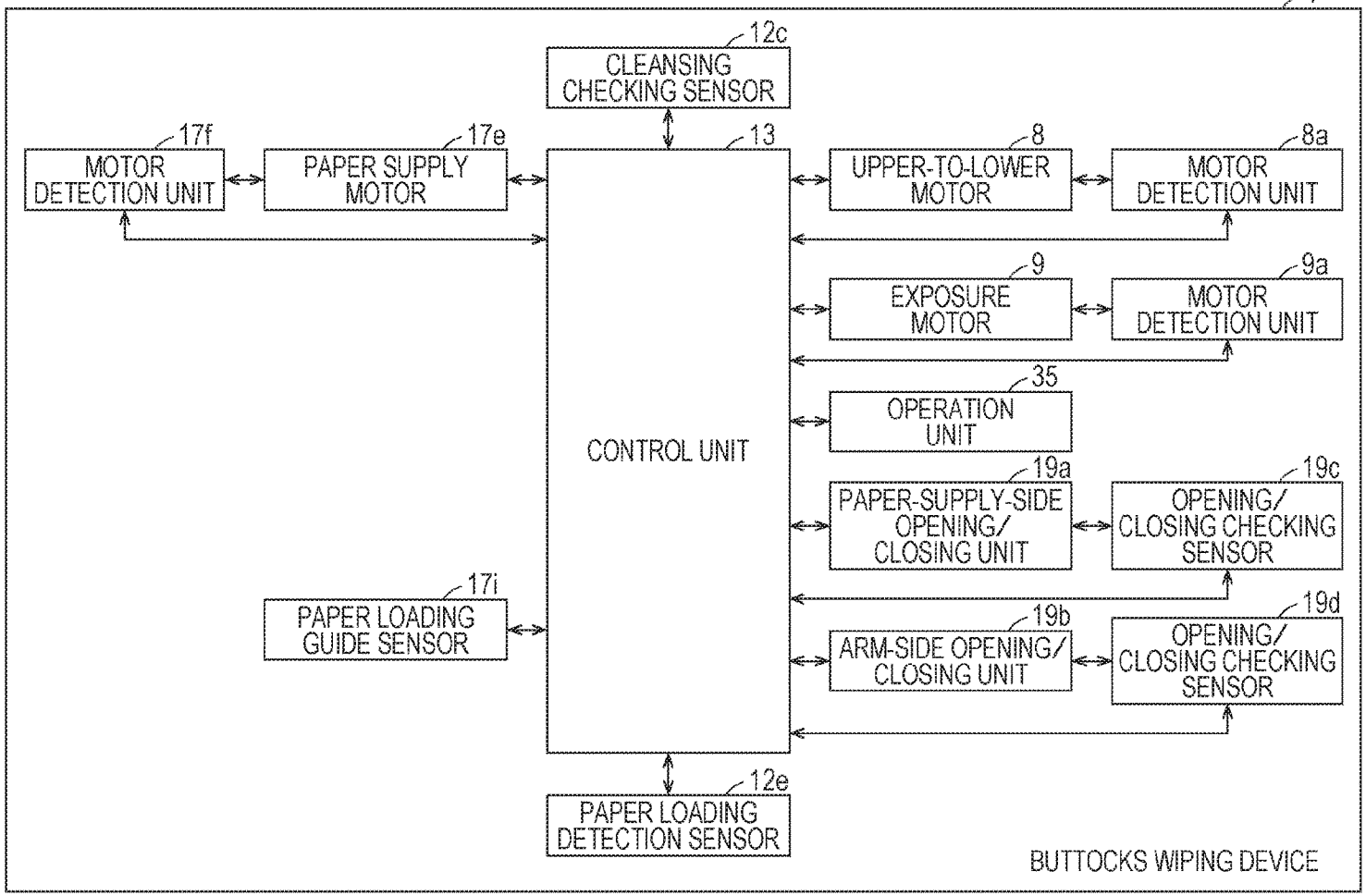
Figure 135C:
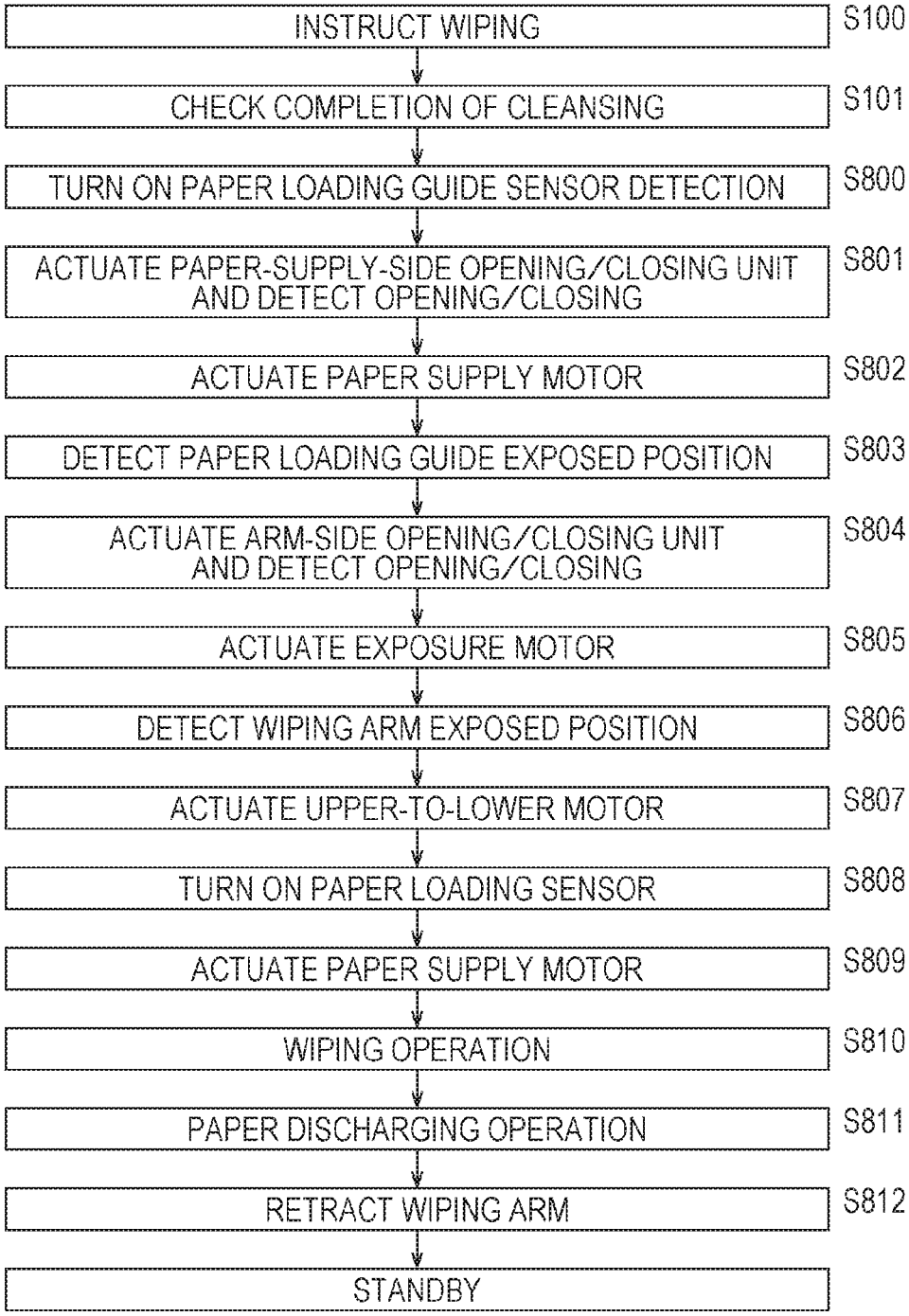
Figure 136:
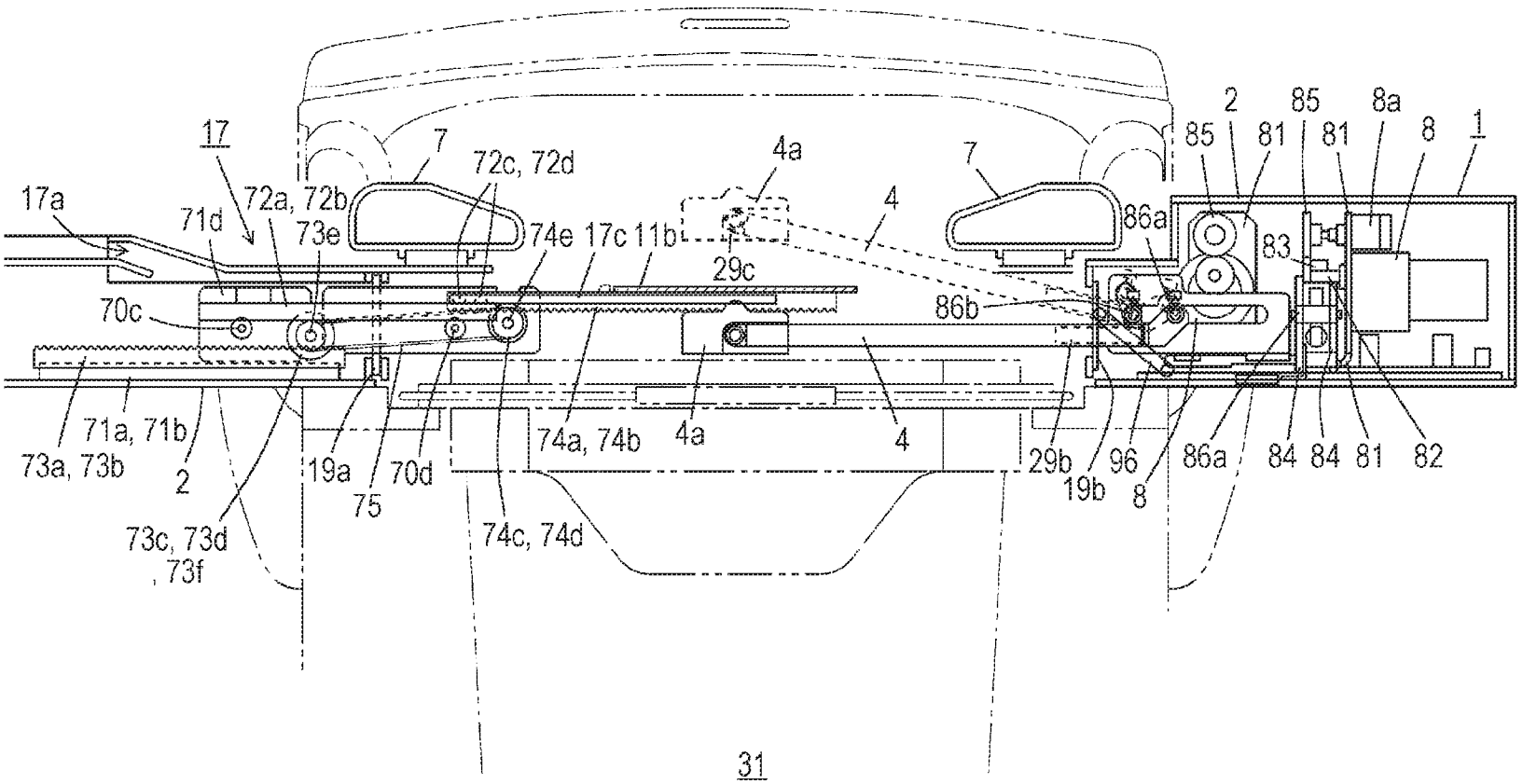
Figure 137:
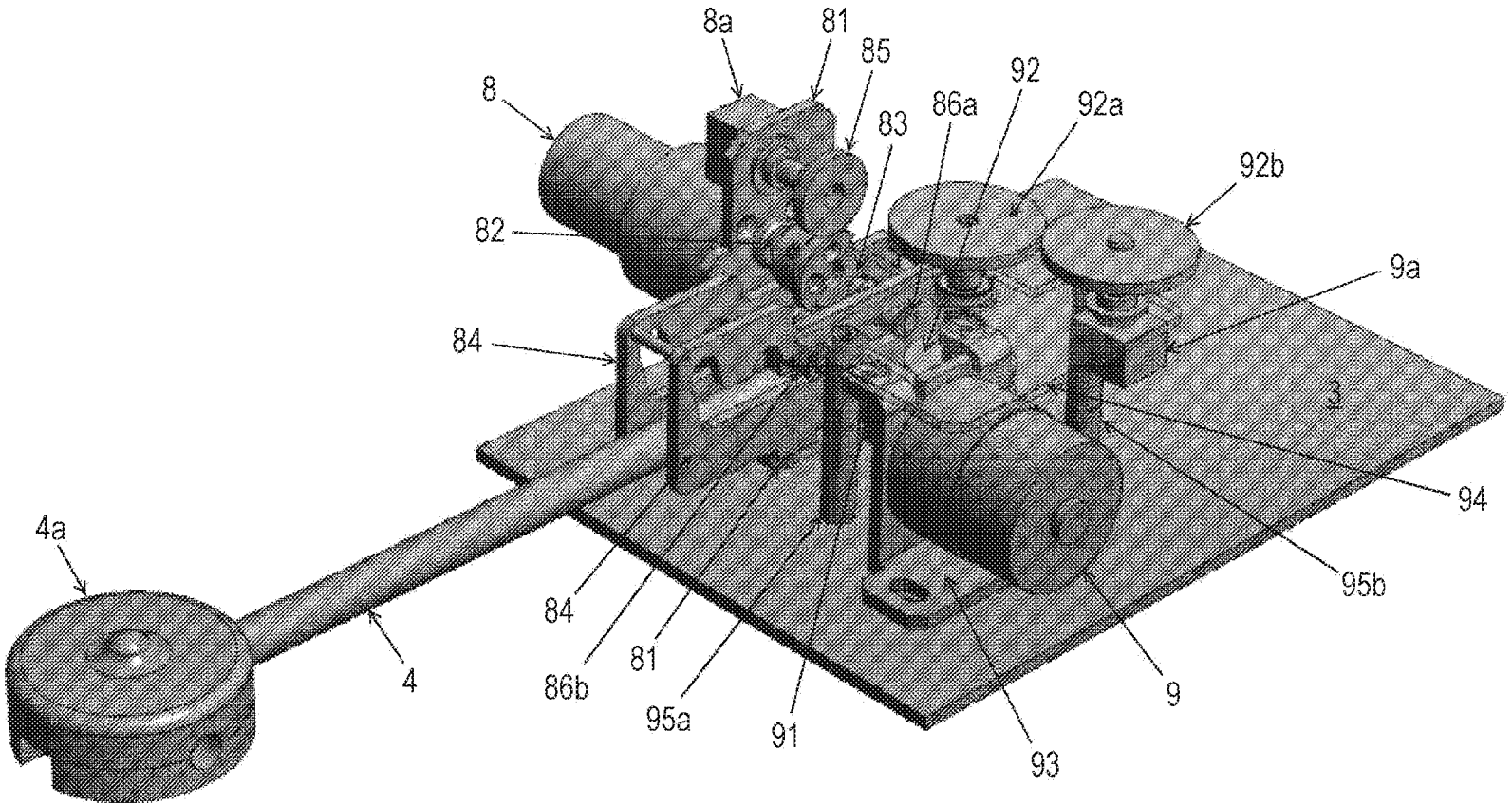
Figure 138:
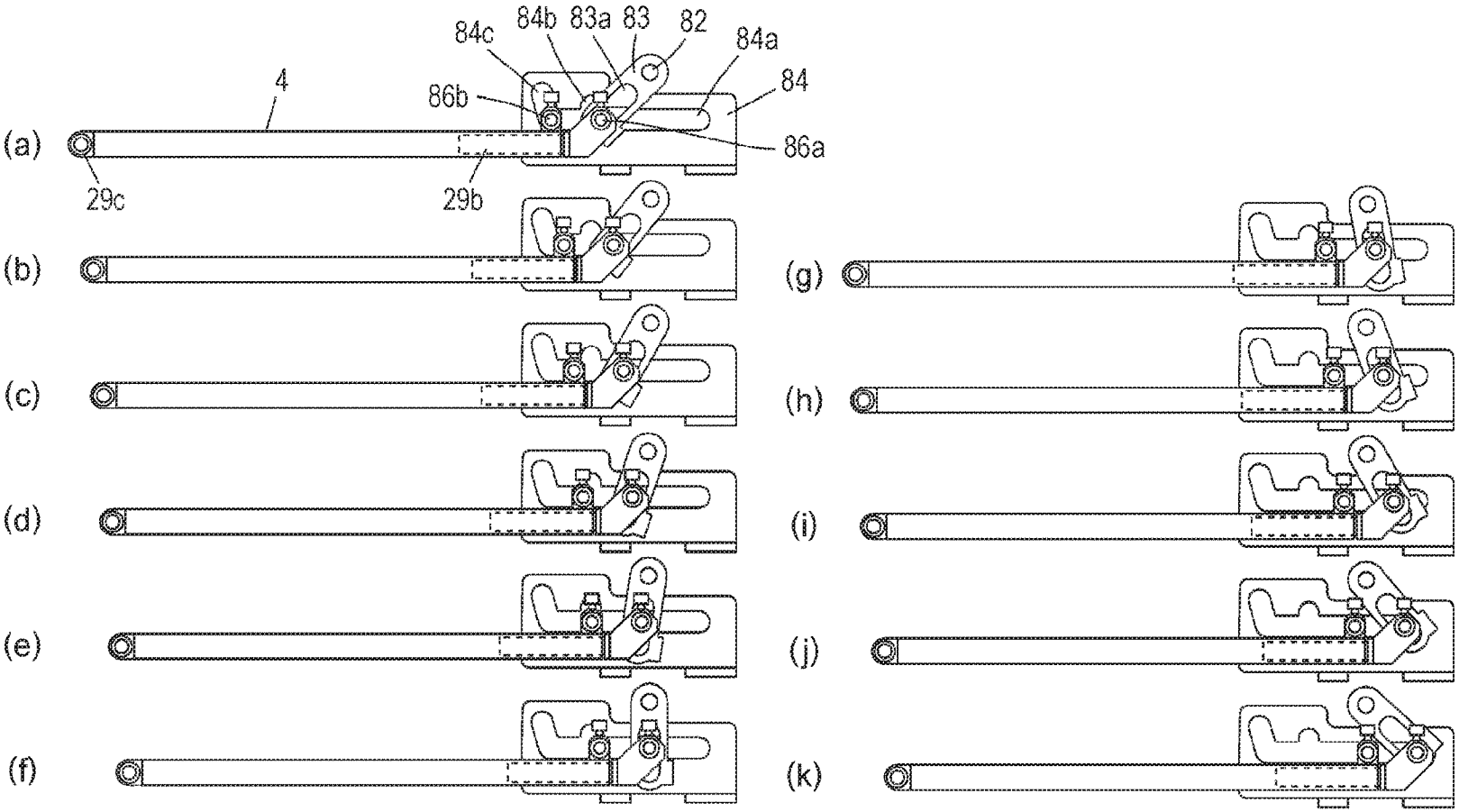
Figure 139:
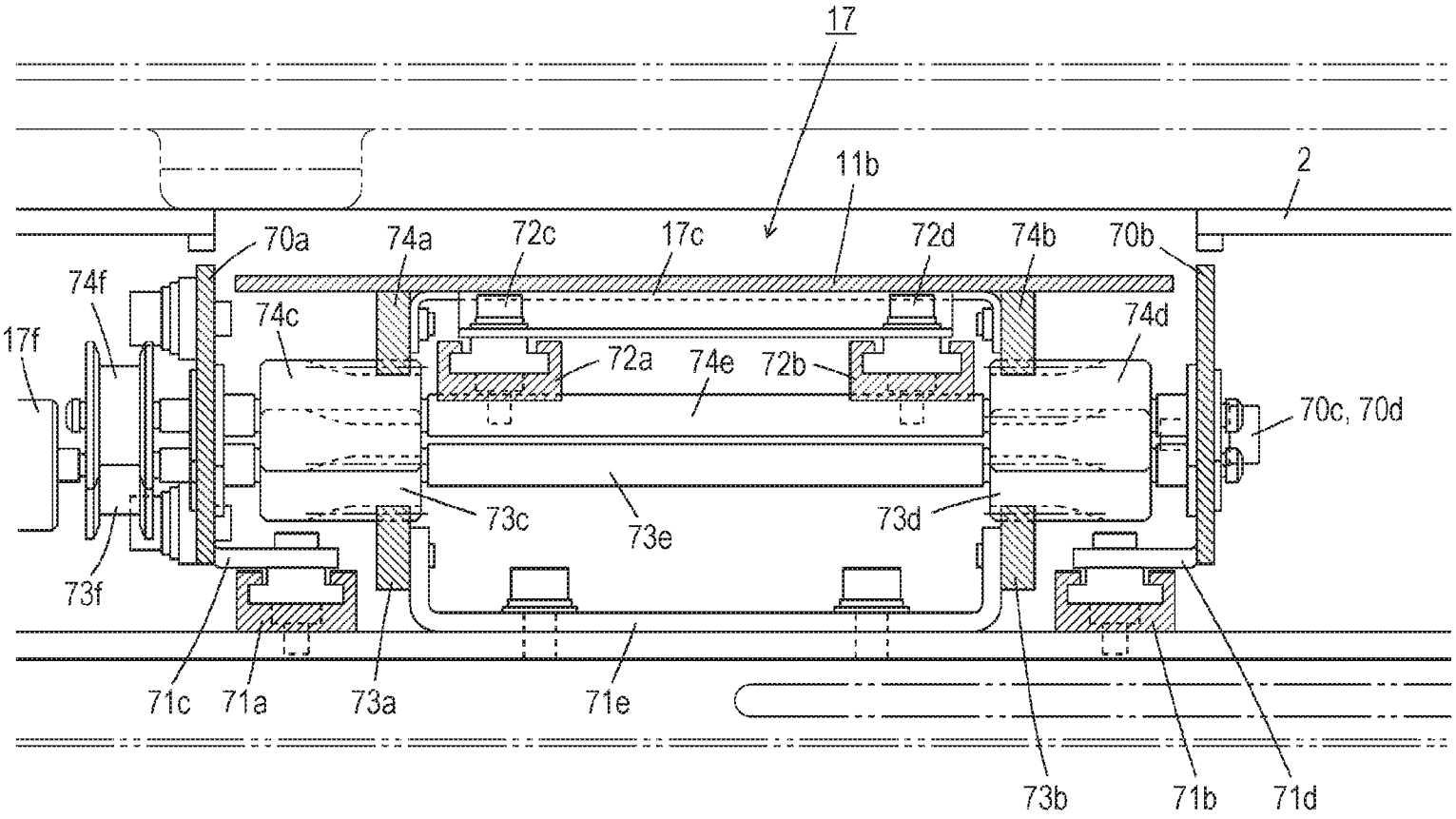
Figure 140:
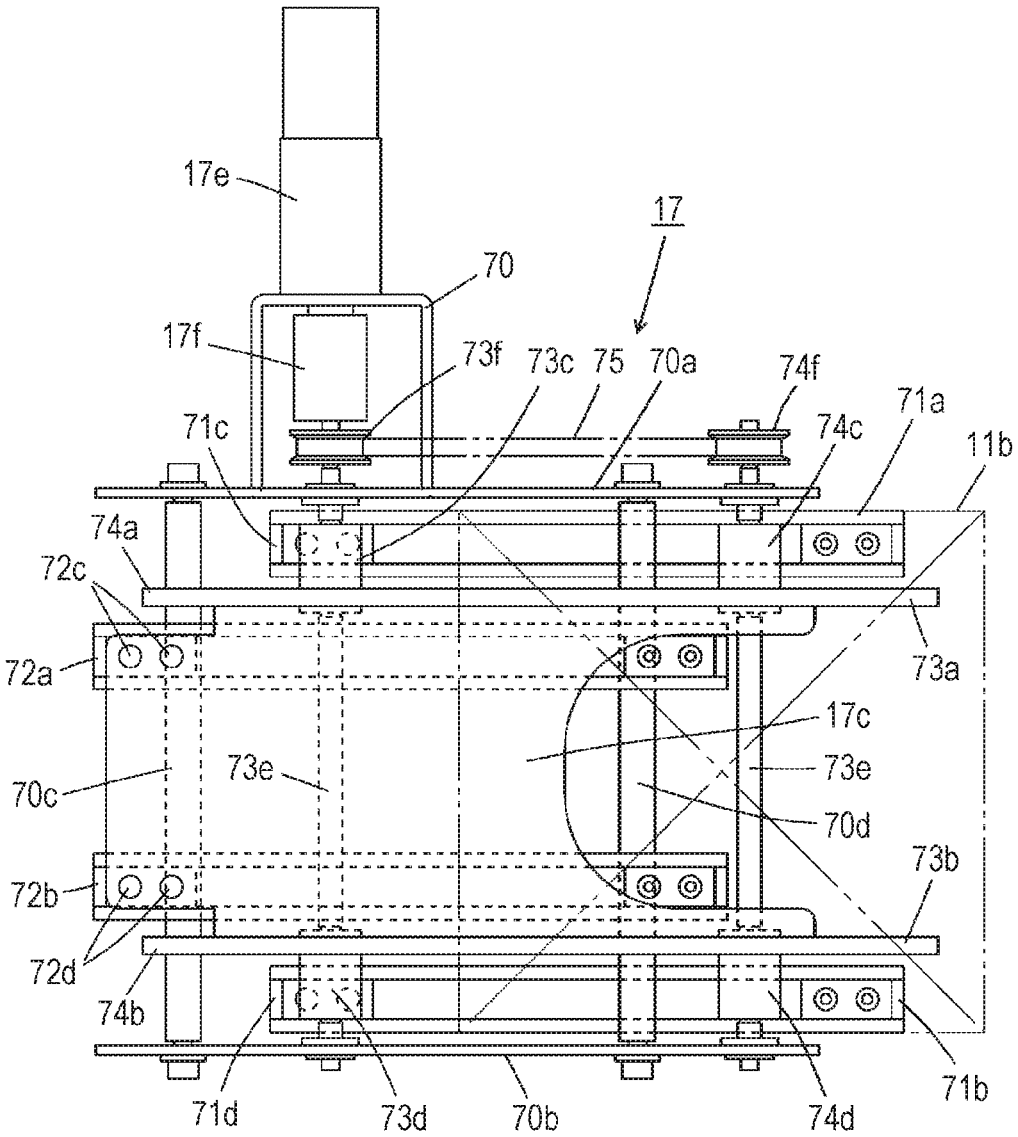
Figure 141:
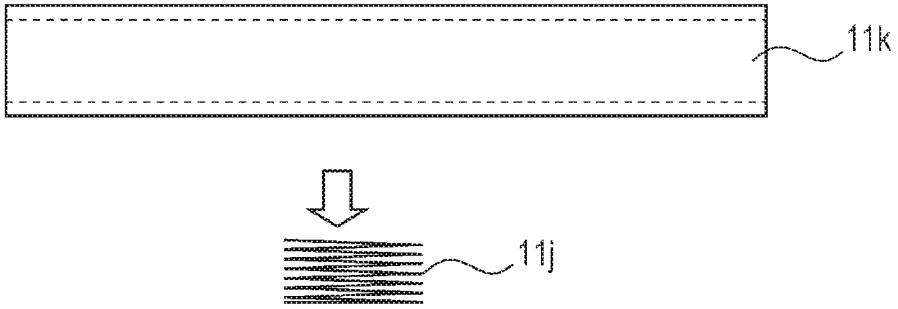
Figure 142:
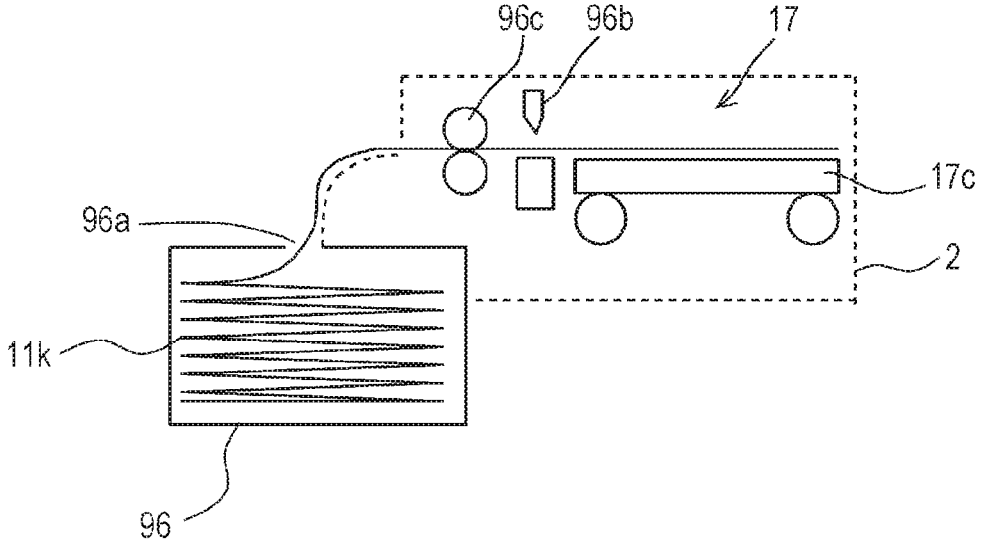
Figure 143:
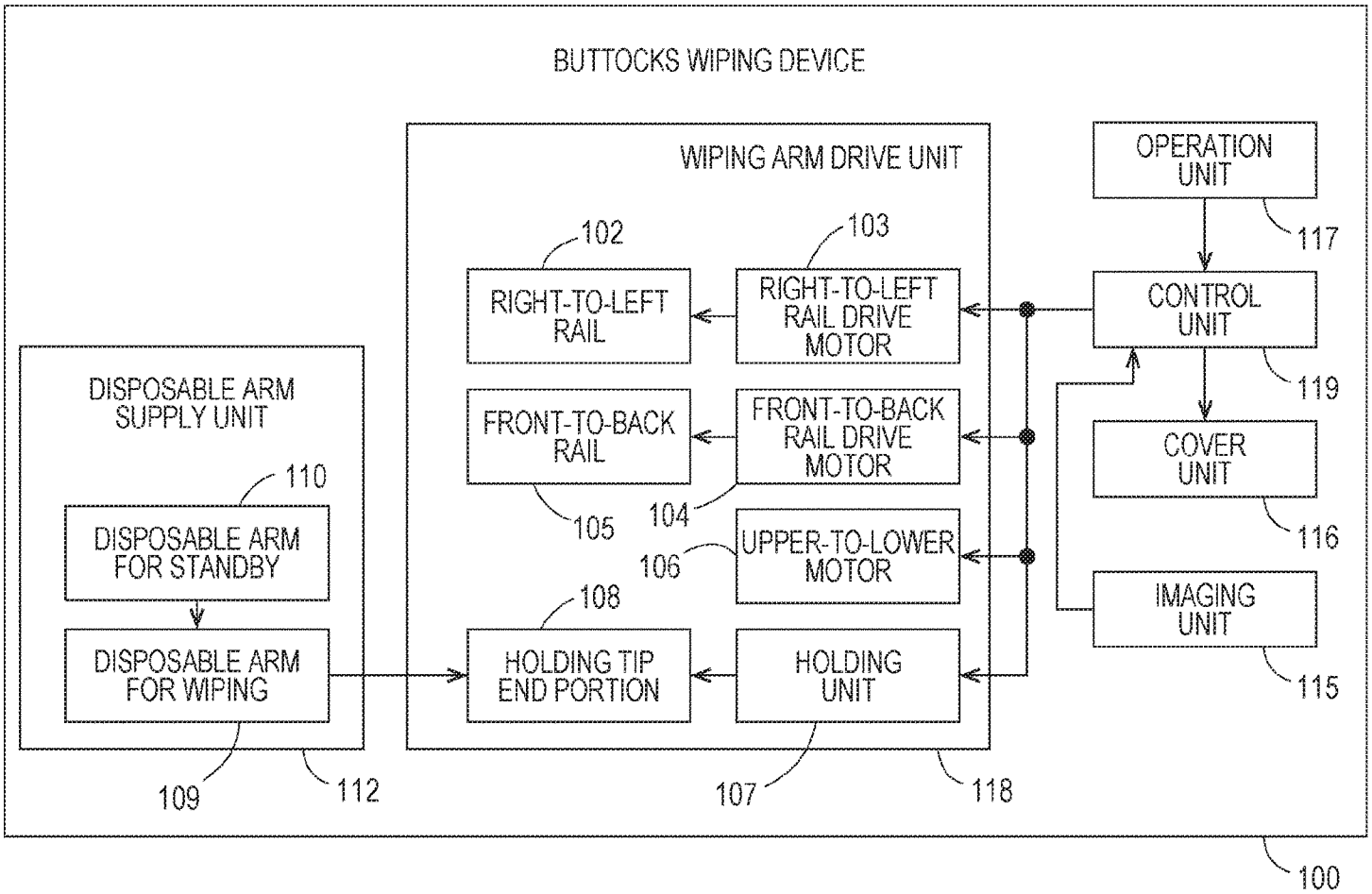
Figure 144:
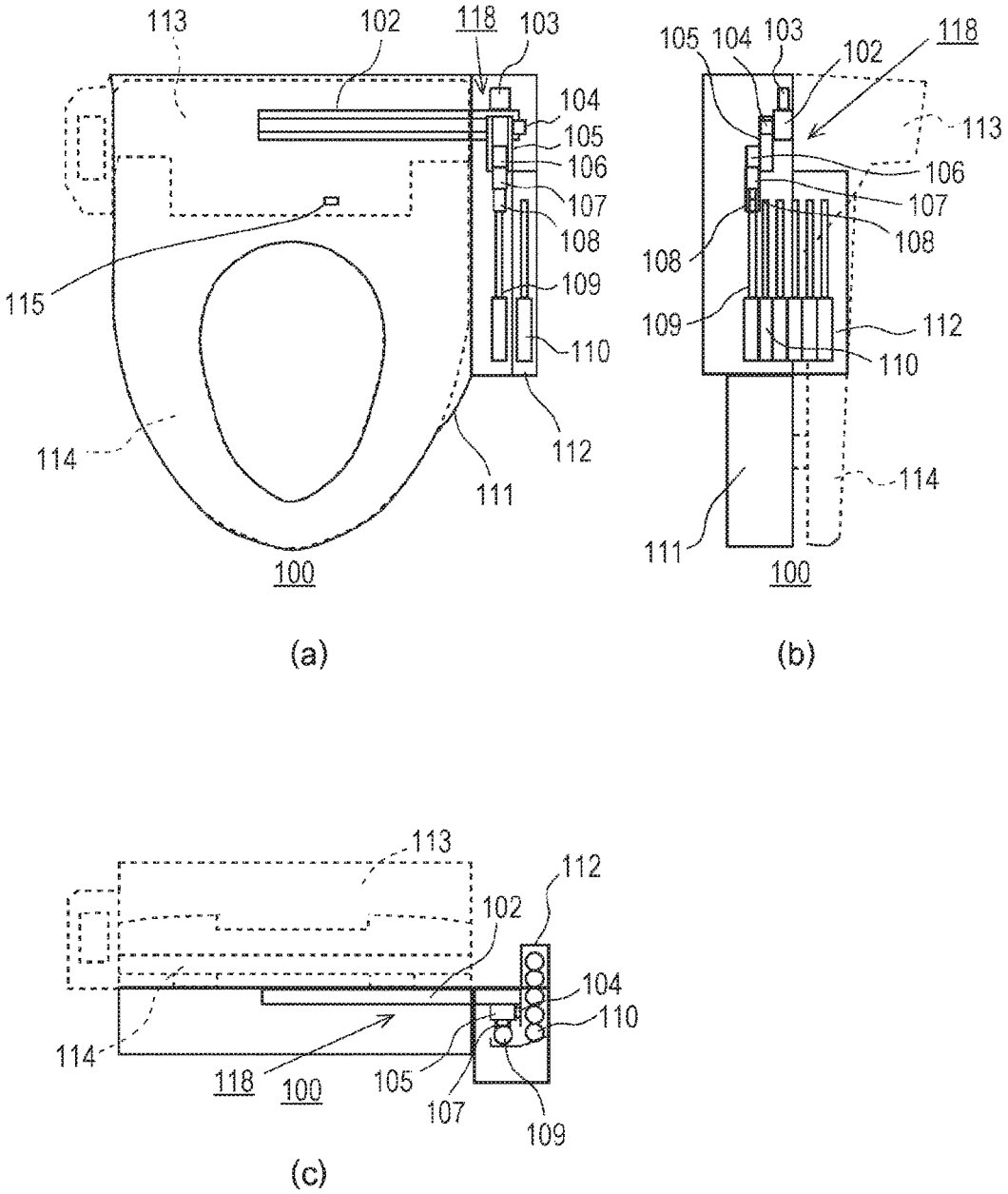
Figure 145:
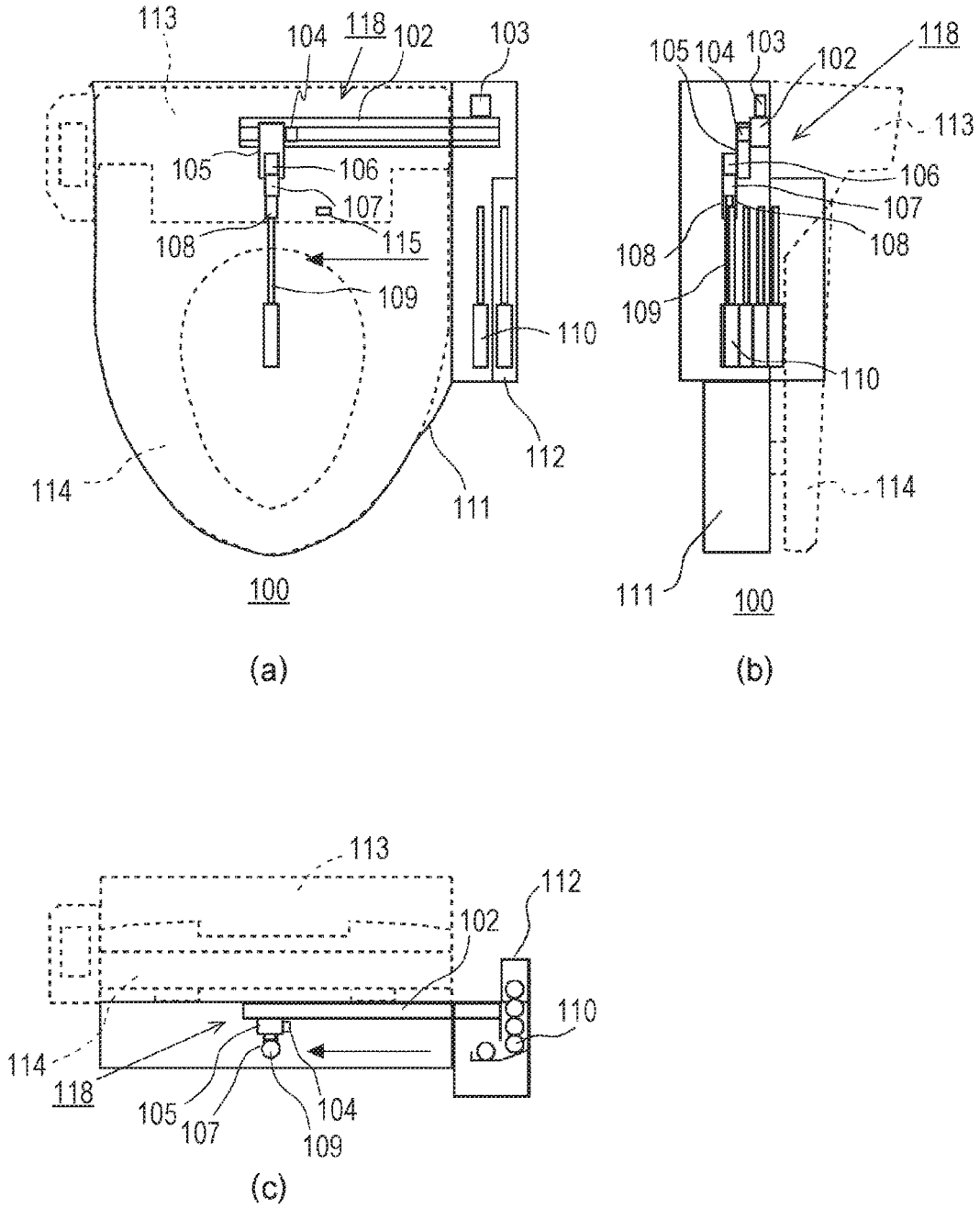
Figure 146:
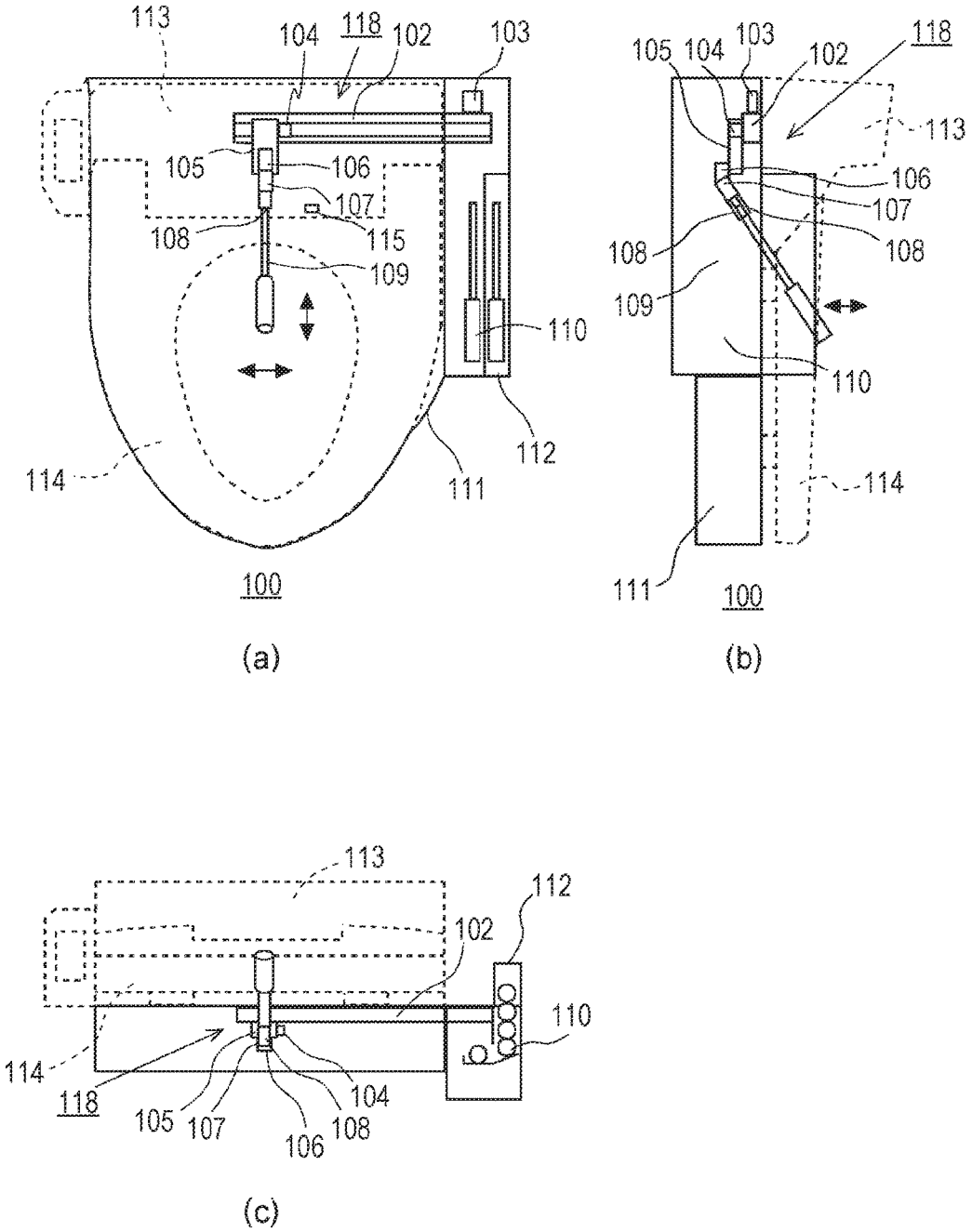
Figure 147:
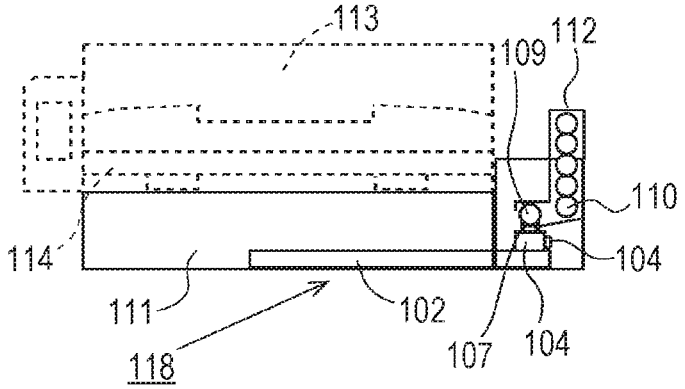
Figure 148:
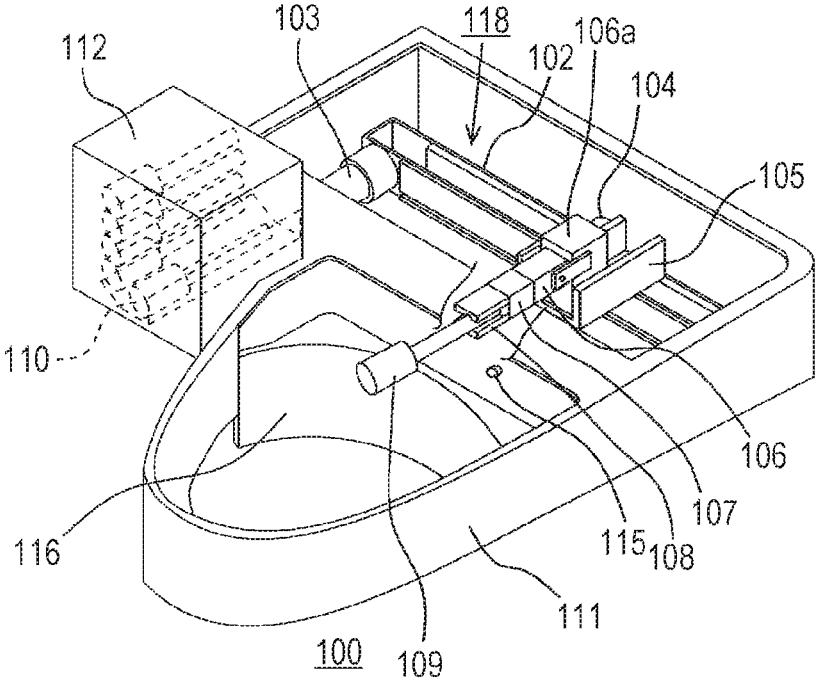
Figure 149:
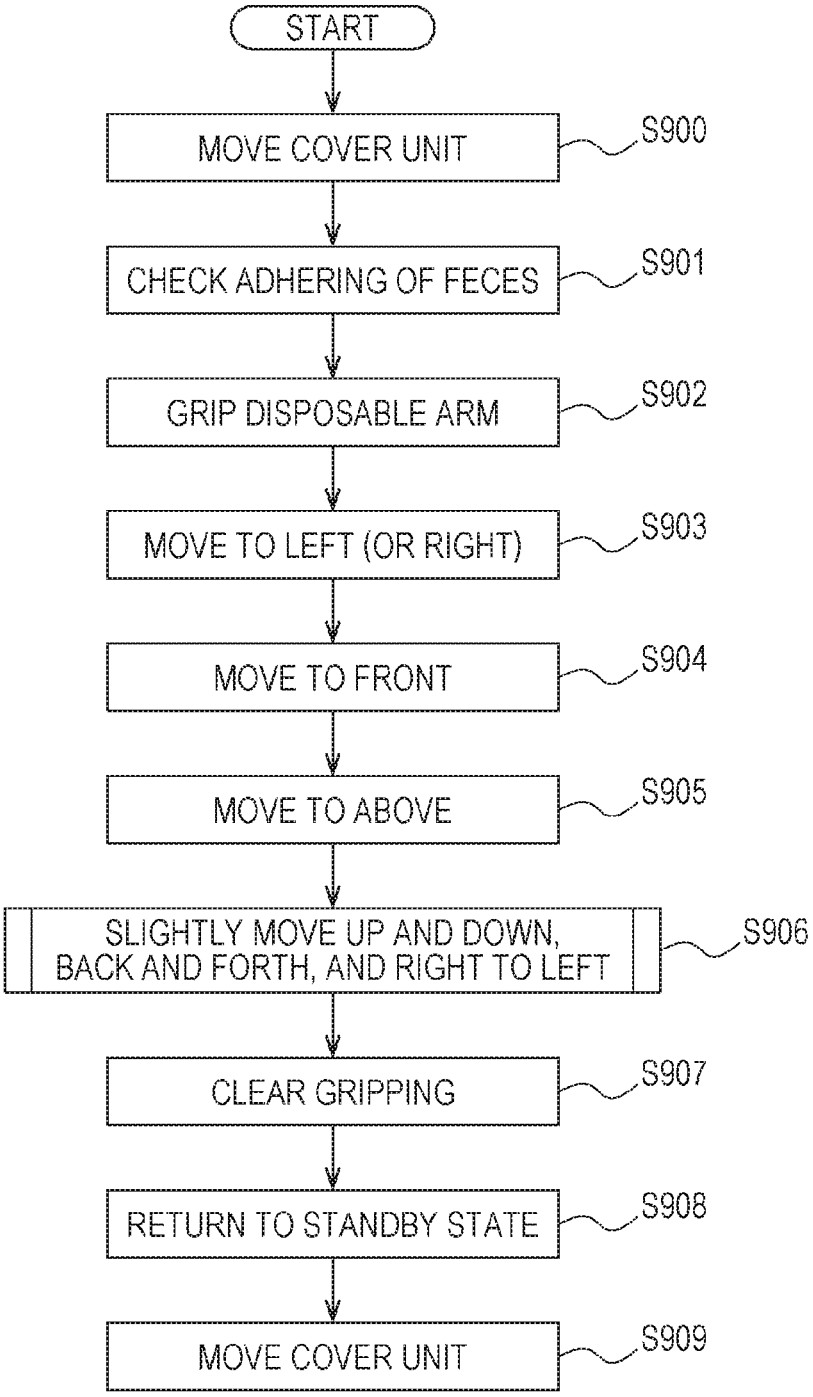
Figure 150:
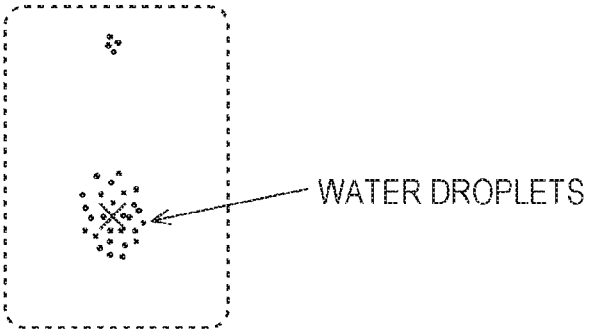
Figure 151:
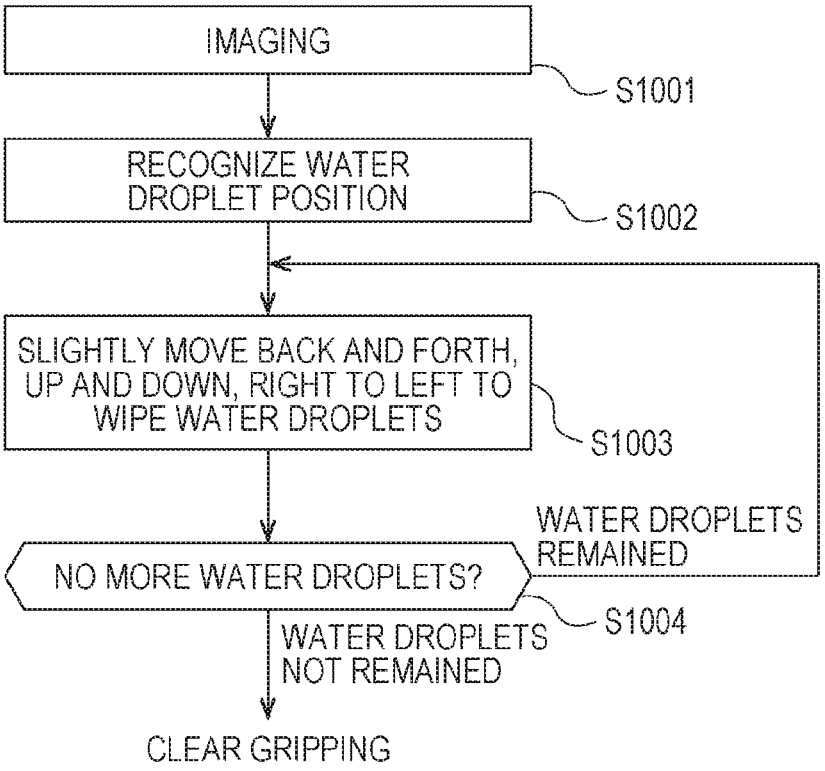
Figure 152:
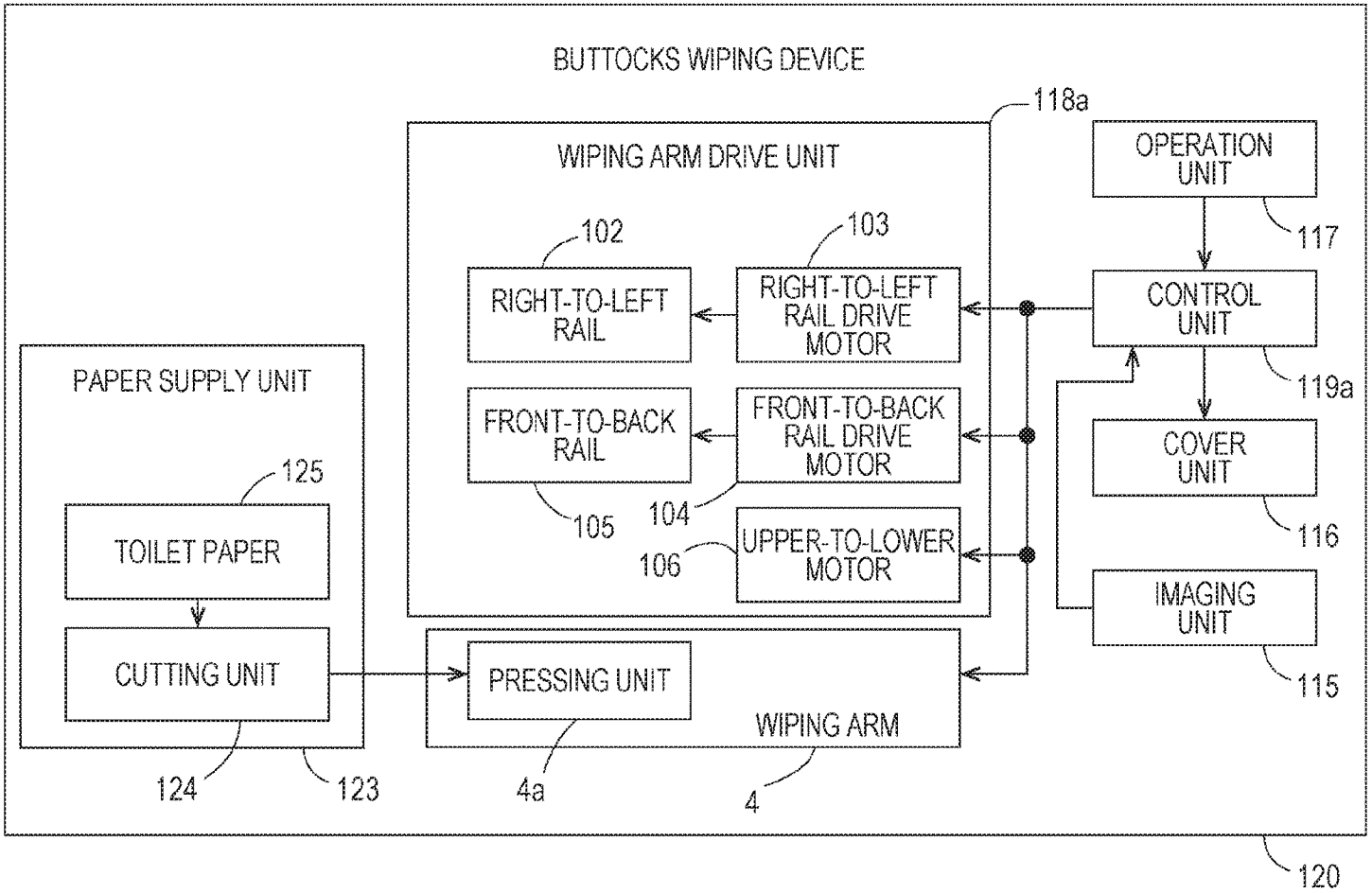
Figure 153:
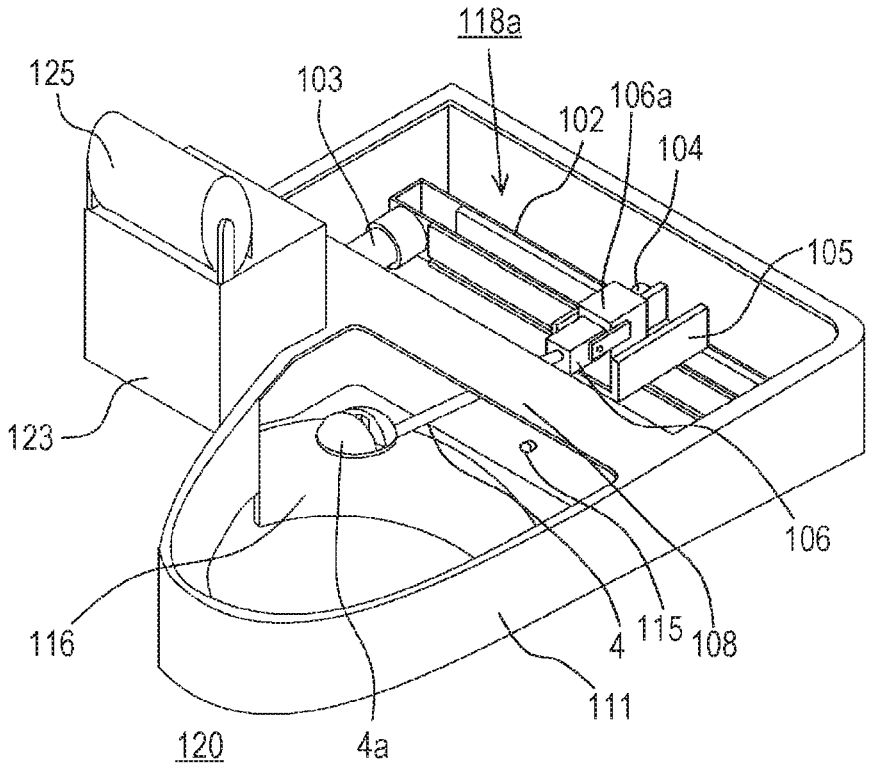
Figure 154:
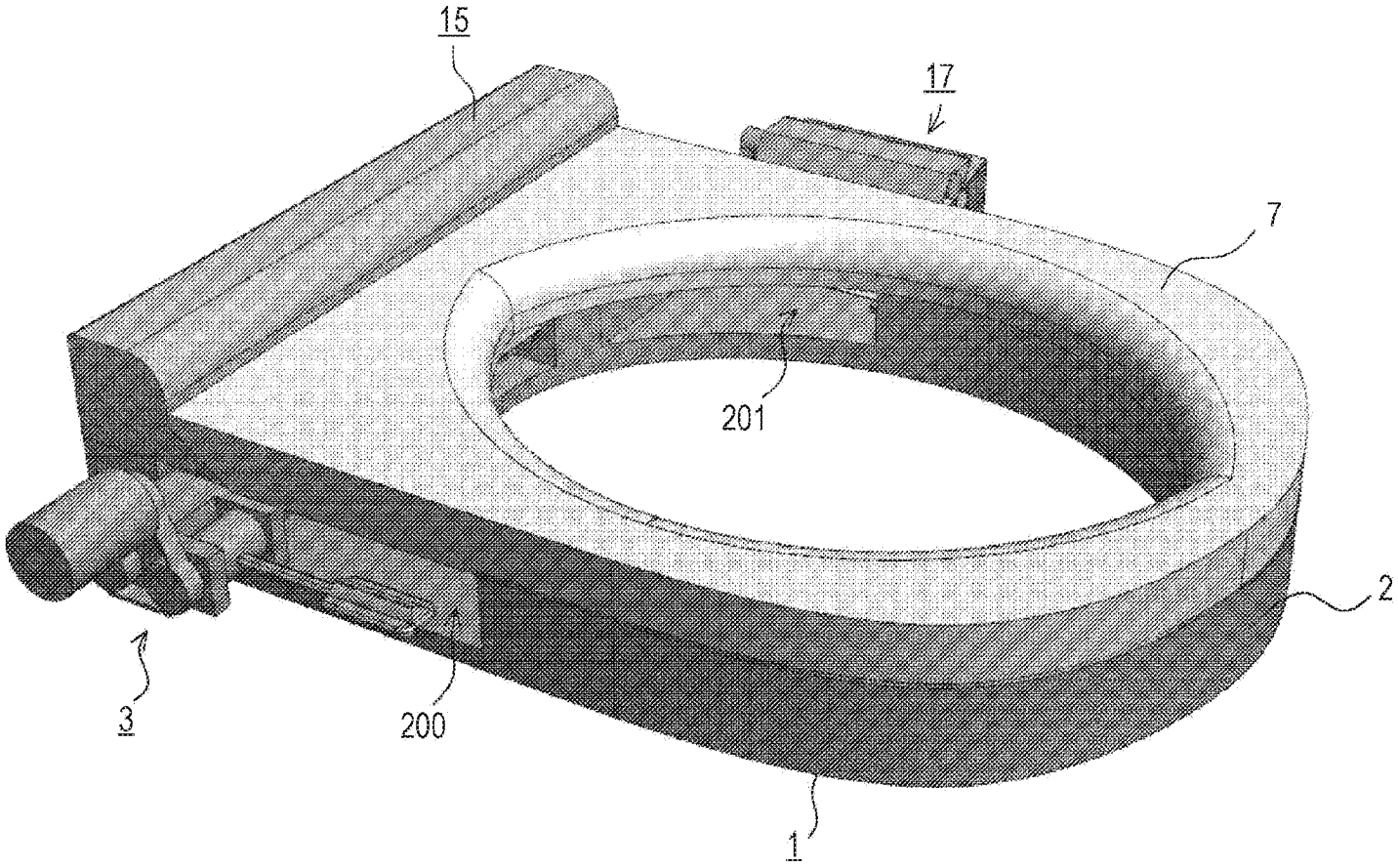
Figure 155:
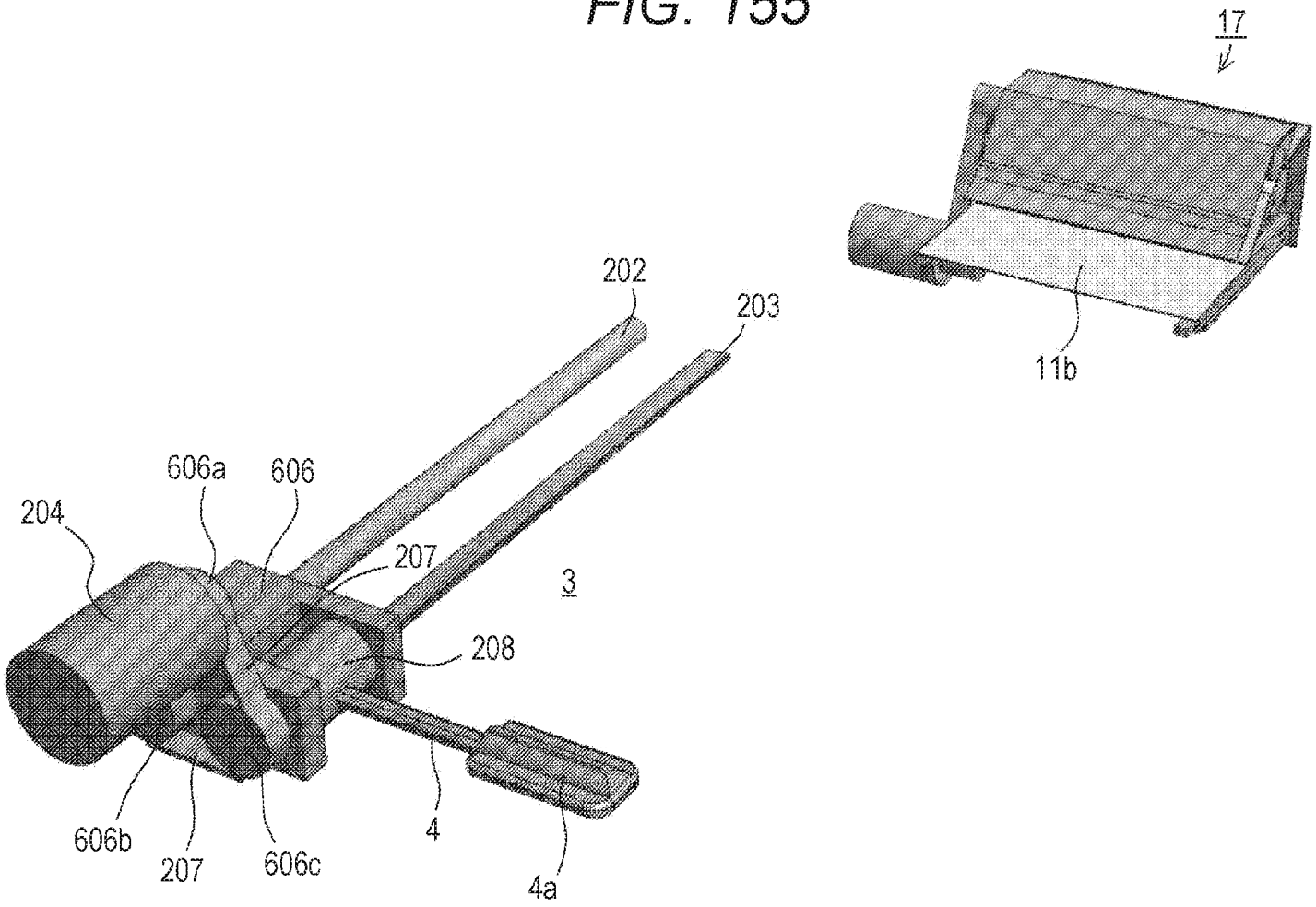
Figure 156:
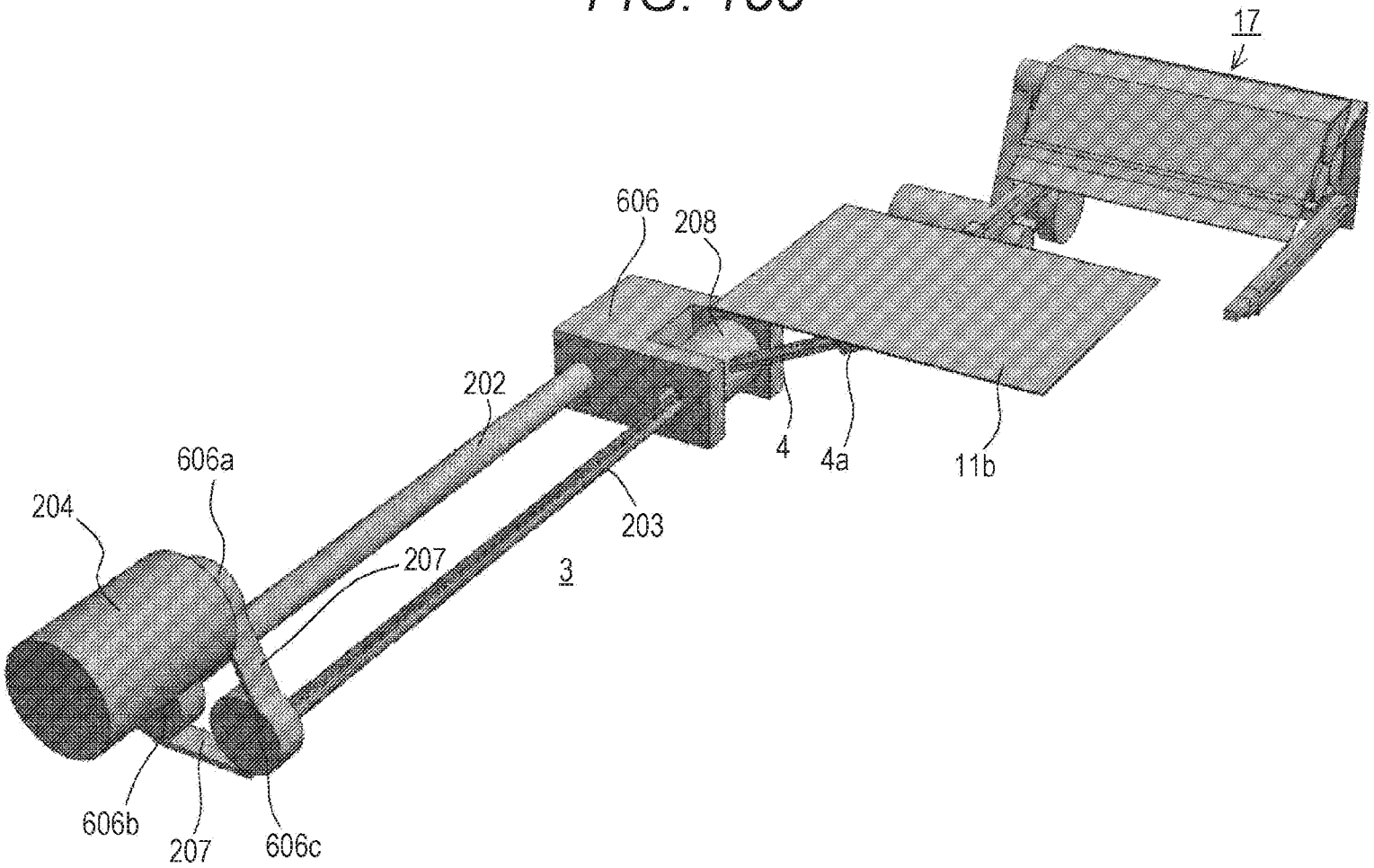
Figure 157:
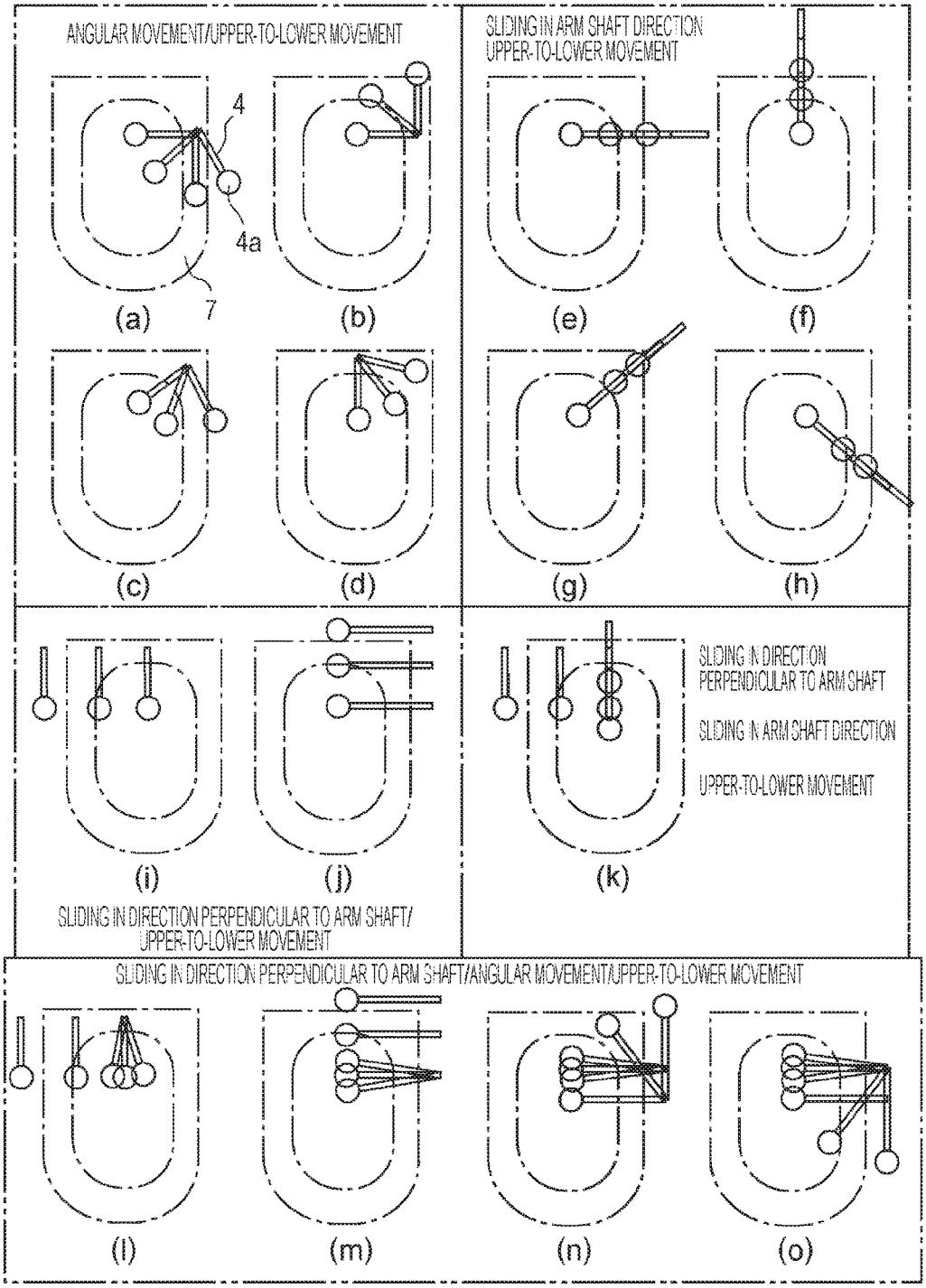
Figure 158:
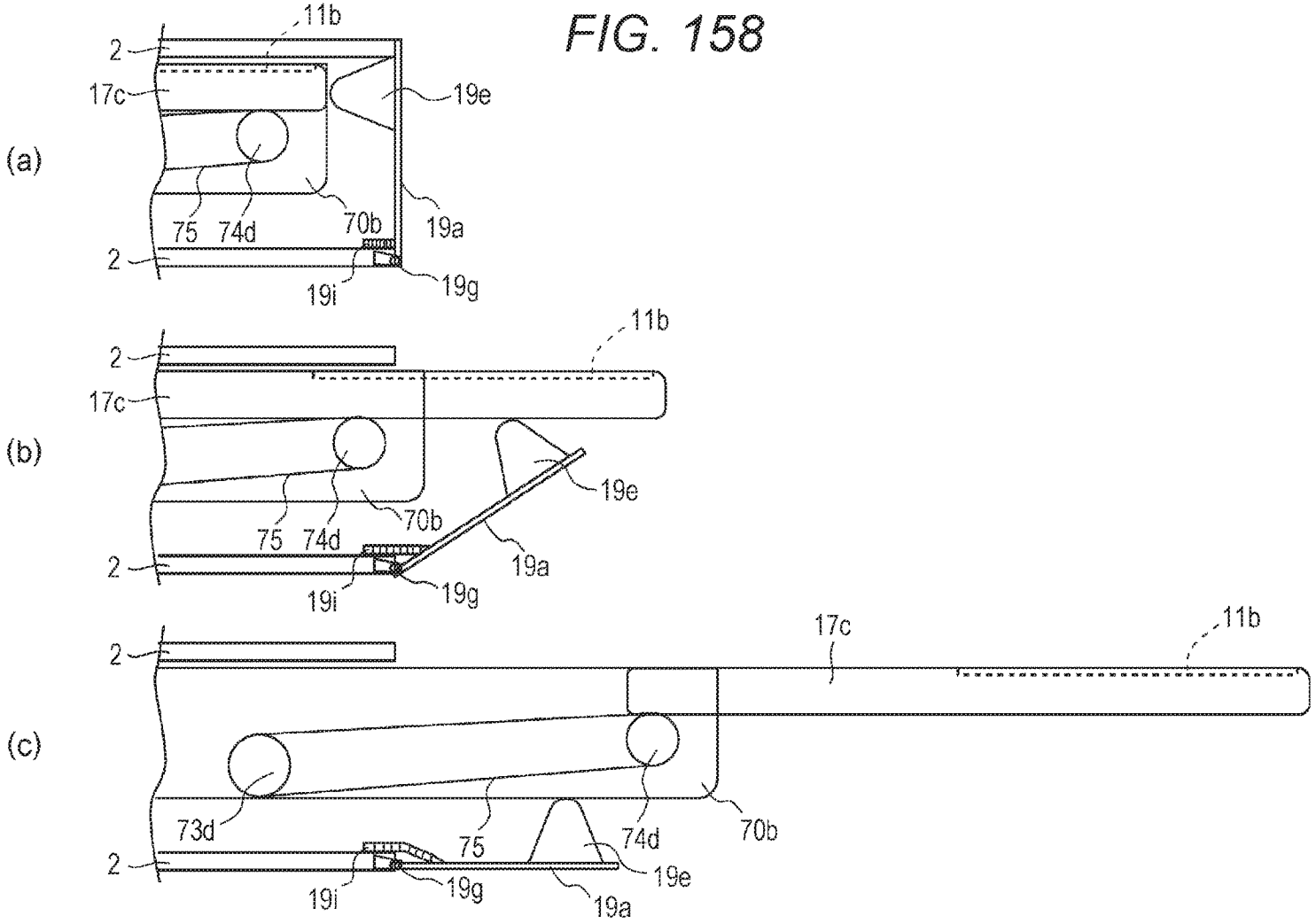

FIG. 113 is a view of the structure of a buttocks wiping device 1 of a twelfth embodiment;

FIG. 114 is a view of the structure of the buttocks wiping device 1 in the case of using a gear box;

FIG. 115 is a view for specifically describing a link mechanism 27*e* used at a coupling portion between a wiping arm 4 and a rotary shaft 29*a* of an upper-to-lower motor 8;

FIG. 116 is a sectional view of a vertical orientation structure for automatically supplying special paper 11*b* to a paper supply unit 17;

FIG. 117 is a sectional view of a diagonally-horizontal orientation structure for automatically supplying the special paper 11*b* to the paper supply unit 17;

FIG. 118 is a sectional view of the vertical orientation structure for automatically supplying the special paper 11*b* to the paper supply unit 17;

FIG. 119 is a sectional view of the vertical orientation structure for automatically supplying the special paper 11*b* to the paper supply unit 17;

FIG. 120 is a sectional view of the diagonally-horizontal orientation structure for automatically supplying the special paper 11*b* to the paper supply unit 17;

FIG. 121 is a view of an outer appearance of a portable toilet 31 in a standby state;

FIG. 122 is an exploded perspective view of the portable toilet 31;

FIG. 123 is an exploded perspective view of various mechanisms of the buttocks wiping device 1;

FIG. 124 is a perspective view of the portable toilet 31 when the special paper 11*b* and the wiping arm 4 are exposed;

FIG. 125 is a plan view of the portable toilet 31 when the special paper 11*b* and the wiping arm 4 are exposed;

FIG. 126 is a perspective view of the portable toilet 31 upon wiping;

FIG. 127 is a front view of the portable toilet 31 upon wiping;

FIG. 128 is a perspective view of the portable toilet 31 including an odor elimination device 50;

FIG. 129 is a flowchart of an example of the step of manufacturing the special paper;

FIG. 130 is a view of a mechanism of a manufacturing device configured to manufacture the special paper 11*b* without folding;

FIG. 131 is a view of another mechanism of the manufacturing device configured to manufacture the special paper 11*b* without folding;

FIG. 132A is a plan view of an internal structure of the portable toilet 31;

FIG. 132B is a block diagram of a functional configuration of the buttocks wiping device 1 used for the portable toilet 31;

FIG. 132C is a flowchart of operation of the buttocks wiping device 1;

FIG. 133 is front view of the internal structure of the portable toilet 31;

FIG. 134 is a right side view of the internal structure of the portable toilet 31;

FIG. 135A is a plan view of an internal structure of the buttocks wiping device 1 in the portable toilet 31;

FIG. 135B is a block diagram of the functional configuration of the buttocks wiping device 1;

FIG. 135C is a flowchart of operation of the buttocks wiping device 1;

FIG. 136 is a front view of the internal structure of the buttocks wiping device 1;

FIG. 137 is a perspective view of the structure including a wiping arm drive unit 3 and the wiping arm 4;

FIG. 138 is a front view of movement transition of the wiping arm 4 in a link mechanism of the wiping arm drive unit 3;

FIG. 139 is a left side view of an internal structure of the paper supply unit 17;

FIG. 140 is a plan view of the internal structure of the paper supply unit 17 when a paper loading guide 17*c* is retracted;

FIG. 141 is a view of continuous folded special paper 11*k* formed in such a manner that continuous multiple pieces of special paper;

FIG. 142 is a view of an outline structure of an automatic paper supply device when the continuous special paper 11*k* is used;

FIG. 143 is a block diagram of a functional configuration of a buttocks wiping device 100 using disposable arms 109, 110;

FIG. 144(*a*) is a plan view of the buttocks wiping device 100, FIG. 144(*b*) is a right side view of the buttocks wiping device 100, and FIG. 144(*c*) is a front view of the buttocks wiping device 100;

FIGS. 145(*a*) to 145(*c*) are a plan view, a right side view, and a front view of the buttocks wiping device 100 when moved to a center position;

FIGS. 146(*a*) to 146(*c*) are a plan view, a right side view, and a front view of the buttocks wiping device 100 when moved to an exposed position;

FIG. 147 is a front view when right-to-left rails 102 are arranged on a bottom surface of a housing portion;

FIG. 148 is a perspective view of an internal structure of the buttocks wiping device 100 in a case where a disposable arm supply unit 112 is disposed on the left;

FIG. 149 is a flowchart of operation of the buttocks wiping device 100;

FIG. 150 is a schematic view of an image of the buttocks acquired by an imaging unit 115;

FIG. 151 is a flowchart specifically showing operation at a step S906 of FIG. 149;

FIG. 152 is a block diagram of a functional configuration of a buttocks wiping device 120 using a wiping arm;

FIG. 153 is a perspective view of an internal structure of the buttocks wiping device 120;

FIG. 154 is a perspective view of a buttocks wiping device 1;

FIG. 155 is a perspective view of a paper supply unit 17 and a wiping arm drive unit 3 housed in a raised portion 2;

FIG. 156 is a perspective view of the paper supply unit 17 and the wiping arm drive unit 3 upon wiping;

FIG. 157 is a schematic view collectively illustrating movement patterns of a wiping arm 4;

FIG. 158 is a sectional view of the structure of a paper-supply-side opening/closing unit 19*a;*

Figure 159:
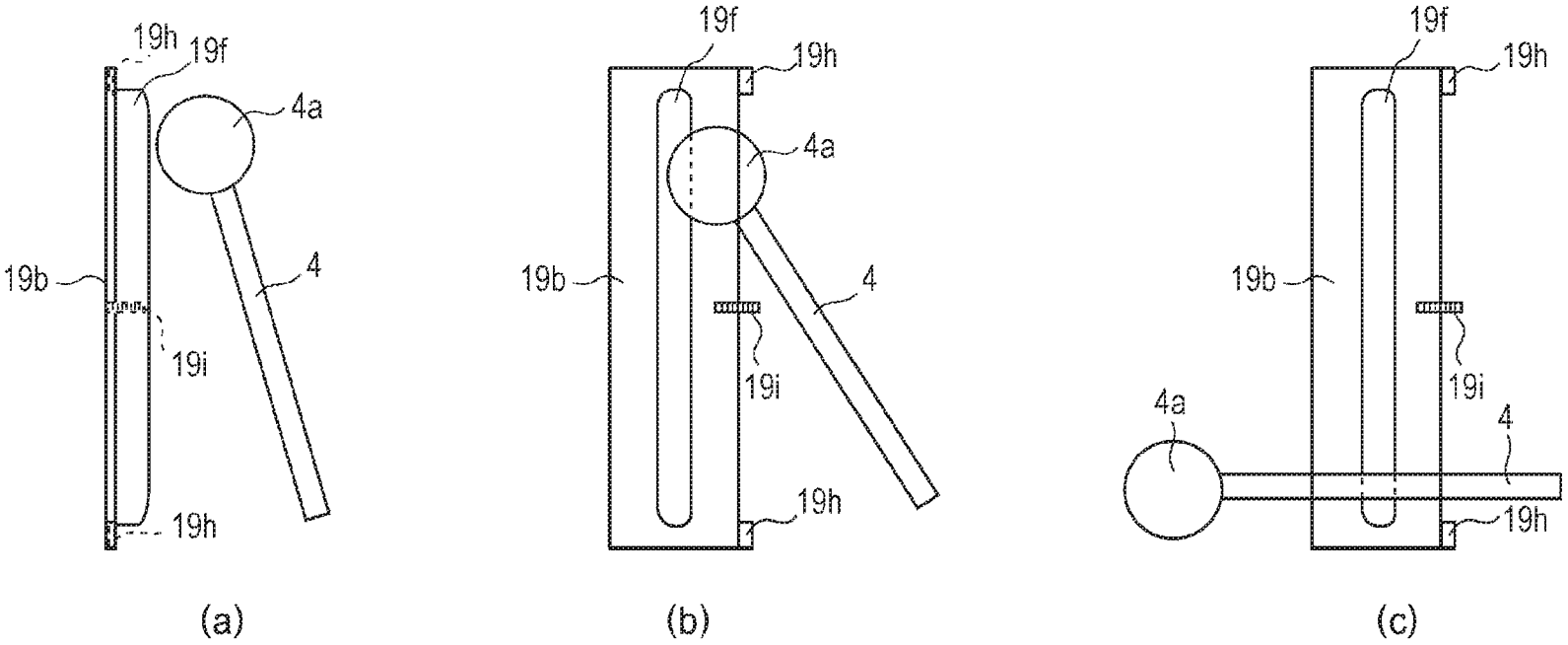

FIG. 159 is a plan view of the structure of an arm-side opening/closing unit 19*b;*

Figure 160A:
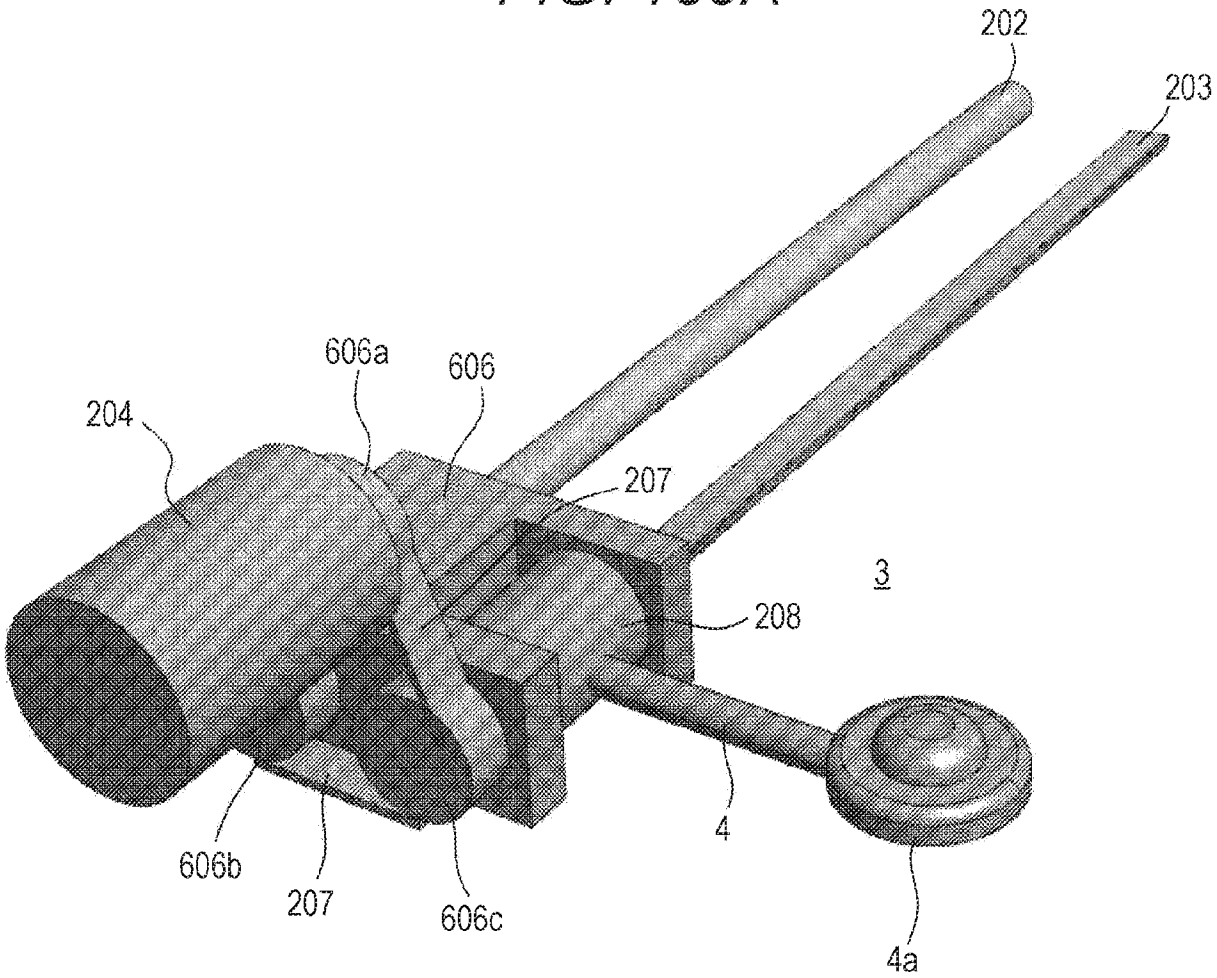
Figure 160B:
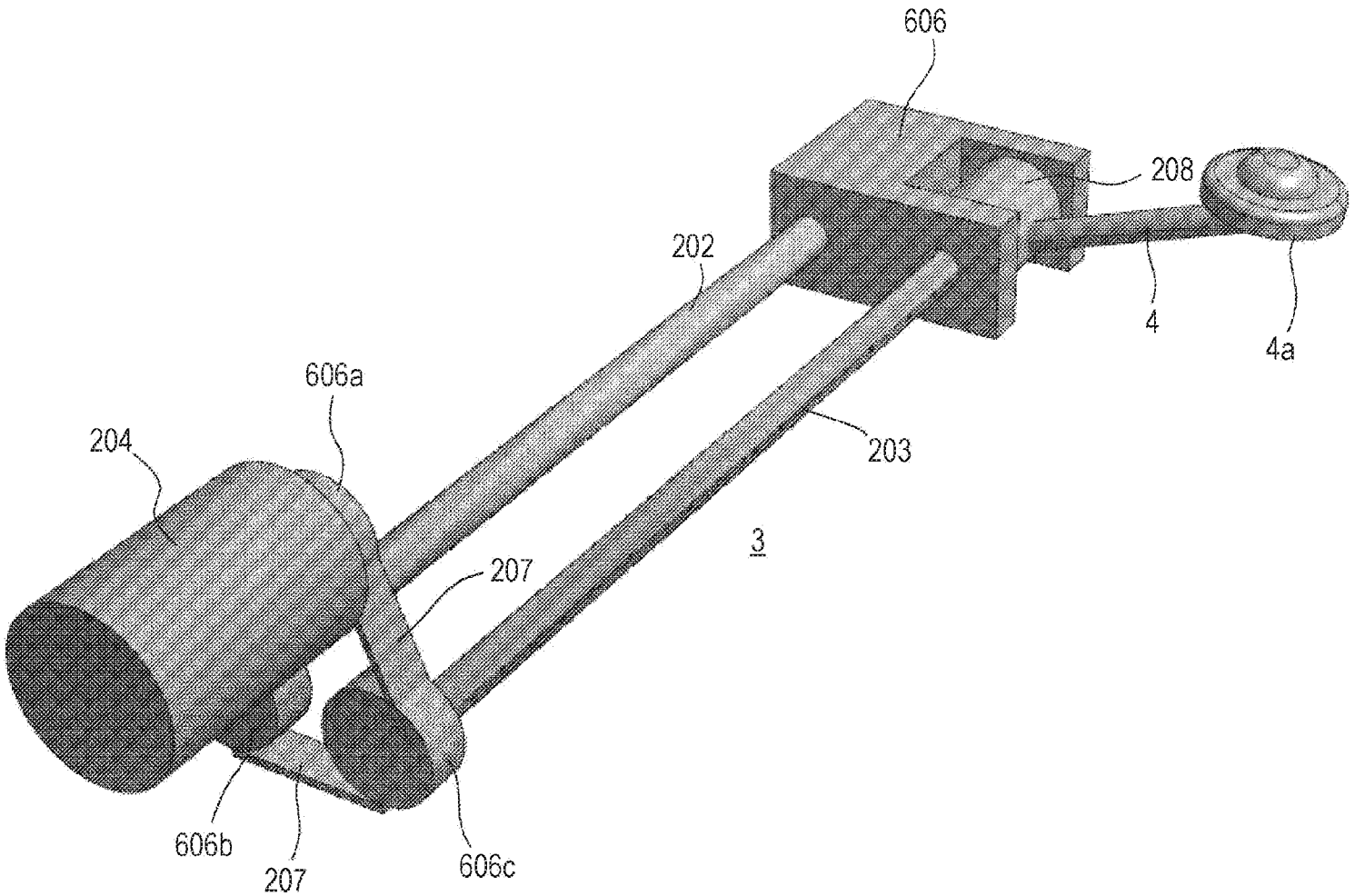
Figure 161:
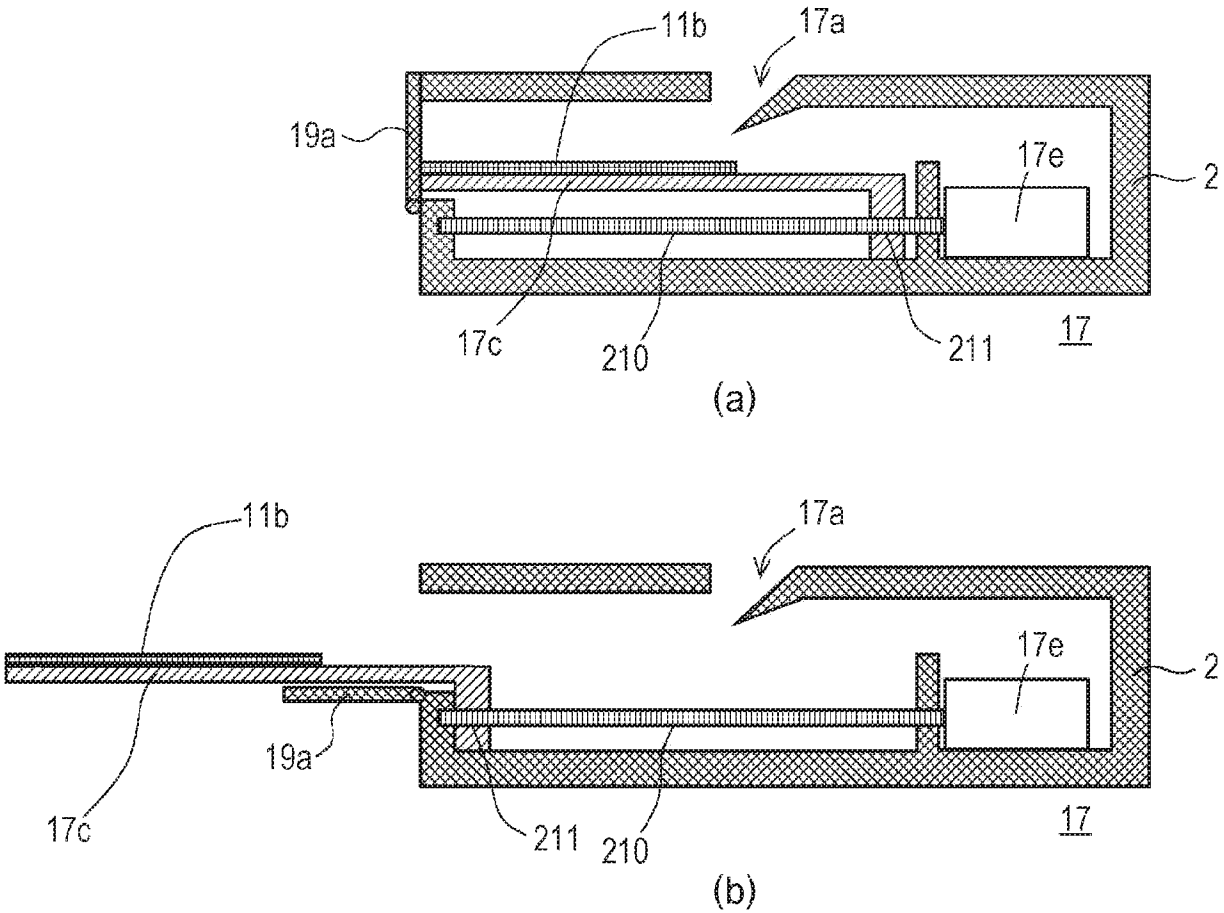

FIG. 160A is a view of a variation of a thirteenth embodiment;

FIG. 160B is a view of a state when the wiping arm 4 is exposed and moved upward;

FIG. 161 is a sectional view of a variation of the mechanism of the paper supply unit 17 for driving a paper loading guide 17*c:*

Figure 162A:
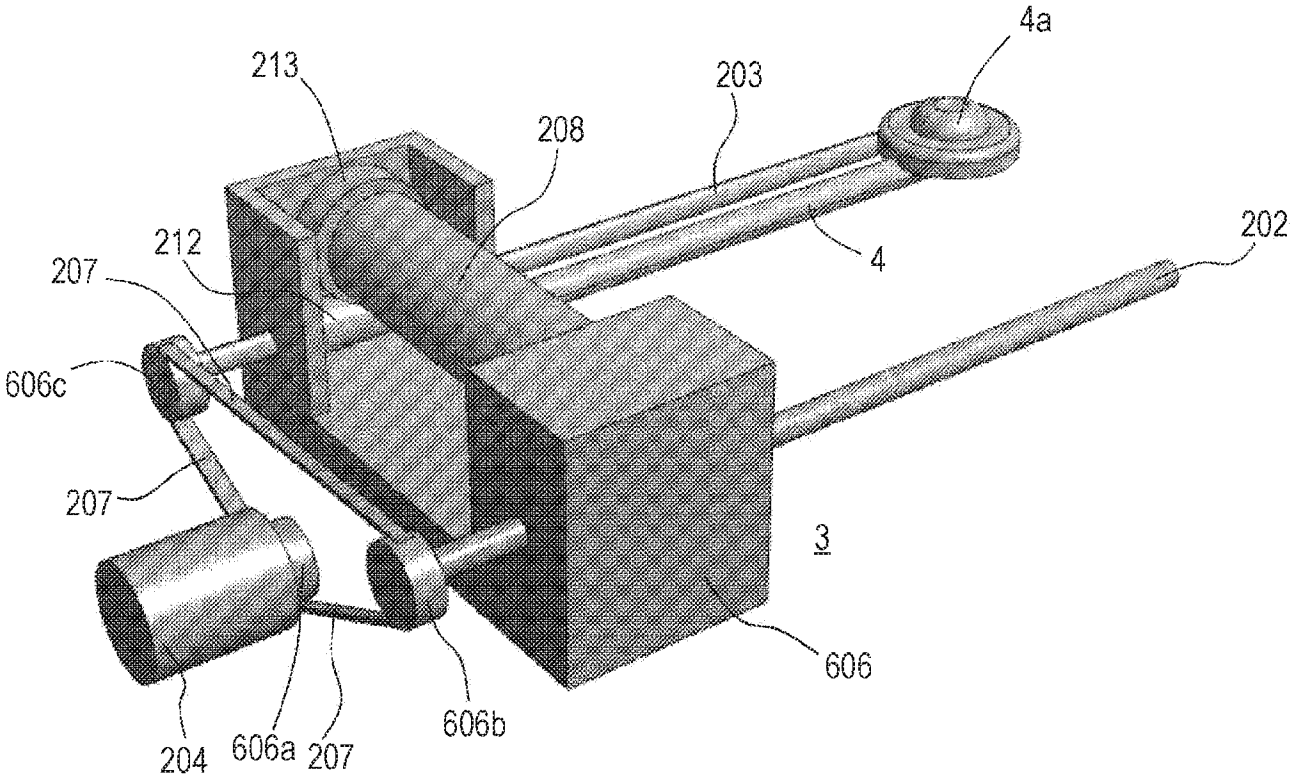
Figure 162B:
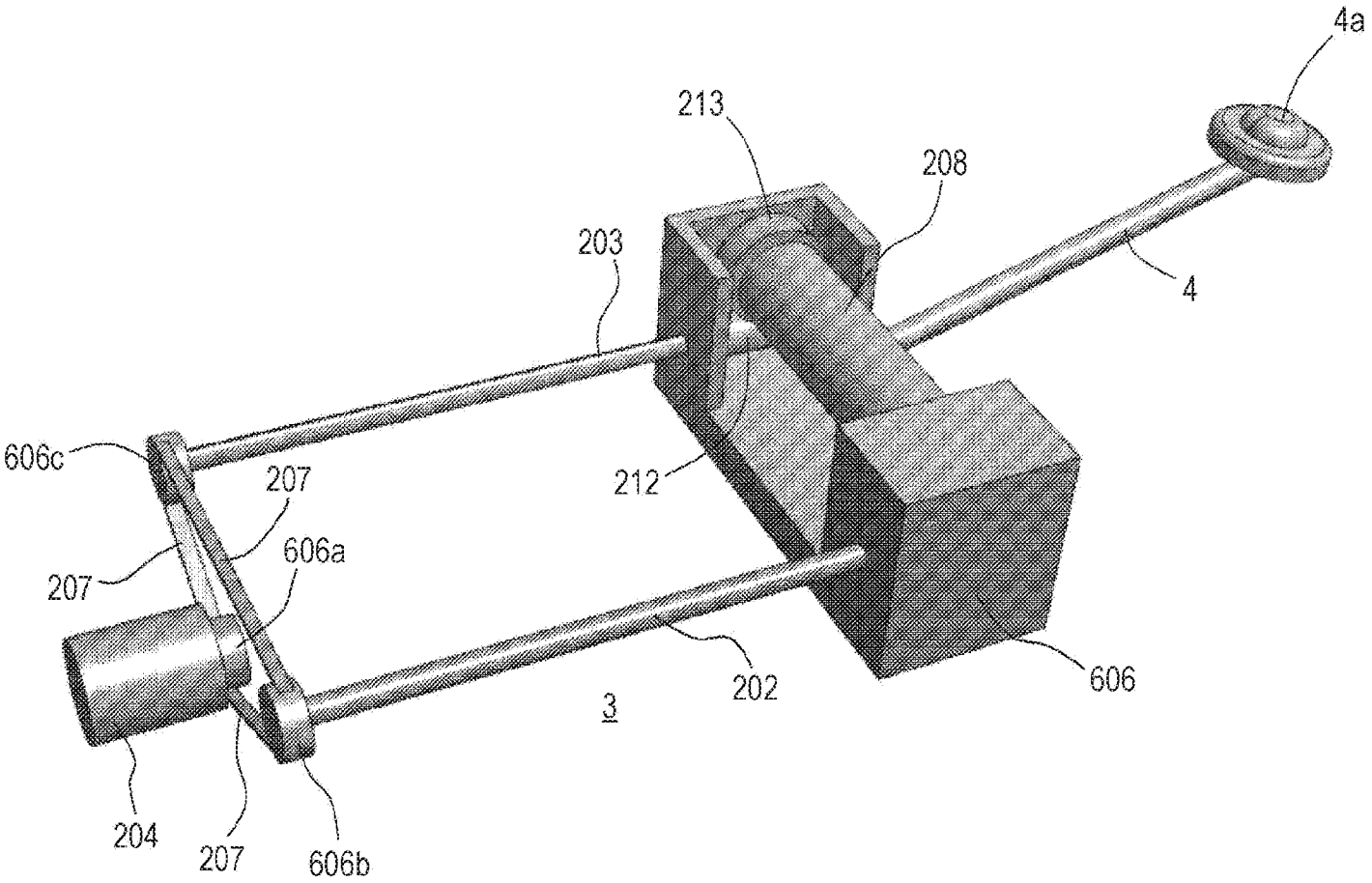
Figure 163:
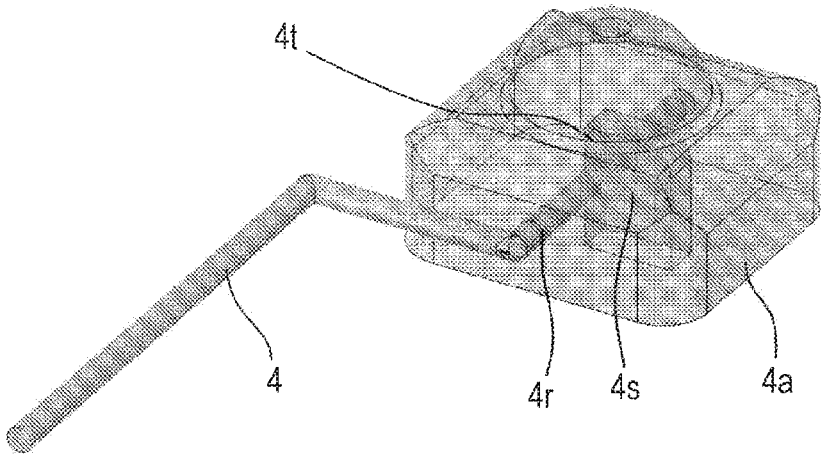
Figure 164:
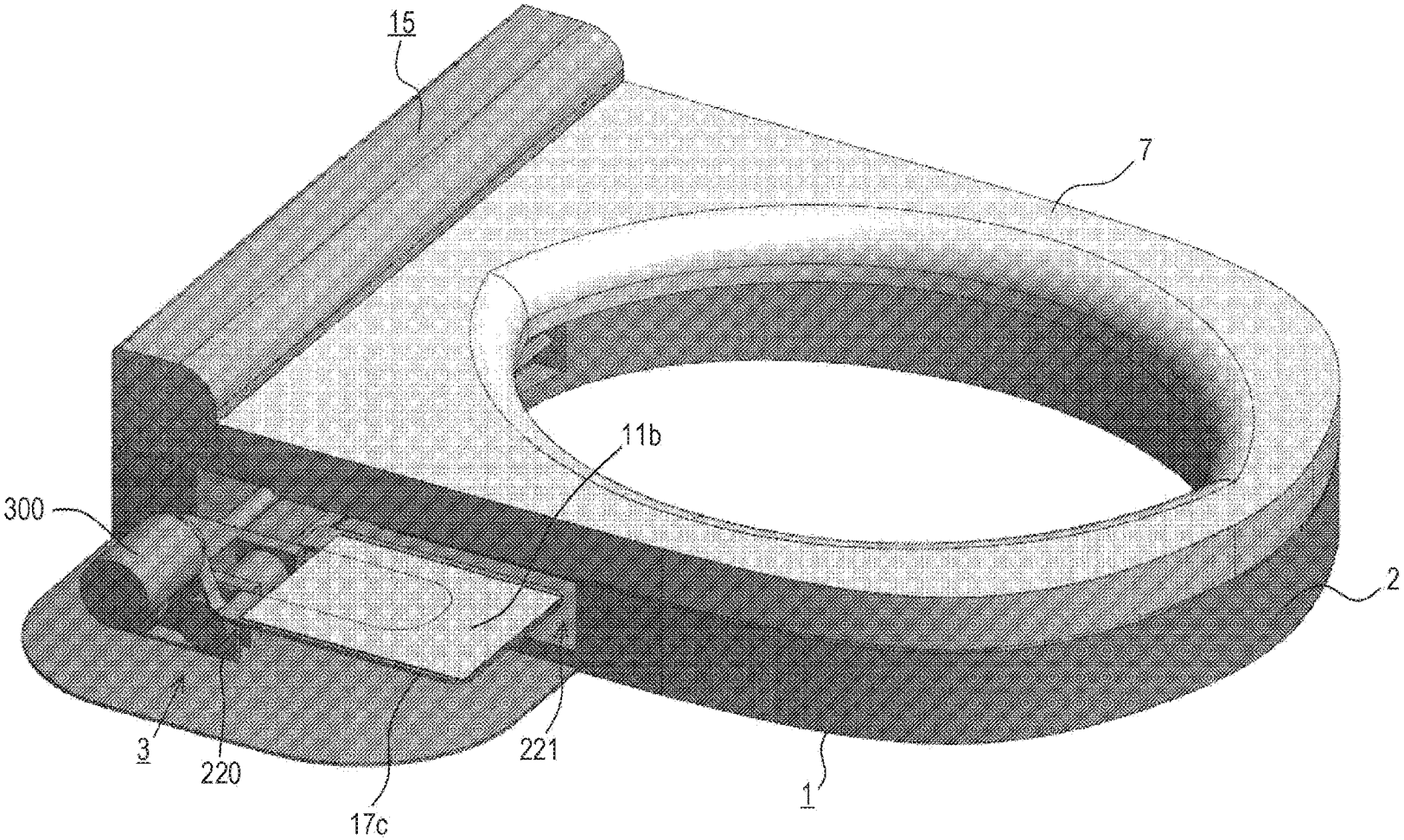
Figure 165:
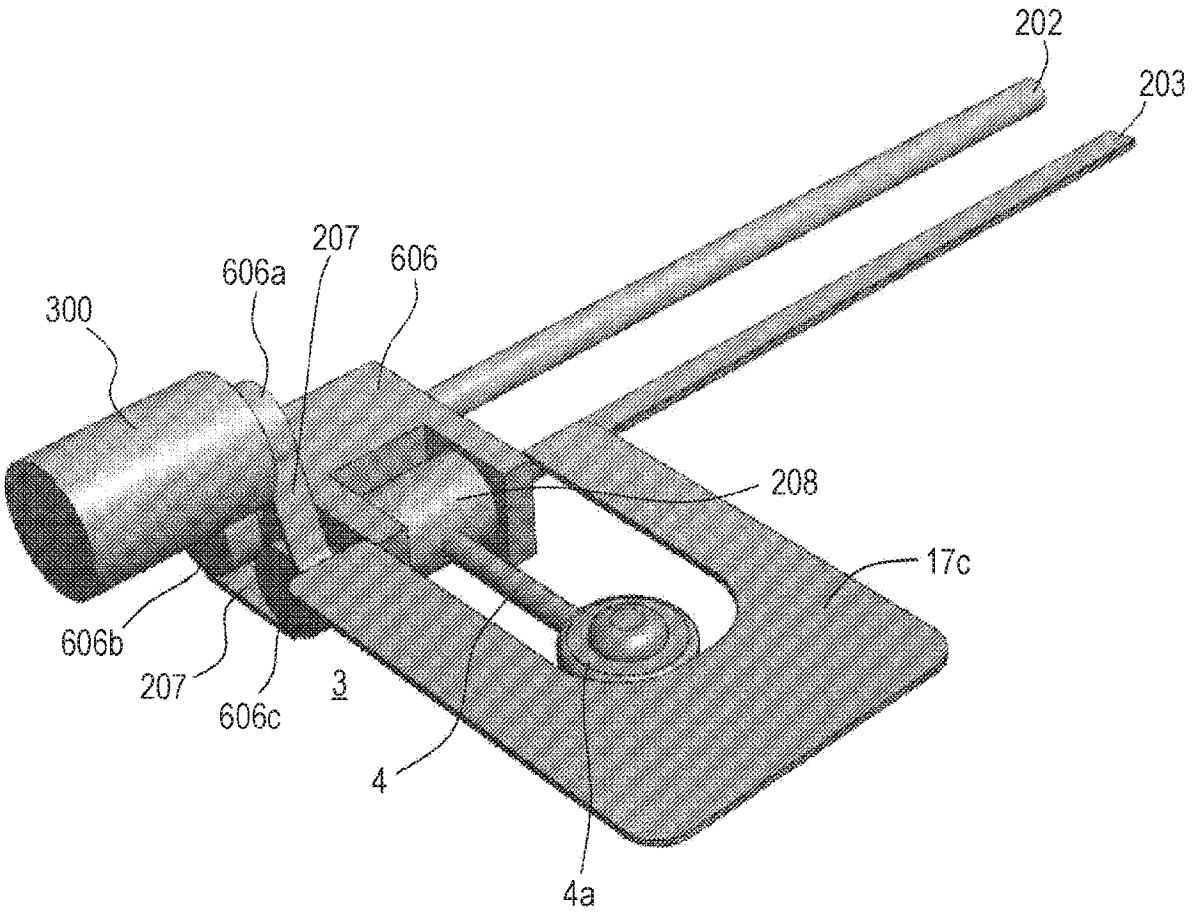

FIG. 162A is a perspective view of a variation of the wiping arm drive unit 3 when the wiping arm 4 is retracted;

FIG. 162B is a perspective view when the wiping arm 4 is exposed and inclined upward;

FIG. 163 is a perspective view clarifying an internal structure of the wiping arm 4;

FIG. 164 is a perspective view of a buttocks wiping device 1 of a fourteenth embodiment;

FIG. 165 is a perspective view of a wiping arm drive unit 3 and a paper loading guide 17*c;*

Figure 166:
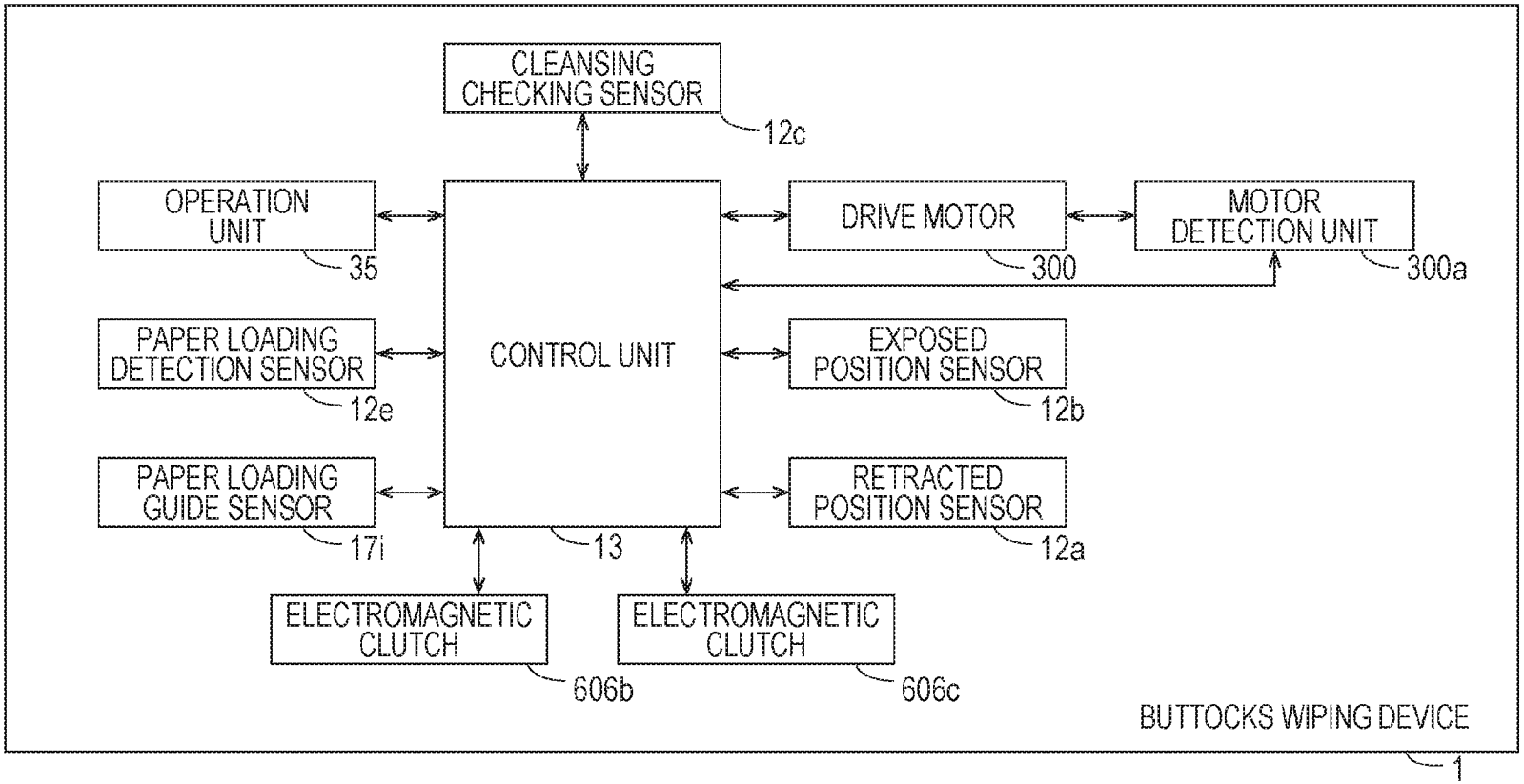
Figure 167:
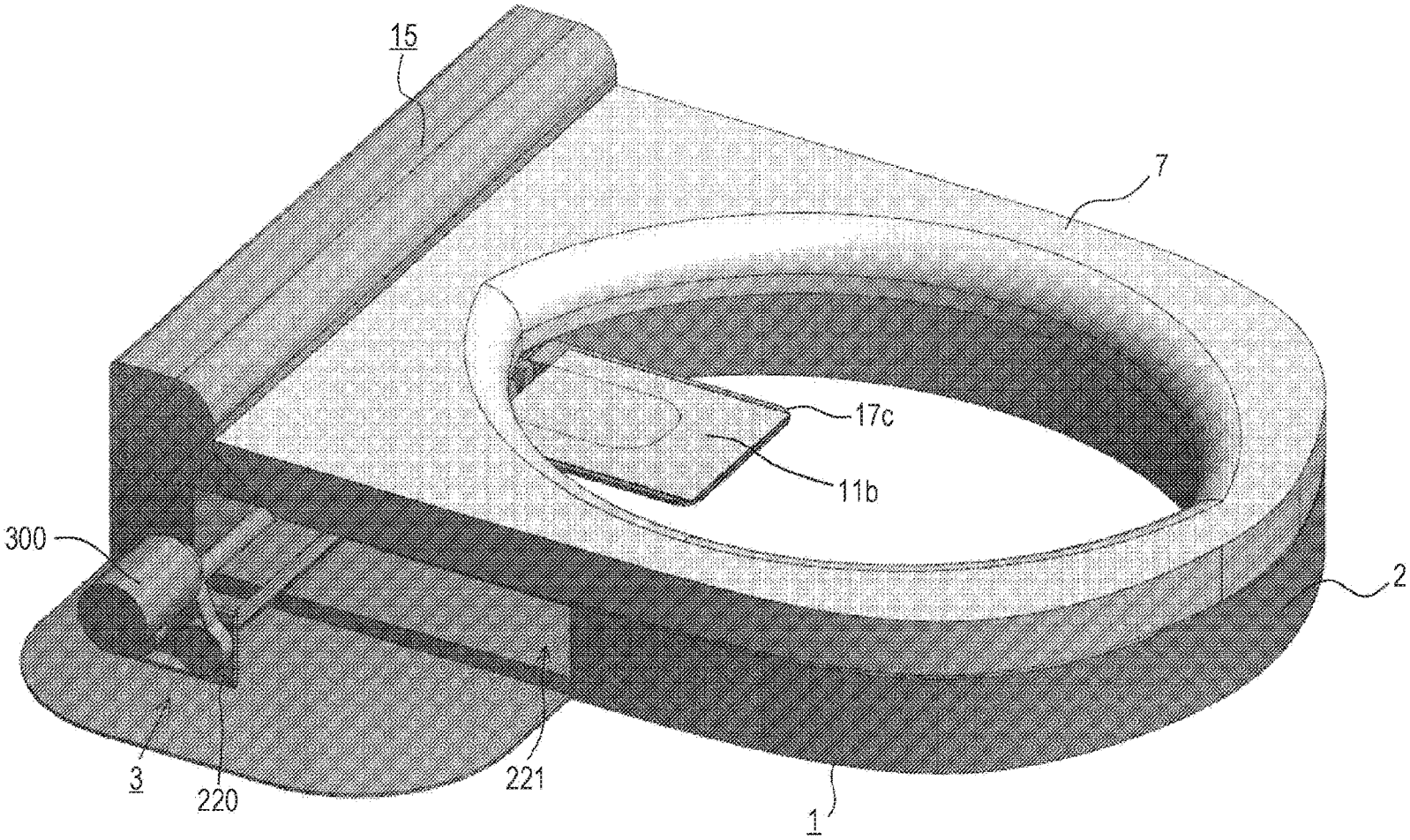
Figure 168:
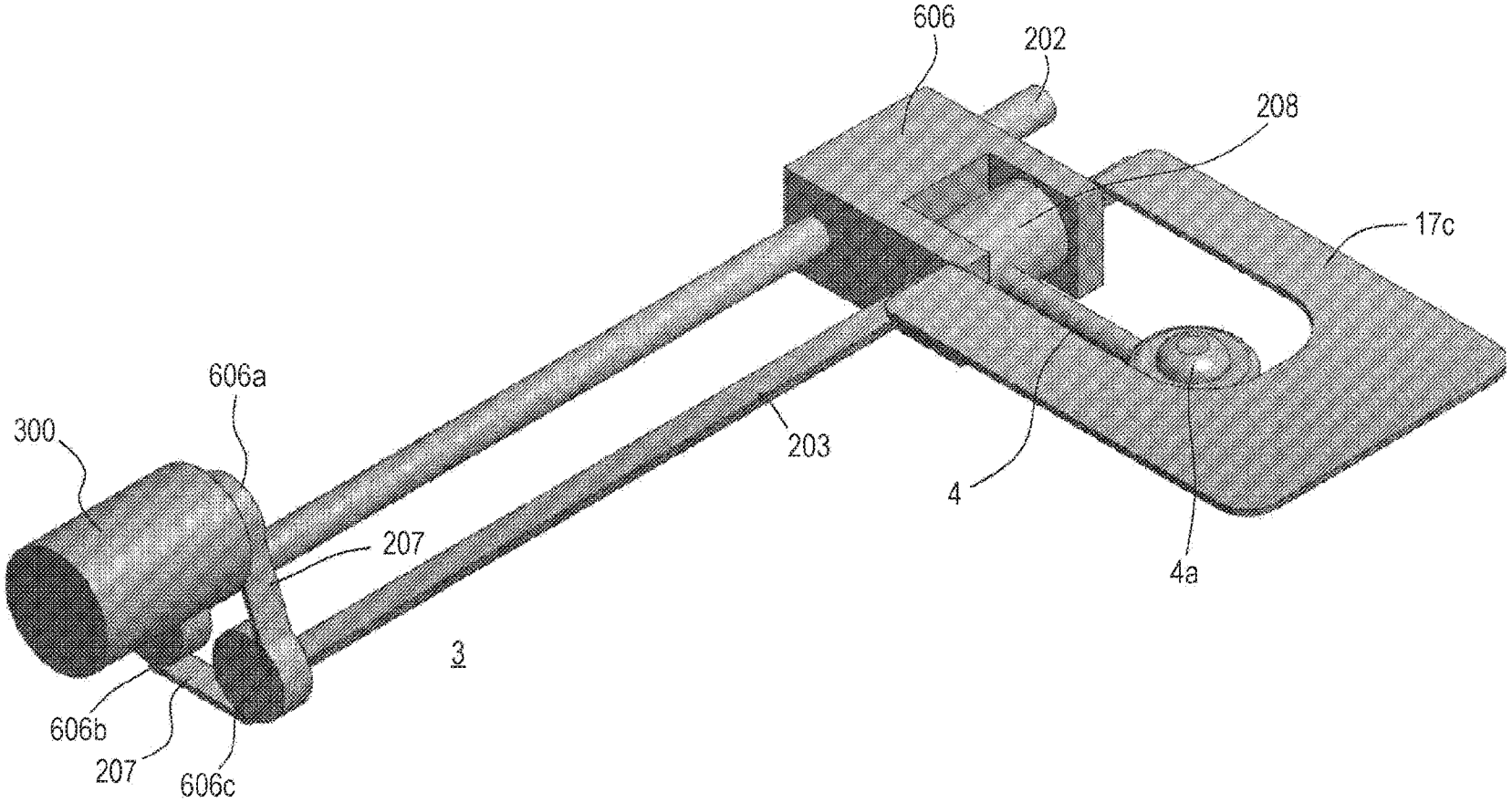
Figure 169A:
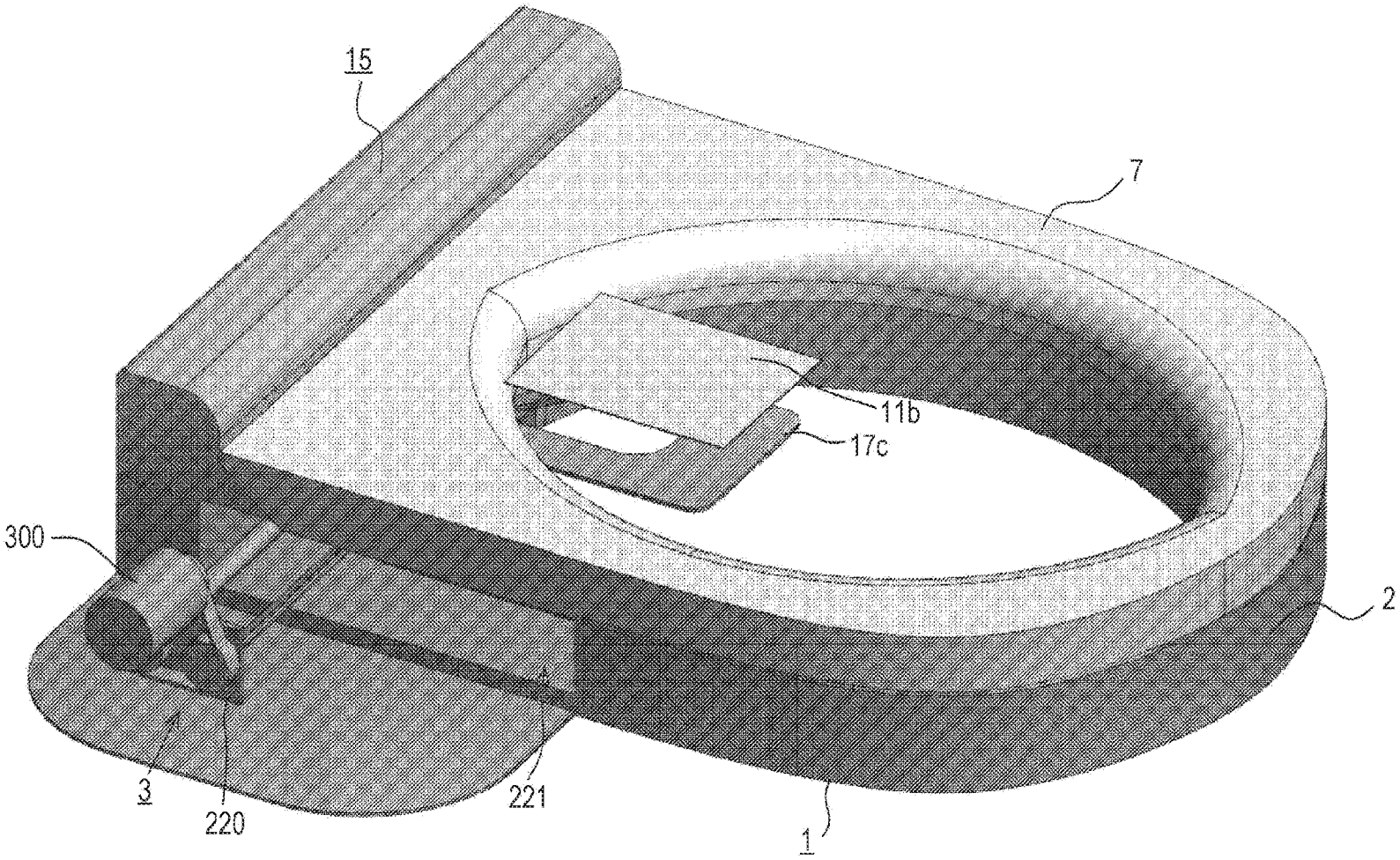
Figure 169B:
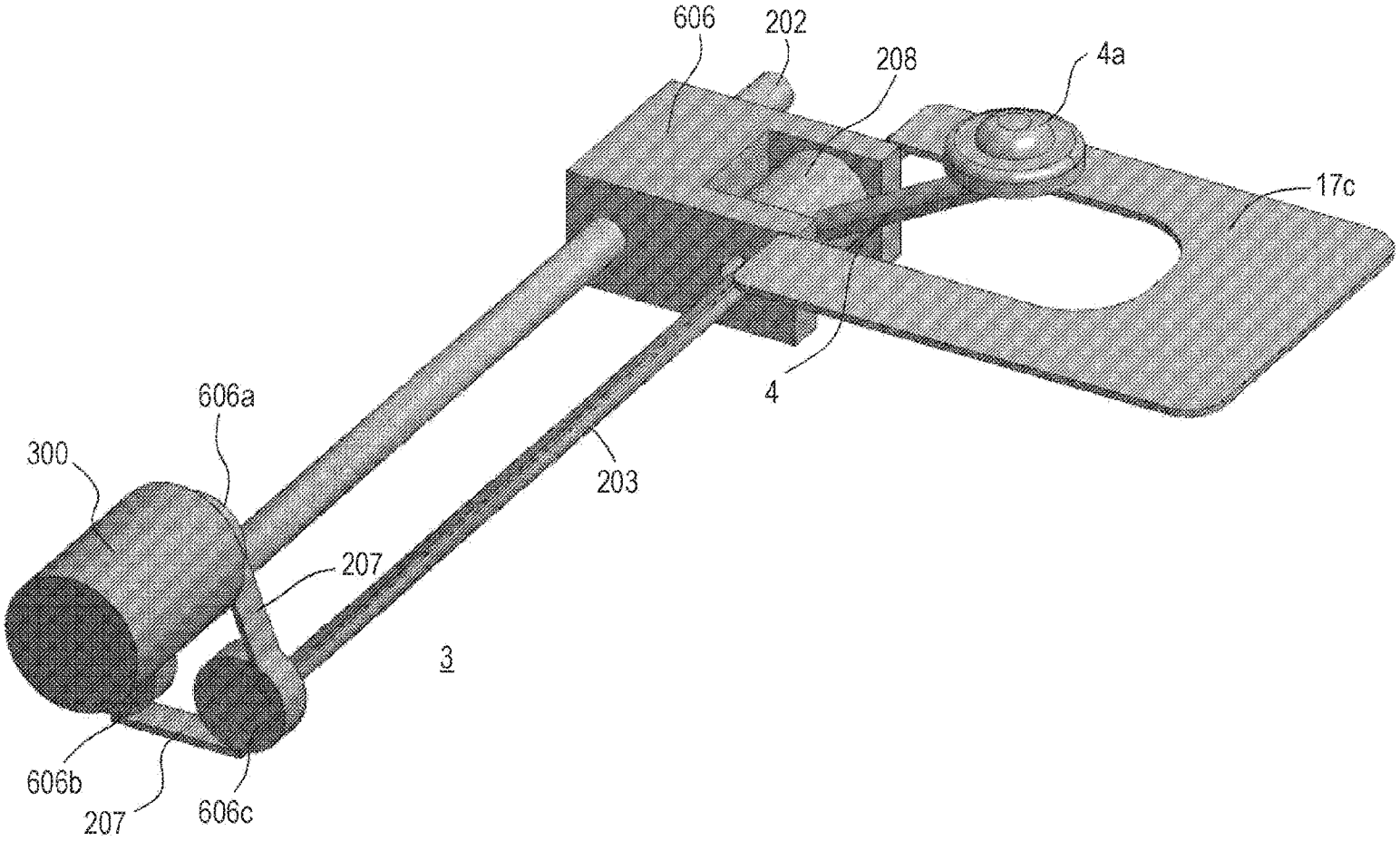
Figure 170:
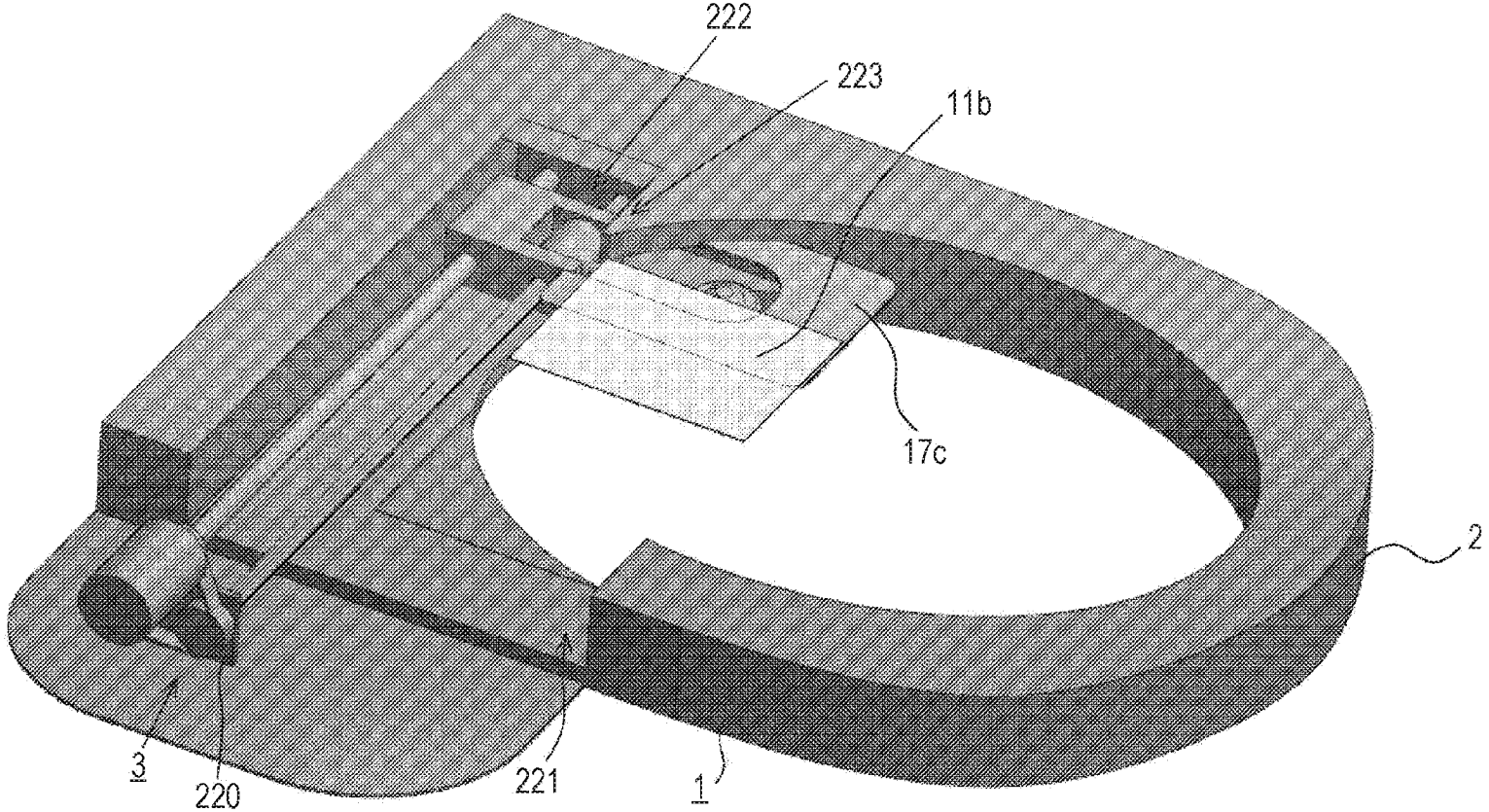
Figure 171A:
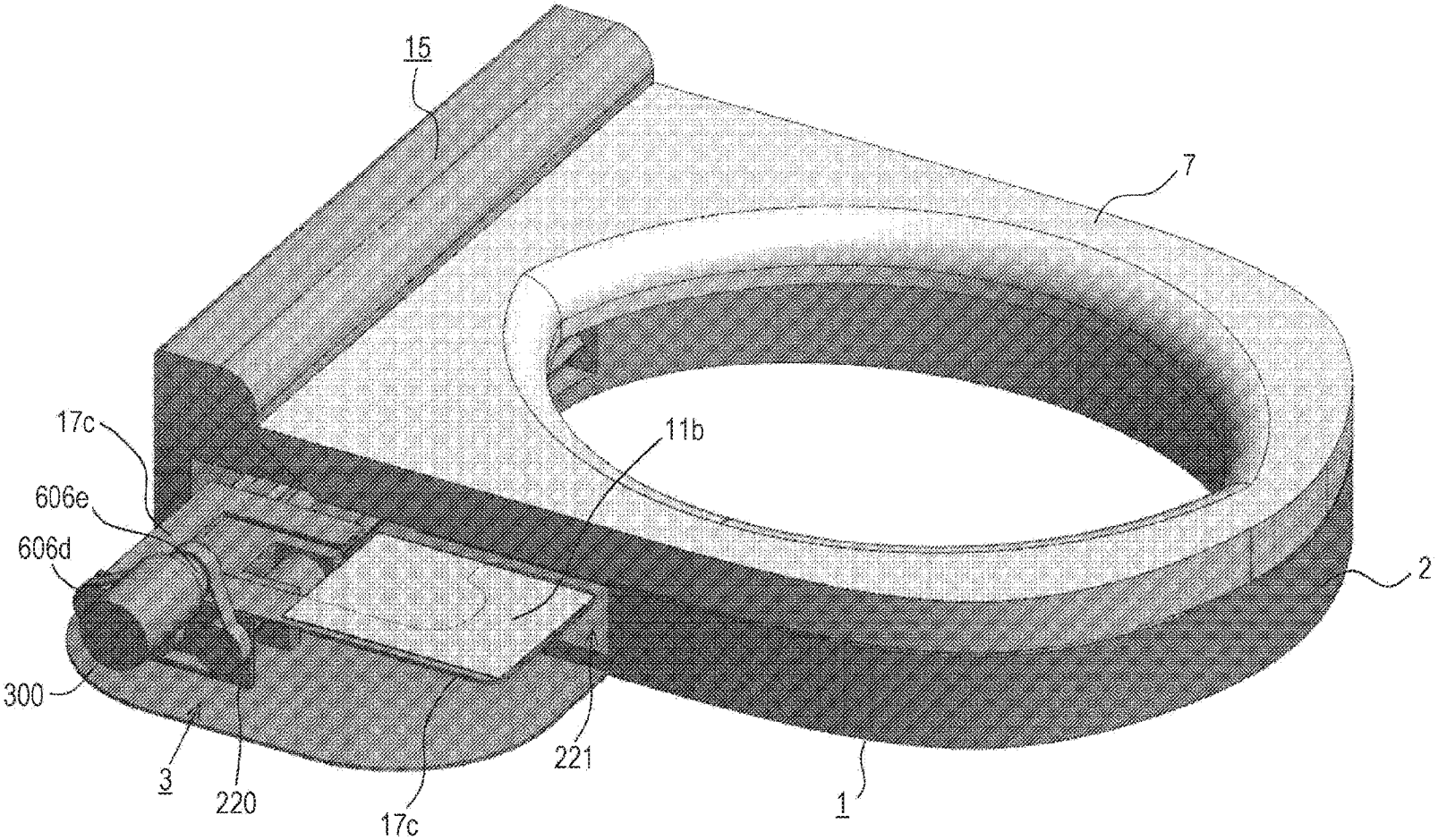
Figure 171B:
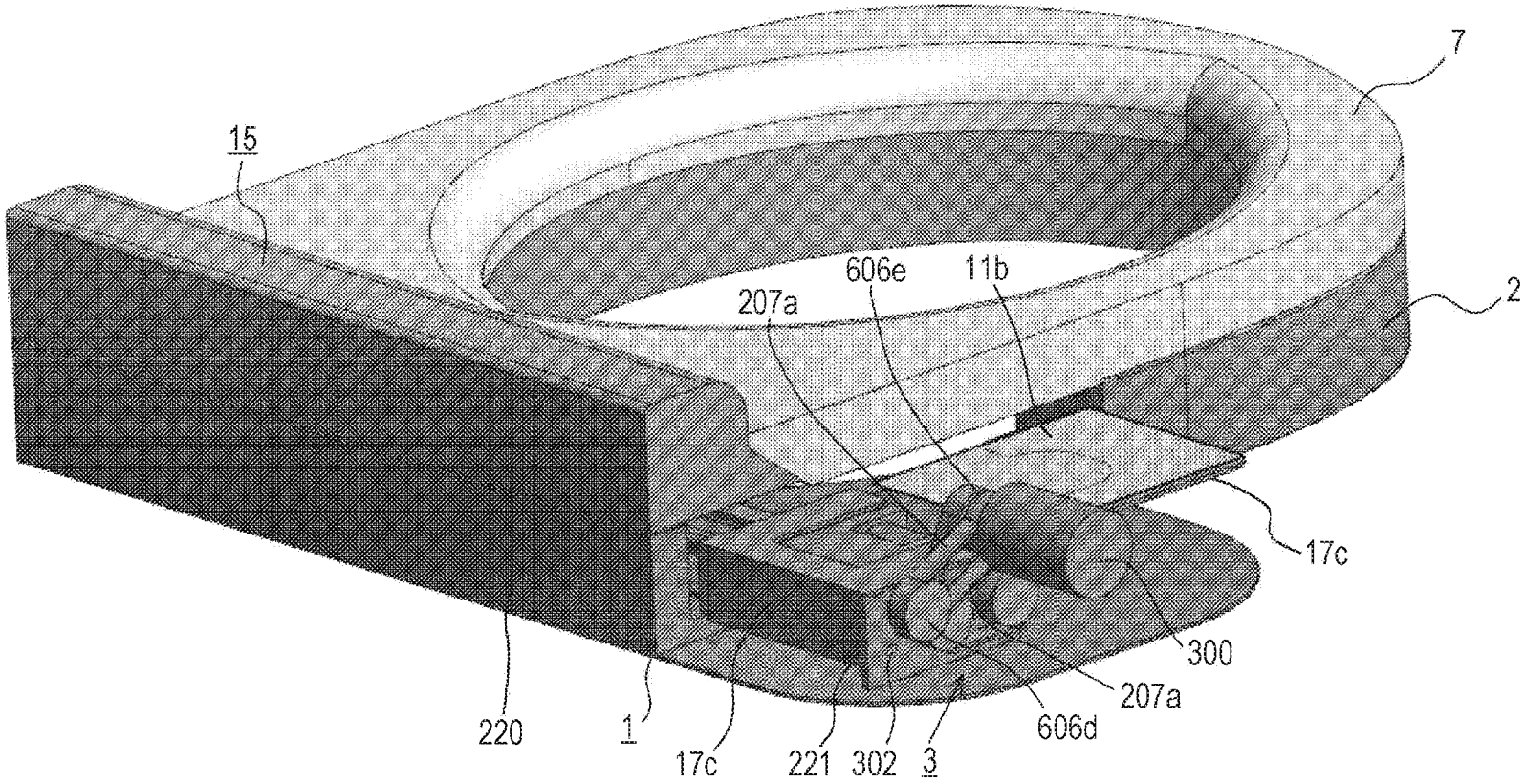
Figure 171C:
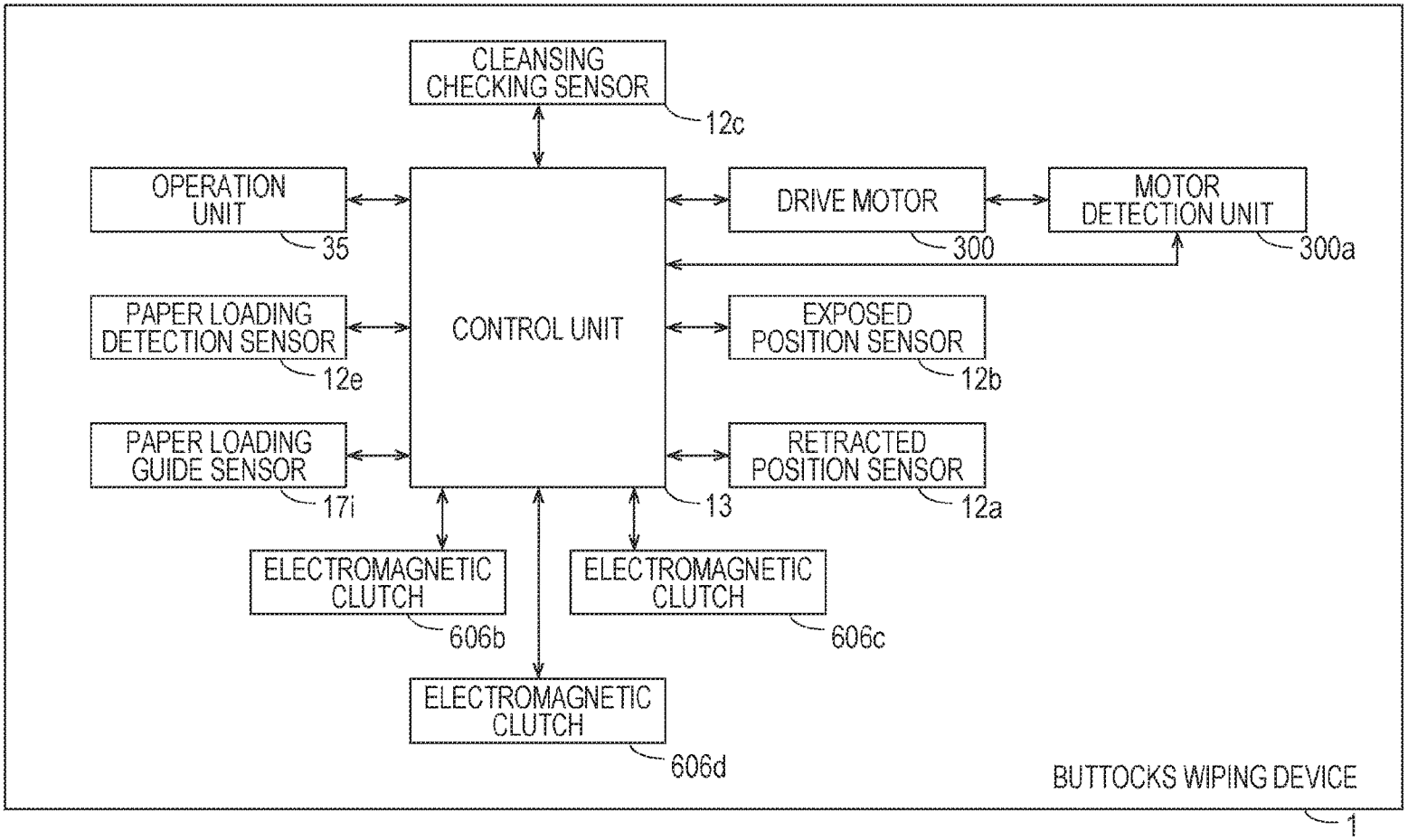
Figure 171D:
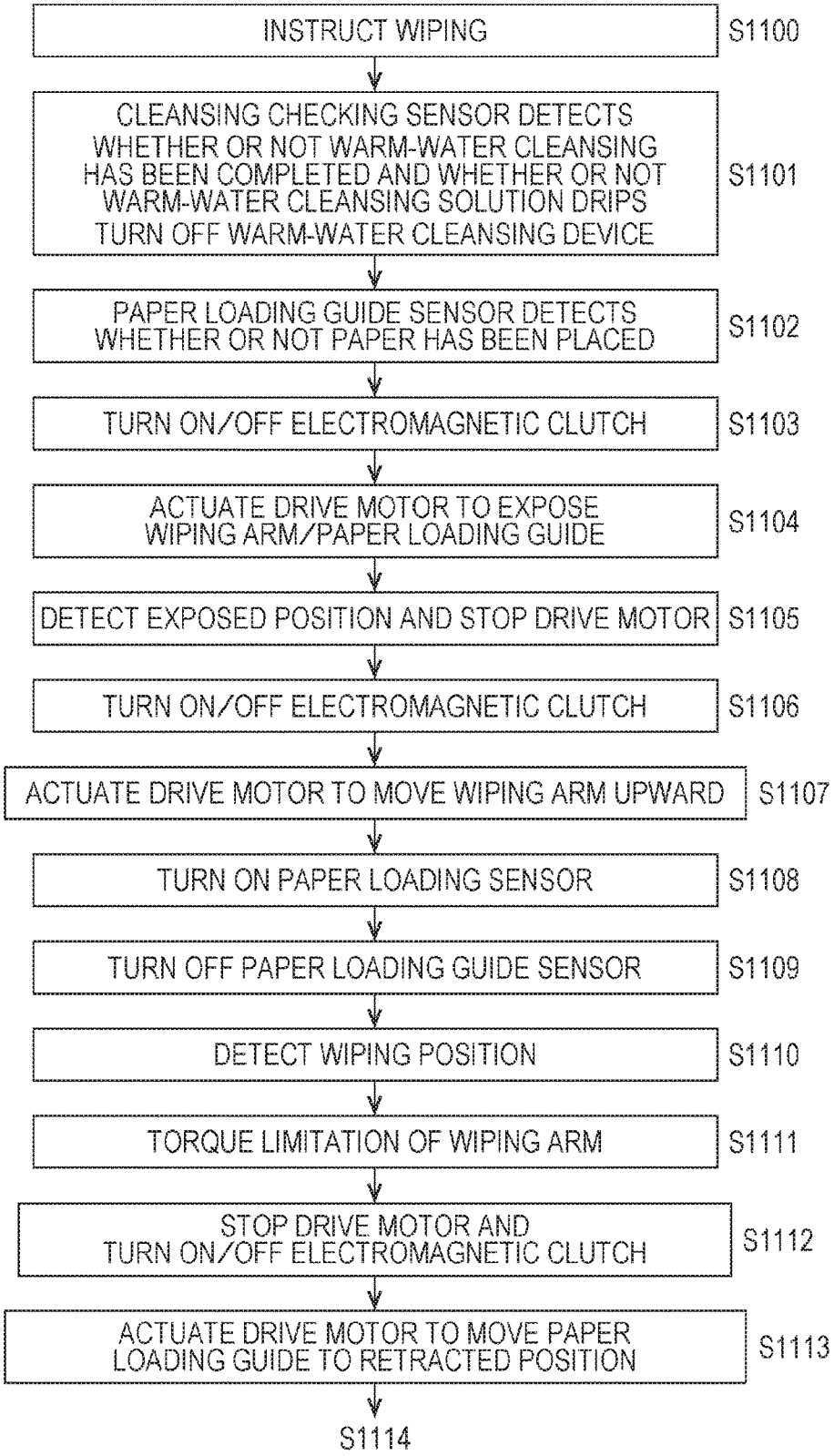
Figure 171E:
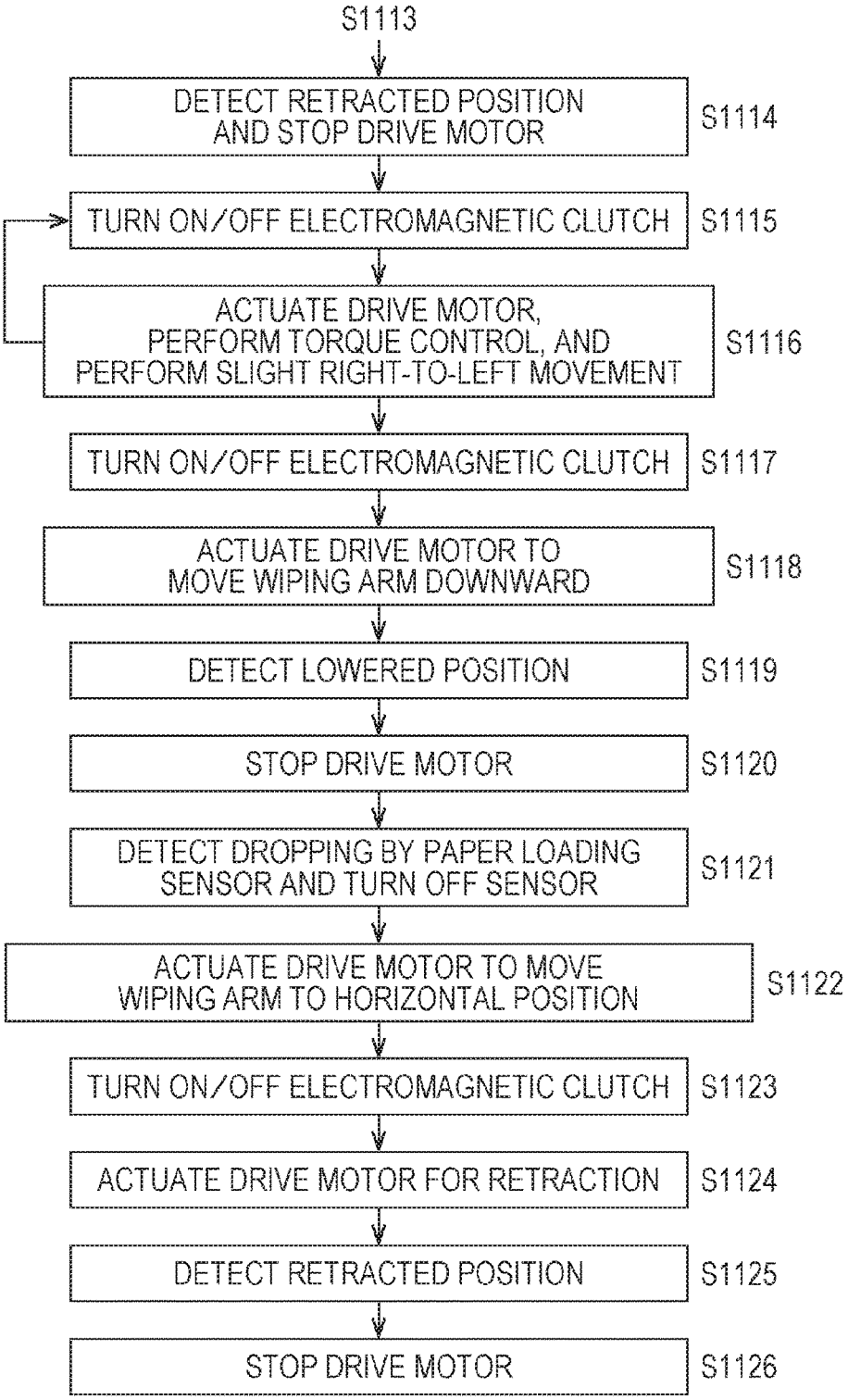
Figure 171F:
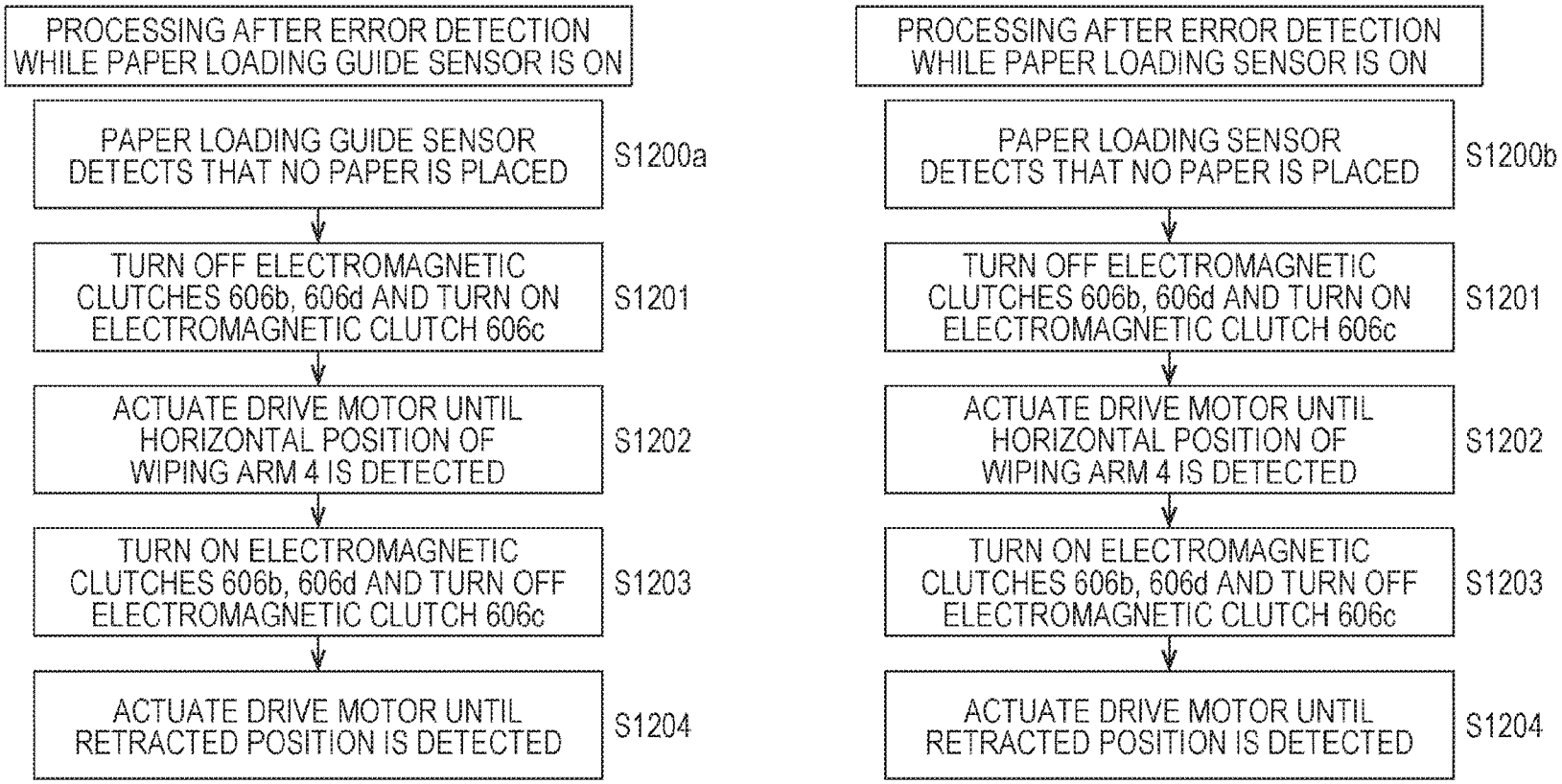
Figure 172A:
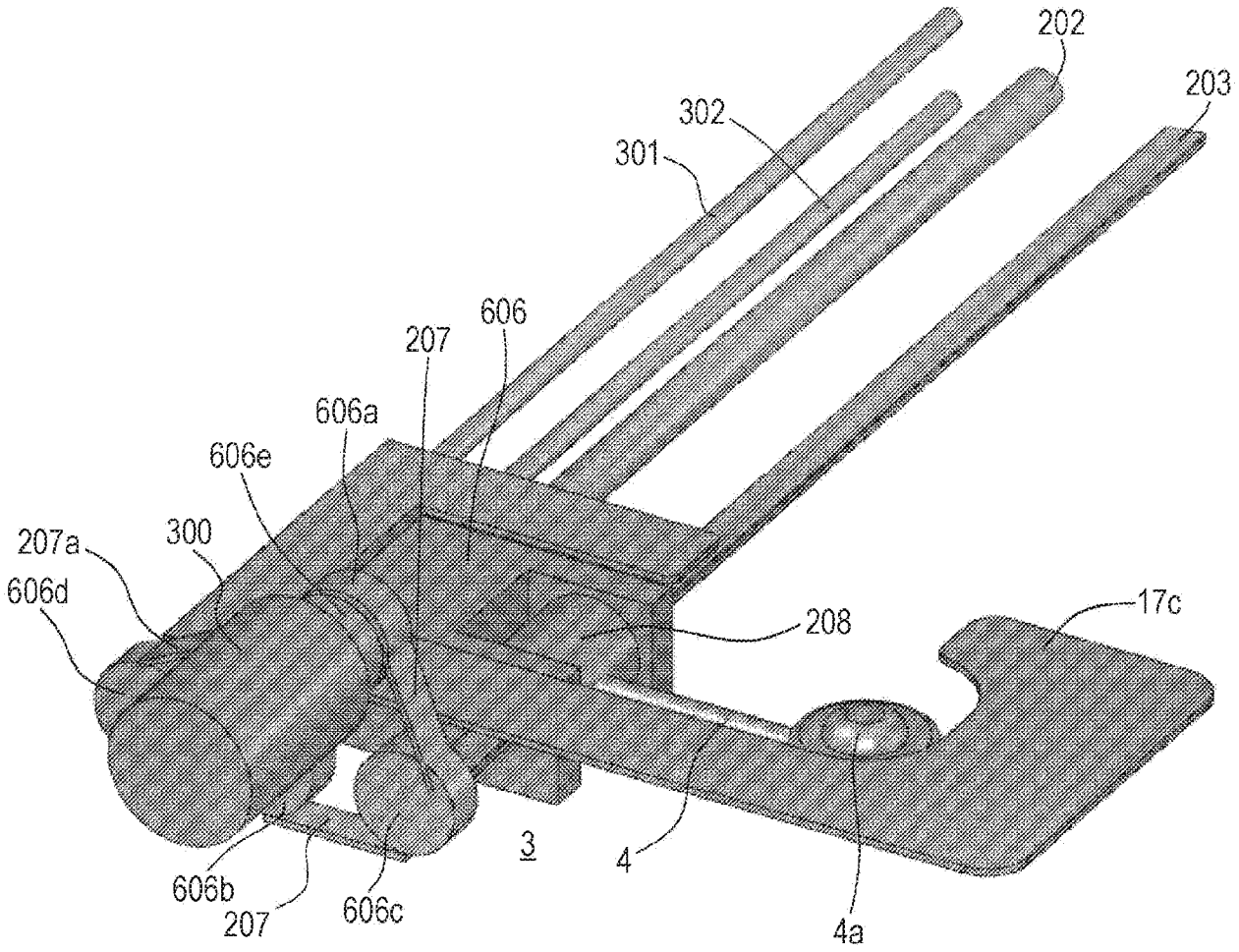

FIG. 166 is a block diagram of a functional configuration of the buttocks wiping device 1;

FIG. 167 is a perspective view of the state of the buttocks wiping device 1 when the paper loading guide 17*c* is exposed;

FIG. 168 is a perspective view of the wiping arm drive unit 3 and the paper loading guide 17*c* when the paper loading guide 17*c* is exposed;

FIG. 169A is a perspective view of the state of the buttocks wiping device 1 upon wiping;

FIG. 169B is a perspective view of the wiping arm drive unit 3 and the paper loading guide 17*c* upon wiping;

FIG. 170 is a view of a structure in a case where a paper dropping portion 223 is provided at a raised portion 2;

FIG. 17*l*A is a perspective view of a buttocks wiping device 1 of a fifteenth embodiment;

FIG. 17*l*B is a perspective view of the buttocks wiping device 1 diagonally from the left back side;

FIG. 17*l*C is a block diagram of a functional configuration of the buttocks wiping device 1;

FIG. 17*l*D is a flowchart of operation of the buttocks wiping device 1;

FIG. 17*l*E is a flowchart of subsequent operation of FIG. 17*l*D;

FIG. 17*l*F is a flowchart of error processing in a case where special paper 11*b* is no longer detected while a paper loading guide sensor 17*i* is activated (S1102 to S1109) and a paper loading detection sensor 12*e* is activated (S1108 to S1121);

FIG. 172A is a perspective view of a structure including a wiping arm drive unit 3 and a paper loading guide 17*c;*

Figure 172B:
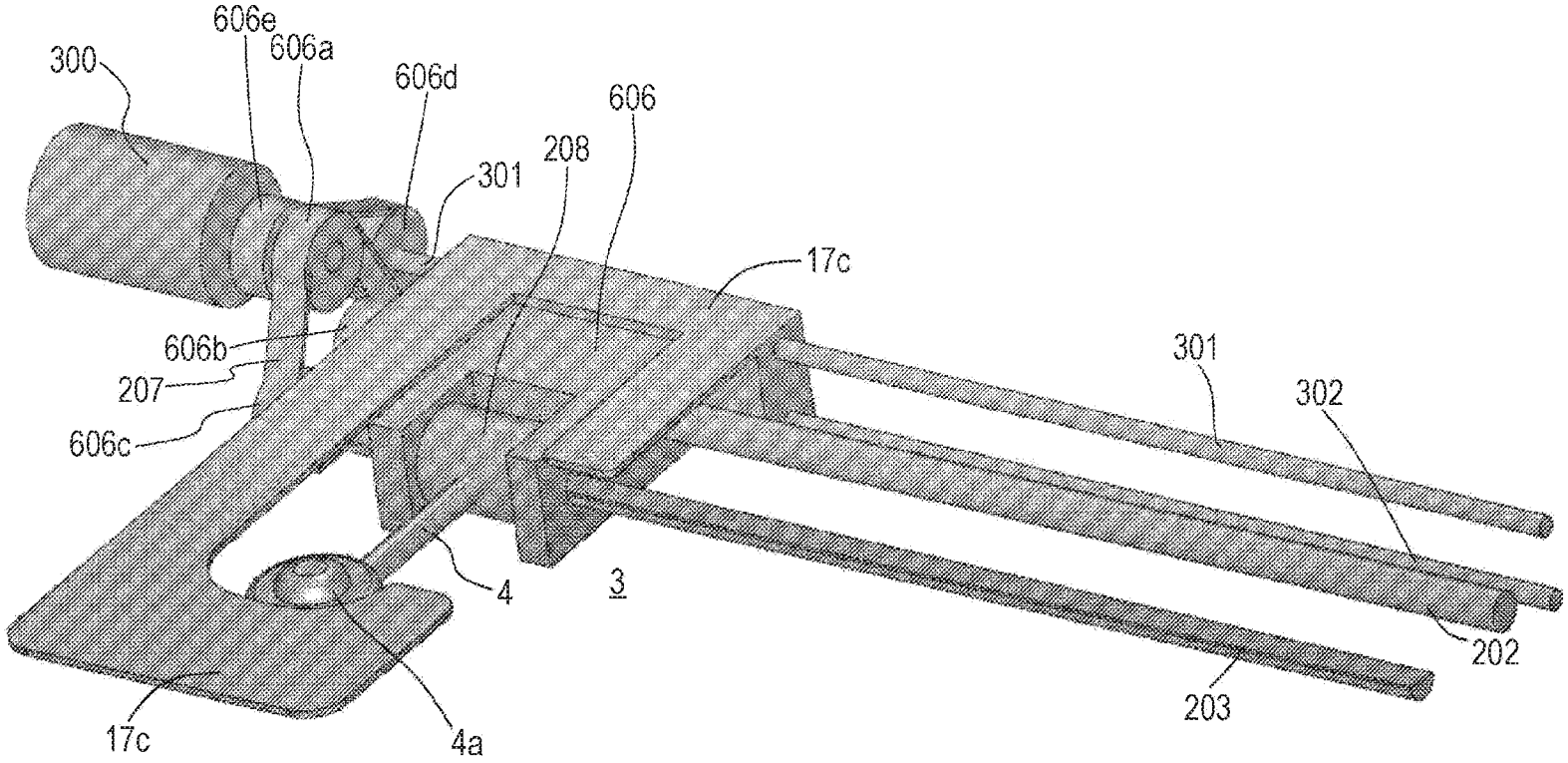

FIG. 172B is a perspective view of the structure including the wiping arm drive unit 3 and the paper loading guide 17*c;*

Figure 173A:
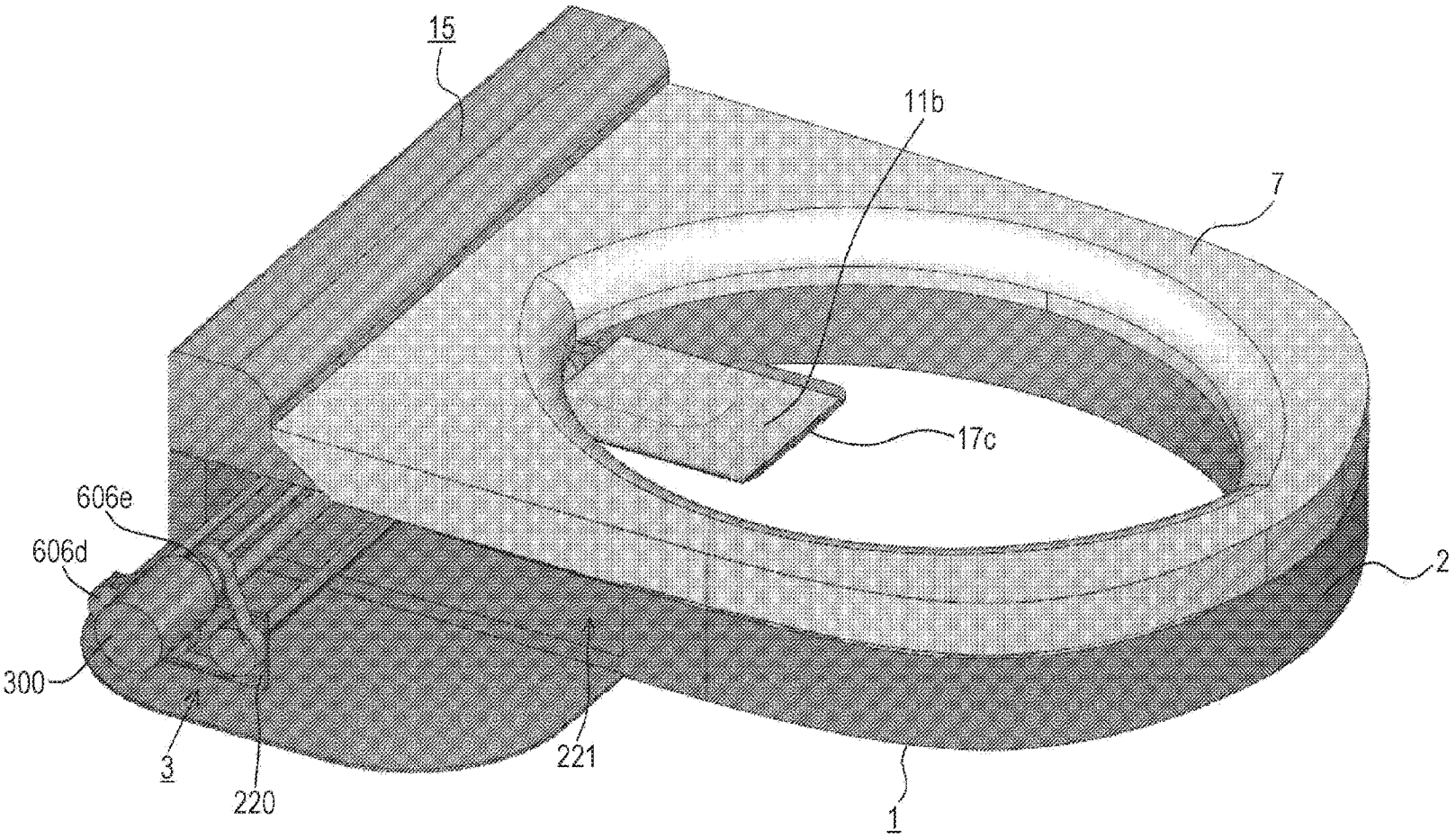
Figure 173B:
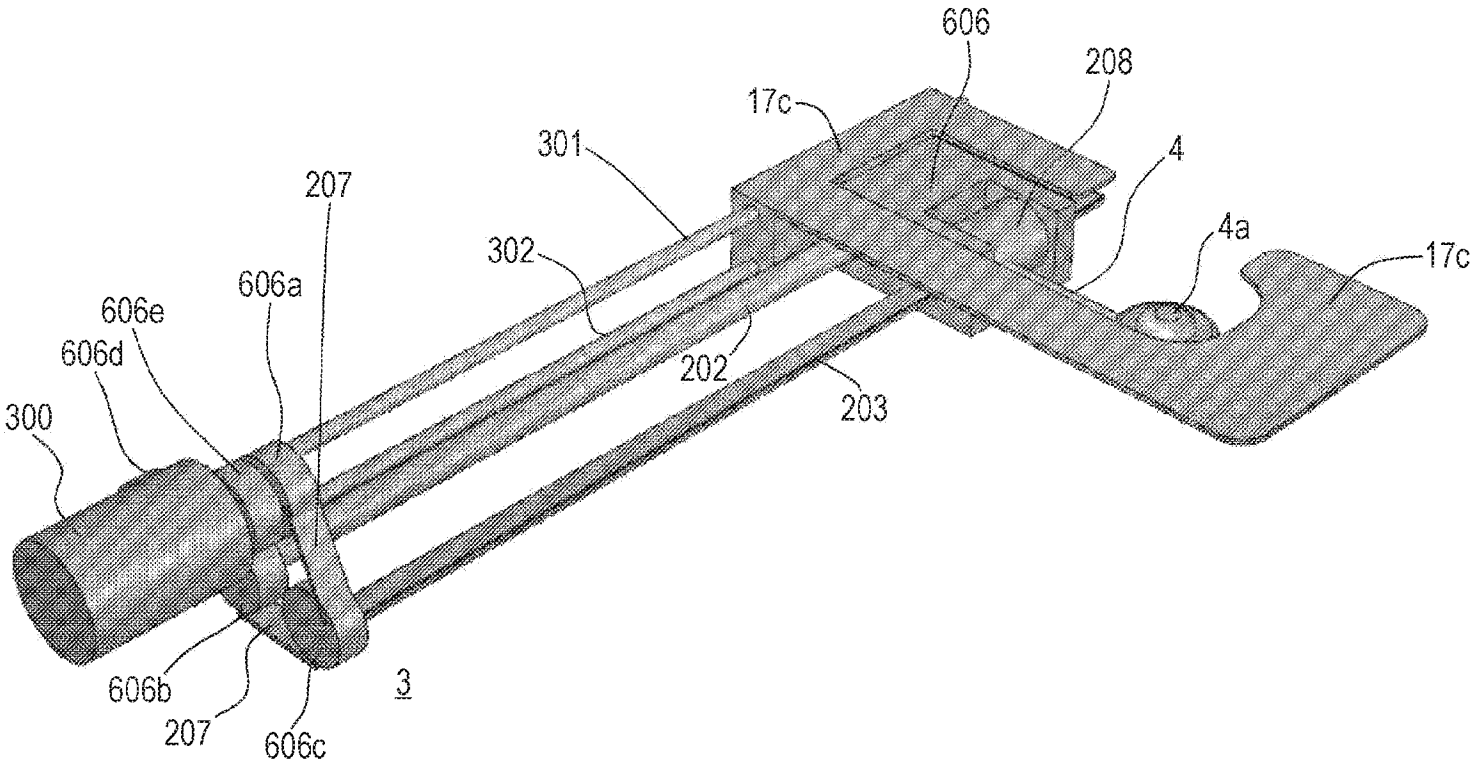
Figure 174A:
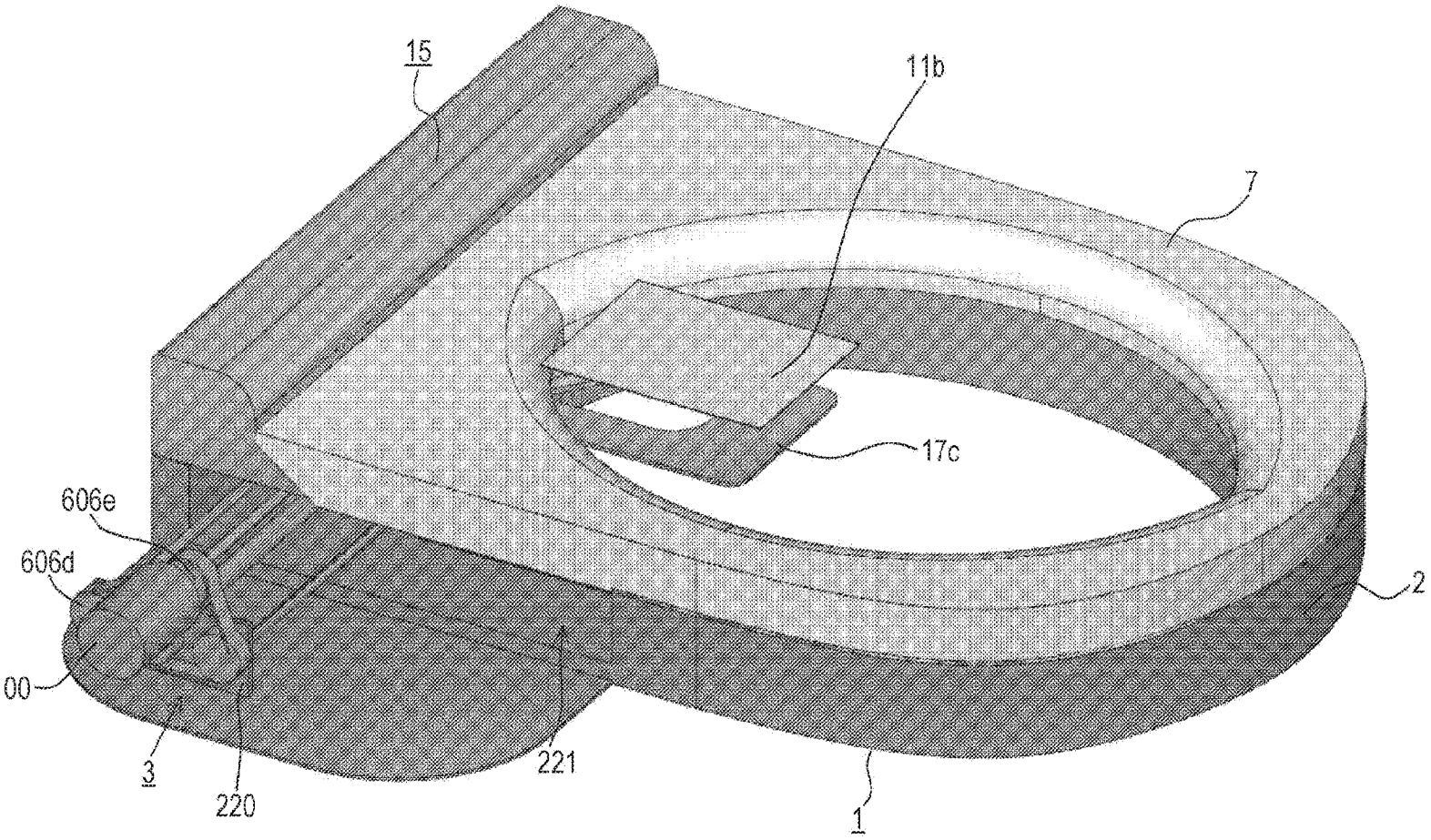
Figure 174B:
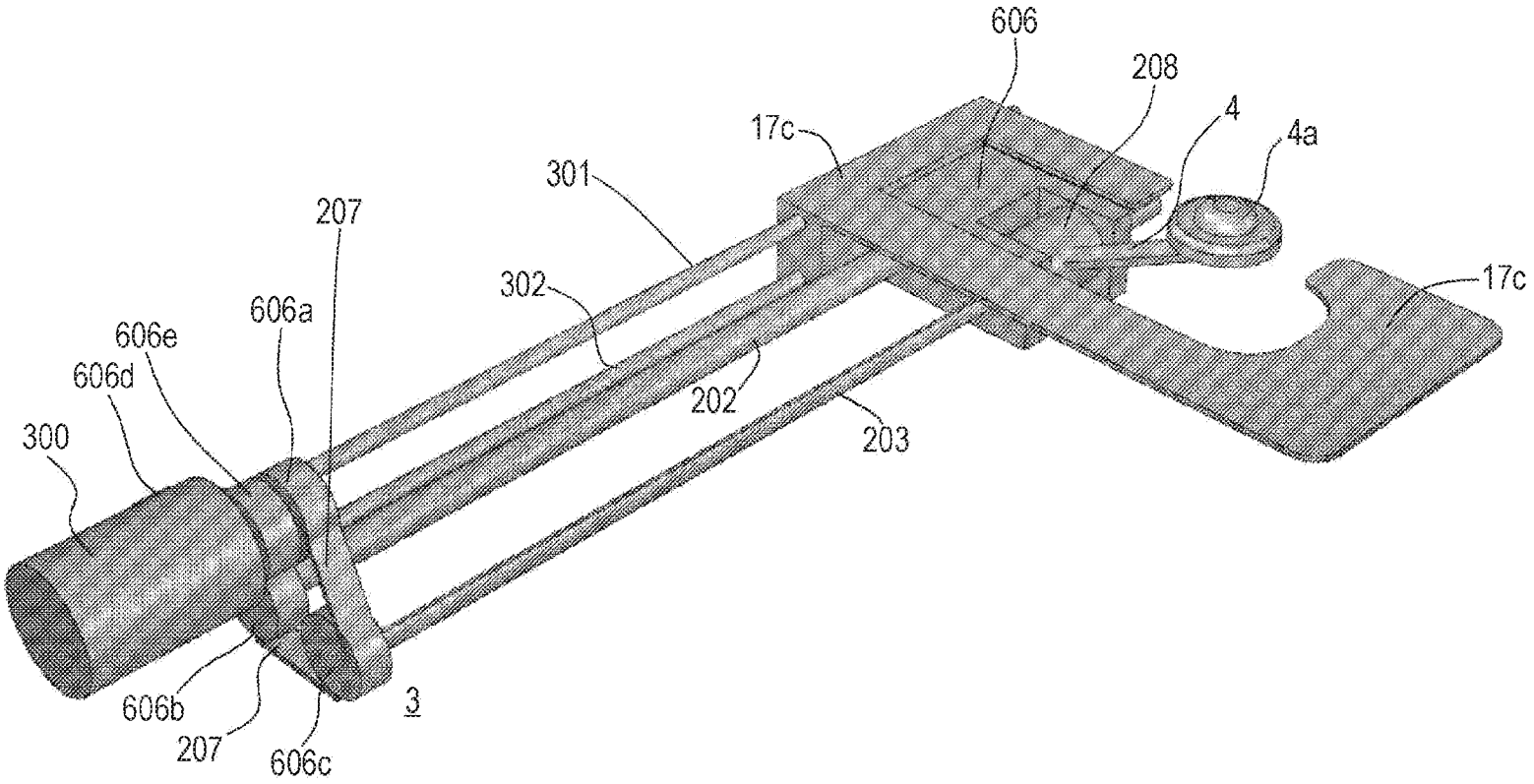
Figure 175A:
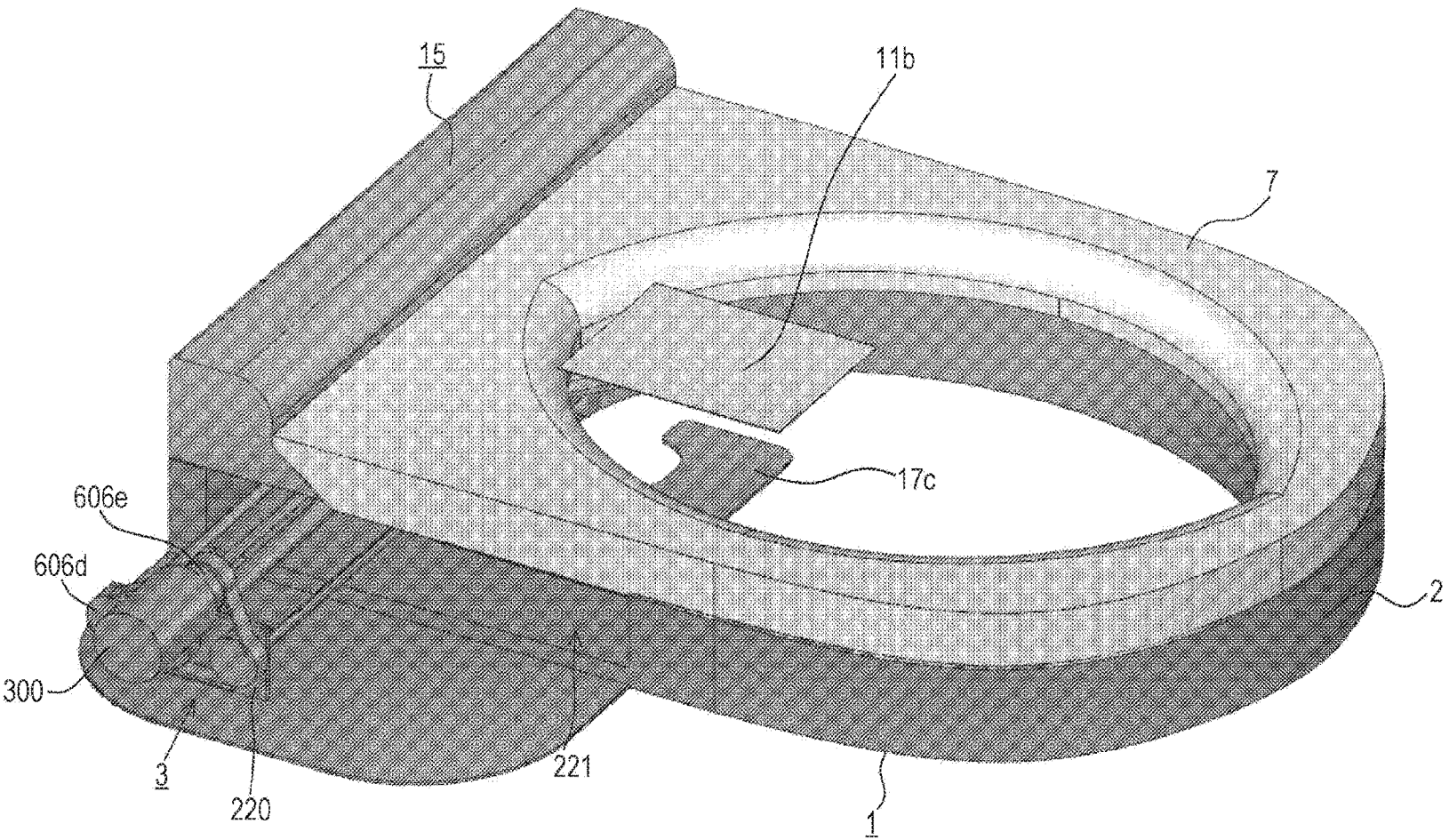
Figure 175B:
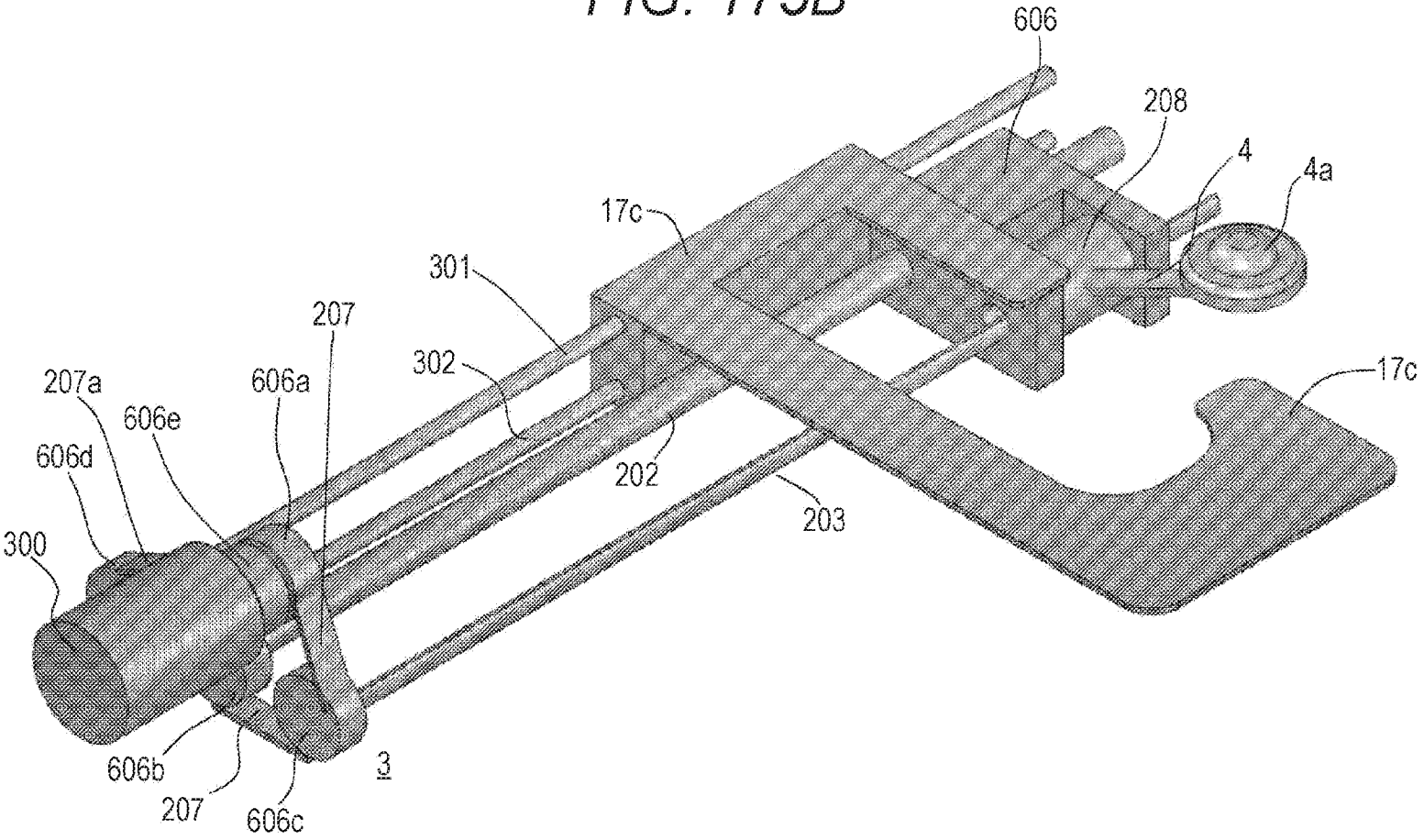
Figure 176:
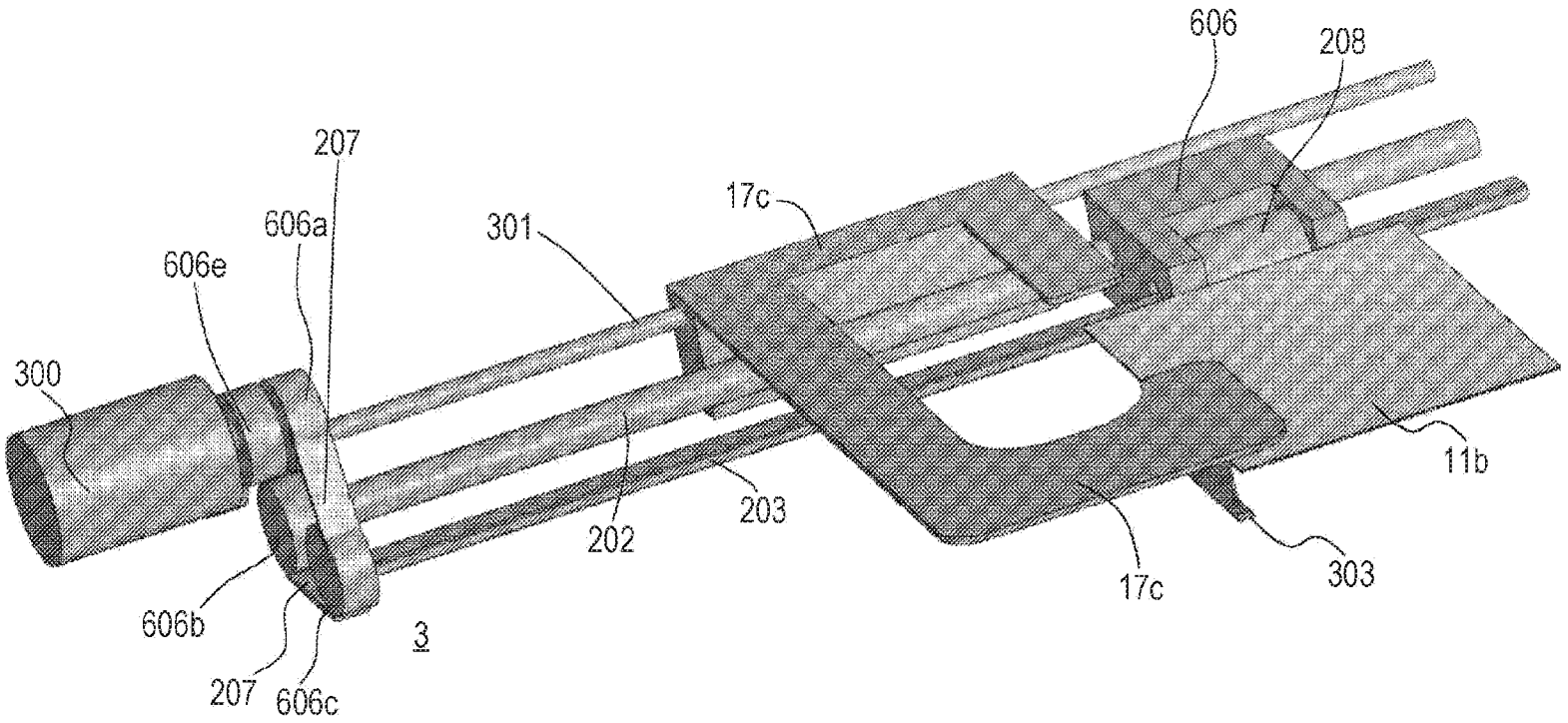
Figure 177:
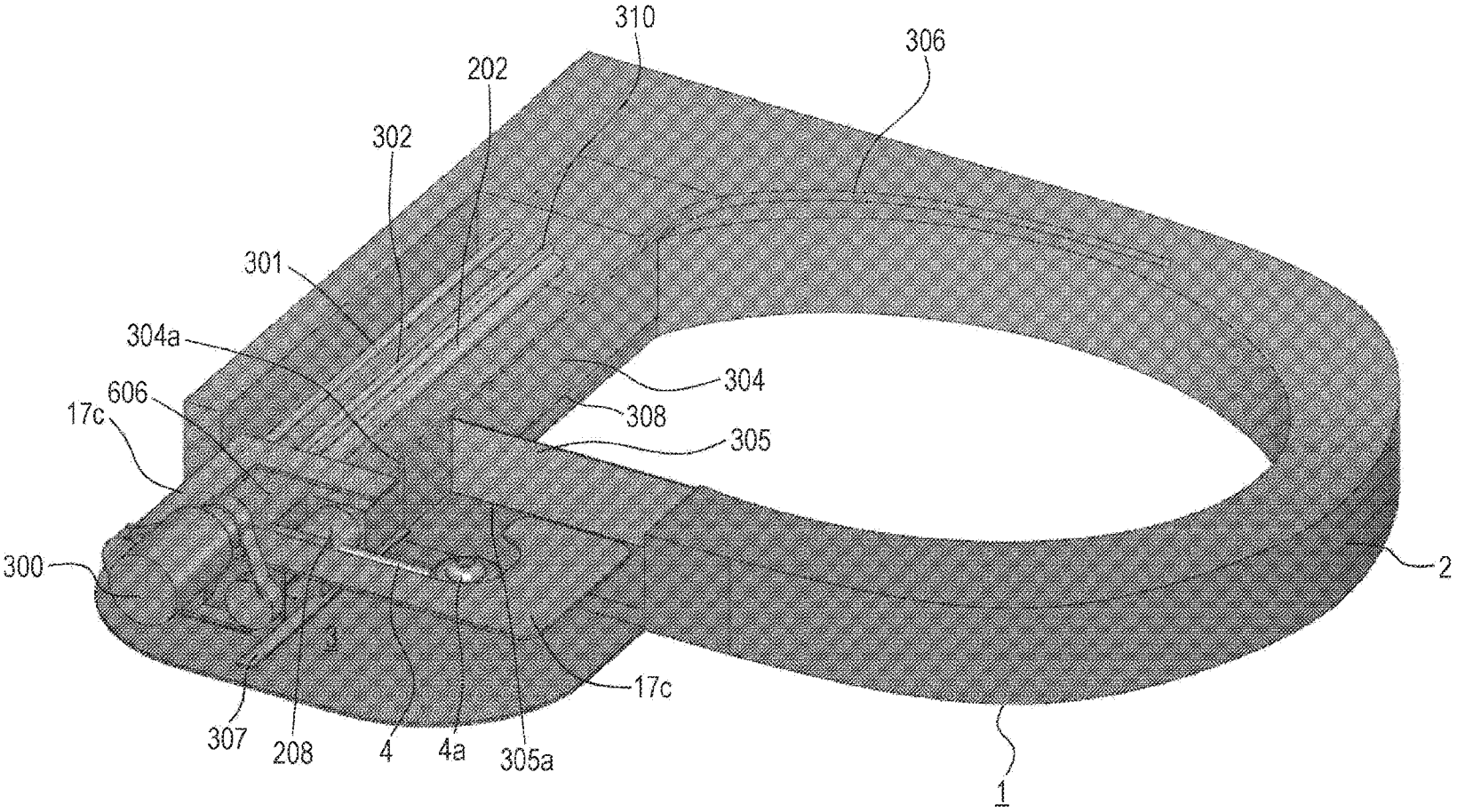
Figure 178:
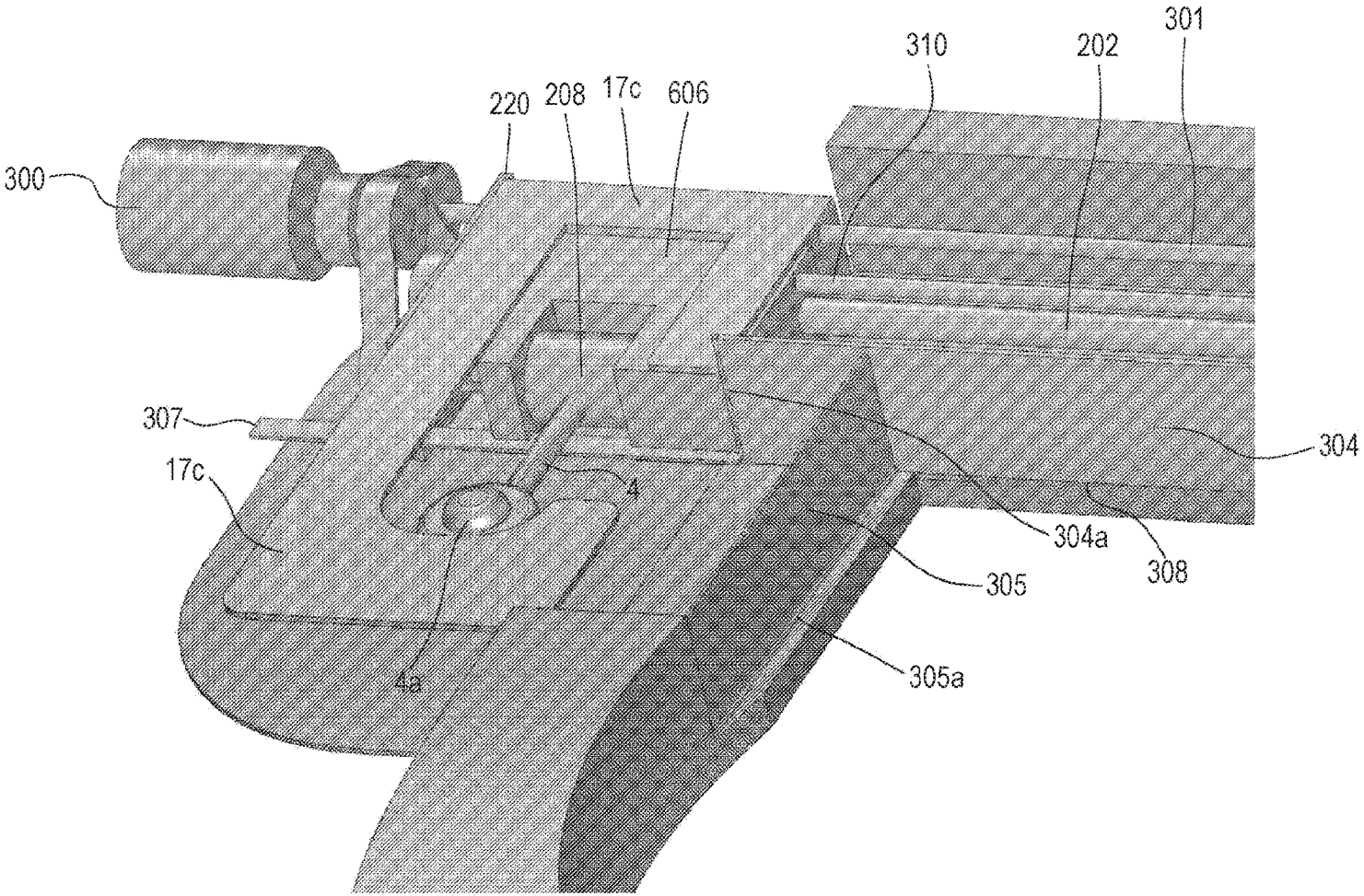
Figure 179:
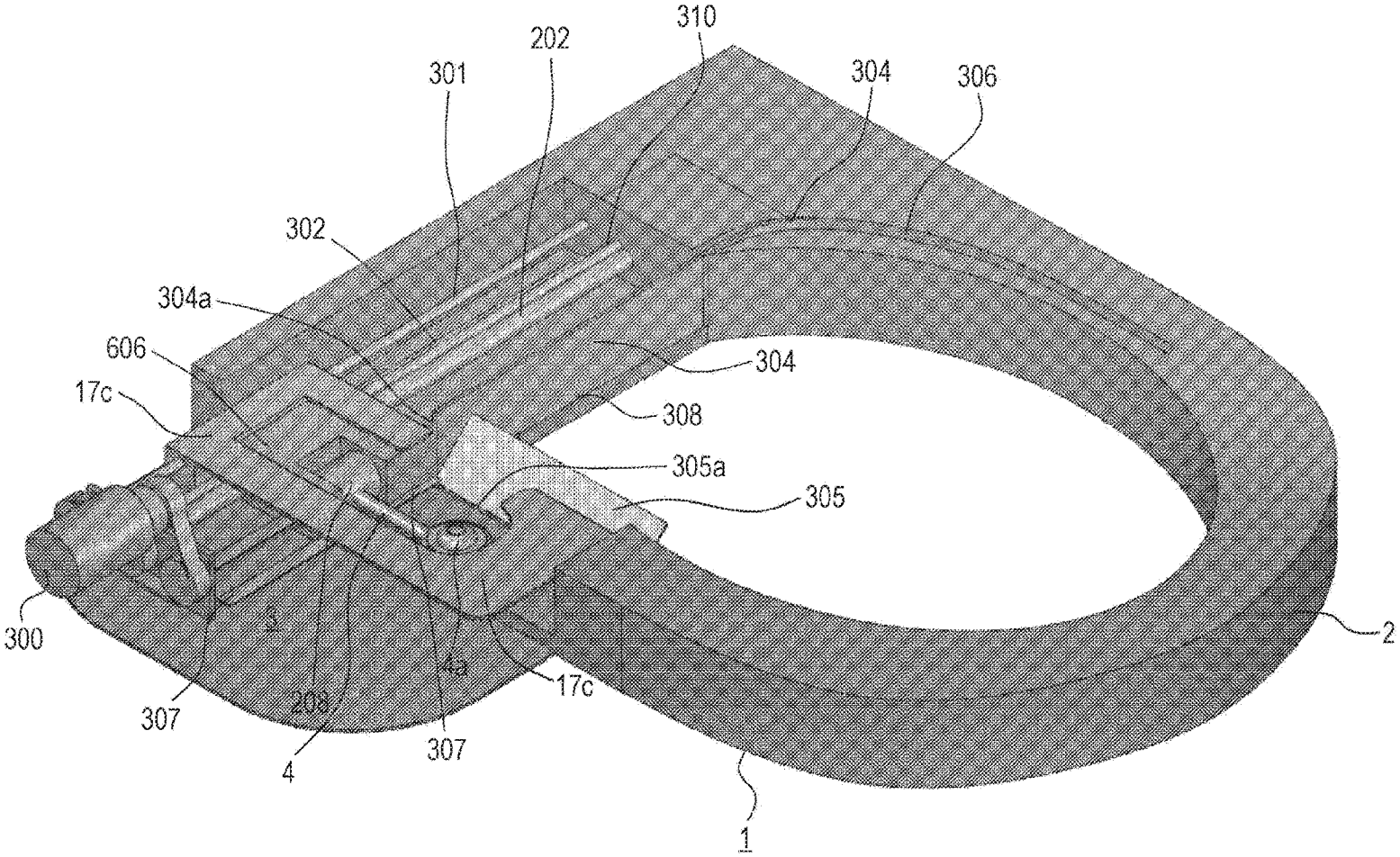
Figure 180:
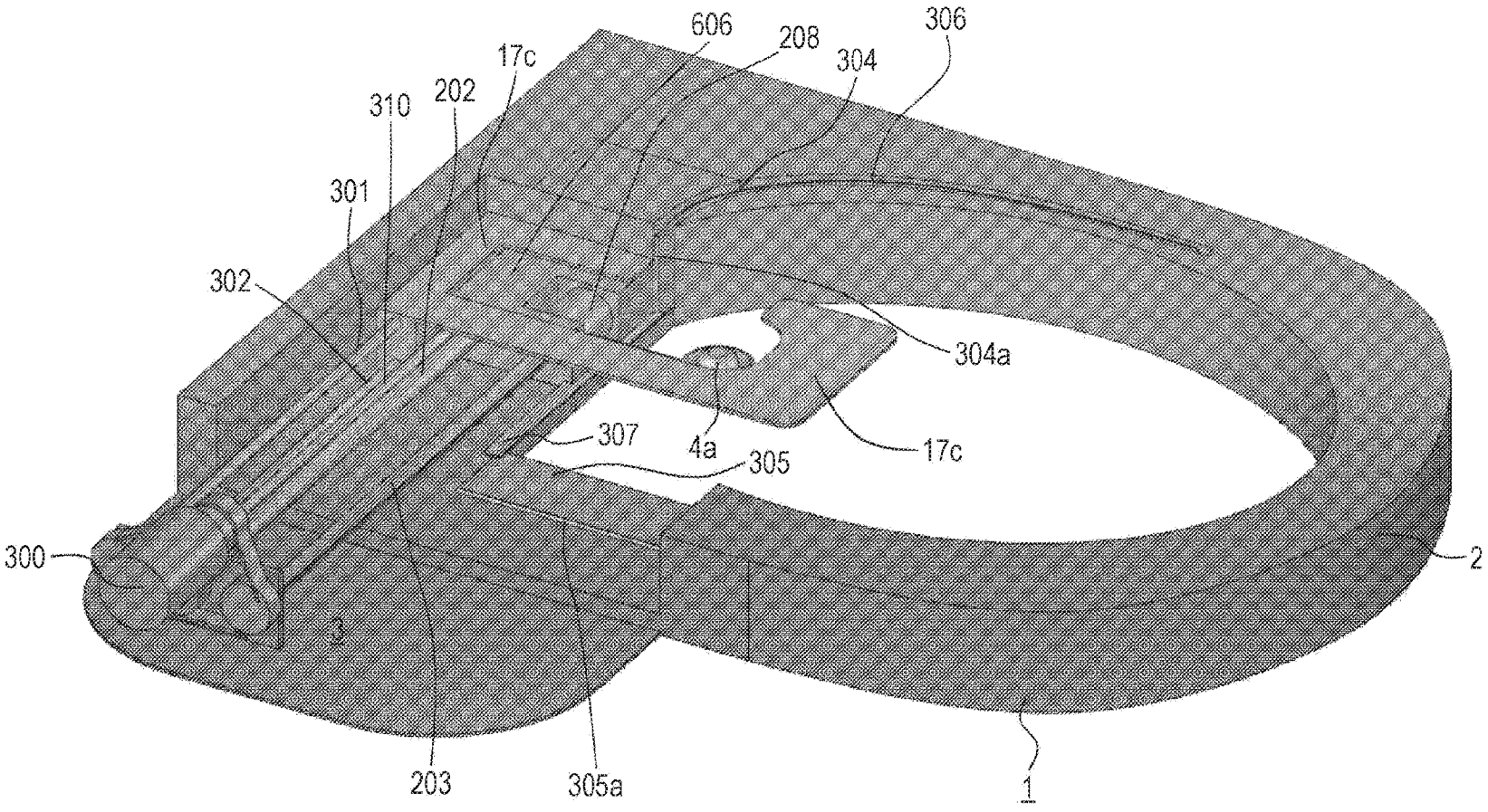
Figure 181:
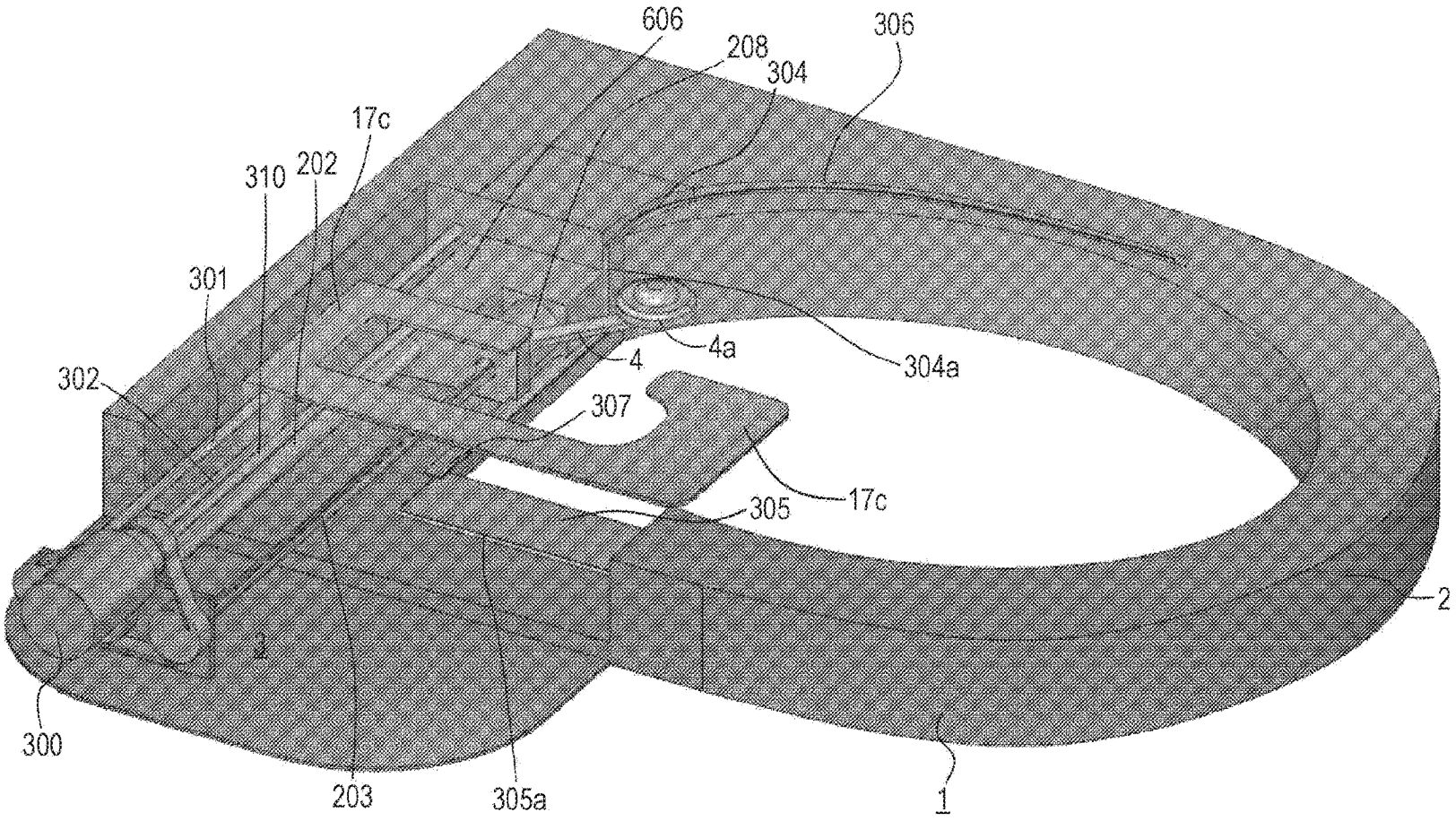
Figure 182:
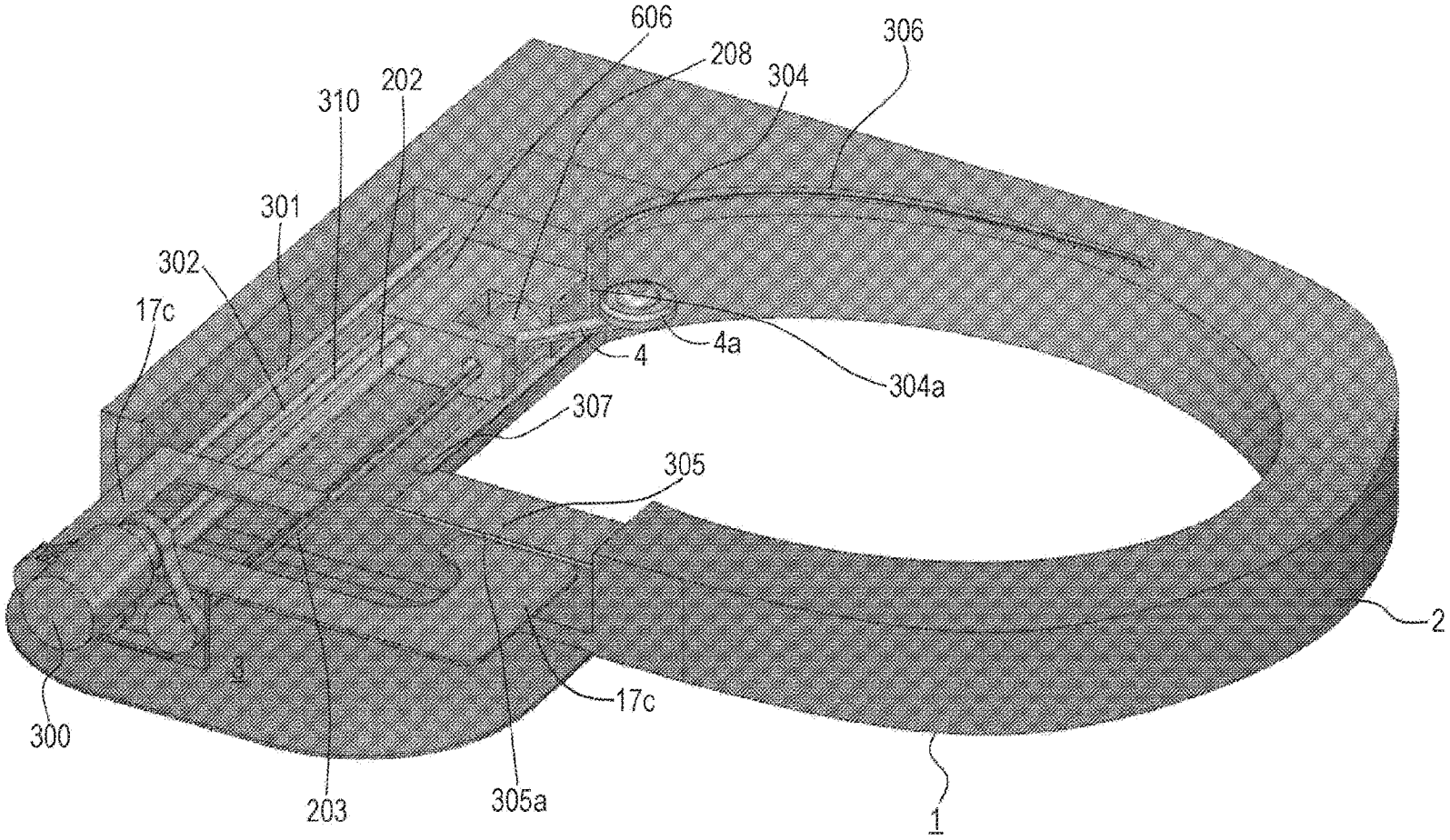
Figure 183:
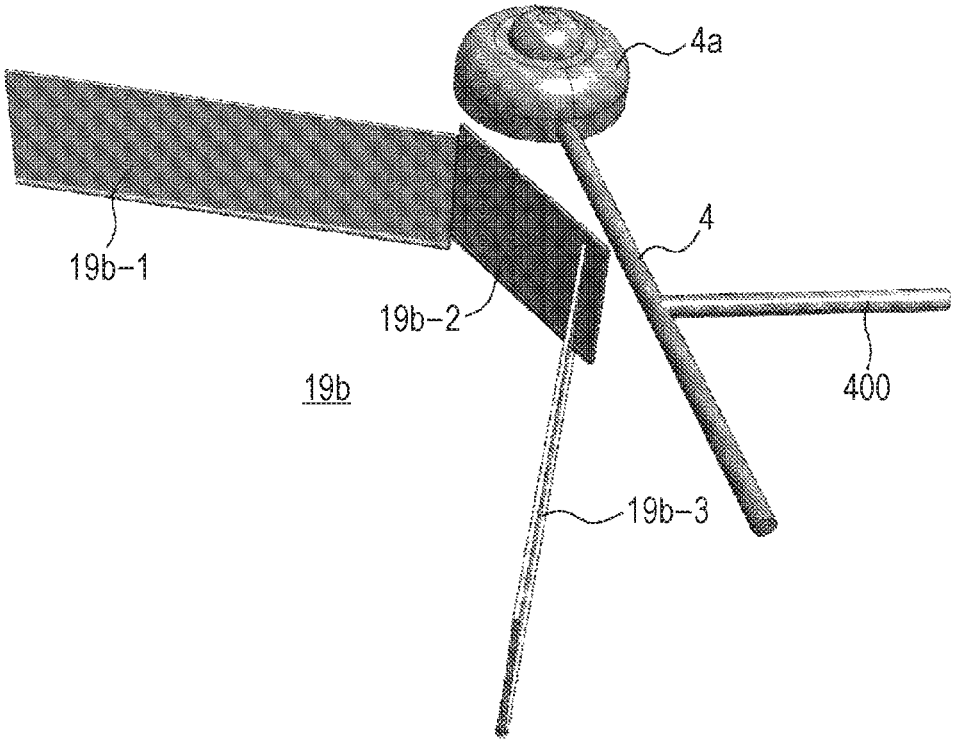

FIG. 173A is a perspective view of a state when special paper 11*b* placed on the paper loading guide 17*c* is exposed;

FIG. 173B is a perspective view of the structure including the wiping arm drive unit 3 and the paper loading guide 17*c* in the state of FIG. 173A;

FIG. 174A is a perspective view of a state when the special paper 11*b* is lifted for wiping;

FIG. 174B is a perspective view of the structure including the wiping arm drive unit 3 and the paper loading guide 17*c* in the state of FIG. 174A;

FIG. 175A is a perspective view of a state when the paper loading guide 17*c* is retracted during wiping;

FIG. 175B is a perspective view of the structure including the wiping arm drive unit 3 and the paper loading guide 17*c* in the state of FIG. 175A;

FIG. 176 is a perspective view of a state when a wiping arm 4 is, for dropping the paper, moved downward such that the special paper 11*b* contacts a paper dropping portion 303 provided below the paper loading guide;

FIG. 177 is a perspective view of an internal structure of a buttocks wiping device 1 of a sixteenth embodiment;

FIG. 178 is an enlarged perspective view of the internal structure;

FIG. 179 is a perspective view of a state when movement of a movable portion 606 and a paper loading guide 17*c* begins such that a hinge-type opening/closing unit 305 begins to open;

FIG. 180 is a perspective view of a state when the movable portion 606 has moved to a retracted position;

FIG. 181 is a perspective view of a state while only the paper loading guide 17*c* is being retracted;

FIG. 182 is a perspective view of a state when only the paper loading guide 17*c* is retracted;

FIG. 183 is a perspective view of an arm-side opening/closing unit 19*b;*

Figure 184:
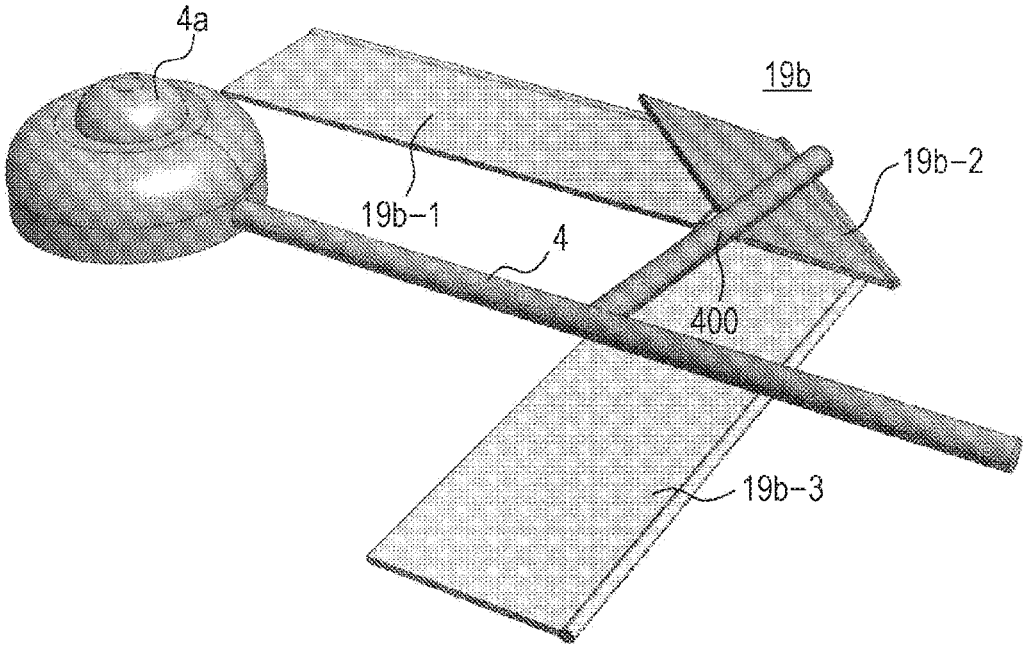
Figure 185:
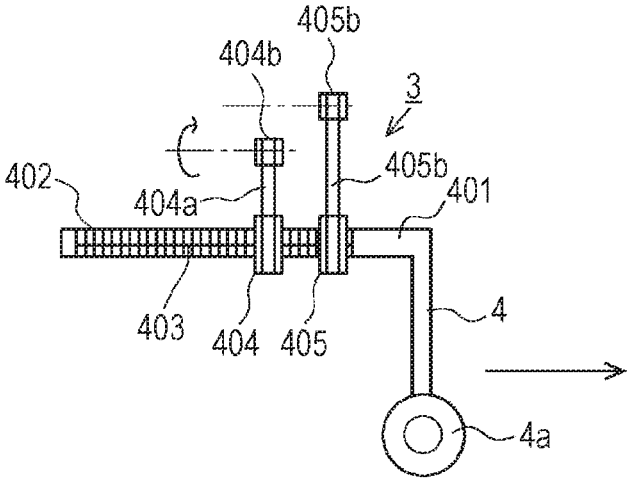
Figure 185:
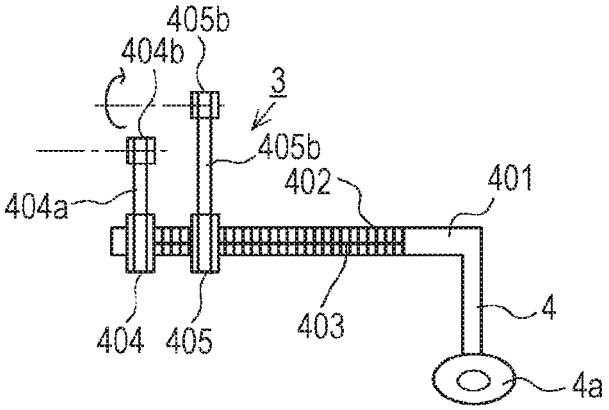
Figure 186:
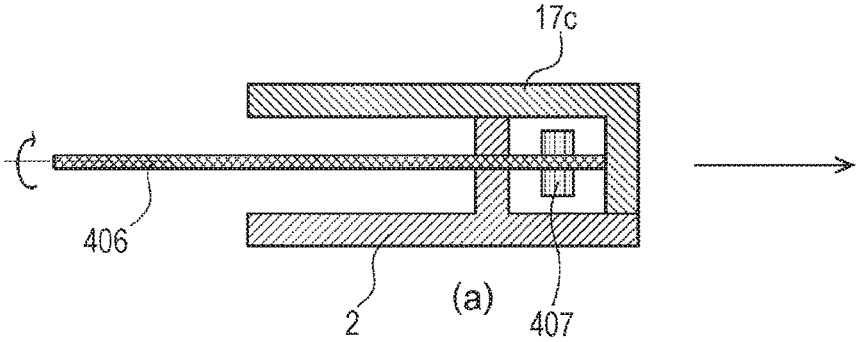
Figure 186:
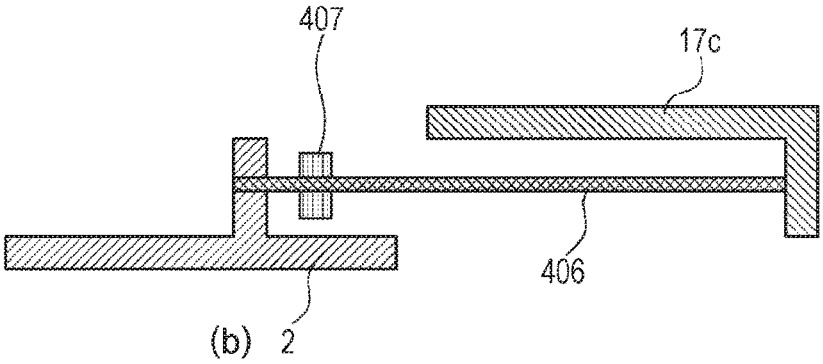

FIG. 184 is a perspective view of a state when the arm-side opening/closing unit 19*b* is opened;

FIG. 185 is a view of the structure for wiping the buttocks from the back of a toilet seat by means of an overlapping-type ball screw spline 401;

FIG. 186 is a sectional view of a mechanism in the case of rotating a nut 407 to expose the paper loading guide 17*c;*

Figure 187:
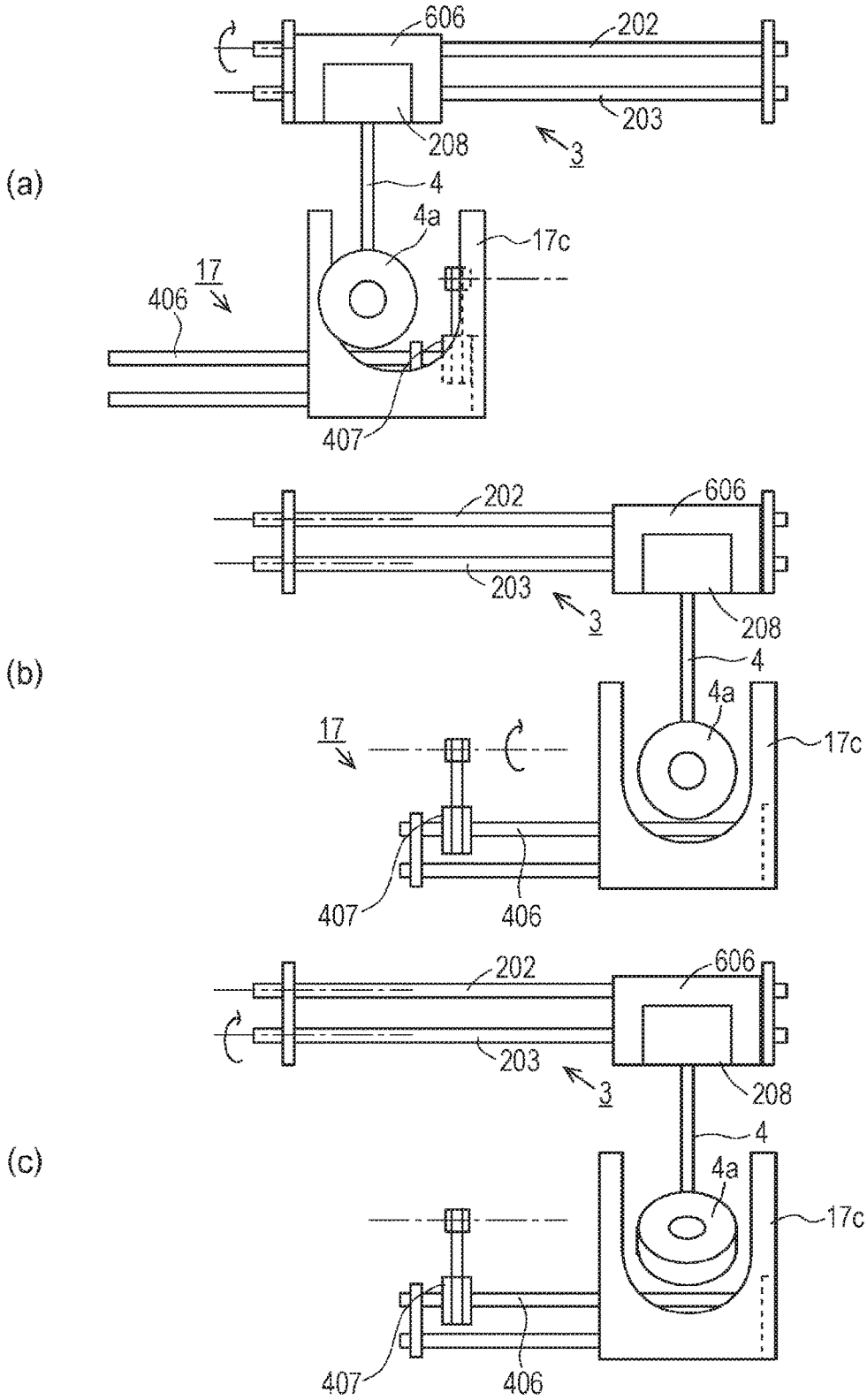
Figure 188:
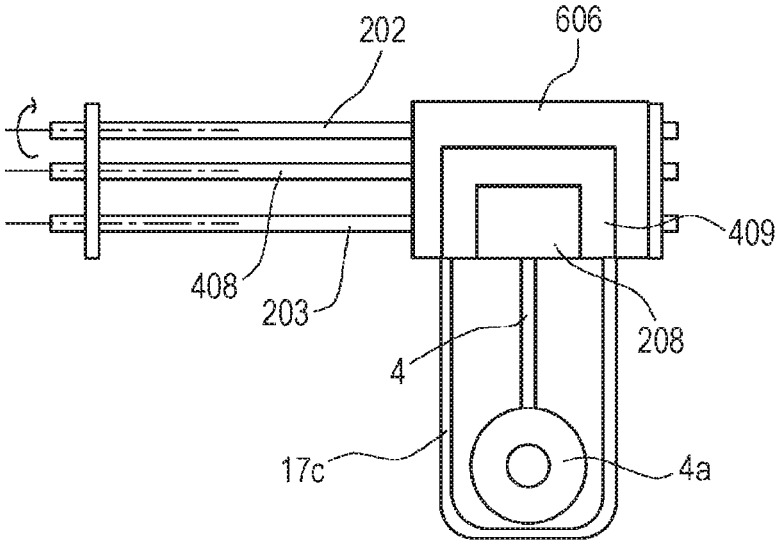
Figure 188:
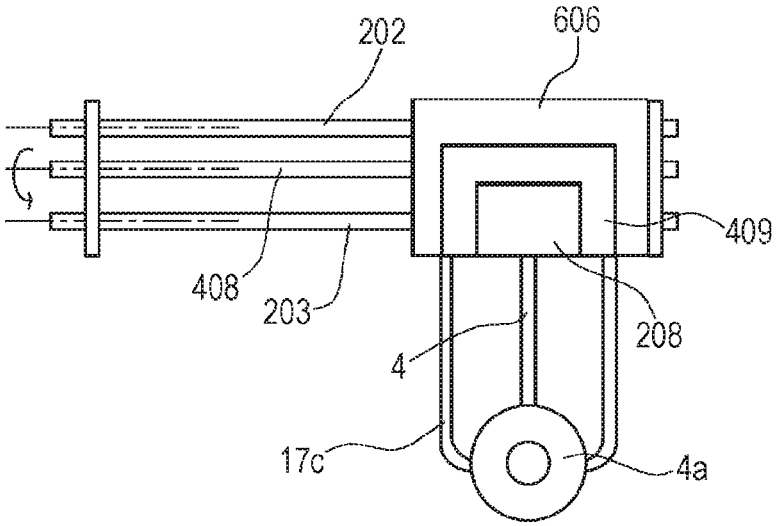
Figure 189:
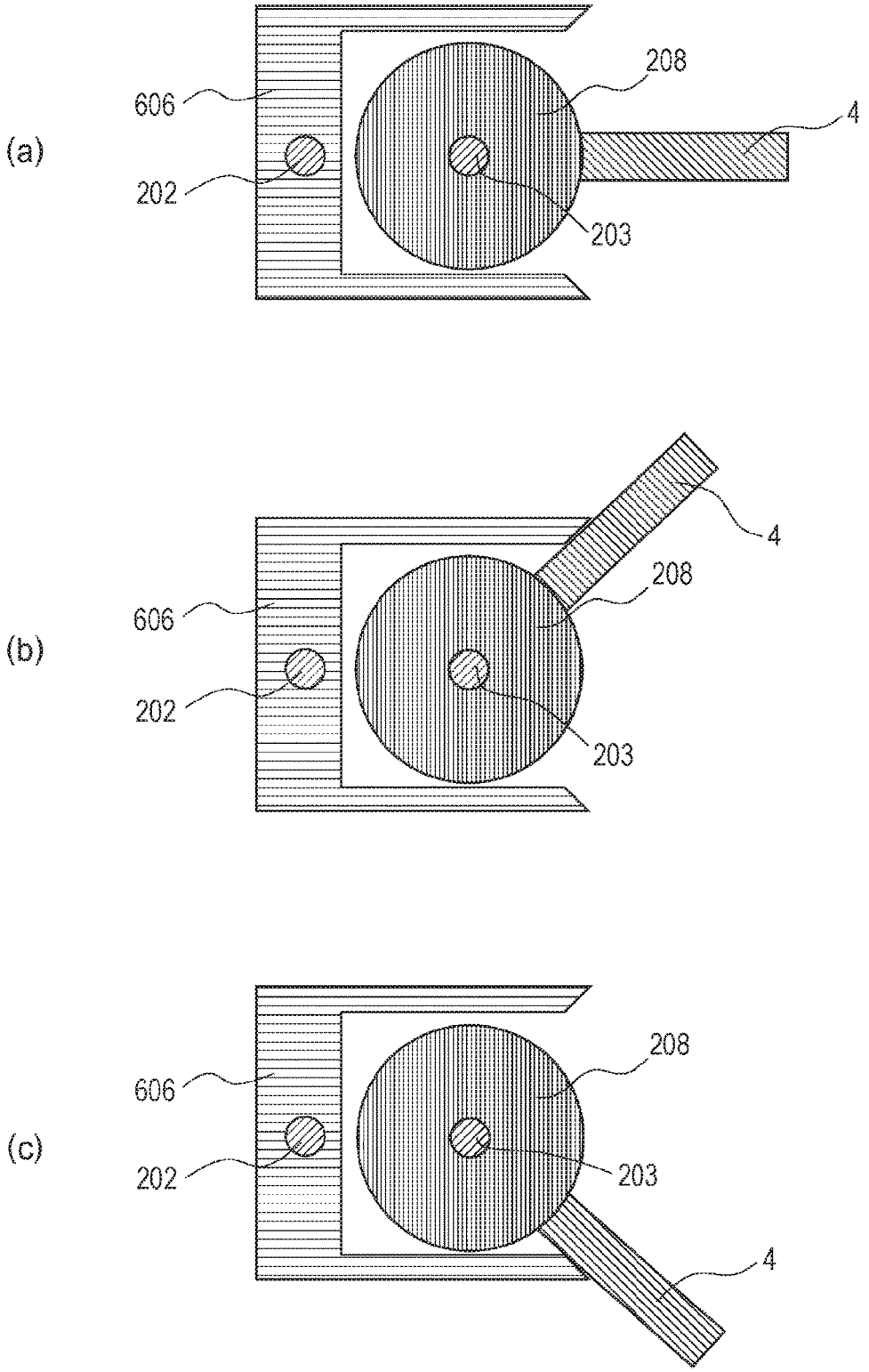
Figure 190:
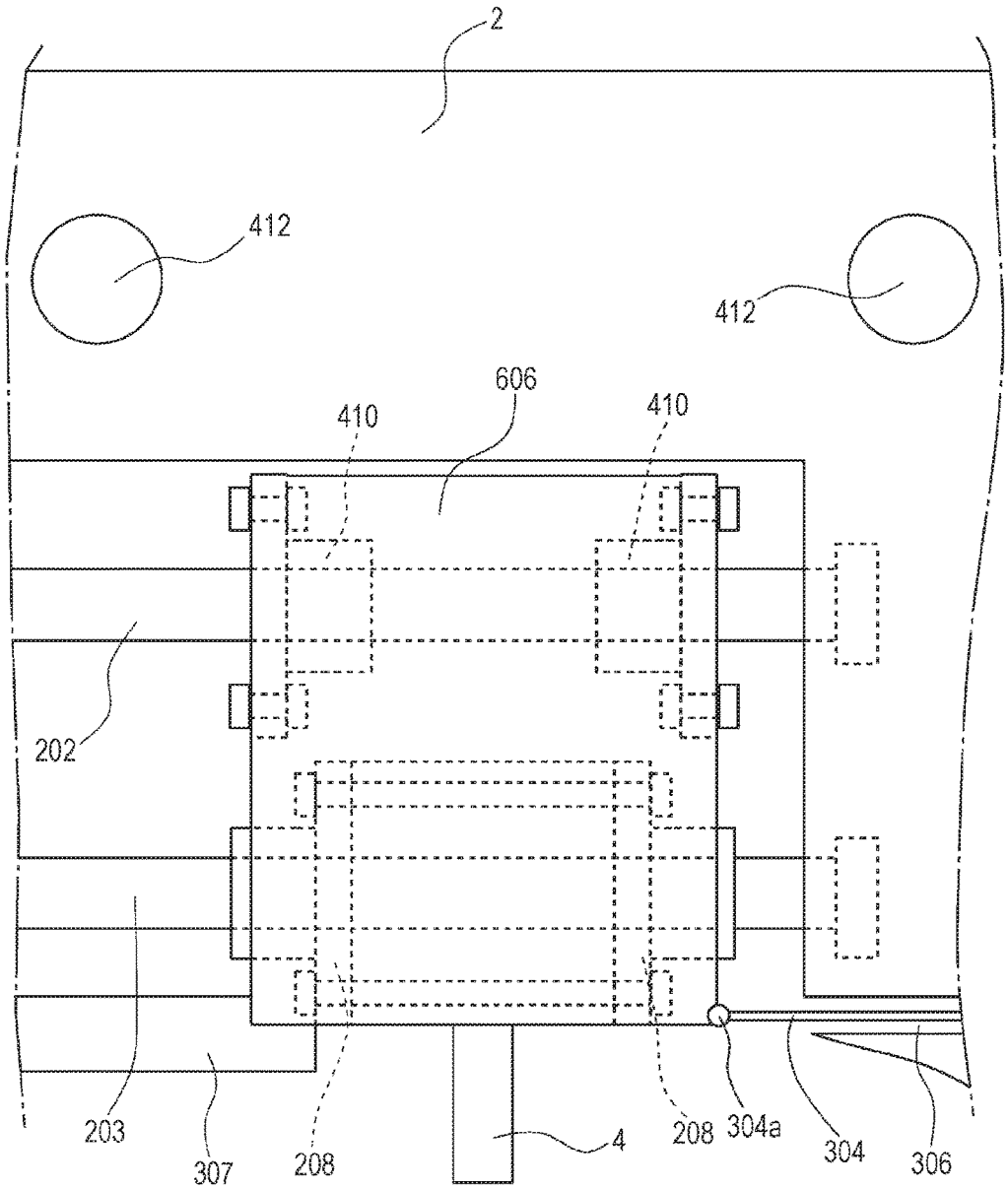
Figure 191:
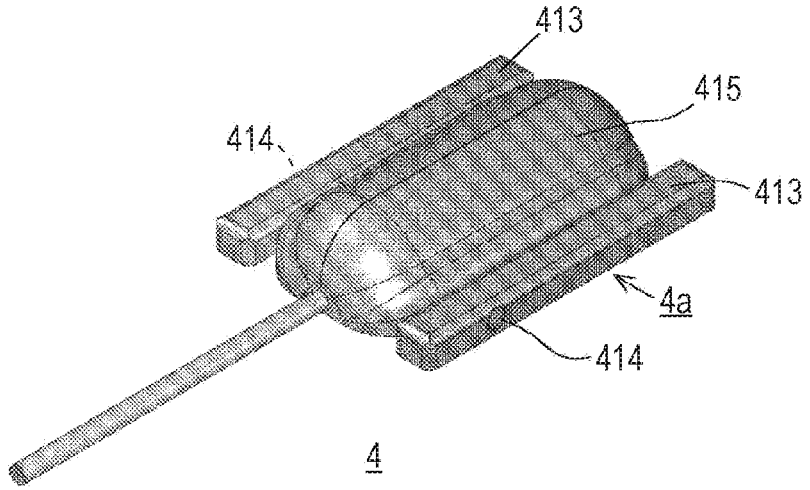
Figure 191:
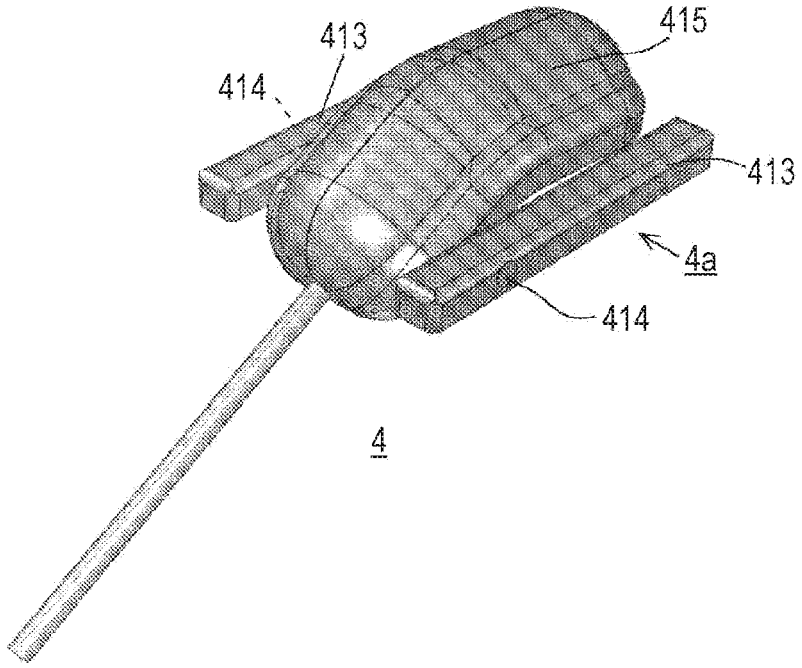
Figure 192:
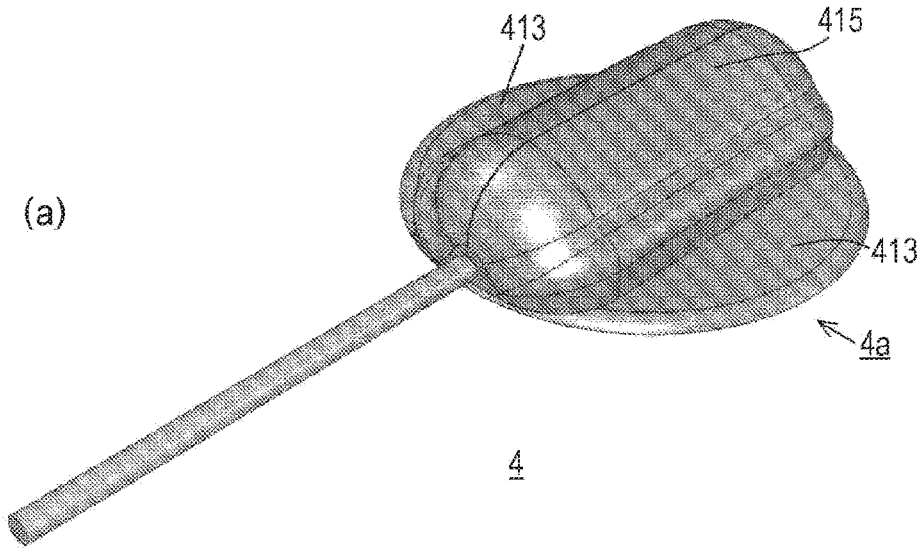
Figure 192:
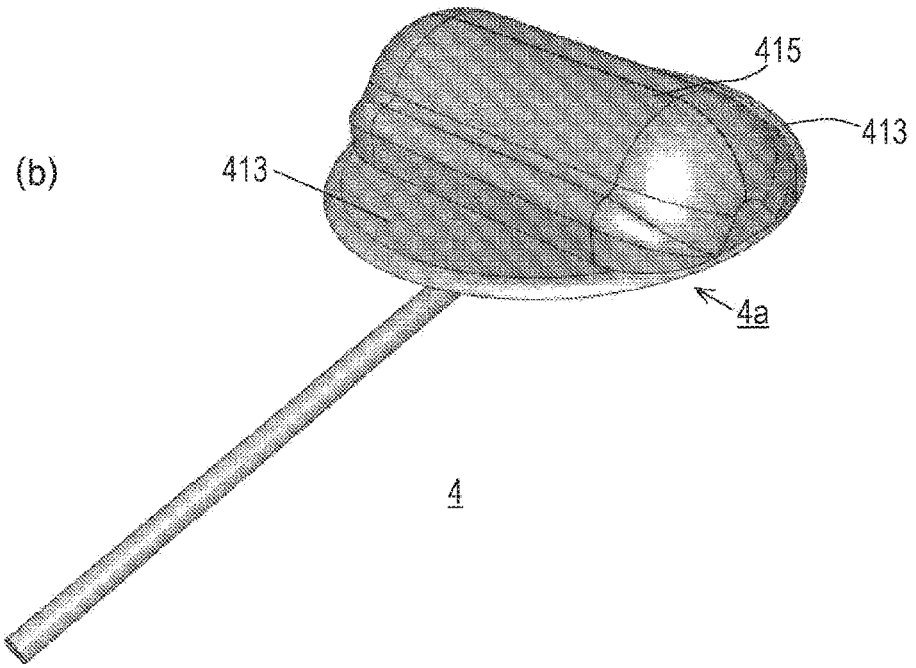
Figure 193:
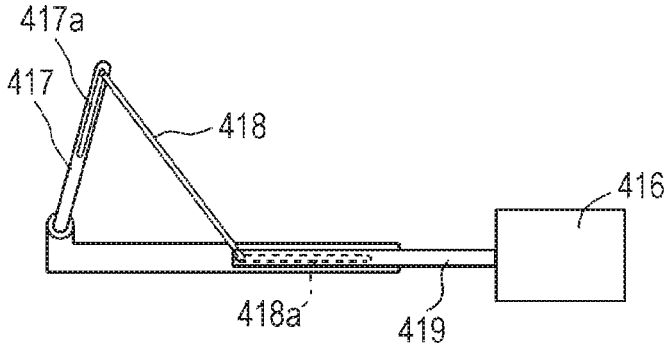
Figure 193:
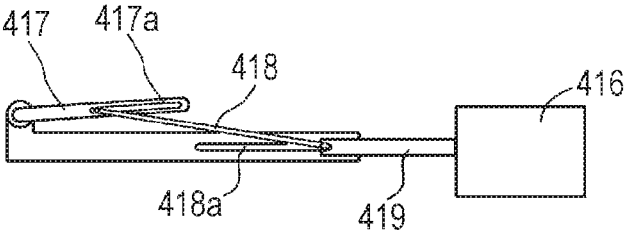
Figure 194:
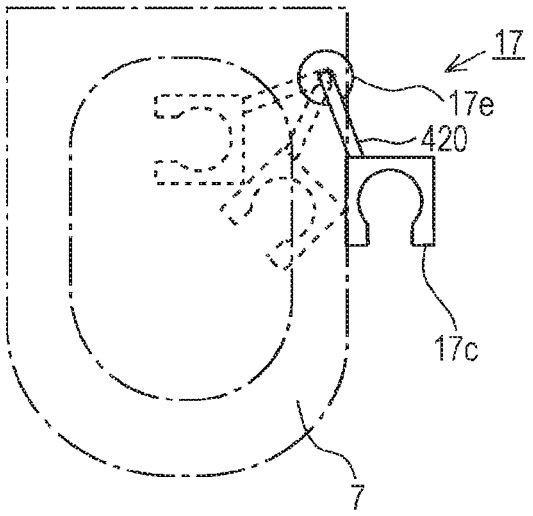
Figure 195:
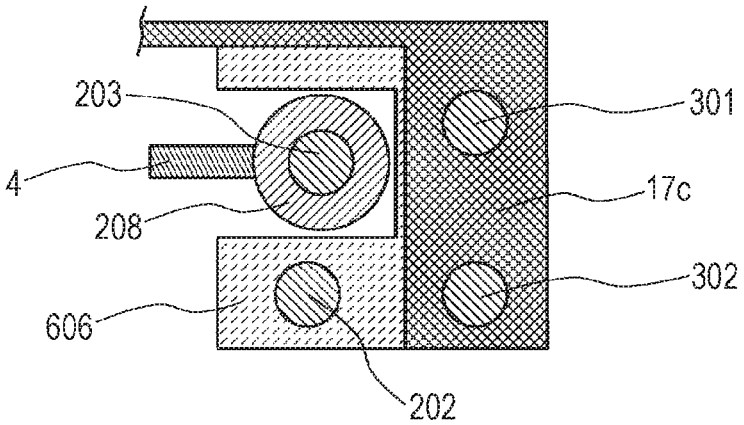
Figure 196:
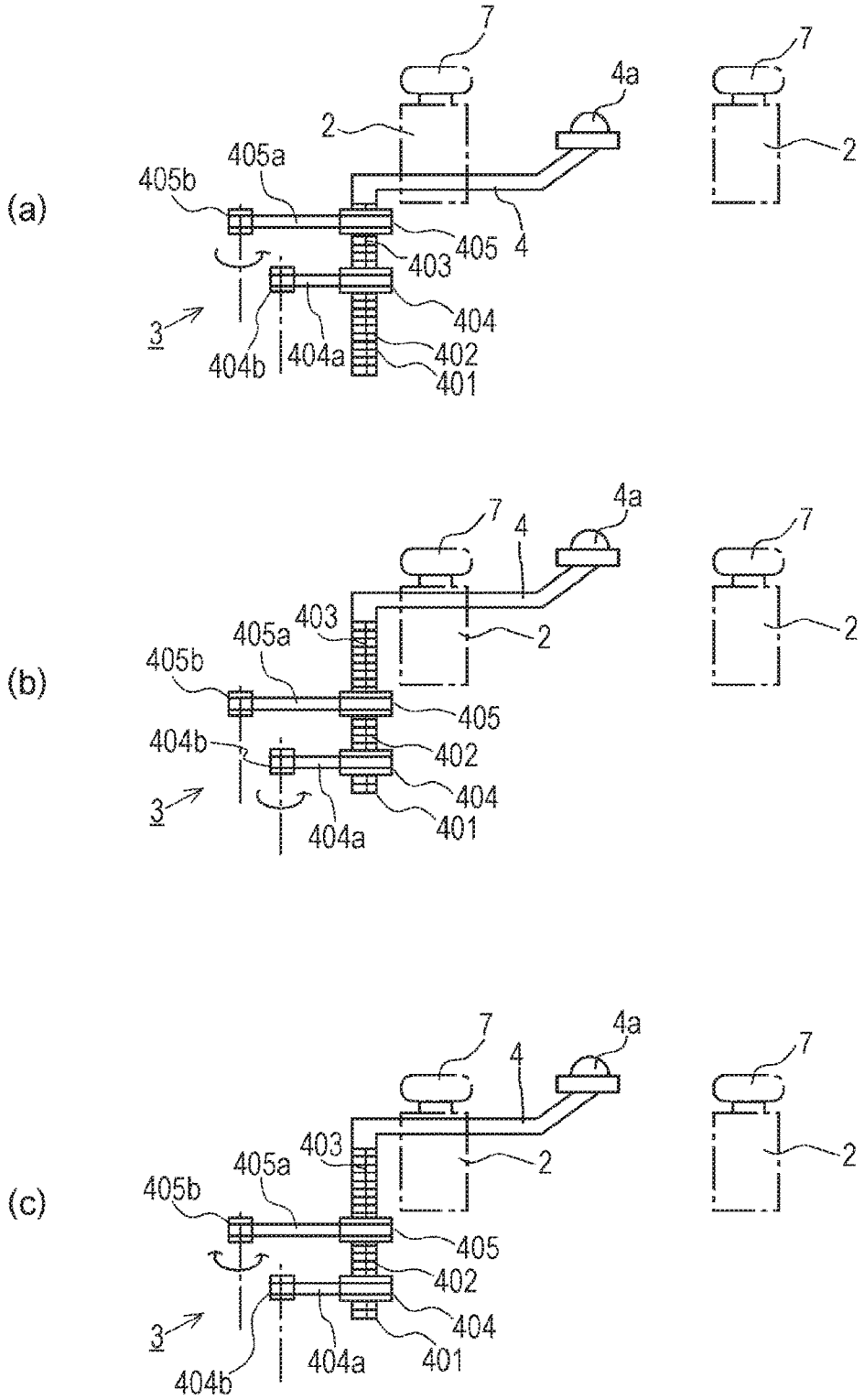
Figure 197:
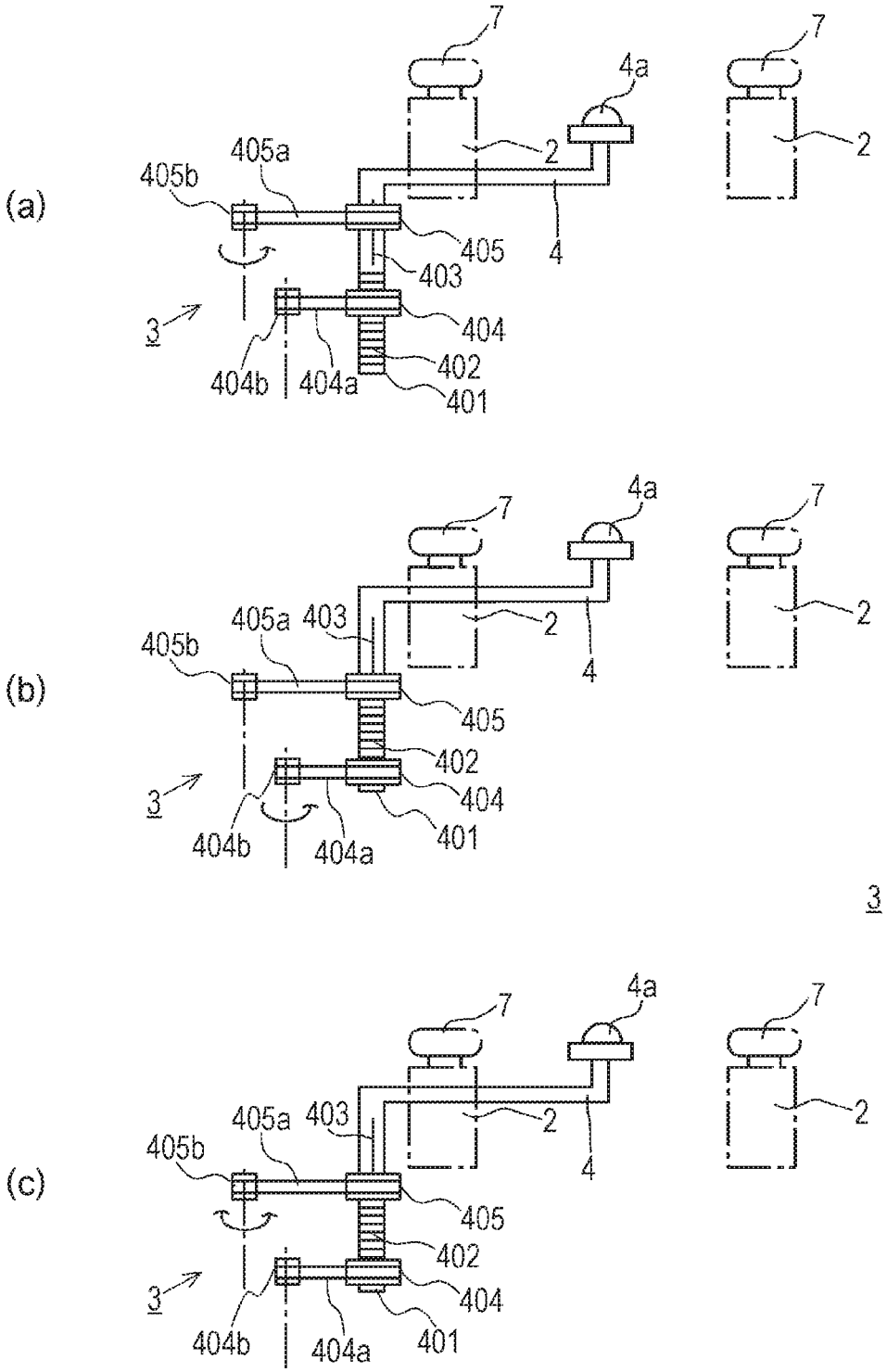
Figure 198A:
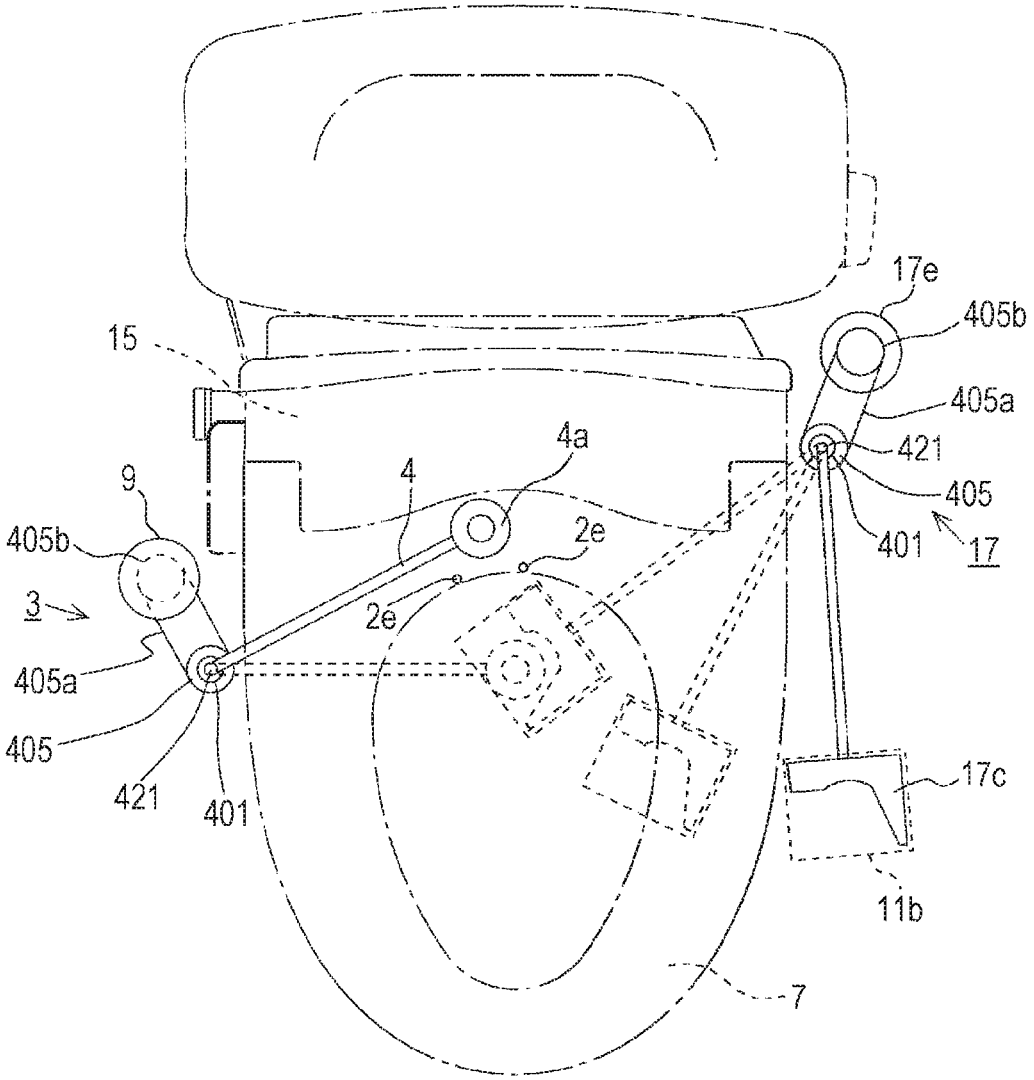
Figure 198B:
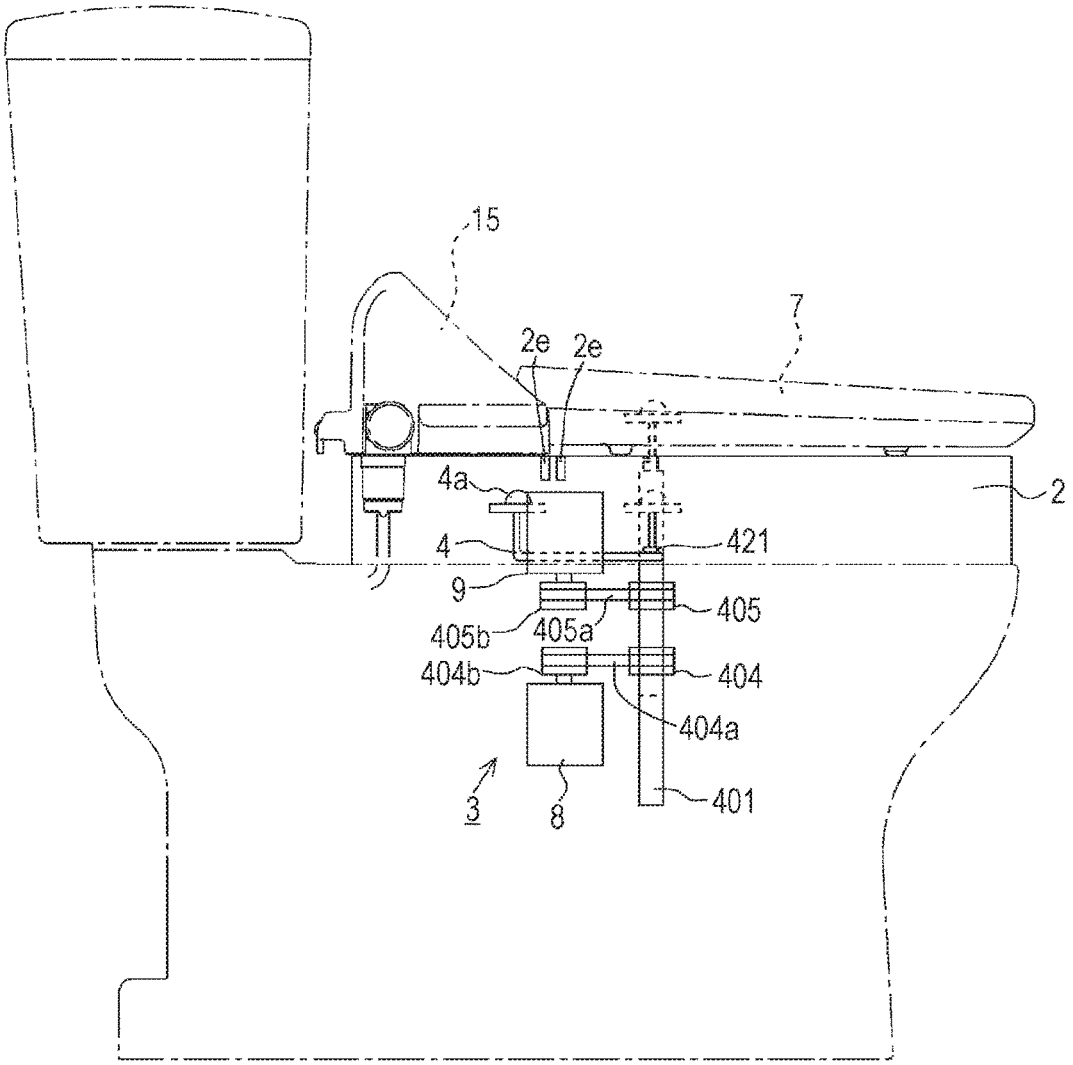
Figure 198C:
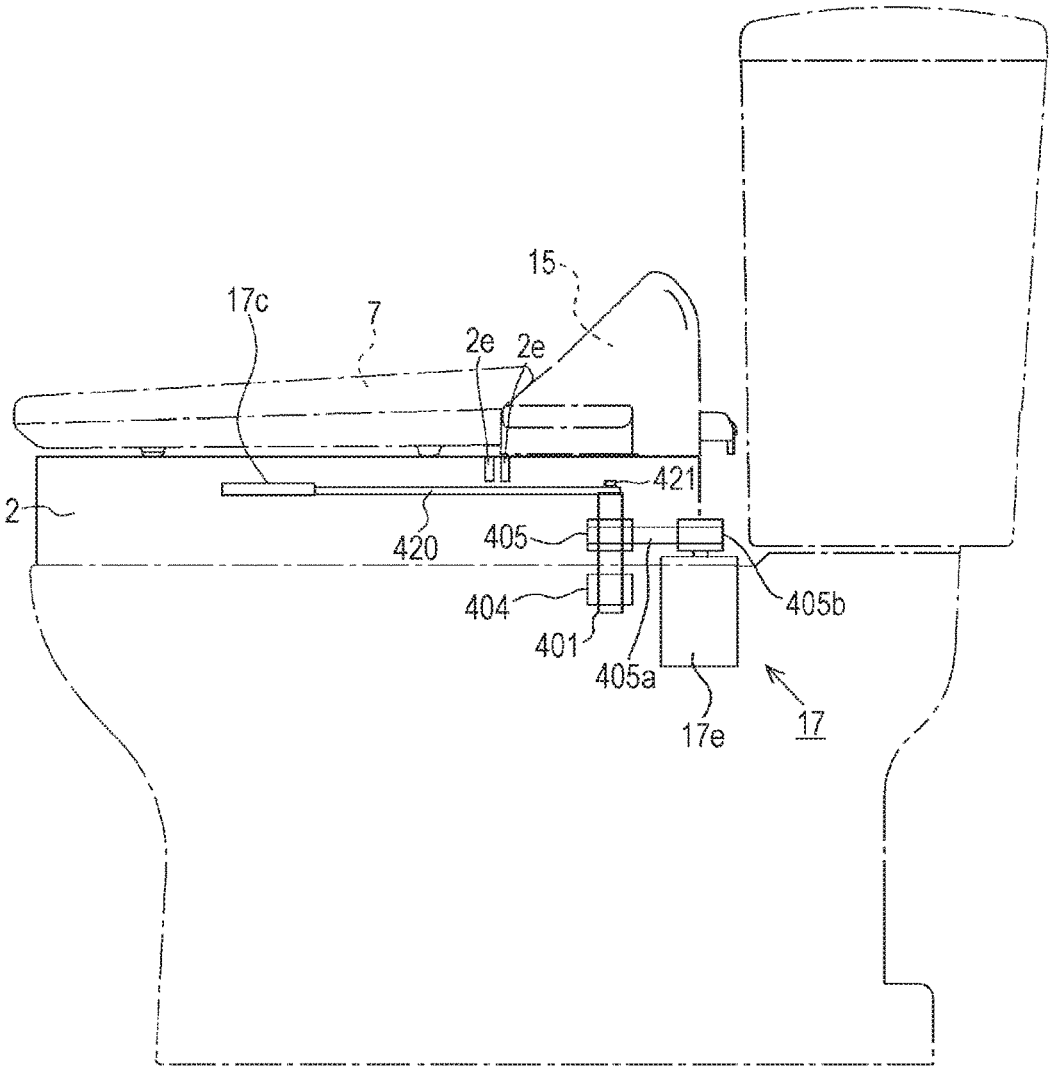
Figure 198D:
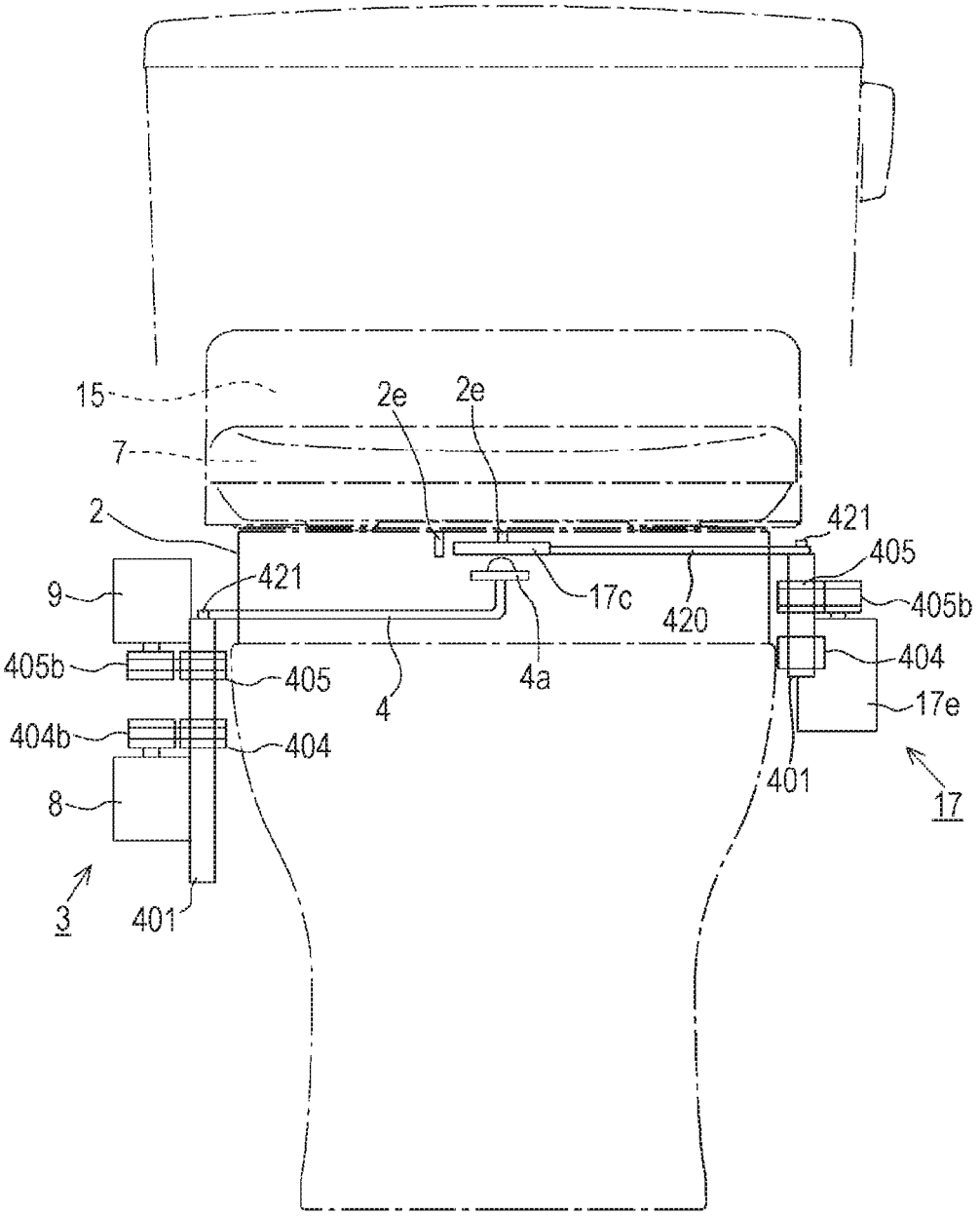
Figure 199:
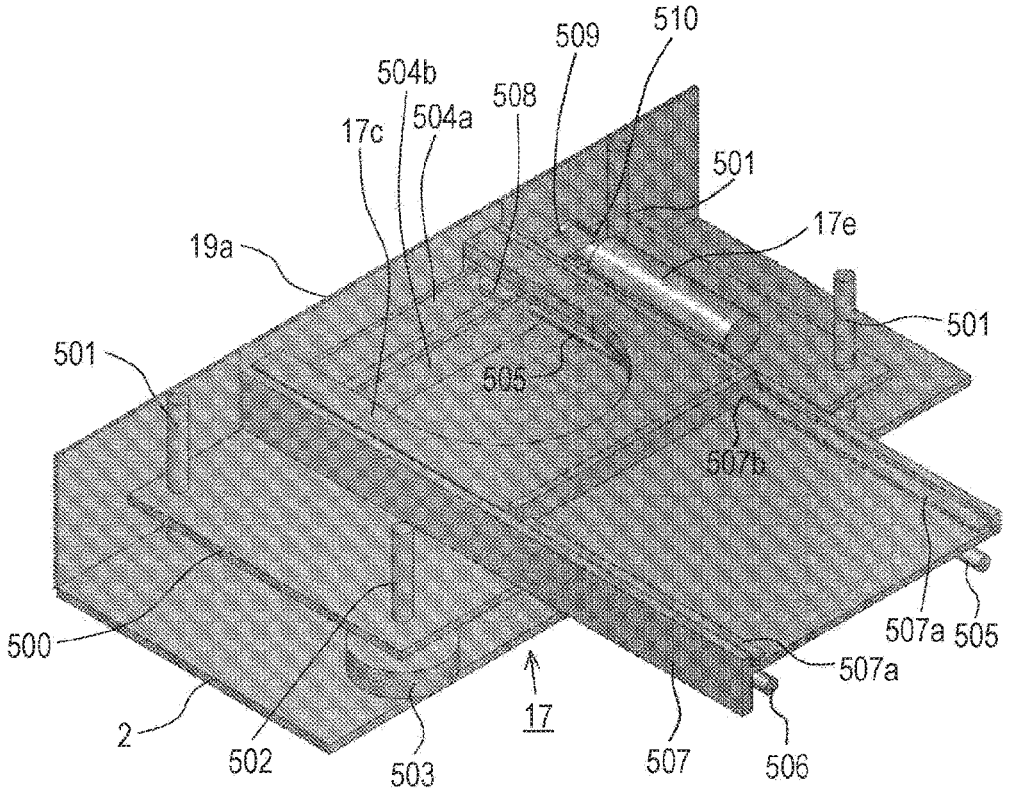
Figure 200:
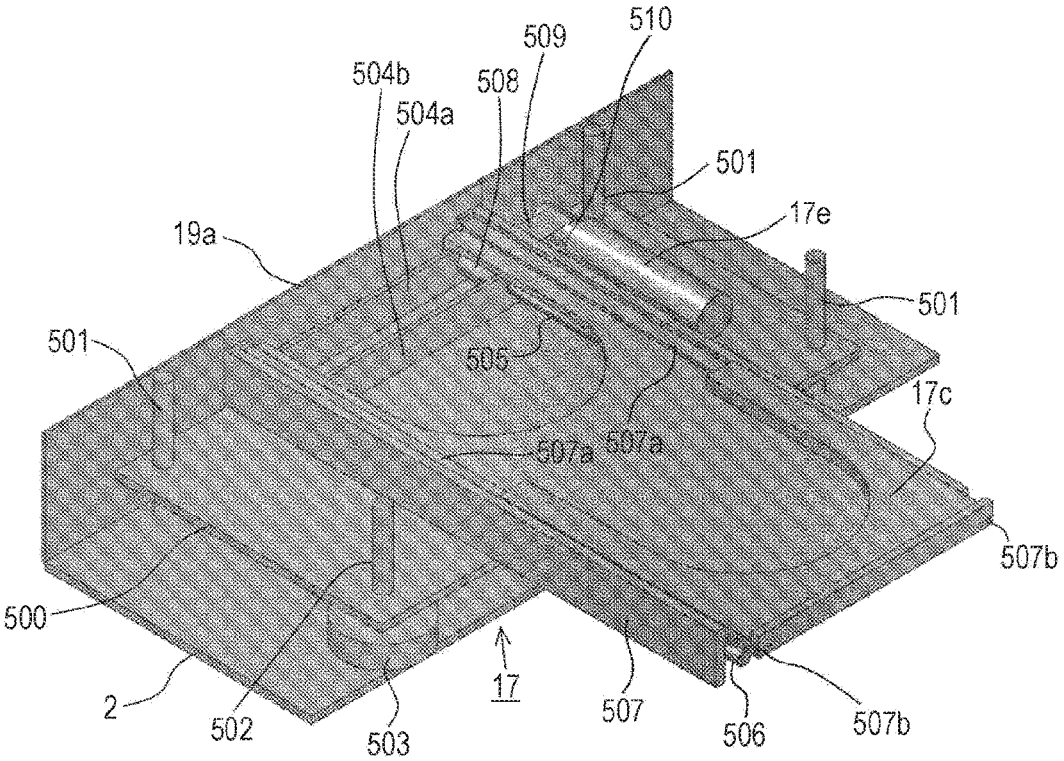
Figure 201:
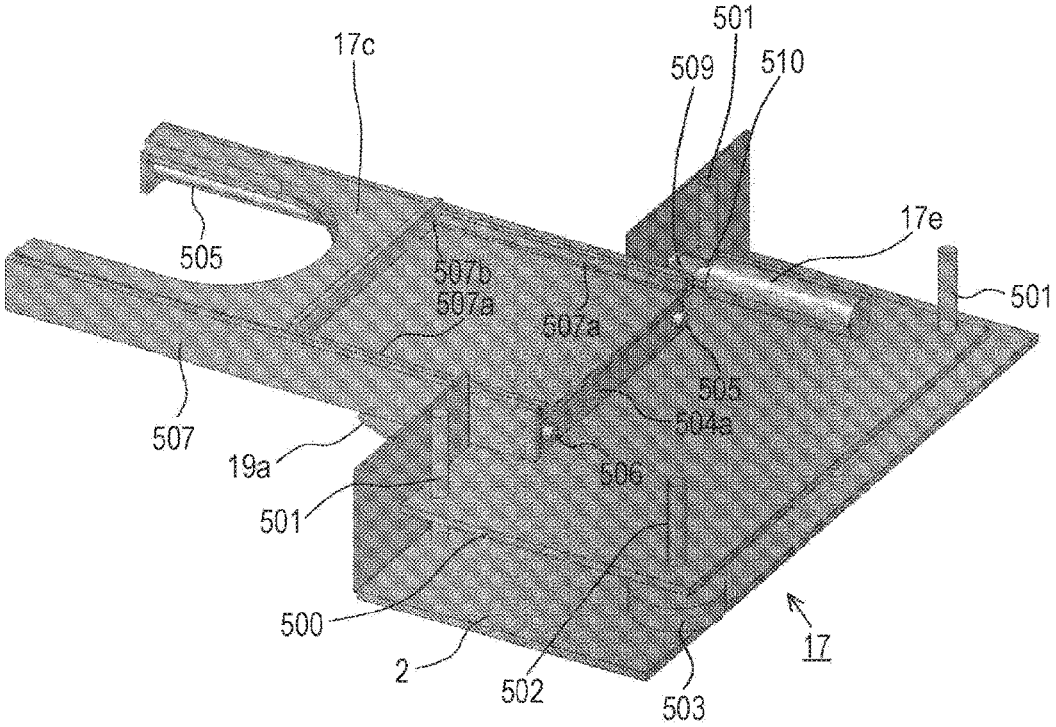
Figure 202:
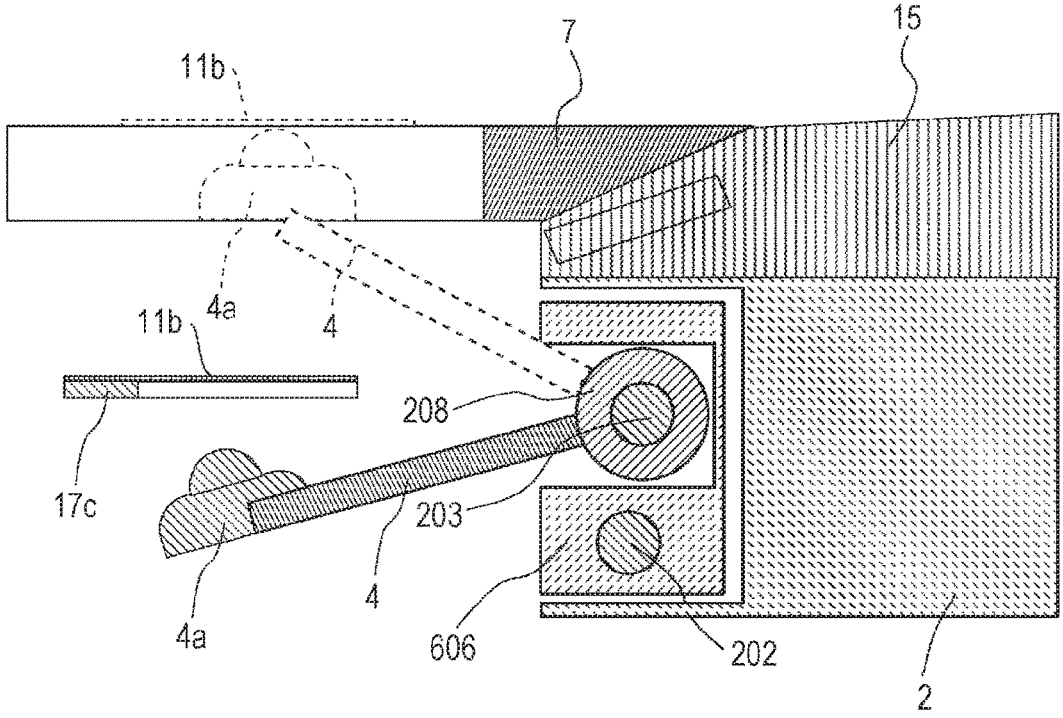

FIG. 187 is a plan view of a paper supply unit 17 utilizing the paper loading guide 17*c* illustrated in FIG. 186 and a wiping arm drive unit 3 utilizing a rotatable portion 208;

FIG. 188 is a view of a structure in a case where the paper loading guide 17*c* is swung by a structure similar to those of the thirteenth to sixteenth embodiments;

FIG. 189 is a sectional view for structurally illustrating limitation of the force of pushing up the buttocks by the wiping arm 4 in the thirteenth to sixteenth embodiments;

FIG. 190 is a plan view when the movable portion 606 is fixed to a screw shaft 202 with flanged nuts 410 and the rotatable portion 208 is fixed to a rotary shaft 203 with flanged spline nuts 411;

FIG. 191 is a perspective view of an example of the shape of a pressing unit 4*a* in the case of using a flexible material;

FIG. 192 is a perspective view of an example of the shape of the pressing unit 4*a* in the case of using the flexible material;

FIG. 193 is a view of an opening/closing mechanism in the case of using an electromagnetic solenoid 416;

FIG. 194 is a plan view of a concept in the case of exposing the paper loading guide 17*c* by angular movement;

FIG. 195 is a sectional view when the movable portion 606 and the rotatable portion 208 are arranged in the upper-to-lower direction;

FIG. 196 is a front view in a case where the wiping arm drive unit 3 is implemented using the overlapping-type ball screw spline;

FIG. 197 is a front view in a case where the wiping arm drive unit 3 is implemented using a separation-type ball screw spline;

FIG. 198A is a plan view of a state when a buttocks wiping device of a seventeenth embodiment is attached to a toilet bowl;

FIG. 198B is a left side view of FIG. 198A, and note that a paper supply unit 17 is not shown;

FIG. 198C is a right side view of FIG. 198A;

FIG. 198D is a front view of FIG. 198A, and note that a bearing, a seat, etc. are not shown;

FIG. 199 is a perspective view of an embodiment of the paper supply unit 17;

FIG. 200 is a perspective view of the paper supply unit 17 when a paper loading guide 17*c* slidably moves backward;

FIG. 201 is a perspective view of the paper supply unit 17 when the paper loading guide 17*c* is exposed;

FIG. 202 is a sectional view of a position relationship between a wiping arm 4 and the paper loading guide 17*c;*

Figure 203:
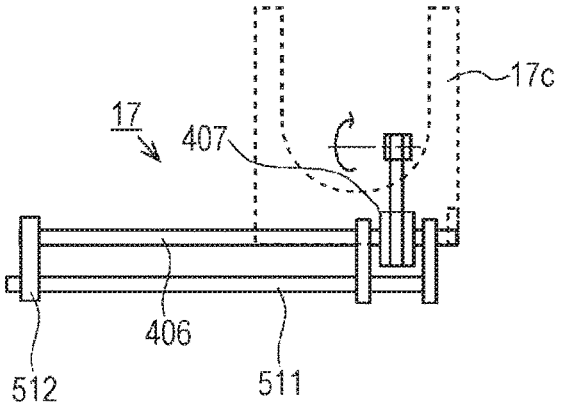
Figure 203:
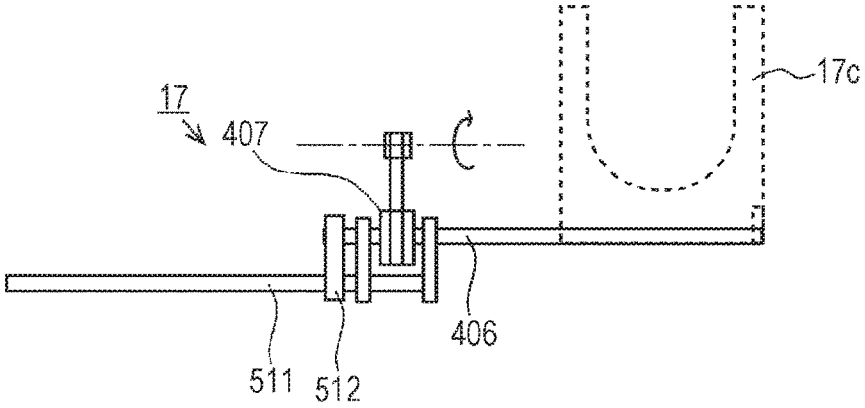
Figure 203:
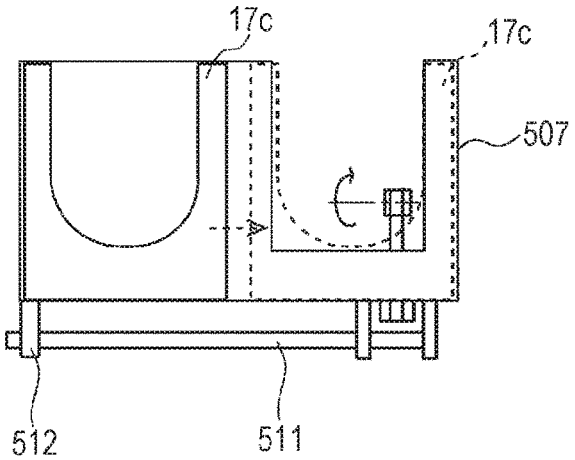
Figure 204A:
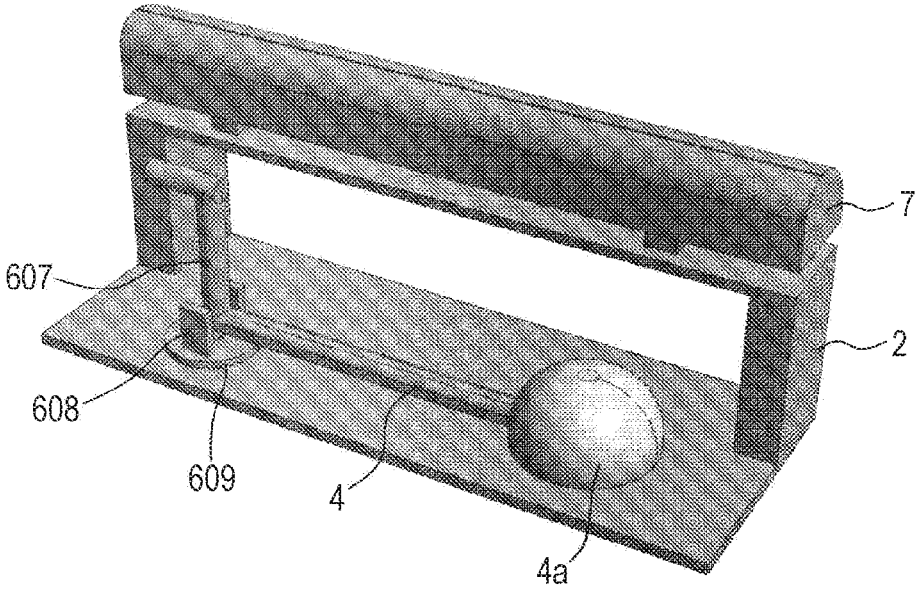
Figure 204B:
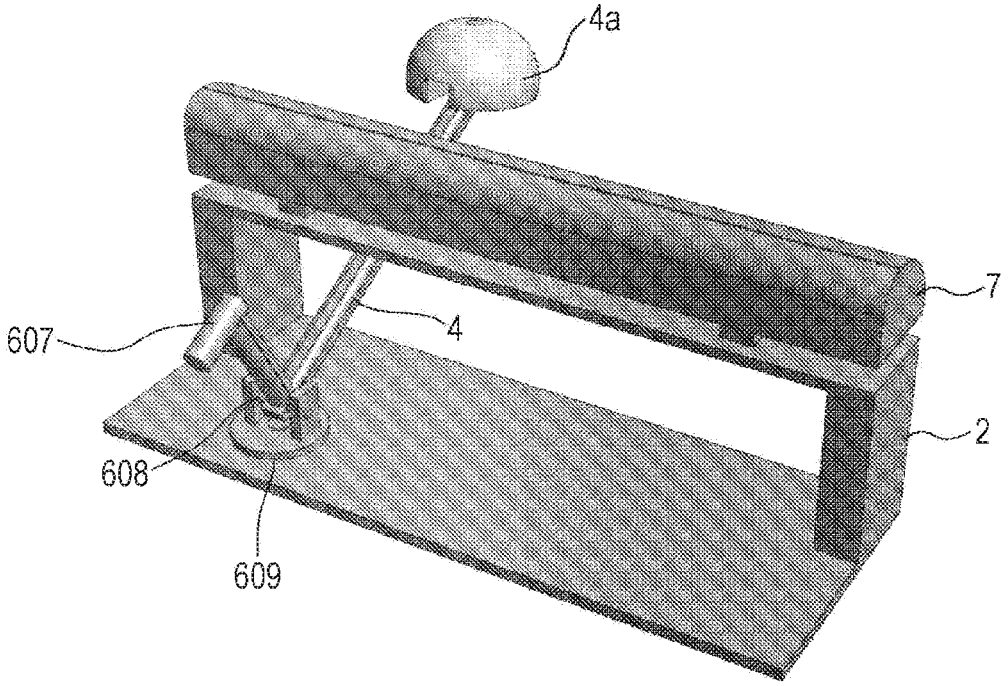
Figure 205:
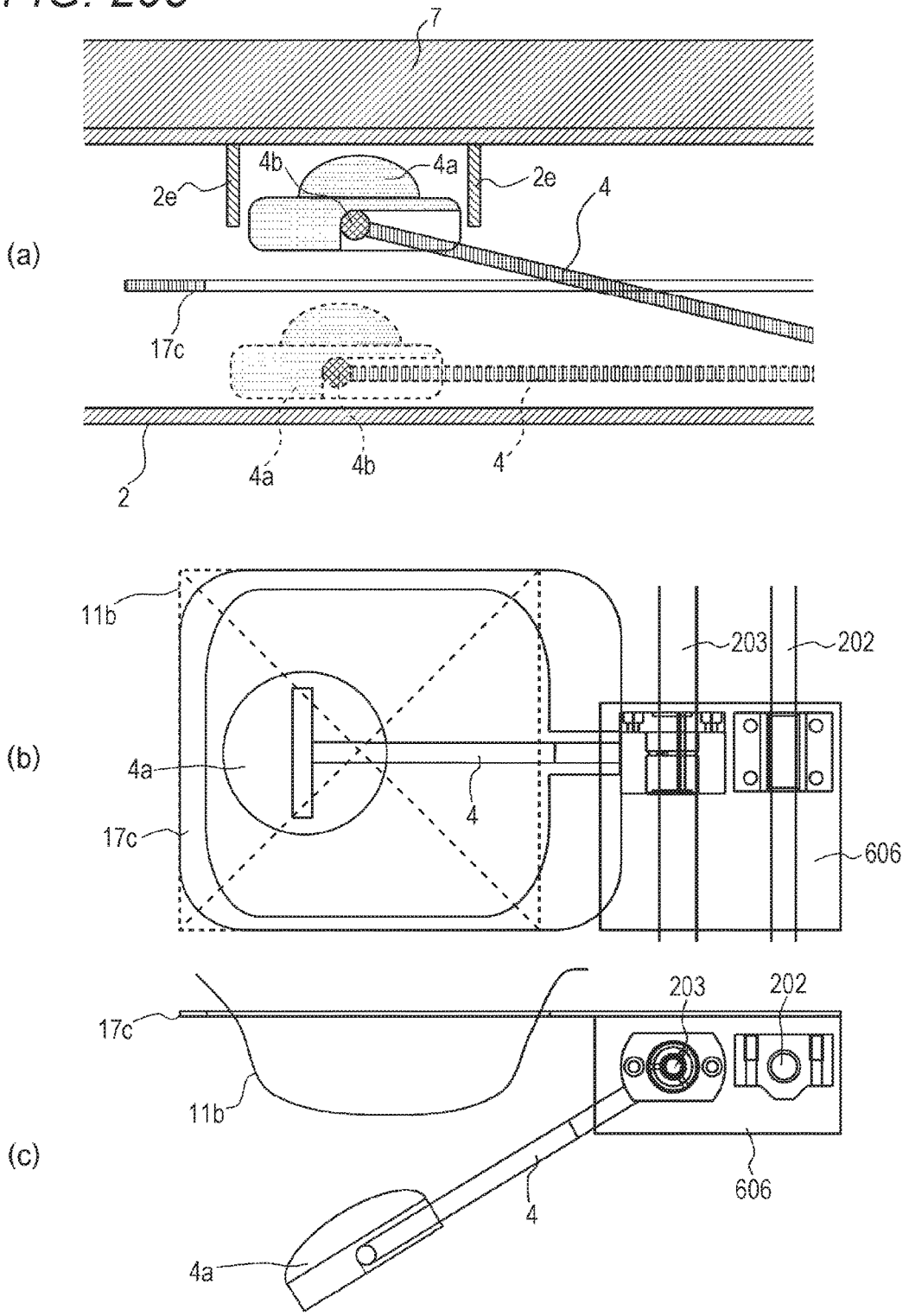

FIG. 203 is a view of a variation of the paper supply unit 17;

FIG. 204A is a perspective view of a buttocks wiping tool usable for manually wiping the buttocks;

FIG. 204B is a perspective view of the buttocks wiping tool usable for manually wiping the buttocks; and FIG. 205(*a*) is a sectional view for describing the method for dropping paper by a protrusion 2*e* provided at a raised portion 2 and functioning as a dropping portion, FIG. 205(*b*) is a plan view of a variation of the paper loading guide 17*c*, and FIG. 205(*c*) is a right side view of a state when the paper is dropped.

DESCRIPTION OF EMBODIMENTS

The modes for carrying out the invention are embodiments as illustrated in the attached drawings, and are configured such that the buttocks are wiped using a wiping arm drive unit housed in a raised portion. Moreover, the thickness of a toilet seat may be slightly increased so that a section for driving an arm is provided in the thick toilet seat instead of providing in the raised portion. Other structures are illustrated in detail in the drawings.

Devices with various combinations of all of disclosed mechanisms are also included in the present invention.

Buttocks wiping devices illustrated in FIGS. 51 to 60 and FIGS. 76 to 97 are each configured such that a head (a pressing unit) of a wiping arm does not move with paper being placed on the head or being held by the head, but movement of the head and movement of the paper are separately performed. Main points of operation control in these buttocks wiping devices will be described.

A detection function includes, e.g., the following functions:

detection (e.g., a mechanical switch or a contact sensor) on whether or not paper is supplied by a user;

a detection unit (e.g., an optical sensor) configured to detect whether or not paper is properly fed;

a detection unit (e.g., a photoelectric sensor or a color identification sensor) configured to detect whether or not paper is properly fed to below the anus):

a detection unit (e.g., a color identification sensor configured to identify the color of the anus or a sensor configured to simply detect whether or not a switch of a warm-water cleansing device has been pressed or detect warm-water cleansing sound) configured to detect whether or not warm-water cleansing has been completed: and a detection unit (A seating sensor used for a toilet seat can be used. For example, the seating sensor may be placed on a toilet bowl, and a control unit of the buttocks wiping device may receive a signal from the seating sensor) configured to detect seating.

Moreover, operation is made as follows.

1. Completion of warm-water cleansing is detected.

2. The user instructs wiping. When warm-water cleansing is not completed yet, the buttocks wiping device alerts the user and stands by without operation.

3. If no paper has been supplied, the buttocks wiping device makes an alert and stands by.

4. If paper has been supplied, paper feeding rollers are driven to feed the paper.

5. Detection on whether or not the paper is properly placed on a paper loading guide is made.

6. The paper loading guide is driven forward.

7. After the paper loading guide has been moved to below the anus, detection on whether or not the paper is properly disposed is made.

8. If the paper has not been properly disposed, an alert is made, the paper loading guide is returned to an original position, and the buttocks wiping device prompts the user to supply paper again.

9. If the paper has been properly disposed, the head moves to a wiping position.

10. The head moves upward such that the paper moves apart from the paper loading guide.

11. The paper loading guide is returned to the original position at the timing of moving the paper apart from the paper loading guide.

12. The arm drive unit presses the head against the buttocks. The head moves back and forth and up and down such that moisture and dirt on the buttocks adhere to the paper.

13. With wiping adjustment by the user, such as the instruction of firm upward pressing, front-to-back movement, or lowering of the head, the drive unit moves the head according to preferences.

14. Upon completion of wiping, the head returns to an original position. Wiping may be completed according to a user's instruction, or may be automatically completed after predetermined operation.

15. When the head returns to the original position, wiping is completed.

16. After the seating sensor has confirmed that the user has left, a sterilization and/or cleansing unit is driven to sterilize and/or cleanse the head. Note that a dryer (an air blower) may be built in the sterilization and/or cleansing unit, and drying may be performed by the dryer after cleansing etc.

17. A cleaning mode is provided so that cleaning can be performed. When an instruction on the cleaning mode is made, maintenance of the head can be performed with the arm being exposed through the toilet bowl. With the instruction on the cleaning mode, the paper loading guide may be also exposed. Note that in this buttocks wiping device, an internal structure thereof can be easily checked in such a manner that a lid provided at the raised portion is merely opened. Thus, maintenance can be performed without exposure on a toilet bowl side.

18. In addition, an abnormal location may be notified using a lamp etc.

Buttocks wiping devices illustrated in FIGS. 106 to 108, 113, 114, 121 to 128, 135 to 140, and 154 to 156 may also operate similarly as described above.

FIGS. 98 to 104 illustrating a head whole-washing cleansing function will be set forth merely as an example, and a head cleansing function is not specifically limited in the present invention.

The embodiments of the present invention will be described below with reference to the drawings. Note that the same reference numerals are generally used for elements with the same names in the drawings. Even when the same reference numerals are used, the elements might have different functions, characteristics, structures, etc. In this case, such differences will be mainly described in each case. Moreover, even for the elements with the same names, description might be made using different reference numerals for the sake of clarifying the differences in function, characteristic, structure, etc.

In addition, all aspects described in the present specification and illustrated in the drawings can be utilized in various combinations. As necessary, these combinations will be described in the present specification. However, even when specific description is not made, these aspects can be utilized in combination. Further, the embodiments described below will be set forth merely as examples, and the present invention should not be interpreted limiting to the embodiments.

In the embodiments of the present invention described in the present specification, there are some descriptions on use of paper flushable down a toilet, such as toilet paper, for wiping the buttocks. As long as the buttocks can be wiped, other materials than paper may be used. For avoiding limited interpretation of the present invention, an object for wiping the buttocks will be referred to as a "wiping material." Thus, in description below, "paper" will be recognized as a replacement term "wiping material." Although phrases such as an automatic paper supply unit and a paper supply unit include the term "paper," these units should be interpreted as a device configured to automatically supply the wiping material and a device configured to supply the wiping material.

In the beginning, great differences of the buttocks wiping device described in the present specification from a conventional buttocks wiping device will be first outlined.

In the conventional buttocks wiping device, paper is held by a head portion of a wiping arm, and a wiping arm drive unit exposes, in a state in which the paper is held by the head portion, the wiping arm at a wiping position below the buttocks. As described above, the conventional buttocks wiping device needs to have the structure for holding the paper.

However, the mechanism for holding the paper is provided at the buttocks wiping device, and therefore, various actuators for holding the paper, such as a motor, a wire, or shape-memory alloy, are necessary. Further, even the mechanism for reliably dropping the held paper is also necessary. As a result, this leads to a complicated structure, as well as leading to a cost increase. The head portion for holding the paper directly contacts the buttocks, and therefore, needs to be sanitary. However, because of these built-in actuators, there is a problem that it is difficult to perform maintenance for maintaining a sanitary state. For example, it is difficult to perform whole-washing of the head portion.

However, upon development of a commercializable buttocks wiping device, the inventor of the present invention has reviewed inventions relating to the buttocks wiping device. The warm-water cleansing device removes almost all of dirt on the anus, and dirt in the vicinity of the anus is merely slight remaining moisture and feces (hereinafter referred to as "moisture etc."). Thus, the buttocks are not necessarily firmly wiped with the paper being firmly held by the head portion, and the moisture etc. can be wiped only by pressing the paper against the vicinity of the anus. Consequently, the inventor has reached such a significant perceptional change that the paper is not necessarily held by the head portion. When viewed in hindsight, it seems that such a significant perceptional change has been made merely by exclusion of the component for holding the paper, but it has not been easy to reach such a perceptional change. The inventor of the present invention has developed the buttocks wiping device since around 2007, and it has taken about 8 years to reach the perceptional change. Taking advantage of this perceptional change, the present specification specifically discloses as many embodiments as possible, but the greatest characteristics of the present invention are as follows.

The head portion of the wiping arm does not hold paper. The following two techniques have been developed as alternative techniques of not holding the paper by the head portion:

(1) First Technique: friction force or the shape of the pressing unit of the wiping arm is utilized to move, without attaching or inserting the paper to the pressing unit, the wiping arm with the paper being placed on the pressing unit, thereby wiping the buttocks; and (2) Second Technique: the paper is exposed below the buttocks, and the buttocks are wiped in such a manner that the pressing unit of the wiping arm pushed up the exposed paper from below.

Any of these techniques contributes to structure simplification, cost reduction, sanitation, usability, and easy maintenance of the buttocks wiping device.

Further, the inventor of the present invention has also considered, as a problem, the large size of the conventional buttocks wiping device. The conventional buttocks wiping device has been configured such that a drive mechanism is disposed at the side of a toilet bowl. For this reason, a large space at the side of the toilet bowl is inevitably consumed. Thus, the inventor of the present invention has developed the following two techniques for avoiding, as much as possible, consumption of the space at the side of the toilet bowl:

(3) Third Technique: part or entirety of the mechanism of the wiping arm drive unit for driving the wiping arm is provided below the toilet seat in the raised portion provided between the toilet bowl and the toilet seat or provided inside the thick toilet seat. Not only right and left spaces but also a space below the warm-water cleansing device can be used as the space below the toilet seat in the raised portion or the space inside the thick toilet seat. This can avoid, as much as possible, consumption of the space at the side of the toilet bowl; and (4) Fourth Technique: in wiping of the buttocks, reliable wiping can be performed by movement of the pressing unit in a direction from the front to the back of a human body. A method in which the wiping arm moves back and forth on a rail has been conventionally employed as the mechanism for moving the pressing unit from the front to the back. However, in the present invention, the wiping arm is rotated about a fixed supporting point at the side of the toilet bowl, and in this manner, the pressing unit is moved back and forth in the vicinity of the anus. With this structure, the big structure of moving the wiping arm itself back and forth on the rail can be omitted, leading to significant size reduction.

By employment of the first and second techniques, the third and fourth techniques can be more easily employed.

Any of the above-described characteristics is an invention that has been obtained based on significant perceptional changes, and is not to be easily developed. The inventive step of the present invention should not be argued as so-called "hindsight."

In addition, various aspects necessary for practical use are disclosed in the present specification. Even if the above-described four techniques are not employed, these techniques can respectively function as independent techniques.

The embodiments of the aspects for practical use of the buttocks wiping device will be sequentially described below.

First Embodiment

Figure 1A:
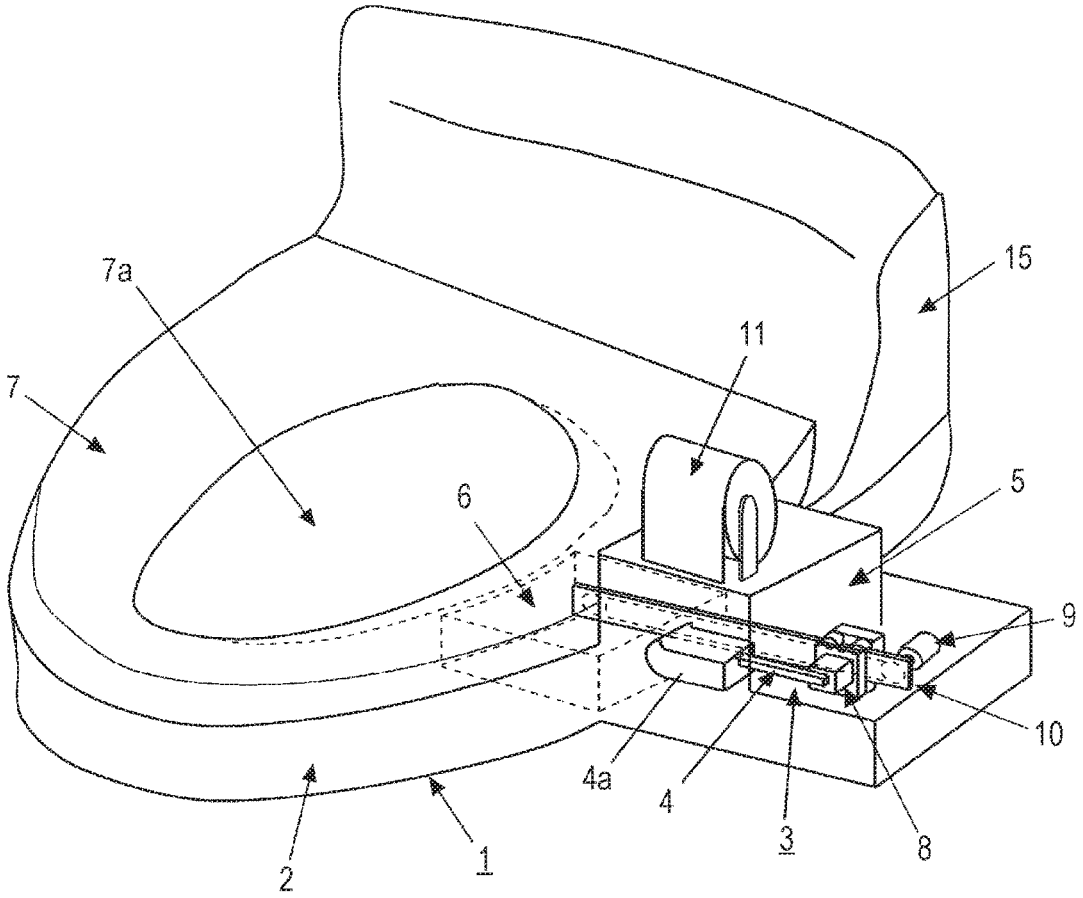
FIG. 1A is a perspective view of an outline structure of an outer appearance of a buttocks wiping device 1 of a first embodiment of the present invention.

FIG. 1A is a perspective view of an outline structure of an outer appearance of a buttocks wiping device 1 of a first embodiment of the present invention. For the sake of clarifying an internal structure, the internal structure is seen through the buttocks wiping device 1 in FIG. 1A. In FIG. 1A, the buttocks wiping device 1 includes a raised portion 2, a wiping arm drive unit 3, a wiping arm 4, an automatic paper supply unit 5, and an opening/closing unit 6. A toilet seat 7 is rotatably attached to a warm-water cleansing device 15. Note that in other embodiments, there are some drawings in which the warm-water cleansing device is not shown. However, the present invention can be, as necessary, understood such that the warm-water cleansing device 15 is similarly provided at the back of the toilet seat 7. The raised portion 2 is provided between a not-shown toilet bowl and the toilet seat 7, and is provided on the toilet bowl below the toilet seat 7. The wiping arm drive unit 3 includes an upper-to-lower motor 8, an exposure motor 9, and a rail unit 10.

The automatic paper supply unit 5 has the function of deliver roll-shaped toilet paper 11, folding and cutting the toilet paper 11 to a predetermined length, and placing the cut paper on a pressing unit 4*a* of the wiping arm 4. The pressing unit 4*a* is a head provided at a tip end portion of the wiping arm 4, and is a wiping unit for pressing the paper against the buttocks to wipe moisture etc. when the wiping arm 4 inclines upward. The automatic paper supply unit 5 has been already practically used as an electric toilet roll. With application of such an electric toilet roll, the automatic paper supply unit 5 can be implemented. Thus, only main points will be described in this embodiment, and detailed description of the structure will not be made.

Note that a roll shape indicates a state in which long toilet paper is winded. In addition to the case of the roll shape, the present specification also discloses a case where long toilet paper is compactly folded in advance and the automatic paper supply unit 5 automatically delivers such long toilet paper to fold and cut such toilet paper at predetermined intervals. In a case where the toilet paper itself has a certain thickness, such long toilet paper is not necessarily folded, and is only cut to a predetermined length.

Note that the automatic paper supply unit 5 is not necessarily used and may be detached and, e.g., an opening or a paper feeding roller for manually placing the paper on the pressing unit 4*a* may be provided at a location at which the automatic paper supply unit 5 is supposed to be provided. With this structure, the buttocks wiping device 1 can be provided, which is configured to manually place the paper on the pressing unit 4*a*.

The opening/closing unit 6 is a device configured to open/close an opening provided at the raised portion 2. For example, a shutter to be driven up and down, back and forth, etc. by a motor, an electromagnetic solenoid, a piston, etc. can be used. However, the present invention is not limited to such a device as long as the device can open/close the opening. Moreover, the opening/closing unit 6 is not necessarily driven by the motor etc., and may be an opening/closing unit using a hinge and a spring. The wiping arm may push, upon exposure thereof, down through the opening/closing unit, and the opening/closing unit may be automatically closed by spring force upon retraction of the wiping arm. Alternatively, a structure may be made such that a user manually opens/closes the opening/closing unit 6 up and down, back and forth, etc. Any well-known mechanisms can be employed as an opening/closing mechanism. Note that in description of the present specification, a front side (a side opposite to the warm-water cleansing device 15) of the toilet seat 7 indicates a forward direction, the side close to the warm-water cleansing device 15 indicates a backward direction, a lower side in the vertical direction indicates a downward direction, an upper side in the vertical direction indicates an upward direction, a right side when facing the toilet seat 7 indicates a right direction, and a left side when facing the toilet seat 7 indicates a left direction.

By the automatic paper supply unit 5 (or manually), the paper is placed on the pressing unit 4*a*. The exposure motor 9 rotates such that the wiping arm 4 moves on the rail unit 10 together with the upper-to-lower motor 8, and then, the pressing unit 4*a* is exposed after having moved toward a hole 7*a* of the toilet seat 7. When the pressing unit 4*a* is exposed, the upper-to-lower motor 8 rotates such that the wiping arm 4 swings upward to incline to the upward direction. This allows wiping of the moisture etc. on the buttocks with the paper. After wiping, the upper-to-lower motor 8 rotates such that the wiping arm 4 swings downward to incline to the downward direction. The paper naturally drops. Note that the mechanism of the wiping arm drive unit 3 as described herein can be used in the second technique of separately moving the paper and the wiping arm. The same applies to other embodiments below. That is, the mechanism of the wiping arm drive unit 3 used in the first technique and the mechanism of the wiping arm drive unit 3 used in the second technique can be used in either technique without noting in each case.

The pressing unit 4*a* is made of a material having a surface exhibiting a certain level of friction that the paper does not drop even upon movement of the wiping arm 4. Thus, when the wiping arm 4 is exposed, the pressing unit 4*a* can be, as described above, exposed through the hole 7*a* without holding or insertion of the paper. As long as dropping of the paper is avoided by friction, various materials of the pressing unit 4*a* are conceivable. For example, various materials including silicon resin, rubber, resin or metal having a non-slip surface, resin or metal having a textured surface, and the pressing unit 4*a* to which a non-slip tape is bonded are conceivable. The specific way to avoid dropping of the paper by friction is not intended to limit the present invention. The present invention is characterized in that the pressing unit 4*a* of the wiping arm 4 is, without the paper being held by the pressing unit 4*a*, exposed with the paper being placed on the pressing unit 4*a* upon movement of the wiping arm 4 by friction caused between the pressing unit 4*a* and the paper.

As illustrated in FIG. 1A and FIGS. 7 to 10 described later, the pressing unit 4*a* is in such a shape that a tip end thereof is raised. Such a shape also suppresses paper 11*a* from dropping upon movement of the wiping arm 4. Note that the shape of the pressing unit 4*a* for reducing dropping of the paper 11*a* is not limited to the example illustrated in the figures. The tip end of the pressing unit 4*a* is rounded such that the paper 11*a* contacts the front and back of the anus, and is in a curved shape along the front-to-back direction of the anus. However, the tip end is not limited to the example illustrated in the figures. In the present invention, the shape of the pressing unit 4*a* is designed not to drop paper. The present invention is characterized in that the shape of the pressing unit 4*a* prevents, without the paper being held by the pressing unit 4*a* of the wiping arm 4, dropping of the paper upon movement of the wiping arm 4 and allows exposure of the pressing unit 4*a* with the paper being placed on the pressing unit 4*a*.

Note that as described later, a disposable arm or a disposable pressing unit using a water-soluble material exhibiting water solubility, water degradability, etc. may be used for the pressing unit 4*a*. A structure in which a shaft is a rigid base material portion and a wiping portion is a water absorbing portion is conceivable as an example of the disposable arm. On this point, the same applies to other embodiments than the first embodiment.

Figure 1B:
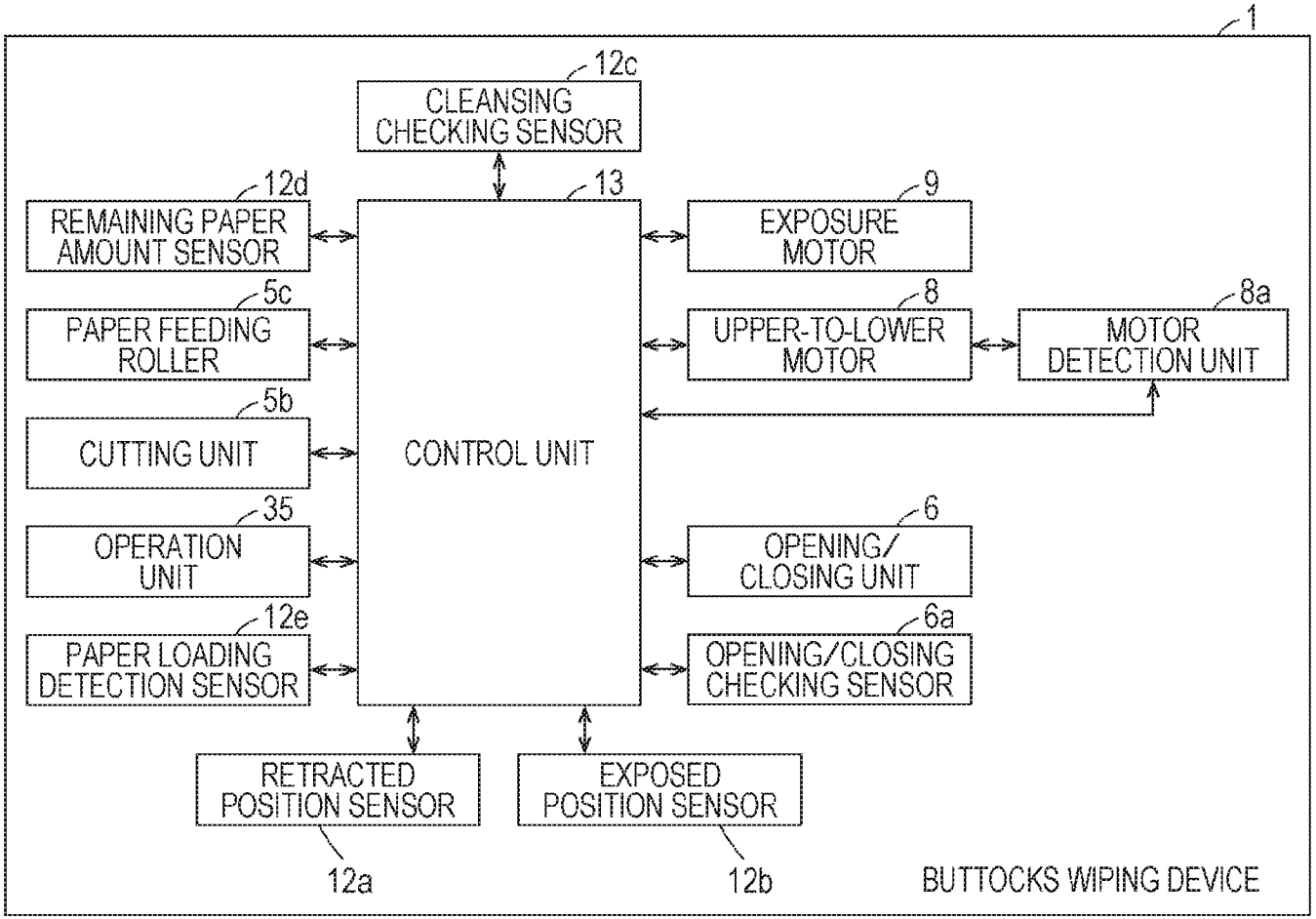
FIG. 1B is a functional block diagram of the buttocks wiping device 1.
Figure 1C:
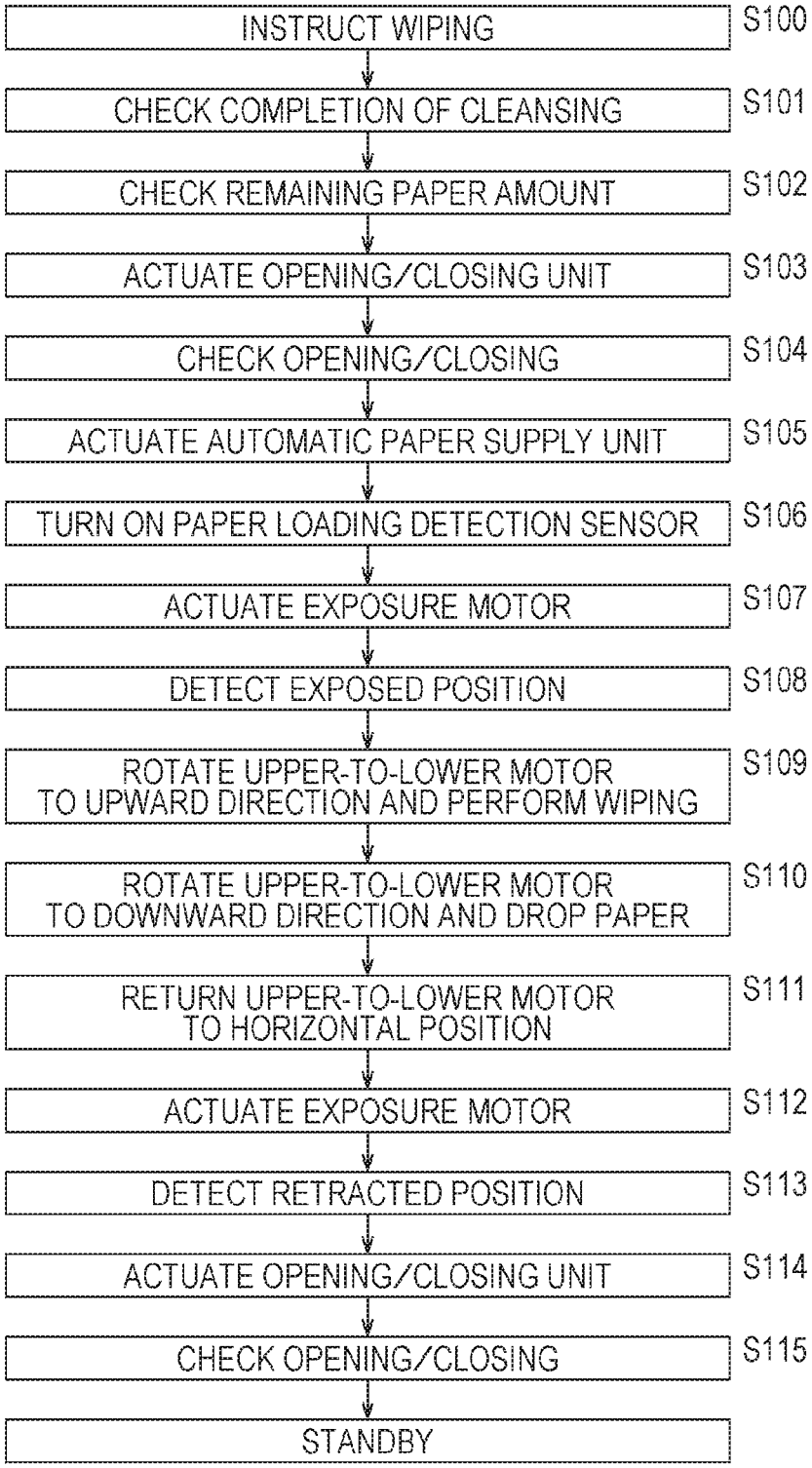
FIG. 1C is a flowchart of operation of the buttocks wiping device 1.
Figure 2:
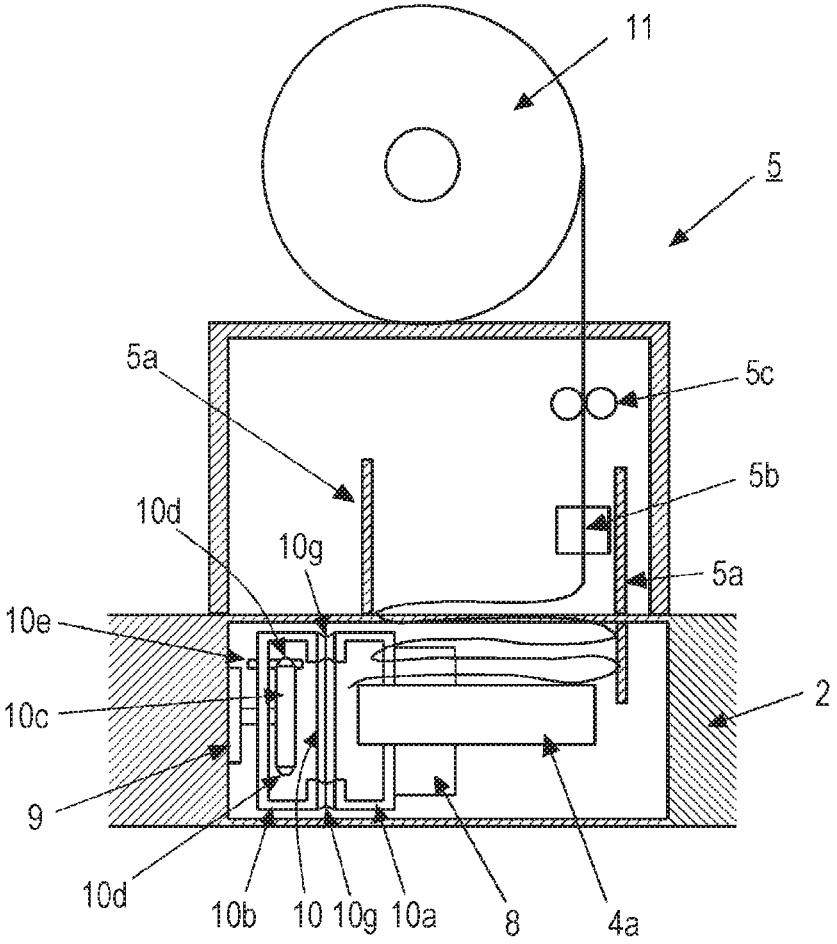
FIG. 2 is a left side view of an internal structure of the buttocks wiping device 1 from a side close to an opening/closing unit 6.
Figure 3:
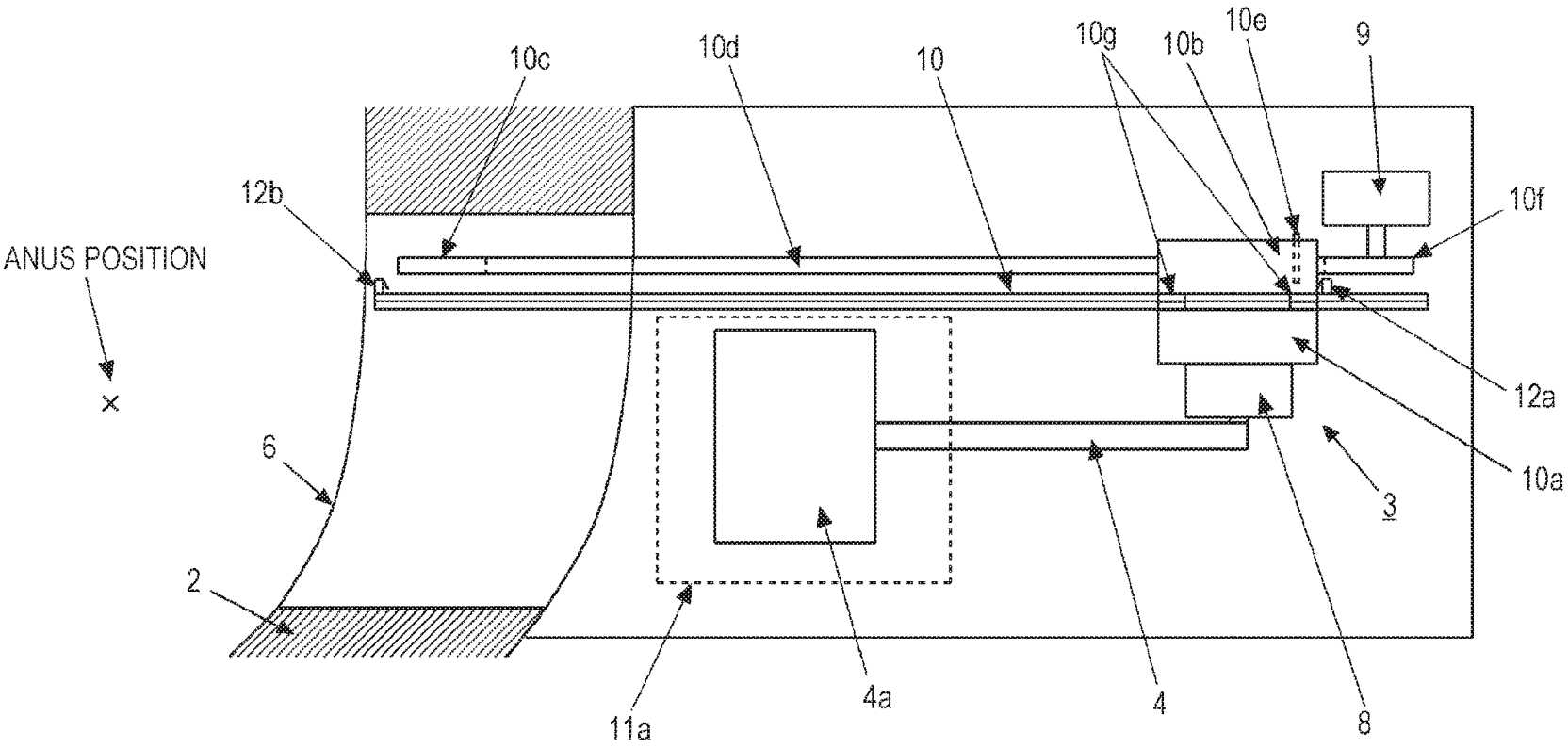
FIG. 3 is a plan view of the internal structure of the buttocks wiping device 1 when paper 11*a* is placed on a pressing unit 4*a;*
Figure 4:
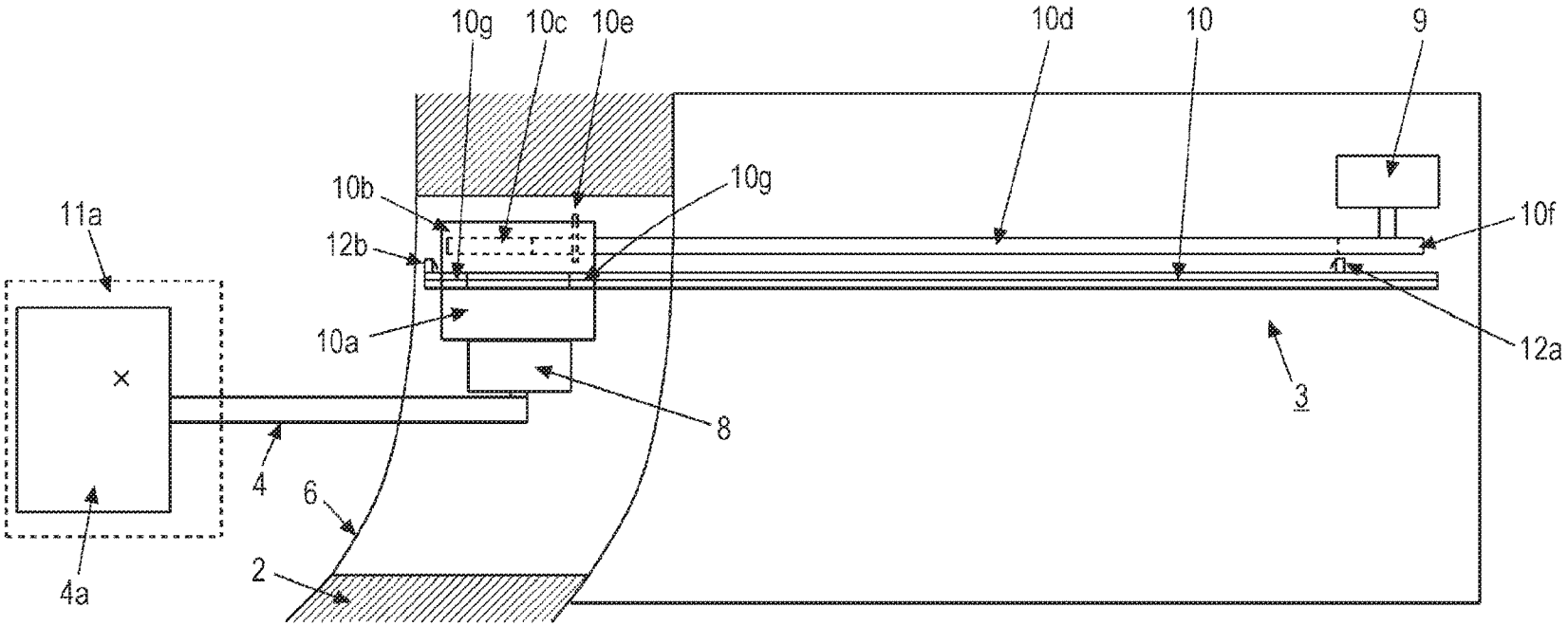
FIG. 4 is a plan view of the internal structure of the buttocks wiping device 1 when the paper 11*a* is exposed.
Figure 5:
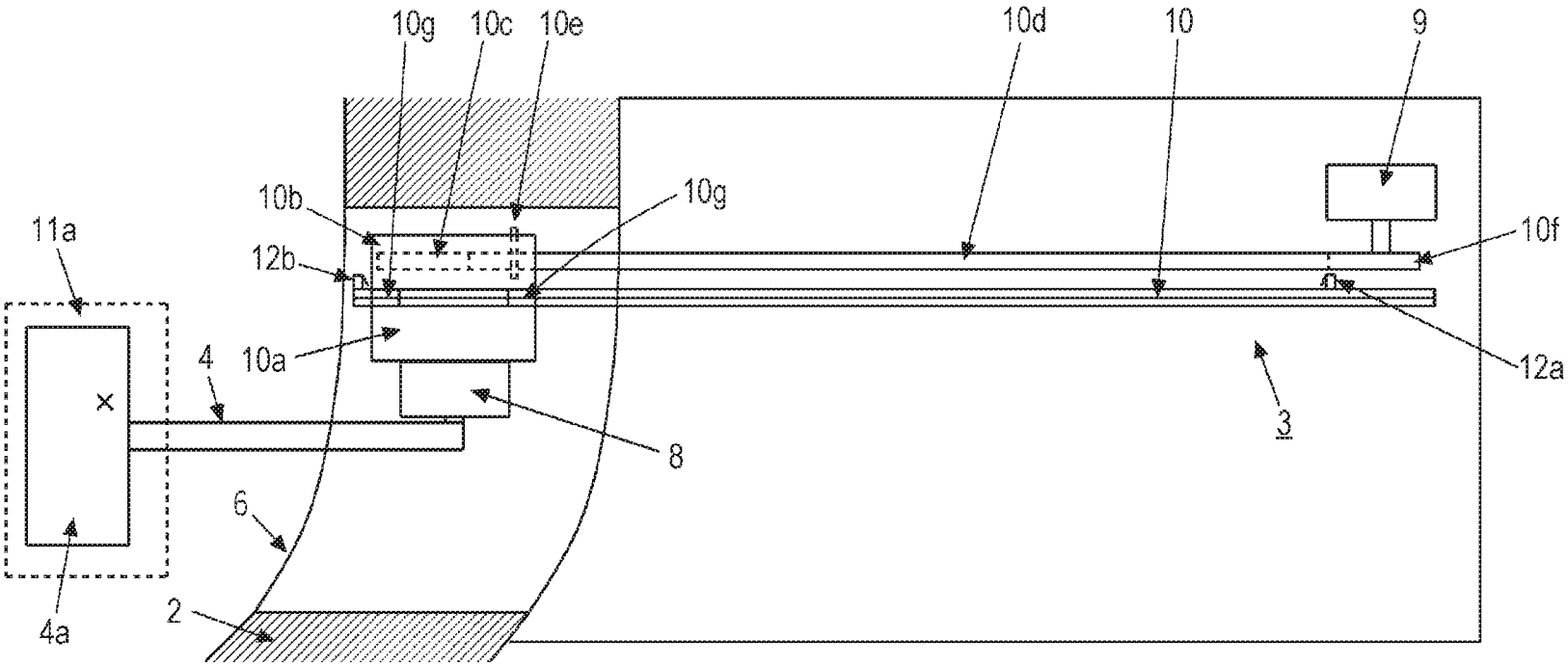
FIG. 5 is a plan view of the internal structure of the buttocks wiping device 1 when a wiping arm 4 inclines to the upward direction.
Figure 6:
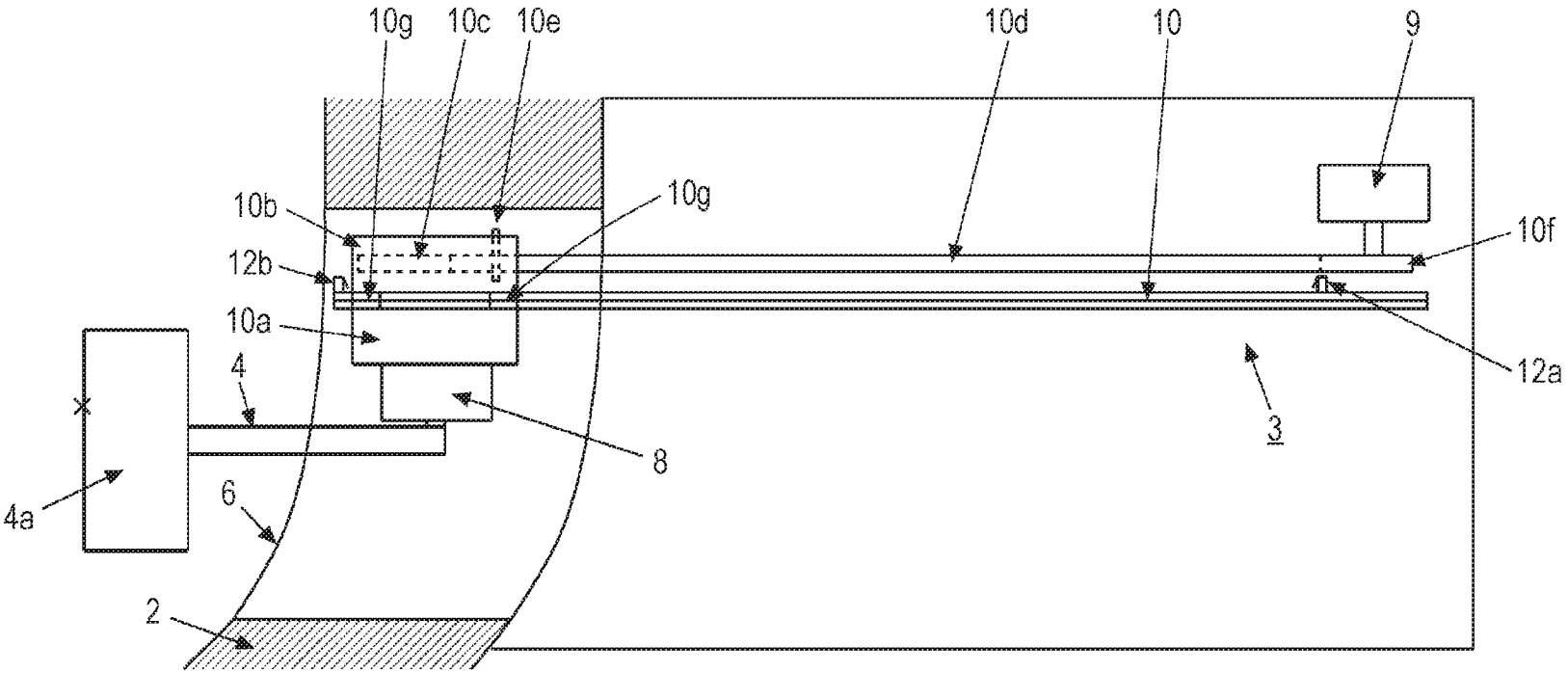
FIG. 6 is a plan view of the internal structure of the buttocks wiping device 1 when the wiping arm 4 inclines to the downward direction.
Figure 7:
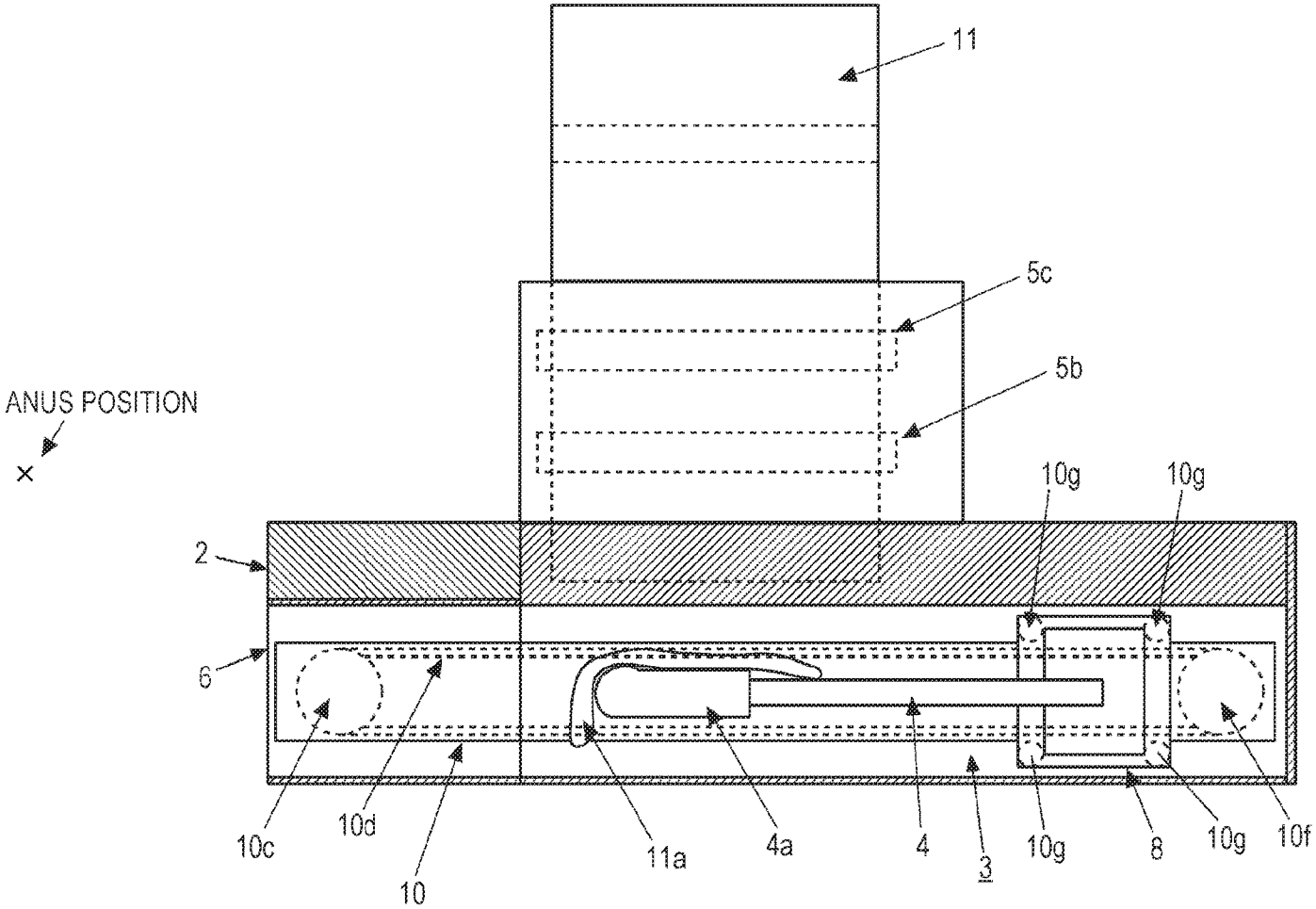
FIG. 7 is a front view of the internal structure of the buttocks wiping device 1 when the paper 11*a* is placed on the pressing unit 4*a;*
Figure 8:
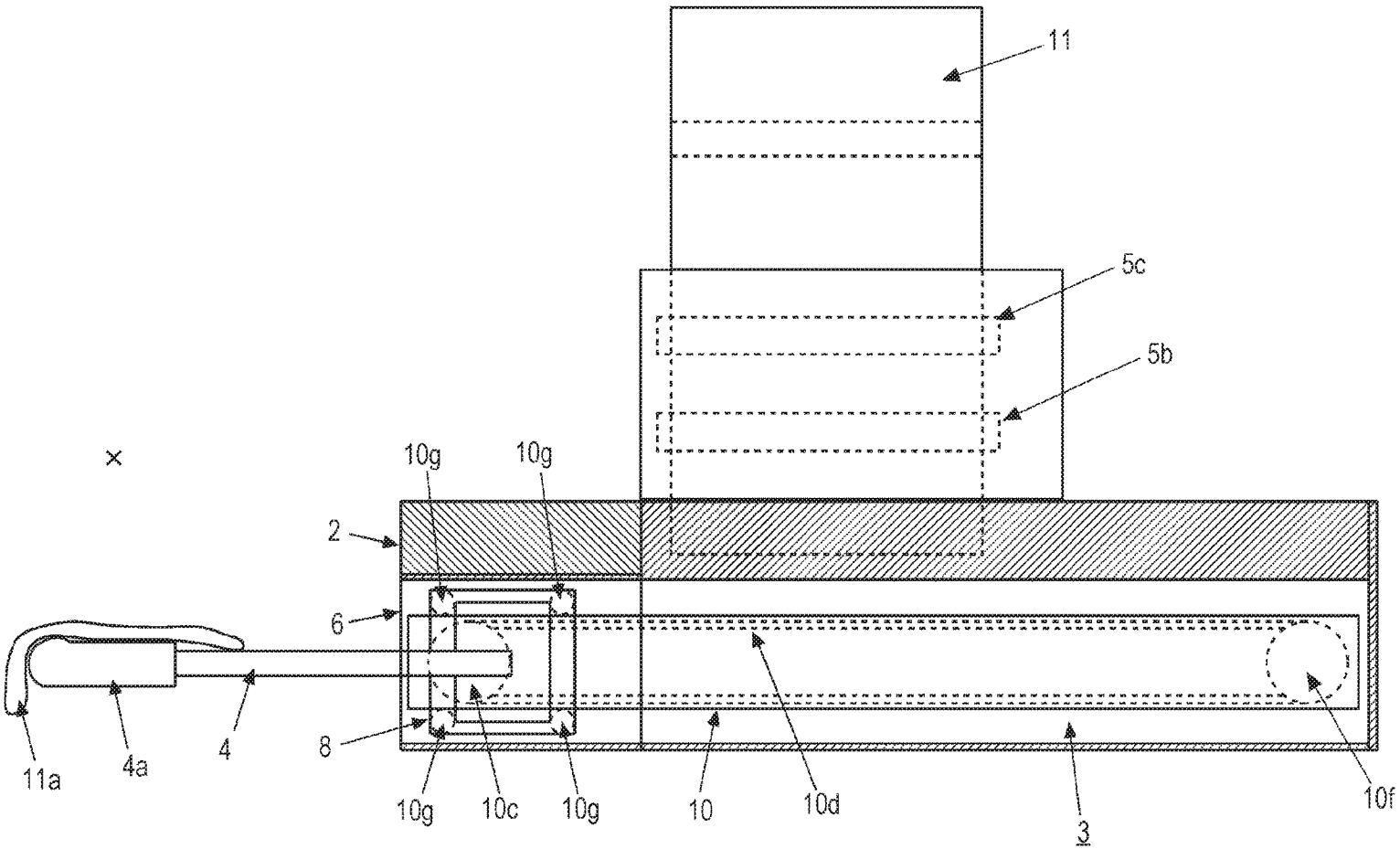
FIG. 8 is a front view of the internal structure of the buttocks wiping device 1 when the paper 11*a* is exposed.
Figure 9:
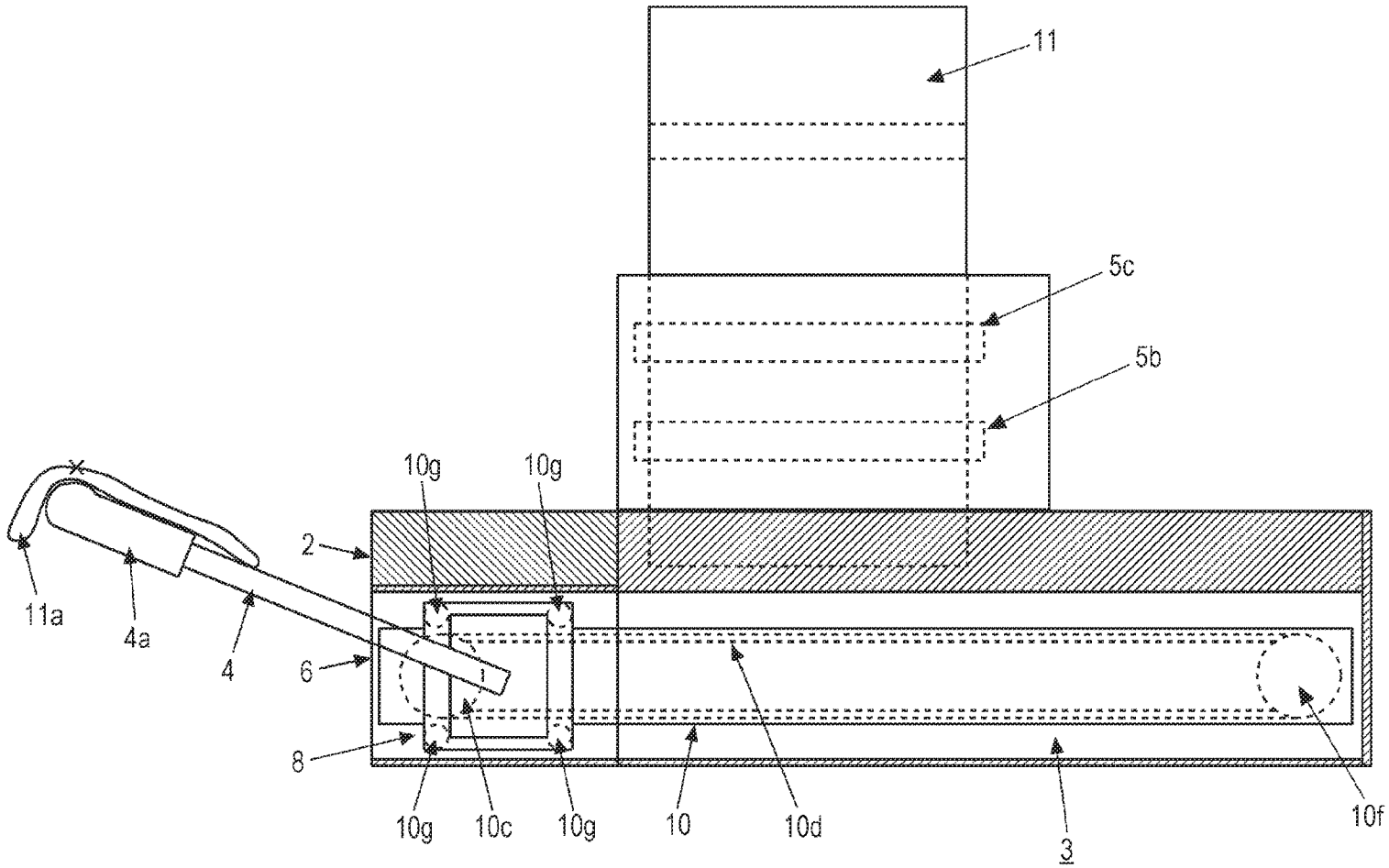
FIG. 9 is a front view of the internal structure of the buttocks wiping device 1 when the wiping arm 4 inclines to the upward direction.
Figure 10:
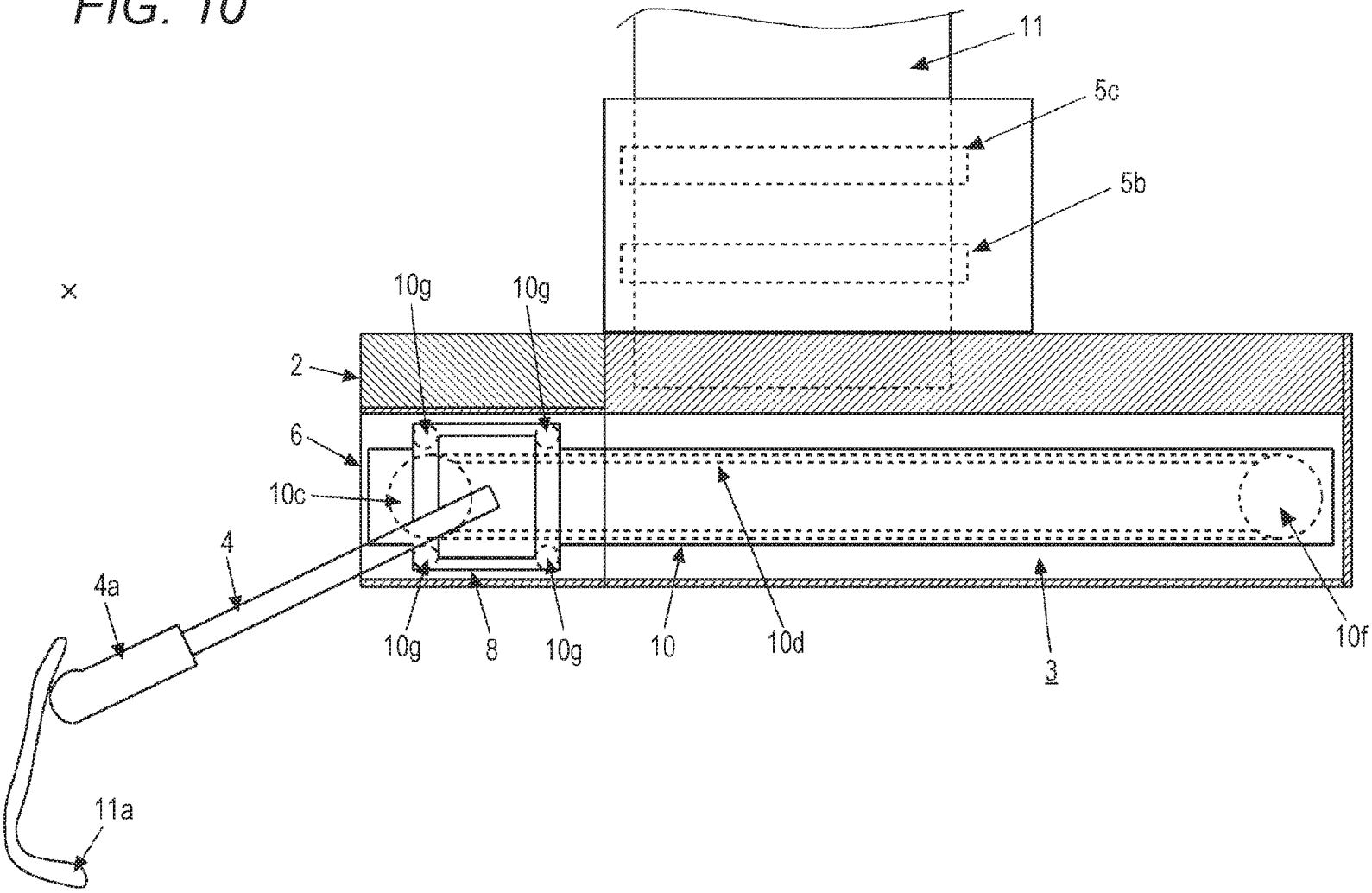
FIG. 10 is a front view of the internal structure of the buttocks wiping device 1 when the wiping arm 4 inclines to the downward direction.

Operation of the buttocks wiping device 1 of the first embodiment will be described below in detail with reference to FIGS. 1B, 1C, and 2 to 10. FIG. 1B is a functional block diagram of the buttocks wiping device 1. FIG. 1C is a flowchart of operation of the buttocks wiping device 1. FIG. 2 is a left side view of the internal structure of the buttocks wiping device 1 from the side close to the opening/closing unit 6. FIG. 3 is a plan view of the internal structure of the buttocks wiping device 1 when the paper 11*a* is placed on the pressing unit 4*a*. FIG. 4 is a plan view of the internal structure of the buttocks wiping device 1 when the paper 11*a* is exposed. FIG. 5 is a plan view of the internal structure of the buttocks wiping device 1 when the wiping arm 4 inclines to the upward direction. FIG. 6 is a plan view of the internal structure of the buttocks wiping device 1 when the wiping arm 4 inclines to the downward direction. FIG. 7 is a front view of the internal structure of the buttocks wiping device 1 when the paper 11*a* is placed on the pressing unit 4*a*. FIG. 8 is a front view of the internal structure of the buttocks wiping device 1 when the paper 11*a* is exposed. FIG. 9 is a front view of the internal structure of the buttocks wiping device 1 when the wiping arm 4 inclines to the upward direction. FIG. 10 is a front view of the internal structure of the buttocks wiping device 1 when the wiping arm 4 inclines to the downward direction.

As illustrated in FIG. 1B, the buttocks wiping device 1 includes a control unit 13 configured to control entire operation. The buttocks wiping device 1 includes a cleansing checking sensor 12*c* configured to detect whether or not cleansing has been completed by the warm-water cleansing device 15, and a remaining paper amount sensor 12*d* configured to detect the remaining amount of the toilet paper 11 at the paper supply unit 5. The cleansing checking sensor 12*c* can be implemented by, e.g., a contact sensor configured to detect whether or not a nozzle of the warm-water cleansing device 15 has been exposed, a sound sensor configured to detect cleansing sound, a color identification sensor configured to detect remaining feces in the vicinity of the anus, or a detection unit configured to detect whether or not a cleansing button and an end button of the warm-water cleansing device 15 have been pressed. However, the cleansing checking sensor 12*c* is not intended to limit the present invention. The remaining paper amount sensor 12*d* can be implemented by, e.g., an optical sensor or an ultrasonic sensor configured to detect the thickness of the roll of the toilet paper 11 or a color identification sensor configured to detect remaining toilet paper 11. However, the remaining paper amount sensor 12*d* is not intended to limit the present invention. Note that in the case of manually placing the paper on the pressing unit 4*a*, the automatic paper supply unit 5 is not necessary, and therefore, the remaining paper amount sensor 12*d* is also not necessary.

The buttocks wiping device 1 includes a paper loading detection sensor 12*e* configured to detect whether or not the paper is placed on the pressing unit 4*a*. The paper loading detection sensor 12*e* can be implemented by, e.g., an optical sensor or a color identification sensor configured to determine the presence or absence of paper, and is typically attached to the pressing unit 4*a*. However, the paper loading detection sensor 12*e* may be other sensors as long as the paper loading detection sensor 12*e* can detect the presence or absence of paper placed on the pressing unit 4*a*, and is not intended to limit the present invention.

As illustrated in FIGS. 1B and 3, the buttocks wiping device 1 includes a retracted position sensor 12*a* configured to detect whether or not the wiping arm 4 is at a retracted position, and an exposed position sensor 12*b* configured to detect whether or not the wiping arm 4 is at an exposed position. FIG. 3 illustrates the image of using a limit switch. However, the retracted position sensor 12*a* and the exposed position sensor 12*b* can be implemented by various other sensors such as a contact switch, a magnetic sensor, and an optical sensor, and are not intended to limit the present invention.

As illustrated in FIGS. 2, 3, and 7, the structure is made such that the plate-shaped rail 10 is sandwiched by four pulleys 10*g* on the upper and lower sides and that seats 10*a*, 10*b* are slidable on the rail 10. The upper-to-lower motor 8 is fixed to the seat 10*a*. One end of the wiping arm 4 is fixed to a rotary shaft of the upper-to-lower motor 8. The wiping arm 4 has the pressing unit 4*a*, and the paper 11*a* is placed on the pressing unit 4*a*. A pulley 10*f* is attached to a rotary shaft of the exposure motor 9. A pulley 10*c* is, in the raised portion 2, rotatably fixed using a not-shown bearing. A belt 10*d* is wrapped around the pulley 10*c* and the pulley 10*f*. Using a coupling tool 10*e*, the seat 10*b* is coupled to the belt 10*d*. With such a structure, the pulley 10*f* rotates upon rotation of the exposure motor 9, and accordingly, the belt 10*d* rotates. Then, the seat 10*b* and the seat 10*a* slide on the rail 10 together with the belt 10*d*. Note that various structures for sliding the wiping arm 4 are conceivable. The example described herein is merely an example, and is intended to limit the present invention.

As illustrated in FIGS. 2 and 7, the automatic paper supply unit 5 includes paper feeding rollers 5*c* and a cutting unit 5*b*. The paper feeding rollers 5*c* are configured to rotate by rotation of a not-shown motor to feed the toilet paper 11 toward the cutting unit 5*b* with the toilet paper 11 being pinched by the paper feeding rollers 5*c*. The cutting unit 5*b* is configured to cut the toilet paper 11 with the toilet paper 11 being pinched by blades. For driving the blades, a swing-type electromagnetic solenoid may be utilized to swing the blades, and in this manner, the toilet paper 11 may be cut. Such a mechanism is well known, and will not be described in detail. However, any well-known cutting mechanisms can be utilized. The toilet paper 11 is hung down between folding guides 5*a*, and therefore, is naturally folded and placed on the pressing unit 4*a*. After the paper feeding rollers 5*c* have delivered a predetermined amount of toilet paper 11, the cutting unit 5*b* cuts the toilet paper 11. With this structure, the cut paper 10*a* is placed on the pressing unit 4*a* as illustrated in FIG. 7.

As illustrated in FIG. 1B, the buttocks wiping device 1 has an opening/closing checking sensor 6*a* configured to detect an opened/closed state of the opening/closing unit 6. The opening/closing checking sensor 6*a* can be implemented by various sensors such as a contact switch and a magnetic sensor, but is not intended to limit the present invention. Moreover, the opening/closing checking sensor 6*a* is not an essential component.

Operation of the buttocks wiping device 1 will be described below with reference to a correspondence between the flowchart shown in FIG. 1C and each figure. Suppose that the user first uses an operation unit 35 to instruct wiping (S100). The control unit 13 checks, using the cleansing checking sensor 12*c*, whether or not cleansing by the warm-water cleansing device 15 has been completed (S101). In a case where cleansing has not been completed yet, the control unit 13 prompts, by sound, a displayed message, etc., the user to complete cleansing without proceeding to subsequent operation. In a case where cleansing has been completed, the control unit 13 proceeds to operation of S102. Note that during execution of wiping, control may be made such that a power supply to the warm-water cleansing device 15 is blocked not to actuate the warm-water cleansing device 15 or that a warm-water cleansing instruction cannot be made after a wiping instruction in a case where the buttocks wiping device 1 and the warm-water cleansing device 15 cooperate with each other.

At S102, the control unit 13 checks, using the remaining paper amount sensor 12*d*, whether or not the paper is run out. In a case where the paper is run out, the control unit 13 prompts, by sound, a displayed message, etc., the user to refill the toilet paper 11 without proceeding to subsequent operation. In a case where the paper is not run out, the control unit 13 proceeds to operation of S103.

At S103, the control unit 13 controls the opening/closing unit 6 to open the opening of the raised portion 2.

Subsequently, the control unit 13 checks, based on a signal from the opening/closing checking sensor 6*a*, whether or not the opening is normally opened (S104). When the opening is not normally opened, the control unit 13 re-controls the opening/closing unit 6 to attempt opening/closing of the opening. In a case where the opening is not still opened, the control unit 13 uses, without proceeding to subsequent operation, sound, a displayed message, etc. to notify the user that an abnormality is caused. In a case where the opening is normally opened, the control unit 13 proceeds to operation of S105. Note that in the case of using a simple hinge-type opening/closing unit, no such control is made.

At S105, the control unit 13 actuates the automatic paper supply unit 5 to deliver the toilet paper 11 by the paper feeding rollers 5*c* as illustrated in FIG. 2. After a predetermined length of toilet paper 11 has been fed, such toilet paper 11 is cut by the cutting unit 5*b*. With this structure, the toilet paper 11 is placed on the pressing unit 4*a*. Note that the automatic paper supply unit 5 has a device configured to press down the paper 11*a* placed on the pressing unit 4*a*, and therefore, unfolding of the folded paper 11*a* is prevented. FIGS. 3 and 7 illustrate a state when the paper 11*a* is placed on the pressing unit 4*a*. Note that in these figures, the paper 10*a* is illustrated as a piece of thick paper for the sake of simplicity of illustration. Note that in a case where the toilet paper 11 is originally thick paper, a piece of sheet-shaped paper 11*a* is used for wiping without folding. Moreover, a piece of special paper may be automatically or manually placed on the pressing unit 4*a*.

Subsequently, the control unit 13 turns on the paper loading detection sensor 12*e*, thereby transitioning to the mode for constantly detecting whether or not the paper 11*a* is normally placed on the pressing unit 4*a* (S106). Such a mode is continued until dropping of the paper 11*a* (S110). If the paper is accidentally dropped during the mode, the control unit 13 stops wiping operation, and drives the wiping arm drive unit 3 such that the wiping arm 4 returns to the retracted position.

At S107, the control unit 13 actuates the exposure motor 9 to expose the wiping arm 4 through the hole 7*a* (S107). FIGS. 4 and 8 are views of a state when the pressing unit 4*a* is exposed through the hole 7*a* of the toilet seat 7. Based on a signal from the exposed position sensor 12*b*, the control unit 13 determines whether or not the wiping arm 4 has reached the exposed position. When reached, actuation of the exposure motor 9 is stopped (S108).

After exposure, the control unit 13 rotates the upper-to-lower motor 8 to incline the wiping arm 4 to the upward direction (S109). FIGS. 5 and 9 are views of a state when the wiping arm 4 inclines to the upward direction. In this state, a motor detection unit 8*a* is placed so that rotation of the upper-to-lower motor 8 can be detected, and detects the number of rotations, a rotation angle, a torque, etc. to transmit the detected signal to the control unit 13.

The motor detection unit 8*a* is a device configured to detect the number of rotations of the motor, the motor rotation angle, the motor torque, etc. The motor detection unit 8*a* can be implemented by a shunt resistor, a potentiometer, a tacho generator, a resolver, a rotary encoder, a hall element, etc., but the present invention is not limited to above.

For example, a variable resistor may be, as a simple structure, used as the motor detection unit 8*a* such that rotation of the rotary shaft of the upper-to-lower motor 8 is transmitted to a rotary shaft of the variable resistor. With a resistance value of the variable resistor, the control unit 13 can detect the rotation angle or the number of rotations, thereby detecting the inclination angle of the wiping arm 4.

For detecting the push-up strength of the pressing unit 4*a*, the shunt resistor may be, as a simple structure, connected in series with the motor, and the value of current flowing through a circuit may be, using a voltage value of the shunt resistor, detected for detection of the motor torque. In this manner, the control unit 13 can control the push-up strength of the upper-to-lower motor 8. Alternatively, a pressure sensor as the motor detection unit 8*a* may be provided at the pressing unit 4*a* to measure a pressure on the buttocks, and in this manner, the motor torque may be recognized. The wiping arm drive unit 3 performs such torque control (or torque limitation) for the motor for driving the wiping arm 4, and in this manner, controls the pressing unit 4*a* not to contact the buttocks with equal to or higher than a predetermined force. The torque control described herein indicates that the torque generated at the motor reaches a predetermined value, and the torque limitation described herein indicates that a predetermined torque or higher is not generated at the motor. When a servomotor is used as the motor, the torque control or the torque limitation can be performed after torque information feedback. When the servomotor is not used as the motor, the value of current flowing through the motor may be, as described above, detected for detection of the torque generated at the motor. A detection result may be fed back to the control unit 13, and then, the control unit 13 may control rotation of the motor.

Note that a servomotor including a built-in encoder can be used as the motor disclosed in the present specification, but it is only a difference in whether or not the encoder is embedded. A functional block similar to that of FIG. 1B is applied (the same applies to all of other embodiments).

Based on a signal from the motor detection unit 8*a*, the control unit 13 controls rotation of the upper-to-lower motor 8 to cause the pressing unit 4*a* of the wiping arm 4 to contact the buttocks with a desired strength at a desired speed. In this manner, wiping of the moisture etc. is executed. In this state, the upper-to-lower motor 8 may perform slight forward-reverse repeat rotation to attach the paper 11*a* to the anus and detach the paper 11*a* from the anus, thereby wiping the moisture etc. Determination on whether or not wiping has been completed is typically made based on a time for which the pressing unit 4*a* contacts the buttocks. For example, after the pressing unit 4*a* has contacted the buttocks for 10 seconds, such a state is taken as completion of wiping, and the control unit 13 proceeds to subsequent operation S110. Note that determination on whether or not wiping has been completed is not limited to above, and various methods such as a method in which a color identification sensor is used to determine whether or not the moisture etc. are actually removed may be employed.

Upon completion of wiping, the control unit 13 rotates the upper-to-lower motor 8 to incline the wiping arm 4 to the downward direction (S110). FIGS. 6 and 10 are views of a state when the wiping arm 4 inclines to the downward direction. In this state, the control unit 13 controls, based on the signal from the motor detection unit 8*a*, rotation of the upper-to-lower motor 8, thereby downwardly inclining the wiping arm 4 to a predetermined angle. The paper 11*a* is naturally dropped by its own weight. Note that it is also assumed that the paper 11*a* does not naturally drop because there is friction of the pressing unit 4*a* and the paper 11*a* has absorbed the moisture. For this reason, the control unit 13 may perform forward-reverse repeat rotation of the upper-to-lower motor 8 and/or the exposure motor 9, thereby slightly vibrating the wiping arm 4 to shake off the paper 11*a*. Alternatively, a protrusion configured to protrude upon retraction may be provided at the opening of the raised portion 2. The protrusion may protrude upon retraction of the wiping arm 4 to contact the paper 11*a*, thereby dropping the paper 11*a* from the pressing unit 4*a*. Note that the protrusion is retracted upon wiping. When the paper loading detection sensor 12*e* detects that the paper 11*a* is not placed on the pressing unit 4*a*, the control unit 13 proceeds to subsequent operation S111.

At S111, the control unit 13 actuates the upper-to-lower motor 8, thereby returning the wiping arm 4 to a horizontal position. Thereafter, the control unit 13 actuates the exposure motor 9 to retract the wiping arm 4 into the raised portion 2 (S112). When the retracted position sensor 12*a* detects retraction of the wiping arm 4 to the retracted position (S113), the control unit 13 actuates the opening/closing unit 6 to close the opening of the raised portion 2 (S114). When the opening/closing checking sensor 6*a* confirms that the opening is normally closed (S115), the control unit 13 is brought into a standby state, and waits for a subsequent wiping instruction. When it is, at S115, detected that the opening is not normally closed, the control unit 13 uses sound, a displayed message, etc. to notify the user that an abnormality is caused. Note that in a case where the opening/closing unit 6 is the simple hinge-type opening/closing unit, operation of S114, S115 is not necessary.

As described above, according to the first embodiment, the pressing unit 4*a* of the wiping arm 4 is, as in the first technique described in the beginning, movable without the paper 11*a* being held by the pressing unit 4*a* and with the paper 11*a* being placed on the pressing unit 4*a* through use of friction of the pressing unit 4*a*. Moreover, the tip end of the pressing unit 4*a* is in the curved shape raised along the shape of the buttocks. Thus, the paper 11*a* is less dropped, and the pressing unit 4*a* is movable with the paper 11*a* being placed on the pressing unit 4*a*. As described above, the wiping arm 4 has the mechanism configured not to hold the paper 11*a*, and therefore, the structure of the wiping arm drive unit 3 can be simplified. Specifically, in the first embodiment, the wiping arm 4 may be merely exposed by the exposure motor 9, and may be merely moved up and down by the upper-to-lower motor 8. Since the wiping arm drive unit 3 with the simple structure can be used, part of the mechanism, i.e., the pulley 1*c*, the rail 10, and the belt 10*d* in this embodiment, can be housed in the raised portion as in the third technique described in the beginning. This can avoid, as much as possible, consumption of a space at the side of the toilet bowl, and the size of the buttocks wiping device 1 can be reduced.

Note that the raised portion 2 and the toilet seat 7 are provided as separate members. However, for integration of the raised portion 2 and the toilet seat 7, the thickness of the toilet seat 7 may be increased to provide, at the toilet seat 7, a cavity in which the wiping arm 4 and the wiping arm drive unit 3 can be partially housed, and an opening of the toilet seat 7 may be opened/closed by the opening/closing unit 6. With this structure, part of the mechanism of the wiping arm drive unit 3 can be provided inside the thick toilet seat. The same applies not only to the first embodiment, but also to all of the embodiments described below.

Second Embodiment

Figure 11A:
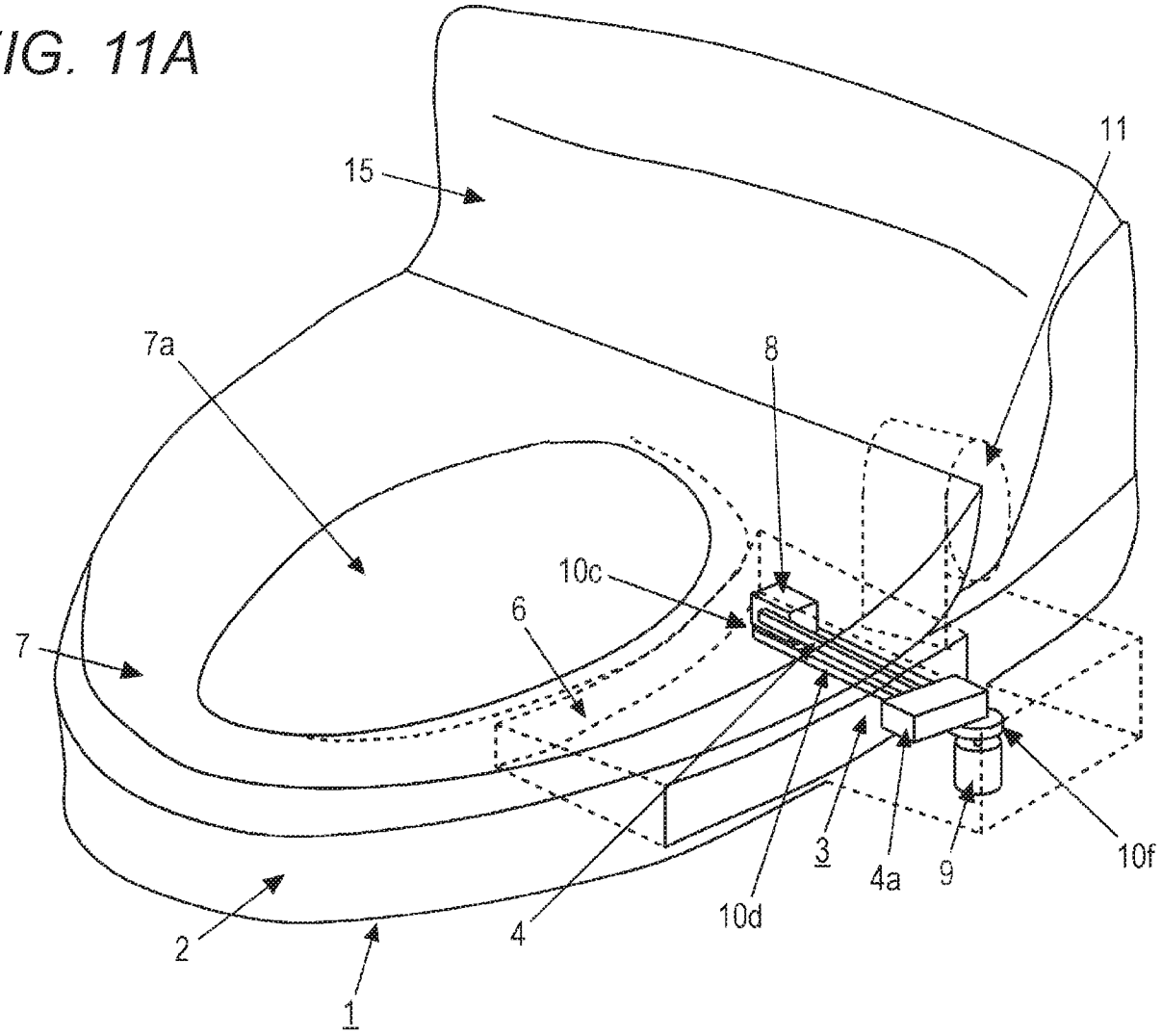
FIG. 11A is a perspective view of an outline structure of an outer appearance of a buttocks wiping device 1 of a second embodiment of the present invention.

FIG. 11A is a perspective view of an outline structure of an outer appearance of a buttocks wiping device 1 of a second embodiment of the present invention. For the sake of clarifying an internal structure, the internal structure is seen through the buttocks wiping device 1 in FIG. 11A. In FIG. 11A, the buttocks wiping device 1 includes a raised portion 2, a wiping arm drive unit 3, a wiping arm 4, and an opening/closing unit 6. The wiping arm drive unit 3 includes an upper-to-lower motor 8, an exposure motor 9, a belt 10*d*, and pulleys 10*c*. 10*f*. In the second embodiment, description will be made supposing that paper 11*a* is manually placed on a pressing unit 4*a*, but a variation can be made such that the paper 11*a* is automatically placed on the pressing unit 4*a* as in FIG. 17 described later.

In the figures, the pressing unit 4*a* is in a quadrangular prism shape. However, as in the first embodiment, the pressing unit 4*a* has a curved shape along the shape of the buttocks in the vicinity of the anus, and is made of a material having a surface exhibiting a certain level of friction that the paper does not drop even upon movement of the wiping arm 4. Note that the pressing unit 4*a* may have a recessed-raised shape, and may have such a shape that the paper 11*a* is less dropped upon movement of the wiping arm 4.

Figure 11B:
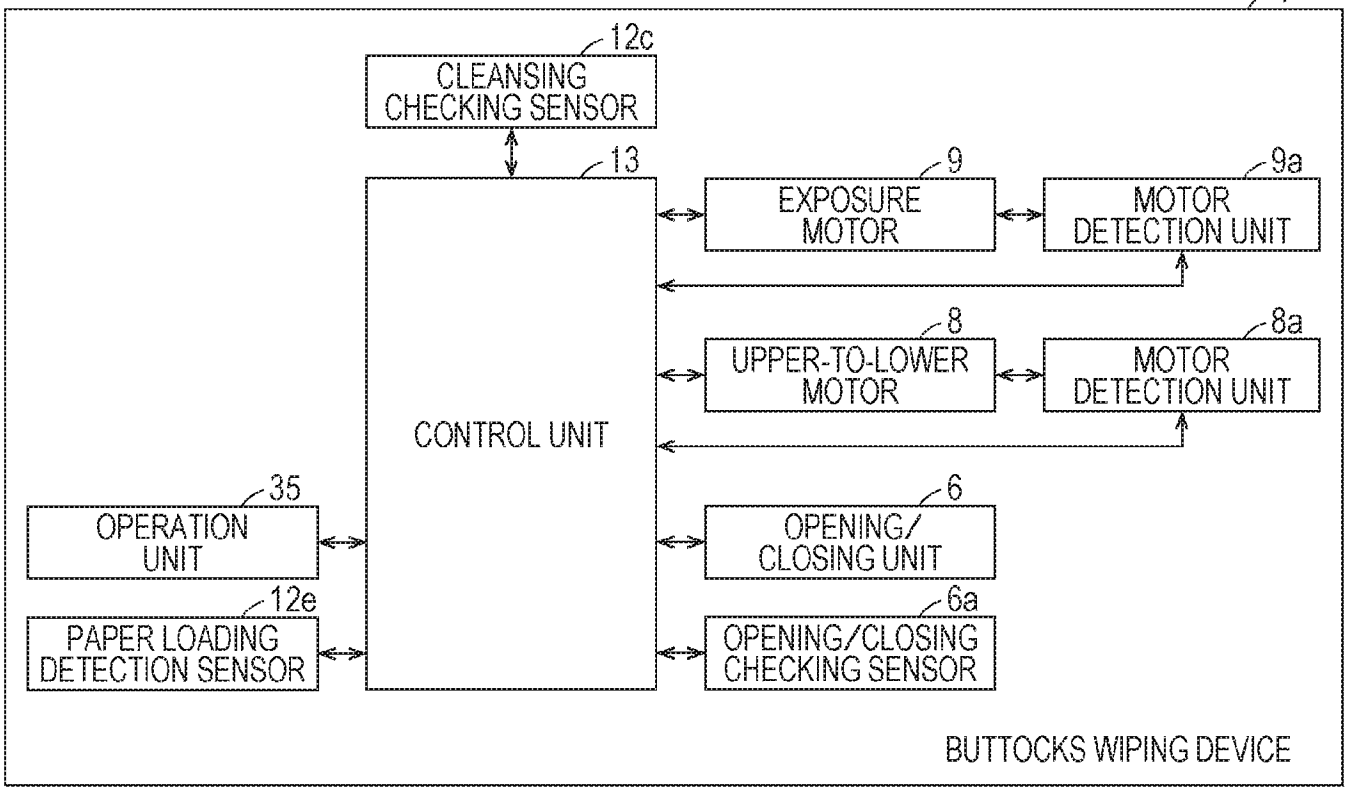
FIG. 11B is a functional block diagram of the buttocks wiping device 1.
Figure 11C:
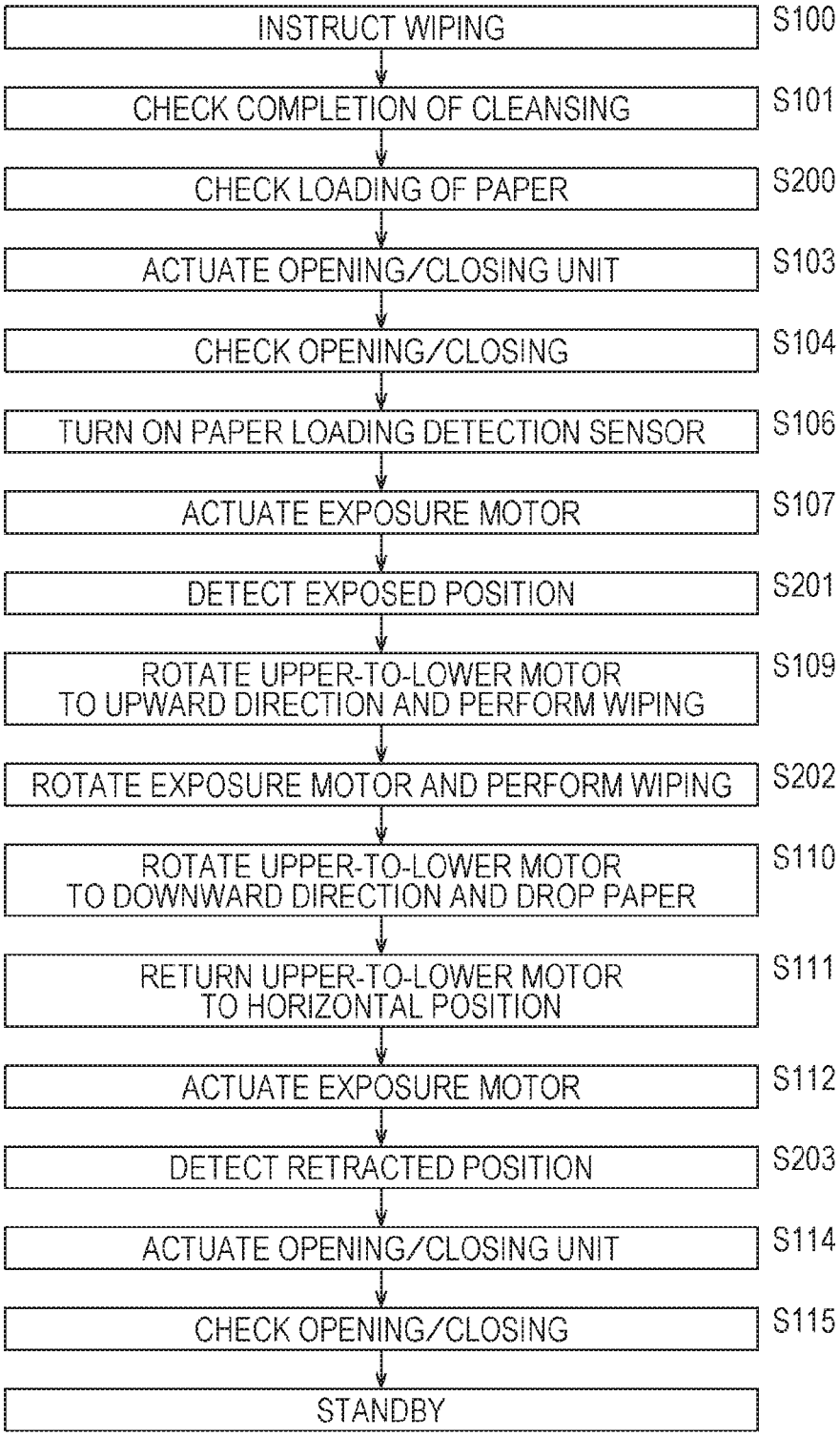
FIG. 11C is a flowchart of operation of the buttocks wiping device 1.
Figure 12:
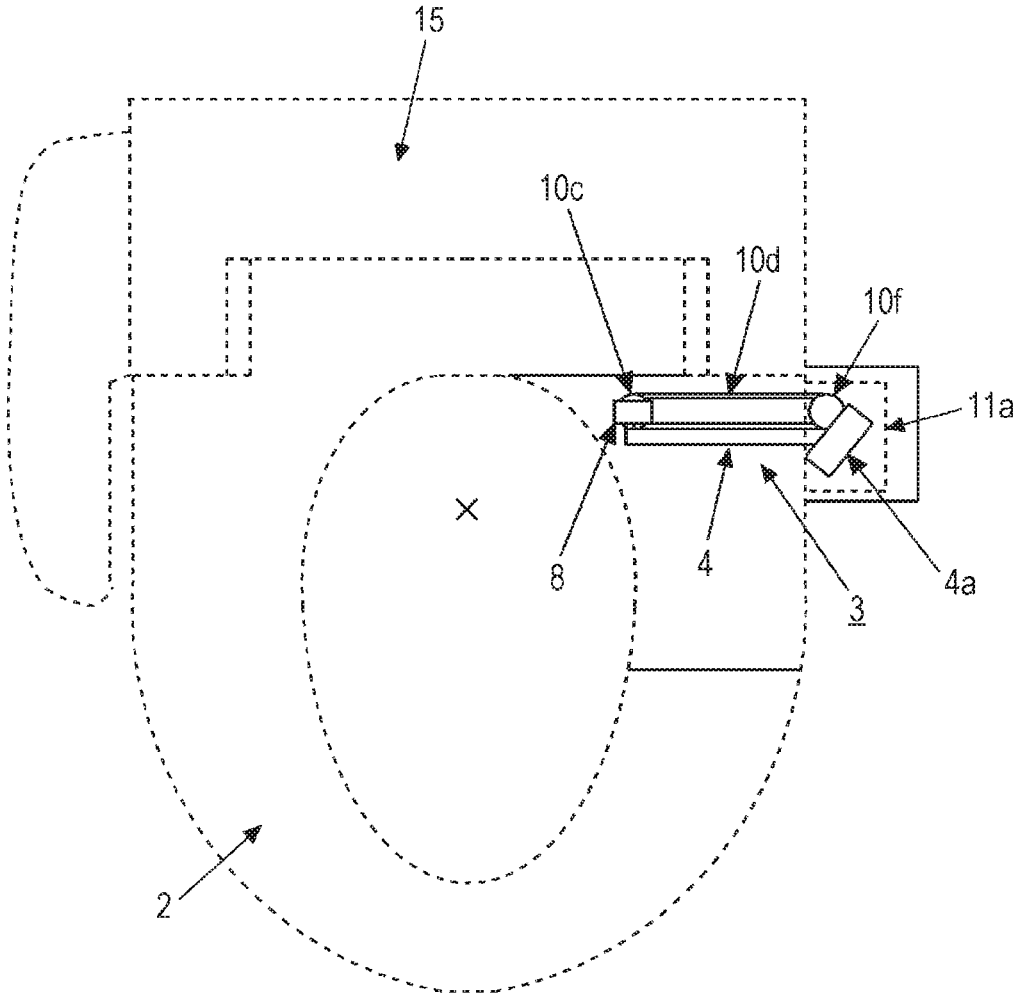
FIG. 12 is a plan view of an internal structure of the buttocks wiping device 1 when paper 11*a* is placed on a pressing unit 4*a;*
Figure 13:
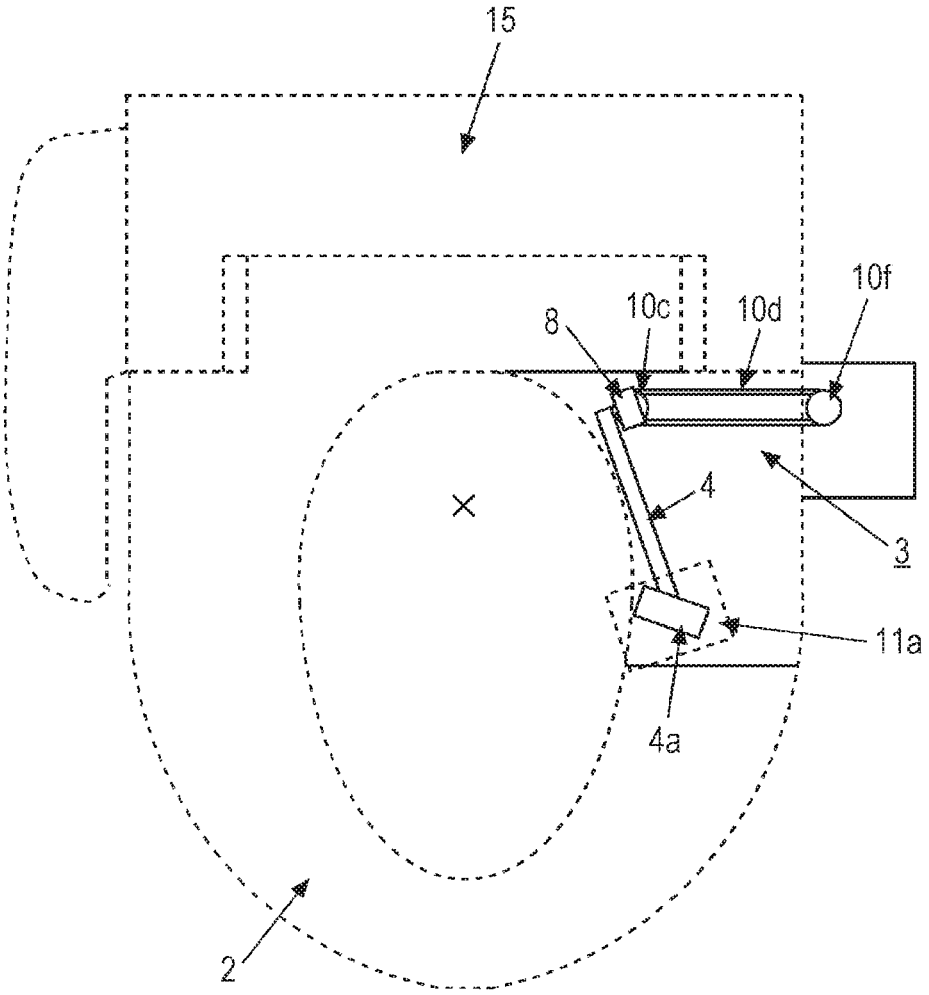
FIG. 13 is a plan view of a state in the course of exposing a wiping arm 4.
Figure 14:
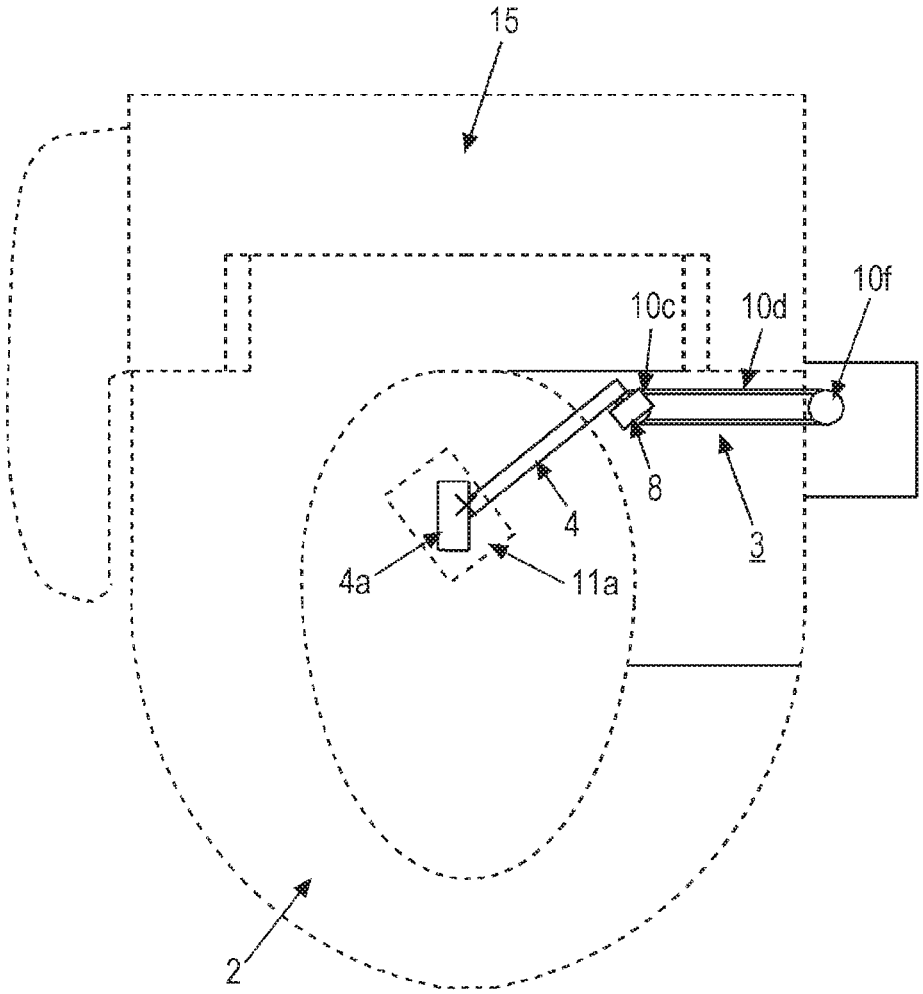
FIG. 14 is a plan view of a state when the wiping arm is exposed at a wiping position.
Figure 15:
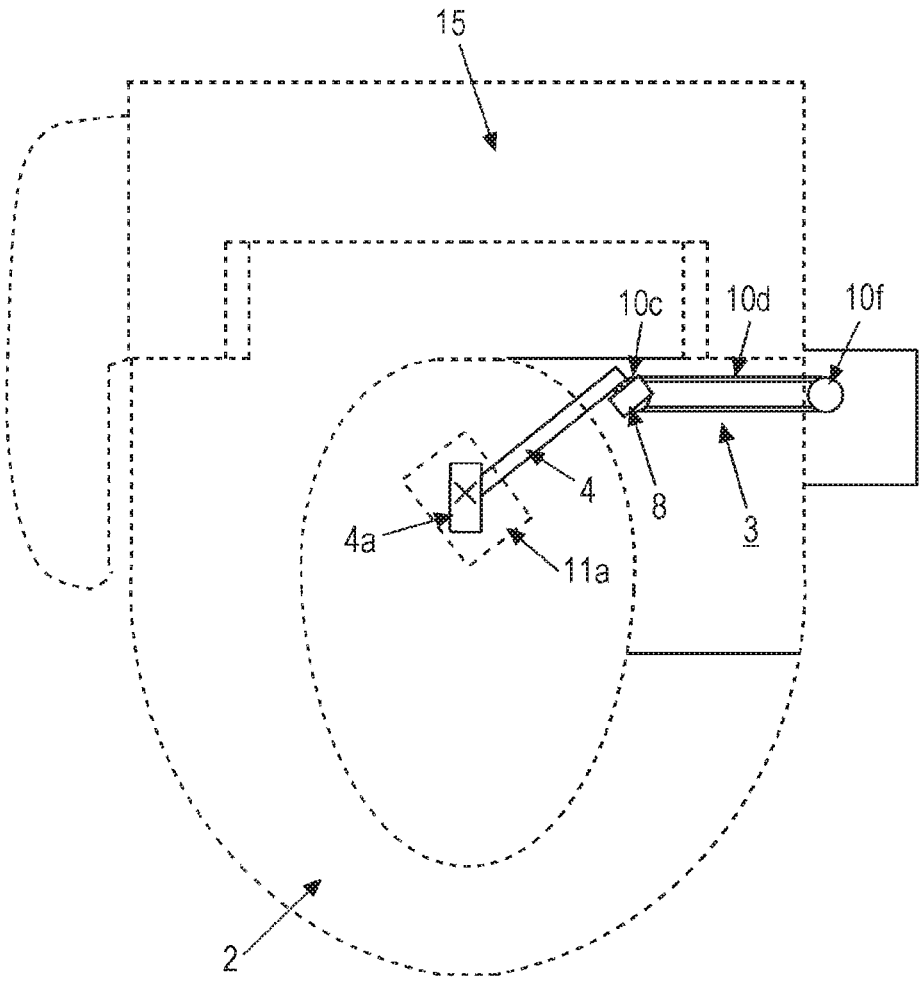
FIG. 15 is a plan view of a state when the wiping arm inclines to the upward direction.
Figure 16:
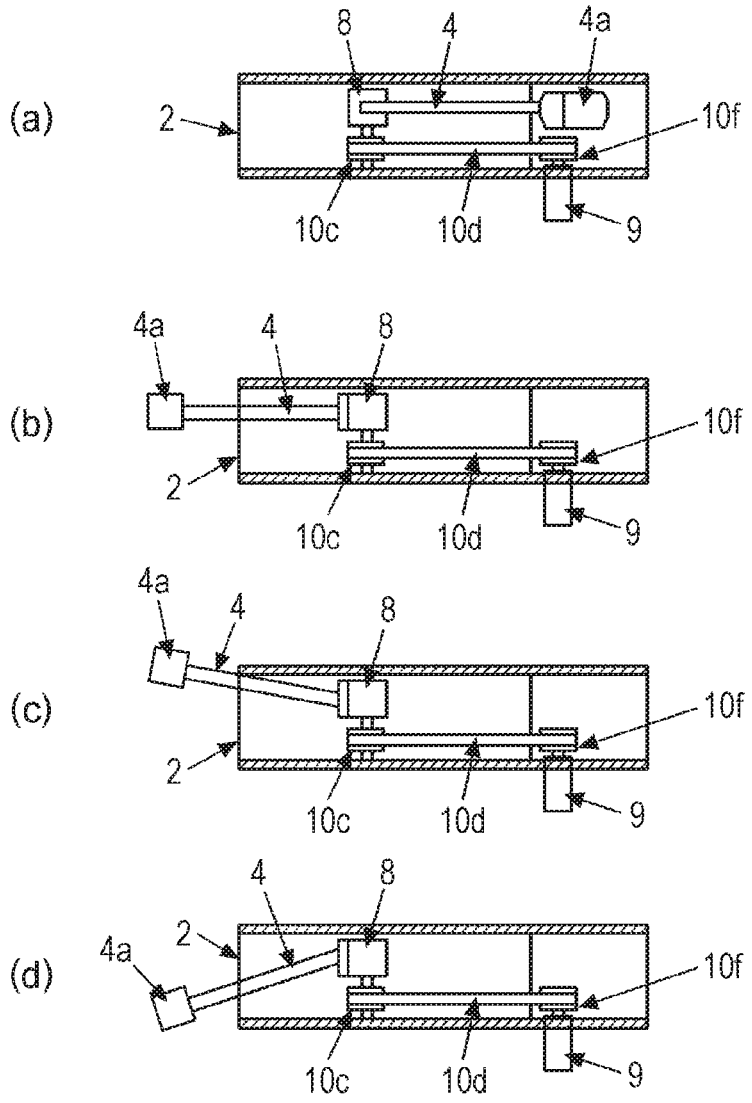
FIG. 16(*a*) is a front view of the internal structure of the buttocks wiping device 1 when the paper is placed, FIG. 16(*b*) is a front view of a state when the wiping arm is exposed, FIG. 16(*c*) is a front view of a state upon wiping by the wiping arm, and FIG. 16(*d*) is a front view of a state upon dropping of the paper.

Operation of the buttocks wiping device 1 of the second embodiment will be described below in detail with reference to FIGS. 11B, 11C, and 12 to 16. FIG. 11B is a functional block diagram of the buttocks wiping device 1. FIG. 11C is a flowchart of operation of the buttocks wiping device 1. Note that the same reference numerals as those of the first embodiment are used to represent similar operation in the flowchart of FIG. 11C, and description thereof will not be repeated. FIG. 12 is a plan view of the internal structure of the buttocks wiping device 1 when the paper 11*a* is placed on the pressing unit 4*a*. FIG. 13 is a plan view of a state in the course of exposing the wiping arm 4. FIG. 14 is a plan view of a state when the wiping arm is exposed at a wiping position. FIG. 15 is a plan view of a state when the wiping arm inclines to the upward direction. FIG. 16(*a*) is a front view of the internal structure of the buttocks wiping device 1 when the paper is placed. FIG. 16(*b*) is a front view of a state when the wiping arm is exposed. FIG. 16(*c*) is a front view of a state upon wiping by the wiping arm. FIG. 16(*d*) is a front view of a state upon dropping of paper. Note that the paper 11*a* is not shown in FIGS. 16(*a*) to 16(*d*).

The pulley 10*f* is attached to a rotary shaft of the exposure motor 9. The pulleys 10*f*, 10*c* are coupled together through the belt 10*d* such that rotation of the exposure motor 9 is transmitted. The upper-to-lower motor 8 is fixed to the pulley 10*c*. One end of the wiping arm 4 is fixed to a rotary shaft of the upper-to-lower motor 8. With this transmission mechanism, the upper-to-lower motor 8 rotates upon rotation of the exposure motor 9. Accordingly, the wiping arm 4 rotates, and then, is exposed through a hole 7*a* of a toilet seat 7 (FIGS. 12 to 14 and FIGS. 16(*a*) and 16(*b*)). When the upper-to-lower motor 8 rotates after exposure, the wiping arm 4 inclines to the upward direction (FIGS. 15 and 16(*c*)), and moisture etc. are wiped by the paper 11*a*.

In the case of manually supplying the paper 11*a* as illustrated in FIG. 11C, a control unit 13 uses, at S200 subsequent to S101, a paper loading detection sensor 12*e* to determine whether or not the paper is placed. If the paper 11*a* is not placed, the control unit 13 prompts, using sound, a displayed message, etc., a user to place the paper. In the second embodiment, a motor detection unit 9*a* for detecting rotation of the exposure motor 9 is used as illustrated in FIG. 11B. A specific example and a function of the motor detection unit 9*a* are similar to those of the motor detection unit 8*a* described in the first embodiment. Based on a signal from the motor detection unit 9*a*, the control unit 13 determines the extent of rotation, and detects whether or not rotation is made to an exposed position (S201). Note that as in the first embodiment, the control unit 13 may use an exposed position sensor and a retracted position sensor to detect the exposed position and a retracted position.

Upon wiping, the control unit 13 uses, at S109, the upper-to-lower motor 8 to incline the wiping arm 4 to the upward direction, as well as performing forward-reverse repeat rotation of the exposure motor 9. In this manner, wiping operation is executed such that the pressing unit 4*a* moves back and forth in the vicinity of the anus (S202). With this structure, the moisture etc. can be, as in the first embodiment, more reliably wiped across a wider area as compared to a case where the pressing unit 4*a* merely contacts the vicinity of the anus.

After paper drops (FIG. 16(*d*)), the control unit 13 determines, based on the signal from the motor detection unit 9*a*, whether or not the wiping arm 4 has reached the retracted position (S203). After the retraction of the buttocks wiping device 1, the opening/closing unit 6 is closed, and then, the buttocks wiping device 1 is brought into a standby state.

As illustrated in FIG. 12, the user places the paper 11*a* in a state in which the pressing unit 4*a* is exposed at the side of the toilet seat 7, and part of the wiping arm drive unit 3 is housed in the raised portion 2.

Figure 17:
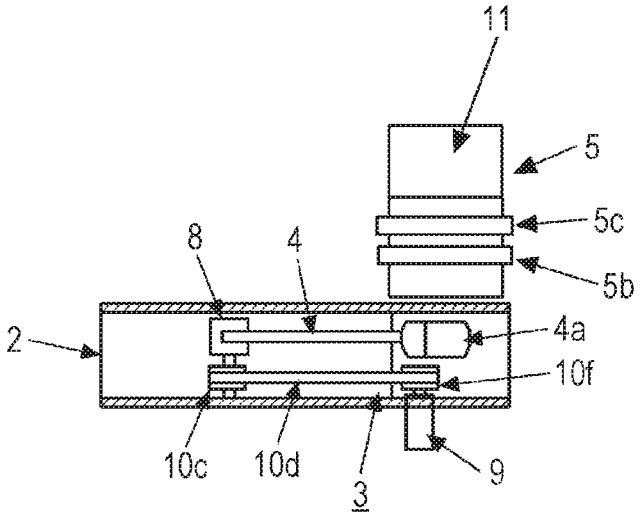
FIG. 17 is a front view in a case where an automatic paper supply unit 5 is disposed on the pressing unit 4*a;*

FIG. 17 is a front view in a case where an automatic paper supply unit 5 is disposed on the pressing unit 4*a*. Although not shown herein, folding guides 5*a* are provided at the automatic paper supply unit 5 to fold the paper in advance as in the first embodiment. Moreover, a mechanism configured to press, after the folded paper has been placed on the pressing unit 4*a*, such paper against the pressing unit 4*a* to avoid unfolding of the paper may be also provided.

As described above, according to the second embodiment, the pressing unit 4*a* of the wiping arm 4 is, as in the first technique described in the beginning, movable without the paper being held by the pressing unit 4*a* and with the paper 11*a* being placed on the pressing unit 4*a* through use of friction of the pressing unit 4*a*. Moreover, the shape of the pressing unit 4*a* is in the curved shape along the vicinity of the anus of the buttocks, and is in such a shape that the paper 11*a* is less dropped. With this structure, the pressing unit 4*a* is movable with the paper 11*a* being placed on the pressing unit 4*a*. As described above, the wiping arm 4 has the mechanism configured not to hold the paper 11*a*, and therefore, the structure of the wiping arm drive unit 3 can be simplified. Specifically, in the second embodiment, the wiping arm 4 may be merely exposed by the exposure motor 9, and may be merely moved up and down by the upper-to-lower motor 8. Since the wiping arm drive unit 3 with the simple structure can be used, part of the mechanism can be housed in the raised portion as in the third technique described in the beginning. This can avoid, as much as possible, consumption of a space at the side of a toilet bowl, and the size of the buttocks wiping device 1 can be reduced. Further, in the second embodiment, the exposure motor 9 performs angular movement of the wiping arm 4 about a certain supporting point, thereby exposing the wiping arm 4. By forward-reverse repeat rotation of the exposure motor 9, the pressing unit 4*a* can be moved back and form in the vicinity of the anus. With this structure, the big structure of moving the wiping arm itself back and forth on the rail as in the fourth technique described in the beginning can be omitted. Consequently, significant size reduction can be realized.

Note that the upper-to-lower motor 8 may be placed below a warm-water cleansing device 15. Note that when rotation movement of the exposure motor 9 is transmitted to the upper-to-lower motor 8 by means of a gear box, a bevel gear, a worm gear, etc., the exposure motor 9 can be housed in the raised portion 2 without use of the transmission mechanism using the belt 10*d*.

Third Embodiment

In the second embodiment, the paper is manually placed on the pressing unit 4*a*, or the automatic paper supply unit 5 is used to place the paper on the pressing unit 4*a*. The automatic paper supply unit 5 can be implemented using a commercially-available electric toilet roll. However, a certain cost is caused for such an automatic paper supply unit 5 itself, and the structure of the buttocks wiping device 1 is also complicated. Needless to say, there is a probability that failure is caused at the automatic paper supply unit 5 itself, leading to a difficulty in maintenance. On the other hand, mere loading of the paper on the pressing unit 4*a* might lead, depending on the way to place the paper 11*a* by the user, to catching of the paper 11*a* by the raised portion 2 upon movement of the wiping arm 4, for example. This cannot deny the probability of not properly exposing the paper 11*a*. For this reason, in a third embodiment, a variation is made to the second embodiment, and a paper supply unit mechanism for delivering paper 11*a* onto a pressing unit 4*a* to properly place the paper 11*a* on the pressing unit 4*a* will be described.

Figure 18:
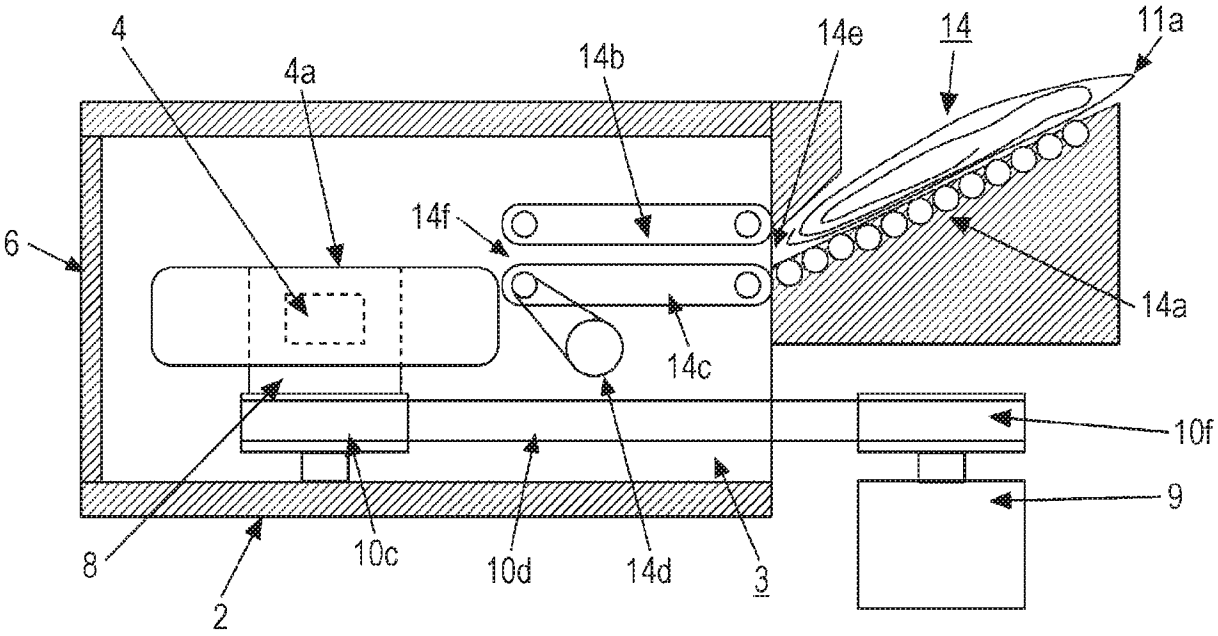
FIG. 18 is a front view of a buttocks wiping device of a third embodiment.

FIG. 18 is a front view of a buttocks wiping device of the third embodiment. In the third embodiment, a mechanism similar to that of the second embodiment is provided as a mechanism of a wiping arm drive unit 3. Note that upon retraction of a wiping arm 4, the pressing unit 4*a* is retracted into a raised portion 2 as illustrated in FIG. 18. The pressing unit 4*a* has such a curved shape that the corners thereof are rounded along the shape of the vicinity of the anus.

As illustrated in FIG. 18, a paper supply unit 14 is newly added. The paper supply unit 14 includes a paper injection port 14*a*, a caterpillar track 14*b*, a caterpillar track 14*c*, and a drive unit 14*d*. The paper injection port 14*a* is made of a material having a low-friction surface or uses, e.g., a free roller or a drive roller, thereby easily sliding or moving the paper 11*a* forward. The caterpillar track 14*c* is configured to rotate by rotation of the drive unit 14*d*. In association with rotation of the caterpillar track 14*c*, the caterpillar track 14*b* also rotates. The caterpillar tracks 14*b*, 14*c* have textured surfaces. When pieces of paper 11*l* a are sandwiched in the upper-to-lower direction, the pieces of the paper 11*a* are embossed to have textured surfaces, and therefore, stick to each other.

Figure 19:
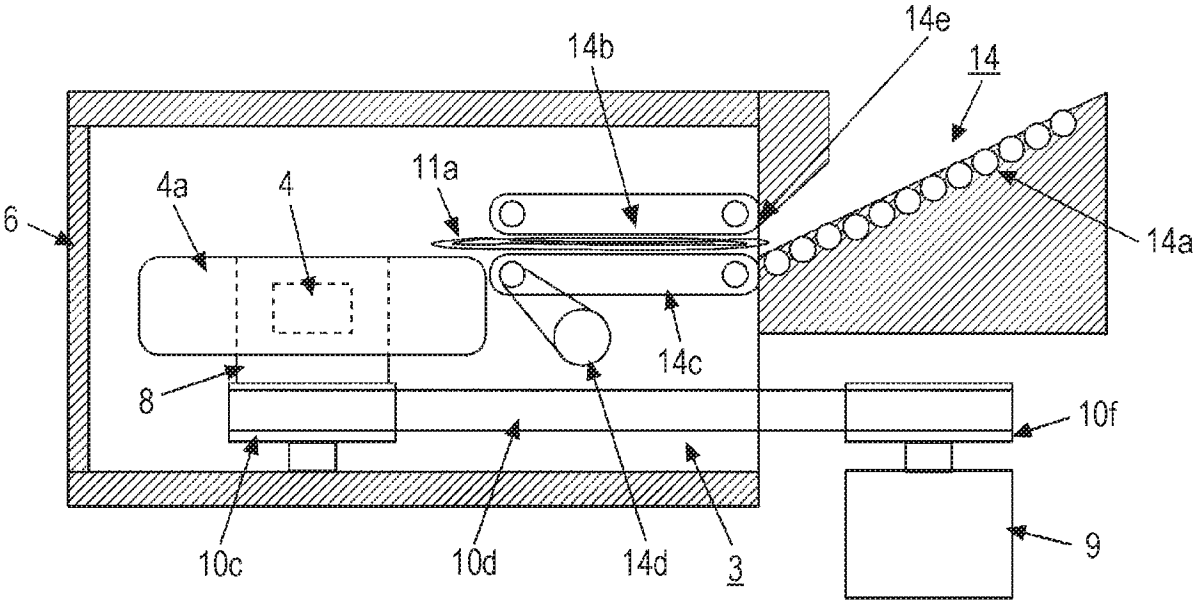
FIG. 19 is a front view of a state when paper 11*a* moves forward.
Figure 20:
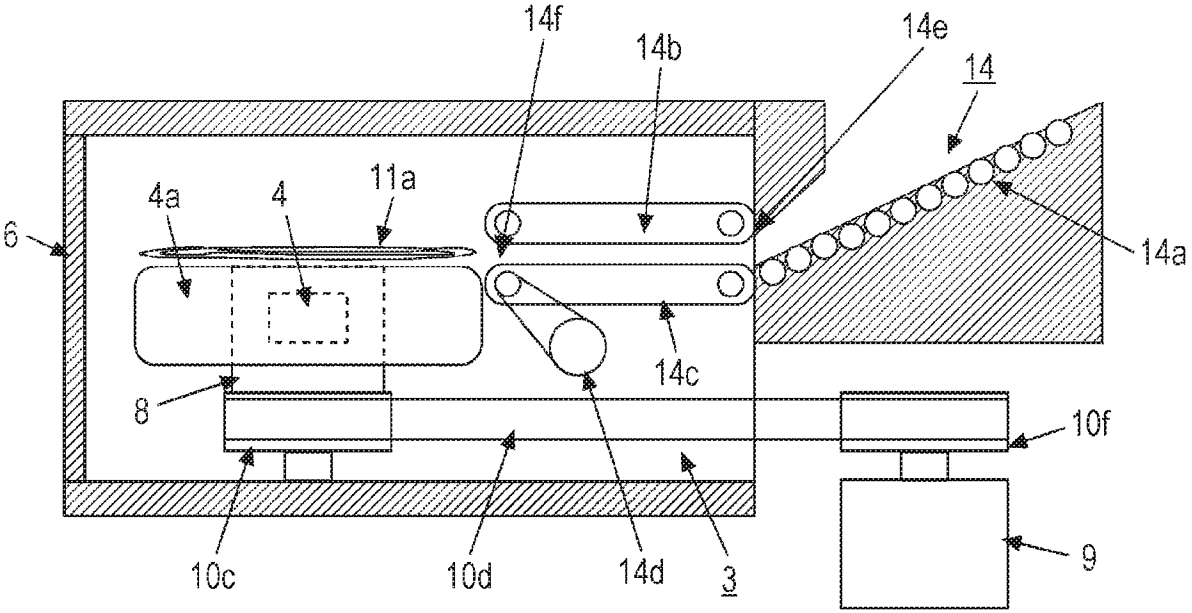
FIG. 20 is a front view of a state when the paper 11*a* is placed on a pressing unit 4*a;*

FIG. 19 is a front view of a state when the paper 11*a* moves forward. FIG. 20 is a front view of a state when the paper 11*a* is placed on the pressing unit 4*a*. When a sensor 14*e* confirms insertion of the paper 11*a*, the drive unit 14*d* begins rotating, and then, the paper 11*a* is delivered to the inside with the paper 11*a* being sandwiched between the caterpillar tracks 14*b*, 14*c*. Thus, the paper 11*a* is flatly shaped while being placed on the pressing unit 4*a*. When the paper is placed on the pressing unit 4*a*, a sensor 14*f* detects that the paper 11*a* is delivered out of the caterpillar tracks 14*b*, 14*c*, and then, the drive unit 14*d* is stopped. Subsequently, an opening/closing unit 6 is, as in the second embodiment, opened such that the wiping arm 4 is exposed, and then, wiping is executed. After wiping, the paper is discarded. Note that only either one of the sensors 14*e*, 14*f* may be provided.

Note that the paper supply unit 14 of the third embodiment can be employed not only in the second embodiment, but also in other embodiments.

Note that a paper supply unit 5 such as an electric toilet roll may be placed on the paper supply unit 14, and the folded and cut paper 11*a* may be placed at the paper injection port 14*a* and be automatically delivered into the caterpillar tracks 14*b*, 14*c*.

With the above-described structure of using the paper supply unit 14 to deliver the paper 11*a* to the pressing unit 4*a*, the paper 11*a* is more properly placed on the pressing unit 4*a* as compared to a case where a user merely places the paper on the pressing unit 4*a*. As a result, it can be expected to reliably proceed to wiping operation.

Note that the above-described technique of delivering the paper onto the pressing unit 4*a* by the paper supply unit 14 can be employed not only for the folded paper 11*a*, but also for the case of using about a single piece of special paper with a certain thickness.

The paper supply unit described in the third embodiment can be, needless to say, used not only for the second embodiment, but also for other embodiments.

Note that in the first to third embodiments, the pressing unit 4*a* of the wiping arm 4 has the surface made of the high-friction material such that the paper 11*a* does not drop upon exposure. However, in addition to the high-friction material, the shape of the pressing unit 4*a* can be designed such that the paper does not drop. Alternatively, paper dropping upon movement can be avoided in such a manner that a hole for generation of a negative pressure is provided at the pressing unit 4*a* to communicate with a separately-provided negative pressure generation device and the paper is sucked through such a hole.

Figure 21:
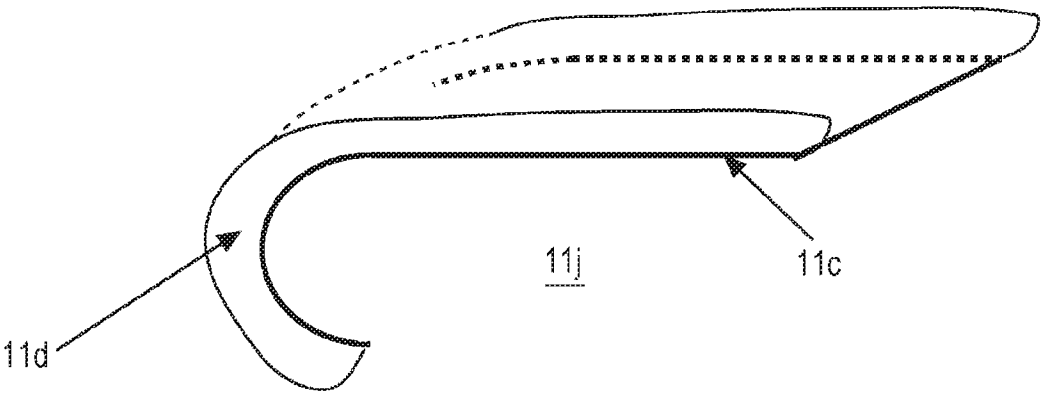
FIG. 21 is a view of an example of special paper 11*j;*

As another alternative, the technique of attaching less-droppable paper to the pressing unit 4*a* is conceivable. FIG. 21 is a view of an example of special paper 11*j*. The special paper 11*j* illustrated in FIG. 21 includes a base material portion 11*c* and a water absorbing portion 11*d*. The base material portion 11*c* is a thick material, and may be preferably a water-soluble (water-degradable or hydrosoluble) material. The base material portion 11*c* is in such a shape that the base material portion 11*c* is less slipped off even when attached to the pressing unit 4*a*. For example, as illustrated in FIG. 21, the base material portion 11*c* has a shape along the curved shape of the pressing unit 4*a*. The water absorbing portion 11*d* is provided on the base material portion 11*c*. The water absorbing portion 11*d* is thick soft paper, and may be made of a material with a stack of some pieces of toilet paper or a thick water-soluble material, for example. The user manually attaches such special paper 11*j* to the pressing unit 4*a* so that dropping of the special paper 11*j* can be prevented upon movement of the wiping arm 4. Note that the structure and shape of the special paper 11*j* may be along the shape of the pressing unit 4*a*, and the special paper 11*j* is not necessarily divided into the base material portion 11*c* and the water absorbing portion 11*d*. When water absorption can be performed only by the base material portion 11*c*, the water absorbing portion 11*d* is not necessary. When only the water absorbing portion 11*d* has a shape along the shape of the pressing unit 4*a*, the base material portion 11*c* is not necessary.

Fourth Embodiment

Figure 22A:
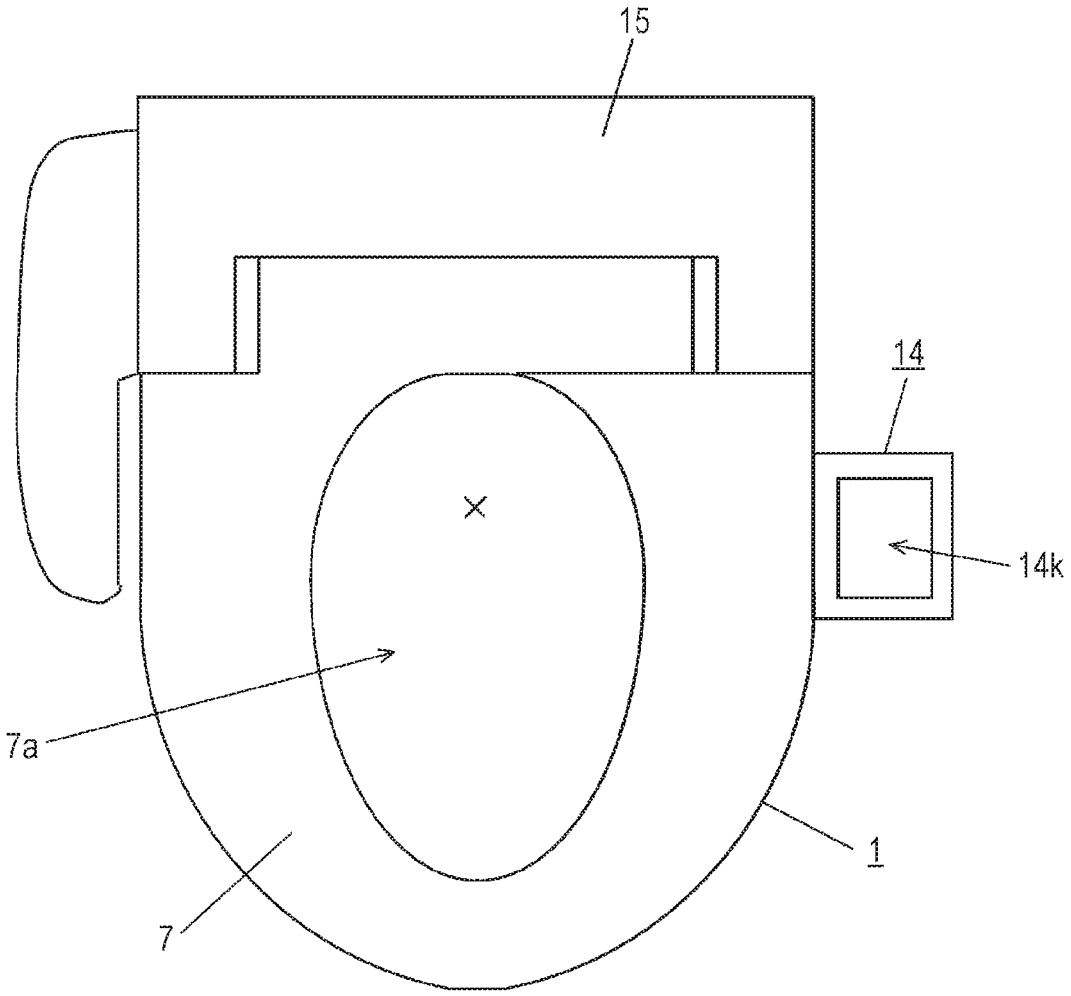
FIG. 22A is a plan view of a buttocks wiping device 1 of a fourth embodiment of the present invention.
Figure 22B:
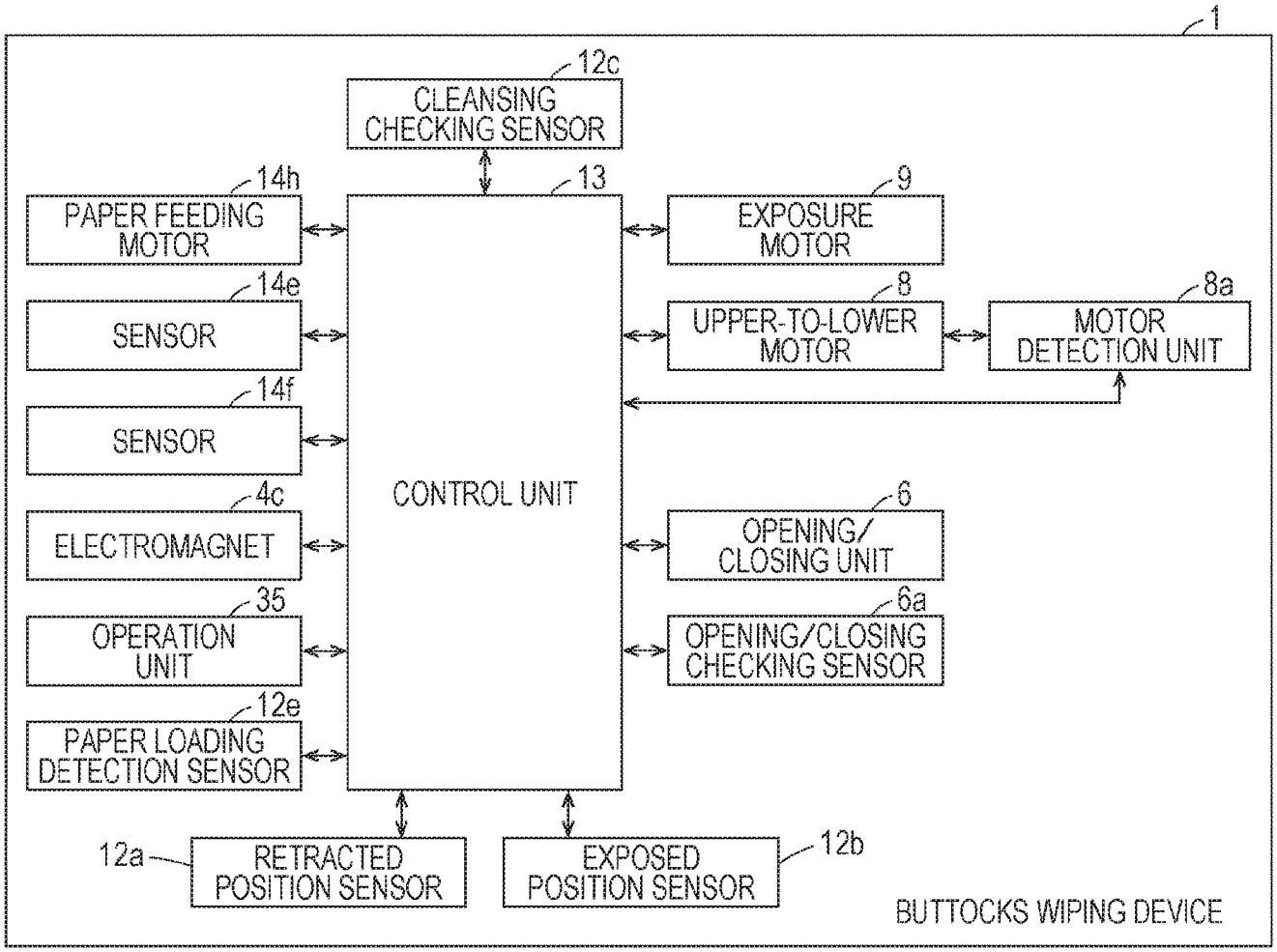
FIG. 22B is a block diagram of a functional configuration of the buttocks wiping device 1.
Figure 22C:
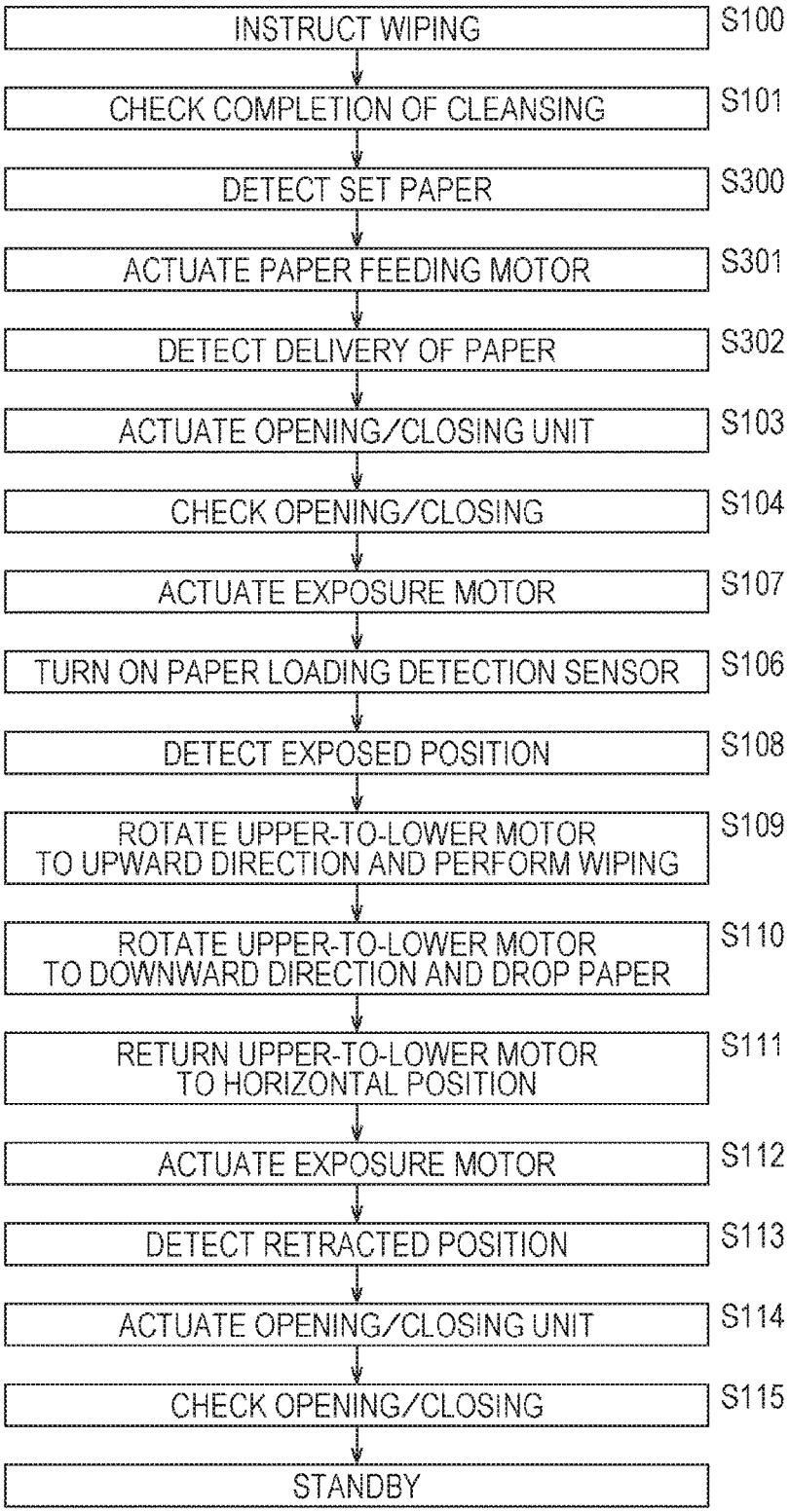
FIG. 22C is a flowchart of operation of the buttocks wiping device 1.
Figure 23:
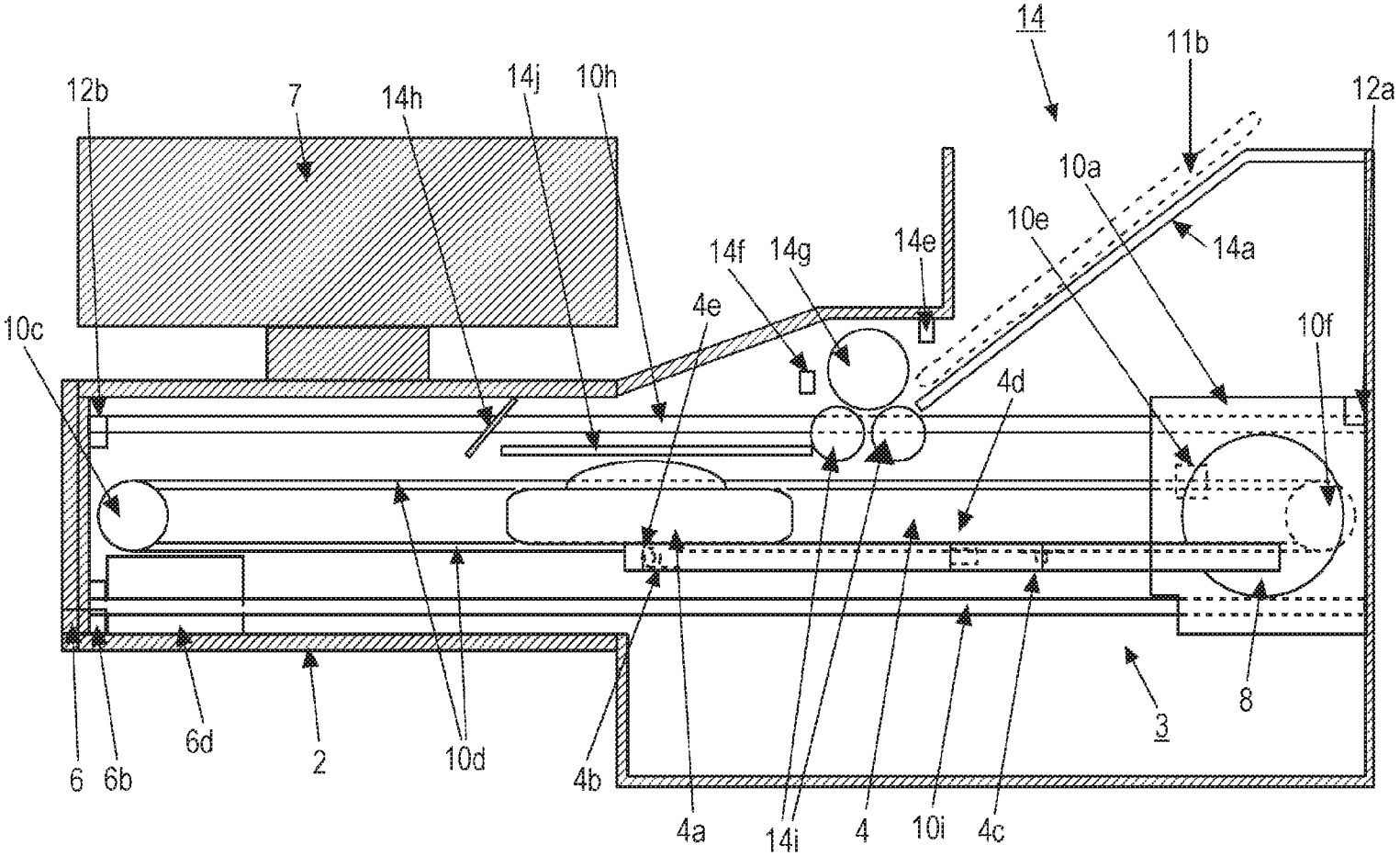
FIG. 23 is a front view of an internal structure of the buttocks wiping device 1.
Figure 24:
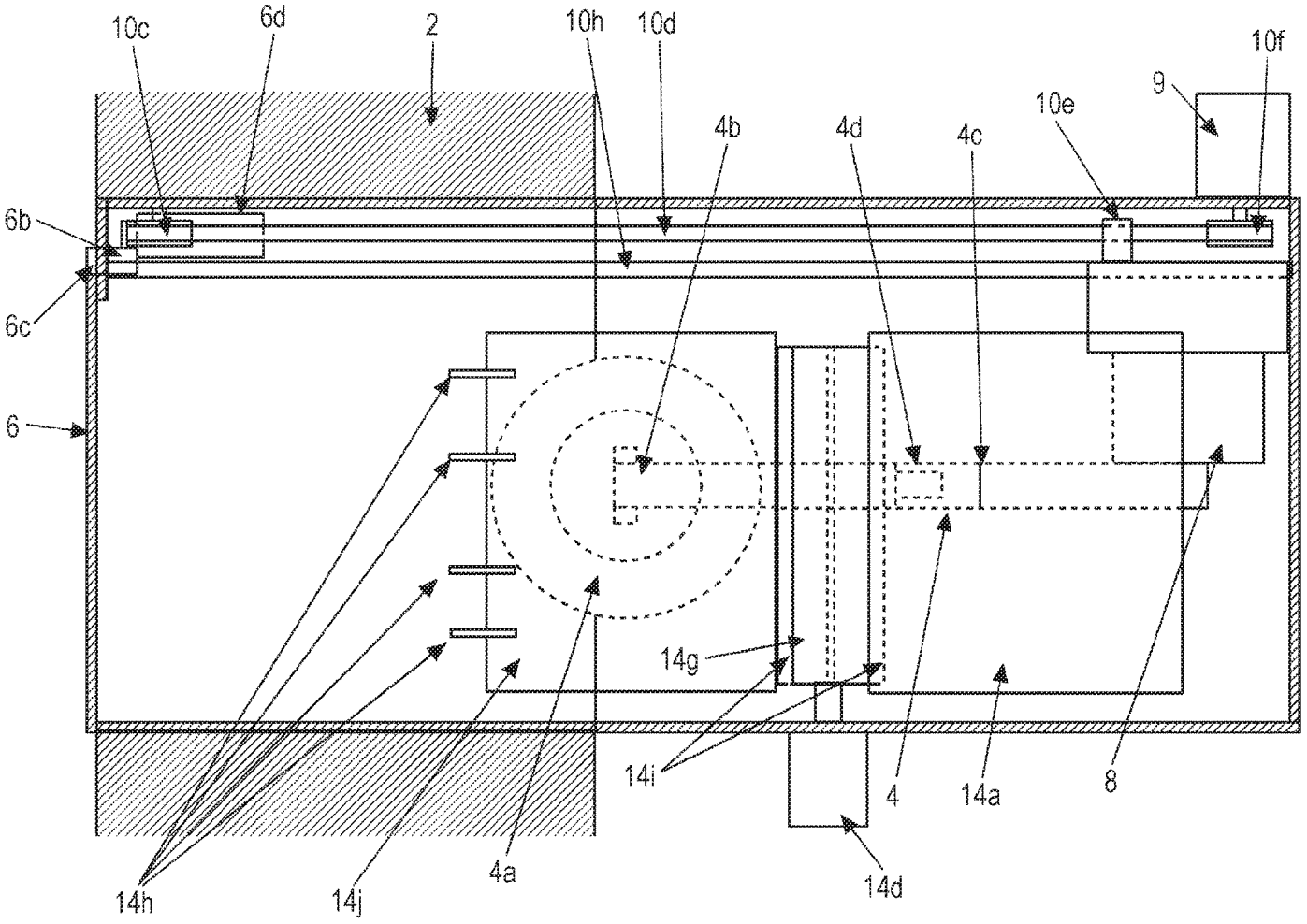
FIG. 24 is a plan view of the internal structure of the buttocks wiping device 1.
Figure 25:
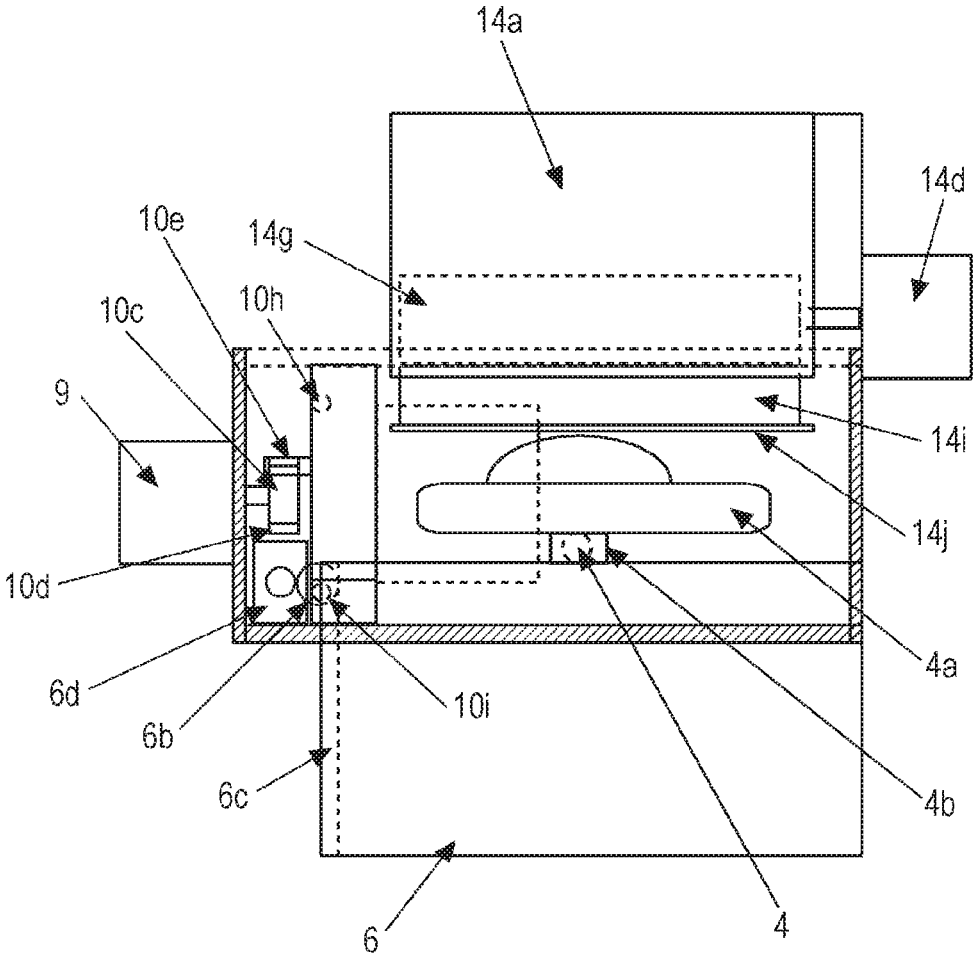
FIG. 25 is a left side view of the internal structure of the buttocks wiping device 1.
Figure 26:
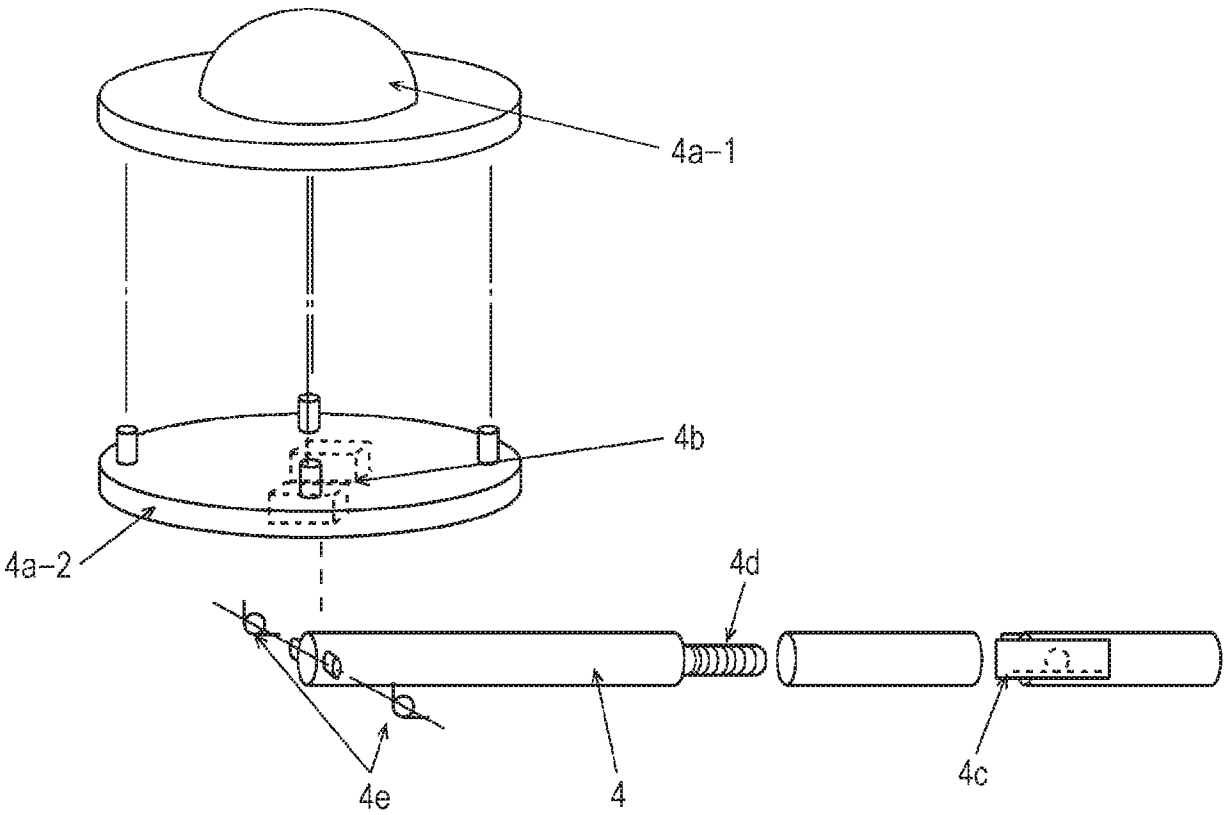
FIG. 26 is an exploded perspective view of a wiping arm 4.
Figure 27:
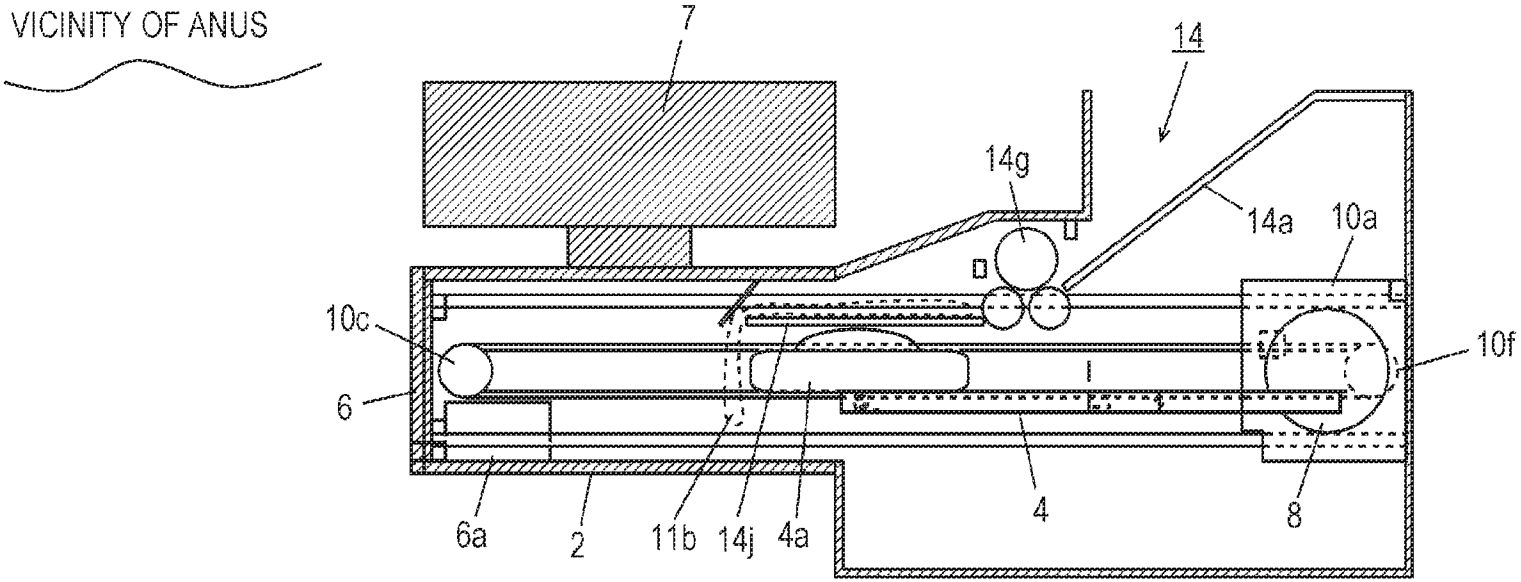
FIG. 27 is a front view of the internal structure when special paper 11*b* is delivered into the buttocks wiping device 1.
Figure 28:
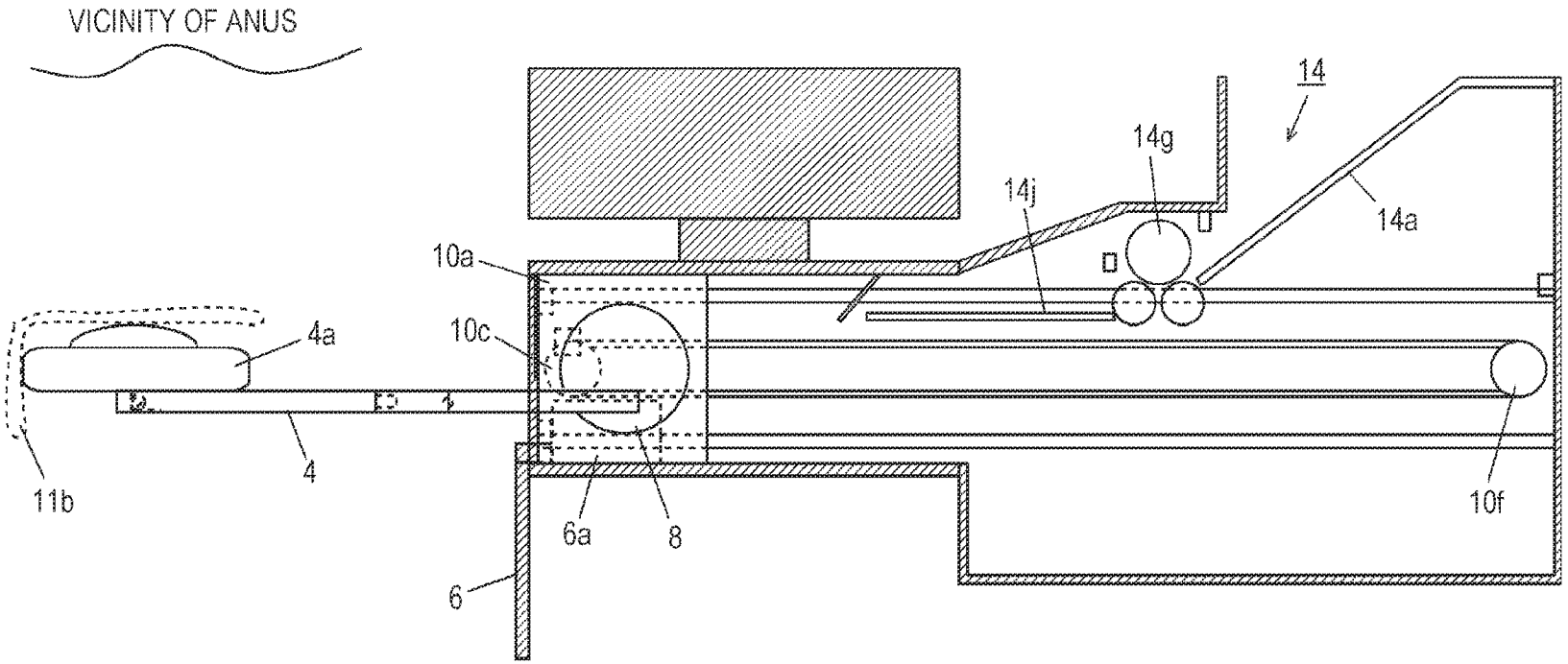
FIG. 28 is a front view of the internal structure when a pressing unit 4*a* is exposed.
Figure 29:
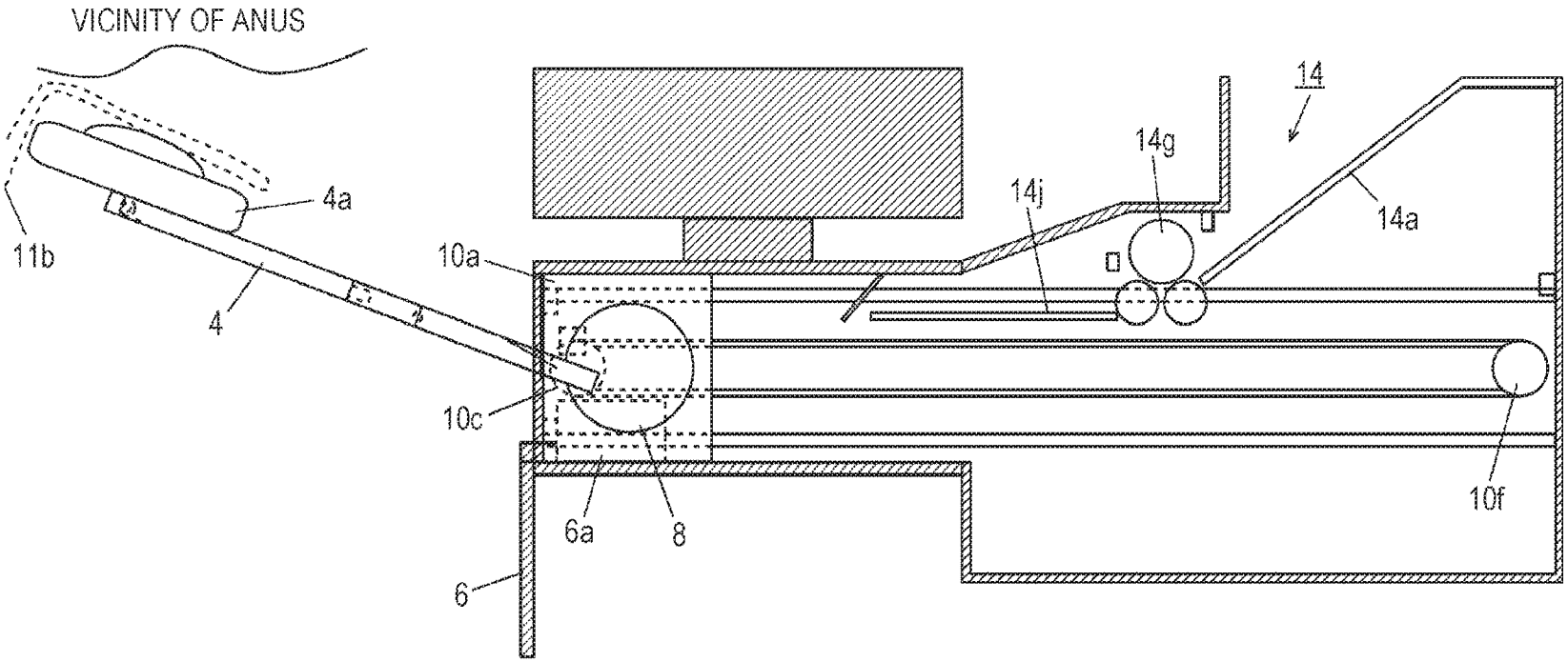
FIG. 29 is a front view of the internal structure when the pressing unit 4*a* inclines to the upward direction.
Figure 30:
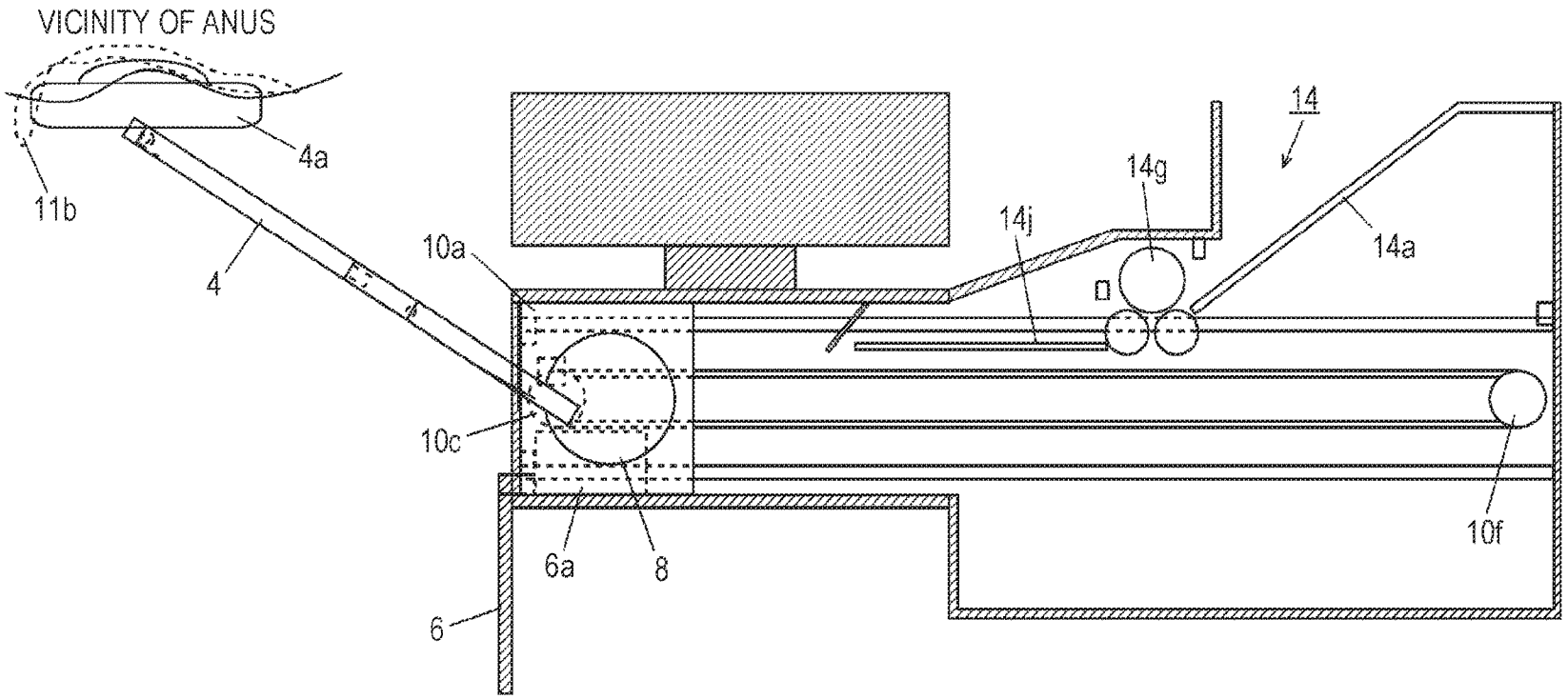
FIG. 30 is a front view of the internal structure when the pressing unit 4*a* contacts the anus.
Figure 31:
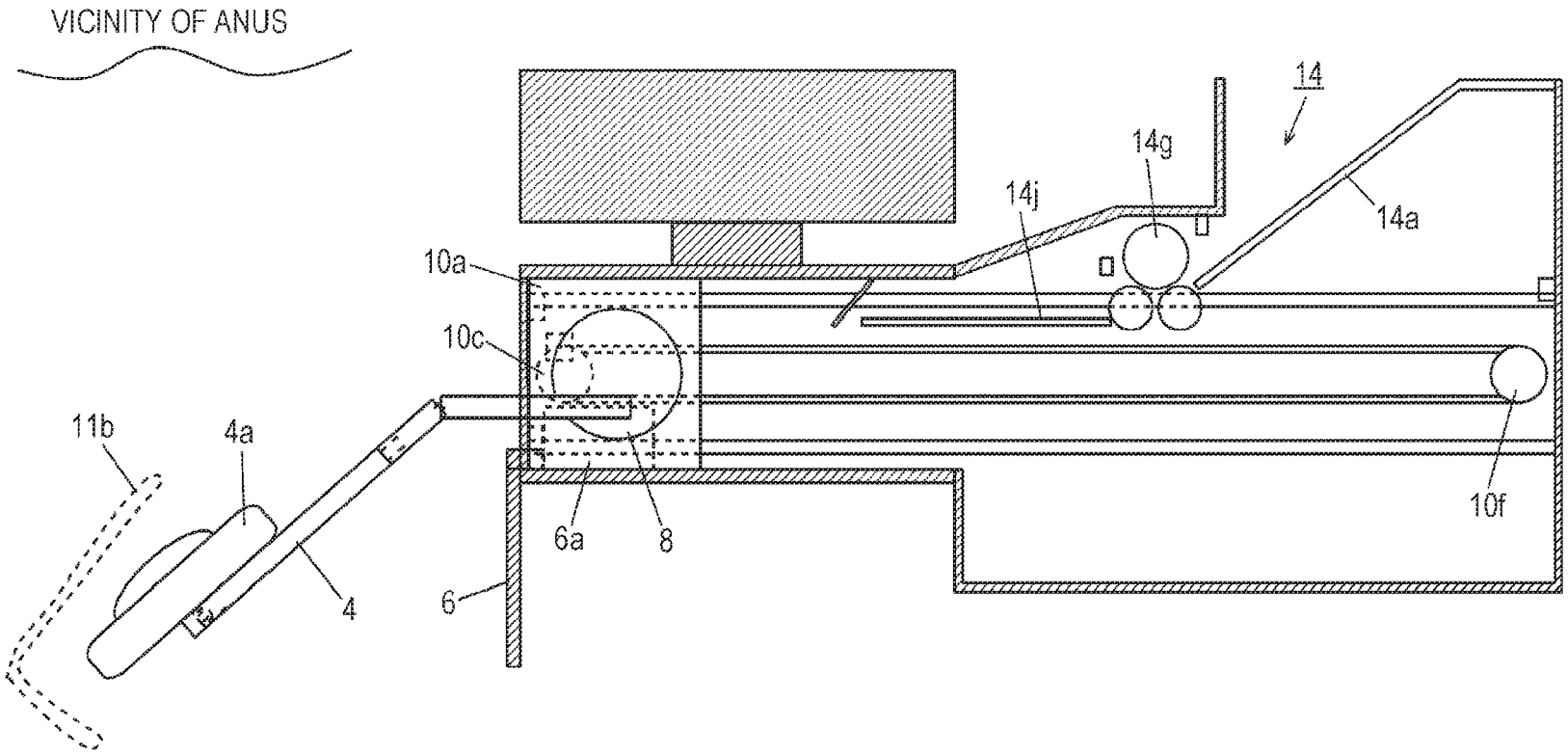
FIG. 31 is a front view of the internal structure when the special paper 11*b* is discarded.

FIG. 22A is a plan view of a buttocks wiping device 1 of a fourth embodiment of the present invention. FIG. 22B is a block diagram of a functional configuration of the buttocks wiping device 1. FIG. 22C is a flowchart of operation of the buttocks wiping device 1. The same reference numerals as those of the first embodiment are used to represent similar operation in FIG. 22C, and detailed description thereof will not be repeated. FIG. 23 is a front view of an internal structure of the buttocks wiping device 1. FIG. 24 is a plan view of the internal structure of the buttocks wiping device 1. FIG. 25 is a left side view of the internal structure of the buttocks wiping device 1. FIG. 26 is an exploded perspective view of a wiping arm 4. FIG. 27 is a front view of the internal structure when special paper 11*b* is delivered into the buttocks wiping device 1. FIG. 28 is a front view of the internal structure when a pressing unit 4*a* is exposed. FIG. 29 is a front view of the internal structure when the pressing unit 4*a* inclines to the upward direction. FIG. 30 is a front view of the internal structure when the pressing unit 4*a* contacts the anus. FIG. 31 is a front view of the internal structure when the special paper 11*b* is discarded.

In the fourth embodiment, the buttocks are wiped using the special paper 11*b*. The special paper 11*b* is thick paper exhibiting water absorbability, and is made of a water-soluble material which can be flushed down a toilet. The special paper 11*b* may be in such a quadrangular shape that multiple pieces of toilet paper are stacked on each other and are joined together at end sides thereof. The special paper 11*b* may be cut into the quadrangular shape in advance, and may be supplied to a user in the form of a stack. Note that the special paper 11*b* is not limited to the quadrangular shape. The special paper 11*b* may be in a triangular shape, a pentagonal shape, or a circular shape as long as the special paper 11*b* is cut into a predetermined shape in advance. As viewed in the plane, the special paper 11*b* is larger than the pressing unit 4*a*. Moreover, the special paper 11*b* can be provided in the form of the stack of multiple pieces of paper joined together in the upper-to-lower direction. For joining, multiple pieces of paper may be pressure-bonded in the upper-to-lower direction by a mold with a recessed-raised portion, or may be bonded in the upper-to-lower direction by a water-soluble adhesive. The joined position is not limited to the end side as long as the special paper 11*b* is partially joined for avoiding detachment thereof.

Moreover, the following technique may be employed: a stack of multiple pieces of toilet paper are joined together at end sides thereof, and a roll of such toilet paper having a perforation at every predetermined length is supplied to the user: and the user may cut, by the user oneself, the toilet paper at the perforation, thereby forming the special paper 11*b* before wiping.

As illustrated in FIG. 22A, the buttocks wiping device 1 has such an entire structure that a paper supply opening 14*k* of a paper supply unit 14 is provided at the side of a raised portion 2. A wiping arm drive unit 3 configured to drive the wiping arm 4 is housed in the raised portion 2 and the paper supply unit 14. Thus, as illustrated in FIG. 22A, a portion exposed at the side of a toilet seat 7 is only the paper supply unit 14 configured to set the special paper 11*b*, leading to size reduction.

As illustrated in FIGS. 23 to 25, the wiping arm drive unit 3 includes an upper-to-lower motor 8, an exposure motor 9, a seat 10*a*, pulleys 10*c*, 10*f*, a belt 10*d*, a coupling tool 10*e*, and sliding rods 10*h*, 10*i*. The pulley 10*f* is coupled to a rotary shaft of the exposure motor 9. When the exposure motor 9 rotates, the pulley 10*f* rotates, and accordingly, the pulley 10*c* and the belt 10*d* rotate. The belt 10*d* and the seat 10*a* are coupled together through the coupling tool 10*e*. The sliding rods 10*h*, 10*i* are inserted into recessed portions or holes provided respectively on the upper and lower sides of the seat 10*a*. Thus, when the exposure motor 9 rotates, the seat 10*a* slides right to left along the sliding rods 10*h*, 10*i*. The upper-to-lower motor 8 is fixed to the seat 10*a*. One end of the wiping arm 4 is coupled to a rotary shaft of the upper-to-lower motor 8. Thus, when the exposure motor 9 rotates, the upper-to-lower motor 8 slides together with the wiping arm 4, and then, the pressing unit 4*a* is exposed through a hole 7*a* of the toilet seat 7. Note that a sliding mechanism including the sliding rods 10*h*, 10*i*, the belt 10*d*, and the pulleys 10*c*, 10*f* is described herein as an example, but the sliding mechanism for sliding the upper-to-lower motor 8 is not limited to above. For example, the sliding mechanism may include a mechanism configured such that a screw shaft configured to rotate in association with rotation of the exposure motor 9 penetrates a ball screw and the upper-to-lower motor 8 is fixed to the ball screw to slide along the screw shaft, or a mechanism configured such that the upper-to-lower motor 8 slides along a rail as in the first embodiment.

The paper supply unit 14 includes a paper injection port 14*a*, a paper feeding motor 14*d*, a sensor 14*e*, a sensor 14*f*, an upper roller 14*g*, a guide 14*h*, a lower roller 14*i*, and a table 14*j*. The paper injection port 14*a* is made of a material having a slippery low-friction surface. The special paper 11*b* injected through the opening 14*k* slides down on the paper injection port 14*a*, and then, enters a detection area of the sensor 14*e* (S300 of FIG. 22C). When the sensor 14*e* detects the special paper 11*b*, the paper feeding motor 14*d* rotates to rotate the upper roller 14*g* and the lower roller 14*i* (S301 of FIG. 22C). When the upper roller 14*g* and the lower roller 14*i* rotate, the special paper 11*b* is delivered with the special paper 11*b* being sandwiched between these rollers. When the special paper 11*b* is delivered out of the upper and lower rollers 14*g*, 14*i*, the sensor 14*f* no longer detects the special paper 11*b*, and detects that the special paper 11*b* has been delivered (S302 of FIG. 22C). At this point, the paper feeding motor 14*d* is stopped. The special paper 11*b* comes into contact with the guide 14*h*, and is bright into a state in which the special paper 11*b* hangs down from the table 14*j* (FIG. 27).

When the exposure motor 9 rotates to move the wiping arm 4 forward, the hanging special paper 11*b* is pulled out of the table 14*j* by friction of the pressing unit 4*a*, and the pressing unit 4*a* is exposed through the opened opening/closing unit 6 (FIG. 28). Various mechanisms configured to open/close the opening/closing unit 6 are conceivable. As illustrated in FIGS. 24 and 25, a rack-and-pinion opening/closing mechanism is used herein, which is configured such that an opening/closing motor 6*d* rotates to rotate a gear (a pinion) 6*b* and a gear (a rack) 6*c* is moved up and down by rotation of the gear 6*b*. However, the present invention is not limited to above.

FIG. 26 is the exploded perspective view of the wiping arm 4. The pressing unit 4*a* includes a raised portion 4*a*-1, a table portion 4*a*-2, and a hinge portion 4*b*. The raised portion 4*a*-1 is made of a flexible friction material in a curved shape along the shape of the vicinity of the anus, such as silicon resin, but is not intended to limit the present invention. The table portion 4*a*-2 is a hard member for coupling of the raised portion 4*a*-1, such as resin or metal, but is not intended to limit the present invention. The hinge portion 4*b* is provided on a bottom surface of the table portion. The hinge portion 4*b* exhibiting repulsive force may be swingably coupled to one end of the wiping arm 4 through an elastic member such as a spring 4*e*, but is not intended to limit the present invention. The pressing unit 4*a* is detachable by a coupling portion 4*d* in the middle of the wiping arm 4. Various shapes of the pressing unit 4*a* can be provided according to preferences or the shape of the anus. The user can customize, according to one's preferences etc., the shape of the pressing unit 4*a*. An electromagnet 4*c* having a hinge mechanism is provided at a middle portion of the wiping arm 4, and therefore, the wiping arm 4 is bendable. A not-shown spring is provided inside the hinge mechanism of the electromagnet 4*c* such that the wiping arm 4 is held horizontal even when no current is applied. For example, the electromagnet 4*c* is magnetized to repel for bending the wiping arm 4, and is magnetized to attract for holding the wiping arm 4 horizontal. The hinge mechanism provided together with the electromagnet 4*c* allows the wiping arm 4 to be bent or be held horizontal according to a magnetization direction of the electromagnet 4*c*.

Upon wiping, the upper-to-lower motor 8 rotates to incline the wiping arm 4 to the upward direction as illustrated in FIG. 29. Subsequently, when the pressing unit 4*a* comes into contact with the vicinity of the anus, the pressing unit 4*a* turns about the hinge portion 4*b*, and is held horizontal as illustrated in FIG. 30. Force of the spring 4*e* presses the pressing unit 4*a* against the anus, and therefore, moisture etc. are absorbed by the special paper 11*b*. Note that wiping may be executed in such a manner that the pressing unit 4*a* is slightly moved up and down and right to left by slight movement of the upper-to-lower motor 8 and the exposure motor 9. Note that slight front-to-back movement is also allowed by a motor configured to move the pressing unit 4*a* back and forth, the motor being attached to the seat 10*a* and the upper-to-lower motor 8 being attached to such a motor.

Upon completion of wiping, the upper-to-lower motor 8 rotates to return the wiping arm 4 to the horizontal direction, and the electromagnet 4*c* is magnetized in the direction of bending the wiping arm 4 to naturally drop the special paper 11*b*, as illustrated in FIG. 31. Subsequently, the electromagnet 4*c* is magnetized to return to an original state, and therefore, the wiping arm 4 is held horizontal. Eventually, the exposure motor 9 rotates to return the wiping arm 4 to a retracted position, and then, the opening/closing unit 6 is closed to bring a standby state for subsequent wiping. Note that the upper-to-lower motor 8 may incline the wiping arm 4 downward to drop the paper without bending the wiping arm 4 by means of the electromagnet 4*c*. In this case, the electromagnet 4*c* is not necessarily used.

Note that in the fourth embodiment, determination on whether or not the paper is placed on the pressing unit 4*a* is made after actuation of the exposure motor 9. Thus, in the flowchart shown in FIG. 22C, the exposure motor 9 is actuated at S107, and then, a paper loading detection sensor 12*e* is, at S106, turned on to monitor whether or not the special paper 11*b* is dropped in the middle.

As described above, according to the fourth embodiment, movement can be, as in the first technique described in the beginning, made without the paper being held and with the special paper 11*b* being kept placed through use of friction. Moreover, a tip end of the pressing unit 4*a* is in a raised shape. Thus, the special paper 11*b* is less dropped, and movement can be made with the special paper 11*b* being kept placed. As described above, the wiping arm 4 has the mechanism configured not to hold the special paper 11*b*, and therefore, the structure of the wiping arm drive unit 3 can be simplified. Specifically, in the fourth embodiment, the wiping arm 4 may be merely exposed by the exposure motor 9, and the wiping arm 4 may be merely moved up and down by the upper-to-lower motor 8. Since the wiping arm drive unit 3 with the simple structure can be used, part of the mechanism can be housed in the raised portion as in the third technique described in the beginning. This can avoid, as much as possible, consumption of a space at the side of a toilet bowl, and the size of the buttocks wiping device 1 can be reduced.

With use of the special paper 11*b* as in the fourth embodiment, the paper supply unit 14 with a simple structure merely using paper feeding rollers can be used to place the paper on the pressing unit 4*a*. With proper arrangement of the paper supply unit 14 and the wiping arm drive unit 4, the size of the buttocks wiping device 1 can be reduced.

With the structure in which the pressing unit 4*a* is held horizontal by, e.g., the hinge mechanism upon contact with the anus, the feeling of wiping can be improved, and the moisture etc. can be reliably wiped.

Fifth Embodiment

Figure 32:
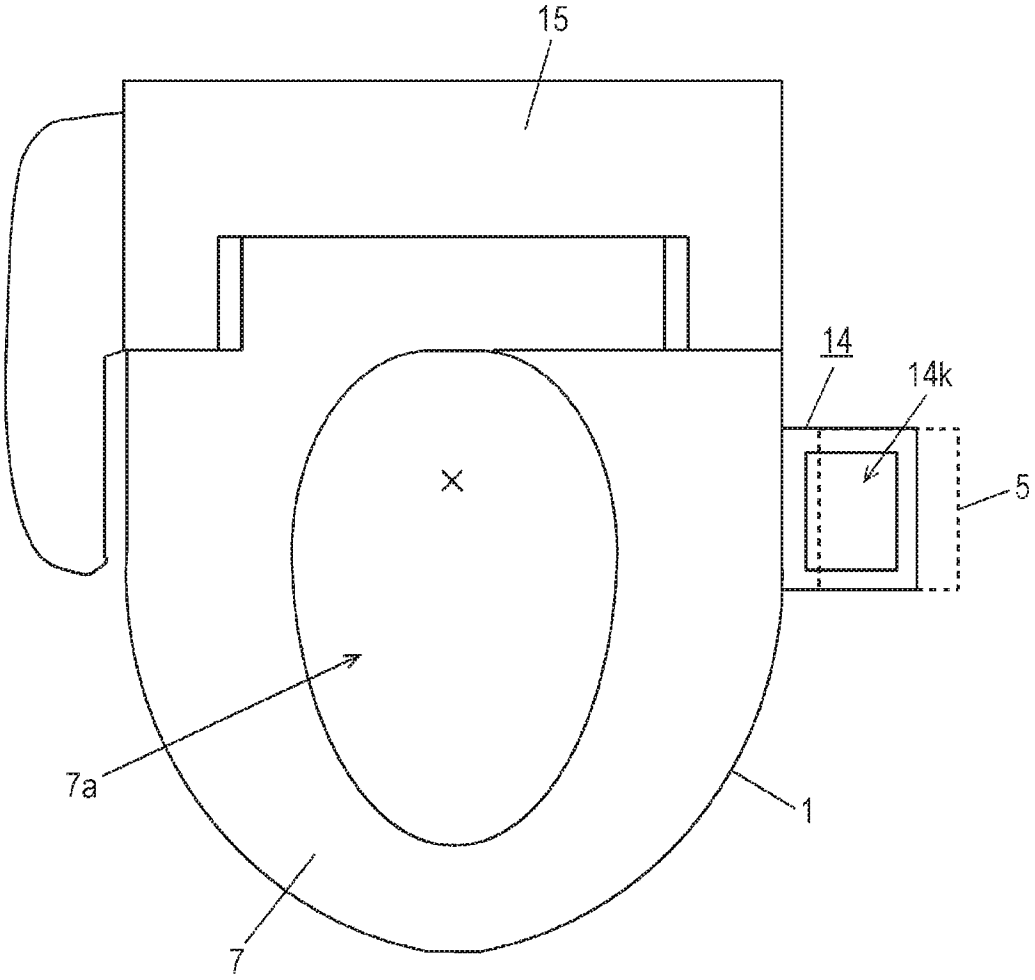
FIG. 32 is a plan view of a buttocks wiping device 1 of a fifth embodiment.

A fifth embodiment describes a buttocks wiping device 1 in a case where an automatic paper supply unit 5 is optionally attached to the fourth embodiment. FIG. 32 is a plan view of the buttocks wiping device 1 of the fifth embodiment. As illustrated in FIG. 32, the buttocks wiping device 1 is configured such that the automatic paper supply unit 5 is attached onto an opening 14*k*. The automatic paper supply unit 5 has Ill an electric toilet roll structure, and can be implemented by a simple structure in which the automatic paper supply unit 5 is placed and fixed onto the opening 14*k*. In a case where only the automatic paper supply unit 5 is provided as a body separated from the buttocks wiping device 1, the buttocks wiping device 1 does not operate as long a sensor 14*e* does not detect special paper 11*b* in the fourth embodiment. Thus, the automatic paper supply unit 5 and the buttocks wiping device 1 are not necessarily cooperate with each other, and the automatic paper supply unit 5 can be easily attached later as an option. Note that needless to say, a design may be made such that the automatic paper supply unit 5 and the buttocks wiping device 1 cooperate with each other.

Paper lie used for the automatic paper supply unit 5 is a roll of the thick special paper 11*b*. The automatic paper supply unit 5 is configured to cut the rolled paper 11*e* into a predetermined length. Such a predetermined length is the length of the special paper 11*b* used in the fourth embodiment, but is determined according to the length of a pressing unit 4*a*.

Figure 33:
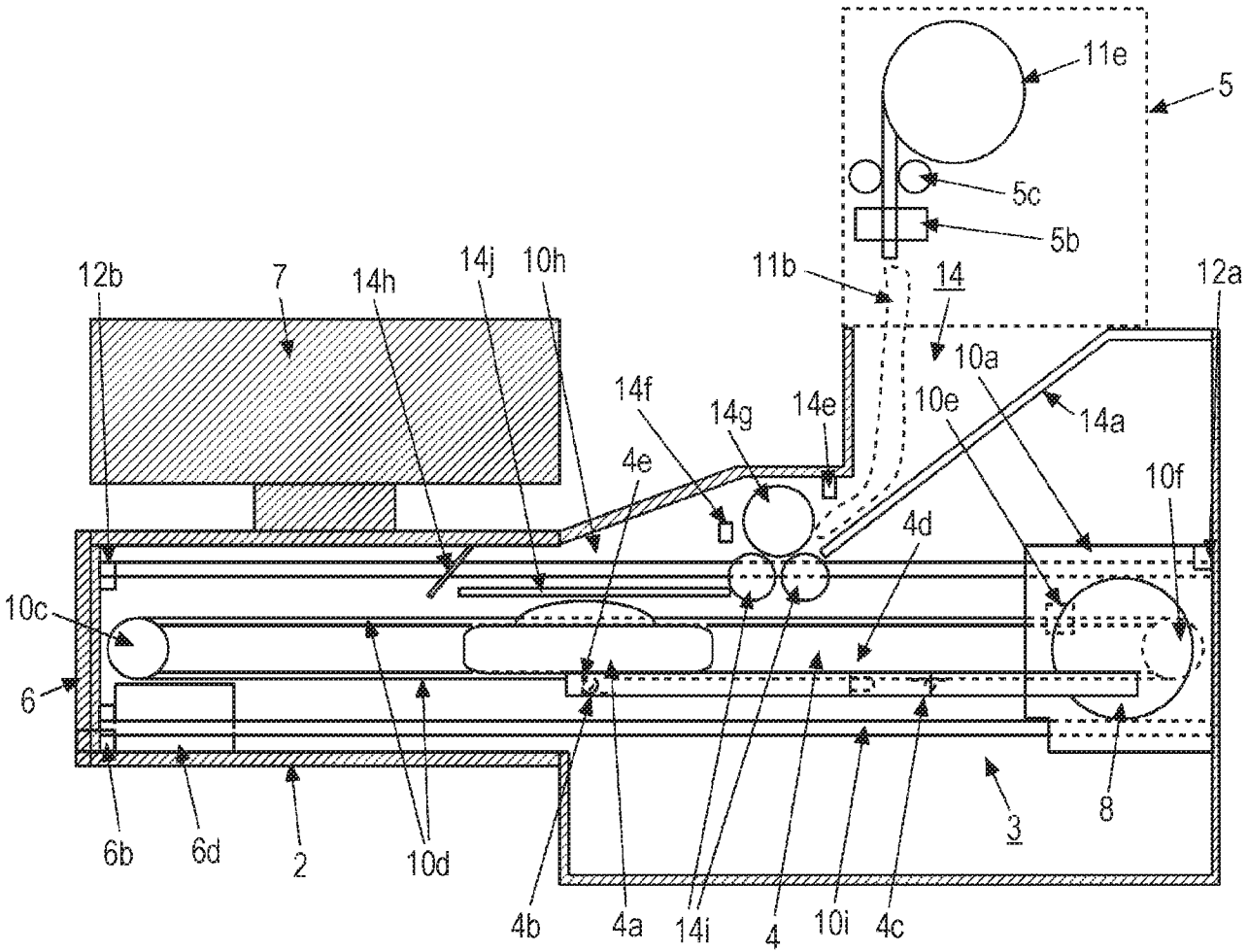
FIG. 33 is a plan view of an internal structure of the buttocks wiping device 1 in the case of attaching an automatic paper supply unit 5 as an option.

FIG. 33 is a plan view of an internal structure of the buttocks wiping device 1 in a case where the automatic paper supply unit 5 is optionally attached. FIG. 33 is different from the fourth embodiment in that the automatic paper supply unit 5 for cutting the special rolled paper 11*e* is attached onto a paper supply unit 14. The automatic paper supply unit 5 includes a cutting unit 5*b* and paper feeding rollers 5*c*. When the predetermined length of the rolled paper 11*e* is delivered by the paper feeding rollers 5*c*, the cutting unit 5*b* cuts the rolled paper 11*e*. In this manner, the special paper 11*b* is cut, and is dropped into a paper injection port 14*a*. Subsequently, wiping operation by the buttocks wiping device 1 is executed as in the fourth embodiment.

As described above, in the fifth embodiment, the special paper 11*b* can be automatically supplied using the special rolled paper 11*e*, and therefore, convenience is further improved.

Note that the automatic paper supply unit 5 as described in the first embodiment may be placed on the opening 14*k* such that rolled toilet paper is delivered, folded, and cut into a predetermined length, and in this manner, the paper may be delivered to the pressing unit through the opening 14*k*.

(Variations of Embodiments)

Figure 34:
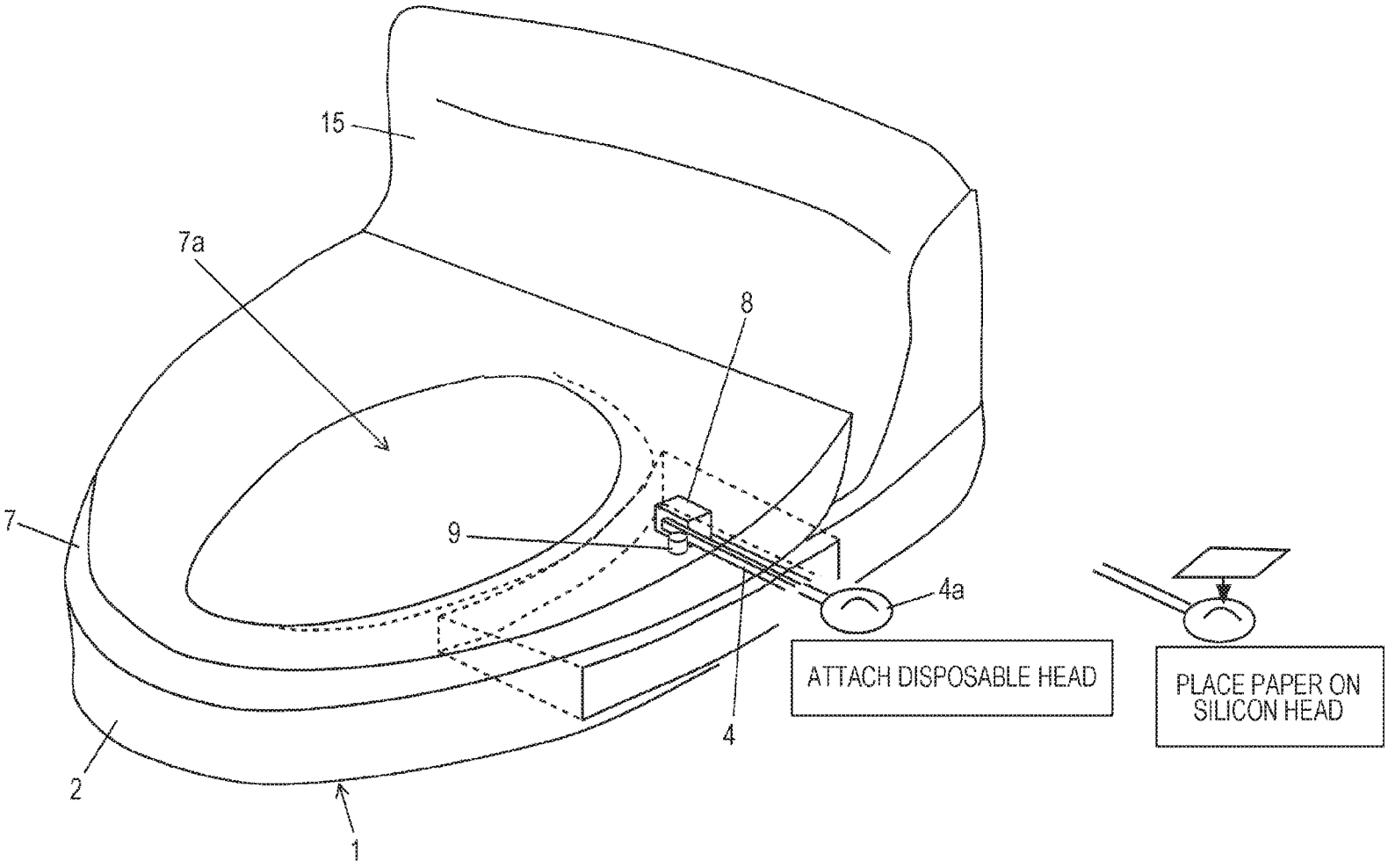
FIG. 34 is a perspective view of an internal structure of a buttocks wiping device 1 when an exposure motor 9 is provided in a raised portion 2.

Some specific variations of the embodiments described so far will be described below. In the second embodiment, the paper 11*a* supplied from the automatic paper supply unit 5 is placed on the pressing unit 4*a*, but may be manually placed on the pressing unit. Moreover, the exposure motor 9 may be provided in the raised portion 2. FIG. 34 is a perspective view of the internal structure of the buttocks wiping device 1 when the exposure motor 9 is provided in the raised portion 2. As illustrated in FIG. 34, the paper 11*a* may be manually placed on the pressing unit 4*a* with the pressing unit 4*a* being exposed at the side of the toilet bowl, and the wiping arm 4 may be exposed through the hole 7*a*. Alternatively, the exposure motor 9 may be housed in the raised portion 2, and the upper-to-lower motor 8 and the wiping arm 4 may be exposed by rotation. As another alternative, the exposure motor 9 may utilize a gear box, various gears, etc. to expose the upper-to-lower motor 8. Note that the pressing unit 4*a* is preferably made of a high-friction material such as silicon, but the present invention is not limited to above.

A further variation of FIG. 34 may be an extendable structure of the wiping arm 4. For example, an electrically-extendable structure of a radio antenna of an automobile has been well known. That is, a structure in which an antenna extends and contracts by electric winding of a wire and a structure in which a rack-and-pinion is used such that an antenna extends and contracts by electric winding of a rack-side windable flexible belt have been known. These structures may be used for extension and contraction of the wiping arm 4. By extension and contraction of the wiping arm 4, the entirety of the buttocks wiping device 1 can be downsized.

Further, a still further variation of FIG. 34 may be manual attachment of a water-soluble disposable head to the tip end of the wiping arm 4 (including an extendable arm).

Figure 35:
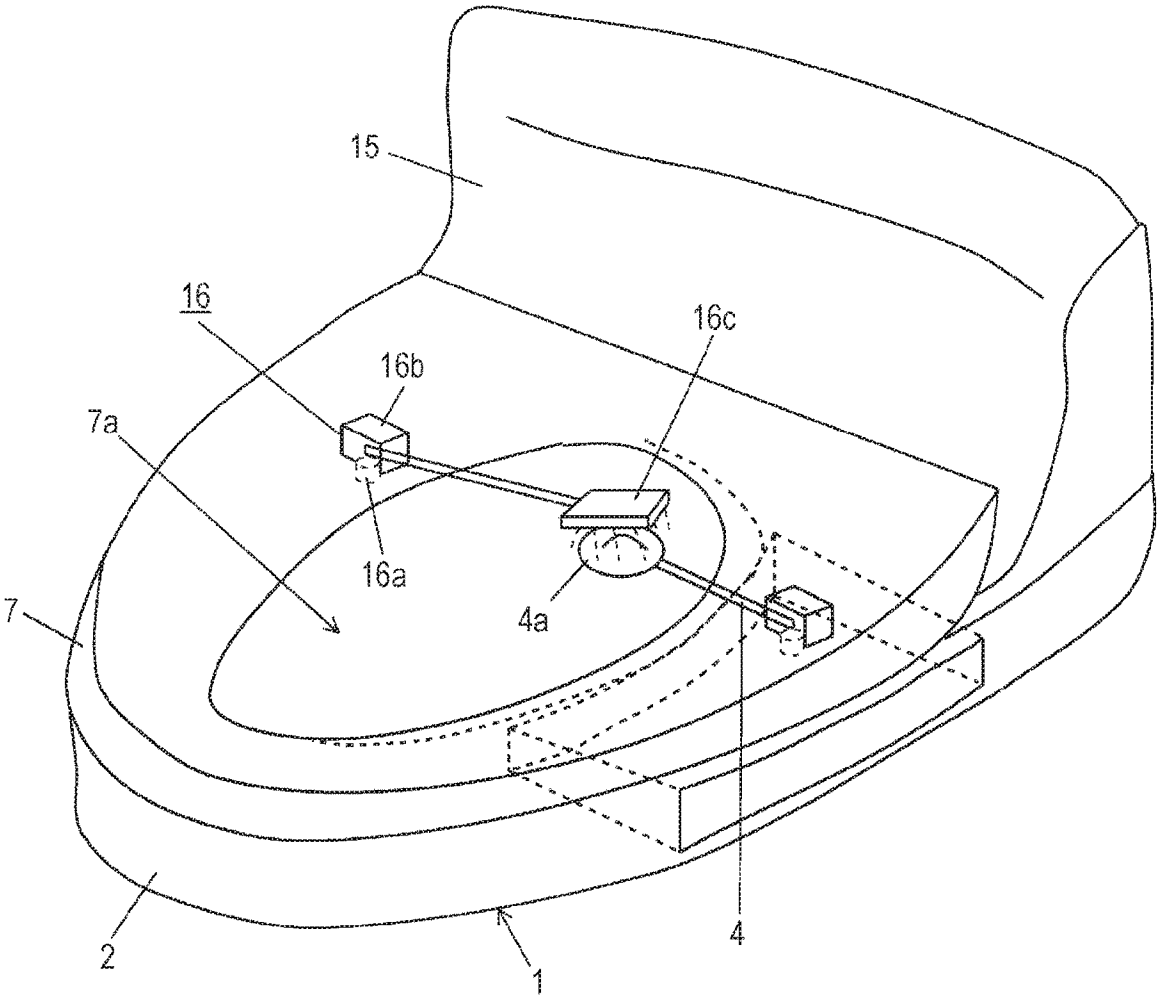
FIG. 35 is a perspective view of the buttocks wiping device 1 equipped with a sterilization/cleansing arm 16 for sterilizing and/or cleansing the pressing unit 4*a* of the embodiments described so far.

FIG. 35 is a perspective view of the buttocks wiping device 1 equipped with a sterilization/cleansing arm 16 configured to sterilize and/or cleanse the pressing unit 4*a* of the embodiments described so far. In FIG. 35, the sterilization/cleansing arm 16 is retracted into the raised portion 2, and for the sake of clarifying such a structure, is illustrated as if part of the toilet seat 7 is cut off. The sterilization/cleansing arm 16 is coupled to, e.g., a not-shown sterilization solution tank, cleansing solution tank, or tap water line, thereby spraying a sterilization solution or a cleansing solution from a sterilization/cleansing head 16*c* by opening and closing of, e.g., a not-shown electromagnetic valve. Moreover, the sterilization/cleansing arm 16 includes an exposure motor 16*a* and an upper-to-lower motor 16*b*. The raised portion 2 is provided with an opening through which the sterilization/cleansing arm 16 is exposed. When not in use, the wiping arm 4 is exposed through the hole 7*a* of the toilet seat 7. Accordingly, the sterilization/cleansing arm 16 is exposed to spray, from above the pressing unit 4*a*, the sterilization solution and/or the cleansing solution, thereby sterilizing and/or cleansing the pressing unit 4*a*. In this example, the sterilization/cleansing arm 16 is inclined to the upward direction by the upper-to-lower motor 16*b*, thereby, e.g., cleansing the pressing unit 4*a* from above. However, when the wiping arm 4 can incline to the downward direction, the sterilization/cleansing arm 16 may include only the exposure motor 16*a*. Moreover, the sterilization/cleansing arm 16 may be retracted into other locations than the raised portion 2, such as the warm-water cleansing device 15, and may be exposed from the warm-water cleansing device 15. When the mechanism for sterilization etc. can be provided separately from the wiping arm 4 as described above, the periphery of the wiping arm drive unit 3 can be waterproofed.

Figure 36:
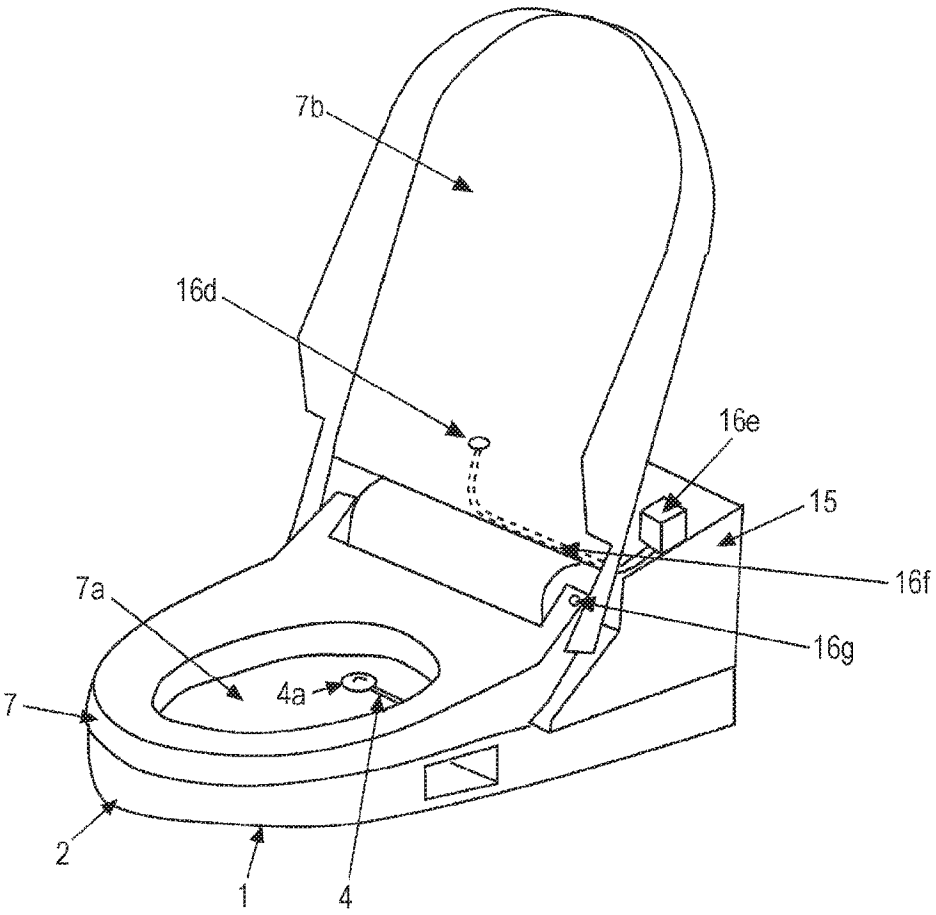
FIG. 36 is a perspective view of the buttocks wiping device 1 configured such that a sterilization/cleansing nozzle 16*d* is attached to a lid 7*b* of a toilet seat 7 to sterilize and/or cleanse the pressing unit 4*a* of the embodiments described so far.

FIG. 36 is a perspective view of the buttocks wiping device 1 configured such that a sterilization/cleansing nozzle 16*d* is attached to a lid 7*b* of the toilet seat 7 to sterilize and/or cleanse the pressing unit 4*a* of the embodiments described so far. In FIG. 36, the buttocks wiping device 1 includes the sterilization/cleansing nozzle 16*d* attached to the lid 7*b*, a tank 16*e*, a pipe 16*f*, and a lid detection sensor 16*g*. The lid detection sensor 16*g* is configured to detect whether or not the lid 7*b* is closed. The sterilization solution and/or the cleansing solution is housed in the tank 16*e*. An electromagnetic valve coupled to the tap water line may be used instead of the tank 16*e*. Alternatively, both of the tank 16*e* and the electromagnetic valve may be used. The mechanism (e.g., a pump) for spraying the housed sterilization solution etc. is built in the tank 16*e*. When the lid 7*b* is closed, the sterilization/cleansing nozzle 16*d* is disposed on the lid 7*b* such that the exposed pressing unit 4*a* is positioned below the sterilization/cleansing nozzle 16*d*. When the lid detection sensor 16*g* detects that the lid 7*b* is closed, the control unit 13 of the buttocks wiping device 1 exposes the wiping arm 4 through the hole 7*a*, and the spray mechanism of the tank 16*e* is driven to spray the sterilization solution and/or the cleansing solution from the sterilization/cleansing nozzle 16*d* through the pipe 16*f*. In this manner, the pressing unit 4*a* is sterilized and/or cleansed. When the mechanism for sterilization etc. can be provided at the lid 7*b* as described above, sterilization etc. of the pressing unit 4*a* can be performed by a simple structure.

Figure 37:
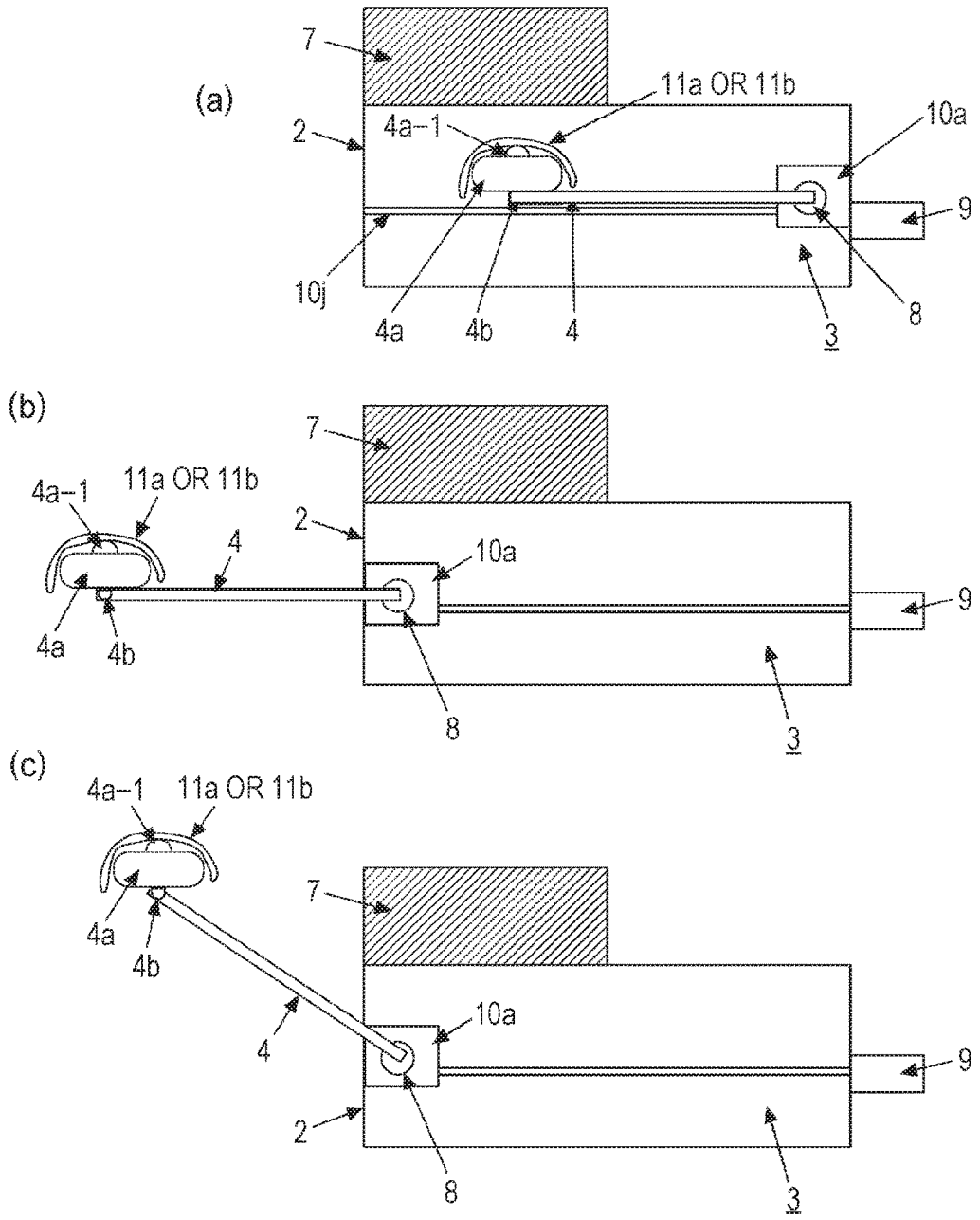
FIG. 37 is a front view of another mechanism in the case of exposing a wiping arm 4 by sliding as in the first, third, and fourth embodiments.

FIG. 37 is a front view of another mechanism in a case where the wiping arm 4 is slid and exposed as in the first, third, and fourth embodiments. As illustrated in FIG. 37(*a*), a screw shaft 10*j* is rotated by rotation of the exposure motor 9 in the wiping arm drive unit 3. The seat 10*a* is provided with a screw hole, and balls are built in the screw hole. Thus, the screw shaft 10*j* and the seat 10*a* form a ball screw. Note that the balls are not essential, and sliding can be performed even when the screw shaft 10*j* and the screw hole of the seat 10*a* merely form a mechanism called a trapezoidal screw or a sliding screw. The seat 10*a* is slidably supported on the raised portion 2 by, e.g., a not-shown sliding shaft. When the exposure motor 9 rotates, the seat 10*a* slides, and the upper-to-lower motor 8 and the wiping arm 4 coupled to the upper-to-lower motor 8 slide accordingly. The wiping arm 4 may has an extendable structure.

As illustrated in FIG. 37(*b*), the wiping arm 4 is exposed in association with rotation of the exposure motor 9. As illustrated in FIG. 37(*c*), the upper-to-lower motor 8 rotates to incline the wiping arm 4 to the upward direction. Because of the presence of the hinge portion 4*b*, the raised portion 4*a*-1 of the pressing unit 4*a* contacts the vicinity of the anus with the raised portion 4*a*-1 being held horizontal. In this state, wiping is executed. After wiping, the wiping arm 4 is bent by the electromagnet 4*c*, and therefore, the paper 11*a* or the special paper 11*b* drops.

As described above, various mechanisms for exposing the wiping arm 4 are conceivable, but are not intended to limit the present invention. The sliding mechanism using the ball screw is a well-know n mechanism in practical use, and there is much technical information on such a mechanism. In practical use of the buttocks wiping device 1, employment of such a mechanism can be considered.

Figure 38:
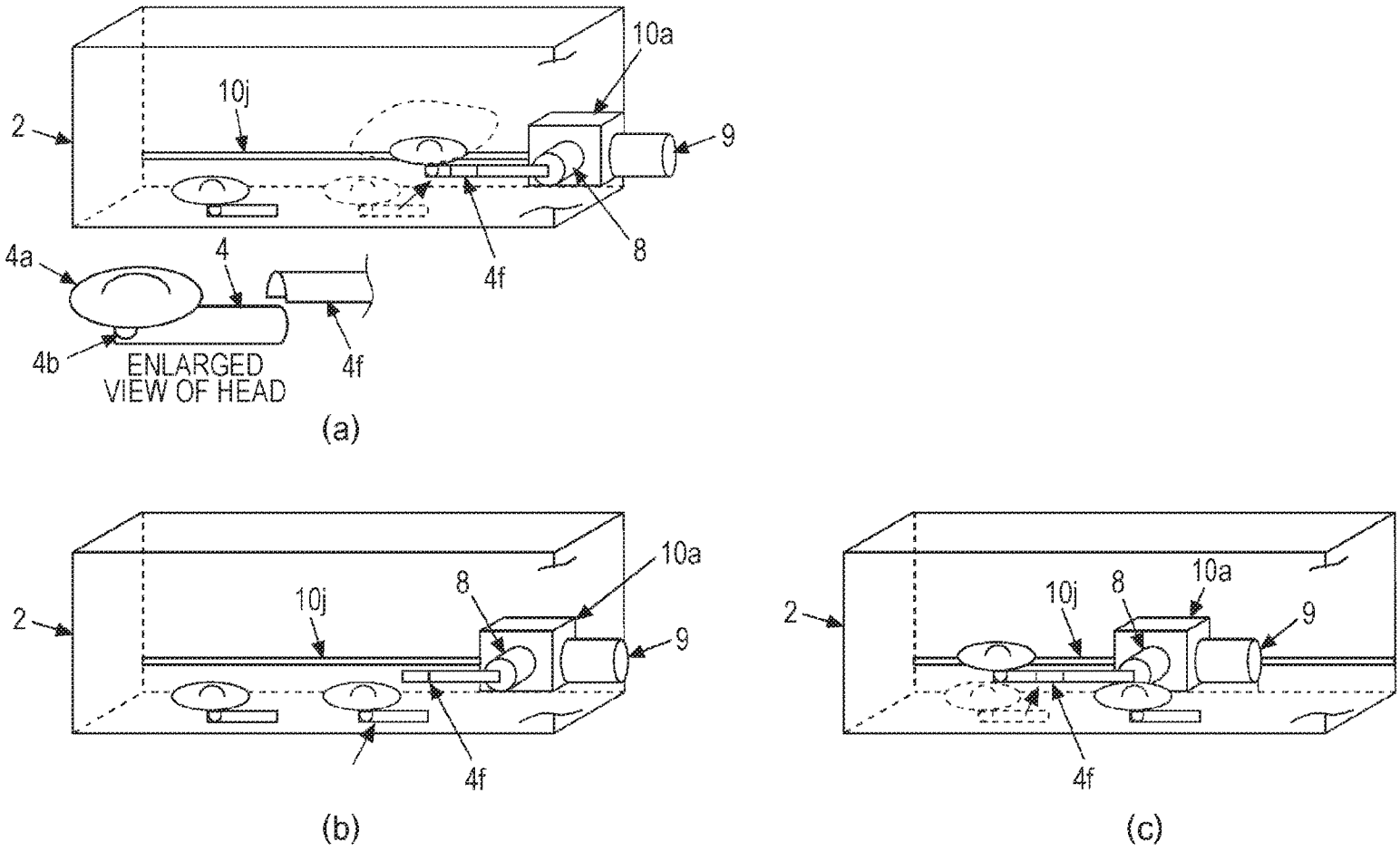
FIG. 38 is a conceptual view of the buttocks wiping device 1 configured such that a plurality of wiping arms 4 are in a standby state and are subjected to cleansing, sterilization, and drying.

FIG. 38 is a conceptual view of the buttocks wiping device 1 configured such that a plurality of wiping arms 4 are in a standby state and are subjected to cleansing, sterilization, and drying. An attachment unit 4*f* is provided at the rotary shaft of the upper-to-lower motor 8. The attachment unit 4*f* is, e.g., a parallel hand, an electromagnet, or a clip-type holding unit. A replacement wiping arm 4 in the standby state can be attached to the attachment unit 4*f*. As illustrated in FIG. 38(*a*), the attachment unit grips the single wiping arm 4 upon wiping. In this example, the attachment unit 4 and/or the wiping arm 4 may or may not be of an extendable type. Operation by the exposure motor 9, the upper-to-lower motor 8, and the screw shaft 10*j* is similar to that of FIG. 37.

The replacement wiping arm 4 is configured to be placeable on a movement path of the attachment unit. As illustrated in FIG. 38(*b*), when wiping is completed, the wiping arm 4 is detached from the attachment unit 4*f*, and is sterilized, cleansed, and dried by not-shown sterilization, cleansing, and drying devices. Next, when wiping is performed, the wiping arm 4 in the standby state is attached to the attachment unit 4 as illustrated in FIG. 38(*c*), and then, wiping is executed.

As described above, the wiping arm 4 is replaceable.

Figure 39:
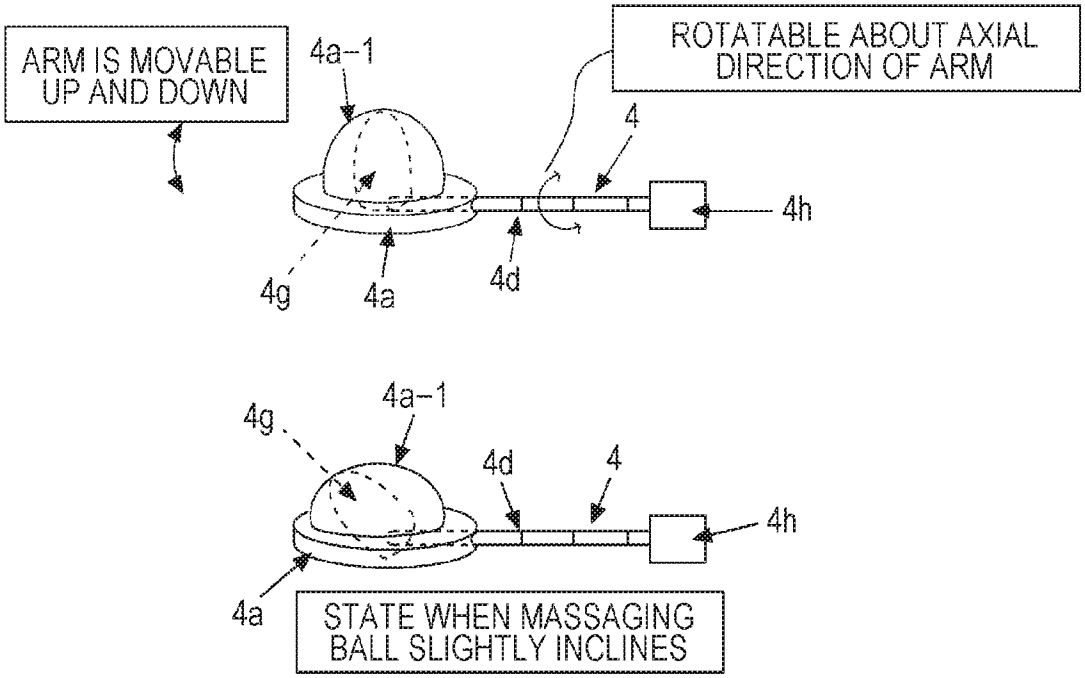
FIG. 39 is a conceptual view for describing the wiping arm 4 configured such that the height of a raised portion 4*a*-1 of the pressing unit 4*a* moves up and down.

FIG. 39 is a conceptual view for describing the wiping arm 4 configured such that the height of the raised portion 4*a*-1 of the pressing unit 4*a* moves up and down. As illustrated in FIG. 39, the raised portion 4*a*-1 is a soft head made of, e.g., silicon resin. A rotary body 4*g* is provided inside the raised portion 4*a*-1, and the arm shaft is attached at an eccentric position as in a massaging ball of a massaging device. The arm itself rotates so that the raised portion 4*a*-1 can move up and down as in the massaging ball of the massaging device. The wiping arm 4 may be of the extendable type. A biaxial drive mechanism 4*h* including an upper-to-lower motor configured to move the wiping arm 4 up and down and further including a motor configured to rotate the wiping arm 4 about an axial direction thereof is attached to one end of the wiping arm 4. When the motors of the biaxial drive mechanism 4*h* rotate, the rotary body 4*g* operates to rotate and turn up and down in the right-to-left direction. Thus, the height of the raised portion 4*a*-1 moves up and down. When the raised portion 4*a*-1 is made of the soft material such as silicon resin, the pressing unit 4*a* can be softly fitted to the anus while the moisture etc. in the vicinity of the anus can be gently and carefully wiped by movement of the rotary body 4*g*.

The variations described above are also applicable to other embodiments than the first to fourth embodiments.

Sixth Embodiment

Figure 40:
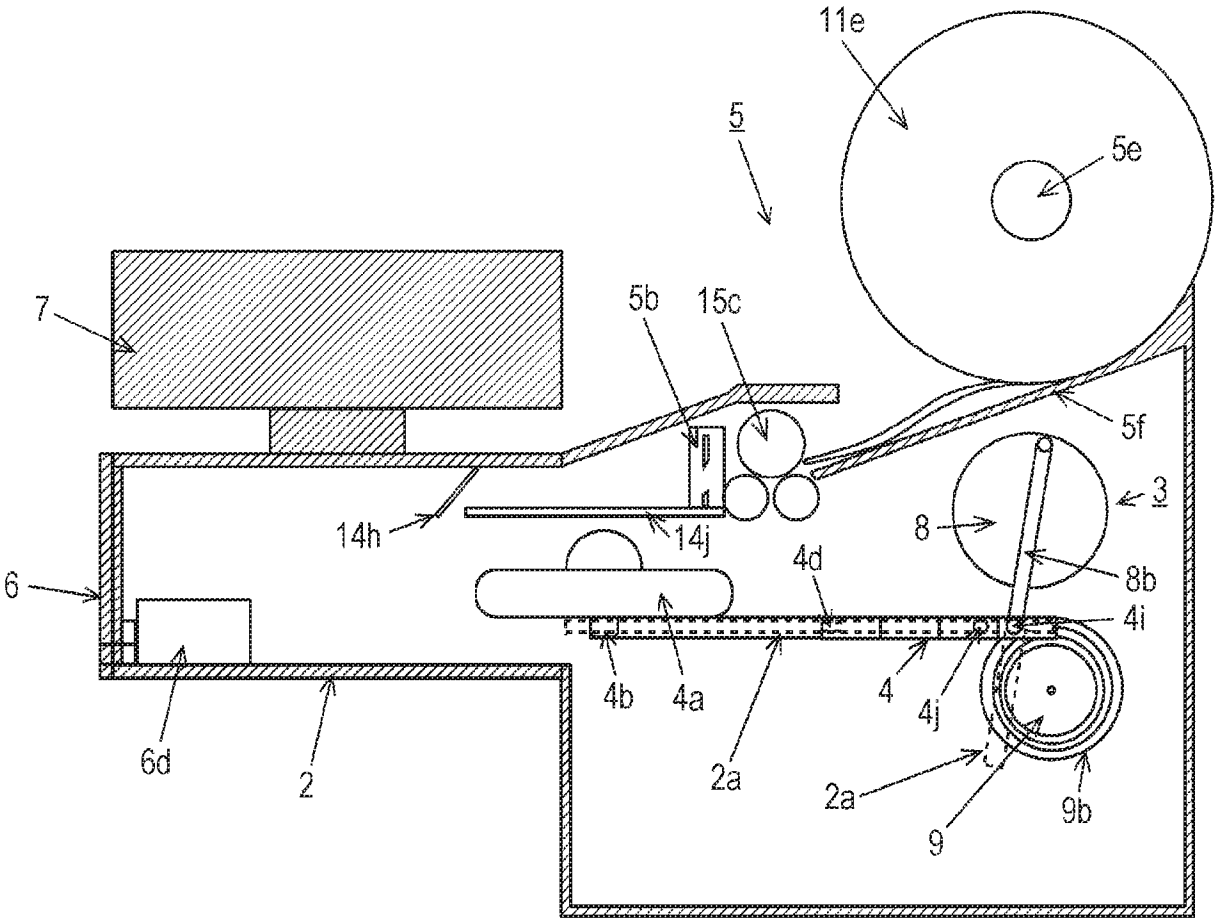
FIG. 40 is a front view of a wiping arm 4 upon retraction.
Figure 41:
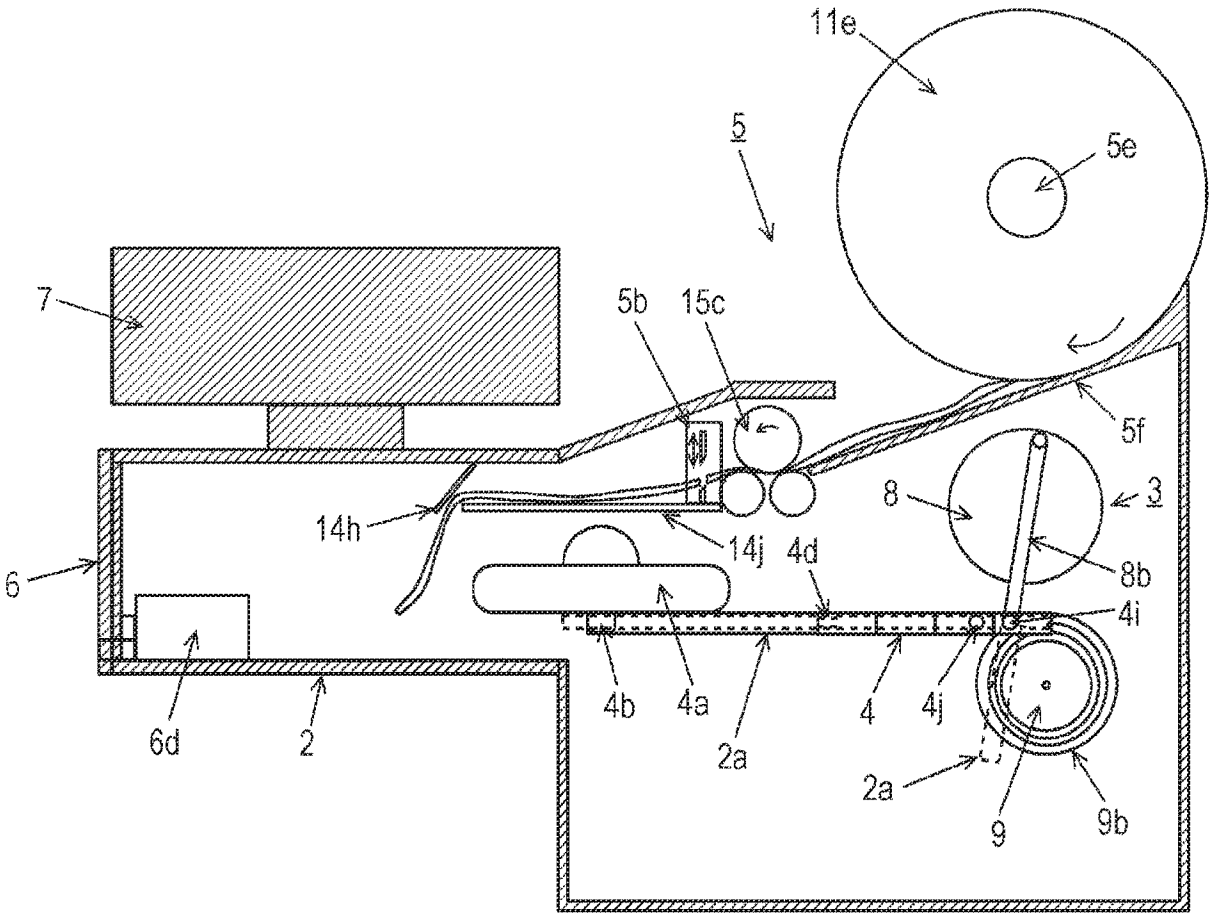
FIG. 41 is a front view after paper has been delivered.
Figure 42:
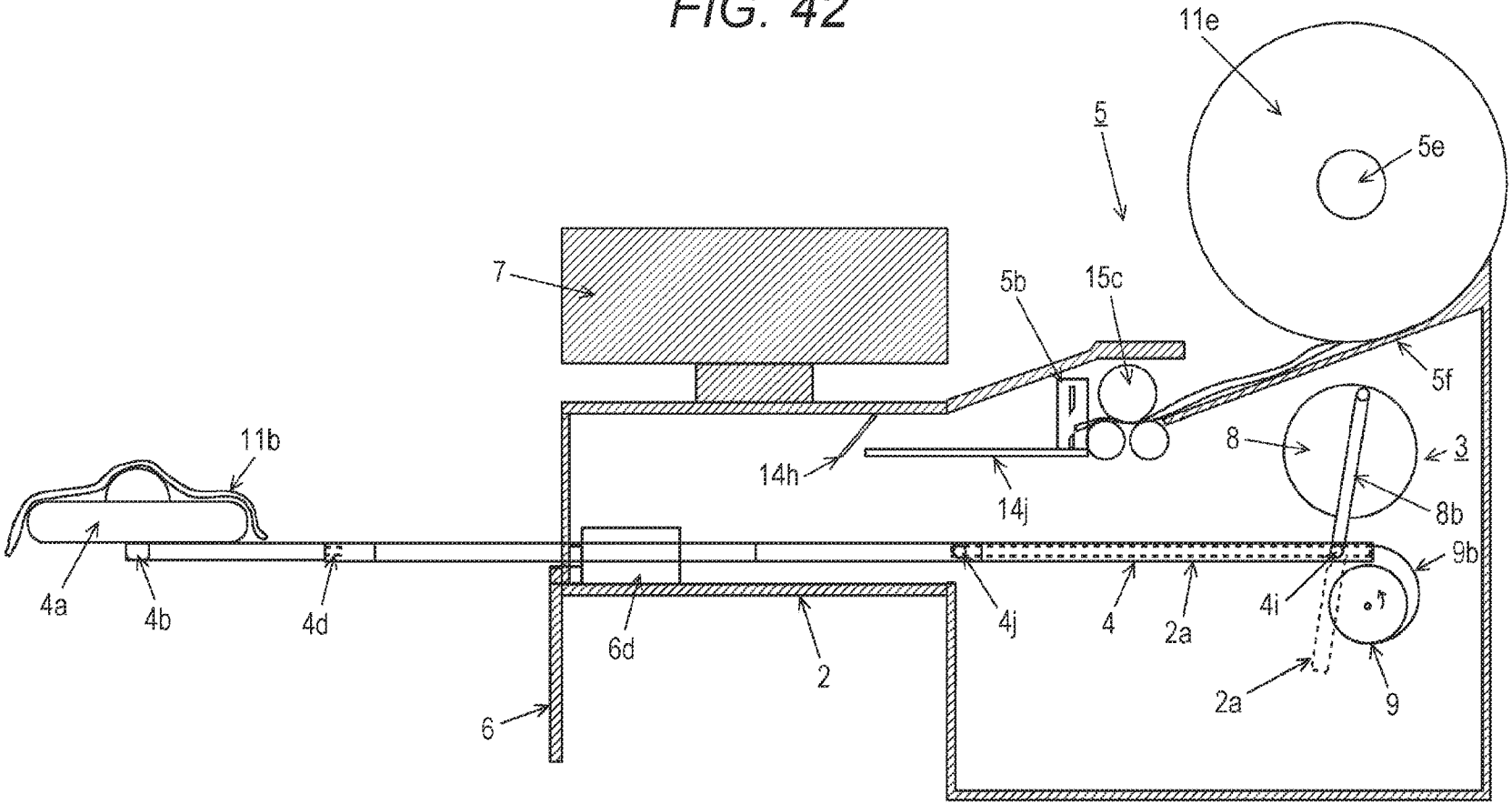
FIG. 42 is a front view of the wiping arm 4 upon exposure.
Figure 43:
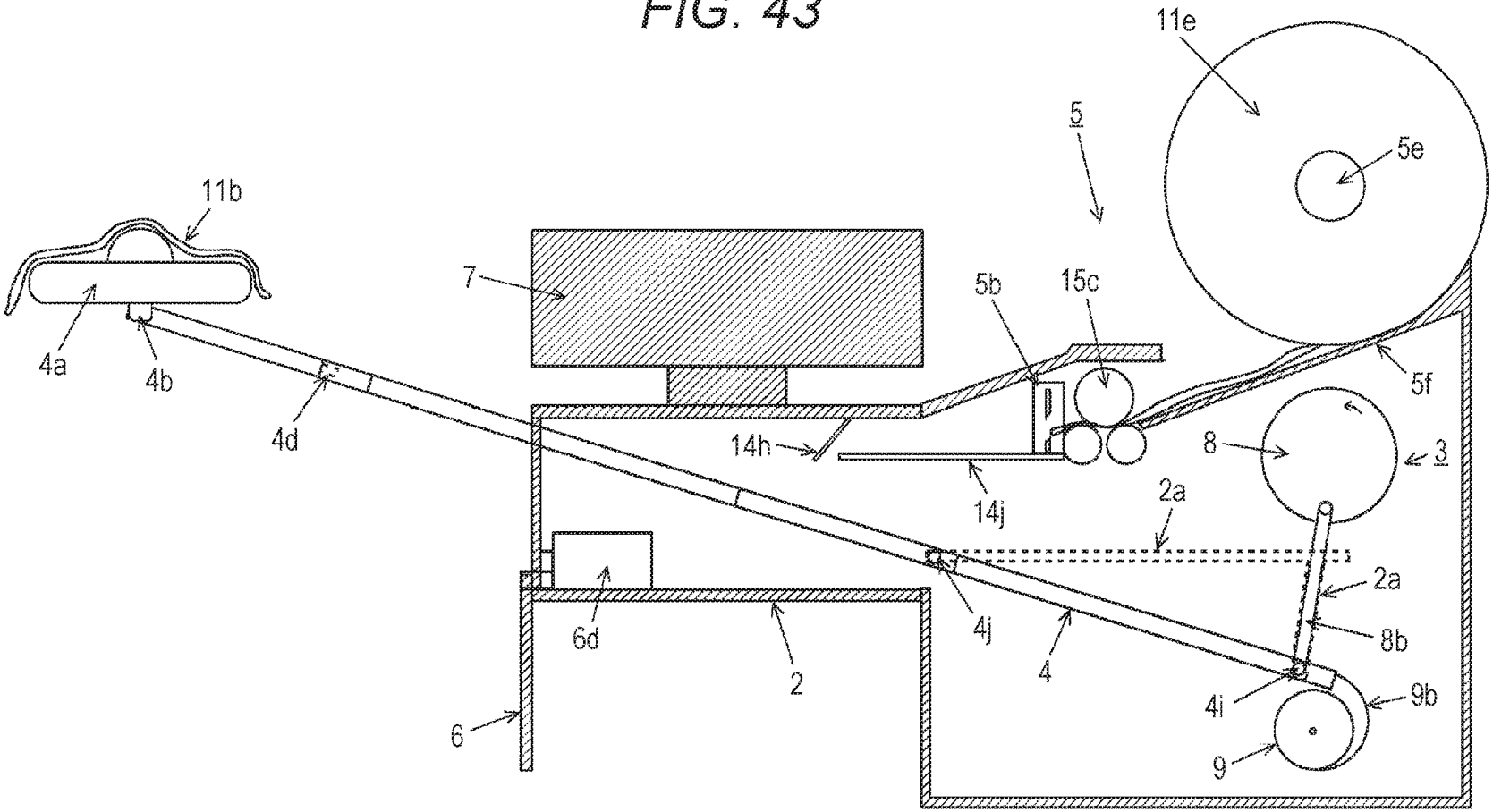
FIG. 43 is a front view upon wiping.

In a sixth embodiment, a buttocks wiping device 1 including a wiping arm 4 equipped with an extendable mechanism will be described. The buttocks wiping device 1 of the sixth embodiment is configured such that the wiping arm 4 has the extendable structure. FIG. 40 is a front view of the wiping arm 4 upon retraction. FIG. 41 is a front view after paper has been delivered. FIG. 42 is a front view of the wiping arm 4 upon exposure. FIG. 43 is a front view upon wiping. As illustrated in FIG. 40, the wiping arm 4 includes a nested extendable arm, and a wire 9*b* penetrates the wiping arm 4. One end of the wire 9*b* is attached to a tip end of the nested extendable arm, and the other end of the wire 9*b* is winded around a winding portion attached to a rotary shaft of an exposure motor 9. The nested extendable arm is extended and contracted by winding and unwinding of the wire 9*b*.

A pin 4*j* protrudes from the wiping arm 4. The pin 4*j* is inserted into a groove 2*a* provided at a raised portion 2. The pin 4*j* allows the wiping arm 4 to slide without inclination. The structures of a pressing unit 4*a*, a hinge portion 4*b*, and a coupling portion 4*d* are similar to those described with reference to FIG. 26. Note that an electromagnet 4*c* may or may not be provided, but illustration is made without the electromagnet 4*c*.

Rolled paper 11*e* used for an automatic paper supply unit 5 is a roll of paper having a certain thickness. The rolled paper 11*e* is rotatably attached to a holder 5*e* of the automatic paper supply unit 5, and is placed on a table 5*f*. An end of the rolled paper 11*e* is supplied to upper and lower paper feeding rollers 15*c*. Although not shown in the figure, a sensor is provided for the paper feeding rollers 15*c*. When the rolled paper 11*e* is supplied, the paper feeding rollers 15*c* are rotated by a not-shown motor. The paper delivered by the paper feeding rollers 5*c* advances in a cutting unit 5*b*, and then, is placed on a table 14*j*. Then, the paper comes into contact with the guide 14*h*, and hangs down from the table 14*j*. In this manner, a predetermined length of rolled paper 11*e* is delivered and cut. Determination on whether or not the paper reaches the predetermined length can be made by detection of the number of rotations of each paper feeding roller 15*c* by the sensor. When the predetermined length of rolled paper 11*e* is delivered, the paper feeding rollers 15*c* are stopped, and then, the cutting unit 5*b* configured to cut the paper by upper and lower blades is actuated to cut the rolled paper 11*e*. As described above, a single piece of special paper 11*b* having a thickness resistant to wiping is set on the table 14*j* (FIG. 41). Note that when the paper feeding rollers 15*c* rotate, the rolled paper 11*e* is delivered by natural rotation. Thus, a motor configured to rotate the rolled paper 11*e* is not necessarily provided, but may be provided.

As illustrated in FIG. 42, when the exposure motor 9 rotates to extend the wire 9*b* by pushing, the nested extendable arm extends such that the pressing unit 4*a* is exposed. In this state, the pin 4*j* reaches an end of the groove 2*a*. Note that an exposed position detection sensor may be provided to detect whether or not the pressing unit 4*a* reaches an exposed position. Note that a belt including a rack or a flexible rack may be used instead of the wire 9*b*. In any case, the present invention is not limited as long as the mechanism configured to extend and contract the wiping arm 4 is provided.

As illustrated in FIG. 43, when an upper-to-lower motor 8 rotates, a pin 4*i* attached to a tip end of a rod 8*b* attached at an eccentric position moves along the groove 2*a*. Accordingly, the wiping arm 4 inclines to the upward direction about the pin 4*j* as a supporting point. Note that in this example, such a crank mechanism is utilized as the mechanism configured to incline the wiping arm 4 to the upward direction, but a rotary shaft of the upper-to-lower motor may be directly attached to one end of the wiping arm 4 for upper-to-lower movement. The mechanism for upper-to-lower movement is not intended to limit the present invention.

As illustrated in FIG. 43, the hinge 4*b* allows the pressing unit 4*a* in a horizontal state to come into contact with the anus, and therefore, moisture etc. are absorbed by the special paper 11*b*. In the case of discarding the special paper 11*b*, the upper-to-lower motor 8 may slightly move with the wiping arm 4 being held horizontal, thereby shaking off the special paper 11*b*. Alternatively, in the case of using the electromagnet 4*c*, the electromagnet 4*c* may be magnetized in a reverse direction to bend the arm, thereby naturally dropping the paper. After the special paper 11*b* has been discarded, the upper-to-lower motor 8 rotates to bring the arm into the horizontal state. Then, the exposure motor 9 rotates to wind the wire 9*b*, thereby shortening the extendable arm. In this manner, the pressing unit is retracted into the raised portion 2.

Note that because of the presence of the hinge portion 4*b*, the pressing unit 4*a* can be inclined by, e.g., a piston. Thus, the paper may be dropped in such a manner that the pressing unit 4*a* is inclined by, e.g., the piston.

In the fifth embodiment, the raised portion does not include an electric mechanism configured to drive the arm, and therefore, a wiping arm drive unit 3 can be kept out of water. In addition, when the extendable arm can be used, protrusion toward the side of a toilet seat can be suppressed minimum, and therefore, the size of the buttocks wiping device 1 can be reduced.

An opening/closing motor 6*d* used for an opening/closing unit 6 can be, by covering, kept out of water, and therefore, the entirety of the device can be waterproofed.

A lid is provided at the raised portion 2 for a paper jam and various types of sanitation, and therefore, the lid is opened so that the paper jam etc. can be easily cleared even by a user and that the pressing unit 4*a* can be held in a sanitary manner. Moreover, the wiping arm drive unit 3 is provided below the automatic paper supply unit 5 so that a complicated mechanism can be hidden from the user. The pressing unit 4*a* does not include an electric mechanism and a complicated start-up mechanism, and therefore, sanitation of the pressing unit 4*a* can be easily provided even by the user. Further, the pressing unit 4*a* can be easily detached by the coupling portion 4*d*, and therefore, the sanitary pressing unit 4*a* can be easily provided.

(One Example of Structure of Opening/Closing Unit 6)

Figure 101:
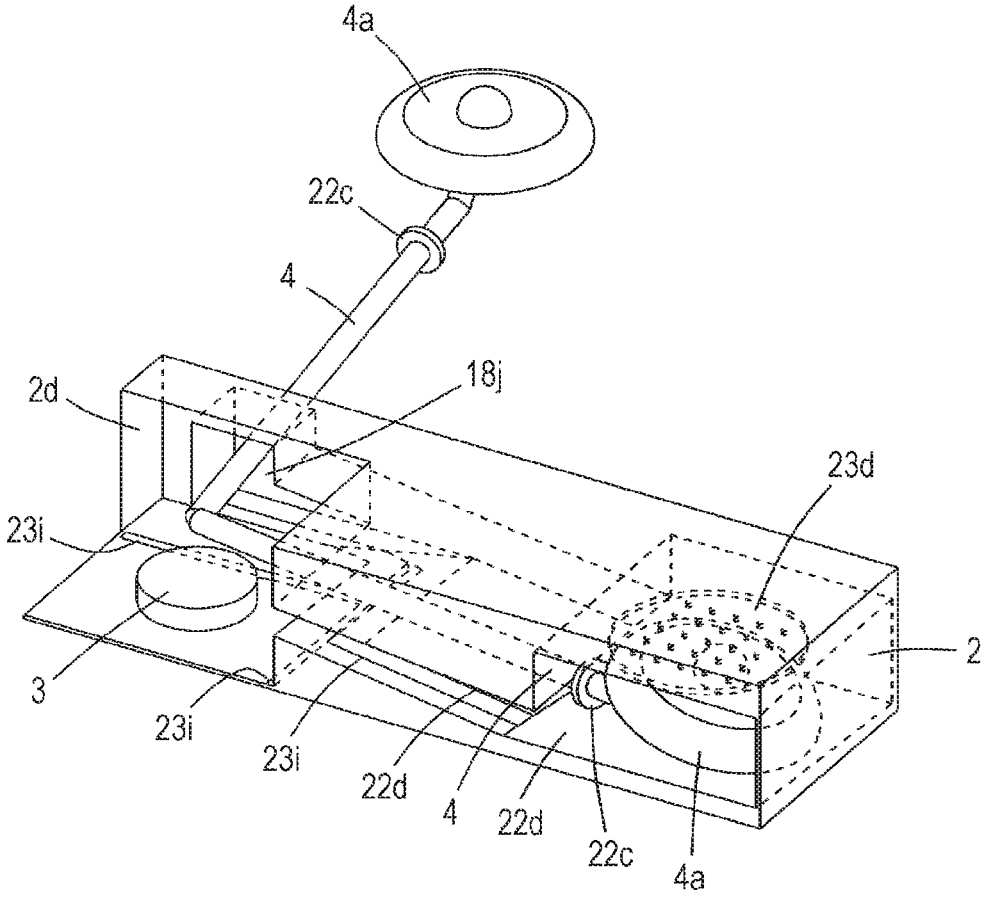
FIG. 101 is a view of an example of the structure of a housing portion 2*d* for housing the wiping arm 4 and the wiping arm drive unit 3.
Figure 102:
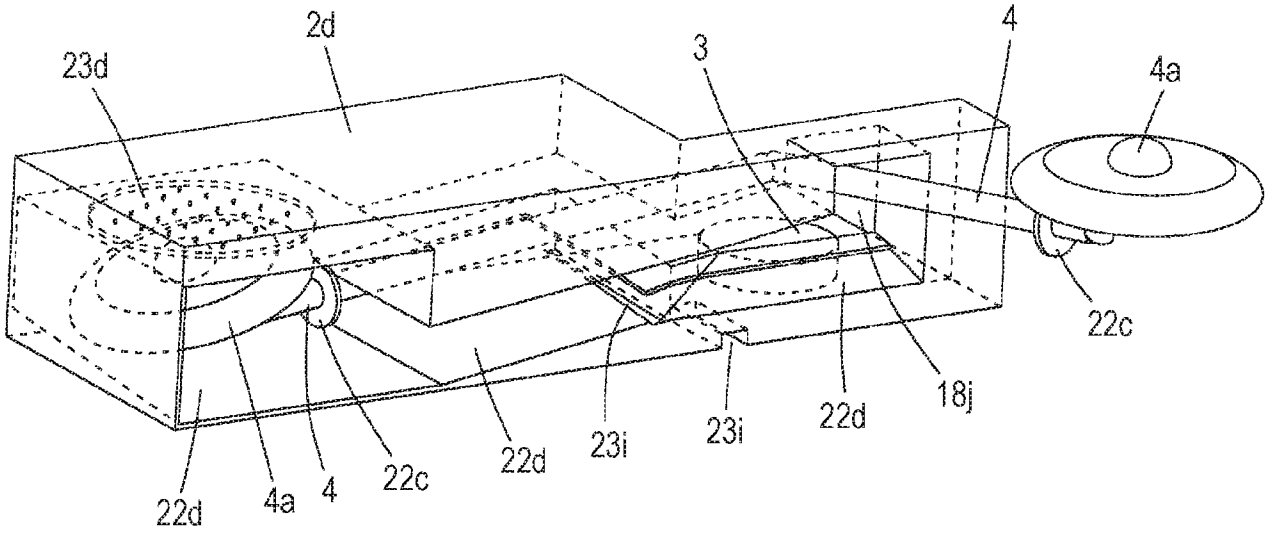
FIG. 102 is a perspective view of the housing portion 2*d* of FIG. 101 from another angle.

Note that an example of the specific structure of the opening/closing unit 6 will be described herein. The shape of the opening/closing unit 6 will be described below as a flat shape, and needless to say, may be curved to fit the shape of a toilet bowl, a toilet seat 7, or the raised portion 2. The shape of the raised portion 2 is not necessarily curved to fit the shape of the toilet seat 7. Specifically, the size of the buttocks wiping device 1 disclosed in the present specification can be reduced. Thus, a portion of the raised portion 2 where the wiping arm 4 is exposed does not open in a curved shape, but may open in a linear planar shape. On this point, the raised portion 2 in a linear shape as illustrated in FIGS. 101 and 102 described later is conceivable as an example. In light of such a point, the example of the structure of the opening/closing unit 6 will be described with reference to FIGS. 44, 45, and 46.

Figure 44:
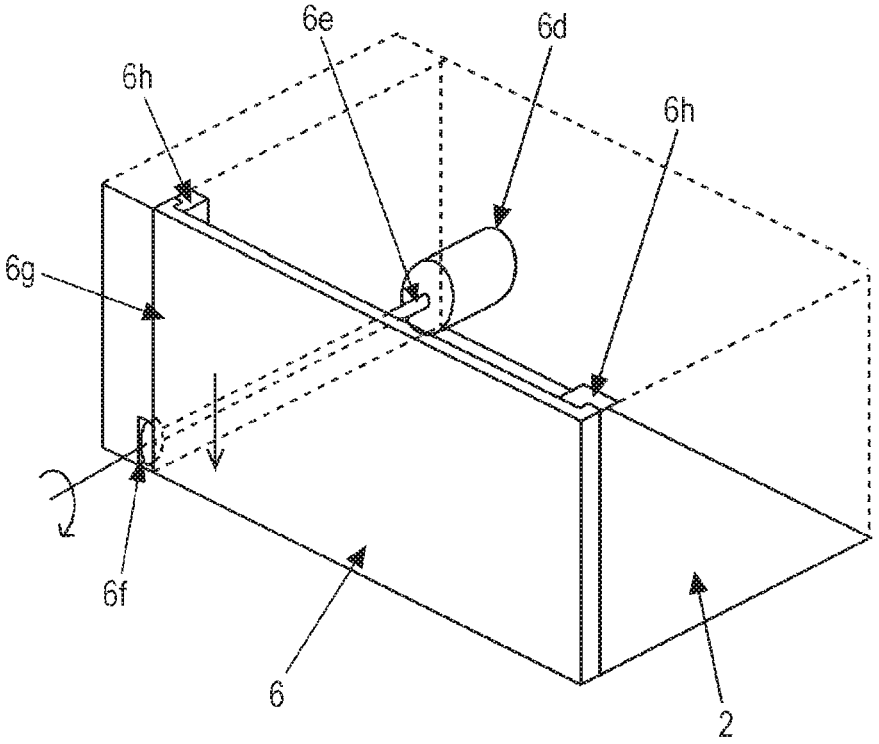
FIG. 44 is a perspective view of an opening/closing unit 6 configured to open/close in the upper-to-lower direction.

FIG. 44 is a perspective view of the opening/closing unit 6 configured to open/close in the upper-to-lower direction. One (the left side in the figure) of right and left end sides of the opening/closing unit 6 serves as a rack 6*g*, and is coupled to a pinion 6*f*. The opening/closing unit 6 is inserted into holding guides 6*h* provided at the raised portion 2, and therefore, is slidable. The pinion 6*f* is coupled to a rotary shaft 6*e* coupled to the opening/closing motor 6*d*. When the opening/closing motor 6*d* rotates, the pinion 6*f* rotates, and accordingly, the rack 6*g* moves to slide the opening/closing unit 6 up and down. The opening/closing motor 6*d* is, using the rotary shaft, disposed on the outside of the raised portion 2 or at a location less exposed to water, and therefore, waterproofing can be realized. Note that the position of the opening/closing motor 6 may be inverted horizontally.

Figure 45:
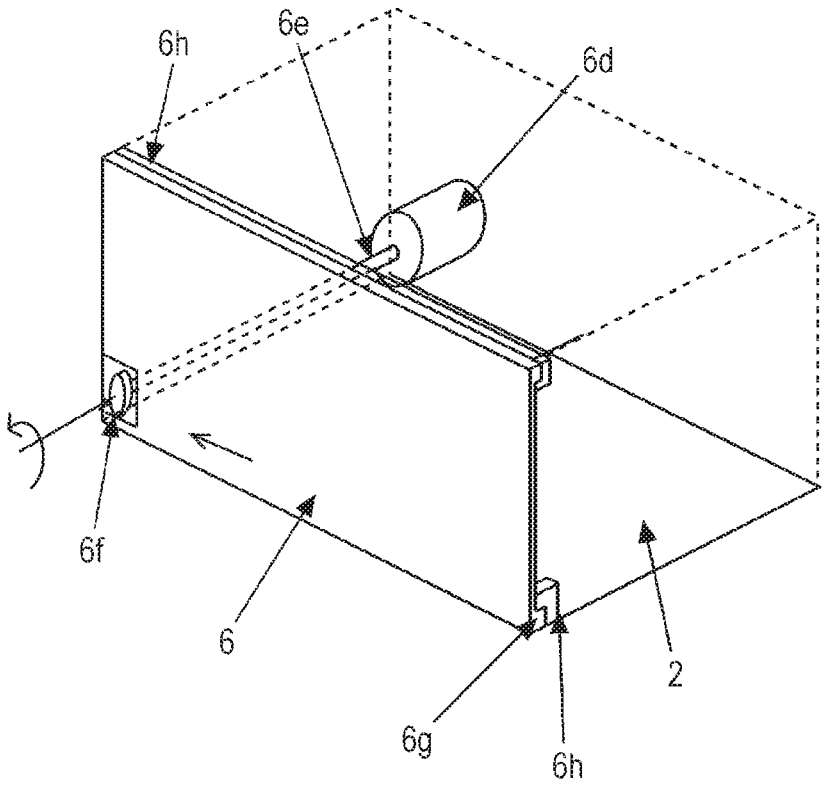
FIG. 45 is a perspective view of an opening/closing unit 6 configured to open/close in the right-to-left direction.

FIG. 45 is a perspective view of the opening/closing unit 6 configured to open/close in the right-to-left direction. One (the lower side in the figure) of upper and lower end sides of the opening/closing unit 6 serves as the rack 6*g*, and is coupled to the pinion 6*f*. The opening/closing unit 6 is inserted into the holding guides 6*h* provided at the raised portion 2, and therefore, is slidable. The pinion 6*f* is coupled to the rotary shaft 6*e* coupled to the opening/closing motor 6*d*. When the opening/closing motor 6*d* rotates, the pinion 6*f* rotates, and accordingly, the rack 6*g* moves to slide the opening/closing unit 6 right to left. The opening/closing motor 6*d* is, using the rotary shaft, disposed on the outside of the raised portion 2 or at the location less exposed to water, and therefore, waterproofing can be realized. Note that the position of the opening/closing motor 6 may be inverted vertically.

Figure 46:
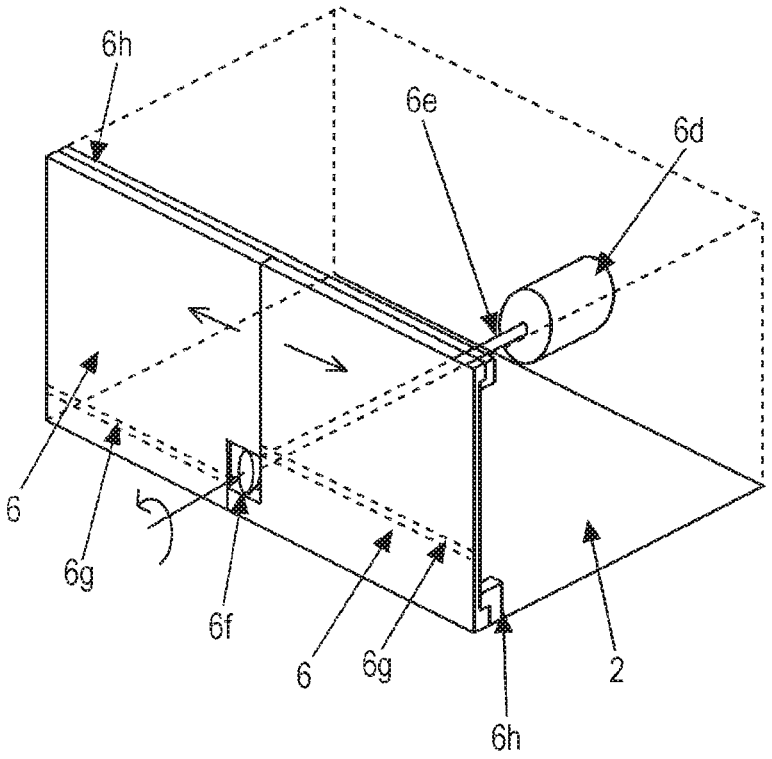
FIG. 46 is a perspective view of opening/closing units 6 configured to open/close separately in the upper-to-lower direction.

FIG. 46 is a perspective view of the opening/closing units 6 configured to open/close separately to the right and left sides. Two opening/closing units 6 are each provided with the rack 6*g*, and therefore, are coupled to the pinion 6*f*. The opening/closing units 6 are inserted respectively into the holding guides 6*h* provided at the raised portion 2, and therefore, are slidable. The pinion 6*f* is coupled to the rotary shaft 6*e* coupled to the opening/closing motor 6*d*. When the opening/closing motor 6*d* rotates, the pinion 6*f* rotates, and accordingly, the rack 6*g* also moves to separately slide the opening/closing units 6 to the right and left sides. The opening/closing motor 6*d* is, using the rotary shaft, disposed on the outside of the raised portion 2 or at the location less exposed to water, and therefore, waterproofing can be realized. Note that the position of the opening/closing motor 6 may be inverted vertically. Using a similar structure, the opening/closing units 6 may be configured to separate from each other to the upper and lower sides.

Seventh Embodiment

Figure 47:
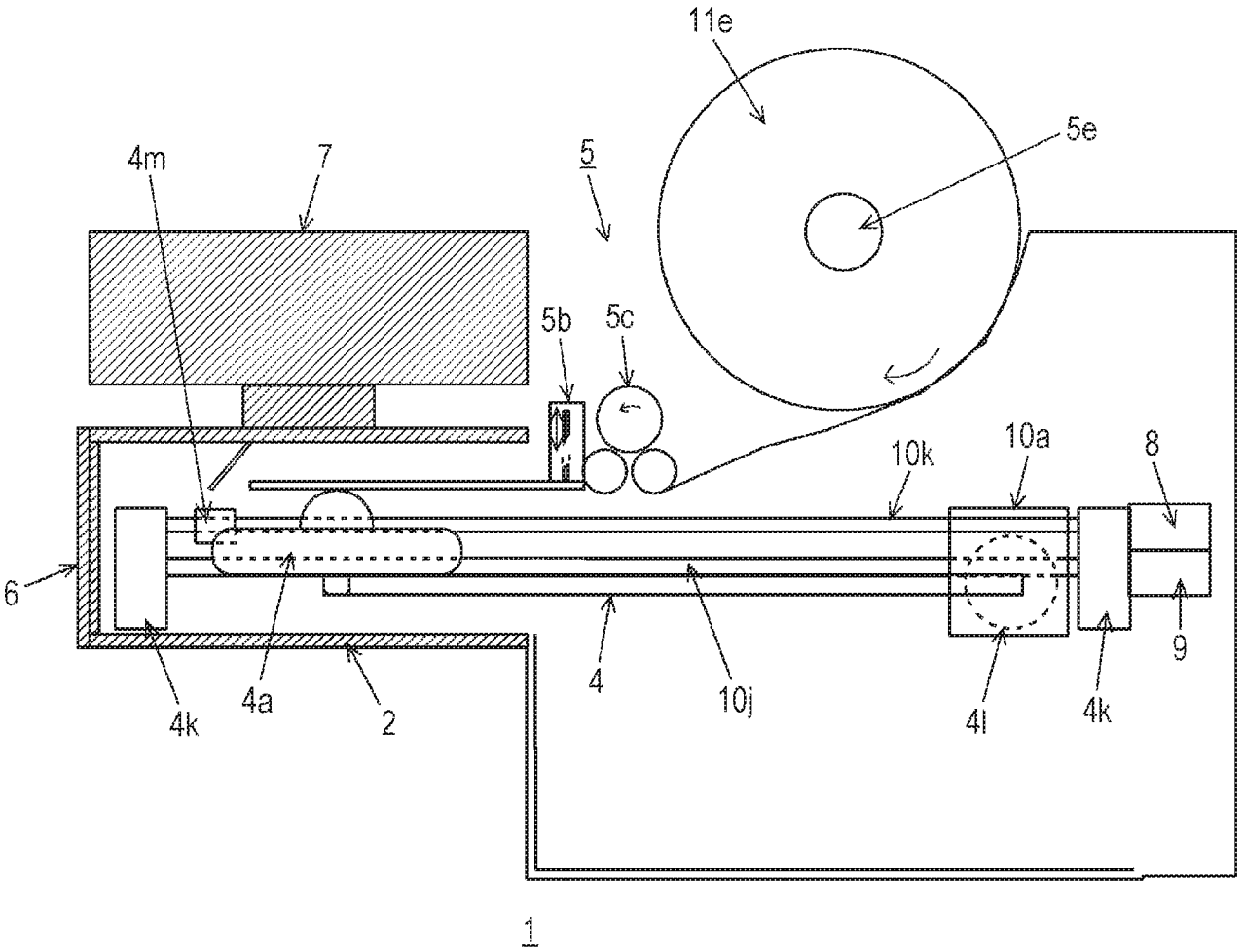
FIG. 47 is a front view (upon retraction) of an internal structure of a buttocks wiping device 1 in a seventh embodiment.
Figure 48:
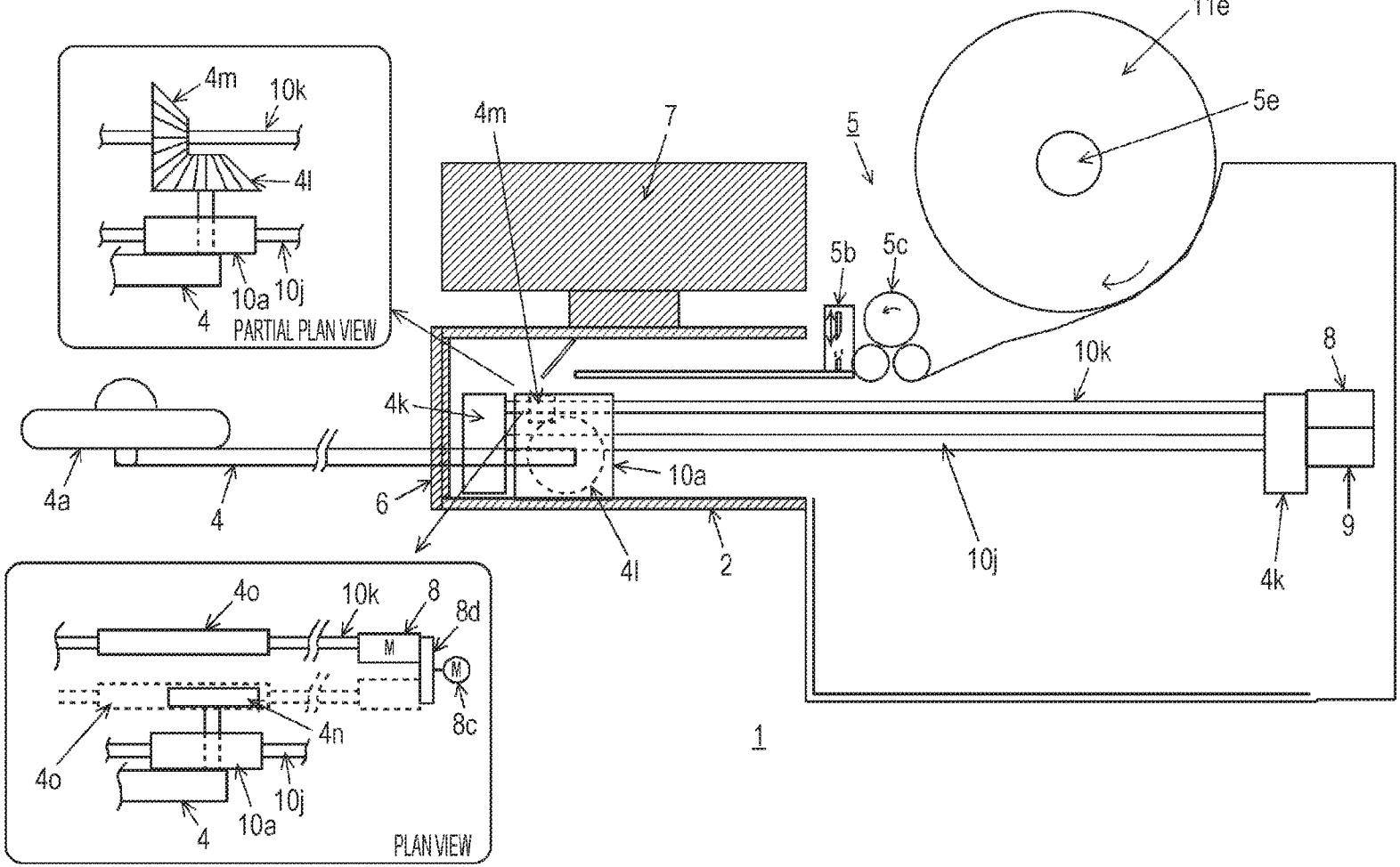
FIG. 48 is a front view (upon exposure) of the internal structure of the buttocks wiping device 1.

A seventh embodiment describes a variation of the embodiment illustrated in FIG. 37. FIG. 47 is a front view (upon retraction) of an internal structure of a buttocks wiping device 1 of the seventh embodiment. FIG. 48 is a front view (upon exposure) of the internal structure of the buttocks wiping device 1. In FIG. 47, the structure of an automatic paper supply unit 5 is similar to that in the case of the sixth embodiment. In the seventh embodiment, the structure for exposing a wiping arm 4 is, as in FIG. 37, a structure in which an exposure motor 9 rotates a screw shaft 10*j* supported on two bearings 4*k* to slide a seat 10*a*. In the seventh embodiment, a function of an upper-to-lower motor 8 is different. The upper-to-lower motor 8 is coupled to a shaft 10*k*. The shaft 10*k* is supported on the bearings 4*k*. A bevel gear 4*m* is fixed to the shaft 10*k* right before an opening/closing unit 6. When the upper-to-lower motor 8 rotates, the bevel gear 4*m* rotates. As illustrated in an enlarged view (an upper left view) of the bevel gear 4*m* of FIG. 48 upon exposure, a bevel gear 4*l* is rotatably coupled to the seat 10*a*. One end of the wiping arm 4 is fixed to a rotary shaft of the bevel gear 4*l*.

The screw shaft 10*j* passes through a screw hole provided at the seat 4*a*. When the exposure motor 9 rotates, the screw shaft 10*j* rotates to slide the seat 4*a*, and then, the wiping arm 4 is exposed. A view when reached an exposed position is illustrated in FIG. 48. When reached the exposed position, the bevel gear 4*m* and the bevel gear 4*l* engage with each other as illustrated in the upper left view of FIG. 48. Upon engagement, the upper-to-lower motor 8 rotates. When the upper-to-lower motor 8 rotates, the shaft 10*k* rotates, and therefore, the bevel gear 4*m* rotates. As a result, the bevel gear 4*l* rotates, and accordingly, the wiping arm 4 rotates. Thus, a pressing unit 4*a* can move in the upper-to-lower direction. With this structure, wiping and paper dropping can be realized. Note that for paper dropping, the wiping arm 4 may be bent by an electromagnet.

Note that in this example, the bevel gears 4*m*, 4*l* are used to move the wiping arm 4 up and down. However, as long as a transmission mechanism configured to convert rotation movement of the shaft 10*k* into movement perpendicular to the shaft 10*k* is provided, the present invention is not limited to the structure using the bevel gears 4*m*, 4*l*. For example, as illustrated in a lower left enlarged view of FIG. 48, a worm 4*o* may be used. That is, the worm 4*o* is fixed to the shaft 10*k*, and is configured to rotate upon rotation of the upper-to-lower motor 8. The upper-to-lower motor 8 is attached to a reply position of a circular plate 8*d*. The circular plate 8*d* is attached to a rotary shaft of a motor 8*c* (or a swing-type electromagnetic solenoid). Thus, when the circular plate 8*d* rotates, the upper-to-lower motor 8, the shaft 10*k*, and the worm 4*o* move in a direction indicated by a dashed line of the figure. At a stage at which the wiping arm 4 has reached the exposed position, when the worm 4*o* is moved to a position indicated by a dashed line, the bevel gear 4*m* and the worm 4*o* coupled to the wiping arm 4 engage with each other. Upon engagement, the upper-to-lower motor 8 rotates, and accordingly, the worm 4*o* and a worm wheel 4*n* rotate. Thus, the wiping arm 4 can move up and down. Note that a clutch mechanism configured to couple the worm wheel 4*n* and the worm 4*o* together is not limited to above.

It can be considered that these structures include a gear for moving the wiping arm 4 up and down at the stage at which the wiping arm 4 has reached the exposed position. With this structure, the upper-to-lower motor 8 can be disposed apart from the vicinity of the opening/closing unit 6 even upon exposure, and therefore, the upper-to-lower motor 8 can be waterproofed.

Figure 49:
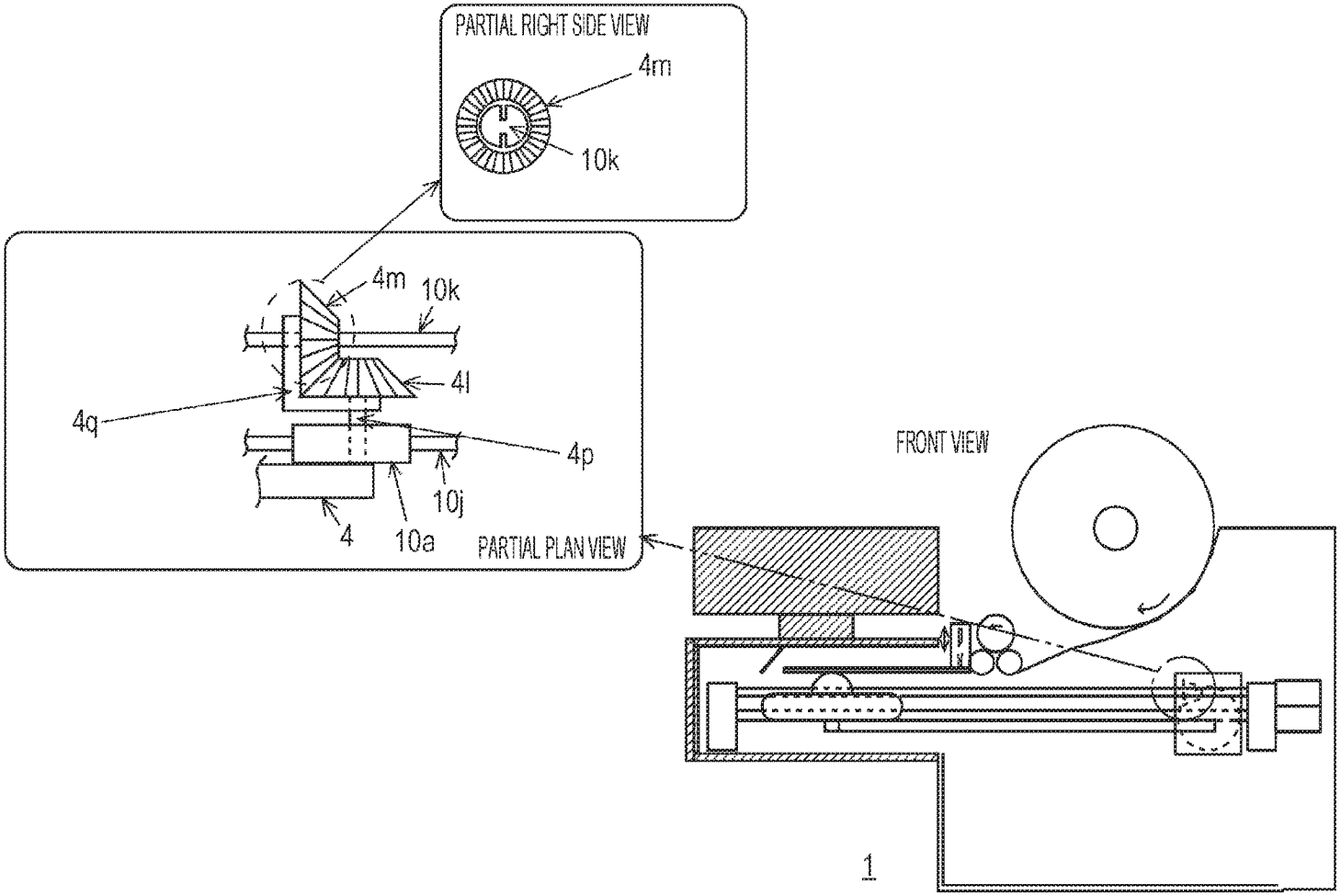
FIG. 49 is a view of a structure in the case of sliding a bevel gear 4*m* and a seat 10*a* together.
Figure 50:
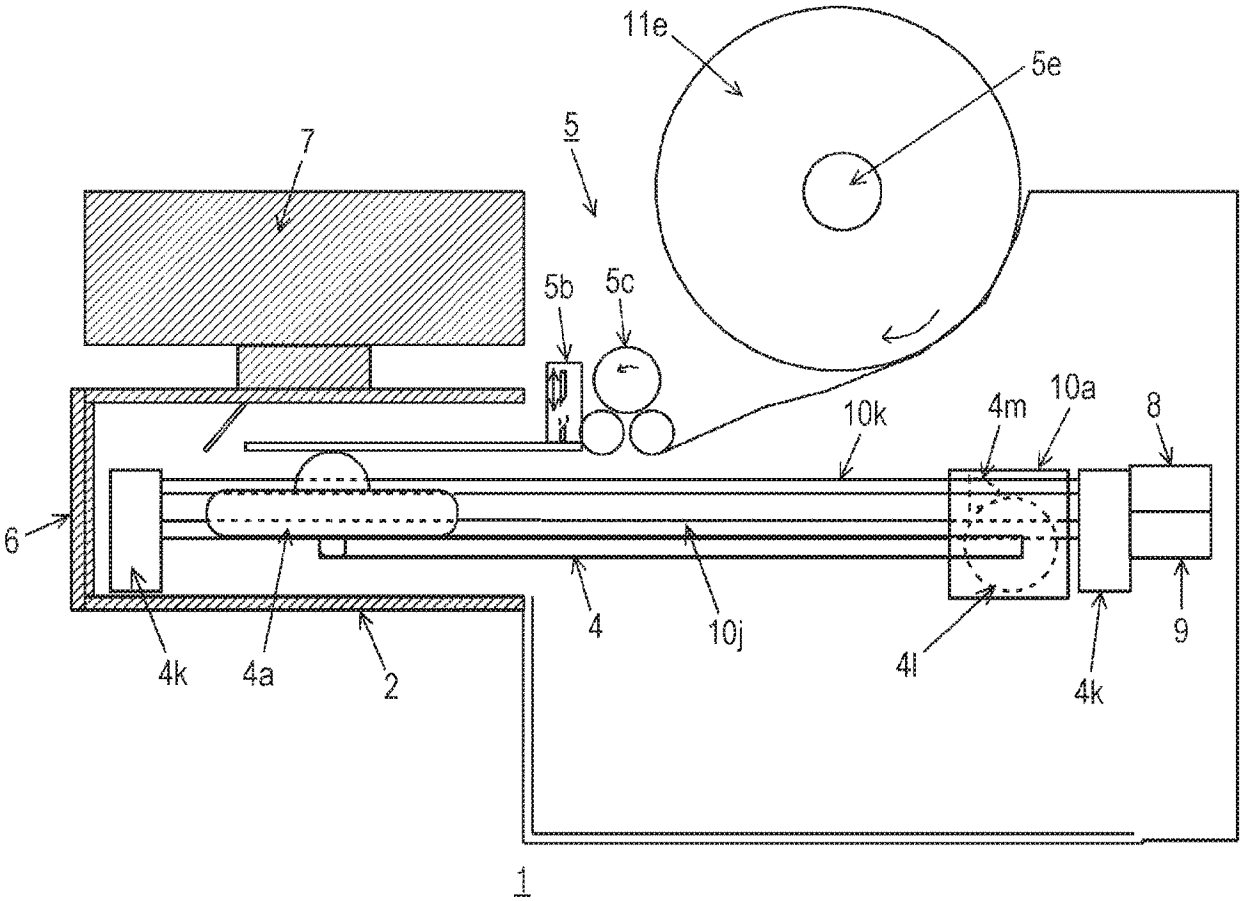
FIG. 50 is a view of the structure in the case of sliding the bevel gear 4*m* and the seat 10*a* together.

Note that FIGS. 49 and 50 are views of a structure in a case where the bevel gear 4*m* and the seat 10*a* slide together. As illustrated in an enlarged view of FIG. 49, a supporting portion 4*q* is fixed to a shaft 4*p* coupling the wiping arm 4 and the bevel gear 4*l* together. The bevel gear 4*m* is fixed to the supporting portion 4*g*. The bevel gear 4*l* and the bevel gear 4*m* slide in a constantly-coupled state. As illustrated in a partial right side view of FIG. 49, the bevel gear shaft 10*k* is provided with cutouts such that the bevel gear 4*m* rotates upon rotation of the shaft. Note that the shaft 10*k* may be a spline shaft or a hexagonal columnar shaft. The bevel gear 4*m* includes protrusions on the inside on which the shaft 10*k* is inserted, and has such a structure that the protrusions are fitted respectively into the cutouts of the shaft 10*k*. Note that cutouts may be formed on the inside of the bevel gear 4*m*, and protrusions may be formed at the shaft 10*k*. With this structure, the bevel gear 4*m* can slide together with the seat 10*a* while rotating in association with rotation of the upper-to-lower motor 8.

Note that after the seat 10*a* has been moved forward to the exposed position by the exposure motor 9, the bevel gear 4*m* may be pushed down by the clutch mechanism, and then, may be coupled to the bevel gear 4*l*, for example. Note that the bevel gear 4*m* and the bevel gear 4*l* may constantly engage with each other, the shaft 10*k* may have an extendable structure, and the bevel gear 4*m* and the bevel gear 4*l* may slide together during extension/contraction of the shaft 10*k*. Note that the upper-to-lower motor 8 and/or the exposure motor 9 may be lowered using, e.g., a gear.

As described above, in the seventh embodiment, the mechanism (e.g., the bevel gears 4*m*, 4*l* or the worm 4*o* and the worm wheel 4*n*) configured to convert rotation in the direction perpendicular to the shaft 10*k* of the upper-to-lower motor 8 is provided, and the wiping arm 4 is coupled to such a mechanism to move up and down. With this structure, the upper-to-lower motor 8 can be disposed at a location apart from a toilet seat opening, and therefore, the effect of waterproofing the upper-to-lower motor 8 is enhanced.

When rotation of the shaft 10*k* and rotation of the screw shaft 10*j* are switched using an electromagnetic clutch, the upper-to-lower motor 8 and the exposure motor 9 can be implemented by a single motor. That is, a wiping arm drive unit 3 includes the mechanism (e.g., the bevel gears 4*m*, 4*l* or the worm 4*o* and the worm wheel 4*n*) configured to convert rotation in the direction perpendicular to a rotary shaft (e.g., the screw shaft 10*j*) of the exposure motor 9, and therefore, the single common motor can be shared as the upper-to-lower motor 8 and the exposure motor 9 to switch, by the electromagnetic clutch etc., rotation of the rotary shaft used for exposure movement and rotation of the rotary shaft used for upper-to-lower movement. With this structure, the number of motors can be reduced, leading to cost and size reduction of the buttocks wiping device.

Eighth Embodiment

In an eighth embodiment, a buttocks wiping device 1 employing the second technique, i.e., the technique of wiping the buttocks in such a manner that paper is exposed below the buttocks separately from a wiping arm and a pressing unit of the wiping arm pushes up the exposed paper from below, will be described.

Figure 51A:
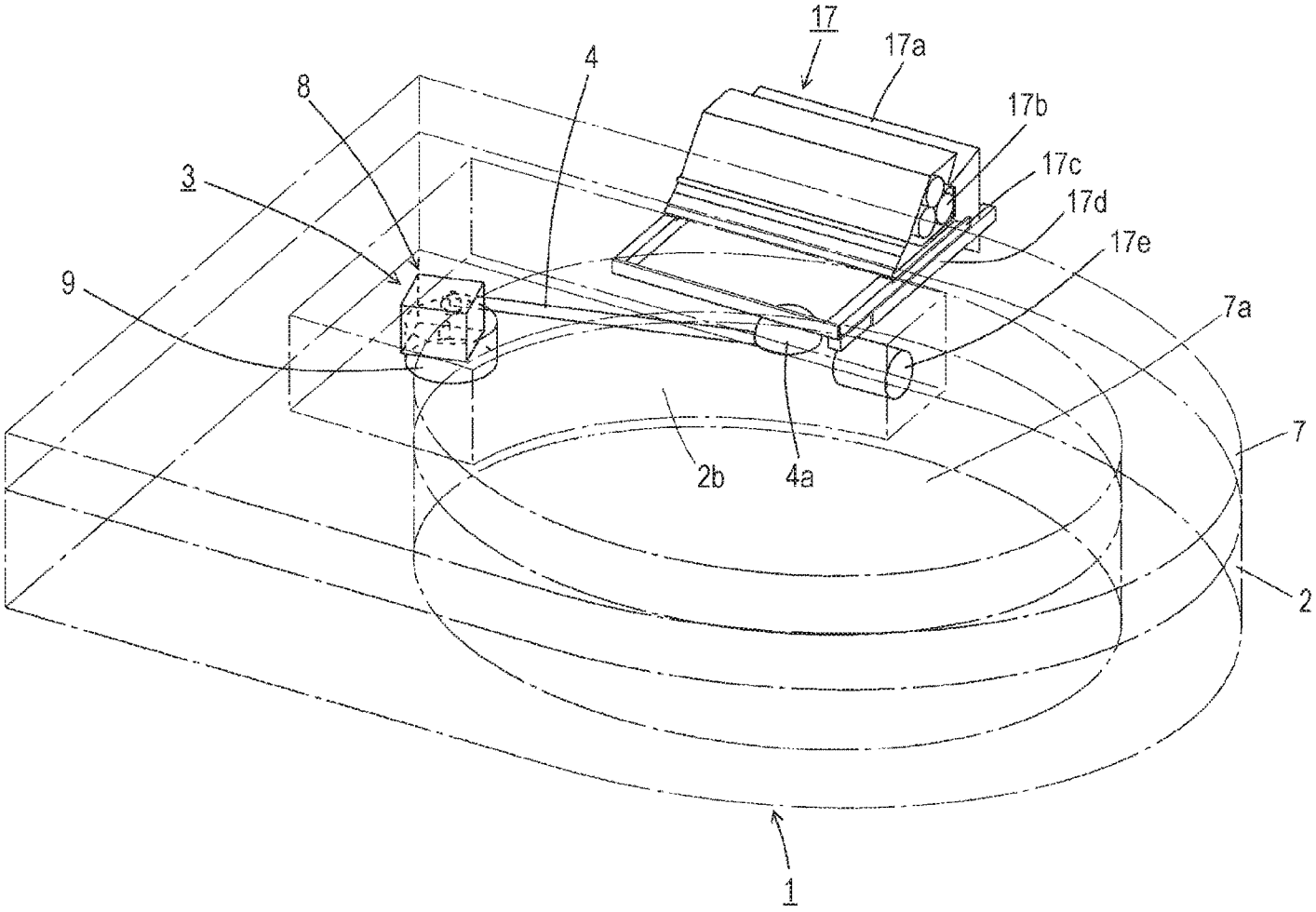
FIG. 51A is a perspective view of a buttocks wiping device 1 of an eighth embodiment of the present invention.
Figure 51B:
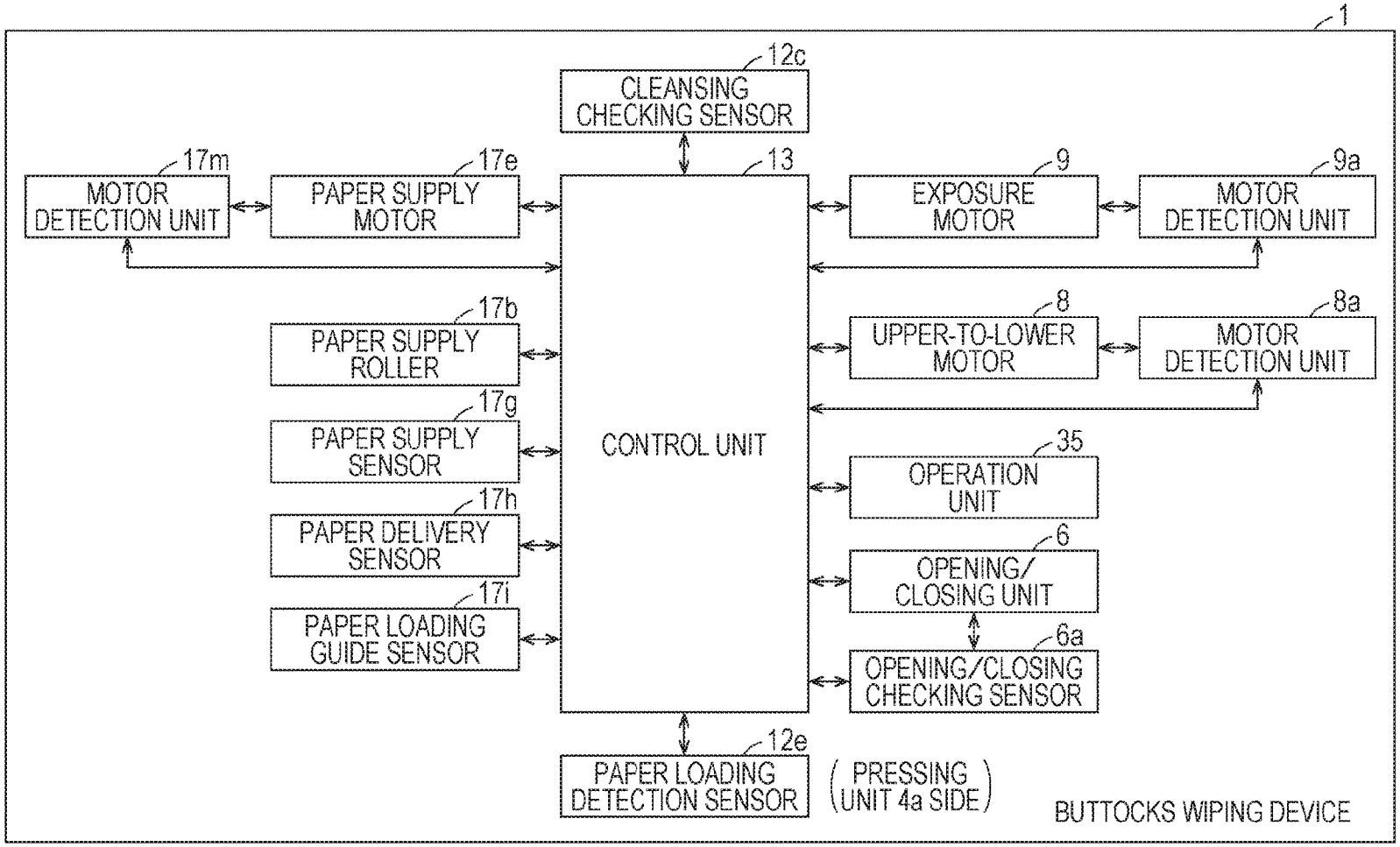
FIG. 51B is a block diagram of a functional configuration of the buttocks wiping device 1.
Figure 51C:
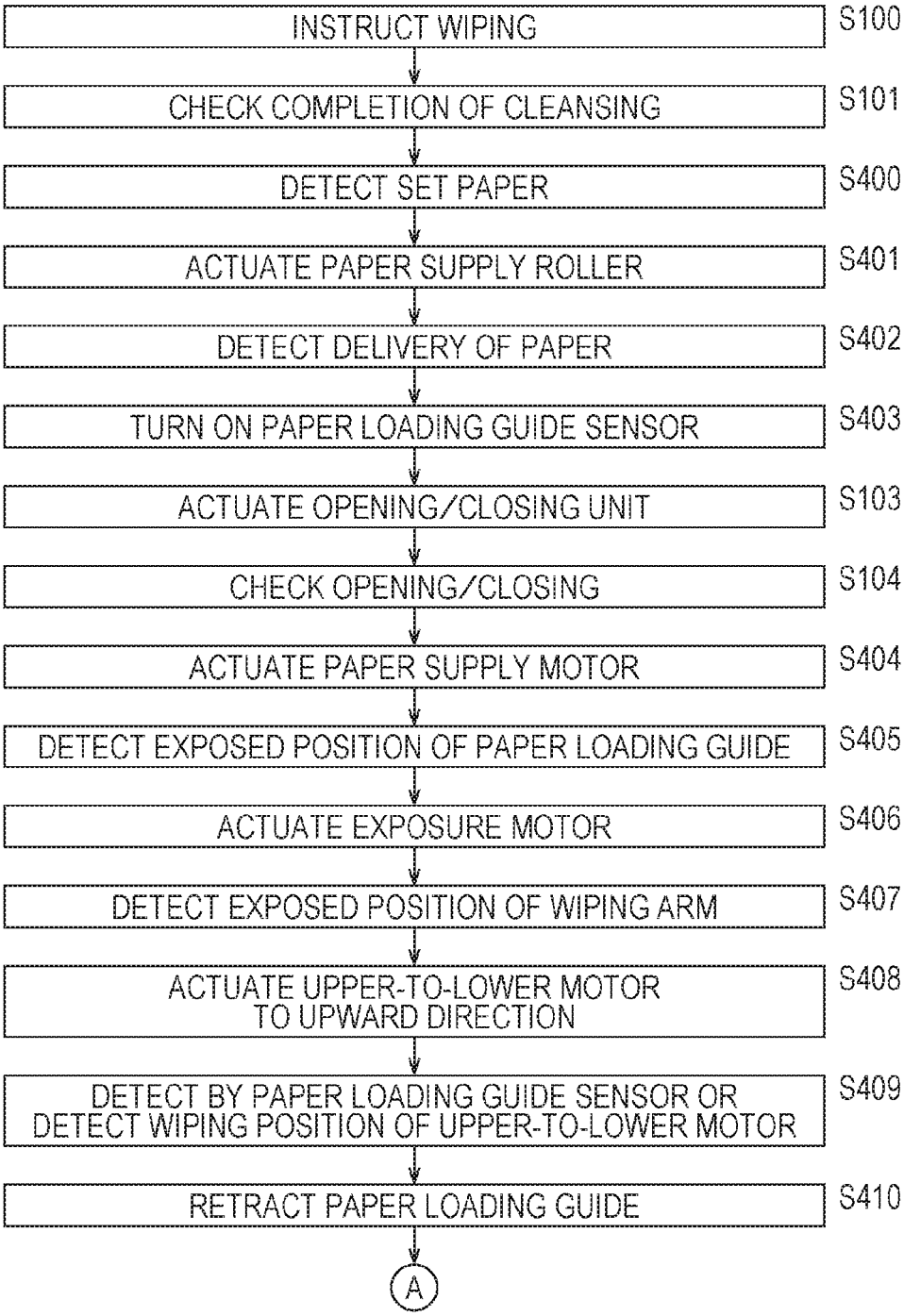
FIG. 51C is a flowchart of operation of the buttocks wiping device 1.
Figure 51D:
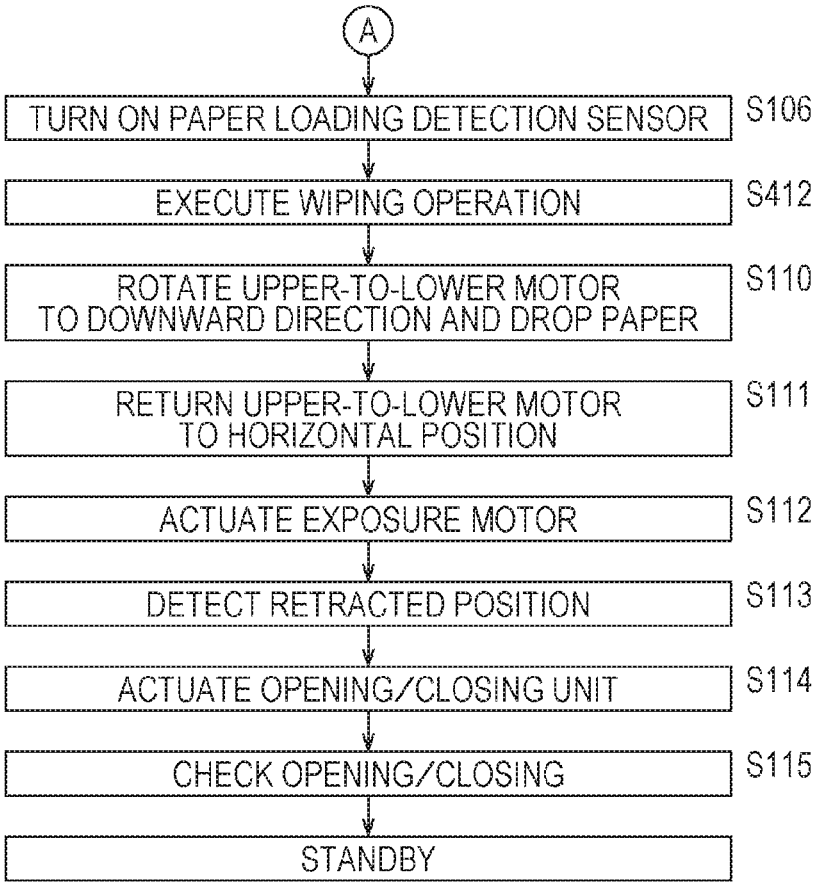
FIG. 51D is a flowchart of operation of the buttocks wiping device 1.
Figure 52:
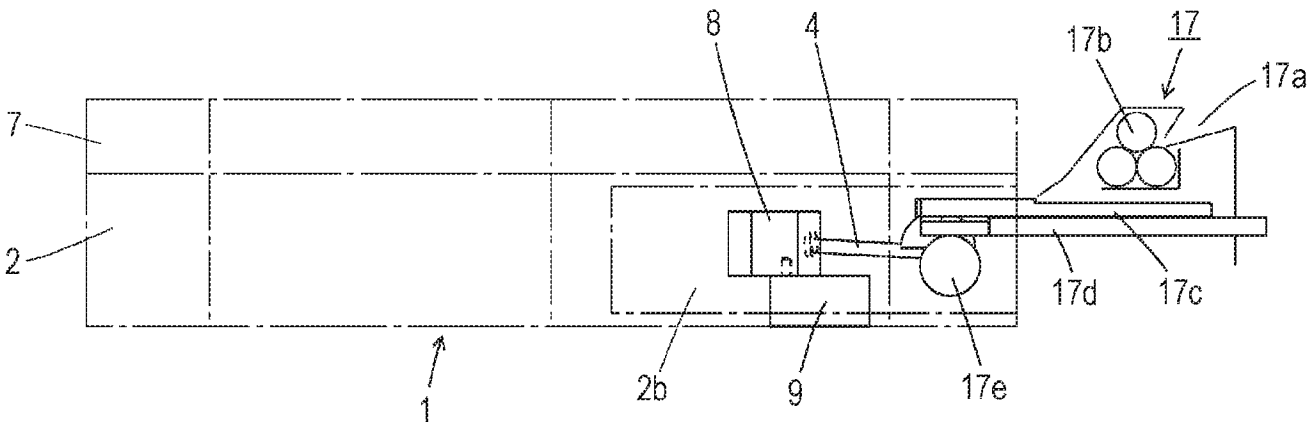
FIG. 52 is a front view of the buttocks wiping device 1.
Figure 53:
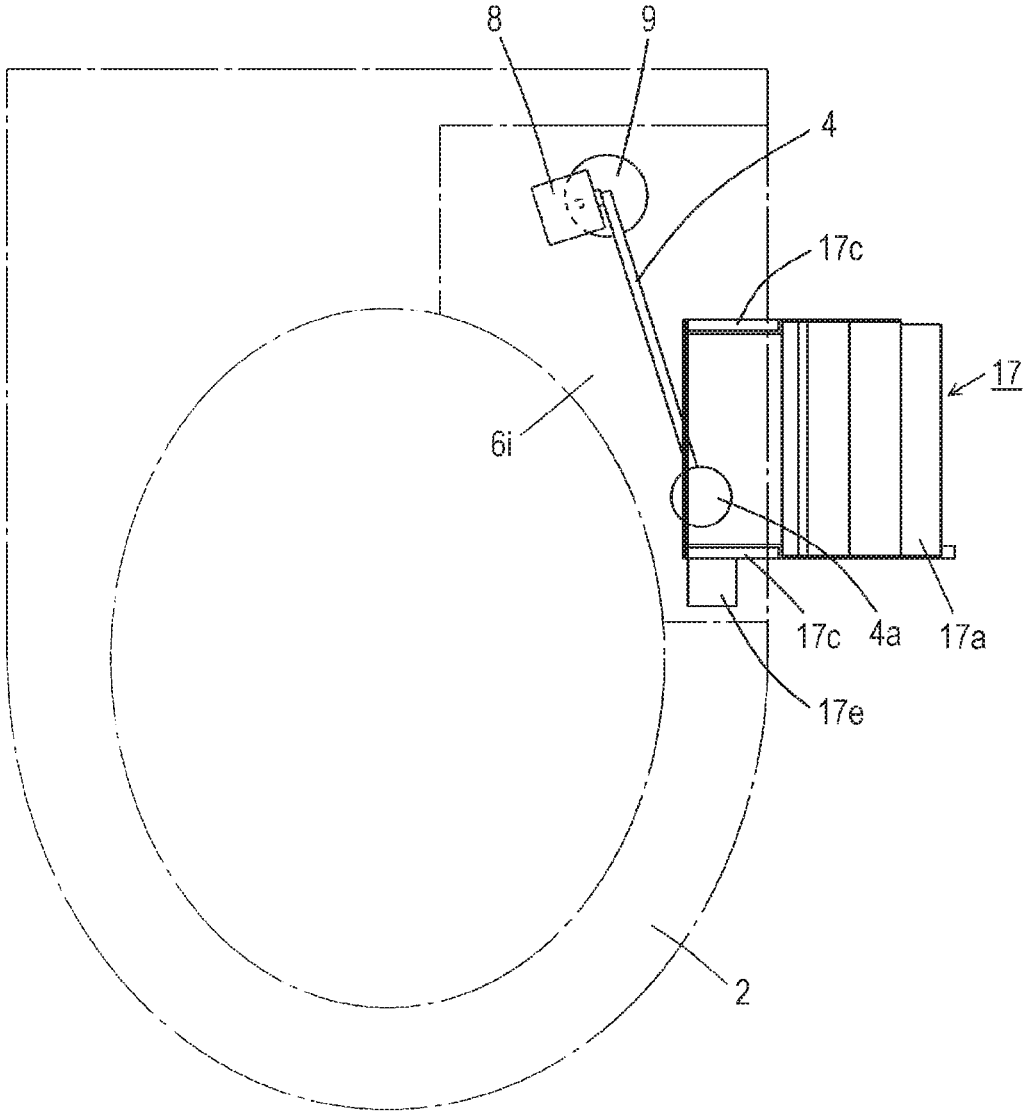
FIG. 53 is a plan view of the buttocks wiping device 1.
Figure 54:
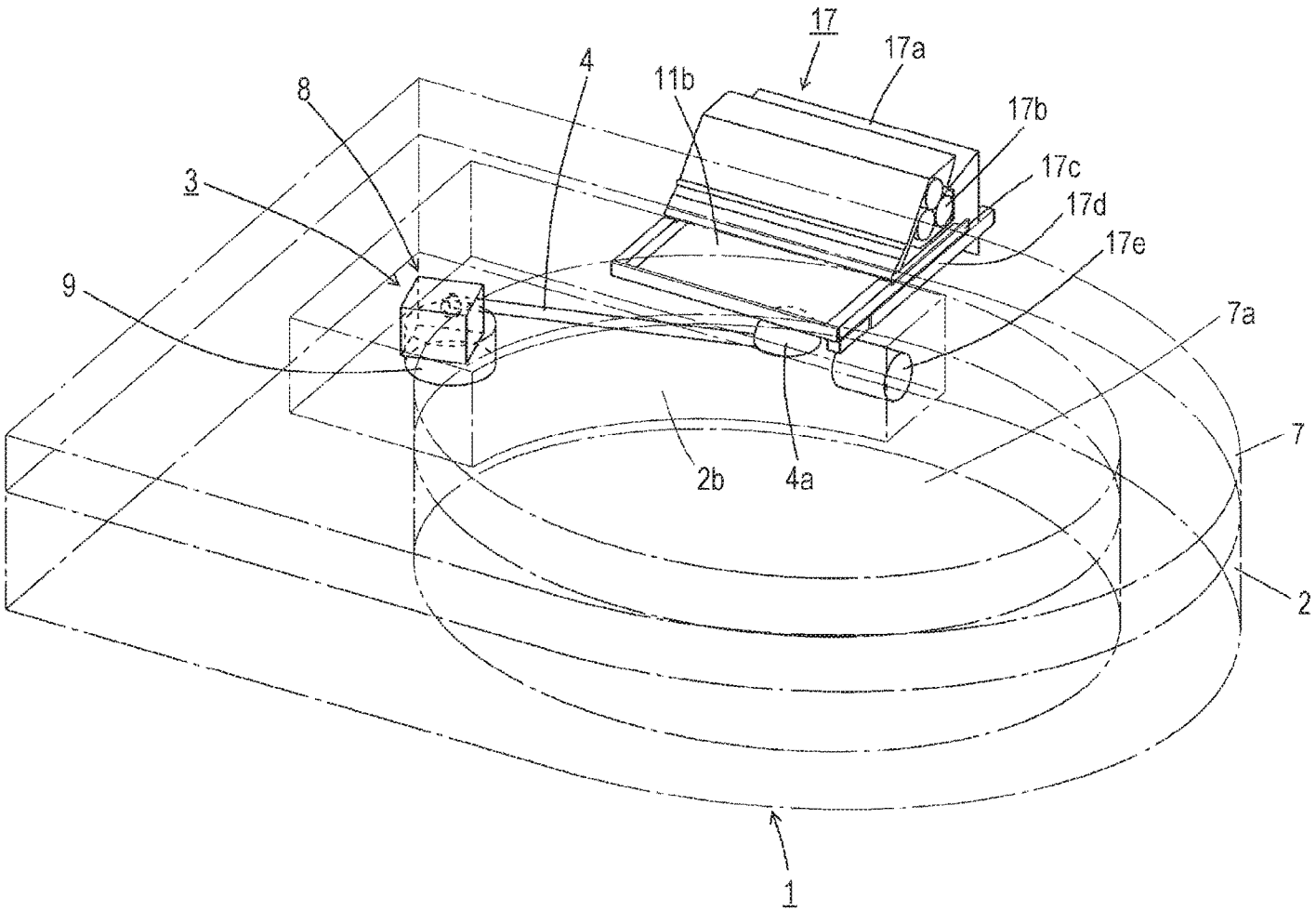
FIG. 54 is a perspective view of the buttocks wiping device 1.
Figure 55:
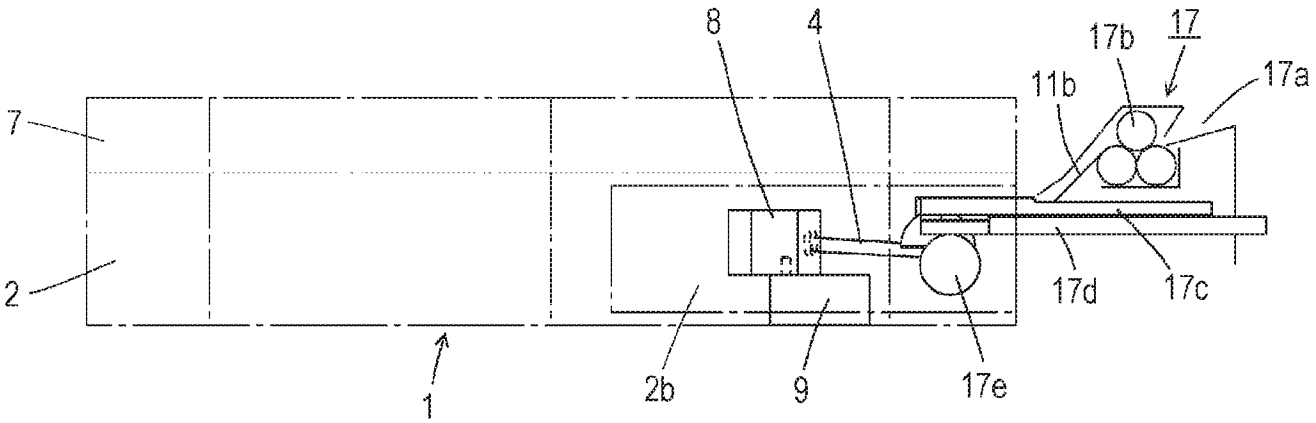
FIG. 55 is a front view of the buttocks wiping device 1.
Figure 56:
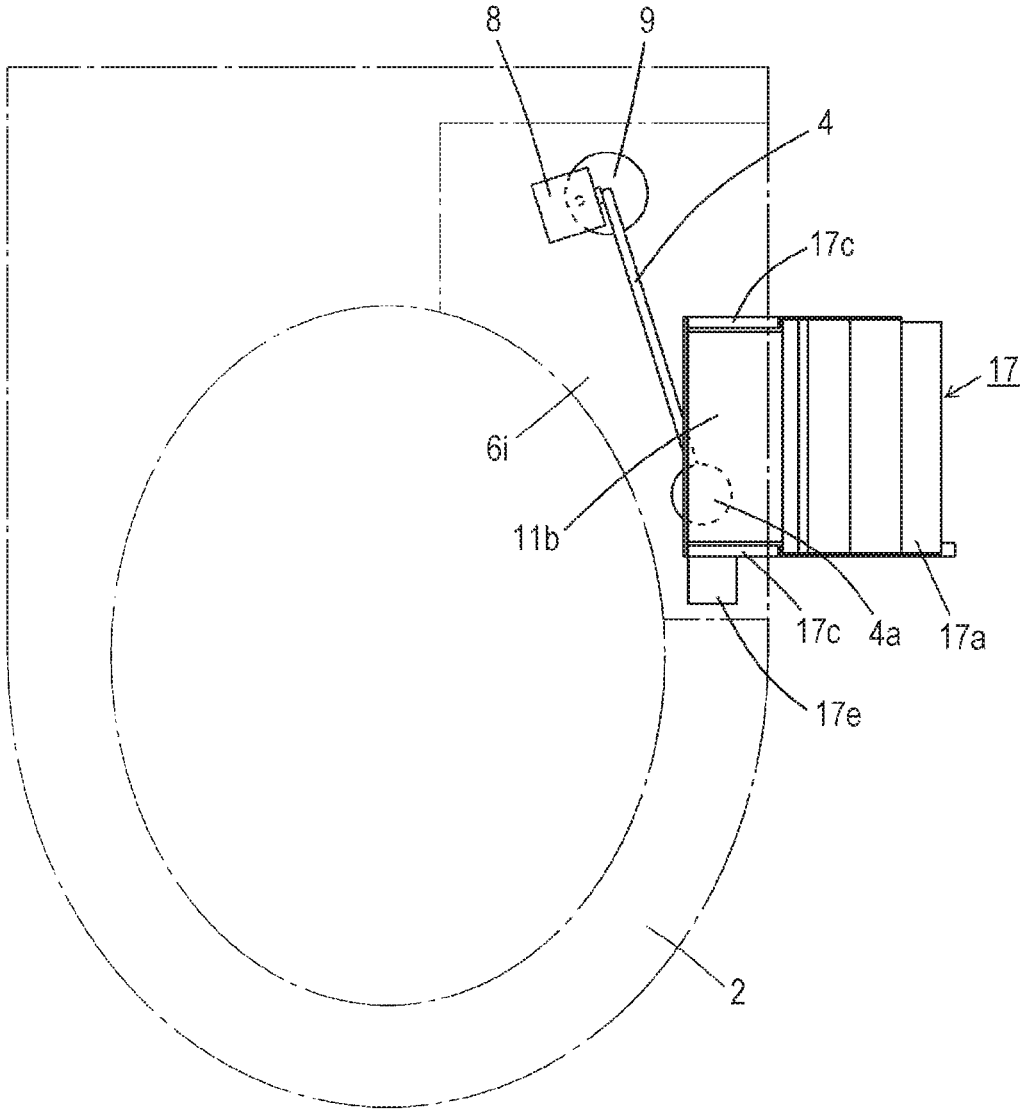
FIG. 56 is a plan view of the buttocks wiping device 1.
Figure 57:
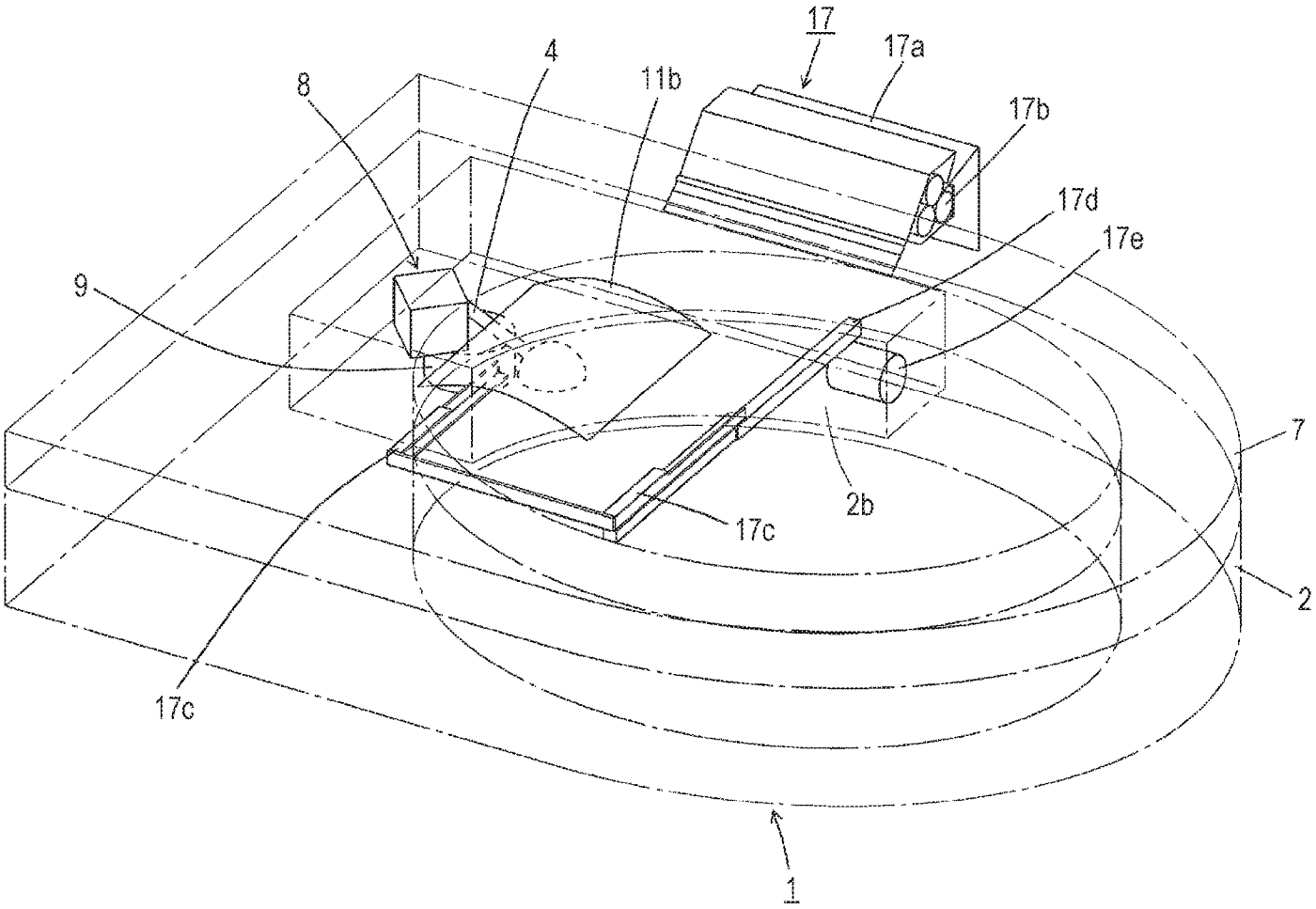
FIG. 57 is a perspective view of the buttocks wiping device 1.
Figure 58:
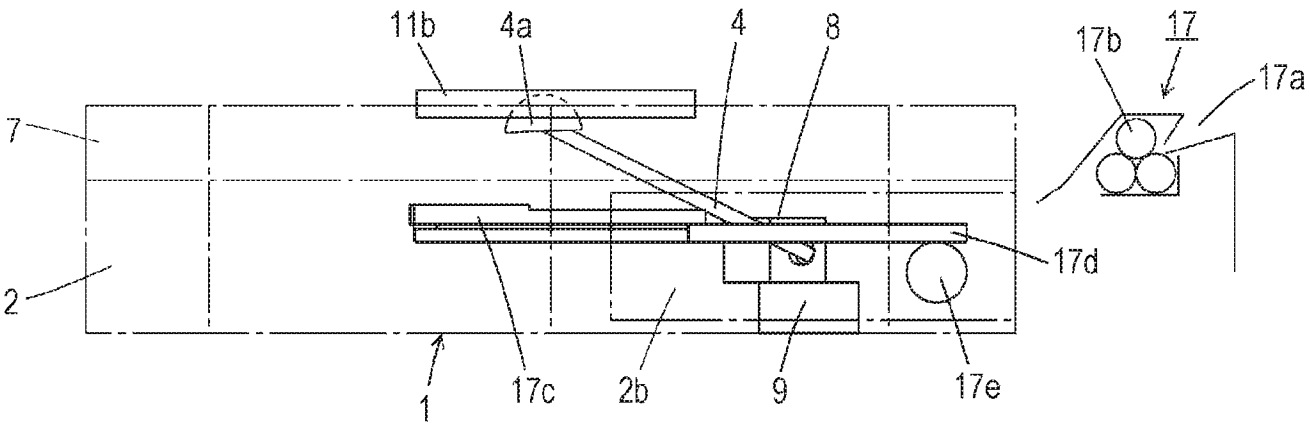
FIG. 58 is a front view of the buttocks wiping device 1.

FIG. 51A is a perspective view of the buttocks wiping device 1 of the eighth embodiment of the present invention. FIG. 51B is a block diagram of a functional configuration of the buttocks wiping device 1. FIGS. 51C and 51D are flowcharts of operation of the buttocks wiping device 1. FIG. 52 is a front view of the buttocks wiping device 1. FIG. 53 is a plan view of the buttocks wiping device 1. FIGS. 51A, 52, and 53 illustrate a state before special paper 11*b* is supplied. FIG. 54 is a perspective view of the buttocks wiping device 1. FIG. 55 is a front view of the buttocks wiping device 1. FIG. 56 is a plan view of the buttocks wiping device 1. FIGS. 54 to 56 illustrate a state when the special paper 11*b* is supplied. FIG. 57 is a perspective view of the buttocks wiping device 1. FIG. 58 is a front view of the buttocks wiping device 1. FIGS. 57 and 58 illustrate a state when the buttocks are wiped with the special paper 11*b*. In each figure, a raised portion 2 and a toilet seat 7 are indicated by chain lines for the sake of clarifying an internal structure. Moreover, although a warm-water cleansing device is not shown in each figure, the warm-water cleansing device is provided at the back of the toilet seat 7, and the toilet seat 7 is rotatably attached to the warm-water cleansing device.

The buttocks wiping device 1 is provided below the toilet seat 7. The buttocks wiping device 1 includes, in a housing portion 2*b* provided at the raised portion 2, a wiping arm 4 and a wiping arm drive unit 3. The wiping arm drive unit 3 includes an upper-to-lower motor 8, an exposure motor 9, and a gear, a shaft, a bearing, etc. (not shown) for transmitting power of these motors to the wiping arm 4. Moreover, the buttocks wiping device 1 includes a paper supply unit 17 for supplying the special paper 11*b*. The paper supply unit 17 is partially housed in the housing portion 2*b* provided at the raised portion 2. Note that the thickness of the toilet seat 7 may be increased such that the structure of the buttocks wiping device 1 is in the toilet seat 7 (the same applies to other embodiments).

The wiping arm 4 has, at one end thereof, a pressing unit 4*a*. Note that the pressing unit 4*a* may be configured to be held horizontal upon contact with the anus by a hinge mechanism provided at the wiping arm 4. The other end of the wiping arm 4 is fixed to a rotary shaft of the upper-to-lower motor 8. When the upper-to-lower motor 8 rotates, the wiping arm 4 moves up and down accordingly. As a result, the pressing unit 4*a* moves up and down. The upper-to-lower motor 8 is fixed to a rotary shaft of the exposure motor 9. When the exposure motor 9 rotates, the upper-to-lower motor 8 angularly moves and rotates about the rotary shaft of the exposure motor 9 as a supporting point, and the wiping arm 4 also rotates together. Then, the wiping arm 4 is exposed through a hole 7*a* of the toilet seat 7 from the housing portion 2*b*. After exposure, the upper-to-lower motor 8 rotates so that the pressing unit 4*a* can move up and down.

The paper supply unit 17 includes a paper injection port 17*a*, paper supply rollers 17*b*, a paper loading guide 17*c*, a push-out portion 17*d*, and a paper supply motor 17*e*. The push-out portion 17*d* has a nested structure. A not-shown gear (pinion) is attached to a rotary shaft of the paper supply motor 17*e*. A rack-and-pinion structure is made such that the gear and the push-out portion 17*d* (a rack) engage with each other. When the paper supply motor 17*e* rotates, an inner insert member of the push-out portion 17*d* moves forward. After the inner insert member has moved forward, the pinion and the rack engage with each other such that an outer insert member moves forward. Specifically, there is a protrusion at a back end of the inner insert member. After the inner insert has been moved forward by the paper supply motor 17*e*, the protrusion is caught by the inside of the outer insert, and therefore, the outer insert begins moving forward. Such a caught portion is configured such that the inner insert also moves forward together with forward movement of the outer insert.

When the paper supply motor 17*e* rotates reversely, the push-out portion 17 contracts by backward movement. Specifically, the outer insert (the rack) moves backward after having engaged with the pinion attached to the paper supply motor 17*e*. When the outer insert moves backward to a tail end, the pinion engages with the inner insert as the rack. Then, the above-described caught portion is released, and the inner insert is retracted by backward movement.

The paper loading guide 17*c* is attached onto the push-out portion 17*d*. In association with movement of the push-out portion 17*d*, the paper loading guide 17*c* also moves forward or backward. The paper supply rollers 17*b* has such a structure that the special paper 11*b* is sandwiched by the rollers in the upper-to-lower direction. The paper supply rollers 17*b* rotate by rotation of a not-shown motor.

When the special paper 11*b* is injected into the paper injection port 17*a*, a paper supply sensor 17*g* attached to the vicinity of an inlet of the paper supply rollers 17*b* detects such injection, and the paper supply rollers 17*b* are rotated. Thus, the special paper 11*b* moves on the inside of the paper supply rollers 17*b*. The special paper 11*b* is placed on the paper loading guide 17*c*. When the special paper 11*b* has been delivered, a paper delivery sensor 17*h* attached to the vicinity of an outlet of the paper supply rollers 17*b* detects that the special paper 11*b* has been discharged, and the paper supply rollers 17*b* are stopped. As described above, the special paper 11*b* is placed on the paper loading guide 17*c*. The paper supply sensor 17*g* and the paper delivery sensor 17*h* may be sensors configured to perform non-contact detection of the presence or absence of paper by a photo sensor, an ultrasonic sensor, etc., but are not limited.

The paper loading guide 17*c* has such a shape that the pressing unit 4*a* can upwardly pass through the paper loading guide 17*c* from below and that the special paper 11*b* does not drop. The shape of the paper loading guide 17*c* is merely an example, and is not intended to limit the present invention. The paper loading guide 17*c* is provided with a paper loading guide sensor 17*i*, and therefore, it can be detected whether or not the special paper 11*b* has been properly placed on the paper loading guide 17*c*. Various sensors such as a photo sensor may be used as the paper loading guide sensor 17*i*. As described above, the special paper 11*b* is placed on the paper loading guide 17*c* as illustrated in FIGS. 54 to 56. Note that the special paper 11*b* may be made of a water absorbent material having a certain thickness. Alternatively, the special paper 11*b* may be, for avoiding bending thereof when placed on the paper loading guide 17*c*, configured such that a base material portion having a certain hardness is provided below the water absorbent material. The special paper 11*b* may be formed in such a manner that multiple pieces of toilet paper are folded and are entirely or partially joined together at end sides thereof, may be formed in such a manner that a stack of multiple pieces of toilet paper are entirely or partially joined together at end sides thereof, or may be formed in such a manner that a single piece of thick water absorbent paper is cut to a predetermined shape.

When the special paper 11*b* is placed on the paper loading guide 17*c*, the paper supply motor 17*e* rotates to move the paper loading guide 17*c* forward. Thus, the paper loading guide 17*c* is exposed from the raised portion 2. Note that although not shown in the figure, a groove etc. for restricting the track of the paper loading guide 17*c* are provided at the raised portion 2 such that the paper loading guide 17*c* is exposed straight from the raised portion 2. After the paper loading guide 17*c* has been exposed, the wiping arm 4 is angularly moved by rotation of the exposure motor 9. Thus, the wiping arm 4 is exposed, and is inclined to the upward direction by the upper-to-lower motor 8. Thus, as illustrated in FIG. 57, the pressing unit 4*a* pushes up the special paper 11*b* from below the paper loading guide 17*c*, and the paper 11*b* is pressed against the buttocks to wipe moisture etc.

Right before wiping, the paper loading guide 17*c* is exposed below the buttocks, and the wiping arm 4 is positioned below the paper loading guide 17*c*. A clearance between the buttocks of a user seated on the toilet seat 7 and the wiping arm 4 is about several centimeters. When the pressing unit 4*a* of the wiping arm 4 moves upward, the special paper 11*b* is lifted, and comes into contact with the buttocks. In this state, the paper supply motor 17*e* moves the paper loading guide 17*c* backward. The wiping arm 4 is slightly moved up and down, back and forth, right to left, etc. by the wiping arm drive unit 3, and therefore, the moisture etc. are reliably absorbed by the special paper 11*b*. In this manner, wiping is executed.

Upon completion of wiping, the upper-to-lower motor 8 inclines the wiping arm 4 to the downward direction. The special paper 11*b* loses, due to its own weight, a balance at the pressing unit 4*a*, and therefore, naturally drops. Note that when the wiping arm drive unit 3 drives the wiping arm 4 to slightly vibrate, the special paper 11*b* is reliably dropped. When the paper loading detection sensor 12*e* provided at the pressing unit 4*a* detects paper dropping, the wiping arm drive unit 3 retracts the wiping arm into the housing portion 2*b*.

As illustrated in FIG. 51B, for rotation of the upper-to-lower motor 8, the exposure motor 9, and the paper supply motor 17*e*, a rotation angle, the number of rotations, a rotating speed, a torque, etc. are controlled by a control unit 13 according to detection results of motor detection units 8*a*, 9*a*, 17*m*. A specific example of each motor detection unit is similar to that of the motor detection unit 8*a* described above.

There is a probability that the paper loading guide 17*c* contacts the buttocks. In such a case, the motor detection unit 17*m* generates a torque of equal to or greater than a predetermined torque at the paper supply motor 17*e*. Thus, a current value detected by the motor detection unit 17*m* is equal to or greater than a predetermined value. In this case, the control unit 13 stops or reversely rotates the paper supply motor 17*e*, thereby controlling the paper loading guide 17*c* not to contact the user. As described above, the paper supply motor 17*e* may be subjected to torque limitation or torque control. In addition, a simple structure is conceivable, in which a sensor or a switch is provided at a tip end of the paper loading guide 17*c*, and in a case where the paper loading guide 17*c* contacts the user, detects such contact so that the control unit 13 can stop or reversely rotate the paper supply motor 17*e*. As described above, the paper supply unit 17 may detect whether or not the paper loading guide 17*c* has contacted the user, and when detected, stop or backwardly move the paper loading guide 17*c*.

Although not shown in the figure, an opening/closing unit 6 is also provided in the eighth embodiment.

Operation of the buttocks wiping device 1 will be described below in detail with reference to FIGS. 51C and 51D. The same reference numerals as those of the first embodiment are used to represent similar operation in FIGS. 51C and 51D, and description thereof will not be repeated.

After a wiping instruction (S100), it is checked whether or not cleansing has been completed (S101). Then, the paper supply sensor 17*g* of the paper supply unit 17 detects whether or not the special paper 11*b* is injected (S400). If not, the control unit 13 displays a message for prompting the user to inject the special paper 11*b*, for example. When the special paper 11*b* is injected, the control unit 13 rotates the paper supply rollers 17*b* to deliver the special paper 11*b* (S401). Suppose that the paper delivery sensor 17*h* has detected that the special paper 11*b* has been delivered (S402). Note that in a case where it is, even after a lapse of a predetermined time, not detected that the special paper 11*b* has been delivered. i.e., a case where the paper delivery sensor 17*h* detects the presence of the paper even after a lapse of the predetermined time, there is a probability that the paper is jammed. For this reason, the control unit 13 determines that an error is caused, and displays a message for notifying the user that a paper jam is caused, for example.

When it is detected that the paper has been delivered, the control unit 13 turns on the paper loading guide sensor 17*i* (S403). That is, the paper loading guide sensor 17*i* is ON until the wiping arm 4 inclines upward. In the meantime, if the paper loading guide sensor 17*i* detects that the paper is not placed, there is a probability that the special paper 11*b* has been dropped in the middle. When such detection is made, the control unit 13 displays a message for prompting the user to provide the wiping instruction again, for example. In addition, the control unit 13 returns the paper loading guide 17*c* and the wiping arm 4 to original positions, and starts wiping operation from the beginning.

After processing of S403, the control unit 13 opens/closes the opening/closing unit 6 at S103 and S104, and then, proceeds to operation of S404. At S404, the control unit 13 actuates the paper supply motor 17*e* to expose the paper loading guide 17*c*. The exposed position of the paper loading guide 17*c* is detected by a not-shown detection unit such as a contact switch, a non-contact switch, a photo sensor, or a magnetic sensor. When the paper loading guide 17*c* is exposed at the exposed position, the control unit 13 stops the paper supply motor 17*e* (S405).

Subsequently, the control unit 13 rotates the exposure motor 9 to angularly move the upper-to-lower motor 8, thereby exposing the wiping arm 4 (S406). The exposed position of the wiping arm 4 is detected from, e.g., the rotation angle detected by the motor detection unit 9*a*. When the wiping arm 4 is exposed at the exposed position, the control unit 13 stops the exposure motor 9 (S407). Then, the control unit 13 rotates the upper-to-lower motor 8 to incline the wiping arm 4 to the upward direction (S408).

When the wiping arm 4 inclines to the upward direction, the pressing unit 4*a* lifts the special paper 11*b*, and then, the special paper 11*b* comes into contact with the vicinity of the anus. The control unit 13 detects lifting of the special paper 11*b* in such a manner that the paper loading guide sensor 17*i* detects whether or not the special paper 11*b* is no longer placed or it is, based on, e.g., the rotation angle of the upper-to-lower motor 8 detected by the motor detection unit 8*a*, detected whether or not the pressing unit 4*a* has reached a wiping position (S409).

After detection at S409, the control unit 13 moves the paper supply motor 17*e* backward, thereby retracting the paper loading guide 17*c* into the housing portion 2*b* (S410).

Thereafter, the control unit 13 turns on the paper loading detection sensor 12*e* as in the first embodiment (S106), and executes the wiping operation while detecting whether or not the paper is dropped in the course of wiping (S412). Upon wiping, the control unit 13 slightly rotates the exposure motor 9 and the upper-to-lower motor 8 while pressing the special paper 11*b* up and down or moving the special paper 11*b* right to left and back and forth. In this manner, wiping is executed. As in the first embodiment, the control unit 13 subsequently executes operation after paper dropping and before closing of the opening/closing unit 6 (S110 to S115), and returns to a standby state for a subsequent wiping instruction.

As described above, in the eighth embodiment, the special paper 11*b* is exposed below the buttocks separately from the wiping arm 4, and the pressing unit 4*a* of the wiping arm 4 pushes up the exposed special paper 11*b* from below. In this manner, the buttocks are wiped. Thus, the structure for holding the special paper 11*b* is not necessary. Consequently, the structure of the buttocks wiping device can be simplified, leading to cost reduction. The paper supply unit 17 can be also implemented by a simple reliable structure for delivering the special paper 11*b* by the paper supply rollers 17*b* and exposing the special paper 11*b* on the paper loading guide 17*c*. In the first technique, there is a probability that the placed paper drops upon exposure of the pressing unit 4*a*. However, in the second technique, there is an extremely-low probability that the paper drops in the middle. Thus, in addition to the simple structure and cost reduction, reliable wiping can be realized. Only clean paper is placed on the paper loading guide 17*c*, and therefore, there is an extremely-low probability that the paper loading guide 17*c* gets dirty. The pressing unit 4*a* contacts the anus with the special paper 11*b* being interposed therebetween, and therefore, there is a probability that the moisture etc. adhere to the pressing unit 4*a*. However, because of the simple structure, the user can easily wipe or cleanse the pressing unit 4*a*. Thus, the buttocks wiping device of the seventh embodiment is sanitary and easily usable, and maintenance of such a buttocks wiping device is facilitated.

Further, in the eighth embodiment, part of the mechanism of the wiping arm drive unit for driving the wiping arm is provided in the raised portion provided at the clearance between the toilet bowl and the toilet seat or in the thick toilet seat. Not only right and left spaces but also a space below the warm-water cleansing device can be used as the inside of the raised portion or the thick toilet seat. This structure avoids, as much as possible, consumption of a space at the side of the toilet bowl.

Note that various structures for pushing out the push-out portion 17*d* are conceivable, and are not intended to limit the present invention. For example, a belt may be winded around the rotary shaft of the paper supply motor 17*e*, and may be coupled to the nested structure of the push-out portion 17*d*. In association with winding and unwinding of the belt, the push-out portion 17*d* may extend/contract. A pinion may be provided at the rotary shaft of the paper supply motor 17*e*, and instead of the belt, a flexible rack may be winded around the pinion. The rack may be coupled to the nested structure of the push-out portion 17*d* so that the push-out portion 17*d* can extend/contract.

Note that for multiple pieces of special paper 11*b* stacked on each other in the upper-to-lower direction, a mechanism of an automatic document feeder (ADF) used for a copying machine etc. is disposed in front of the paper injection port, and the mechanism of the automatic document feeder delivers each piece of special paper 11*b* to the paper injection port 17*a* such that the paper supply rollers 17*b* place such a piece of special paper 11*b* on the paper loading guide 17*c*. With this structure, the paper can be automatically supplied. Alternatively, the long special paper 11*b* may be injected into the paper supply rollers 17*b*, and may be cut by a cutting unit at predetermined intervals such that a single piece of special paper 11*b* is placed on the paper loading guide 17*c*.

The wiping arm 4 and the paper supply unit 17 are separately provided as in the present embodiment. Thus, only the mechanism of the wiping arm 4 or the mechanism of the paper supply unit 17 can be developed. That is, the mechanism of the wiping arm 4 and the mechanism of the paper supply unit 17 can be separately developed. The pressing unit 4*a* does not directly hold the paper. Thus, the pressing unit 4*a* can be developed such that the shape of the pressing unit 4*a* fits the shape of the vicinity of the anus, or can be developed while various materials such as hard resin, silicon resin, rubber, soft resin, and metal are tested by actual application to a human. Consequently, a proper design can be made in terms of ergonomics.

Note that in the above-described embodiments, an arm portion of the wiping arm 4 is in a linear shape, but may be bent. The wiping arm 4 mainly includes the pressing unit 4*a* provided at the tip end portion, and the arm portion as a strut portion for coupling the pressing unit 4*a* to the drive unit. With the arm portion bent in advance, the pressing unit 4*a* can be moved to a high position as described below.

Figure 59:
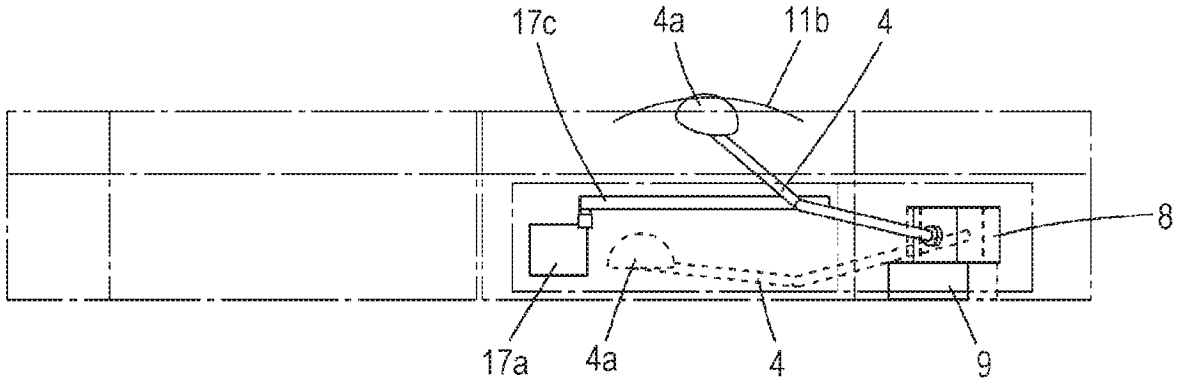
FIG. 59 is a right side view of an internal structure when a wiping arm 4 is bent.
Figure 60:
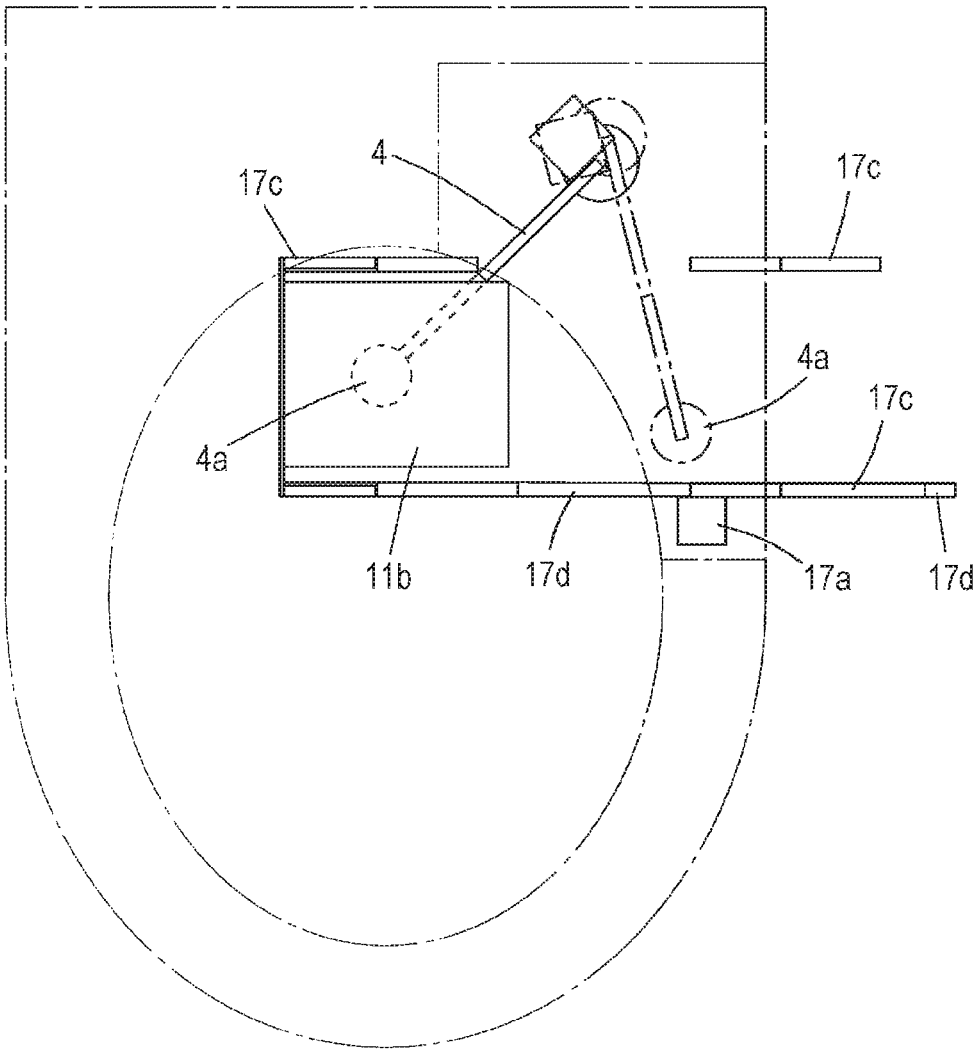
FIG. 60 is a plan view of the internal structure when the wiping arm 4 is bent.

FIG. 59 is a right side view of the internal structure when the wiping arm 4 is bent. FIG. 60 is a plan view of the internal structure when the wiping arm 4 is bent. FIG. 59 illustrates the position of the wiping arm 4 upon retraction and wiping at the same time. FIG. 60 illustrates the positions of the wiping arm 4 and the paper loading guide 17*c* upon retraction and wiping at the same time. An intermediate portion of the wiping arm 4 is bent so that a base portion of the wiping arm 4 attached to the rotary shaft of the upper-to-lower motor 8 can incline to the downward direction upon retraction as illustrated in FIG. 59. Note that a portion to be bent is a matter to be appropriately designed, and is not limited to the illustrated example.

Thus, when the base portion is inclined to the upward direction upon wiping, the pressing unit 4*a* can be moved to a higher position as compared to the case of the linear arm portion. Consequently, in a case where the pressing unit 4*a* needs to be provided at a higher position, it is effective to bend the wiping arm 4. Further, movement of the pressing unit 4*a* to a higher position means that the pressing unit 4*a* can be more firmly pressed against the buttocks. Thus, in a case where it is desired to more firmly press the pressing unit 4*a* against the buttocks, the wiping arm 4 may be bent. In the case of using the second technique, the paper and the wiping arm 4 are separately exposed, and therefore, the heights of the wiping arm 4 and the pressing unit upon retraction are less restricted. Thus, retraction can be performed even when the arm is bent.

Note that when the arm portion (a portion other than the pressing unit 4*a*) of the wiping arm 4 is made of a bendable flexible material, contact of the pressing unit 4*a* with the buttocks with force more than necessary can be prevented while the feeling of wiping can be improved.

Ninth Embodiment

Figure 61A:
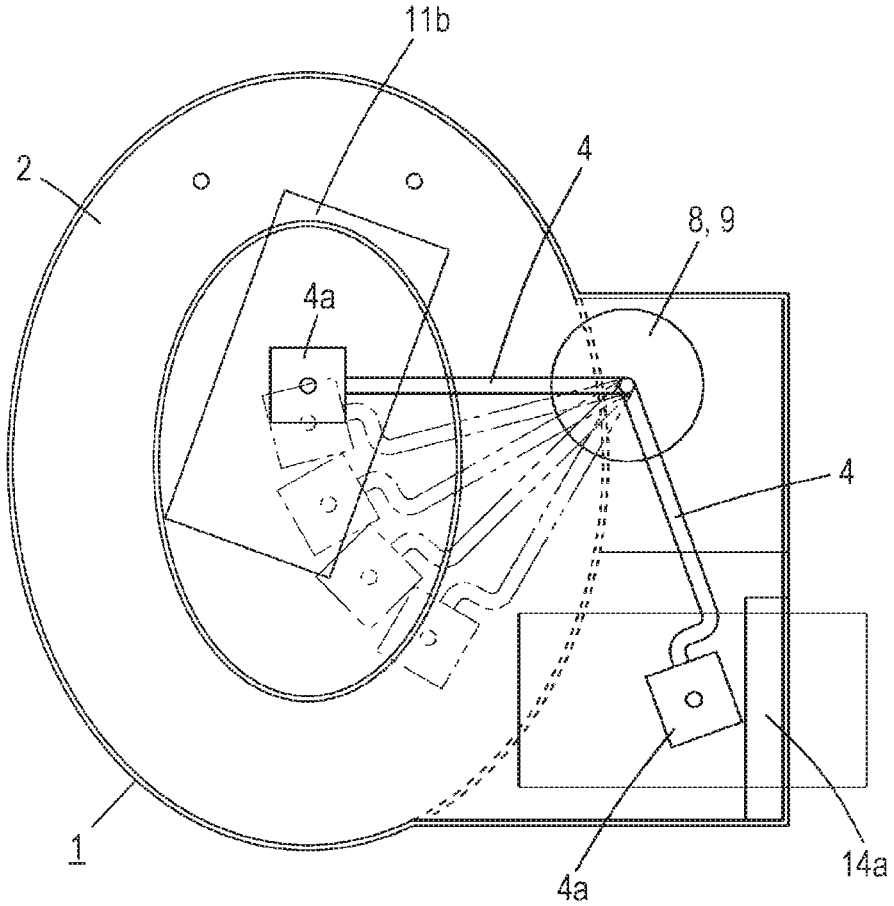
FIG. 61A is a plan view of an internal structure of a buttocks wiping device 1 of a ninth embodiment.
Figure 61B:
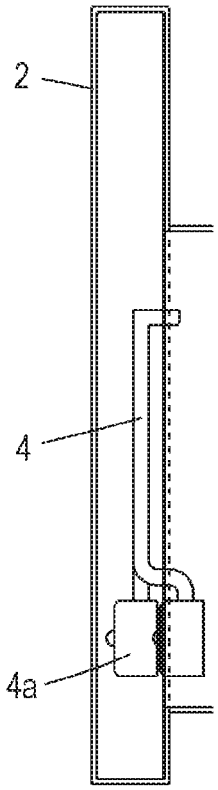
FIG. 61B is a right side view of the internal structure of the buttocks wiping device 1.
Figure 61C:
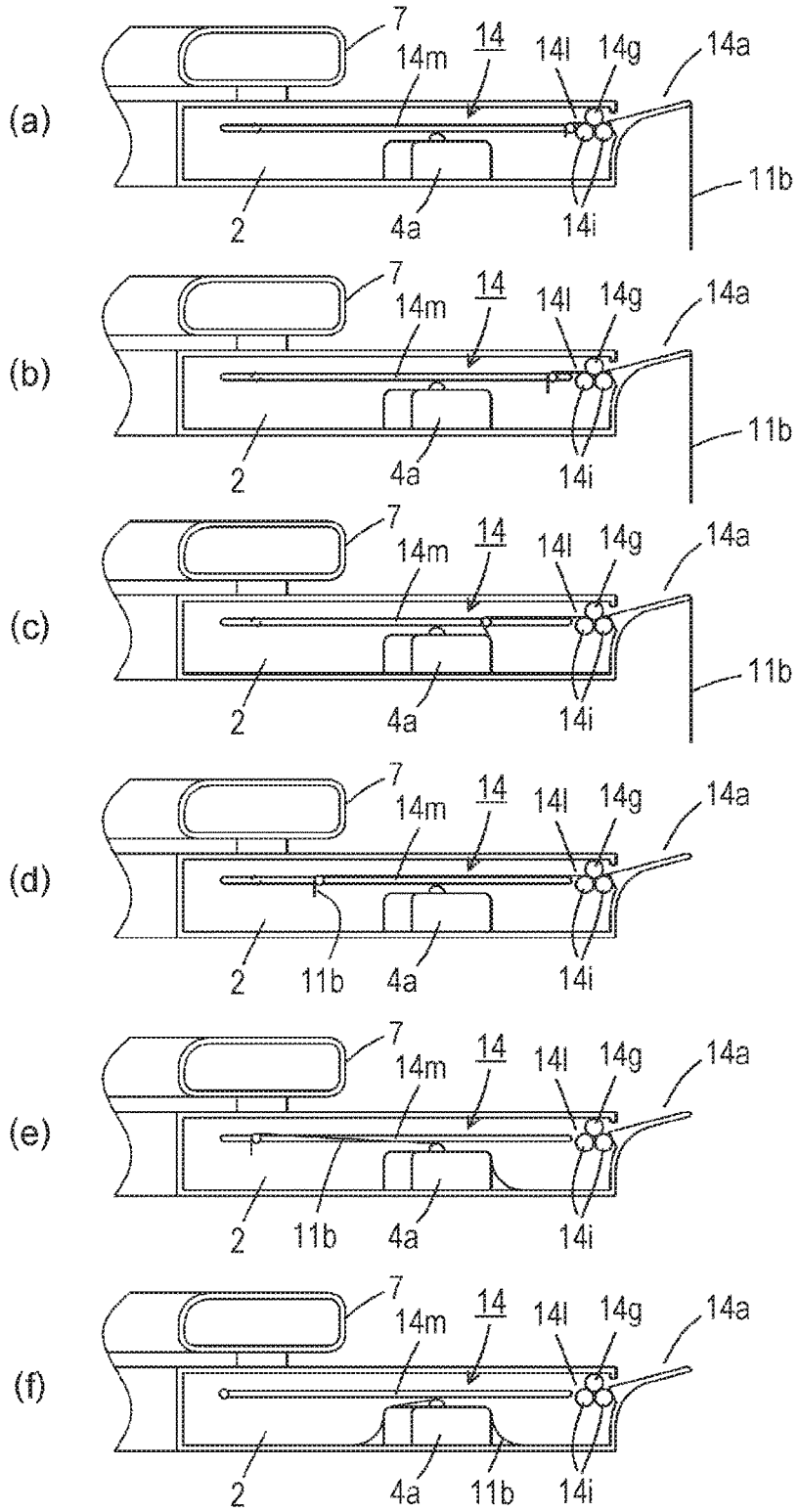
FIG. 61C is a front view of the internal structure of the buttocks wiping device 1, the view illustrating transition upon paper supply.

A ninth embodiment is an embodiment employing the first technique. FIG. 61A is a plan view of an internal structure of a buttocks wiping device 1 of the ninth embodiment. FIG. 61B is a right side view of the internal structure of the buttocks wiping device 1. FIG. 61C is a front view of the internal structure of the buttocks wiping device 1, the view illustrating transition upon paper feeding. FIGS. 61A and 61B illustrate a plurality of wiping arms 4 for the sake of clarifying a movement path, but a single wiping arm 4 is actually provided.

The buttocks wiping device 1 includes a raised portion 2, an upper-to-lower motor 8, an exposure motor 9, and the wiping arm 4. A pressing unit 4*a* is provided at a tip end of the wiping arm 4. The pressing unit 4*a* is provided at an eccentric position shifted from the center axis of the wiping arm 4, and through a hinge, is attached to an end bent in an L-shape as illustrated in FIG. 61A. The other end of the wiping arm 4 is attached to a rotary shaft of the upper-to-lower motor 8. Although not shown in the figure, the axial center of the rotary shaft of the upper-to-lower motor 8 and the axial center of the wiping arm 4 are on a straight line.

Figure 62:
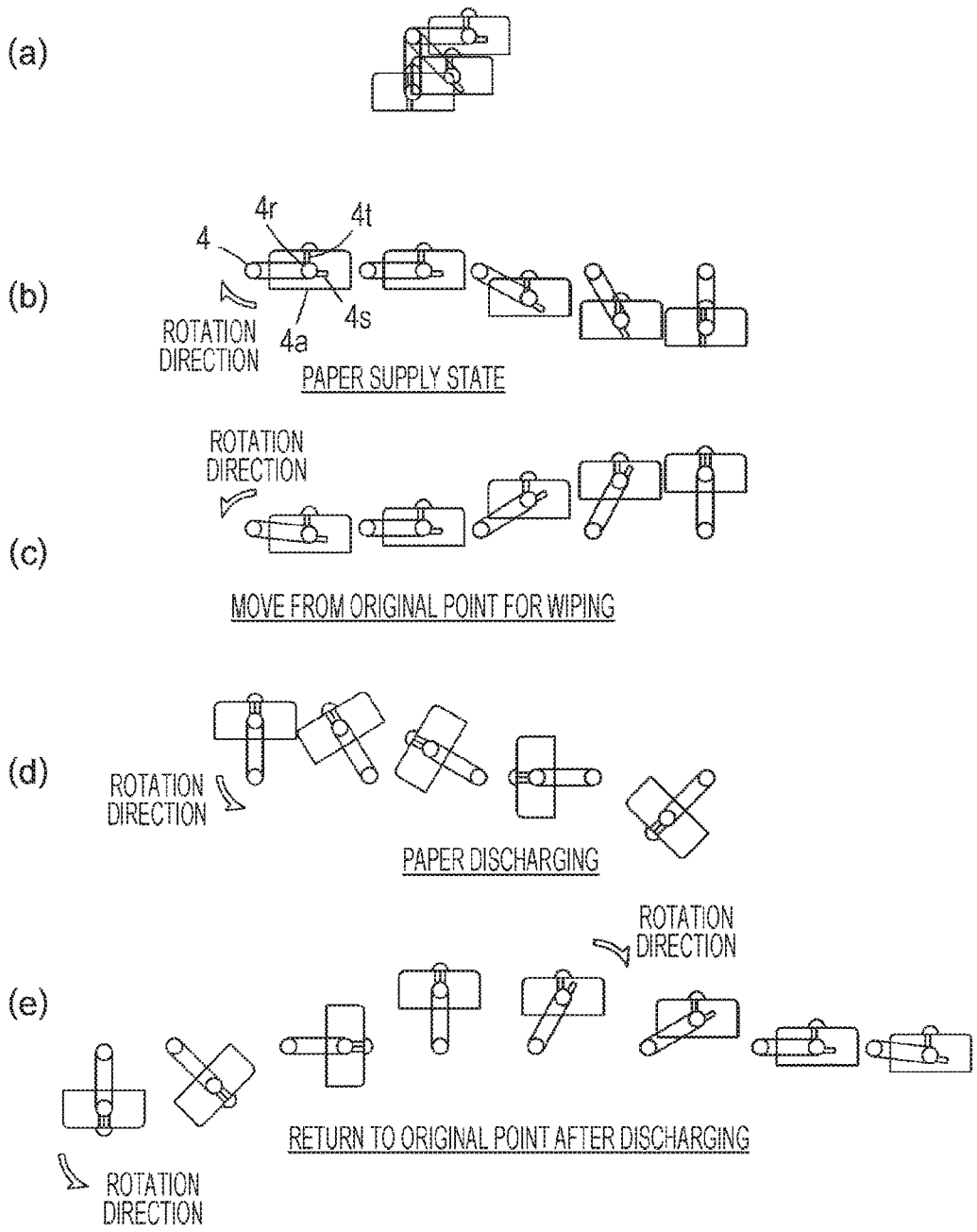
FIG. 62 is a view of movement transition of a pressing unit 4*a;*

That is, when the upper-to-lower motor 8 rotates, the center axis of the wiping arm 4 rotates, and accordingly, the wiping arm 4 rotates to rise (FIG. 62 described later).

The upper-to-lower motor 8 is rotatably fixed to a rotary shaft of the exposure motor 9. That is, when the exposure motor 9 rotates, the upper-to-lower motor 8 rotates by angular movement, and accordingly, the wiping arm 4 is exposed.

A state when paper is placed on the pressing unit 4*a* will be described with reference to FIG. 61C. First, the special paper 11*b* is inserted into a paper injection port 14*a* of a paper supply unit 14 as illustrated in FIG. 61C(a). When such insertion is detected by a not-shown sensor, an upper roller 14*g* and a lower roller 14*i* are rotated by a not-shown motor. Accordingly, the special paper 11*b* is delivered, and then, is placed on a delivery unit 14*l*. The delivery unit 14*l* is slidable right to left along a sliding groove 14*m* on the plane of paper. Various mechanisms for sliding are conceivable. For example, a mechanism is conceivable, in which the delivery unit 14*l* is fixed to a ball screw attached to a not-shown screw shaft, and the ball screw slides in association with rotation of the screw shaft by a not-shown motor. However, the present invention is not specifically limited to above.

When a not-shown sensor detects that the special paper 11*b* has been placed on the delivery unit 14*l*, the delivery unit 14*l* begins sliding as illustrated in FIG. 61C(b). Accordingly, the upper roller 14*g* and the lower roller 14*i* rotate. Thus, as illustrated in FIGS. 61C(b) to 61C(e), the special paper 11*b* is fed to the left on the plane of paper. As illustrated in FIGS. 61C(d) to 61C(e), when the special paper 11*b* is delivered out of the upper roller 14*g* and the lower roller 14*i*, a not-shown sensor detects that the paper has been delivered, and then, the upper roller 14*g* and the lower roller 14*i* are stopped. In this state, loading of the special paper 11*b* on the pressing unit 4*a* begins. As illustrated in FIGS. 61C(e) to 61C(f), when loading of the special paper 11*b* on the pressing unit 4*a* begins, the special paper 11*b* remains on the pressing unit 4*a* because of friction between the pressing unit 4*a* and the special paper 11*b*. When the delivery unit 14*l* reaches the leftmost end of the sliding groove 14*m*, the special paper 11*b* is brought into a state in which the special paper 11*b* is placed on the pressing unit 4*a*. After FIG. 61C(f), the wiping arm 4 moves to an exposed position. Accordingly, the delivery unit 14*l* returns to an original position of FIG. 61C(a).

As described above, the paper supply unit 14 of the ninth embodiment is configured such that the paper is delivered by the upper and lower rollers 14*g*, 14*i* as paper feeding rollers and that the delivery unit 14*l* moves in association with rotation of the paper feeding rollers to place the paper 11*b* on the pressing unit 4*a*. Such a mechanism of the paper supply unit 14 can be also utilized in other embodiments employing the first technique than the ninth embodiment.

FIG. 62 is a view of movement transition of the pressing unit 4*a*. The pressing unit 4*a* is attached to the tip end of the wiping arm 4, the tip end being bent two times in the L-shape. The pressing unit 4*a* is attached to the position eccentric with respect to the center axis of the wiping arm 4. The pressing unit 4*a* is attached to the wiping arm 4 by a rotary portion 4*r*. FIG. 163 is a perspective view clarifying an internal structure of the pressing unit 4*a*. A spherical bearing structure may be utilized for the rotary portion 4*r*, or the pressing unit 4*a* may be rotatably attached to the tip end of the arm as illustrated in FIG. 163. The pressing unit 4*a* has such a weight that the pressing unit 4*a* can be held horizontal. As illustrated in FIG. 62(*b*), a protrusion 4*s* protrudes from the rotary portion 4*r*. A protrusion 4*t* (a wall portion 4*t* in FIG. 163) protrudes on the inside of a portion of the pressing unit 4*a*, the portion being to contact the vicinity of the anus.

As illustrated in FIG. 62(*a*), when the wiping arm 4 rotates clockwise about the axial center thereof on the plane of paper, the pressing unit 4*a* lowers due to its own weight while balancing horizontally. The state of lowering the pressing unit 4*a* as illustrated in FIG. 62(*a*) is specifically illustrated in FIG. 62(*b*). In a final state of transition of FIG. 62(*b*), paper supply by the paper supply unit 14 is performed as illustrated in FIG. 61C.

As illustrated in FIG. 62(*c*), when the wiping arm 4 rotates counterclockwise about the axial center thereof on the plane of paper, the pressing unit 4*a* lifts due to its own weight while balancing horizontally. A state in which the protrusion 4*s* contacts the protrusion 4*t* is at the maximum height of the pressing unit 4*a*. In this state, wiping is performed.

As illustrated in FIG. 62(*d*), when the pressing unit 4*a* reaches the maximum height and wiping is completed, the wiping arm 4 rotates counterclockwise about the axial center thereof on the plane of paper. Then, a state in which the protrusion 4*s* and the protrusion 4*t* are kept contact with each other is brought, and therefore, the pressing unit 4*a* cannot be held horizontal and inclines downward. In this manner, the paper can be dropped.

After paper dropping, the wiping arm 4 rotates counterclockwise about the axial center thereof on the plane of paper as illustrated in FIG. 62(*e*). When the pressing unit 4*a* reaches the maximum height, and in turn, rotates clockwise about the axial center thereof on the plane of paper, the protrusions 4*s*. 4*t* contacting each other are released from each other, and then, the pressing unit 4*a* returns to an original point while being held horizontal. This brings a standby state for subsequent wiping.

As described above, in the ninth embodiment, the pressing unit 4*a* is provided eccentric with respect to the rotation center of the wiping arm 4. Thus, the pressing unit 4*a* can be moved upward by rotation of the wiping arm 4 about the axial center thereof.

Figure 63:
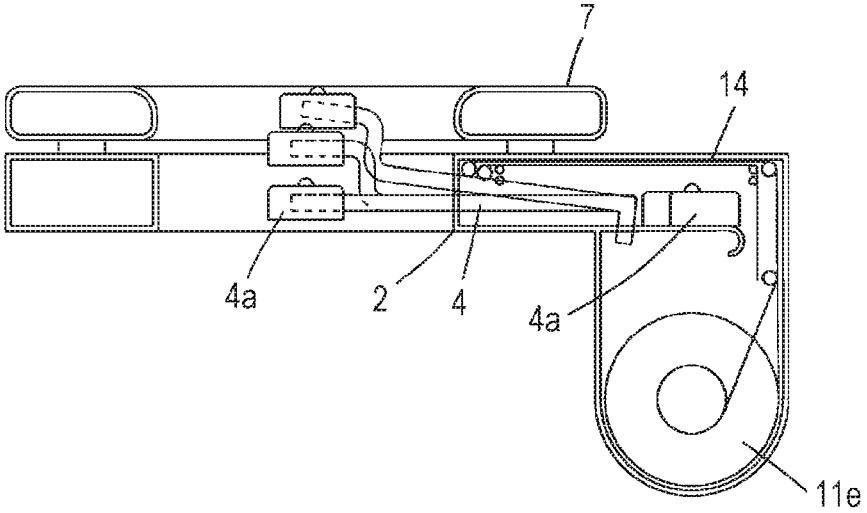
FIG. 63 is a front view of the internal structure in a case where rolled paper 11*e* is placed on a paper supply unit 14 for realizing automatic paper supply.

Note that FIG. 63 is a front view of the internal structure in a case where rolled paper 11*e* is placed on the paper supply unit 14 for realizing automatic paper supply. As illustrated in FIG. 63, the rolled paper 11*e* formed as a roll of the special paper 11*b* is used. Various rollers deliver the paper such that the paper is placed on the pressing unit 4*a*, and the delivered paper is cut to a predetermined length by a not-shown cutting unit. With this structure, automatic paper supply can be also realized in the ninth embodiment.

As described above, in the ninth embodiment, structure simplification, cost reduction, sanitation, usability, and easy maintenance of the buttocks wiping device can be realized using the first technique.

Figure 64:
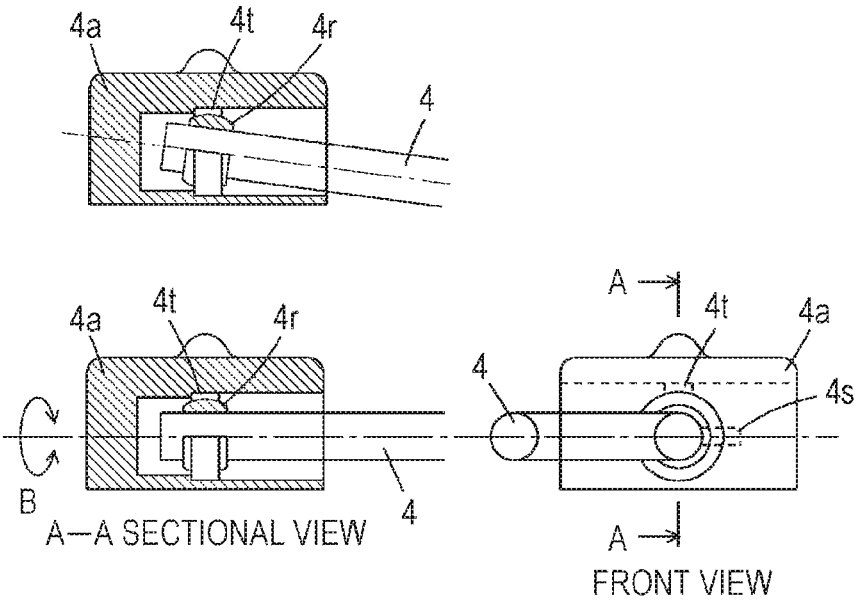
FIG. 64 is a front view and a sectional view of an example of a specific structure of the pressing unit 4*a;*

FIG. 64 is a front view and sectional views of an example of a specific structure of the pressing unit 4*a*. As illustrated in the front view of FIG. 64, the pressing unit 4*a* is attached to the bent tip end of the wiping arm 4. As illustrated in the sectional views of FIG. 64, the rotary portion 4*r* is attached to the tip end of the wiping arm 4. The rotary portion 4*r* is rotatable in a direction indicated by an arrow B. Although not shown in the sectional views, the protrusion 4*s* comes into contact with the protrusion 4*t* when the protrusion 4*s* indicated by a dashed line in the front view rotates in the direction indicated by the arrow B. In addition, the wiping arm 4 can be utilized in an inclined state as illustrated in the upper sectional view. An upper surface of the pressing unit 4*a* has a curved shape (a raised portion in this case) along the shape of the vicinity of the anus of the buttocks.

(Variations of Pressing Unit 4*a*)

Figure 65:
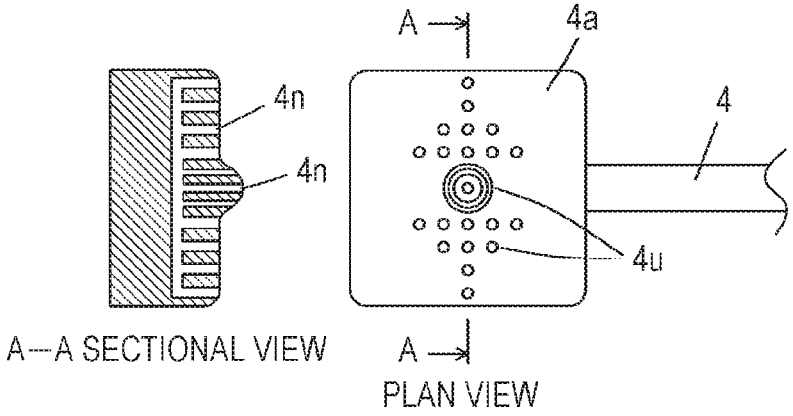
FIG. 65 is a plan view and a sectional view of the pressing unit 4*a* used when the paper is sucked by a negative pressure.

Some variations of the pressing unit 4*a* will be described. FIG. 65 is a plan view and a sectional view of the pressing unit 4*a* used when the paper is sucked using a negative pressure. As illustrated in FIG. 65, one or more air holes 4*u* are provided at the pressing unit 4*a*. The inside of the wiping arm 4 communicates with a negative pressure generation device (not shown) configured to generate the negative pressure. By generation of the negative pressure, movement of the wiping arm 4 and wiping of the buttocks are performed with the paper being sucked to the pressing unit 4*a*. Thus, movement and wiping can be performed without the paper dropping from the pressing unit 4*a*. Moreover, when a positive pressure generation device can be attached to the pressing unit 4*a*, a positive pressure is generated so that air can come out of the air holes 4*u*. In this case, the positive pressure may be, upon wiping, generated such that wiping is performed with the paper being slightly lifted, or may be generated to blow down the paper upon paper discarding.

Figure 66:
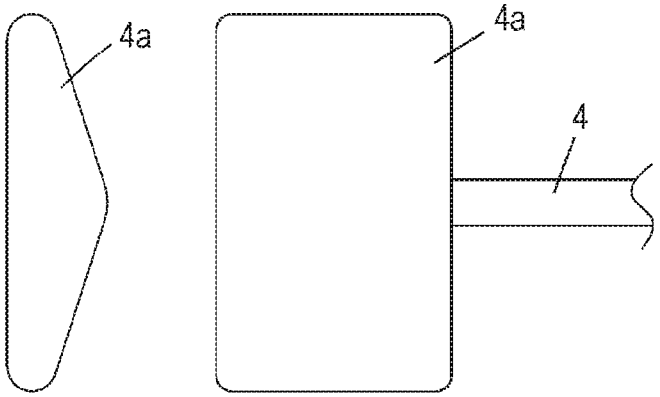
FIG. 66 is a plan view and a left side view of the pressing unit 4*a* expandable by a positive pressure.

FIG. 66 is a plan view and a left side view of the pressing unit 4*a* configured to expand using the positive pressure. The pressing unit 4*a* is in a bag shape, and has a shape expandable using the positive pressure as illustrated in the left side view. The wiping arm 4 and the not-shown positive pressure generation device communicate with each other. As in the first technique, the wiping arm may move with the paper being placed on the pressing unit 4*a* In this case, the paper is placed on the pressing unit 4*a* with the pressing unit 4*a* being expanded. Moreover, as in the second technique, the pressing unit 4*a* may move to below the separately-exposed paper to wipe the buttocks. In this case, the pressing unit 4*a* expanded in advance may move to below the paper. Alternatively, the contracted pressing unit 4*a* may move to below the paper, and after expanded, may wipe the buttocks. Moreover, the pressing unit 4*a* may be made of a disposable water-soluble material so that the pressing unit 4*a* can be flushed down a toilet. It is sanitary when the pressing unit 4*a* can be discarded after wiping and a new pressing unit 4*a* can be attached for subsequent wiping. In a case where the pressing unit 4*a* is disposable, the pressing unit 4*a* itself is used for wiping without the paper being placed on the pressing unit 4*a*, and is discarded after wiping.

Figure 67:
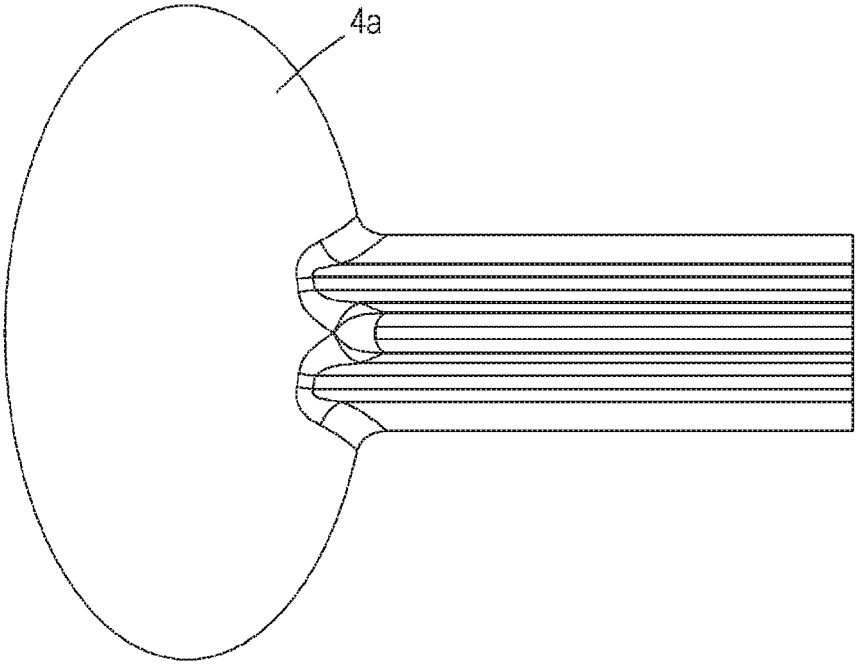
FIG. 67 is a plan view of a disposable pressing unit 4*a;*
Figure 68:
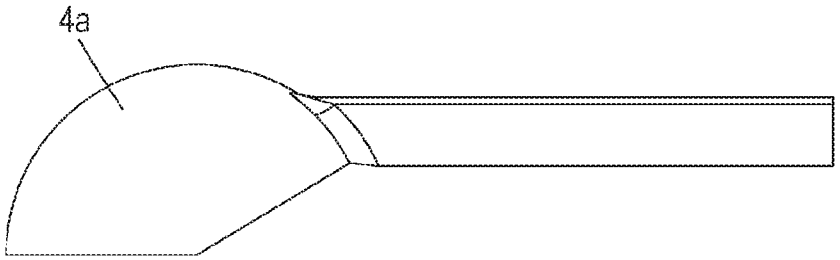
FIG. 68 is a front view of the disposable pressing unit 4*a;*
Figure 69:
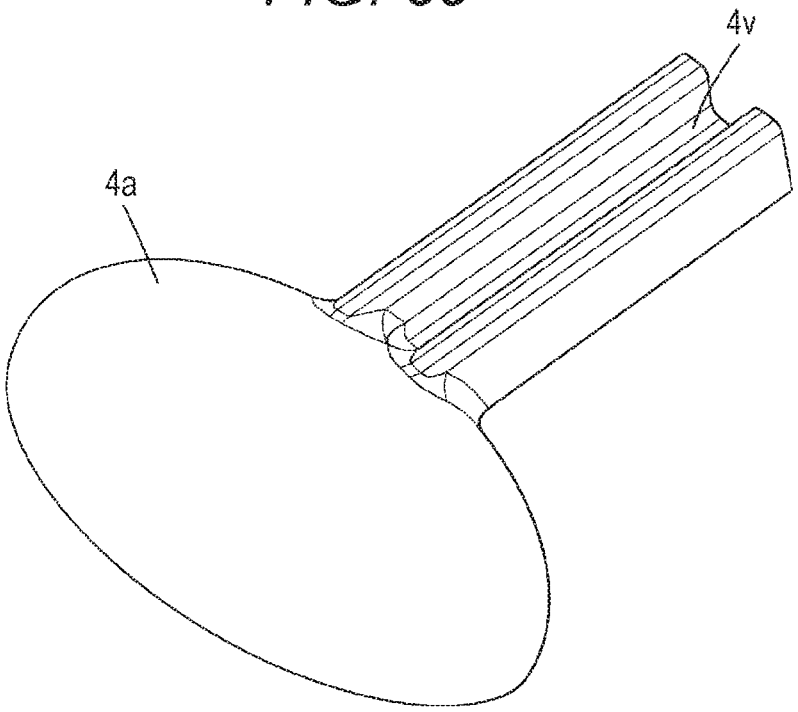
FIG. 69 is a perspective view of the disposable pressing unit 4*a;*
Figure 70:
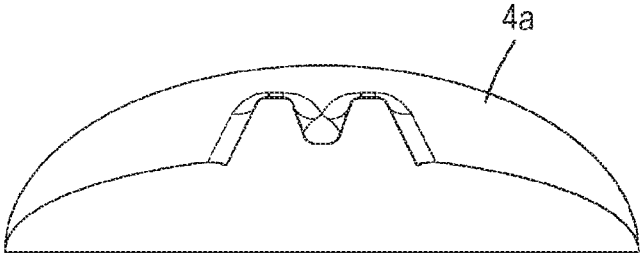
FIG. 70 is a right side view of the disposable pressing unit 4*a;*
Figure 71:
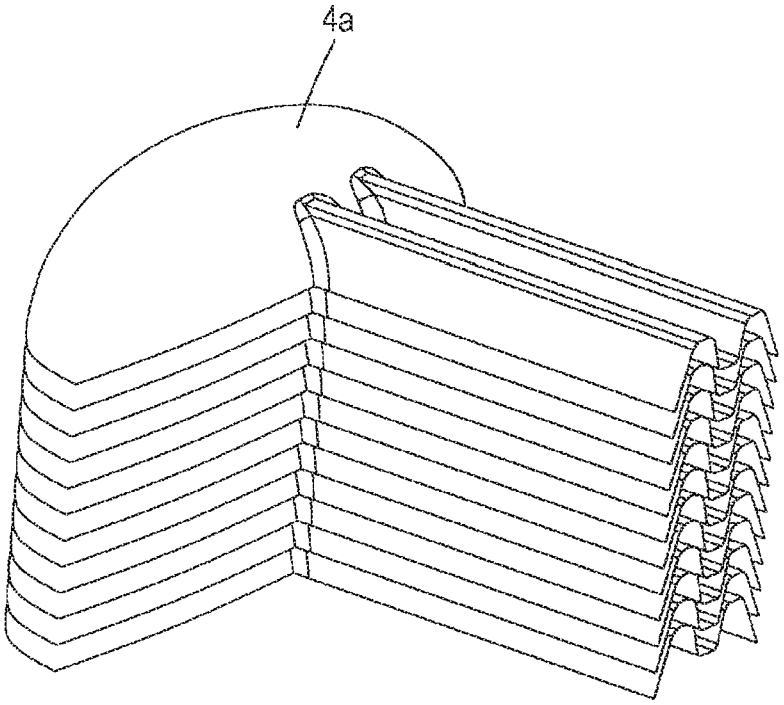
FIG. 71 is a perspective view of a state when the disposable pressing units 4*a* are stacked on each other in the upper-to-lower direction.

FIG. 67 is a plan view of the disposable pressing unit 4*a*. FIG. 68 is a front view of the disposable pressing unit 4*a*. FIG. 69 is a perspective view of the disposable pressing unit 4*a*. FIG. 70 is a right side view of the disposable pressing unit 4*a*. FIG. 71 is a perspective view of a state when the disposable pressing units 4*a* are stacked on each other in the upper-to-lower direction. The disposable pressing unit 4*a* is made of a water-soluble water-degradable material which can be flushed down the toilet. The pressing unit 4*a* is formed in such a manner that such a material is molded by pressing. A high water absorbent material may be joined to an upper surface of a rounded curved surface of the pressing unit 4*a*. As illustrated in FIG. 69, the rounded curved surface portion is provided with a gripping portion 4*v* having a W-shaped cross section. A wiping arm drive unit is provided with a gripping mechanism such as a parallel hand, and the gripping portions 4*v* are, one by one, held by the gripping mechanism and are utilized for wiping. As illustrated in FIG. 71, the pressing units 4*a* stacked on each other in the upper-to-lower direction are, one by one, gripped by the gripping mechanism, and the buttocks are wiped.

Figure 72:
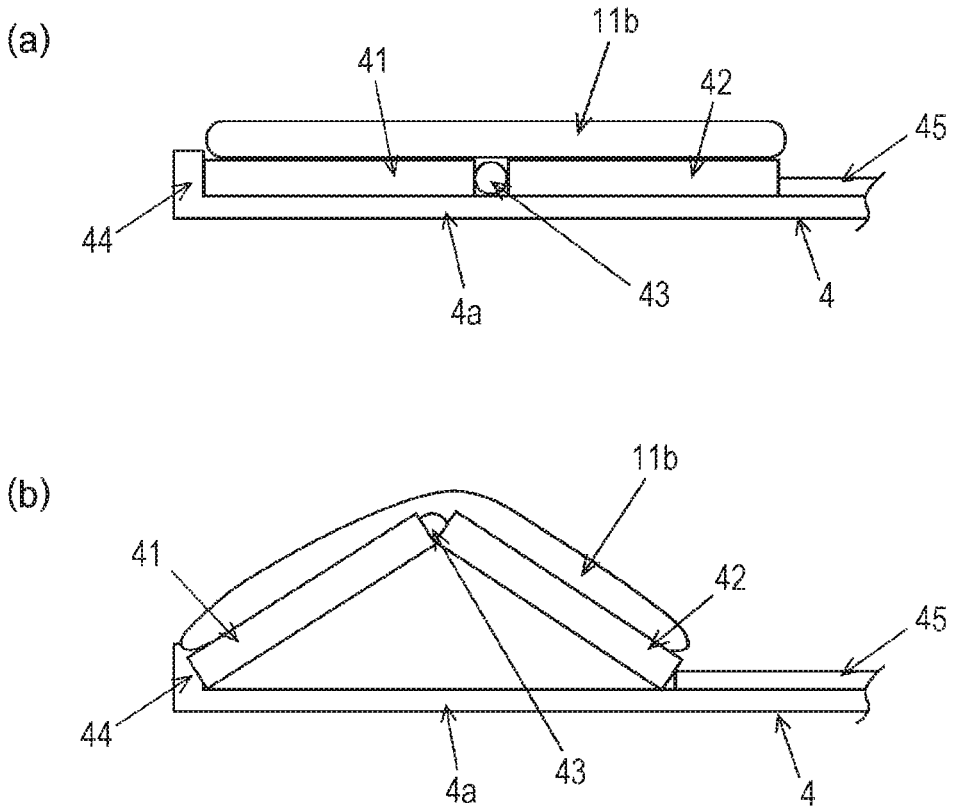
FIG. 72 is a front view of another example of the embodiment of the pressing unit 4*a;*

FIG. 72 is a front view of an example of another embodiment of the pressing unit 4*a*. FIG. 72(*a*) illustrates a state when the paper 11*b* is placed on the pressing unit 4*a*. The pressing unit 4*a* includes a rising portion 41, a rising portion 42, a rotary portion 43, and a protrusion 44. The wiping arm 4 further includes a forward drive portion 45. FIG. 72(*b*) illustrates a state when the paper 11*b* is lifted. The rising portions 41, 42 are coupled together by a hinge structure, and therefore, are bendable at the rotary portion 43. The forward drive portion 45 is moved forward by a not-shown drive mechanism. When the forward drive portion 45 moves forward, the rising portion 42 is pushed, and accordingly, the rising portion 41 protrudes toward the protrusion 44. Thus, two rising portions 42 rise in a bent state. With this structure, the paper is lifted. Using such a mechanism for lifting the paper 11*b* from a horizontal state, the buttocks can be wiped without upper-to-lower movement of the wiping arm 4 or with the reduced upper-to-lower movement width of the wiping arm 4.

Figure 73:
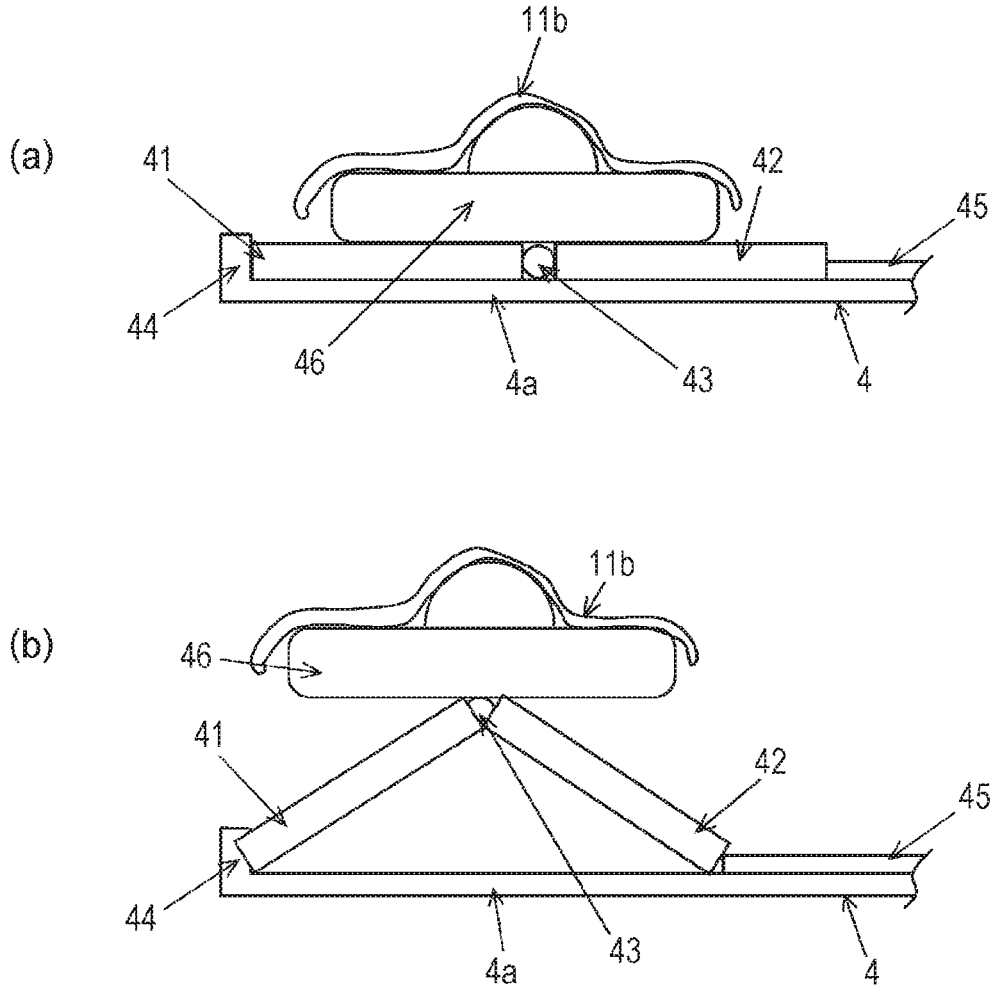
FIG. 73 is a front view of a variation of the pressing unit 4*a* of FIG. 72.

FIG. 73 is a front view of a variation of the pressing unit 4*a* of FIG. 72. Unlike the pressing unit 4*a* of FIG. 72, the pressing unit 4*a* illustrated in FIG. 73 includes a tip end raised portion 46 on the rising portions 41, 42. The tip end raised portion 46 is rotatably attached onto the rising portions 41, 42. FIG. 73(*a*) illustrates a state when the paper 11*b* is placed on the pressing unit 4*a*. FIG. 73(*b*) illustrates a state when the paper 11*b* is lifted. When the rising portions 41, 42 are lifted by the forward drive portion 45, the tip end raised portion 46 is also lifted together. Thus, the buttocks can be wiped. With the tip end raised portion 46, the raised portion can firmly contact the anus, leading to reliable wiping.

Note that the rising mechanisms illustrated in FIGS. 72 and 73 have been set forth merely as examples, and the present invention is not limited to above. In addition, a mechanism such as a pantograph may be utilized, or a mechanism configured to expand a rubber tube or an air bag by a positive pressure may be used to lift the paper.

Figure 74:
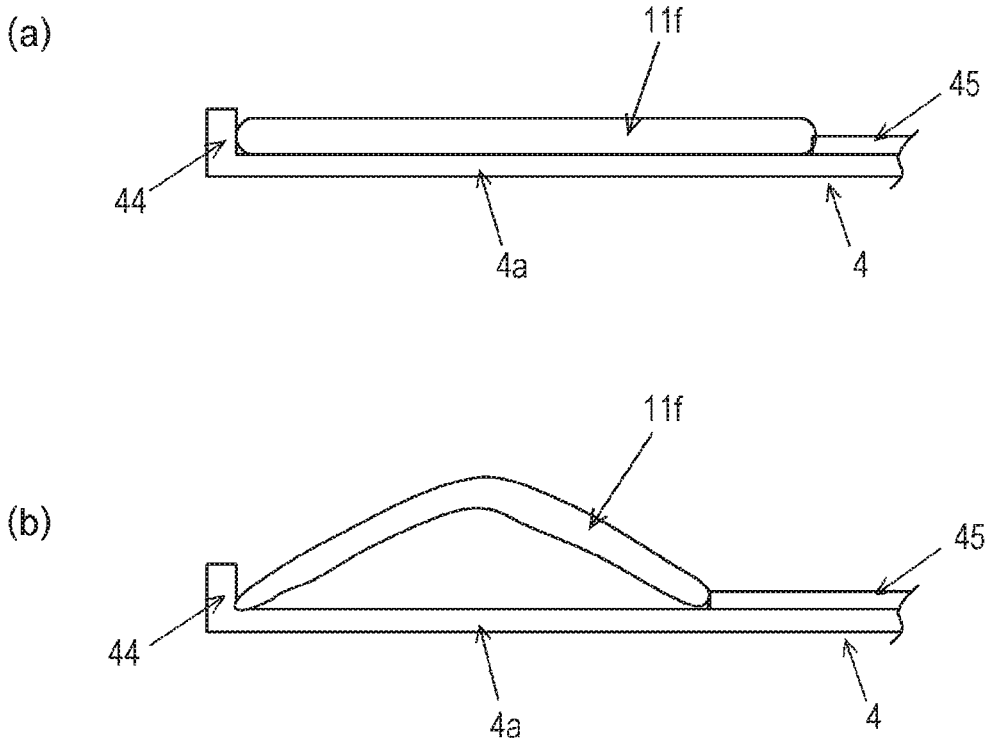
FIG. 74 is a front view of the structure of the pressing unit 4*a* in a case where special paper 11*f* is used to rise the special paper itself.

FIG. 74 is a front view of the structure of the pressing unit 4*a* in a case where the special paper 11*f* is used to rise the special paper itself. FIG. 74(*a*) illustrates a state when the special paper 11*f* is placed on the pressing unit 4*a*. FIG. 74(*b*) illustrates a state when the special paper 11*f* rises. The special paper 11*f* used herein is thick paper having a certain hardness. For example, an upper portion of the special paper 11*f* may be made of a water absorbent material. For example, a water absorbent portion of toilet paper may be joined onto thick water-soluble paper (a base material portion) having a certain hardness. When the special paper 11*f* is pushed by the forward drive portion 45, the special paper 11*f* bends and rises. Wiping is executed in such a rising state. With a folding line formed at the base material portion, the special paper 11*f* is bendable at the folding line. Moreover, e.g., a box shape which can be assembled with a single touch of a button can be employed as the shape of the base material portion of the special paper 11*f*. When a so-called one-touch carton shape is employed for the base material portion, a one-touch carton can rise into a box shape by forward driving by the forward drive portion 45. Thus, the water absorbing portion is lifted for wiping the buttocks. When the special paper 11*f* itself is configured to rise as described above, wiping can be performed without upper-to-lower movement of the wiping arm 4 or with the reduced upper-to-lower movement width of the wiping arm 4.

Figure 75:
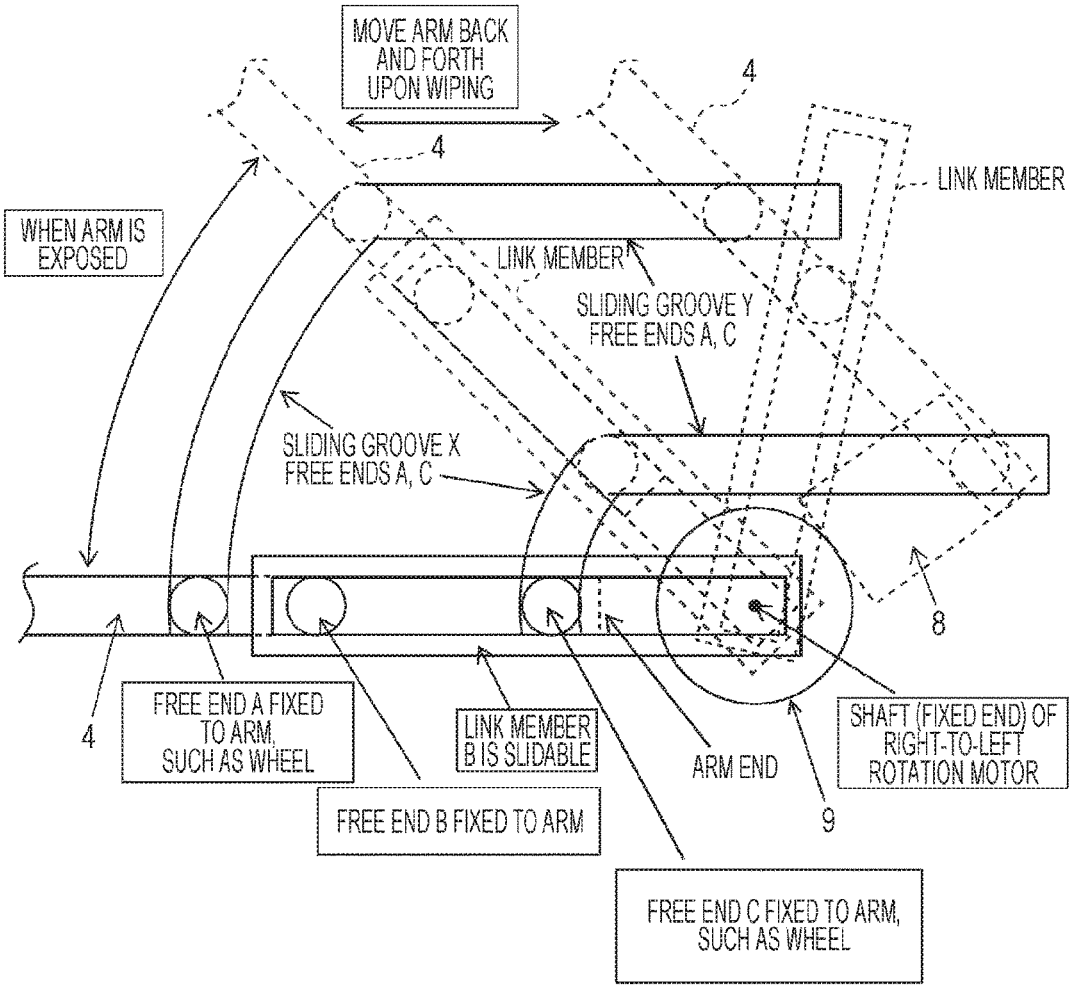
FIG. 75 is a view of a link mechanism in an attempt to move the pressing unit 4*a* at a wiping position in the embodiment of FIG. 51A.

FIG. 75 is a view of a link mechanism in an attempt to move the pressing unit 4*a* back and forth at a wiping position in the embodiment of FIG. 51A. The link mechanism using the exposure motor 9 to move the wiping arm 4 back and forth is illustrated. A linear sliding groove Y for front-to-back movement is provided at an end portion of each sliding groove X in an arc shape about the rotary shaft of the exposure motor 9. For example, wheels or pulleys are provided at two free ends A. C fixed to a lower portion of the wiping arm 4, thereby sliding in the sliding grooves X, Y. A free end B is fixed to an upper portion of the wiping arm 4, and is slidable in a link member. The link member is rotatable about the rotary shaft of the exposure motor 9. When the exposure motor 9 rotates, the link member rotates. Accordingly, the free end B slides, and the free ends A, C also slide in the sliding grooves X. When the free ends A, C reach the sliding grooves Y, the free ends A, C slide in the sliding grooves Y in association with sliding of the free end B in the link member. The upper-to-lower motor 8 is fixed to one end of the wiping arm 4, and is slidable together with the wiping arm 4. The wiping arm 4 slides in the sliding grooves Y in association with rotation of the exposure motor 9, and therefore, the wiping arm 4 is movable back and forth upon wiping. With front-to-back movement of the wiping arm 4, wiping is reliably performed. Note that the link mechanism described herein has been set forth merely as an example, and is not intended to limit the present invention. In the present invention, when movement of the wiping arm 4 is restricted using the link mechanism, the number of motors to be used can be reduced while complicated movement can be realized.

Tenth Embodiment

In a tenth embodiment, a buttocks wiping device 1 employing the second technique, i.e., the technique of wiping the buttocks in such a manner that paper is exposed below the buttocks separately from a wiping arm and a pressing unit of the wiping arm pushes up the exposed paper from below, will be described.

Figure 76A:
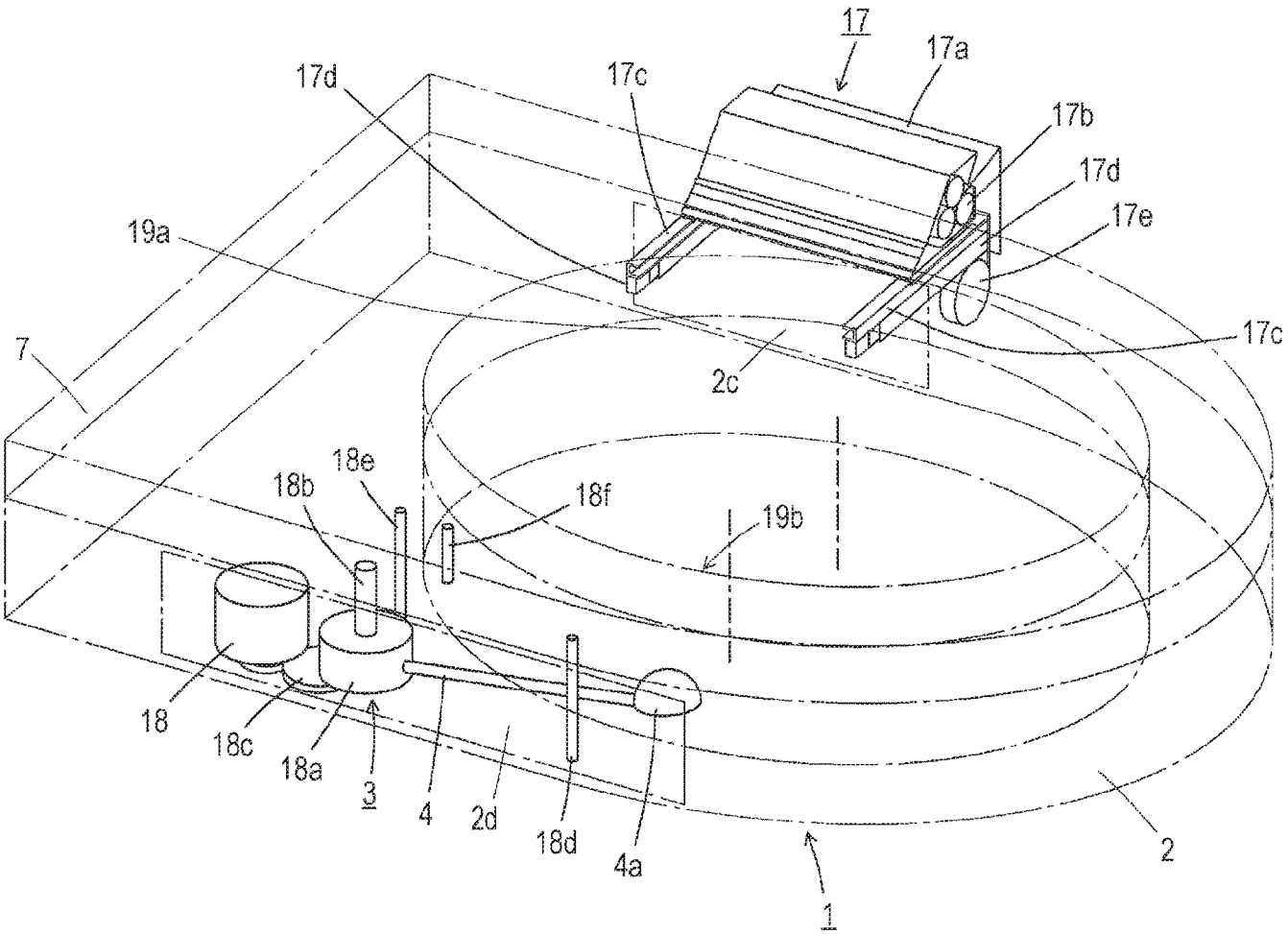
FIG. 76A is a perspective view of a buttocks wiping device 1 of a tenth embodiment of the present invention.
Figure 76B:
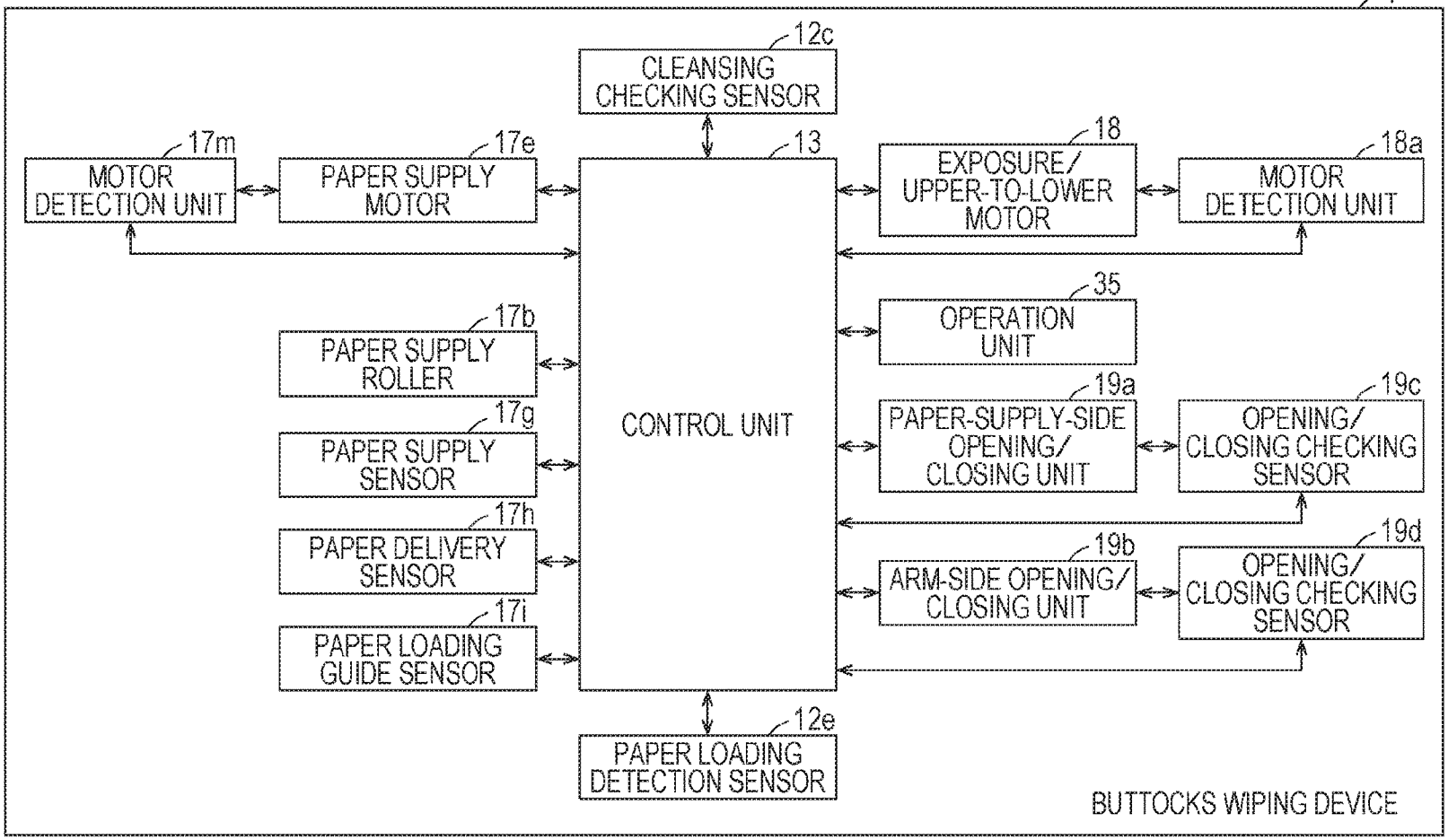
FIG. 76B is a block diagram of a functional configuration of the buttocks wiping device 1.
Figure 76C:
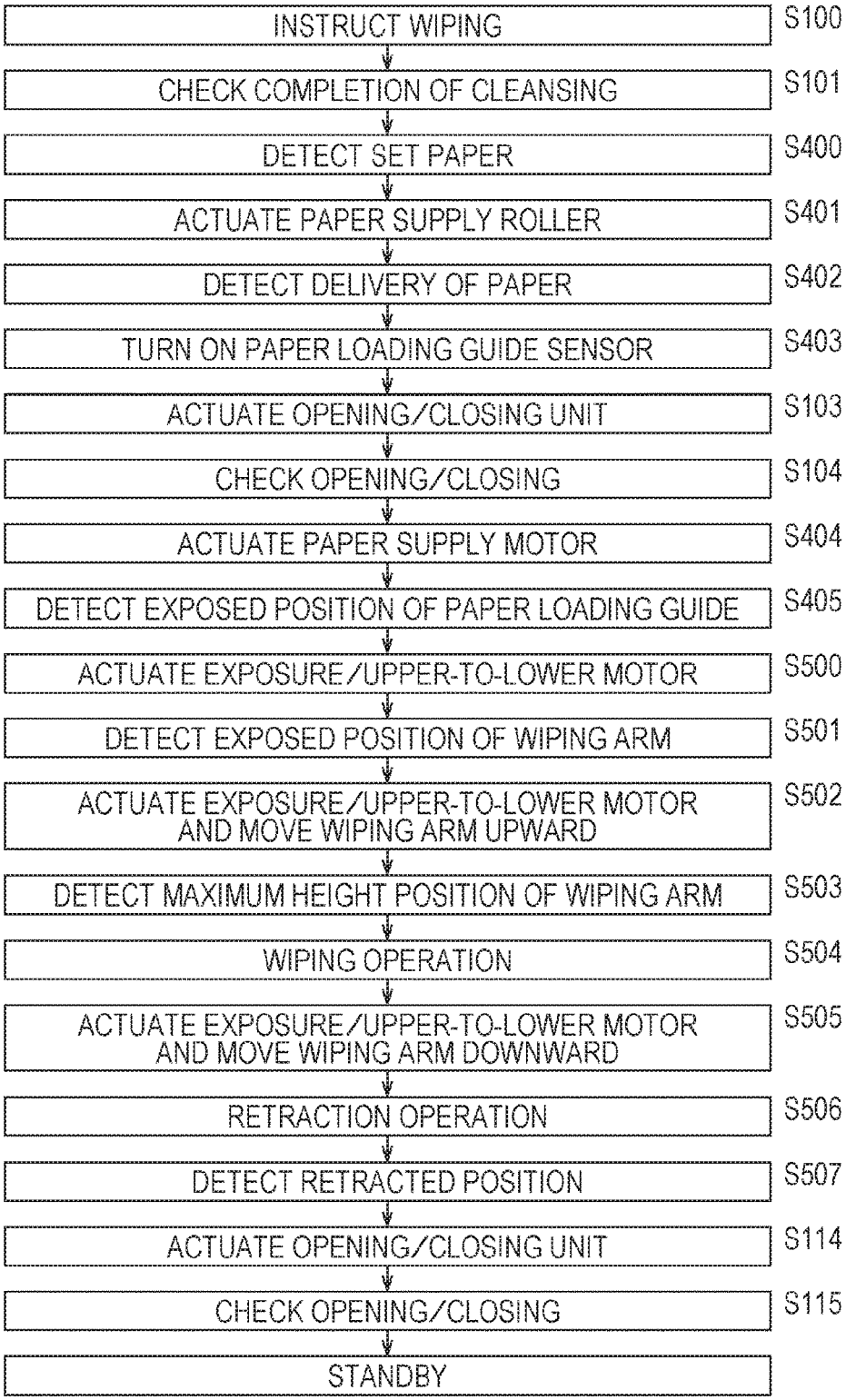
FIG. 76C is a flowchart of operation of the buttocks wiping device 1.
Figure 77:
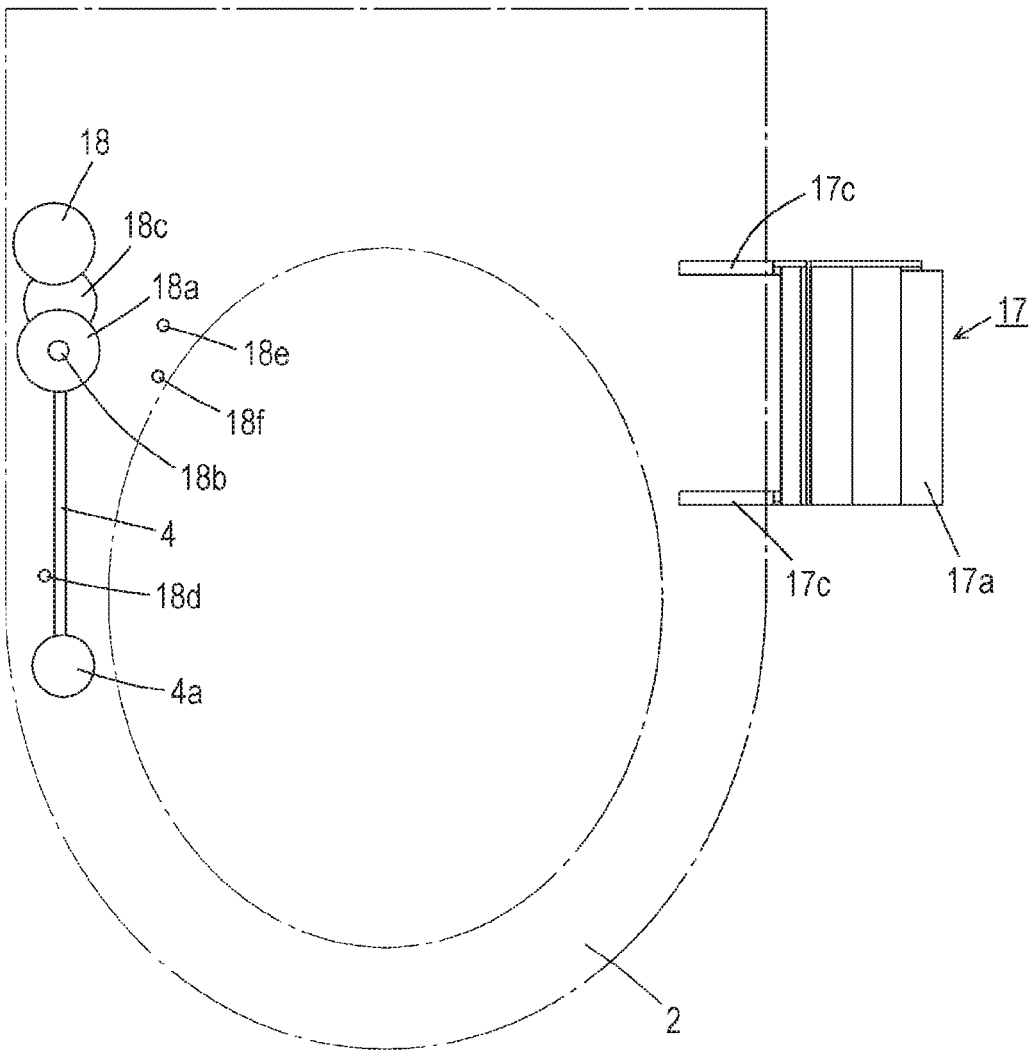
FIG. 77 is a plan view of the buttocks wiping device 1.
Figure 78:
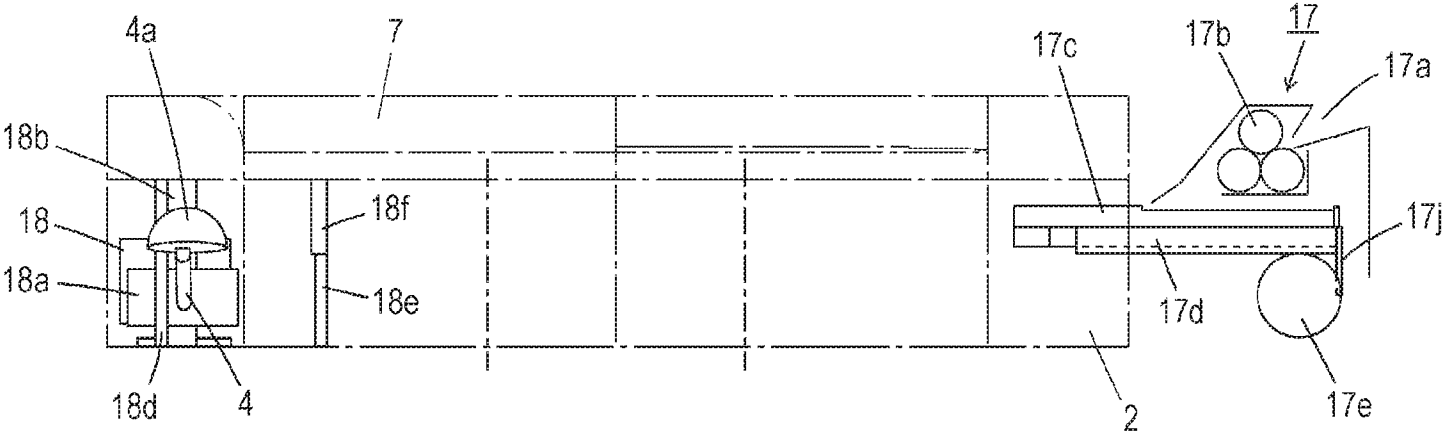
FIG. 78 is a front view of the buttocks wiping device 1 when a wiping arm 4 is retracted.
Figure 79:
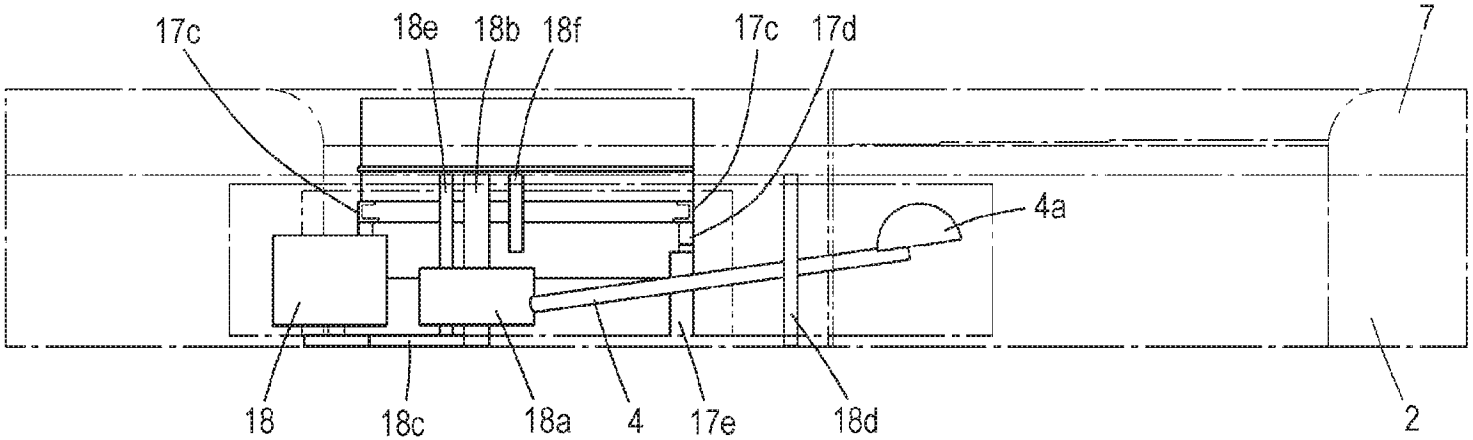
FIG. 79 is a left side view of the buttocks wiping device 1 when the wiping arm 4 is retracted.
Figure 80:
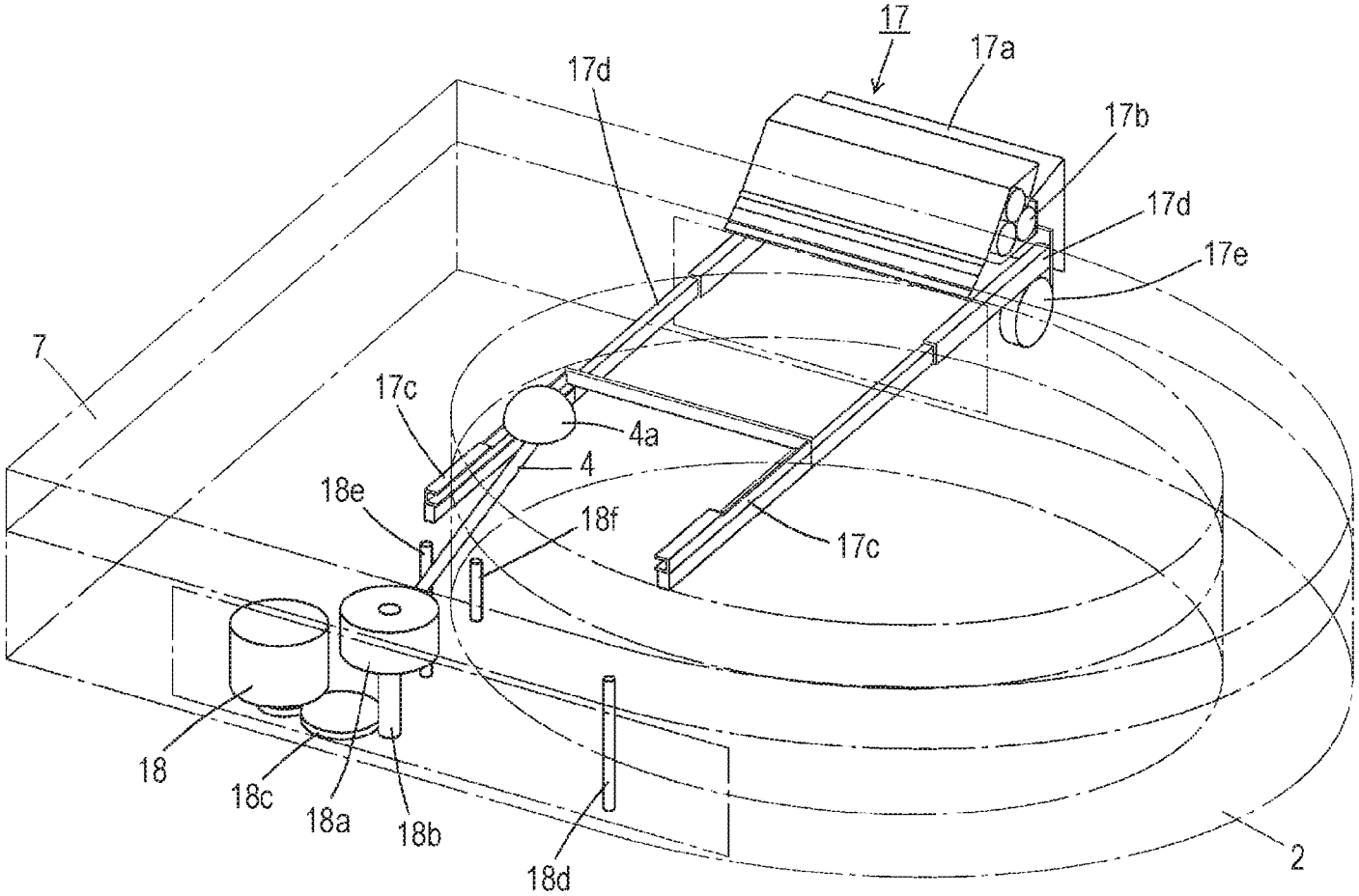
FIG. 80 is a perspective view of the buttocks wiping device 1 when the wiping arm 4 is positioned at the maximum height.
Figure 81:
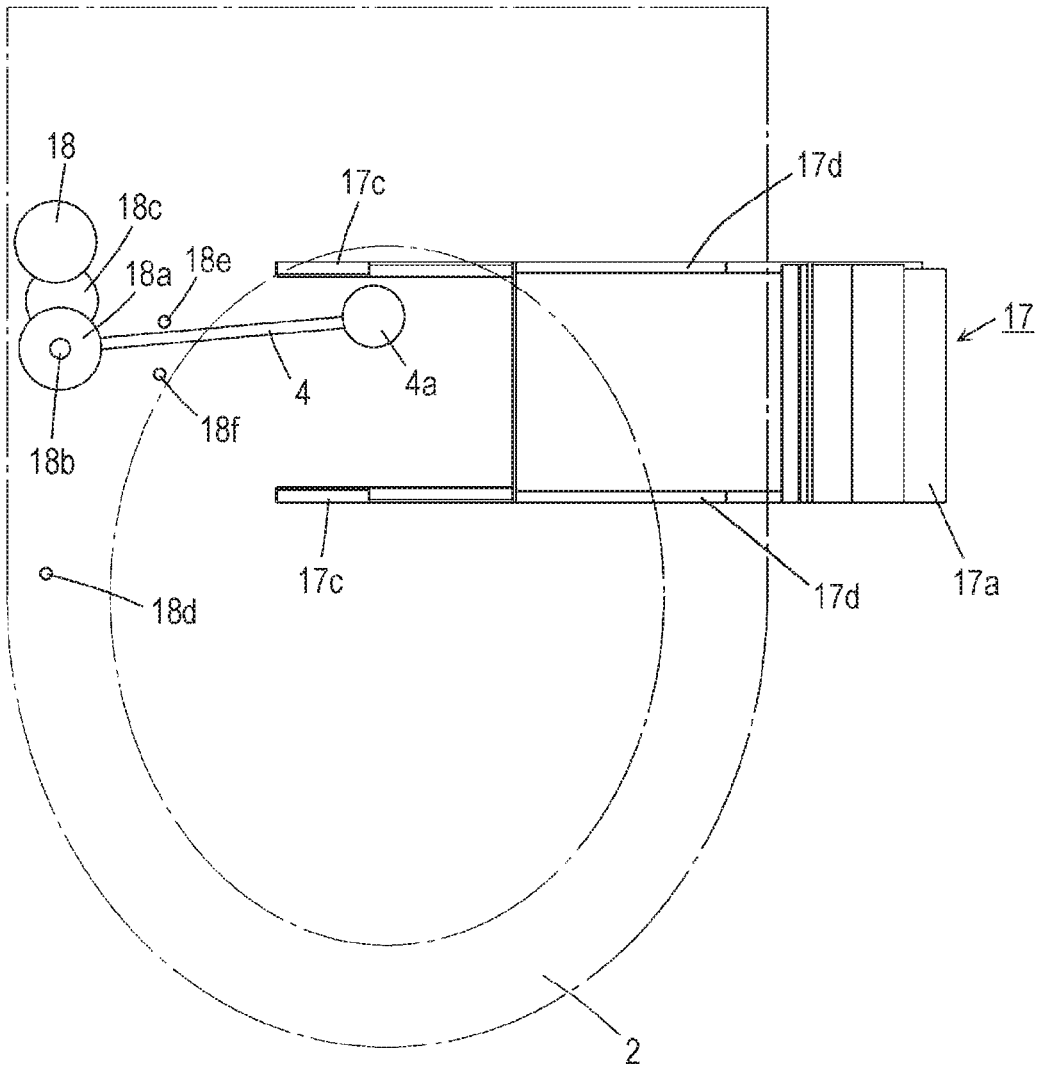
FIG. 81 is a plan view of the buttocks wiping device 1 when the wiping arm 4 is positioned at the maximum height.
Figure 82:
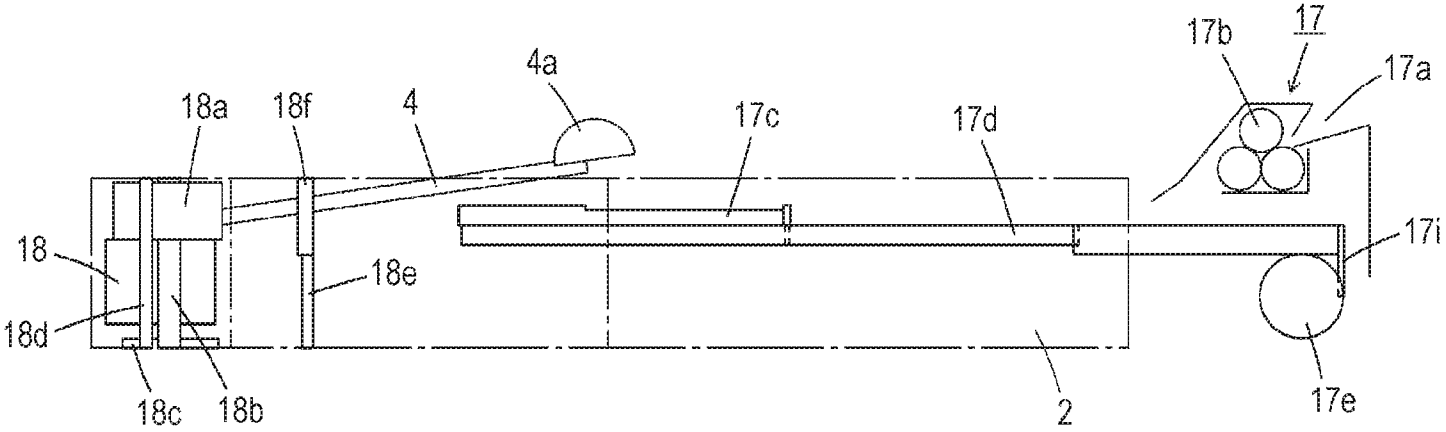
FIG. 82 is a front view of the buttocks wiping device 1 when the wiping arm 4 is positioned at the maximum height.
Figure 83:
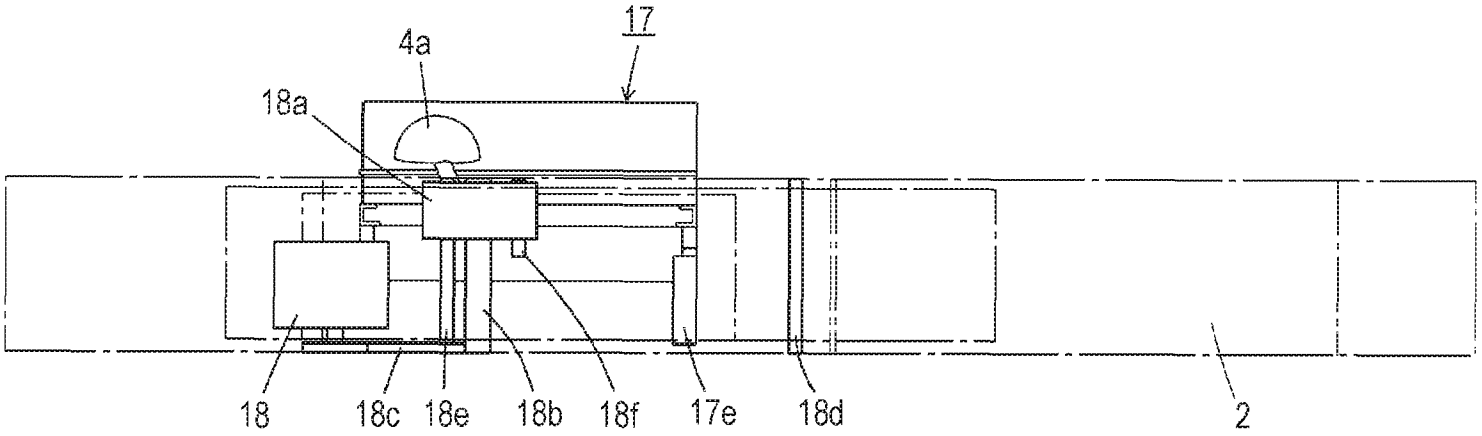
FIG. 83 is a left side view of the buttocks wiping device 1 when the wiping arm 4 is positioned at the maximum height.
Figure 84:
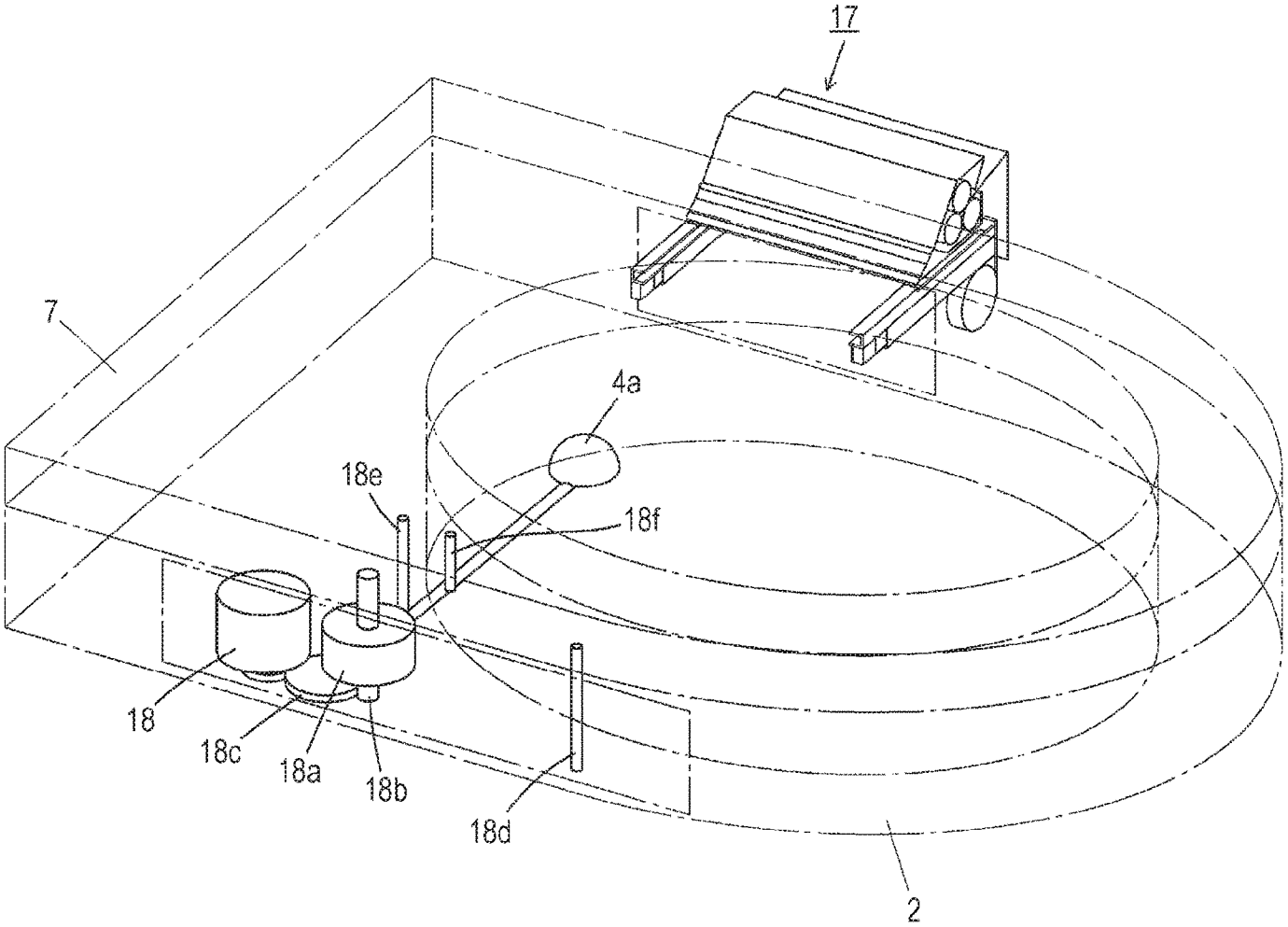
FIG. 84 is a perspective view of the buttocks wiping device 1 when the wiping arm 4 is returned.
Figure 85:
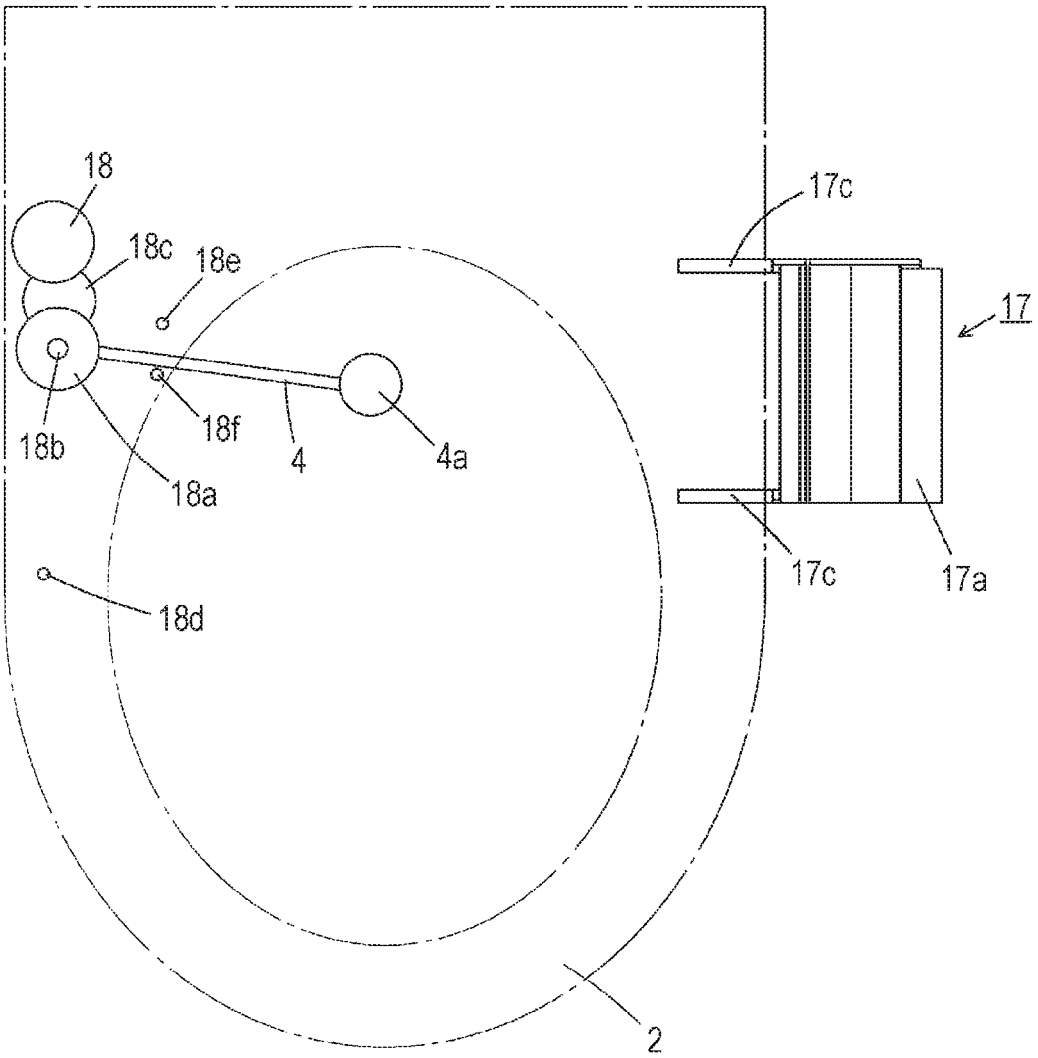
FIG. 85 is a plan view of the buttocks wiping device 1 when the wiping arm 4 is returned.
Figure 86:
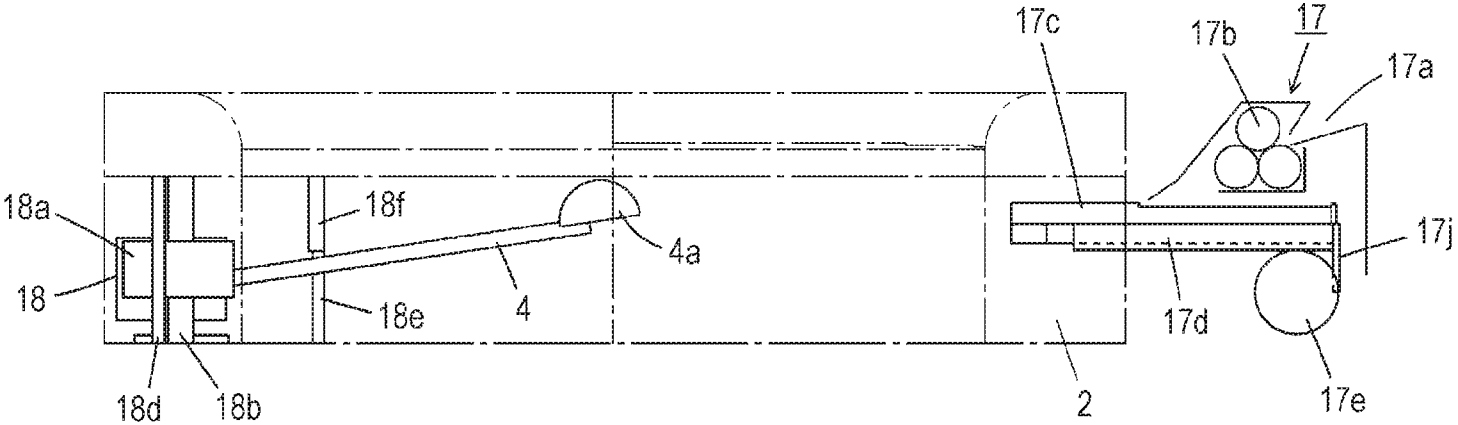
FIG. 86 is a front view of the buttocks wiping device 1 when the wiping arm 4 is returned.
Figure 87:
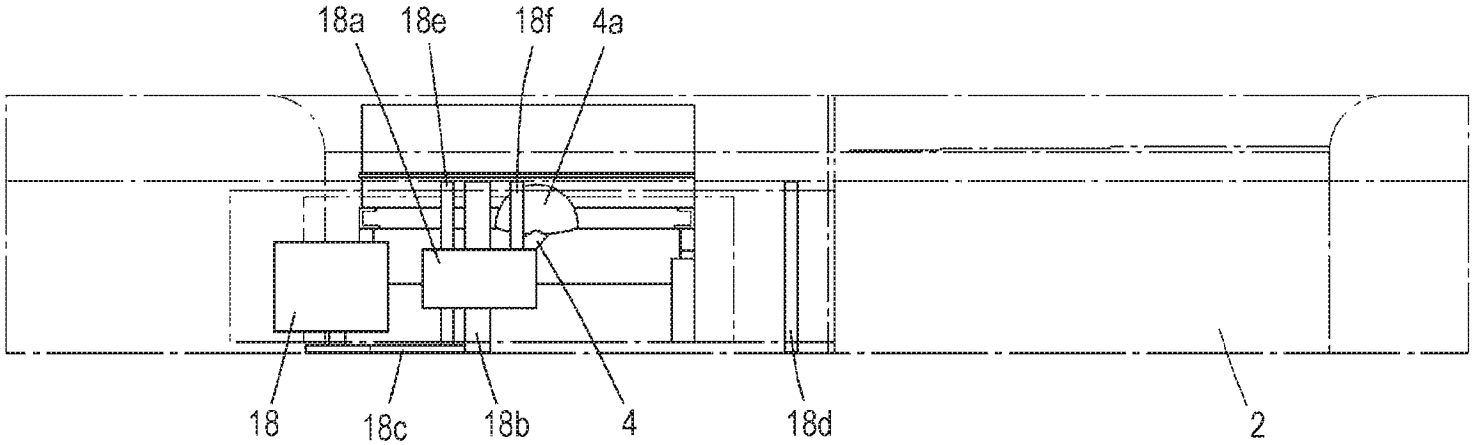
FIG. 87 is a left side view of the buttocks wiping device 1 when the wiping arm 4 is returned.

FIG. 76A is a perspective view of the buttocks wiping device 1 of the tenth embodiment of the present invention. FIG. 76B is a block diagram of a functional configuration of the buttocks wiping device 1. FIG. 76C is a flowchart of operation of the buttocks wiping device 1. FIG. 77 is a plan view of the buttocks wiping device 1. A toilet seat 7 is not shown in FIG. 77 for the sake of clarifying an internal structure. FIG. 78 is a front view of the buttocks wiping device 1 when a wiping arm 4 is retracted. FIG. 79 is a left side view of the buttocks wiping device 1 when the wiping arm 4 is retracted. FIG. 80 is a perspective view of the buttocks wiping device 1 when the wiping arm 4 is positioned at the maximum height. FIG. 81 is a plan view of the buttocks wiping device 1 when the wiping arm 4 is positioned at the maximum height. FIG. 82 is a front view of the buttocks wiping device 1 when the wiping arm 4 is positioned at the maximum height. FIG. 83 is a left side view of the buttocks wiping device 1 when the wiping arm 4 is positioned at the maximum height. The toilet seat 7 is not shown in FIGS. 81 to 83 for the sake of clarifying the internal structure. FIG. 84 is a perspective view of the buttocks wiping device 1 when the wiping arm 4 is returned. FIG. 85 is a plan view of the buttocks wiping device 1 when the wiping arm 4 is returned. The toilet seat 7 is not shown in FIG. 85 for the sake of clarifying the internal structure. FIG. 86 is a front view of the buttocks wiping device 1 when the wiping arm 4 is returned. FIG. 87 is a left side view of the buttocks wiping device 1 when the wiping arm 4 is returned. In each figure, a raised portion 2 and the toilet seat 7 are indicated by chain lines for the sake of clarifying the internal structure. Moreover, although a warm-water cleansing device is not shown in each figure, the warm-water cleansing device is provided at the back of the toilet seat 7, and the toilet seat 7 is rotatably attached to the warm-water cleansing device.

In the buttocks wiping device 1 of the eighth embodiment, the paper supply unit 17 and the wiping arm drive unit 3 are provided on the same side in the right-to-left direction when facing the toilet seat 7. However, in the buttocks wiping device 1 of the tenth embodiment, a paper supply unit 17 and a wiping arm drive unit 3 are provided facing each other on opposite sides in the right-to-left direction when facing the toilet seat 7. That is, the wiping arm 4 is provided on the side opposite to the position of the paper supply unit 17 in the right-to-left direction. In the tenth embodiment, the paper supply unit 17 is housed in a housing portion 2*c*, and the wiping arm 4 is retracted into a housing portion 2*b*. In the eighth embodiment, the exposure motor 9 and the upper-to-lower motor 8 are used as the mechanism for exposing and upwardly moving the wiping arm 4. However, in the buttocks wiping device 1 of the tenth embodiment, exposure and upper-to-lower movement are realized using a single exposure/upper-to-lower motor 18. Note that in the tenth embodiment, an exposure motor 9 and an upper-to-lower motor 8 may be used to expose the wiping arm 4 and move the wiping arm 4 up and down as in the eighth embodiment.

As illustrated in FIGS. 78 and 82, the structure of the paper supply unit 17 is a structure in which a belt 17*i* is winded around a rotary shaft of a paper supply motor 17*e* and is coupled to a nested structure of a push-out portion 17*d*. In such a structure, the belt 17*i* is unwinded such that the push-out portion 17*d* extends (FIG. 82), and is winded such that the push-out portion 17*d* contracts (FIG. 78). Moreover, as illustrated in FIG. 80, the wiping arm 4 is exposed from the left, and moves upward. Unlike the eighth embodiment, a paper loading guide 17*c* is in a U-shape opening on the left side such that the paper loading guide 17*c* does not interfere with a pressing unit 4*a* of the wiping arm 4 upon upward movement thereof. Note that as long as the paper loading guide 17*c* is in such a shape that the pressing unit 4*a* can passes through the paper loading guide 17*c* upon upward movement, the paper loading guide 17*c* is not limited to the illustrated example. Other structures are similar to those of the eighth embodiment.

The buttocks wiping device 1 is provided below the toilet seat 7 and the not-shown warm-water cleansing device. The buttocks wiping device 1 includes the wiping arm 4 and the wiping arm drive unit 3 in the housing portion 2*b* provided at the raised portion 2. Moreover, the buttocks wiping device 1 includes the paper supply unit 17 in the housing portion 2*c* provided at the raised portion 2. The wiping arm drive unit 3 includes the exposure/upper-to-lower motor 18, an arm coupling portion 18*a*, a screw shaft 18*b*, a gear 18*c*, a first stopping portion 18*d*, a second stopping portion 18*e*, and a third stopping portion 18*f*. As in the eight embodiment, the wiping arm 4 has the pressing unit 4*a* coupled through a hinge mechanism.

The buttocks wiping device 1 includes an arm-side opening/closing unit 19*b* for opening/closing the housing portion 2*d*, and a paper-supply-side opening/closing unit 19*a* for opening/closing the housing portion 2*c*. Although specific structures of the arm-side opening/closing unit 19*b* and the paper-supply-side opening/closing unit 19*a* will not be described and not be shown in the figures, the arm-side opening/closing unit 19*b* and the paper-supply-side opening/closing unit 19*a* can be implemented by, e.g., a shutter configured to open/close an opening of each housing portion 2*d*, 2*c* by means of a motor or a lid having a hinge mechanism on one side to open/close in the upper-to-lower direction, such as an openable lid of a CD-ROM drive. Opening/closing checking sensors 19*d*, 19*c* for detecting whether or not opening/closing is normally performed are provided respectively at the arm-side opening/closing unit 19*b* and the paper-supply-side opening/closing unit 19*a*.

FIGS. 76A, 77, 78, and 79 illustrate a state in which the wiping arm 4 is retracted. The gear 18*c* engages with a rotary shaft of the exposure/upper-to-lower motor 18. A gear is provided at a lower portion of the screw shaft 18*b*, and engages with the gear 18*c*. By upper and lower bearings (not shown) of the raised portion 2, the screw shaft 18*b* is rotatably attached to the raised portion 2. The arm coupling portion 18*a* is provided with a screw hole, and the screw shaft 18*b* penetrates the screw hole. The screw hole may be a ball screw, but balls are not essential. Upon instruction of wiping, a control unit 13 rotates the exposure/upper-to-lower motor 18 after operation of S100 to S405 as illustrated in FIG. 76C (S500). When the exposure/upper-to-lower motor 18 rotates, the gear 18*c* rotates, and accordingly, the screw shaft 18*b* rotates. When the screw shaft 18*b* rotates, the arm coupling portion 18*a* rotates together. The wiping arm 4 is fixed to the arm coupling portion 18*a*, and therefore, rotates about the screw shaft 18*b* in association with rotation of the screw shaft 18*b*. With this structure, the wiping arm 4 is exposed.

The first stopping portion 18*d* and the second stopping portion 18*e* are each fixed to upper and lower portions of the raised portion 2. Meanwhile, the third stopping portion 18*f* is fixed only to an upper surface of the raised portion 2, and there is a space below the third stopping portion 18*f*. When the wiping arm 4 is exposed by rotation of the exposure/upper-to-lower motor 18, the wiping arm 4 passes below the third stopping portion 18*f*, and moves until contacting the second stopping portion 18*e*. The control unit 13 detects, based on the number of rotations detected by a motor detection unit 18*g*, that the wiping arm 4 has reached an exposed position (S501). Note that the control unit 13 may use other detection units than the motor detection unit 18*a* to detect that the wiping arm 4 has reached the exposed position. A specific example of the motor detection unit 18*g* is similar to the motor detection unit 8*b*.

The wiping arm 4 is brought into a state in which the wiping arm 4 contacts the second stopping portion 18*e*. Thus, when the exposure/upper-to-lower motor 18 further rotates, movement of the wiping arm 4 is restricted, and the coupling portion 18*a* moves upward along the screw shaft 18*b* (S502). When the wiping arm 4 moves upward to the maximum height, such a position is detected by the motor detection unit 18*g* based on the number of rotations, and rotation of the exposure/upper-to-lower motor 18 is stopped (S503). FIGS. 80, 81, 82, and 83 illustrate a state when the wiping arm 4 has moved to the maximum height. Although special paper 11*b* is not shown in FIGS. 80, 81, 82, and 83, the special paper 11*b* placed on the paper loading guide 17*c* is supplied from the right, and the pressing unit 4*a* lifts the special paper 11*b*. Then, the pressing unit 4*a* comes into contact with the buttocks through the special paper 11*b*. Subsequently, the paper supply unit 17 moves the paper loading guide 17*c* backward. After backward movement of the paper loading guide 17*c*, forward-reverse repeat rotation of the exposure/upper-to-lower motor 18 is performed, and in this manner, the operation of moving the pressing unit 4*a* back and forth in the vicinity of the anus is performed (S504). In this manner, moisture etc. can be wiped down. Note that the shape of the pressing unit 4*a* is not limited to the illustrated example. When a rotary body (e.g., a rotation roller) is provided at the pressing unit 4*a*, front-to-back movement of the pressing unit 4*a* is smoothly performed, and therefore, such a rotary body may be provided. In an attempt to adjust the force of causing the pressing unit 4*a* to contact the buttocks, the exposure/upper-to-lower motor 18 is rotated such that the wiping arm 4 contacts the third stopping portion 18*f*, and such rotation is continued with the wiping arm 4 contacting the third stopping portion 18*f*. Then, the arm coupling portion 18*a* is lowered, and therefore, the height of the pressing unit 4*a* is lowered. Accordingly, the strength of contact with the buttocks can be weakened. Note that when lowered to an open space below the third stopping portion 18*f*, the wiping arm 4 returns to the exposed position, and for this reason, is not lowered to below the third stopping portion 18*f*. When forward-reverse repeat movement of the exposure/upper-to-lower motor 18 is performed again at a location where the contact strength is weakened, wiping can be performed by front-to-back movement of the pressing unit 4*a*.

In the case of retracting the wiping arm 4 after completion of wiping, the exposure/upper-to-lower motor 18 rotates opposite to that upon exposure, thereby causing the wiping arm 4 to contact the third stopping portion 18*f*. FIGS. 84 and 85 are views of a state when the wiping arm 4 contacts the third stopping portion 18*f*. When the wiping arm 4 contacts the third stopping portion 18*f*, movement of the wiping arm 4 is restricted. Thus, by continuous rotation of the exposure/upper-to-lower motor 18, the arm coupling portion 18*a* lowers along the screw shaft 10*b* (S505). In addition, the wiping arm 4 also lowers. As illustrated in FIGS. 86 and 87, when the wiping arm 4 fully lowers to the open space below the third stopping portion 18*f*, the stopped wiping arm 4 is released, and begins rotating again. Then, the wiping arm 4 returns to the housing portion 2*d*, and comes into contact with the first stopping portion 18*d* (S506).

Based on the number of rotations detected by the motor detection unit 18*g*, the control unit 13 detects that the wiping arm 4 has returned to the housing portion 2*d* (S507). In such a state, the control unit 13 causes the exposure/upper-to-lower motor 18 to rotate a predetermined number of times, thereby lowering the wiping arm 4. Then, the wiping arm 4 returns to a retracted position before start of wiping operation. Subsequently, operation of S114 and S115 is performed to bring a standby state for subsequent wiping.

As described above, the second technique is employed in the tenth embodiment, and therefore, advantageous effects similar to those of the eighth embodiment are provided. Moreover, exposure and upper-to-lower movement of the wiping arm 4 are performed by the single motor, leading to cost reduction.

Figure 88:
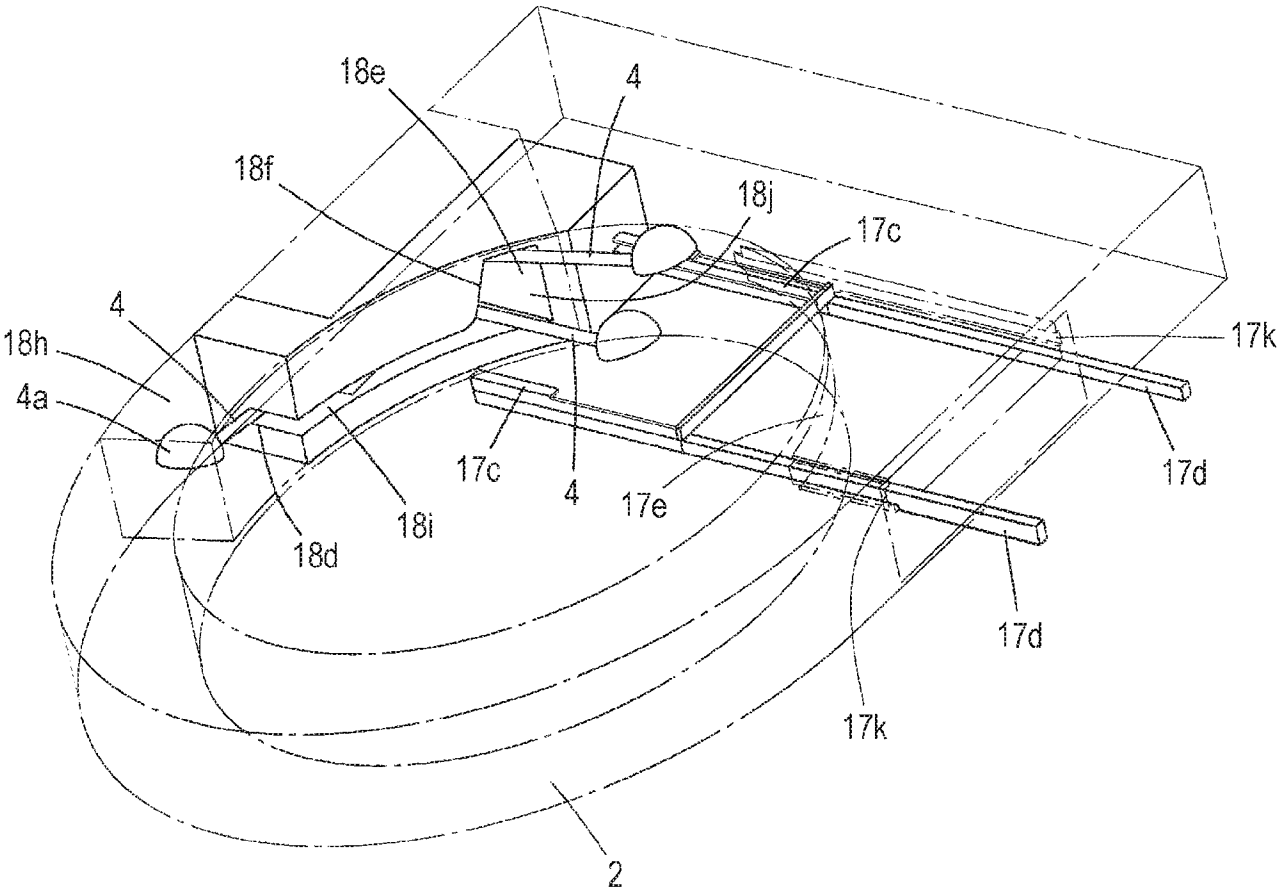
FIG. 88 is a perspective view of a variation of a raised portion 2 and movement transition of the wiping arm 4 and a paper loading guide 17*c;*

Note that the shape of the raised portion 2 may be designed such that the special first to third stopping portions 18*d*, 18*e*, 18*f* are not necessarily provided. Moreover, entering of water into the housing portion 2*d* can be prevented. Further, a structure can be employed, which allows sterilization/cleansing for maintaining the pressing unit 4*a* in a sanitary manner. FIG. 88 is a perspective view of a variation of the raised portion 2, as well as illustrating movement transition of the wiping arm 4 and the paper loading guide 17*c*. FIG. 88 merely illustrates three wiping arms 4 for the sake of clarifying movement transition, and there is actually a single wiping arm 4.

As illustrated in FIG. 88, as long as an arm movement opening 18*j* is provided only at a location where the wiping arm 4 moves, entering of moisture into the side close to the wiping arm drive unit 3 can be avoided as much as possible. An arm-side opening 18*i* may be separately opened/closed by the not-shown opening/closing unit 19*b*. With a lid 18*h* provided at a retracted location of the pressing unit 4*a* at the retracted position of the wiping arm 4, a user can open the lid 18*h* to cleanse or sterilize the pressing unit 4*a*. A nozzle configured to spray a sterilization solution or a cleansing solution may be attached to the back side of the lid 18*h* such that sterilization or cleansing is performed upon retraction. The sterilization solution or the cleansing solution flows to a toilet bowl side through the arm-side opening 18*i*. A drying device such as a dryer may be provided at the back of the lid 18*h*.

As illustrated in FIG. 88, a paper loading guide opening 17*l* may have the minimum size. A groove 17*k* etc. configured to support the paper loading guide 17*c* may be formed. The paper loading guide 17*c* is supported by the groove 17*k* and a not-shown supporting portion. When a bottom surface of the opening 17*l* is coincident with a bottom surface of the paper loading guide 17*c*, the paper loading guide 17*c* is movable without swinging, and is reliably pushed out. The opening 17*l* is small, and therefore, can be opened/closed by an opening/closing section using a simple lid, such as an electromagnet and a spring.

As illustrated in FIG. 88, the shape of the raised portion 2 can be designed such that the illustrated portions indicated by the reference numerals 18*d*, 18*e*, 18*f* fulfill the functions of the first to third stopping portions 18*d*, 18*e*, 18*f*, respectively. That is, the wiping arm 4 can move upward when contacting a surface of 18*e*. The wiping arm 4 can move downward when contacting a surface of 18*f*. When contacting a surface of 18*d*, the wiping arm 4 can move downward, or operation can be terminated assuming that the wiping arm 4 has returned to an original position. Note that the surface of 18*f* may be a surface extending straight down in the vertical direction.

(Variations of Tenth Embodiment)

Figure 89:
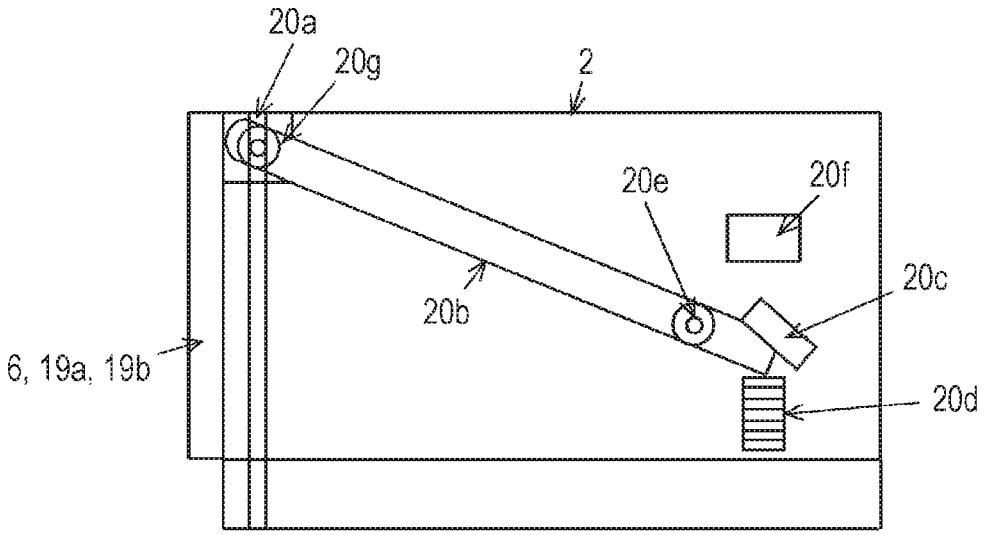
FIG. 89 is a view of a mechanism of an opening/closing unit.
Figure 90:
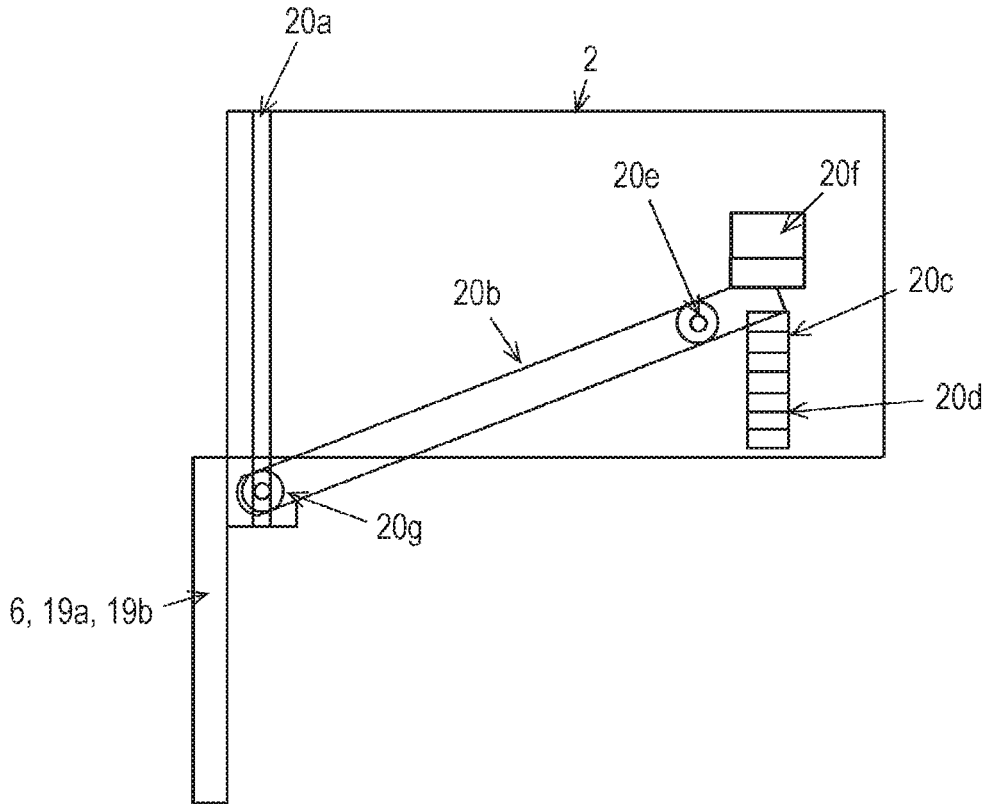
FIG. 90 is a view of the mechanism of the opening/closing unit.

Variations of the tenth embodiment will be collectively described below. FIGS. 89 and 90 are views of the mechanism of the opening/closing unit. FIG. 89 illustrates a closed state, and FIG. 90 illustrates an opened state. The raised portion 2 may be formed such that the opening provided at the raised portion 2 is in a linear shape, but the present invention is not limited to above. This mechanism can be utilized for all opening/closing units, and can be utilized for the opening/closing units 6, 19*a*. 19*b* described so far.

For sliding in a guide groove 20*a* provided at the raised portion 2, the opening/closing unit 6, 19*a*, 19*b* is attached to an arm portion 20*b* to rotate about a rotary shaft 20*g*. A magnet 20*c* is attached to one end of the arm portion 20*b*. A spring 20*d* is further attached to such an end, and is fixed to the raised portion 2. The arm portion 20*b* is rotatable about a supporting point 20*e*. The supporting point 20*e* is fixed to the raised portion 2. The spring 20*d* constantly applies force in the direction of closing the opening/closing unit 6, 19*a*, 19*b*. Such a mechanism may be provided at each end of the opening/closing unit 6, 19*a*, 19*b*. Until receiving an opening instruction from the control unit 13, an electromagnet is in a detached state.

Upon opening, the control unit 13 magnetizes the electromagnet 20*f* When the electromagnet 20*f* is magnetized, the magnet 20*c* and the electromagnet 20*f* are joined together. The opening/closing unit 6, 19*a*, 19*b* lowers about the supporting point 20*e* along the guide groove 20*a*. Upon closing, the control unit 13 detaches the electromagnet 20*f*. When the electromagnet 20*f* is detached, the magnet 20*c* is lowered by force of the spring 20*d*. This lifts the opening/closing unit 6, 19*a*. 19*b*. When the opening/closing unit is implemented by such an opening/closing mechanism using the electromagnet, cost reduction can be realized.

Note that a relationship between the electromagnet and the permanent magnet as illustrated in FIGS. 89 and 90 can be also realized in such a manner that a solenoid shaft is rotatably attached to an end portion of the arm portion 20*b*.

Figure 91:
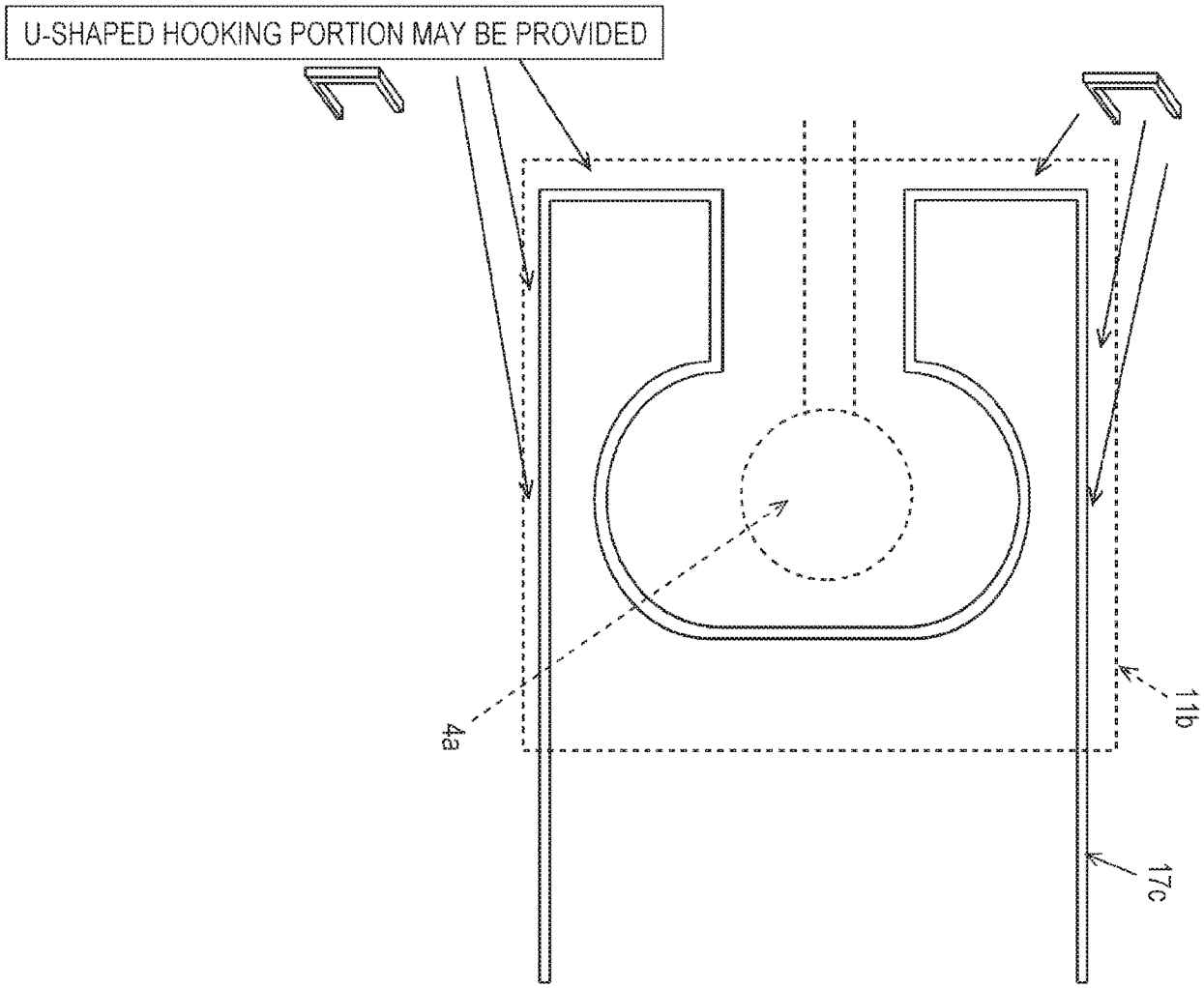
FIG. 91 is a plan view of another example of the paper loading guide.

FIG. 91 is a plan view of another example of the paper loading guide. The paper loading guide 17*c* may be manufactured by, e.g., bending of a wire. Note that such manufacturing is not limited to the wire, and sheet-metal processing, resin molding, etc. may be employed. The paper loading guide 17*c* may be formed such that a portion of the paper loading guide 17*c* opens to allow passage of the pressing unit 4*a*. The shape of the paper loading guide 17*c* other than the portion through which the pressing unit 4*a* passes is designed to avoid paper bending and dropping. In the example illustrated in FIG. 91, a linear wire is disposed so that end sides of the special paper 11*b* can be placed on a hole in an inverted C-shape (the hole that the pressing unit 4*a* adds). Note that U-shaped hooking portions may be provided in places for avoiding dropping of the special paper 11*b*. In addition, the special paper 11*b* does not drop when a surface of the paper loading guide 17*c* exhibits high friction. With such a shape, bending of the special paper 11*b* is less caused. Thus, paper including a stack of one or more pieces of toilet paper may be used, and water-soluble paper as a base material having a thickness corresponding to about the thickness of copy paper is not necessarily bonded to below a water absorbing portion. Needless to say, paper using a base material portion may be used. Alternatively, the entirety of the paper loading guide 17*c* may be in a plate shape, and may be in such a shape that only a portion of the paper loading guide 17*c* is cut out so that the pressing unit 4*a* and an arm shaft of the wiping arm 4 can pass through the paper loading guide 17*c*.

Figure 92:
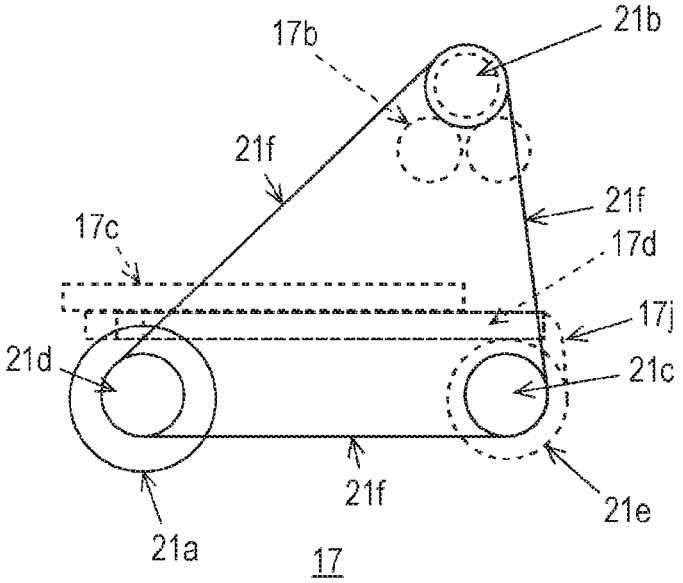
FIG. 92 is a front view of an example of a mechanism of a paper supply unit 17 in a case where rotation of paper supply rollers 17*b* and forward driving of the paper loading guide 17*c* are realized by a single motor.

FIG. 92 is a front view of an example of the mechanism of the paper supply unit 17 in a case where rotation of paper supply rollers 17*b* and forward driving of the paper loading guide 17*c* are realized by a single motor. Rotation of a paper supply motor 21*a* is transmitted to electromagnetic clutches 21*b*, 21*c* with pulleys through a pulley 21*d* and a belt 21*f*. Such a mechanism using the electromagnetic clutches is a mechanism often used for OA equipment etc., and can be implemented. With the electromagnetic clutches, the electromagnetic clutches are turned on/off at proper timing. For example, the following control is made. (1) The electromagnetic clutch 21*b* of the paper supply rollers 17*b* is turned on, and the electromagnetic clutch 21*c* of a winding portion 21*e* is turned off. Accordingly, the paper supply motor 21*a* rotates to rotate only the paper supply rollers 17*b*. Thus, the special paper 11*b* is placed on the paper loading guide 17*c*. (2) At the timing at which the special paper 11*b* reaches a leading end with the special paper 11*b* being placed on the paper loading guide 17*c*, the electromagnetic clutch 21*c* of the winding portion 21*e* is turned on to extend a belt 17*j*. Meanwhile, the electromagnetic clutch 21*b* is turned on to feed the special paper 11*b* to the end. Subsequently, the electromagnetic clutch 21*b* may be turned off. (3) At the timing at which the paper loading guide 17*c* is driven forward to the end and the pressing unit 4*a* lifts the special paper 11*b*, the paper supply motor 21*a* rotates reversely to wind the belt around the winding portion 21*e*, thereby retracting the paper loading guide 17*c*. With such use of the electromagnetic clutches, the common motor can be shared, leading to cost reduction.

Figure 93:
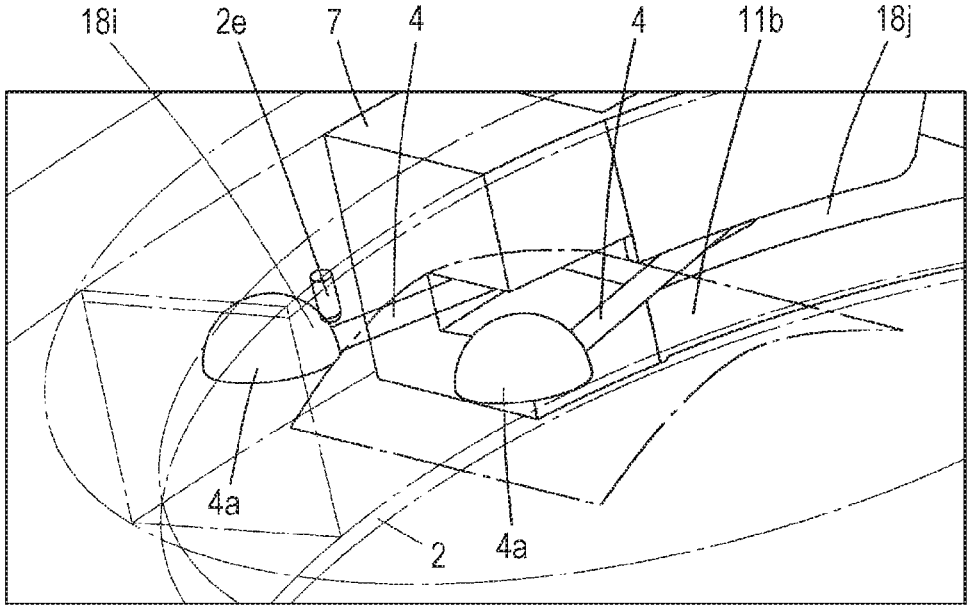
FIG. 93 is an enlarged view of the position of a pressing unit 4*a* at a retracted position and the position of the pressing unit 4*a* right before returning to the retracted position.

FIG. 93 is an enlarged view of the position of the pressing unit 4*a* at the retracted position and the position of the pressing unit 4*a* right before returning to the retracted position. A protrusion 2*e* is provided almost at the height of the pressing unit 4*a* (e.g., a position at which a clearance of about 2 to 3 mm is formed between an upper surface of the pressing unit 4*a* and a lower end of the protrusion 2*e*) on the upper surface of the raised portion 2 in the arm-side opening 18*i*. Note that the protrusion 2*e* is configured not to interfere with movement of the wiping arm 4. In the case of a structure in which a spring is built in the protrusion 2*e* and is retracted by pressing down upon contact between the pressing unit 4*a* and the protrusion 2*e*, the height of the upper surface of the pressing unit 4*a* and the height of the lower end of the protrusion 2*e* may be coincident with each other without the clearance. Usually, when the wiping arm 4 returns to the original position, the special paper 11*b* naturally loses its balance, and then, drops. In a case where the special paper 11*b* contains much moisture, the special paper 11*b* closely contacts the pressing unit 4*a*, leading to the probability that the special paper 11*b* does not drop naturally. In this case, the special paper 11*b* comes into contact with the protrusion 2*e*, and then, loses its balance. As a result, the special paper 11*b* naturally drops. Note that in a case where the volume of the arm-side opening 18*i* is smaller than that of the special paper 11*b*, the special paper 11*b* comes into contact with such an opening, and therefore, naturally drops due to losing of the balance. In this case, the protrusion 2*e* is not necessary. The shape of the raised portion 2 with the above-described structure for naturally dropping the special paper 11*b* avoids the necessity of bending the wiping arm 4 or rotating the pressing unit 4*a* for dropping the special paper 11*b*. In addition, the protrusion 2*e* utilizing an electromagnet and the spring may be configured to protrude, for naturally dropping the special paper 11*b*, from the raised portion 2 to contact the special paper 11*b*. Moreover, when the surface of the pressing unit 4*a* can be made of a water-repellent material, moisture on the special paper 11*b* is repelled so that the special paper 11*b* can easily slip off from the pressing unit 4*a*. Note that there are cases where the protrusion 2*e* is not formed as a protrusion depending on the shape of the opening. Thus, in the present invention, it is regarded that a dropping portion (in this example, the protrusion 2*e*) configured to come into contact with the special paper 11*b* placed on the pressing unit 4*a* when the wiping arm is retracted into the wiping arm opening is provided. Thus, the special protrusion 2*e* is not necessarily provided at the opening, and a case where the special paper 11*b* drops due to contact with the edge of the opening is conceivable. In such a case, part of the opening configured to contact the special paper 11*b* functions as the dropping portion.

Figure 94:
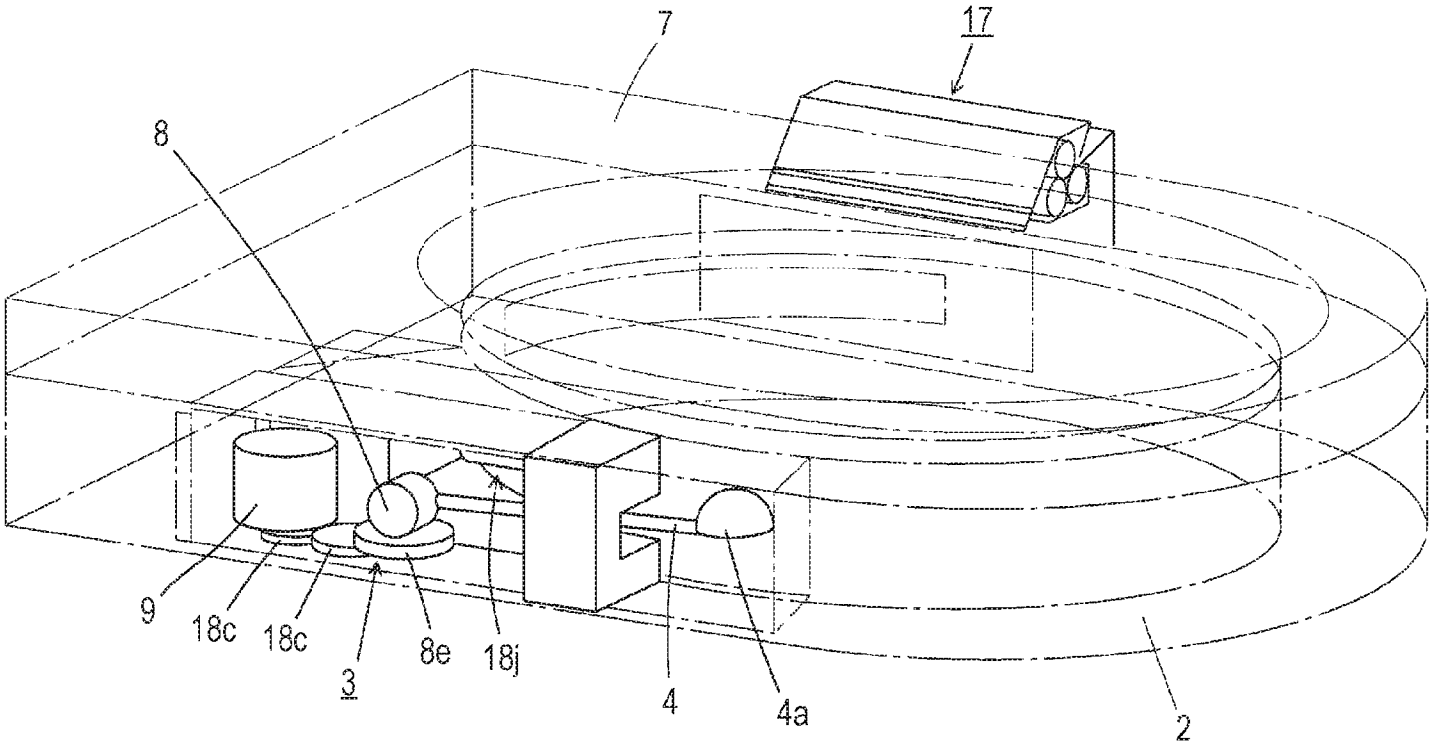
FIG. 94 is a perspective view of an internal structure of a wiping arm drive unit 3 when an exposure/upper-to-lower motor 18 used in the tenth embodiment is replaced with two motors including an exposure motor 9 and an upper-to-lower motor 8.
Figure 95:
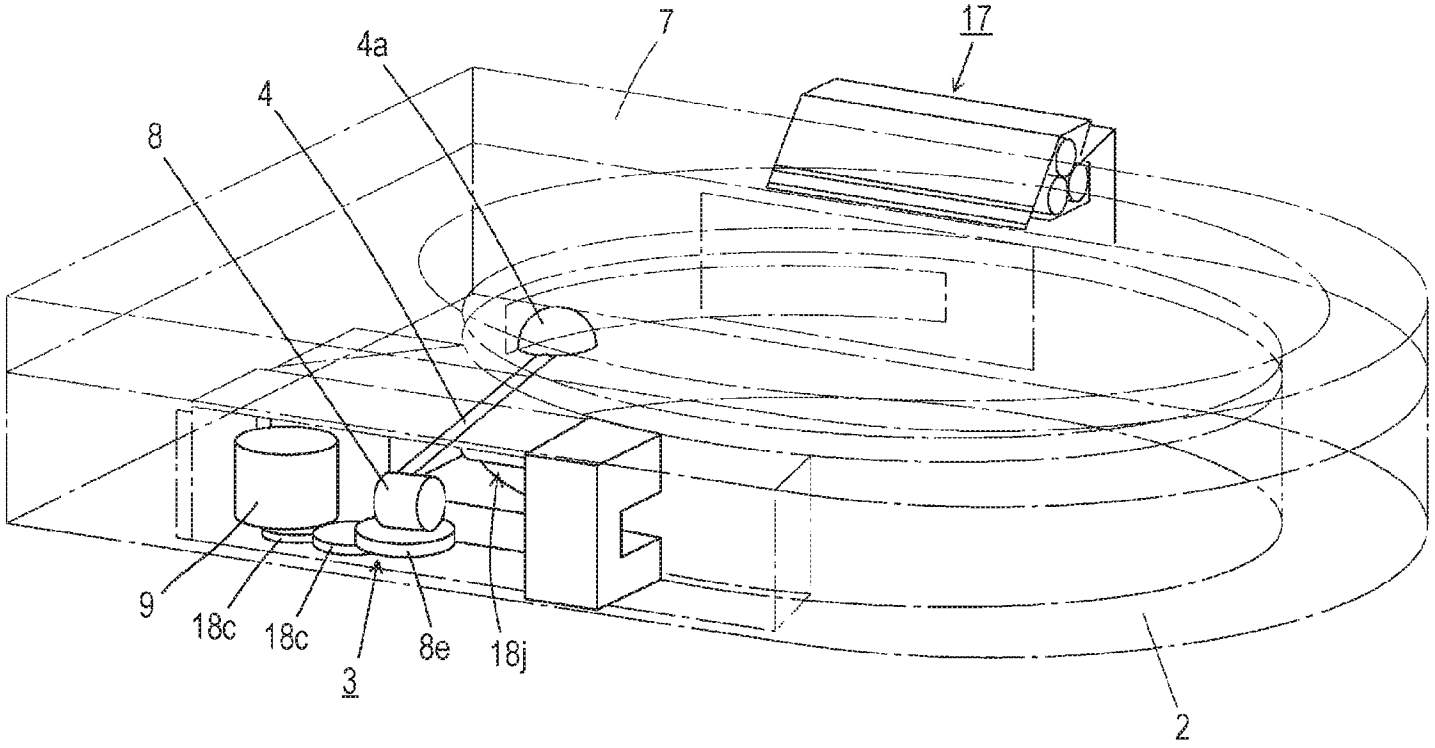
FIG. 95 is a perspective view of the internal structure of the wiping arm drive unit 3 when the exposure/upper-to-lower motor 18 used in the tenth embodiment is replaced with two motors including the exposure motor 9 and the upper-to-lower motor 8.

FIGS. 94 and 95 are perspective views of the internal structure of the wiping arm drive unit 3 when the exposure/upper-to-lower motor 18 used in the tenth embodiment is replaced with two motors including the exposure motor 9 and the upper-to-lower motor 8. FIG. 94 illustrates the retracted position. FIG. 95 illustrates the exposed position. With a simple structure in which the paper supply rollers 17*b* and the belt 17*j* for forward driving of the paper loading guide 17*c* are, using the electromagnetic clutches 21*b*, 21*c*, driven by the common paper supply motor 21*a* and an electromagnet is used at the opening of the raised portion 2, a cost can be reduced by such a structure. Meanwhile, it is the greatest challenge to improve the feeling of wiping in the buttocks wiping device 1. Thus, it is effective that a cost saved by, e.g., sharing of the common motor in the simplest possible structure is allocated to the mechanism for improving the feeling of wiping. For example, as illustrated in FIG. 94, rotation of the exposure motor 9 for exposing the wiping arm 4 is, using a plurality of gears 18*c*, transmitted to rotation of a rotary table 8*e*, and therefore, the wiping arm drive unit 3 can be compactly housed in the raised portion 2. The upper-to-lower motor 8 is fixed onto the rotary table 8*e*. By rotation of the exposure motor 9, the upper-to-lower motor 8 angularly moves about the center of the rotary table 8*ae* as a supporting point, and accordingly, the wiping arm 4 is exposed. After exposure as illustrated in FIG. 95, the upper-to-lower motor 8 rotates to incline the wiping arm 4 upward. The rotation center of the wiping arm 4 is positioned at the side of the anus. Thus, when forward-reverse repeat rotation of the exposure motor 9 is performed with a small width, the pressing unit 4*a* moves back and forth in the vicinity of the anus, leading to front-to-back wiping. Using the upper-to-lower motor 8, e.g., the height of the pressing unit 4*a* and the contact strength of the pressing unit 4*a* can be adjusted according to user's preferences. With front-to-back movement of the pressing unit 4*a*, almost all of moisture and dirt in the vicinity of the anus can be wiped.

Note that in the case of using the mechanism of FIG. 76A, a trapezoidal screw or a triangular screw other than the ball screw may be used, for example. Moreover, in the case of using the mechanism of FIG. 76A, the member for more tightening, such as a U-nut, may be used for the arm coupling portion.

Figure 96:
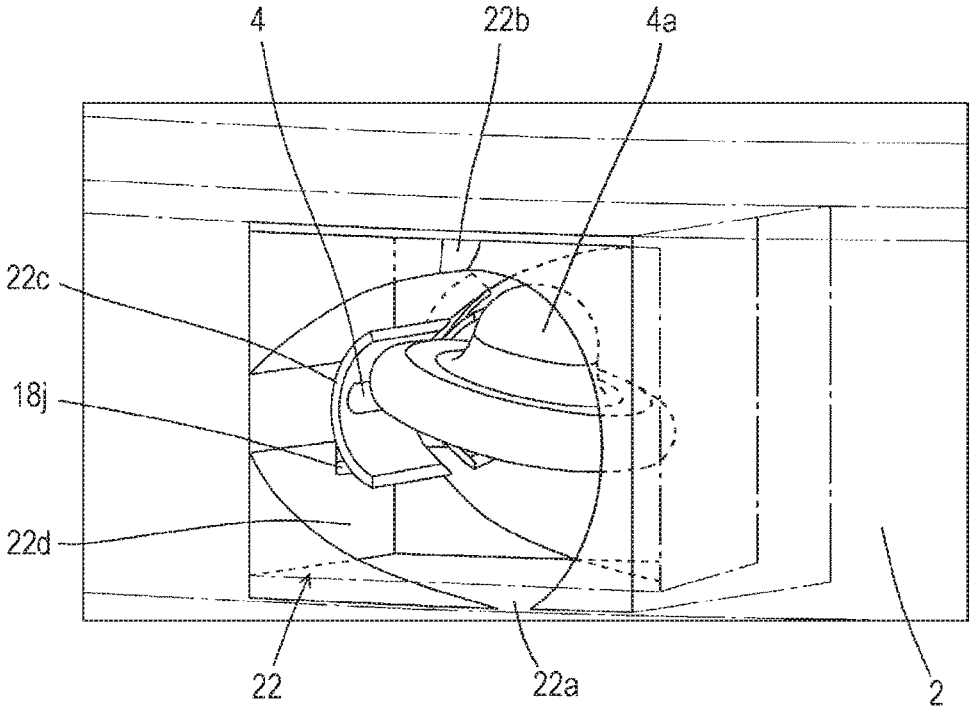
FIG. 96 is an enlarged perspective view of a sterilization and/or cleansing unit 22.

FIG. 96 is an enlarged perspective view of a sterilization and/or cleansing unit 22. A defensive barrier 22*c* for water droplets is provided on the wiping arm 4 to prevent the sterilization solution or the cleansing solution from entering the wiping arm drive unit 3. Note that in such a manner that a clearance between the arm movement opening 18*j* formed at the raised portion 2 and the wiping arm 4 is formed as small as possible, the defensive barrier can be downsized, or in some cases, is not necessarily provided. Moreover, the defensive barrier 22*c* may be inserted into the raised portion 2. A nozzle or shower 22*b* is provided above the pressing unit 4*a* such that the sterilization solution and/or the cleansing solution are sprayed from the nozzle or shower 22*b*. A well-known method can be utilized as a spraying method. For example, a tap water line and the nozzle or shower 22*b* may be coupled together through an electromagnetic valve such that the electromagnetic valve is opened for performing cleansing upon sterilization/cleansing. The sterilization solution or the cleansing solution may be contained in the middle of such a coupling path. Cleansing may be performed using only water stored in the tank, or cleansing/sterilization may be performed using the sterilization solution or the cleansing solution stored in the tank. A well-known method can be used as the method for sucking up water from the tank. For example, pumping may be performed. As long as the pressing unit 4*a* is configured to be held horizontal upon wiping, the pressing unit 4*a* may be inclined upon retraction. The cleansing solution etc. are naturally dropped by such inclination. The sterilization and/or cleansing unit 22 has an inclined surface 22*d*, and therefore, the dropped cleansing solution etc. directly flow down a toilet bowl from a drainage path 22*a*. The drainage path 22*a* is preferably inclined toward the toilet bowl. Depending on the flow of cleansing solution etc., a rotatable brush may be attached to the sterilization and/or cleansing unit 22. The brush is rotatable by a rotary blade provided at a flow path.

Figure 97:
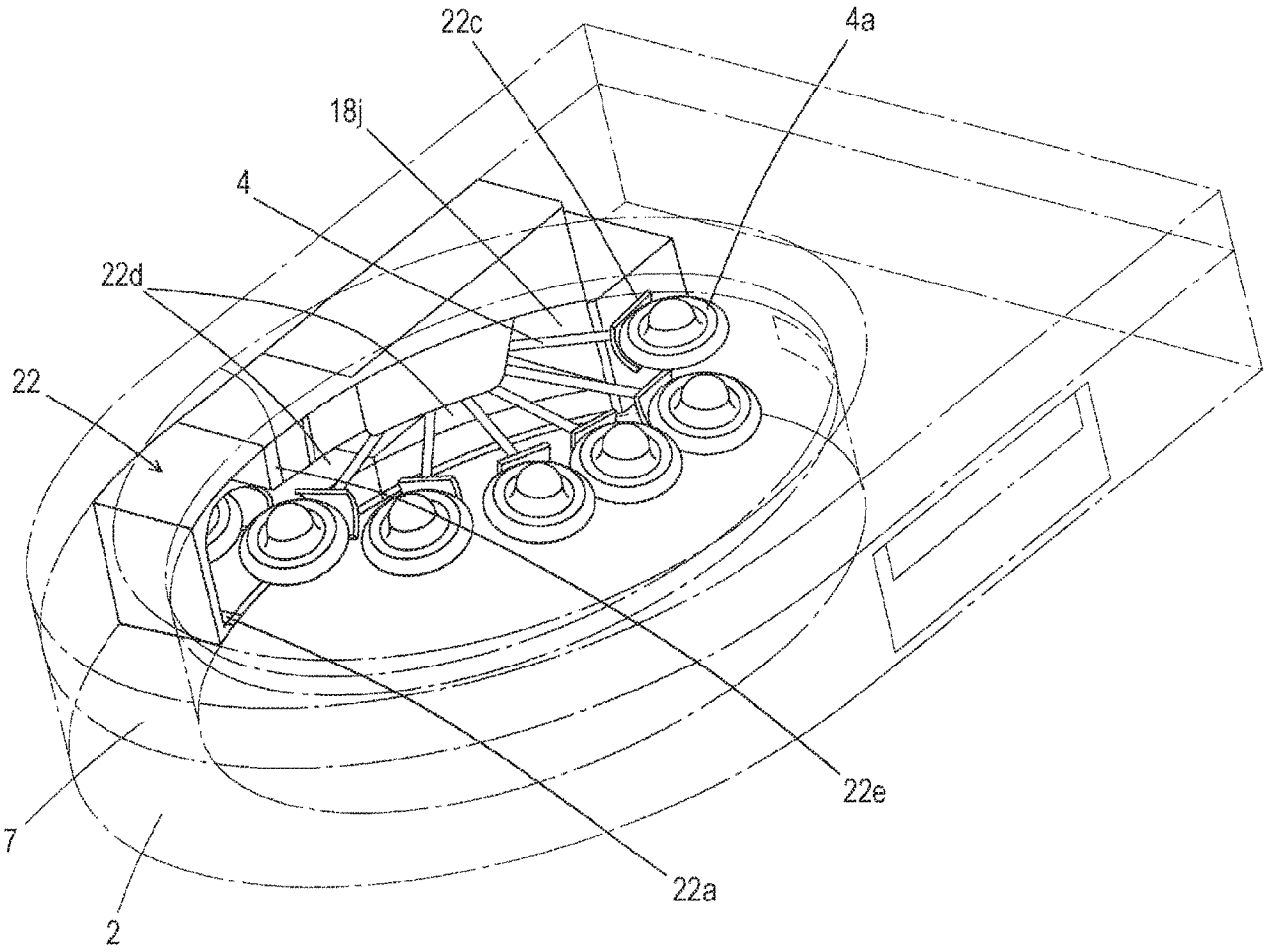
FIG. 97 is a view of movement paths of the wiping arm 4 and the pressing unit 4*a* when the sterilization and/or cleansing unit 22 is used.

FIG. 97 is a view of movement paths of the wiping arm 4 and the pressing unit 4*a* in the case of using the sterilization and/or cleansing unit 22. The defensive barrier 22*c* may be optimized not to contact the buttocks upon wiping. The arm movement opening 18*j* for movement of the wiping arm 4 can be formed as small as possible to prevent moisture from entering the wiping arm drive unit 3. Needless to say, a waterproofing effect is further enhanced when the wiping arm 4 is configured to move in a cutout of an elastic member, such as silicon resin, provided inside the arm movement opening 18*j*. When the sterilization and/or cleansing unit 22 can be configured detachable as a post-installable unit, the sterilization and/or cleansing unit 22 is available for sale as an option, and can be easily repaired. A bottom surface of the arm movement opening 18*j* in the raised portion 22 may be formed as the inclined surface 22*d* such that no moisture enters the raised portion 2. In the figure, an insertion port may be provided in the vicinity of 22*e* such that the defensive barrier 22*c* is inserted into the raised portion 2. In addition, the position of the defensive barrier 22*c* is not specifically limited. Note that when the pressing unit 4*a* can be coupled to incline relative to the axial center of the wiping arm 4 such that the pressing unit 4*a* is held horizontal upon wiping, it can be expected that the paper is naturally dropped merely by downward inclination of the arm. Various shapes of the head are conceivable, and are not intended to limit the present invention.

Figure 98:
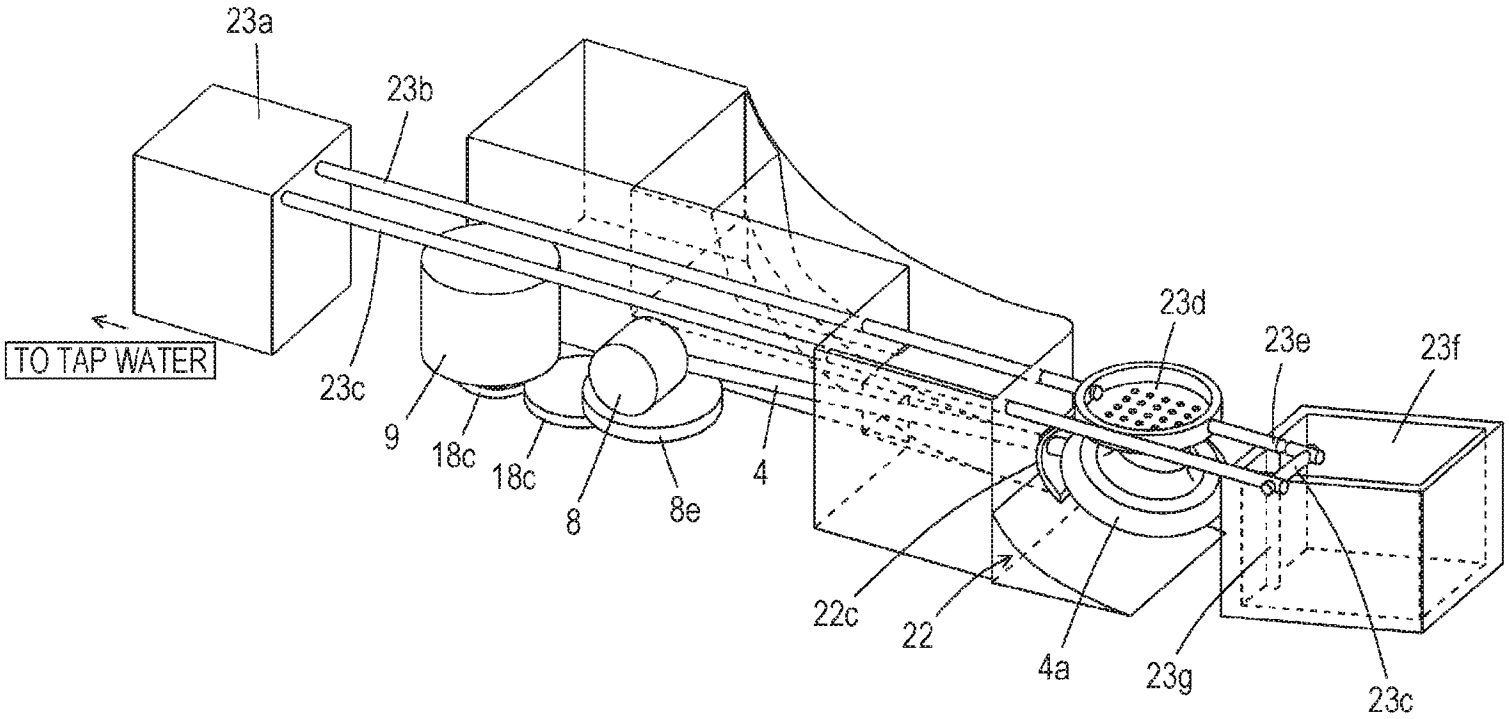
FIG. 98 is a perspective view of an example of a cleansing mechanism structure.
Figure 99:
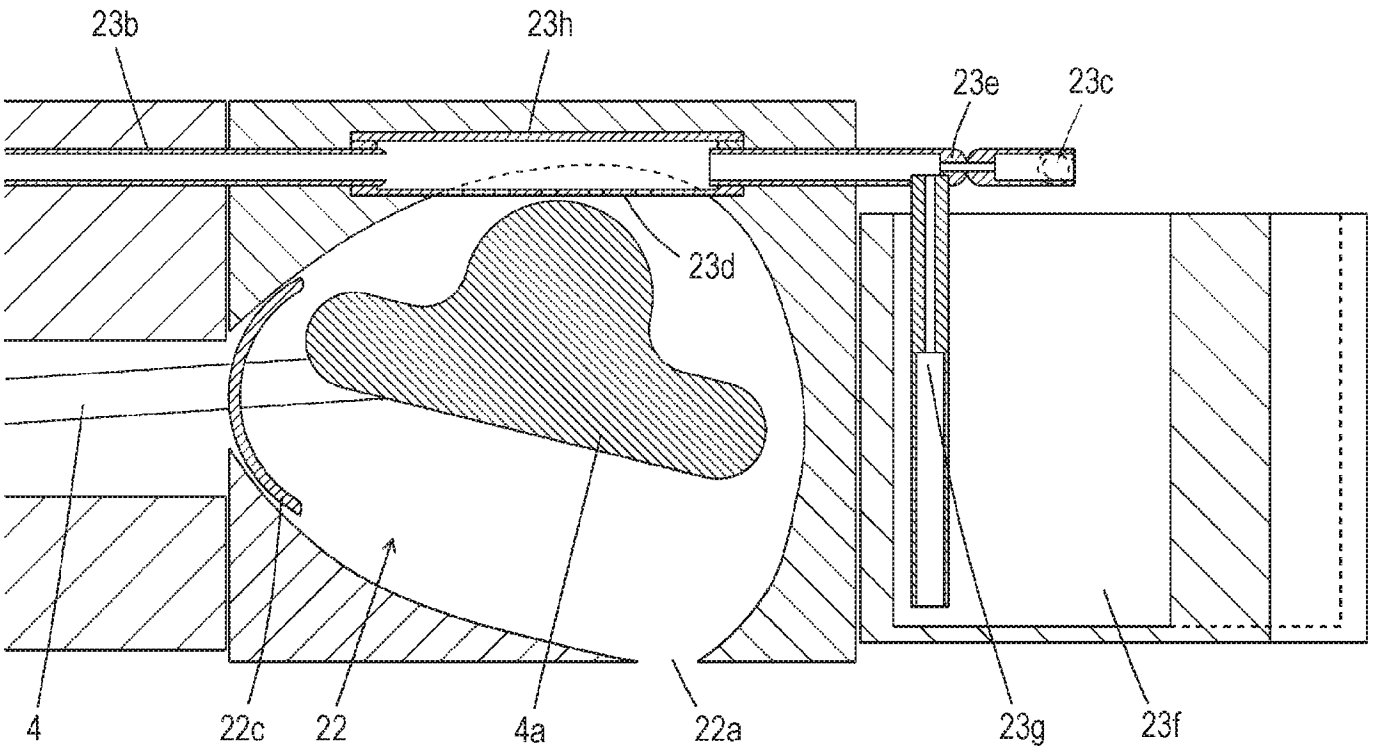
FIG. 99 is a sectional view of the example of the cleansing mechanism structure.

FIG. 98 is a perspective view of an example of a cleansing mechanism structure. FIG. 99 is a sectional view of the example of the cleansing mechanism structure. A tap water pipe is coupled to an electromagnetic valve 23*a*. The electromagnetic valve 23*a* can supply tap water to a water pipe 23*b* and a cleansing/sterilization solution pipe 23*c*, and can switch opening/closing of both pipes. A shower head 23*d* can be optimized using any well-known mechanisms. In the case of spraying water to the pressing unit 4*a*, the electromagnetic valve 23*a* couples the tap water line and the water pipe 23*b* together. In this manner, the water comes out of the shower head 23. In the case of spraying the cleansing solution or the sterilization solution to the pressing unit 4*a*, the electromagnetic valve 23*a* couples the tap water line and the cleansing/sterilization solution pipe 23*c*. In this manner, tap water is mixed with the cleansing solution or the sterilization solution, and then, is sprayed from the shower head 23*d*.

As illustrated in FIG. 99, the cleansing/sterilization solution pipe 23*c* communicates with a Venturi tube 23*e* right before the shower head 23*d*. The Venturi tube 23*e* is configured such that the diameter thereof is decreased at a portion coupled to the cleansing/sterilization solution pipe 23*c*. At the portion with the decreased diameter, the Venturi tube 23*e* downwardly communicates with an orifice 23*g*. With such a structure, the cleansing solution or the sterilization solution stored in a tank 23*f* is sucked up by a Venturi effect, and then, is mixed with tap water. Subsequently, the diluted sterilization solution or cleansing solution is sprayed from the shower head 23*h*. Note that in this example, the Venturi effect is used to mix tap water with the cleansing solution or the sterilization solution. Any other well-known mechanisms can be used for mixing, and the present invention is not limited to the mechanism using the Venturi effect. Note that a lid of the tank 23*f* is not shown.

The sterilization solution or the cleansing solution to be diluted is contained in the tank 23*f*. For example, sodium hypochlorite or quaternary ammonium salt is contained. In the case of using a strong sterilization solution such as sodium hypochlorite, there is a probability that the pressing unit 4*a* is corroded. For this reason, the water pipe 23*b* and the cleansing/sterilization solution pipe 23*c* are combined together so that only water cleansing is performed after sterilization cleansing, but the present invention is not limited to above. Note that the type of cleansing/sterilization solution is not specifically limited.

Figure 100:
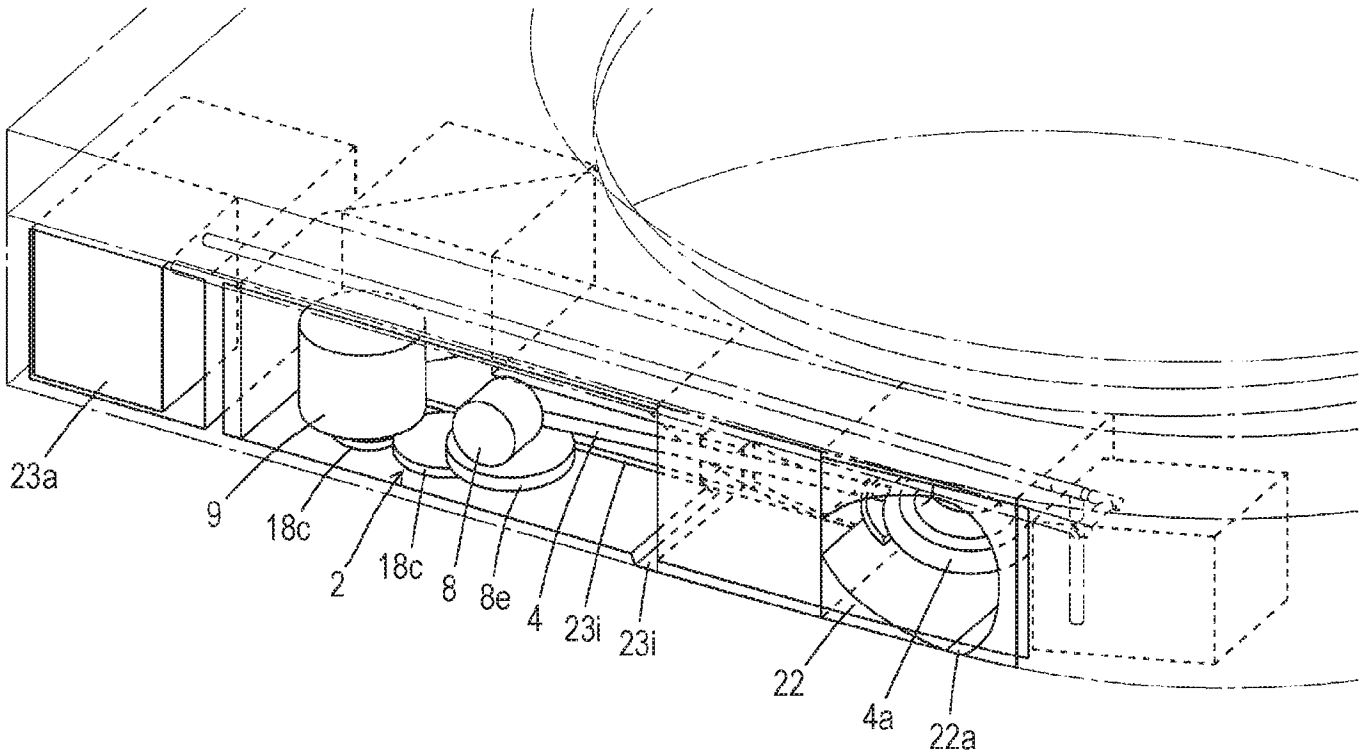
FIG. 100 is a perspective view when a cleansing mechanism illustrated in FIG. 98 is housed in a raised portion 2.

FIG. 100 is a perspective view when a cleansing mechanism illustrated in FIG. 98 is housed in the raised portion 2. As illustrated in FIG. 100, the electromagnetic valve 23*a* is provided separately from the wiping arm drive unit 3. A water entering location is unpredictable, and therefore, a drainage groove 23*i* is provided at the periphery of the wiping arm drive unit 3. Alternatively, e.g., a wall configured to prevent water entering may be provided instead of the drainage groove 23*i*. Note that when the plane of the opening for exposing the wiping arm 4 can be in such a linear planar shape that the shutter opens to right below or right beside the opening, the structure of the opening/closing unit can be simplified.

FIG. 101 is a view of an example of the structure of the housing portion 2*d* for housing the wiping arm 4 and the wiping arm drive unit 3. Note that in FIG. 101, each motor of the wiping arm drive unit 3 is not specifically shown. Note that in FIG. 101, two wiping arms 4 are illustrated for the sake of clarifying movement transition of the wiping arm 4, but a single wiping arm 4 is actually provided. The arm movement opening 18*j* is provided at the housing portion 2*d*, and the inclined surface 22*d* or the drainage groove 23*i* is, as necessary, provided such that no water from the shower head 23*d* enters the wiping arm drive unit 3. Thus, even if splashed water enters the housing portion 2*d*, such water flows down to the toilet bowl side by the inclined surface 22*d* or the drainage groove 23*i*. The defensive barrier 22*c* is provided in the middle of the wiping arm 4. The defensive barrier 22*c* has the function of preventing water droplets adhering to the wiping arm 4 from flowing down to the wiping arm drive unit 3 when the wiping arm 4 inclines to the upward direction.

The plane including the opening 18*j* for housing the wiping arm 4 is in the planar shape as illustrated in FIG. 101, and therefore, the structure of the opening/closing unit for opening/closing the opening 18*j* can be simplified. The same applies to the opening (17*l* of FIG. 105) for housing the paper loading guide 17*c*, and such an opening will be described later.

Note that when the wiping arm drive unit 3 can repeatedly swing, before retraction of the pressing unit 4*a*, the wiping arm 4 right to left, the paper can naturally drop due to such vibration. When the pressing unit 4*a* can be made of metal or a water-repellent material to reduce friction and enhance water-repellent properties, the feeling of wiping can be improved while the paper can be easily dropped.

FIG. 102 is a perspective view of the housing portion 2*d* of FIG. 101 from another angle. When the arm movement opening 18*j* of the housing portion 2*d* is in the linear planar shape, a drive mechanism structure of the opening/closing unit, such as the shutter, for opening/closing the arm movement opening 18*j* can be simplified. Supposing that the wiping arm drive unit 3 is below the warm-water cleansing device, the pressing unit 4*a* wipes the buttocks from behind a person. In this case, for realizing front-to-back movement of the pressing unit 4*a*, one more motor may be added to the wiping arm drive unit 3.

Figure 103:
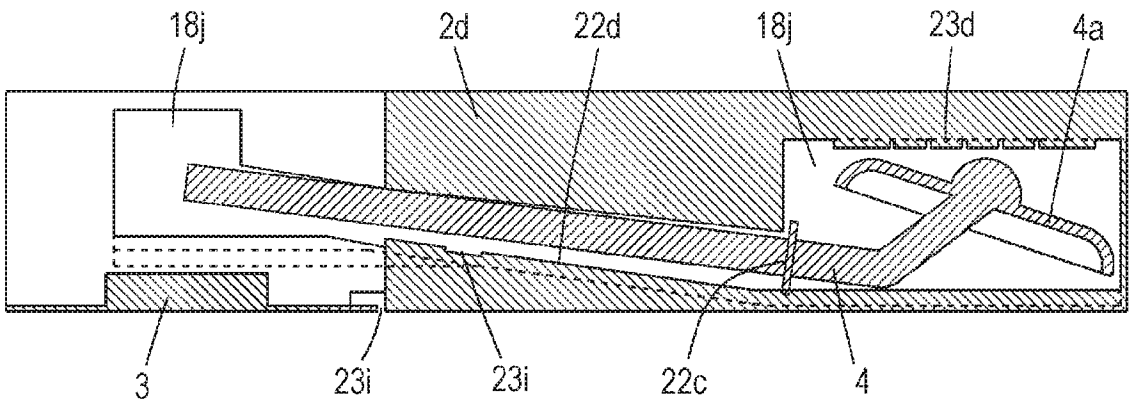
FIG. 103 is a sectional view of the housing portion 2*d* of FIGS. 101 and 102.

FIG. 103 is a sectional view of the housing portion 2*d* illustrated in FIGS. 101 and 102. FIG. 103 illustrates the sectional view (not showing a water/cleansing solution supply path) along a plane including the arm shaft when the wiping arm 4 is at the retracted position. As illustrated in FIG. 103, the wiping arm 4 inclines to the downward direction at the retracted position. The pressing unit 4*a* is held horizontal at the highest position (a wiping position), and inclines at the retracted position. The wiping arm 4 bends in the middle thereof. The pressing unit 4*a* is, at a bottom surface thereof, hollowed out in a bowl shape, and is, in the vicinity of a center portion thereof, joined to a tip end of the wiping arm 4. With this structure, almost no water from the shower head 23*d* is splashed on the arm upon cleansing at the original position. These structures of the wiping arm 4, the pressing unit 4*a*, and the housing portion 2*d* have been set forth merely as examples, and may be, as necessary, designed and optimized to such proper shapes that no water enters the wiping arm drive unit 3. When the pressing unit 4*a* can be of a screw type and be in a point-symmetrical shape, no orientation difference is caused even when the pressing unit 4*a* is loosened. The pressing unit 4*a* is replaceable according to individual differences and preferences.

Figure 104:
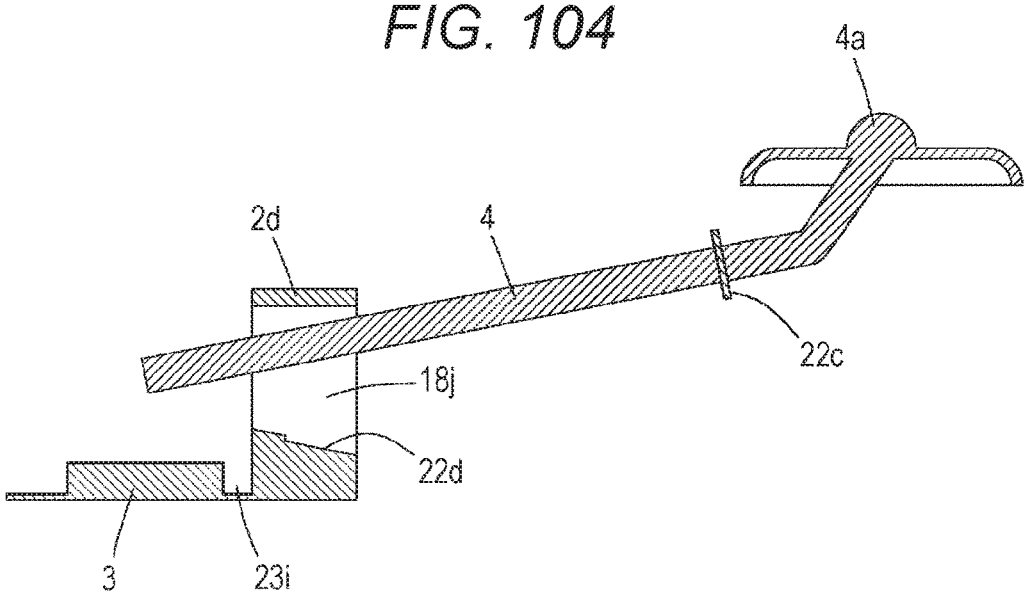
FIG. 104 is a sectional view along a plane including an arm shaft when the wiping arm is at the highest position.

FIG. 104 is a sectional view along a plane including the arm shaft when the wiping arm is at the highest position. When the wiping arm 4 inclines to the highest position, the pressing unit 4*a* is held horizontal. In this state, even if moisture adheres to the wiping arm 4, the defensive barrier 22*c* prevents the moisture from dropping down to the wiping arm drive unit 3. Even when some water droplets adhere to the pressing unit 4*a* upon subsequent wiping before drying of the pressing unit 4*a* and after cleansing of the pressing unit 4*a*, the pressing unit 4*a* has been already sterilized/cleansed, and therefore, the remaining droplets are clean water droplets. Moreover, the pressing unit 4*a* pushes up the paper from below, and therefore, the remaining water droplets only adhere to the lower side of the paper and do not directly adhere to the anus. Thus, even when some water droplets remain, there is no sanitary problem. In addition, a method can be employed, in which a small quantity of water droplets is purposefully adhered to the pressing unit 4*a* such that the paper does not drop upon lifting of the paper.

Figure 105:
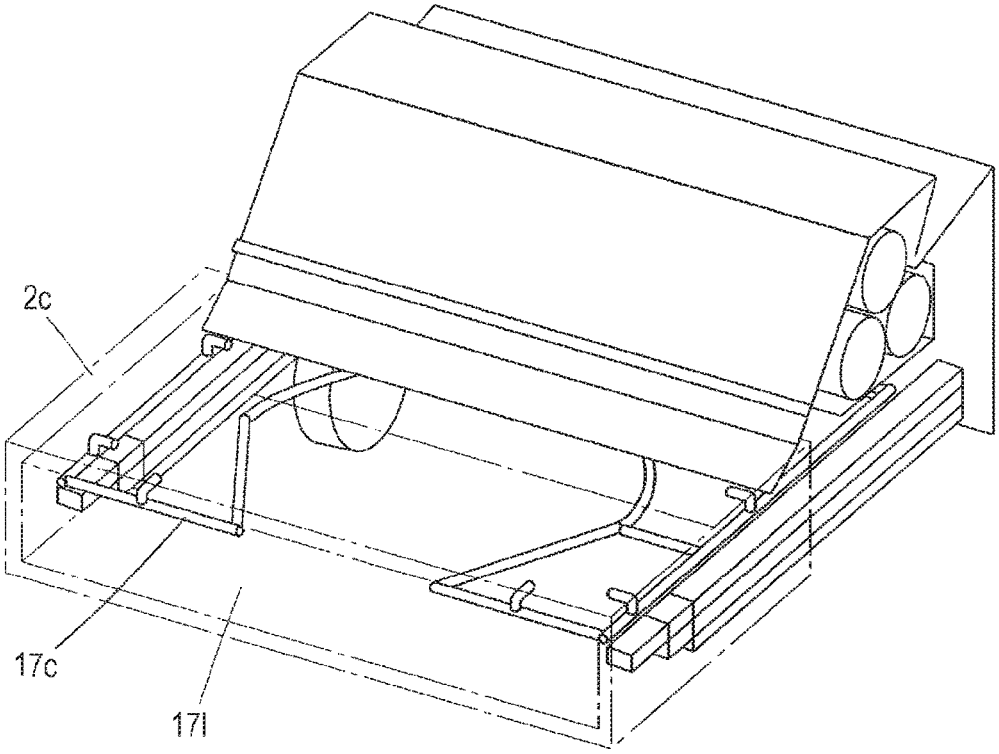
FIG. 105 is a perspective view of the paper supply unit 17 and the housing portion 2*b* thereof.

FIG. 105 is a perspective view of the paper supply unit 17 and the housing portion 2*b* thereof. When the paper loading guide opening 17*l* can be in a linear planar shape as illustrated in FIG. 105 in the housing portion 2*c* for housing the paper supply unit 17, the structure of the opening/closing unit can be simplified. Note that in a case where there are concerns about sanitation of the paper loading guide 17*c*, a section configured to spray the sterilization solution to the paper loading guide 17*c* may be provided. The paper loading guide 17*c* may be dipped into the sterilization solution itself.

Eleventh Embodiment

Figure 106A:
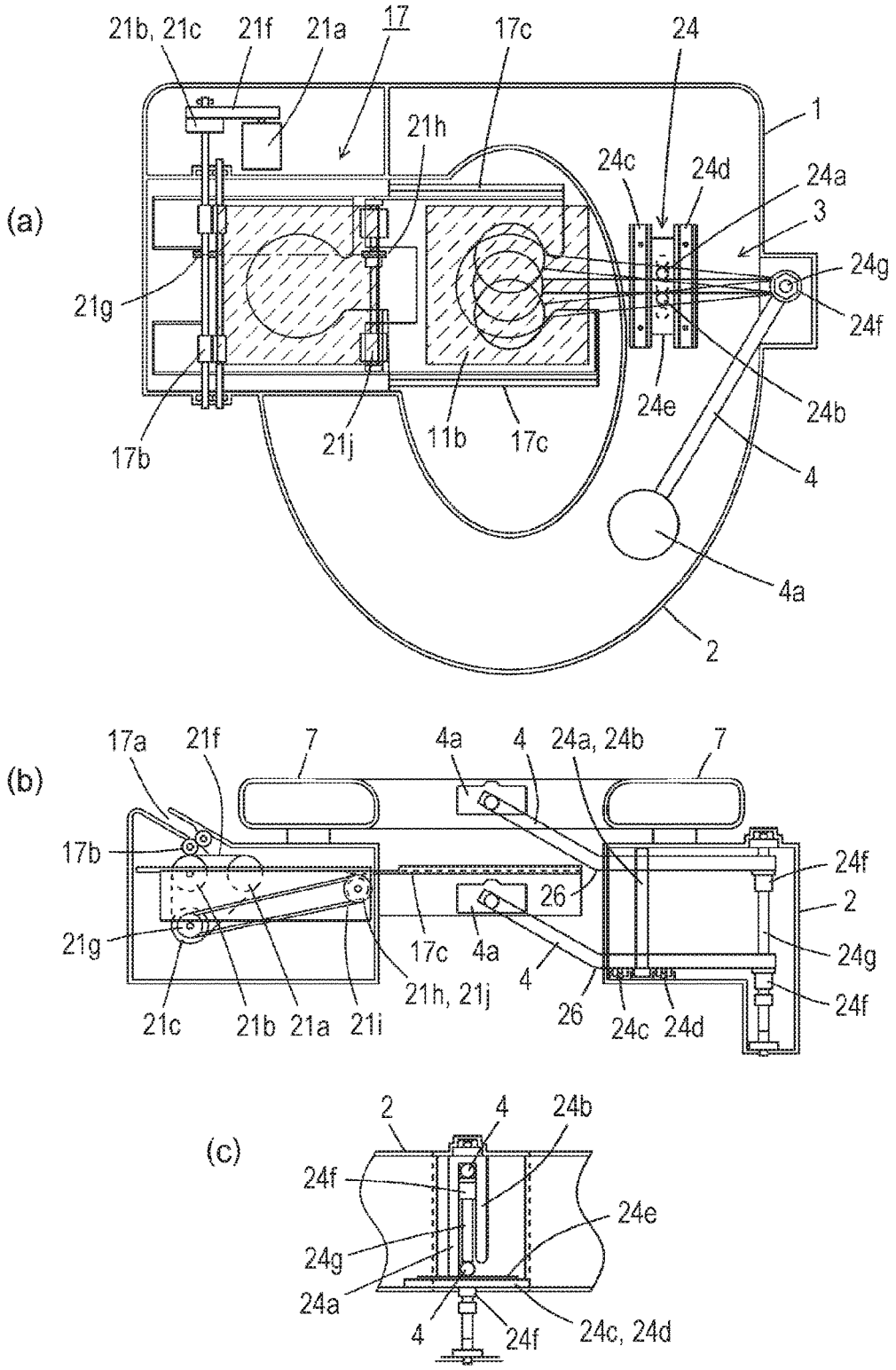
FIG. 106A is a view of the structure of a buttocks wiping device 1 of an eleventh embodiment, (a) is a plan view, (b) is a front view, and (c) is a left side view of a restriction rod portion 24.
Figure 106B:
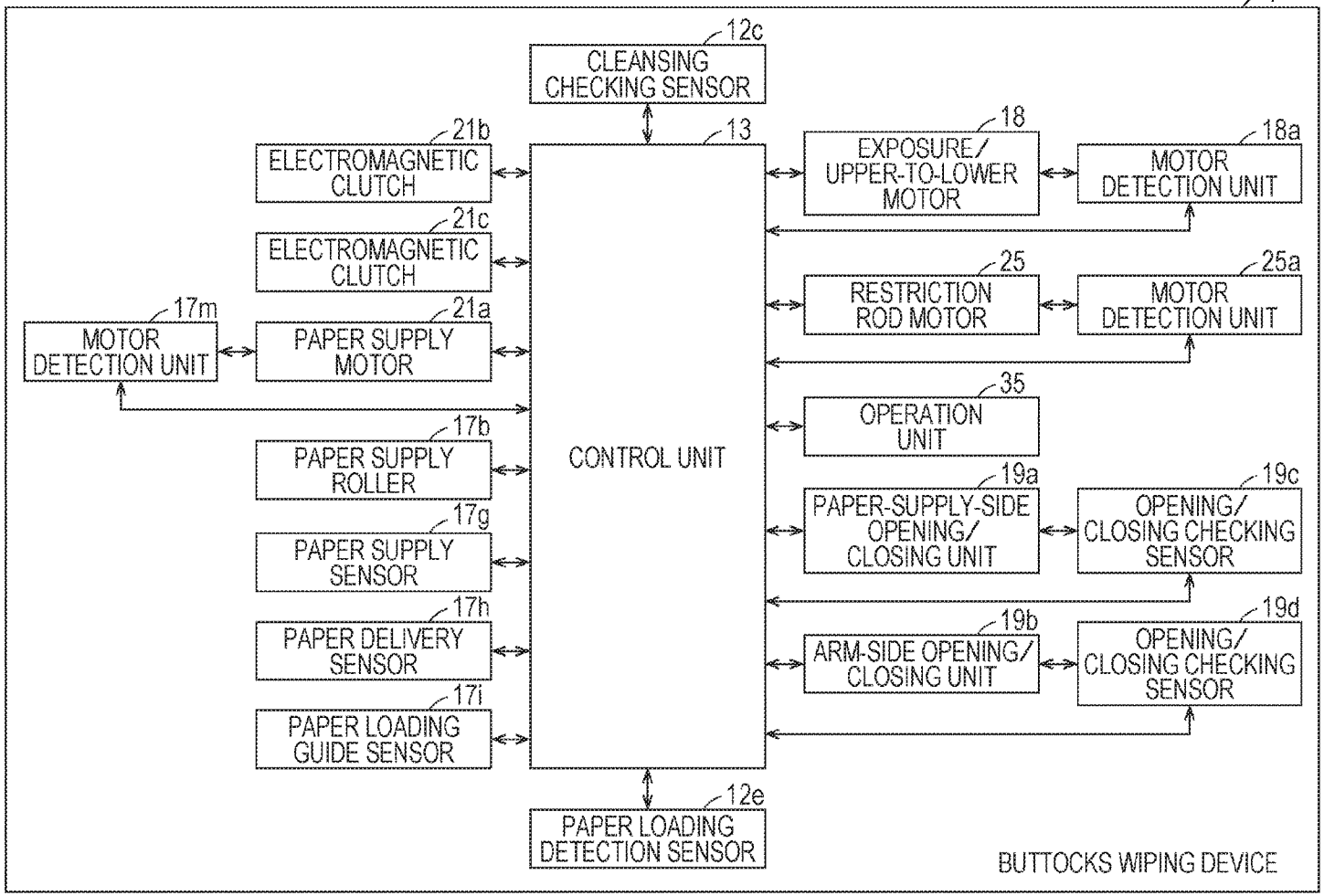

FIG. 106A is a view of the structure of a buttocks wiping device 1 of an eleventh embodiment. FIG. 106A(a) is a plan view, FIG. 106A(b) is a front view, and FIG. 106A(c) is a lift side view of a restriction rod portion 24. FIG. 106B is a block diagram of a functional configuration of the buttocks wiping device 1. Note that operation of the buttocks wiping device 1 of the eleventh embodiment will be described with reference to FIG. 76C also used for description of the tenth embodiment. A plurality of wiping arms 4 are illustrated for the sake of clarifying movement transition, but a single wiping arm 4 is actually provided.

First, a mechanism and operation of a paper supply unit 17 in the eleventh embodiment will be described. The paper supply unit 17 has such a mechanism that rotation of a paper supply motor 21*a* is transmitted to electromagnetic clutches 21*b*, 21*c* through a belt 21*f*. A paper loading guide 17*c* has such a mechanism that the paper loading guide 17*c* is moved back and forth by rotation of a rail drive wheel 21*j*. For example, a back surface of the paper loading guide 17*c* may serve as a rack, and the rail drive wheel 21*j* may serve as a pinion. The rail drive wheel 21*j* is coupled to a pulley 21*h* through a rotary shaft. The pulley 21*h* is connected to a pulley 21*g* through a belt 21*i*. The pulley 21*g* is coupled to the electromagnetic clutch 21*c* through a shaft. Thus, when the electromagnetic clutch 21*c* is ON, if the paper supply motor 21*a* rotates, the pulley 21*g* rotates, and the belt 21*i* rotates. Then, the pulley 21*h* rotates, and the rail drive wheel 21*j* rotates. Accordingly, the paper loading guide 17*c* moves forward (or moves backward). The electromagnetic clutch 21*b* is coupled to paper supply rollers 17*b* through a shaft. When the electromagnetic clutch 21*b* is ON, if the paper supply motor 21*a* rotates, the paper supply rollers 17*b* rotate.

When special paper 11*b* is inserted into a paper injection port 17*a*, a paper supply sensor 17*g* detects such insertion. Then, a control unit 13 turns on the electromagnetic clutch 21*b*, and turns off the electromagnetic clutch 21*c*. In this manner, the special paper 11*b* is delivered. When the paper delivery sensor 17*h* finishes detecting delivery of the special paper 11*b*, the control unit 13 turns on the electromagnetic clutch 21*c* to move the paper loading guide 17*c* forward. The paper loading guide 17*c* is provided with a paper loading guide sensor 17*i*, and it can be detected whether or not the paper is properly placed. Such a detection method is the same as that described in the eighth embodiment.

Next, a mechanism and operation of a wiping arm drive unit 3 will be described. The wiping arm drive unit 3 is provided with an exposure/upper-to-lower motor 18. Although not shown in FIG. 106A, the exposure/upper-to-lower motor 18 is provided so that a screw shaft 24*g* can rotate. Moreover, the wiping arm drive unit 3 is provided with a restriction rod motor 25. Although not shown in FIG. 106A, the restriction rod motor 25 is provided so that a movable plate 24*e* can slide on restriction rod drive units 24*c*, 24*d* on rails. The restriction rod portion 24 is fixed to the movable plate 24*e*. An upper portion of the restriction rod portion 24 is slidably attached to a raised portion 2, and the restriction rod portion 24 is slidable in association with sliding of the movable plate 24*e*. The restriction rod portion 24 includes two restriction rods 24*a*, 24*b* having different lengths. There is a clearance between the two restriction rods 24*a*, 24*b*, the wiping arm 4 being inserted into the clearance upon upward movement. The restriction rod 24*a* is provided continuously to upper and lower portions of the raised portion 2. In contrast, the restriction rod 24*b* is shorter such that a space is formed below the restriction rod 24*b*. Upon exposure/upward movement, the wiping arm 4 moves upward with the wiping arm 4 being inserted between the two restriction rods 24*a*, 24*b*.

A motor detection unit 18*a* is provided so that, e.g., the number of rotations of the exposure/upper-to-lower motor 18 can be detected. A motor detection unit 25*a* is provided so that, e.g., the number of rotations of the restriction rod motor 25 can be detected. Specific examples of the motor detection units 18*a*, 25*a* are similar to the motor detection unit 8*a* described in the first embodiment.

The wiping arm 4 is, at a retracted position thereof, positioned at the lowest position. An arm coupling portion 24*f* is fixed to a base of the wiping arm 4. The arm coupling portion 24*f* is fitted onto the screw shaft 24*g*. As illustrated in FIG. 106A(c), there is an open space below the restriction rod 24*b*. When the special paper 11*b* is placed on the paper loading guide 17*c*, the control unit 13 causes the exposure/upper-to-lower motor 18 to rotate (S500 of FIG. 76C), thereby exposing the wiping arm 4. By rotation of the exposure/upper-to-lower motor 18, the screw shaft 24*g* rotates, and therefore, the wiping arm 4 is exposed. In this state, the wiping arm 4 passes below the restriction rod 24*b*, and comes into contact with the restriction rod 24*a* (the state of the wiping arm 4 as illustrated on the lower side in FIGS. 106A(b) and 106A(c)). The motor detection unit 18*a* detects whether or not the wiping arm 4 has been exposed and reached a position at which the wiping arm 4 contacts the restriction rod 24*a* (S501 of FIG. 76C).

When the exposure/upper-to-lower motor 18 continuously rotates, the wiping arm 4 moves upward (the state of the wiping arm 4 as shown in S502 of FIG. 76C and as illustrated on the upper side in FIGS. 106A(b) and 106A(c)). The motor detection unit 18*a* detects whether or not a pressing unit 4*a* reaches the highest position (S503 of FIG. 76C). Subsequently, the processing proceeds to wiping operation. The special paper 11*b* contacts the buttocks with the pressing unit 4*a* having reached the greatest height, and therefore, almost all of moisture etc. are wiped only by such contact. When an attempt is made to move the pressing unit 4*a* back and forth in the vicinity of the anus according to preferences, the restriction rod motor 25 is actuated by the control unit 13. When the restriction rod motor 25 is actuated, the movable plate 24*e* slides on the restriction rod drive units 24*c*, 24*d*. The restriction rods 24*a*. 24*b* are fixed to the movable plate 24*e*. Thus, when the movable plate 24*e* slides, the restriction rods 24*a*, 24*b* also slide. The wiping arm 4 angularly moves about the screw shaft 24*g* in association with sliding of the restriction rods 24*a*, 24*b*, and therefore, the pressing unit 4*a* moves back and forth in the vicinity of the anus. The wiping operation is executed as described above.

Upon completion of wiping, the exposure/upper-to-lower motor 18 reversely rotates. By rotation of the exposure/upper-to-lower motor 18, the screw shaft 24*g* rotates, and the arm coupling portion 24*f* lowers. Accordingly, the wiping arm 4 also lowers (S505 of FIG. 76C). When the wiping arm 4 lowers, the wiping arm 4 reaches a lower end of the restriction rod 24*b*, and then, passes through the open space below the lower end of the restriction rod 24*b*. Then, the wiping arm 4 returns to the retracted position (S506 and S507 of FIG. 76C).

As described above, according to the structure described in the eleventh embodiment, the wiping arm 4 can be also exposed and moved up and down and back and forth.

Figure 107:
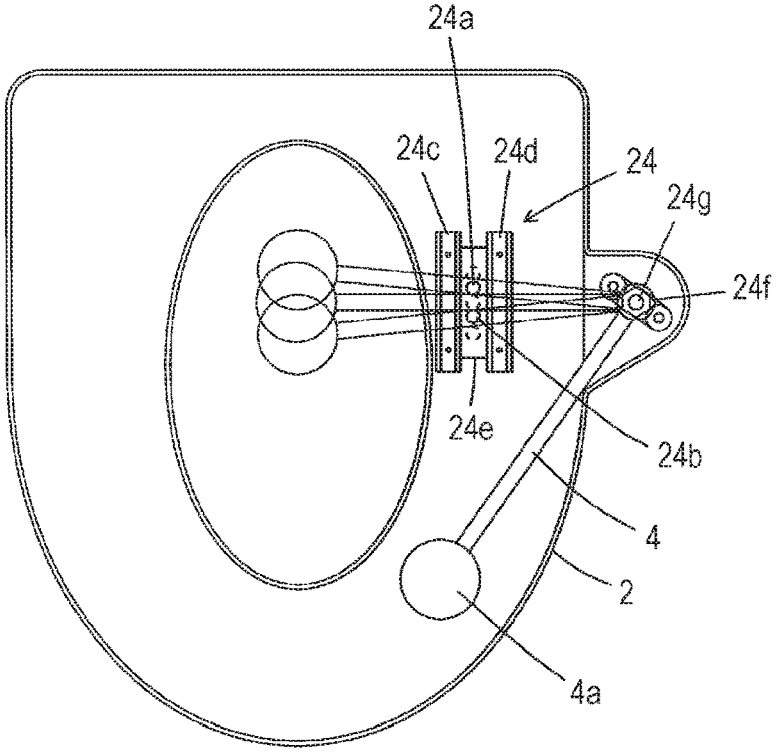
Figure 107:
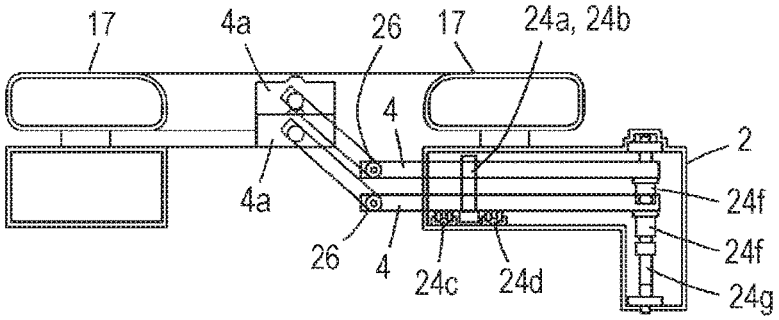
Figure 107:
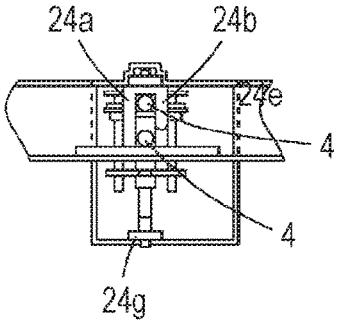

Note that in the eleventh embodiment, the wiping arm 4 is bent, but the height of the raised portion 2 is changeable when the wiping arm 4 can be rotatable at a bending position 26. FIG. 107 illustrates a view when the wiping arm 4 is rotatable at the bending position 26. In FIG. 106A, the bending position 26 of the wiping arm 4 is at around an end portion of the raised portion 2 when the wiping arm 4 is exposed. However, in FIG. 107, the wiping arm 4 is rotatable at the bending position 26. With this structure, the height of the raised portion 2 can be decreased when the mechanism for holding the pressing unit 4*a* horizontal at the bending position 26 upon exposure can be provided. For example, a method in which a swing-type electromagnetic solenoid is provided at the bending position 26 to bend the wiping arm 4 to a certain angle is conceivable as an electric bending method, but the present invention is not limited to above.

Note that when it can be configured such that upon selection of a cleaning mode, the wiping arm 4 further moves to the right as viewed in FIG. 106A(a), and then, the pressing unit 4*a* is exposed to the outside of the raised portion 2, the pressing unit 4*a* can be cleansed/sterilized, for example.

FIG. 108 is a view of a structure in a case where the exposure/upper-to-lower motor 18 used in the eleventh embodiment is changed to an upper-to-lower motor 8 and an exposure motor 9. FIG. 108(*a*) is a plan view, and FIG. 108(*b*) is a front view: The upper-to-lower motor 8 is fixed onto a rotary table 8*e* (e.g., a thrust needle bearing). The rotary table 8*e* is rotatable by rotation of the exposure motor 9. The base of the wiping arm 4 is fixed to a rotary shaft of the upper-to-lower motor 8. When the exposure motor 9 rotates, the upper-to-lower motor 8 rotates, and then, the wiping arm 4 is exposed through a toilet bowl. After exposure, the pressing unit 4*a* of the wiping arm 4 is, as illustrated in FIG. 108(*b*), moved upward by rotation of the rotary shaft of the upper-to-lower motor 8. In association with rotation of the upper-to-lower motor 8, the wiping arm 4 can be moved up and down. When the exposure motor 9 is repeatedly rotated after upward movement of the pressing unit 4*a*, the pressing unit 4*a* can be moved back and forth. As described above, the buttocks can be reliably wiped.

Note that the mechanism of the wiping arm drive unit 3 for the second technique can be also used for the first technique. That is, in a case where the wiping arm drive unit 3 used in the second technique is used for the first technique, the paper may be, needless to say, placed on the pressing unit 4*a* by a hand or a paper supply unit, and then, the anus may be wiped by movement with the paper being placed on the pressing unit 4*a*.

(Embodiment for Sterilization/Cleansing)

The embodiment for sterilization and cleansing will be described. FIG. 109 is a block diagram of a system in a case where the pressure of tap water is utilized to spray a sterilization solution or a cleansing solution. Cleansing of the pressing unit 4*a* has been, as a structure example illustrated in FIG. 109, already described with reference to FIG. 98. That is, an electromagnetic valve 23*a* is switchable between the state of directly spraying tap water to the pressing unit 4*a* from a spraying unit (e.g., a shower head) 23*d* and the state of spraying a diluted sterilization or cleansing solution from a tank 23*f* to the pressing unit 4*a* through the spraying unit (e.g., a shower head) 23*d*. Similarly, in the case of, e.g., cleansing/sterilizing the paper loading guide 17*c*, the electromagnetic valve 23*a* is switchable between the state of directly spraying tap water to the paper loading guide 17*c* from a spraying unit (e.g., a shower head) 23*j* and the state of spraying the diluted sterilization or cleansing solution from the tank 23*f* to the paper loading guide 17*c* through the spraying unit (e.g., a shower head) 23*j*.

FIG. 110 is a block diagram of a system in a case where a drive unit is used to spray the sterilization solution or the cleansing solution. Unlike FIG. 109, FIG. 110 shows a structure in which the sterilization solution or the cleansing solution in the tank 23*f* is pumped up by a pump 23*k* and is fed to the spraying unit 23*d*. 23*j*. A power source such as a motor may be used alone as the power for driving the pump 23*k*. However, the motor configured to drive the wiping arm 4 or the paper loading guide 17*c* may be connected to the pump through an electromagnetic clutch such that the common motor is shared, for example. As described above, various mechanisms for spraying the sterilization solution or the cleansing solution are conceivable.

Note that any well-known sections can be utilized as the spraying units 23*d*, 23*j*. For example, the spraying unit for sterilization/cleansing solution may be a nozzle configured to spray the sterilization/cleansing solution in a mist form, and the spraying unit for tap water may be a unit configured to spray water across a wide area, such as a shower head.

FIG. 111 is a perspective view of the mechanism using the system illustrated in the block diagram of FIG. 110. Note that in FIG. 111, the pipe for cleansing the paper loading guide 17*c* with water is not shown. The cleansing solution is sucked up by the pump 23*k*. The pump 23*k* is a centrifugal pump, for example. In the case of using the centrifugal pump, an impeller is sealed by an oil seal, and is coupled to a motor shaft. In addition, the pump 23*k* may be a magnet pump. The type of pump is not specifically limited. The sterilization solution sucked up by the pump 23*k* passes through a sterilization solution pipe, and is sprayed from the nozzle 23*d* near the pressing unit 4*a* or the nozzle 23*j* near the paper loading guide. With the optimized shape of the nozzle, the sterilization solution can be evenly sprayed to the pressing unit 4*a* or the paper loading guide. Whole-washing of the pressing unit 4*a* can be performed using water supplied from a water pipe. The sterilization solution in the sterilization solution tank 23*f* is merely pumped up, and the sterilization solution pipe is substantially horizontal. Thus, the motor can be, at low cost, implemented by a simple DC motor. Supposing that the pressing unit 4*a* or the paper loading guide 17*c* is stained to the same degree as that of a hand having wiped the buttocks, the type of sterilization solution may be an inexpensive sterilization solution such as benzalkonium chloride. However, the type of sterilization solution is not limited.

(Special Paper 11*b*)

FIG. 112 is a view of an example of the special paper 11*b* to be used for the paper loading guide 17*c*. FIG. 112(*a*) illustrates the special paper 11*b* configured such that multiple pieces of toilet paper are folded together and are joined together at each side 11*g* (portions indicated by diagonal lines). Any joining methods such as pressure bonding, bonding with an adhesive, sewing with a water-soluble sewing thread, or embossing may be employed for joining. As illustrated in FIG. 112(*b*), joining is not necessarily performed on a folded side depending on a folding method. Moreover, joining may be performed only on two sides as illustrated in FIG. 112(*c*) as long as the paper pieces stacked on each other are not separated from each other. Pressure bonding can be implemented in such a manner that the paper may be vertically pressed by molds with raised and recessed portions or be sandwiched by embossing rollers, for example. For reducing paper bending, joining may be performed with a thick water-soluble sheet being additionally disposed on the lowermost surface or disposed between pieces of paper. Note that the structure of the special paper 11*b* described herein has been set forth merely as an example. In this example, the pieces of toilet paper are folded together, but multiple pieces of toilet paper may be joined together with these paper pieces being stacked on each other. The joined toilet paper pieces may be cut using, e.g., a Thomson die, or may be cut using other cutting devices.

Twelfth Embodiment

FIG. 113 is a view of the structure of a buttocks wiping device 1 of a twelfth embodiment. FIG. 113(*a*) is a plan view, FIG. 113(*b*) is a front view, FIG. 113(*c*) is a partial plan view of a wiping arm 4 (upon exposure: note that rotated 90 degrees to the right), FIG. 113(*d*) is a right side view, and FIG. 113(*e*) is a schematic view of a link mechanism. A bevel gear 27*b* is attached to a rotary shaft of an exposure motor 9. A rotary table 8*e* is attached to rotate about a center shaft 27*g* by bearings 27*d*. 27*e*. A bevel gear 27*a* is attached to the center shaft 27*g*. The rotary table 8*e* is, at one side, bent in an L-shape, and an upper-to-lower motor 8 is attached to the L-shaped bent portion. The bevel gear 27*a* and the bevel gear 27*b* engage with each other. When the rotary shaft of the exposure motor 9 rotates, the bevel gear 27*b* rotates. Accordingly, the bevel gear 27*a* rotates, and the rotary table 8*e* rotates. As a result, the upper-to-lower motor 8 angularly moves and rotates about the center shaft 27*g*. A wiping arm 4 is attached to a rotary shaft of the upper-to-lower motor 8 through a link mechanism 27*e* (specifically described with reference to FIG. 115). Thus, the wiping arm 4 is exposed in association with rotation of the rotary table 8*e*. The wiping arm 4 and the rotary shaft of the upper-to-lower motor 8 are coupled together through the link mechanism 27*e*. Thus, when the wiping arm 4 moves upward as illustrated in FIG. 113(*e*), the top position of the pressing unit 4*a* can be moved straight up. When moved straight up, the top position of the pressing unit 4*a* does not shift right to left even with an individual difference in the height position of the anus. Thus, the feeling of wiping is improved.

FIG. 114 is a view of the structure of the buttocks wiping device 1 in the case of using a gear box. FIG. 114(*a*) is a plan view, FIG. 114(*b*) is a front view, FIG. 114(*c*) is a partial plan view of the wiping arm 4 (upon exposure: note that rotated 90 degrees to the right), FIG. 114(*d*) is a right side view, and FIG. 114(*e*) is a schematic view of the link mechanism. In the buttocks wiping device 1 illustrated in FIG. 114, a gear box 28 is used to transmit, after deceleration, rotation of the rotary shaft of the exposure motor 9 to the center shaft 27*g* of the rotary table 8*e* through a transmission section 28*a* such as a belt. Operation after rotation of the center shaft 27*g* is similar to that of FIG. 113. As described above, rotation of the exposure motor 9 may be, using the gear box, transmitted to the upper-to-lower motor 8.

FIG. 115 is a view for specifically describing the link mechanism 27*e* used at a coupling portion between the wiping arm 4 and the rotary shaft 29*a* of the upper-to-lower motor 8. Upper-to-lower operation of the wiping arm 4 upon exposure will be specifically described with reference to FIG. 115. The rotary shaft 29*a* and the wiping arm 4 are coupled together through a nested extendable portion 29*b*. A portion of the wiping arm 4 coupled to the rotary shaft 29*a* serves as an inner insert, and a portion of the wiping arm 4 coupled to a free end 27*f* serves as an outer insert. The extendable portion 29*b* allows the wiping arm 4 to extend/contract at a base portion thereof. The free end 27*f* moves according to the track of the link mechanism 27*e* such that the extendable portion 29*b* extends/contracts.

FIG. 115(*a*) is a front view when the pressing unit 4*a* has reached the uppermost position. FIGS. 115(*b*) to 115(*e*) illustrate a state while the pressing unit 4*a* is gradually lowering from FIG. 115(*a*). When the rotary shaft 29*a* of the upper-to-lower motor 8 rotates, the extendable portion extends in association with upward movement of the free end 27*f* along a groove of the link mechanism 27*e*. With this structure, the top 29 of the pressing unit 4*a* moves upward without shifting right to left on the plane of paper. When reached the uppermost position as illustrated in FIG. 115(*a*), the free end 27*f* comes into contact with an upper end of the groove provided at the link mechanism 27*e*. In this state, the extendable portion 29*b* has been extended to the maximum, and therefore, the top 29 of the pressing unit 4*a* has moved upward without shifting right to left. Conversely, upon downward movement of the pressing unit 4*a*, the extendable portion 29*b* contracts while the top 29 of the pressing unit 4*a* is moving downward without shifting right to left. The pressing unit 4*a* is coupled to the wiping arm 4 through a hinge mechanism 29*c*. The hinge mechanism 29*c* is a T-shaped mechanism provided at one end of the wiping arm 4, and is swingable in the pressing unit 4*a*. The hinge mechanism 29*c* can hold the pressing unit 4*a* horizontal.

When the top portion of the pressing unit 4*a* comes into contact with the vicinity of the anus, the pressing unit 4*a* held horizontal can contact the vicinity of the anus. Note that the structure for preventing right-to-left shifting has been set forth merely as an example, and the structure of the hinge mechanism 29*c* has been also set forth merely as an example. These structures are not intended to limit the present invention.

As described above, according to the twelfth embodiment, the wiping arm 4 can be driven using a mechanism with a high technical reliability, such as a bevel gear or a gear box. Moreover, right-to-left shifting of the top of the pressing unit 4*a* can be prevented using the link mechanism. Thus, even with an individual difference in the height of the anus, the top 29 can contact the anus. Consequently, the feeling of wiping is improved.

Note that it is assumed that a user sits at a proper position upon warm-water cleansing, leading to an assumption that the position of the anus does not significantly shift.

(Automatic Paper Supply Mechanism of Special Paper)

The mechanism for automatically supplying special paper 11*b* will be described with reference to FIGS. 116 to 120. The mechanism described herein can be utilized with the mechanism being attached to a paper injection port 14*a* of a paper supply unit 14 used for the first technique or with the mechanism being attached to a paper injection port 17*a* of a paper supply unit 17 used for the second technique. The case where the mechanism is attached to the paper injection port 17*a* of the paper supply unit 17 used for the second technique will be described herein, but the same applies to the case of the first technique.

FIG. 116 is a sectional view of a vertical orientation structure for automatically supplying the special paper 11*b* to the paper supply unit 17. Pieces of special paper 11*b* are stacked in a paper stocker portion 30. Each piece of special paper 11*b* is a single piece of thick paper or a stack of multiple pieces of paper joined together. A friction plate 30*a* is provided below a leading end portion of the special paper 11*b*. The stack of special paper 11*b* is sandwiched between the friction plate 30*a* and a delivery roller 30*b*. The delivery roller 30*b* is rotated by, e.g., a not-shown motor. Friction between adjacent ones of the pieces of special paper 11*b* is smaller than friction between the special paper 11*b* and the delivery roller 30*b*, and therefore, only the uppermost one of the pieces of special paper 11*b* is delivered when the delivery roller 30*b* rotates. The friction plate 30*a* prevents the second and subsequent ones of the pieces of special paper 11*b* from moving forward. The delivered uppermost one of the pieces of special paper 11*b* is supplied to paper feeding rollers 17*b*. By rotation of the paper feeding rollers 17*b*, the single piece of special paper 11*b* is supplied to a paper loading guide 17*c*. In this manner, the special paper 11*b* can be automatically supplied to the paper loading guide 17*c*.

FIG. 117 is a sectional view of a diagonally-horizontal orientation structure for automatically supplying the special paper 11*b* to the paper supply unit 17. As in FIG. 117, the special paper 11*b* may be, one by one, delivered by the delivery roller 30*b* with the paper stocker portion 30 being disposed in a diagonally-horizontal orientation. Needless to say, even when the paper stocker portion 30 is disposed in a horizontal orientation, the special paper 11*b* can be delivered one by one. In addition, a paper separation mechanism or a paper feeding mechanism used for a copying machine etc. may be employed for the paper stocker portion 30.

FIGS. 118 and 119 are sectional views of a vertical orientation structure for automatically supplying the special paper 11*b* to the paper supply unit 17. The pieces of special paper 11*b* are stacked in the paper stocker portion 30. Claw portions 30*c* as raised portions for stopping the special paper 11*b* are provided respectively on the upper and lower sides of the paper stocker portion 30. Note that the length, size, position, etc. of the claw portion 30*c* are optimized as necessary. A holding unit 30*f* is a hand configured such that the special paper 11*b* can be pinched by tip ends of the hand. Note that the holding unit 30*f* is not specifically limited as long as the special paper 11*b* can be held. The holding unit 30*f* can be, by a drive unit 30*d*, moved right to left along a guide 30*e* on the plane of paper. For example, the drive unit 30*e* may be a motor, and the guide 30*e* may be a screw: In addition, it may be configured such that the holding unit 30*f* is movable right to left by rotation of the screw. However, the structure is not limited to above as long as the holding unit 30*f* can approach a paper side or move apart from the paper side.

In a case where a single piece of special paper 11*b* is taken out of the paper stocker portion 30, the drive unit 30*d* drives the holding unit 30*f* to approach the paper side. When the tip ends of the holding unit 30*f* come into contact with the special paper 11*b*, it is recognized, by reaction of a sensor or a current value change, that the tip ends contact the special paper 11*b*. When the tip ends contact the special paper 11*b*, the holding unit 30*f* closes the tip ends thereof to hold the special paper 11*b*. With the optimized shape of each tip end, the holding unit 30*f* can hold only a single piece of paper. When the special paper 11*b* is held, the drive unit 30*d* drives the holding unit 30*f* to move reversely. With this structure, only the single piece of special paper 11*b* is taken out of the paper stocker portion 30 as in FIG. 119. When the holding unit 30*f* reaches a predetermined position, a position at which the held special paper 11*b* is to be released is recognized by a sensor etc. When reached a position as in FIG. 119, the holding unit 30*f* releases the held special paper 11*b*. Then, the special paper 11*b* drops, and is supplied to the paper feeding rollers 17*b*. Subsequently, the paper feeding rollers 17*b* rotate to supply the paper to the paper loading guide 17*c*.

FIG. 120 is a sectional view of the diagonally-horizontal orientation structure for automatically supplying the special paper 11*b* to the paper supply unit 17. As in FIG. 120, the holding unit 30*f* may be driven to approach the special paper 11*b* or to move apart from the special paper 11*b* with the paper stocker portion 30 being disposed in the diagonally-horizontal orientation, thereby holding the special paper 11*b* one by one. Needless to say, even when the paper stocker portion 30 is disposed in the horizontal orientation, the special paper 11*b* can be delivered one by one. The holding unit 30*f* may suck out, using a negative pressure, the special paper 11*b* one by one, and then, release the negative pressure to drop the single piece of special paper 11*b*. In this manner, the special paper 11*b* may be supplied to the paper feeding rollers 17*b*. Alternatively, the paper delivery roller 30*b* and the claw portions 30*c* may be used to take out the paper one by one.

(Embodiment for Portable Toilet)

The buttocks wiping device is used for a toilet bowl. A so-called portable toilet used in a room is also surely the toilet bowl. Thus, the buttocks wiping device used for the portable toilet is, needless to say, also included in the present invention.

FIGS. 121 to 128 illustrate an example of the buttocks wiping device used for a portable toilet 31 having a wiping function (hereinafter referred to as a "portable toilet 31"), and such a buttocks wiping device will be described below.

However, any structures of the buttocks wiping device disclosed in the present specification can be utilized for the portable toilet.

First, terms to be used will be described. A portable toilet function is the function of accumulating excrement in, e.g., a container and disposing the excrement to the outside of the room after excretion as in a typical portable toilet. A warm-water cleansing function is the function of cleansing the buttocks with water after excretion. For use in any installation locations, water is often supplied from a water tank, and the present invention is not limited to above. The wiping function is the function of wiping, with paper, moisture on the buttocks after water cleansing. A raised portion is provided at a clearance between a toilet seat and the toilet bowl, and part or entirety of the wiping arm and a drive unit thereof is housed in the raised portion. Note that instead of the raised portion, the thickness of the toilet seat may be increased such that part or entirety of the wiping arm and the wiping arm drive unit is provided in the toilet seat. The wiping arm is configured to use the paper supplied from a paper supply function, thereby wiping the buttocks. A head at a tip end of the wiping arm has a shape fitting the anus. The paper supply function is the function of supplying the paper to the wiping arm.

In the portable toilet 31 illustrated in FIGS. 121 to 128, the paper supply unit 17 supplies, separately from the wiping arm 4, the special paper 11*b* onto the wiping arm 4, and the wiping arm 4 pushes up the special paper 11*b* from below. In this manner, the buttocks are wiped. That is, the second technique is employed.

A paper disposing function is the function of dropping the special paper 11*b* from the wiping arm 4 after wiping. The special paper 11*b* is naturally dropped in such a manner that the wiping arm 4 slightly moves right to left and up and down, or is dropped by a protrusion etc. for dropping the special paper 11*b* when the wiping arm 4 returns to the raised portion 2. Rectangular paper is used as the special paper 11*b*, the rectangular paper being formed in such a manner that a stack of multiple pieces of toilet paper are, for example, pressure-bonded together to such an extent that moisture can be sufficiently absorbed. The special paper 11*b* is injected into the paper injection port 17*a* provided at the paper supply unit 17, and then, is supplied. A nursing target injects the special paper 11*b* into the paper injection port 17*a*, and then, causes the portable toilet 31 illustrated in FIGS. 121 to 128 to perform wiping.

The raised portion 2 is provided with a housing portion 32 for housing the wiping arm 4 and the wiping arm drive unit 3 and a paper loading guide opening 33 for housing the paper loading guide 17*c* of the paper supply unit 17. For preventing water from entering the housing portion 32 and the paper loading guide opening 33 through hollow-out portions thereof upon water washing, shutter functions (39, 34) are provided respectively on both of a wiping arm side and a paper feeding unit side.

A malfunction prevention function is the function of performing wiping by the wiping arm 4 after determination on whether or not the buttocks have been cleansed. In a case where the buttocks have not been cleansed, wiping is not performed for preventing malfunction. An automatic paper supply function is an automatic paper supply function provided as an optional function for a nursing target who is difficult to manually inject the special paper 11*b* into the paper injection port 17*a* of the paper supply unit 17, the automatic paper supply function being the function of housing a stack of multiple pieces of special paper 11*b* in a paper stocker portion 38 and injecting, one by one, the special paper 11*b* into the paper injection port from the paper stocker portion 38.

Sterilization Function: in the portable toilet 31 illustrated in FIGS. 121 to 128, the pressing unit 4*a* of the wiping arm 4 contacts the buttocks although the special paper 11*b* is interposed therebetween. Thus, the pressing unit 4*a* needs to be held in a sanitary manner. For this reason, the function of spraying a sterilization solution to the pressing unit 4*a* is provided as necessary.

Maintenance Function: a lid portion is openably provided at the raised portion 2 so that the pressing unit 4*a* of the wiping arm and the paper loading guide 17*c* can be sterilized, cleansed, etc., and in this manner, these elements can be directly sterilized, cleansed, etc. Moreover, when a cleaning mode is selected, the wiping arm 4 or the paper loading guide 17*c* is exposed for sterilization, cleansing, etc.

Antibacterial Processing: the pressing unit 4*a* and the paper loading guide 17*c* are made of an antibacterial material such that no bacteria propagation is caused.

Odor Elimination Function: an odor elimination device 50 configured to eliminate odor in the toilet bowl in a state in which the toilet bowl is closed to prevent excrement odor from spreading across the room is provided as an optional function.

Restriction Conditions on Usage Environment and Necessity of Installation Environment Improvement: with a home power supply, the portable toilet 31 illustrated in FIGS. 121 to 128 is operable, and it is not necessary to specially remodel the inside of the room or to improve installation environment.

Preparation and Cleaning Up in Daily Use: the special paper 11*b* needs to be separately purchased.

In the case of using the automatic paper supply function, the paper stocker portion 38 needs to be refilled with the special paper 11*b*.

The wiping arm 4 and the paper loading guide 17*c* may be regularly cleaned.

Continuous Available Time: under a normal usage condition, it is not necessary to take a continuous available time into consideration.

Maintenance Management System: a paper jam is assumed as a trouble caused under the normal usage condition. Because of a simple structure, such a paper jam is cleared in such a manner that the user merely removes the special paper 11*b* through the opened raised portion 2.

Connection to Other Types of Equipment: cooperation with a warm-water cleansing device 15 is necessary, and the buttocks are wiped under a condition where warm-water cleansing has been completed.

Cooperation with the odor elimination device 50 is optionally available, and the excrement odor in the toilet bowl can be eliminated by the odor elimination device 50.

Shape of Raised Portion 2: for preventing a finger from being caught upon opening/closing of a toilet seat 7, the raised portion 2 for housing various functions is in a shape fitting the shapes of the portable toilet 31, a toilet bowl portion 36, and the warm-water cleansing device 15.

Moreover, for housing various functions, the raised portion 2 is provided with some holes and hollows in the mechanism. In a normal state, all of these holes and hollows are closed. This prevents a finger from being caught.

Fixing of Raised Portion 2: the raised portion 2 is fixed to the portable toilet 31, thereby not dropping from the portable toilet 31. Although slightly protruding from the raised portion 2, the paper supply unit 17, the paper stocker portion 38, etc. are firmly fixed to the raised portion 2, thereby not dropping.

Wiping Arm 4: it is necessary that the wiping arm 4 does not press the buttocks with force more than necessary.

(1) The height of a ceiling portion of the raised portion 2 is limited such that the wiping arm 4 does not move upward to a height more than necessary.

(2) A motor configured not to generate a torque more than necessary is used for the wiping arm drive unit 3.

(3) A sensor or a current value detection unit is provided at the wiping arm drive unit 3 such that when a torque equal to or greater than a predetermined torque is generated due to pressing of the wiping arm 4 against the buttocks, the motor weakens wiping operation to reduce the torque to less than the predetermined torque. With this structure, torque control or torque limitation is performed.

Paper Delivery: it is necessary that the paper loading guide 17*c* is configured not to contact the buttocks.

(1) The height of an opening through which the paper loading guide 17*c* is exposed is determined from the raised portion 2, and the paper loading guide 17*c* is originally configured not to contact the buttocks.

(2) A motor configured not to generate a torque more than necessary is used for the paper supply unit 17.

(3) For stopping or reversely rotating the motor when a torque equal to or greater than a predetermined torque is generated due to contact of the paper loading guide 17*c* with the buttocks, a sensor or a current value detection unit is provided at the paper supply unit 17, or a sensor or a switch is provided at the paper loading guide 17*c*. With this structure, the paper loading guide 17*c* stops or reversely rotates when contacting the user.

There is a probability that the user directly sits on the raised portion 2 with the toilet seat 7 being lifted. For this reason, a sensor or a switch is, as a countermeasure against direct sitting on the raised portion 2, provided such that the wiping arm drive unit 3 and the paper supply unit 17 do not operate when the toilet seat 7 is not lowered.

A sensor configured to detect completion of warm-water cleansing is provided as a countermeasure against operation after completion of warm-water cleansing. When warm-water cleansing has not been completed yet, the wiping arm drive unit 3 and the paper supply unit 17 do not operate.

Countermeasure against Electric Leakage: it is designed no to cause electric leakage.

Power Blackout: in the case of power blackout during operation, a motor configured to manually return the wiping arm 4 and the paper loading guide 17*c* to original positions is utilized (a proper holding torque is used). Note that an auxiliary battery can be employed depending on a cost.

Excretion after Water Washing: a countermeasure considering the probability of excretion after water washing is necessary. The shape of the paper loading guide 17*c* is designed to merely drop down the special paper 11*b* even after excretion. Moreover, the shape of the paper loading guide 17*c* is designed such that no breakdown is caused due to dropping force of excrement. Preparing for the case of excrement dropped on the wiping arm 4, a sensor detects dirt on the pressing unit 4*a*. In a case where dirt is on the pressing unit 4*a*, warning is provided.

Wiping Arm 4: in a case where the wiping arm 4 is not in an operable state due to motor breakdown, even when an operation switch is pressed, the wiping arm 4 does not move to a predetermined location within a predetermined time. For this reason, a sensor is provided at such a predetermined location, thereby performing self-diagnosis for determining whether or not the wiping arm 4 has moved to such a location. If the wiping arm 4 does not move within the predetermined time, such a state is taken as occurrence of an abnormality, and warning is provided.

Paper loading guide 17*c*: in a case where the paper loading guide 17*c* is not in an operable state due to motor breakdown, even when an operation switch is pressed, the paper loading guide 17*c* does not move to a predetermined location within a predetermined time. For this reason, a sensor is provided at such a predetermined location, thereby performing self-diagnosis for determining whether or not the paper loading guide 17*c* has moved to such a location. If the paper loading guide 17*c* does not move within the predetermined time, such a state is taken as occurrence of an abnormality, and warning is provided.

Automatic Paper Supply Function: the presence or absence of paper stocked in the paper stocker portion 38 is detected. When there is no paper, warning is provided to prompt the user to refill the paper stocker portion 38 with paper.

Outer Appearance: an outer size is a width of 460 mm×a depth of 645 mm×a height of 680 mm, and has been obtained from existing portable toilets and warm-water cleansing devices. The wiping device itself is small.

Weight: about 30 Kg. The weight of an existing portable toilet with a warm-water cleansing device is about 20 Kg. and therefore, the above-described weight has been obtained by addition of a weight of about 10 Kg for realizing the wiping function etc.

Driving is performed with an AC of 100 V/50-60 Hz. Power supply can be performed from the home power supply.

The wiping arm drive unit 3 includes the following actuators:

Upper-to-Lower Motor 8: a single geared DC motor for moving the wiping arm 4 up and down by the upper-to-lower motor 8: and Exposure Motor 9: a single geared DC motor for exposing/retracting the wiping arm 4 by the exposure motor 9.

By these motors, the wiping arm 4 can be moved up and down and back and forth upon wiping.

Each motor may generate such a torque that the pressing unit 4*a* is pressed against the buttocks by movement of the pressing unit 4*a* and the wiping arm 4.

The paper supply unit 17 includes the following actuator:

Paper supply motor 21*a*: a single geared DC motor utilizing electromagnetic clutches 21*b*, 21*c* and a belt 21*f* for sharing a common drive motor for driving the paper supply rollers 17*b* and a rail drive wheel 21*j*. Such a motor may generate such a torque that the paper loading guide is moved.

An arm opening/closing unit 39 includes the following actuator:

Geared DC Motor 39*a*: note that using a lever, a shutter can be opened/closed only by attachment/detachment of an electromagnet.

A paper loading guide opening/closing unit 34 includes the following actuator:

Geared DC Motor 34*a*: note that using a lever, a shutter can be opened/closed only by attachment/detachment of an electromagnet.

The paper stocker portion 38 includes the following actuators:

a single geared DC motor (not shown) for holding a stack of pieces of special paper 11*b*: and a single geared DC motor (not shown) for injecting the held paper into the paper injection port.

In addition, the following structure is conceivable.

The special paper 11*b* and the wiping arm 4 are separately positioned below the buttocks. However, there is a probability that when the pressing unit 4*a* moves from below the special paper 11*b*, the special paper 11*b* cannot closely contact the buttocks well. In this case, suction of the paper to the pressing unit 4*a* is necessary. For this reason, a hole for negative pressure generation is provided at the pressing unit 4*a*, and the special paper 11*b* is sucked to the pressing unit 4*a* in such a manner that the negative pressure is generated by a negative pressure generation device upon contact with the buttocks. On the other hand, for detaching the special paper 11*b*, the special paper 11*b* is dropped from the pressing unit 4*a* in such a manner that the negative pressure is released or that a positive pressure is generated. In the case of employing such a structure, a compressor is necessary for negative/position pressure generation.

An outline of operation of the portable toilet 31 with the wiping function is as follows.

1. Start of Wiping

When a wiping switch of an operation unit 35 is pressed by the user, each opening/closing unit 34, 39 is opened. Moreover, the paper supply unit 17 is actuated to place the special paper 11*b* on the paper loading guide 17*c*, and the paper loading guide 17*c* moves forward to expose the special paper 11*b* below the buttocks. In association with such operation, the wiping arm 4 is exposed below the buttocks.

2. During Wiping

The pressing unit 4*a* of the wiping arm 4 moves upward from below the special paper 11*b* placed on the paper loading guide 17*c*, and pushes up the special paper 11*b* such that the special paper 11*b* closely contacts the vicinity of the anus.

Then, the paper loading guide 17*c* moves backward and returns to the original position.

By gentle front-to-back and upper-to-lower movement of the wiping arm 4, moisture etc. on the buttocks are absorbed by the special paper.

3. After Completion of Wiping

Upon completion of wiping, the pressing unit 4*a* is lowered. When the pressing unit 4*a* is lowered, the special paper 11*b* moves apart from the buttocks due to its own weight. This is because the special paper 11*b* has a certain thickness. In such a state, the wiping arm 4 slightly moves back and forth and up and down to shake off the special paper 11*b*.

Finally, the wiping arm 4 returns to the original position, and each opening/closing unit 34, 39 is closed.

Note that the moving speeds of the wiping arm 4 and the paper loading guide 17*c* are about 5 cm/second, for example.

A user interface is as follows.

1. Wiping Switch

A wiping button is provided at the operation unit 35 in a recognizable manner so that operation can be performed even by the nursing target.

2. Button for Cleaning Mode

A cleaning button is provided so that the pressing unit 4*a* and the paper loading guide 17*c* can be cleansed etc. When the cleaning button is pressed, the wiping arm 4 and the paper loading guide 17*c* are exposed.

A sensor etc. are as follows.

1. Position Detection of Wiping Arm 4

Sensors (four sensors in total) are provided respectively at an upper limit position, a lower limit position, a left limit position, and a right limit position of the wiping arm 4, thereby detecting the position of the wiping arm 4. Such a position is utilized for control of the upper-to-lower motor 8 and the exposure motor 9. Note that, e.g., the upper limit position, the lower limit position, the left limit position, and the right limit position may be detected by motor detection units 8*a*, 9*a* configured to detect, e.g., the number of rotations of each of the upper-to-lower motor 8 and the exposure motor 9.

2. Position Detection of Paper Loading Guide 17*c*

Sensors (two sensors in total) are provided respectively at a left limit position and a right limit position of the paper loading guide 17*c*, thereby detecting the position of the paper loading guide 17*c*. Such a position is utilized for control of the paper supply motor 21*a*. Note that, e.g., the left limit position and the right limit position may be detected by a motor detection unit configured to detect, e.g., the number of rotations of the paper supply motor 21*a*.

3. Detection of Completion of Warm-Water Cleansing

By detection on whether or not an operation button for warm-water cleansing has been pressed, it is determined whether or not warm-water cleansing has been completed. Note that a sound sensor may detect whether or not water is coming out of a nozzle of the warm-water cleansing device 15, thereby determining whether or not warm-water cleansing has been completed.

The switch or the sensor is provided at the raised portion 2 such that operation is not made in the case where the toilet seat is not lowered.

Operation and a structure will be described below in detail with reference to FIGS. 121 to 128. FIG. 121 is a view of the outer appearance of the portable toilet 31 in a standby state. For implementing the portable toilet function, the toilet bowl portion 36 includes a bucket for accumulating waste on the inside. Note that the toilet bowl portion 36 may be equipped with a device configured to automatically seal waste in a disposable bag or container. The warm-water cleansing device 15, the toilet seat 7, and the buttocks wiping device 1 are provided above the toilet bowl portion 36. The operation unit 35 is provided at the side of the toilet seat 7. Note that the operation unit 35 may be of a wireless type. Note that the operation switch for the wiping function may be separately provided, or may be incorporated into an operation unit of the warm-water cleansing device 15. The raised portion 2 is provided between the toilet bowl portion 36 and the toilet seat 7. Part or entirety of the wiping arm 4 and the wiping arm drive unit 3 is housed in the raised portion 2. Moreover, some of the functions of the paper supply unit 17 are housed in the raised portion 2, and the special paper 11*b* is delivered from the paper supply unit 17.

Note that in the case of manually supplying the paper, the paper stocker portion 38 is not provided.

FIG. 122 is an exploded perspective view of the portable toilet 31. As illustrated in FIG. 122, the wiping arm 4, the wiping arm drive unit 3, and an internal mechanism 40 of the paper supply unit 17 are housed in the raised portion 2. The internal mechanism 40 of the paper supply unit 17 is housed in a housing 37 of the paper supply unit 17 and the paper loading guide opening 33 provided at the raised portion 2. The paper stocker portion 38 is placed on the paper supply unit 17. The structure of the paper supply unit 17 is similar to those as illustrated in FIGS. 106A, 108, 113, etc. The structure illustrated in FIGS. 116 to 120 is used for the paper stocker portion 38.

FIG. 123 is an exploded perspective view of various mechanisms of the buttocks wiping device 1. As illustrated in FIG. 123, the wiping arm drive unit 3 includes the upper-to-lower motor 8 connected to one end of the wiping arm 4, the rotary table 8*e* to which the upper-to-lower motor 8 is fixed, and the exposure motor 9 configured to rotate the rotary table 8*e*. The rotary shaft of the exposure motor 9 and the rotary table 8*e* are coupled together through the bevel gear as illustrated in, e.g., FIG. 113, but the present invention is not limited to above. When the exposure motor 9 rotates, the rotary table 8*e* rotates such that the upper-to-lower motor 8, the wiping arm 4, and the pressing unit 4*a* are exposed by angular movement. After exposure, the upper-to-lower motor 8 rotates to incline the wiping arm 4 diagonally upward, and then, the special paper 11*b* is lifted by the pressing unit 4*a*.

The wiping arm 4, the pressing unit 4*a*, and the wiping arm drive unit 3 are housed in the housing portion 32 provided at the raised portion 2. The housing portion 32 is closed by a lid 32*a*.

For closing the opening of the housing portion 32, the arm opening/closing unit 39 to be driven by the motor 39*a* is provided. Note that for moving the arm opening/closing unit 39 up and down, other mechanisms than the motor 39*a* can be used.

The internal mechanism 40 of the paper supply unit 17 includes the paper supply motor 21*a*, the paper supply rollers 17*b*, the paper loading guide 17*c*, and the rail drive wheel 21*j*. When the user manually injects the special paper 11*b* into the paper injection port 17*a* of the paper supply unit 17 or the special paper 11*b* is injected from the paper stocker portion 38 into the paper injection port 17*a* of the paper supply unit 17, the paper supply motor 21*a* rotates to rotate the paper supply rollers 17*b*. When the paper supply rollers 17*b* rotate, the special paper 11*b* is placed on the paper loading guide 17*c*. When the special paper 11*b* is placed on the paper loading guide 17*c*, the electromagnetic clutch 21*c* connected to the paper supply motor 21*a* is actuated to rotate the rail drive wheel 21*j*. By rotation of the rail drive wheel 21*j*, the paper loading guide 17*c* is exposed with the special paper 11*b* being placed on the paper loading guide 17*c*.

For closing the paper loading guide opening 33, the paper loading guide opening/closing unit 34 to be driven by the motor 34*a* is provided. Note that for moving the paper loading guide opening/closing unit 34 up and down, other simple mechanisms than the motor 34*a* can be used.

FIG. 124 is a perspective view of the portable toilet 31 when the special paper 11*b* and the wiping arm 4 are exposed. FIG. 125 is a plan view of the portable toilet 31 when the special paper 11*b* and the wiping arm 4 are exposed. When the special paper 11*b* and the wiping arm 4 are exposed as illustrated in FIGS. 124 and 125, the pressing unit 4*a* is positioned below the special paper 11*b*. The paper loading guide 17*c* is in a shape greatly hollowed out so that only the special paper 11*b* can be lifted in a case where the pressing unit 4*a* moves upward from below.

FIG. 126 is a perspective view of the portable toilet 31 upon wiping. FIG. 127 is a front view of the portable toilet 31 upon wiping. As illustrated in FIGS. 126 and 127, the wiping arm 4 inclines to the upward direction upon wiping, and therefore, the pressing unit 4*a* moves upward. In this manner, the special paper 11*b* is lifted. In addition, the paper loading guide 17*c* moves backward, and returns to the original position. In this state, the buttocks, the special paper 11*b*, and the pressing unit 4*a* closely contact each other, and therefore, the moisture etc. on the buttocks are absorbed by the special paper 11*b*. By forward-reverse repeat rotation of the exposure motor 9, the pressing unit 4*a* moves back and forth, leading to reliable wiping. Moreover, when the pressing unit 4*a* contacts the buttocks with a pressure equal to or higher than a certain pressure, the upper-to-lower motor 8 weakens pressing, thereby adjusting the pressing pressure.

FIG. 128 is a perspective view of the portable toilet 31 including the odor elimination device 50. In the standby state such as a state after excretion, the odor elimination device 50 is actuated with a lid 51 of the toilet bowl being lowered, as illustrated in FIG. 128. Assuming that the odor elimination device 50 is used, a hole for feeding air into the odor elimination device 50 from the toilet bowl portion 36 is provided at the raised portion 2. Upon odor elimination, the arm opening/closing unit 39 is lowered to feed air into the odor elimination device 50 through the hole, thereby eliminating the odor. After odor elimination, the arm opening/closing unit 39 moves upward to seal the toilet bowl portion 36, thereby preventing the odor from spreading across the room.

As described above, the buttocks are wiped using the second technique in the portable toilet 31.

(Manufacturing of Special Paper 11*b*)

FIG. 129 is a flowchart of an example of the step of manufacturing the special paper 11*b*. A device configured to deliver rolled paper (S600), automatically fold the paper (S601), and cut the paper to a predetermined length (S602) is used as a device used for manufacturing the special paper 11*b*. Any well-known techniques can be utilized for these delivering, folding, and cutting steps. For example, as in JP-A-2003-70680 and JP-A-H9-276178, the rolled paper may be delivered while a reciprocable member repeatedly moves to fold the rolled paper. For example, as in JP-A-2003-72998 and Japanese Utility Model No. 3024537, after the rolled paper has been received in a such a shape that the rolled paper is naturally folded, the rolled paper is folded.

Subsequently, the rolled paper subjected to folding and cutting is pressure-bonded by, e.g., a pressing machine (S603). A device having raised and recessed portions configured to sandwich paper folded in the upper-to-lower direction and to fit pressure-bonded portions (e.g., paper ends) each other in the upper-to-lower direction may be used as the pressing machine. Alternatively, a device configured to use upper and lower rollers to sandwich paper and having raised and recessed portions configured to fit pressure-bonding target portions each other in the upper-to-lower direction may be used.

Using, e.g., a punching blade of a Thomson die, extra end portions of a peripheral edge portion of the pressure-bonded paper are cut off. As a result, the special paper 11*b* with a predetermined size is formed (S604). Note that the step of cutting off the peripheral edge portion is not necessary as long as the paper can be folded with a high accuracy.

FIG. 130 is a view of a mechanism of a manufacturing device configured to manufacture the special paper 11*b* without folding. As illustrated in FIG. 130, multiple rolls of toilet paper 11 are rotatably provided. In a state in which the multiple rolls of toilet paper 11 are stacked on each other in the upper-to-lower direction, the toilet paper 11 is supplied to a pressure bonding unit 52 from each roll of toilet paper 11. The pressure bonding unit 52 is a device such as embossing rollers, and upper and lower rollers are provided with raised and recessed portions. In this example, the rollers of the pressure bonding unit 52 are provided with the raised and recessed portions so that the pieces of toilet paper 11 are, at predetermined intervals, pressure-bonded together at ends in a longitudinal direction of the toilet paper 11 and ends in a direction perpendicular to the longitudinal direction. With this structure, as indicated by a reference numeral 11*h* in FIG. 130, the pressure-bonded toilet paper 11*h* is delivered from the pressure bonding unit 52. Subsequently, a cutter 53*a* is actuated up and down at certain intervals in a cutting unit 53, thereby cutting the pressure-bonded toilet paper 11*h* at predetermined intervals. Thus, the special paper 11*b* is discharged from the cutting unit 53. Note that the cutting unit 53 may be configured to punch out the toilet paper 11*h* into a rectangular shape as in the Thomson die. Note that the pressing machine for fitting in the upper-to-lower direction may be used as the pressure bonding unit 52, and in this case, paper feeding rollers may be provided before the pressing machine.

FIG. 131 is a view of another mechanism of the manufacturing device configured to manufacture the special paper 11*b* without folding. As illustrated in FIG. 131, multiple rolls of toilet paper 11 are rotatably provided. In a state in which the multiple rolls of toilet paper 11 are stacked on each other in the upper-to-lower direction, the toilet paper 11 is supplied to upper and lower rollers 52*a* from each roll of toilet paper 11. The toilet paper 11 delivered from the upper and lower rollers 52*a* is supplied to a bonding unit 52*b* provided right after the upper and lower rollers 52*a*. The bonding unit 52*b* is a gun configured to inject a water-soluble adhesive. The bonding unit 52*b* can drop the water-soluble adhesive onto the ends of the toilet paper 11 in the longitudinal direction thereof, thereby sealing the toilet paper 11. Note that the bonding unit 52*b* is not necessarily provided right after the upper and lower rollers 52*a*, but may be provided before the upper and lower rollers 52*a*. The bonding unit 52*b* can apply, at predetermined intervals, the adhesive in the direction perpendicular to the longitudinal direction. In this manner, the bonded toilet paper 11*i* is delivered, and then, is delivered into the cutting unit 53. The cutting unit 53 cuts the toilet paper 11*i* as in FIG. 130, and then, discharges the special paper 11*b*.

Note that each piece of toilet paper may be cut to a predetermined size in advance, and a stack of multiple pieces of cut toilet paper are joined together by, e.g., pressure bonding. In this manner, the special paper 11*b* may be manufactured. In this case, e.g., a cutting structure using the Thomson die may be provided for the purpose of further cutting off end portions for reshaping after bonding.

(First Aspect of Embodiment for Portable Toilet)

A first aspect of the embodiment for the portable toilet 31 with the wiping function will be described with reference to FIGS. 132A, 132B, 132C, 133, and 134. FIG. 132A is a plan view of an internal structure of the portable toilet 31. FIG. 132B is a block diagram of a functional configuration of the buttocks wiping device 1 used for the portable toilet 31. FIG. 132C is a flowchart of operation of the buttocks wiping device 1. FIG. 133 is a front view of the internal structure of the portable toilet 31. FIG. 134 is a right side view of the internal structure of the portable toilet 31. FIG. 132A illustrates the case of the wiping arm 4 at a retracted position and the case of the wiping arm 4 at an exposed position. FIG. 133 illustrates the lowermost position and the uppermost position when the wiping arm 4 is at the exposed position. In FIG. 134, the wiping arm 4 is at the exposed position.

In FIG. 132A, the pressing unit 4*a* is rotatably attached to a T-shaped member provided at a tip end of the wiping arm 4, and therefore, is held horizontal. Note that the mechanism configured to use the negative pressure to suck the special paper 11*b* or the mechanism configured to use the positive pressure to drop the special paper 11*b* may be provided at the pressing unit 4*a*.

In FIG. 132A, a paper loading table 205*k* is configured such that a portion corresponding to the pressing unit 4*a* is hollowed out. An upper portion of the pressing unit 4*a* is slightly exposed through such a hollow-out portion. The special paper 11*b* supplied from a paper supply unit 205 illustrated in FIG. 134 is placed on the portion of the pressing unit 4*a* slightly exposed through the hollow-out portion of the paper loading table 205*k*.

With the structure using the exposure motor 9, the bevel gears 27*a*. 27*b*, and the center shaft 27*g*, the wiping arm 4 can be exposed by angular movement, and can be moved up and down by the upper-to-lower motor 8. Detailed operation by the upper-to-lower motor 8 and the exposure motor 9 is similar to that by the mechanism illustrated in FIG. 113. Note that the mechanism including the upper-to-lower motor 8 and the exposure motor 9 may be replaced with other mechanisms described in the present specification.

The present embodiment is characterized by operation of the paper supply unit 205. Thus, operation of the paper supply unit 205 will be described below with reference to FIGS. 132B, 132C, 133, and 134.

As illustrated in FIG. 134, the paper supply unit 205 includes a ball screw motor 205*m*, a ball screw 205*a* coupled to a rotary shaft of the ball screw motor 205*m*, a paper stocker 205*b*, a paper feeding motor 205*c*, a pulley 205*d* coupled to a rotary shaft of the paper feeding motor 205*c*, a paper feeding roller 205*e*, a pulley 205*o*, a belt 205*j* configured to transmit rotation of the pulley 205*d* to the paper feeding roller 205*e* through the pulley 205*o*, a free roller 205*f*, a paper feeding drive roller 205*g* coupled to a rotary shaft of a not-shown motor, a paper feeding roller 205*h*, a slide 205*i*, and the paper loading table 205*k*. A paper loading table detection unit 206*a* configured to detect whether or not the paper is placed is provided on the paper loading table 205*k*. A plate on which the special paper 11*b* is placed is provided on the ball screw 205*a*, and a paper remaining amount detection unit 206*b* configured to detect whether or not the special paper 11*b* is placed on the plate is provided. A paper feeding detection unit 206*c* configured to detect the presence or absence of the special paper 11*b* is provided before the paper feeding drive roller 205*g*.

The user places a stack of multiple pieces of special paper 11*b* in the paper stocker 205*b*. The paper stocker 205*b* can be refilled with the special paper 11*b* from the side by a drawable portion 205*p*. FIG. 133 illustrates a state when the drawable portion 205*p* is drawn. The operation unit 35 instructs wiping (S100). When completion of warm-water cleansing is detected (S101), the control unit 13 determines, using the paper remaining amount detection unit 206*b*, whether or not the special paper 11*b* remains (S700). Only in a case where the special paper 11*b* remains, the processing proceeds to subsequent operation. In a case where the special paper 11*b* does not remain, the control unit 13 notifies the user of, e.g., a message or sound for prompting the user to perform paper refilling.

Subsequently, the control unit 13 rotates the ball screw motor 205*m* such that the ball screw 205*a* is moved upward by a single piece of paper (S701). The control unit 13 recognizes such a rotation amount from a signal from a motor detection unit 205*l*. Thus, the uppermost special paper 11*b* comes into contact with the free roller 205*f* and the paper feeding roller 205*e*. In this state, the control unit 13 rotates the paper feeding motor 205*c* (S702). When the paper feeding motor 205*c* rotates, rotation force is transmitted to the paper feeding roller 205*e* through the pulley 205*d* and the belt 205*j*. Then, only the uppermost piece of special paper 11*b* is delivered.

The delivered piece of special paper 11*b* is inserted between the paper feeding drive roller 205*g* and the paper feeding roller 205*h*. The control unit 13 detects, using the paper feeding detection unit 206*c*, that the special paper 11*b* is delivered to the paper feeding drive roller 205*g* (S703). Then, the control unit 13 continuously drives the paper feeding motor 205*c* until the paper feeding detection unit 206*c* no longer detects the special paper 11*b* (S703). Meanwhile, the control unit 13 also rotates the paper feeding drive roller 205*g*, thereby delivering the special paper 11*b* onto the slide 205*i*. The special paper 11*b* slides down the slide 205*i*, and then, is placed on the paper loading table 205*k*. Then, the paper loading table detection unit 206*a* (or the paper loading detection sensor 12*e* provided at the pressing unit 4*a*) detects that the paper has been placed on the pressing unit 4*a* (S704). In this manner, preparation for the wiping operation is completed. Thus, the control unit 13 exposes the wiping arm 4, and then, executes wiping of the buttocks by upper-to-lower movement of the wiping arm 4. After wiping, the paper is discarded, and the control unit 13 executes the operation of returning the wiping arm 4 to the original retracted position (S705).

As described above, in the present embodiment, the portable toilet 31 can be provided, which utilizes friction force or the shape of the pressing unit of the wiping arm and utilizes the first technique of wiping the buttocks by movement of the wiping arm with the paper being placed on the pressing unit.

Note that in the present embodiment, the base portion of the wiping arm 4 serves as the nested extendable portion 29*b*, and the rotary shaft of the upper-to-lower motor 8 and a base portion of the extendable portion 29*b* are coupled together through the link mechanism 27*e*. The detailed structure of the link mechanism is similar to that of FIG. 115. Thus, the extendable portion 29*b* extends/contracts in association with rotation of the rotary shaft of the upper-to-lower motor 8, and therefore, the top position of the pressing unit 4*a* moves straight up and down without shifting right to left.

Note that the structure of the paper supply unit 205 as described in the present embodiment can be, needless to say, also used for other ordinary toilets than the portable toilet.

(Second Aspect of Embodiment for Portable Toilet)

In the first aspect of the embodiment for the portable toilet, the first technique is used. A second aspect of the embodiment for the portable toilet when the second technique using the paper loading guide is used will be described below. FIG. 135A is a plan view of the internal structure of the buttocks wiping device 1 at the portable toilet 31. In FIG. 135A, a position when the paper loading guide 17*c* and the wiping arm 4 are exposed is indicated by a solid line, and a position when the wiping arm 4 is retracted is indicated by a dashed line. FIG. 135B is a block diagram of the functional configuration of the buttocks wiping device 1. FIG. 135C is a flowchart of operation of the buttocks wiping device 1. FIG. 136 is a front view of the internal structure of the buttocks wiping device 1. FIG. 136 illustrates transition upon upper-to-lower movement of the wiping arm 4. FIG. 137 is a perspective view of the structure including the wiping arm drive unit 3 and the wiping arm 4. FIG. 138 is a front view of movement transition of the wiping arm 4 at a link mechanism of the wiping arm drive unit 3. FIG. 139 is a left side view of an internal structure of the paper supply unit 17. FIG. 140 is a plan view of the internal structure of the paper supply unit 17 when the paper loading guide 17*c* is retracted. The functions, structure, and operation of the buttocks wiping device 1 will be described below with reference to FIGS. 135 to 140.

First, the structure and operation of the paper supply unit 17 will be described. A motor frame 70, movable frames 70*a*, 70*b*, and movable beams 70*c*. 70*d* form an entire frame of the paper supply unit 17. A paper supply motor 17*e* and a coupling 17*f* are fixed to the motor frame 70. The movable beams 70*c*, 70*d* fix the movable frames 70*a*, 70*b* such that the movable frames 70*a*. 70*b* face each other. A rotary shaft (hereinafter referred to as a "lower rotary shaft") 73*e* and a rotary shaft (hereinafter referred to as an "upper rotary shaft") 74*e* are rotatably attached to the movable frames 70*a*, 70*b*. The lower rotary shaft 73*e* is coupled to a rotary shaft of the paper supply motor 17*e* through the coupling 17*f*. A pulley (hereinafter referred to as a "lower pulley") 73*f* is attached to one end of the lower rotary shaft 73*e*. Pinions (hereinafter referred to as "lower pinions") 73*c*, 73*d* are attached respectively to both ends of the lower rotary shaft 73*e*. With this structure, when the lower rotary shaft 73*e* rotates, the lower pulley 73*f*, the lower pinion 73*c*, and the lower pinion 73*d* rotate.

A pulley (hereinafter referred to as an "upper pulley") 74*f* is attached to one end of the upper rotary shaft 74*e*. Pinions (hereinafter referred to as "upper pinions") 74*c*, 74*d* are attached respectively to both ends of the upper rotary shaft 74*e*. A belt 75 extends between the upper pulley 74*f* and the lower pulley 73*f*, and therefore, rotation operation of the lower pulley 73*f* is transmitted to the upper pulley 74*f*. With this structure, when the lower pulley 73*f* rotates, the upper pulley 74*f* rotates. Accordingly, the upper rotary shaft 74*e* rotates, and the upper pinion 74*c* and the upper pinion 74*d* rotate.

Rail portions (hereinafter referred to as "lower rail portions") 71*a*, 71*b* are fixed to the raised portion 2. Moreover, racks (hereinafter referred to as "lower racks") 73*a*. 73*b* are fixed to the raised portion 2 by a fixing table 71*e*. The lower racks 73*a*, 73*b* engage respectively with the lower pinions 73*c*, 73*d*. The lower pinions 73*c*, 73*d* are fixed respectively to sliding tables 71*c*, 71*d*, thereby sliding on the lower rail portions 71*a*, 71*b*.

Rail portions (hereinafter referred to as "upper rail portions") 72*a*, 72*b* are fixed to the movable beams 70*c*, 70*d*. The paper loading guide 17*c* is attached by fixing portions 72*c*, 72*d*, thereby sliding on the upper rail portions 72*a*, 72*b*. Racks (hereinafter referred to as "upper racks") 74*a*, 74*b* are fixed respectively to both sides of the paper loading guide 17*c*. The upper racks 74*a*, 74*b* engage respectively with the upper pinions 74*c*, 74*d*.

When the lower pinions 73*c*. 73*d* are rotated by rotation of the paper supply motor 17*e*, the lower pinions 73*c*, 73*d* move along the lower rail portions 71*a*, 71*b* while engaging respectively with the lower racks 73*a*, 73*b*. Thus, in association with movement of the lower pinions 73*c*, 73*d*, the entire frame including the motor frame 70, the movable frames 70*a*, 70*b*, and the movable beams 70*c*, 70*d* moves together with the exposure motor 17*e*, the coupling 17*f*, the lower pulley 73*f*, the belt 75, the upper pulley 74*f*, the sliding tables 71*c*, 71*d*, the lower pinions 73*c*, 73*d*, the lower rotary shaft 73*e*, the upper pinions 74*c*, 74*d*, the upper rail portions 72*a*. 72*d*, the upper racks 74*a*. 74*b*, the upper rotary shaft 74*e*, the fixing portions 72*c*. 72*d*, the paper loading guide 17*c*, etc.

Further, when the paper supply motor 17*e* rotates, rotation is transmitted by the belt 75. Then, when the pulley 74*f* rotates, the upper pinions 74*c*. 74*d* rotate. Since the upper pinions 74*c*, 74*d* engage respectively with the upper racks 74*a*, 74*b*, the upper racks 74*a*, 74*b* move along the upper rail portions 72*a*, 72*d* upon rotation of the upper pinions 74*c*, 74*d*. With such a structure, the paper loading guide 17*c* in the state of FIG. 140 upon retraction is exposed through the toilet bowl upon exposure as illustrated in FIGS. 135 and 136. In such a manner that the paper loading guide 17*c* is moved while the entire frame is moving, the paper loading guide 17*c* is retracted within a size corresponding to about the front-to-back width of the paper loading guide 17*c* upon retraction illustrated in FIG. 140, whereas the paper loading guide 17*c* can be exposed to a distance corresponding to equal to or greater than the front-to-back width of the paper loading guide 17*c* upon exposure illustrated in FIGS. 135A and 136. In the case of the portable toilet, the width of the toilet bowl is larger or the size of the bucket in the toilet bowl portion is larger as compared to that of a typical toilet, and for this reason, the movement distance of the paper loading guide 17*c* needs to be longer. Thus, according to the present embodiment, the paper loading guide is retracted/exposed so that paper feeding by the paper loading guide 17*c* can be performed in the portable toilet.

The summary of the mechanism of the paper supply unit 17 used herein is as follows. The paper supply unit 17 has, as a first movement mechanism for the paper loading guide 17*c*, the upper racks 74*a*, 74*b* and the upper pinions 74*c*, 74*d*. The paper supply unit 17 has, as a second movement mechanism configured to move the first movement mechanism itself, the lower pinions 73, 73*d* fixed to the raised portion 2 and the lower racks 73*a*. 73*b* configured to move together with the first movement mechanism. The first mechanism has the paper supply motor 17*e* using the upper racks 74*a*. 74*b* and the upper pinions 74*c*, 74*d* to move the paper loading guide 17*c*. The paper supply motor 17*e* is coupled to the upper pinions 74*c*, 74*d* such that rotation movement thereof is transmitted to the second movement mechanism, and the first movement mechanism moves in association with rotation movement of the paper supply motor 17*e*.

That is, the paper supply unit 17 includes the first movement mechanism configured to move the paper loading guide 17*c*, and the second movement mechanism configured to move the first movement mechanism itself. Moreover, the first movement mechanism is configured to move the paper loading guide 17*c* by the rack-and-pinion mechanism. The second movement mechanism is configured to move the first movement mechanism by the rack-and-pinion mechanism. The first movement mechanism includes the paper supply motor 17*e* for driving the rack-and-pinion mechanism. The second movement mechanism moves the first movement mechanism by the rack-and-pinion mechanism in association with rotation movement of the paper supply motor 17*e*.

Note that the upper rack-and-pinion and the lower rack-and-pinion may be provided in a vertically-symmetrical pattern.

Note that in this example, the user inserts the paper through the paper injection port 17*a*, and places the special paper 11*b* on the paper loading guide 17*c*. However, as in the embodiments described above, the paper supply rollers 17*b* may be used to place the special paper 11*b* on the paper loading guide 17*c*. Needless to say, there are cases where the above-described method for retracting the paper loading guide 17*c* is not necessarily used depending on the width of the toilet bowl. For example, the upper pinions 74*c*. 74*d* may merely engage respectively with the upper racks 74*a*, 74*b* without use of the lower pinions 73*c*. 73*d* and the lower racks 73*a*. 73*b*. Moreover, the paper loading guide 17*c* may be slidably attached to the upper rail portions 72*a*. 72*b* such that the paper loading guide 17*c* fixed to the upper racks 74*a*, 74*b* is exposed by rotation of the upper pinions 74*c*, 74*d* in association with rotation of the paper supply motor 17*e*.

Conversely, the lower pinions 73*c*, 73*d* may merely engage respectively with the lower racks 73*a*, 73*b* without use of the upper pinions 74*c*, 74*d* and the upper racks 74*a*, 74*b*. Moreover, the paper loading guide 17*c* may be fixed to the lower pinions 73*c*, 73*d*, and the paper supply motor 17*e*, the lower pinions 73*c*, 73*d*, and the paper loading guide 17*c* may be moved along the lower rail portions 71*a*. 71*b* in association with rotation of the paper supply motor 17*e*. In this manner, the paper loading guide 17*c* may be exposed.

Next, the structure and operation of the wiping arm drive unit 3 will be described. The wiping arm drive unit 3 includes the exposure motor 9 and the upper-to-lower motor 8. The exposure motor 9 is fixed to the raised portion 2 through an exposure motor fixing portion 93. A worm 91 is attached to the rotary shaft of the exposure motor 9. A worm wheel 92 is rotatably attached to the raised portion 2 and a shaft holding plate 94 to be engaged with the worm 91. The raised portion 2 and the shaft holding plate 94 are fixed by struts 94*a*, 95*b*. When the rotary shaft of the exposure motor 9 rotates, the worm 91 rotates, and accordingly, the worm wheel 92 rotates. A rotary table 81 is attached to a rotary shaft of the worm wheel 92. The rotary table 81 is bent in an L-shape. The upper-to-lower motor 8 and two opposing guide brackets 84 are fixed to the rotary table 81. With this structure, the rotary table 81 rotates, by angular movement, about the rotary shaft of the worm wheel 92 in association with rotation of the worm wheel 92, and the upper-to-lower motor 8 and the guide brackets 84 rotate together.

A link plate 83 is fixed to a motor rotary shaft 82 of the upper-to-lower motor 8. The link plate 83 is provided with first grooves 83*a*. A first free end 86*a* provided at one end of the extendable portion 29*b* is slidably inserted into the first groove 83*a*. The wiping arm 4 is extendably attached to the extendable portion 29*b*. Second grooves 84*a* are horizontally formed at the guide brackets 84, and a third groove 84*b* cut in an upper left diagonal direction is formed in the vicinity of the middle of each second groove 84*a*. Further, a fourth groove 84*c* cut in the upper left diagonal direction is formed at a left end of each second groove 84*a*. The fourth groove 84*c* is longer than the third groove 84*b*. The extendable portion 29*b* is a member with a nested structure at one end of the wiping arm 4. The first free end 86*a* is also inserted into the second, third, and fourth grooves 84*a*, 84*b*, 84*c* formed at the guide bracket 84. A second free end 86*b* is provided at one end of the wiping arm 4 on a side on which the extendable portion 29*b* is inserted. The first free end 86*a* is inserted into the second, third, and fourth grooves 84*a*, 84*b*, 84*c* formed at the guide bracket 84.

The wiping arm drive unit 3 has transmission portions 92*a*, 92*b* for transmitting rotation of the worm wheel 92, such as gears. Rotation of the transmission portions 92*a*, 92*b* is transmitted to a motor detection unit 9*a* so that the motor detection unit 9*a* can detect the number of rotations and the rotating speed of the exposure motor 9. Note that the motor detection unit 9*a* may be separately provided for detecting a current (i.e., a torque) flowing through the exposure motor 9. Moreover, the wiping arm drive unit 3 has a transmission portion 85 for transmitting rotation of the upper-to-lower motor rotary shaft 82, such as a gear. Rotation of the transmission portion 85 is transmitted to a motor detection unit 8*a* so that the motor detection unit 8*a* can detect the number of rotations and the rotating speed of the upper-to-lower motor 8. Note that the motor detection unit 8*a* may be separately provided for detecting a current (i.e., a torque) flowing through the upper-to-lower motor. Note that each motor detection unit may be small so that the motor detection unit can be directly attached to the rotary shaft of the corresponding motor, or may be built in the corresponding motor. Moreover, a pressure sensor attached to the pressing unit 4*a* may be used for torque detection.

The hinge mechanism 29*c* is provided at the other end of the wiping arm 4. Specifically, the hinge mechanism 29*c* is in the T-shape, and is rotatable in the pressing unit 4*a*. The pressing unit 4*a* includes two divided overlapping portions, the pressing unit 4*a* being configured such that an upper half thereof is a raised portion fitting the shape of the anus and that a lower half thereof rotatably attaches the T-shaped hinge mechanism 29*c* with the hinge mechanism 29*c* being interposed between the upper and lower halves. Since the T-shaped hinge mechanism 29*c* are sandwiched between the two overlapping portions including the raised upper half and the lower half, the pressing unit 4*a* is rotatable. The overlapping portions constantly hold the pressing unit 4*a* horizontal even when the wiping arm 4 inclines.

The link mechanism will be described with reference to FIG. 138. Note that force in a direction in which the extendable portion 29*b* contracts is applied to the extendable portion 29*b* by, e.g., a spring in the wiping arm 4. FIG. 138(*k*) illustrates an original position. In this state, the first free end 86*a* is positioned at a right end of the second groove 84*a*. The state of (k) is a state in which the wiping arm 4 is most retracted. Subsequently, the state transitions in the order of (j), (i), (h), (g), (f), (e), (d), (c), and (b) in association with rotation of the upper-to-lower motor 8, and eventually reaches the state of (a). The state of (a) is a state in which the wiping arm 4 is most exposed. Since the force is applied to the extendable portion 29*b* such that the extendable portion 29*b* contracts, the length of the wiping arm 4 itself is kept constant. The mechanism as in FIG. 138 is not necessarily provided. Suppose that a difference in the tip end position of the wiping arm 4 among FIGS. 138(*a*) to 138(*k*) is 40 mm at a maximum. Such a tip end position difference is necessary because of the following reason: in a case where the wiping arm 4 is caught by somewhere in the raised portion 2 upon exposure or retraction of the wiping arm 4, the mechanism as in FIG. 138 is provided to adjust the tip end position in the raised portion 2, and therefore, the wiping arm 4 can be retracted without the wiping arm 4 being caught. As described above, the link mechanism of the present embodiment primarily has the purpose for adjusting the right-to-left position of the pressing unit 4*a*. This link mechanism is implemented in such a manner that the first free end 86*a* slides in the first groove 83*a* and slides in the second groove 84*a*. Note that such a link mechanism is not essential.

Further, the link mechanism of the present embodiment has the second purpose for moving, upon upward movement, the pressing unit 4*a* straight up without right-to-left shifting of the top portion of the pressing unit 4*a*. This will be described with reference to FIG. 136. When the second free end 86*b* reaches the leftmost end in FIG. 138(*a*), the first and second free ends 86*a*, 186*b* can be inserted respectively into the third and fourth grooves 84*b*, 84*c*. In this state, the first free end 86*a* has already reached a lower end of the first groove 83*a*, and therefore, can no longer slide further. Thus, when the upper-to-lower motor 8 further rotates, force greater than the resistive force of contracting the extendable portion 29*b* is applied. Thus, the extendable portion 29*b* extends while the first and second free ends 86*a*, 186*b* slide with these free ends being inserted respectively into the third and fourth grooves 84*b*, 84*c*. Such a state is illustrated in FIG. 136. Since the extendable portion 29*b* extends as illustrated in FIG. 136, the top of the pressing unit 4*a* moves upward without shifting right to left when the wiping arm 4 inclines diagonally upward. As described above, the link mechanism of the present embodiment can implement the mechanism for preventing right-to-left shifting of the top of the pressing unit 4*a*. Note that such a link mechanism is not essential. Specifically, the link mechanism is not necessarily when shifting of the top of the pressing unit 4*a* does not influence the feeling of wiping in relation to the length of the wiping arm 4.

Next, a paper-supply-side opening/closing unit 19*a* and an arm-side opening/closing unit 19*b* will be described. As illustrated in FIG. 136, the paper-supply-side opening/closing unit 19*a* is provided at the opening of the raised portion 2. For example, the paper-supply-side opening/closing unit 19*a* is movable right to left by a not-shown rack-and-pinion and a not-shown motor. As illustrated in FIG. 136, the arm-side opening/closing unit 19*b* has such a mechanism that a lever 96 is slid to the right on the plane of paper by a not-shown motor or a not-shown electromagnetic solenoid, and therefore, the arm-side opening/closing unit 19*b* moves into the raised portion 2. Note that the mechanism of each opening/closing unit is not limited to above.

Next, the flow of operation of the portable toilet 31 will be described. After a wiping instruction (S100), it is checked whether or not cleansing has been completed (S101). Then, the control unit 13 detects, using a paper loading guide sensor 17*i*, whether or not the special paper 11*b* is placed on the paper loading guide 17*c*, and then, keeps the paper loading guide sensor 17*i* in an ON state (S800). ON of the sensor 17*i* is continued until S806 described later. Meanwhile, in a case where the sensor 17*i* detects that the special paper 11*b* is not placed on the paper loading guide 17*c*, such a state indicates that the special paper 11*b* cannot be placed due to some kind of error. Thus, the control unit 13 notifies the user of such a state by, e.g., a sign.

After S800, the control unit 13 actuates the paper-supply-side opening/closing unit 19*a* to open the opening of the raised portion 2 on the side close to the paper supply unit 17 (S801). The control unit 13 uses an opening/closing checking sensor 19*c* to determine whether or not the opening on the side close to the paper supply unit 17 is opened. In a case where the opening is not normally opened, the control unit 13 notifies the user of such a state by, e.g., a sign.

Subsequently, the control unit 13 actuates the paper supply motor 17*e* to expose the paper loading guide 17*c* (S802). In a case where a not-shown detection unit detects the exposed position of the paper loading guide 17*c*, the control unit 13 stops actuation of the paper supply motor 17*e* (S803).

Subsequently, the control unit 13 actuates the arm-side opening/closing unit 19*b* to open the opening of the raised portion 2 on the side close to the wiping arm 4 (S804). The control unit 13 uses an opening/closing checking sensor 19*d* to determine whether or not the opening on the side close to the wiping arm 4 is opened. In a case where the opening is not normally opened, the control unit 13 notifies the user of such a state by, e.g., a sign.

Subsequently, the control unit 13 actuates the exposure motor 9 to expose the wiping arm 4 through a hole of the toilet seat 7 (S805). In a case where the motor detection unit 9*a* detects the exposed position of the wiping arm 4, the control unit 13 stops actuation of the exposure motor 9 (S806).

Subsequently, the control unit 13 actuates the upper-to-lower motor to move the pressing unit 4*a* of the wiping arm 4 upward (S807). In this state, the control unit 13 turns on the paper loading detection sensor 12*e* configured to determine whether or not the special paper 11*b* is placed on the pressing unit 4*a* (S808). The ON state of the paper loading detection sensor 12*e* is continued until S811 for performing paper discharging operation. Meanwhile, if the paper loading detection sensor 12*e* detects that the special paper 11*b* is not placed, such a state indicates that the special paper 11*b* has dropped from the pressing unit 4*a*. Thus, the control unit 13 drives the wiping arm drive unit 3 to return the wiping arm 4 to the retracted position, and notifies the user of such a state by, e.g., a sign.

By operation of S807, the pressing unit 4*a* moves upward, and therefore, the special paper 11*b* comes into contact with the anus. Then, the moisture etc. are wiped by the special paper 11*b*. When upward movement of the pressing unit 4*a* begins, the control unit 13 reversely rotates the paper supply motor 17*e*, thereby performing the operation of returning the paper loading guide 17*c* to the retracted position and closing the paper-supply-side opening/closing unit 19*a* (S809). Subsequently, the control unit 13 drives the wiping arm drive unit 3 to drive the pressing unit 4*a* back and forth or up and down as necessary. In this manner, the wiping operation is executed (S810).

After wiping, the control unit 13 performs the operation of reversely rotating the upper-to-lower motor 8 to process the pressing unit 4*a* and repeatedly performing slight movement of the exposure motor 9 to drop the special paper 11*b* until the paper loading detection sensor 12*e* no longer detects loading of the special paper 11*b*. In this manner, the paper is discharged (S811). After completion of paper discharging, the control unit 13 rotates the upper-to-lower motor 8 and the exposure motor 9 to return the wiping arm 4 to the retracted position, thereby retracting the wiping arm 4. Moreover, the control unit 13 closes the arm-side opening/closing unit 19*b* (S812). Then, the control unit 13 is brought into the standby state for subsequent wiping.

As described above, according to the present embodiment, wiping of the moisture etc. is executed using the second technique of disposing, below the anus, the special paper 11*b* from the paper supply unit 17 and pushing up, using the pressing unit 4*a* of the wiping arm 4, the special paper 11*b* from below by the wiping arm drive unit 3.

(Variation of Method for Supplying Special Paper 11*b*)

In the embodiments described so far, the structure in which when the special paper 11*b* is placed on the paper loading guide 17*c*, the special paper 11*b* manufactured in the rectangular shape in advance is supplied to the paper loading guide 17*c* by the user or the stack of multiple pieces of special paper 11*b* is automatically supplied to the paper loading guide 17*c* has been mainly described. However, the method for supplying the special paper 11*b* is not limited to above.

For example, continuous multiple pieces of special paper 11*b* may be formed in a roll shape, and the rolled special paper 11*b* may be automatically cut to a predetermined length by means of an electric toilet roll structure. Then, the cut special paper 11*b* may be placed on the paper loading guide 17*c*.

Note that the special paper 11*b* has a certain thickness such that water absorbing power is provided to the special paper 11*b*. For this reason, when the multiple pieces of special paper 11*b* are formed in the roll shape, there is a probability that the roll itself becomes thick. This might lead to a difficulty in use. Thus, a technique in which multiple pieces of special paper are folded at a predetermined length and the folded special paper is cut to a predetermined length will be described with reference to FIGS. 141 and 142. FIG. 141 is a view of continuous folded special paper 11*k* formed in such a manner that continuous multiple pieces of special paper are folded. FIG. 142 is a view of an outline structure of an automatic paper supply device upon use of the continuous special paper 11*k*. A folding interval is equal to the length of the special paper 11*b*, for example. The continuous folded special paper 11*k* is, at ends thereof, joined by pressure bonding, bonding, a water-soluble sewing thread, etc., Note that the paper at a cut portion having a predetermined length may be thin. Moreover, when water-soluble paper having a certain thickness is used as the continuous special paper 11*k*, bonding at the ends is not necessary. The continuous special paper 11*k* is folded at regular intervals so that the continuous special paper 11*k* can be housed in a paper stocker portion 96. Even when the continuous paper length is increased, the height of the paper stocker portion 96 may be merely adjusted. As illustrated in FIG. 142, the continuous folded special paper 11*k* is housed in the paper stocker portion 96, and a tip end of the continuous special paper 11*k* is exposed through an opening 96*a*. The exposed continuous special paper 11*k* is placed on the paper loading guide 17*c* through a cutting unit 96*b* with the continuous special paper 11*k* being sandwiched between paper feeding rollers 96*c*. Every time the paper feeding rollers 96*c* rotate by a predetermined length, the continuous special paper 11*k* is cut by the cutting unit 96*b*. Thus, every time cutting is performed, the continuous special paper 11*k* cut to the predetermined length is placed on the paper loading guide 17*c*. Thereafter, the paper loading guide 17*c* is exposed for execution of wiping.

Since the above-described technique of using the continuous special paper 11*k* cut at predetermined intervals and placing such paper 11*k* on the paper loading guide 17*c* is used, it is not necessary to supply the special paper 11*b* one by one. Thus, wiping of the buttocks can be automatically executed even by a user with impairment in a hand.

Note that the automatic paper supply mechanism described herein can be utilized for the first technique. That is, the special paper 11*b* supplied through the cutting unit 96 and the paper feeding rollers 96*c* may be placed on the pressing unit 4*a* instead of being placed on the paper loading guide.

(Embodiment for Arrangement of Wiping Arm Drive Unit Below Warm-Water Cleansing Device)

A structure in which the wiping arm drive unit is disposed below the warm-water cleansing device will be described below. The embodiment using disposable arms 109, 110 for wiping of the buttocks will be described with reference to FIGS. 143 to 151. The disposable arms 109, 110 used herein are tools entirely exhibiting water solubility, the disposable arms 109, 110 being each configured such that a water-soluble water absorbing portion is attached to a rod-shaped water-soluble base material portion. For example, a rod-shaped member around which water-soluble paper is winded in a spiral pattern is used as the base material portion. The water absorbing portion is configured such that toilet paper is winded around a tip end of the base material portion. Alternatively, the above-described disposable pressing unit as illustrated in FIGS. 67 to 71 may be used. Note that use of the term "disposable arm" or "disposable pressing unit" does not essentially relate to the present invention. A portion for gripping the water absorbing portion is necessary for the water absorbing portion as a portion for directly wiping the buttocks. The disposable arm described with reference to FIG. 144 has a rod-shaped gripping portion, whereas the disposable pressing unit described with reference to FIG. 67 has a bent plate-shaped gripping portion. However, the fact remains that the portion for wiping the buttocks is disposable.

FIG. 143 is a block diagram of a function configuration of a buttocks wiping device 100 using the disposable arms 109, 110. FIG. 144(*a*) is a plan view of the buttocks wiping device 100. FIG. 144(*b*) is a right side view of the buttocks wiping device 100. FIG. 144(*c*) is a front view of the buttocks wiping device 100. FIGS. 145(*a*) to 145(*c*) are a plan view, a right side view, and a front view of the buttocks wiping device 100 when moved to a center position. FIGS. 146(*a*) to 146(*c*) are a plan view, a right side view, and a front view of the buttocks wiping device 100 when moved to an exposed position. Note that the disposable arms 109, 110 used herein are set forth merely as an example. Tools with any other structures may be used as long as these tools are disposable tip end tools for wiping moisture.

As illustrated in FIG. 144, the buttocks wiping device 100 is provided below a warm-water cleansing device 113 and a toilet seat 114. A toilet bowl (not shown) is provided below the buttocks wiping device 100. A wiping arm drive unit 118 is disposed below the warm-water cleansing device 113, and therefore, the buttocks wiping device 100 can be effectively disposed. Consequently, the entire size of the buttocks wiping device 100 can be downsized. Moreover, a holding pressing unit 108 for holding the disposable arm 109 is not exposed, and therefore, can be held in a sanitary manner.

The buttocks wiping device 100 includes an operation unit 117, a control unit 119, a cover unit 116, an imaging unit 115, the wiping arm drive unit 118, and a disposable arm supply unit 112. The disposable arm 109 is an arm for wiping, and therefore, can be regarded as a wiping arm. The wiping arm drive unit 118 is a device for moving the disposable arm 109. Thus, the drive unit 118 can be referred to as the "wiping arm drive unit 118."

The operation unit 117 is an input device configured for user's instruction for wiping. The control unit 119 is a device for controlling operation of the buttocks wiping device 100. The cover unit 116 is a device for covering a clearance generated between the toilet bowl and the toilet seat 114, thereby preventing moisture from entering the buttocks wiping device 100. As in FIG. 148 described later, the cover unit 116 may be a device configured to move up and down, or may be a device configured to open in the right-to-left direction. A specific structure of the cover unit 116 is not intended to limit the present invention.

The imaging unit 115 is disposed at such a position that an image of the vicinity of the anus can be acquired. The control unit 119 is configured to determine a moisture adhering region based on the image acquired by the imaging unit 115, thereby controlling the wiping arm drive unit 118 such that the disposable arm contacts such a region. Moreover, the control unit 119 can determine whether or not dirt adheres to the buttocks, and when adhered, can cause the warm-water cleansing device 113 to execute cleansing before wiping of the buttocks. Needless to say, the imaging unit 115 is waterproofed.

The wiping arm drive unit 118 includes right-to-left rails 102, a right-to-left rail drive motor 103, a front-to-back rail drive motor 104, front-to-back rails 105, an upper-to-lower motor 106, a holding unit 107, and the holding pressing unit 108.

The right-to-left rails 102 are attached to a lower portion of the warm-water cleansing device 113. As illustrated in FIG. 144(*c*), the right-to-left rails 102 are attached on a ceiling side of a member (hereinafter referred to as a "housing portion") configured to house the wiping arm drive unit 118. Note that as illustrated in FIG. 147, the right-to-left rails 102 may be attached to a bottom surface of the housing portion. By rotation of the right-to-left rail drive motor 103, the right-to-left rails 102 can move, right to left, a member placed on the rails.

The front-to-back rails 105 are placed respectively on the right-to-left rails 102. By rotation of the front-to-back rail drive motor 104, the front-to-back rails 105 can move, back and forth, a member placed on the rails.

The upper-to-lower motor 106 is placed on the front-to-back rails. The holding unit 107 is attached to the upper-to-lower motor 106. By rotation of the upper-to-lower motor 106, the holding unit 107 can move up and down about a rotation axis thereof.

The holding unit 107 may be a parallel hand or a fulcrum hand, but is not specifically limited. The holding unit 107 allows the holding pressing unit 108 to hold a base material portion of the disposable arm 109, the holding pressing unit 108 having been processed into a shape easily holding the base material portion. With such a mechanism, the disposable arm 109 can be moved right to left, back and forth, and up and down.

Note that the rail, the motor, and the hand have been described herein as the specific mechanism for moving the disposable arm 109, but have been set forth merely as an example. As long as the mechanism can perform right-to-left, front-to-back, and upper-to-lower movement and holding, such a mechanism is not limited to the motor, the rail, and the hand. That is, the wiping arm drive unit 118 may only include a right-to-left drive unit for moving the disposable arm right to left, a front-to-back drive unit for moving the disposable arm back and forth, an upper-to-lower drive unit for moving the disposable arm up and down, and a holding unit for holding the disposable arm. Moreover, the front-to-back drive unit is provided for improvement of the feeling of wiping, but is not essential in the case of not performing front-to-back wiping.

As illustrated in FIG. 144(*c*), standby disposable arms 110 are vertically stacked on each other in the disposable arm supply unit 112. For example, an elongated box-shaped member configured to vertically stack the disposable arms 110 on each other may be used as the structure for stacking, and a member for hooking the base material portion may be disposed at intervals of the base material portions such that each base material portion does not incline. Moreover, other structures can be employed, and the present invention is not specifically limited to above. For downsizing, the structure described herein is made, in which the disposable arm supply unit 112 has, at a bottom surface thereof, a diagonally-inclined portion and the disposable arm 109 for wiping is automatically moved. Note that the disposable arm supply unit 112 may have such a structure that the holding pressing unit 108 holds and pulls out the base material portion one by one.

As illustrated in FIG. 144, the disposable arm 109 is first gripped. After gripping, the disposable arm 109 is moved to the left by the right-to-left rails 102 as illustrated in FIG. 145. Note that the disposable arm 109 moves, needless to say, to the right in the case of having a horizontally-symmetrical structure. In this example, the cover unit 116 is opened such that the disposable arm 109 moves to a center portion of a hole of the toilet bowl through the clearance between the toilet bowl and the toilet seat. At this point of time, the disposable arm 109 is positioned below the toilet bowl, and therefore, the disposable arm 109 does not contact the buttocks.

Subsequently, the upper-to-lower motor 106 is driven to move the disposable arm 109 upward as illustrated in FIG. 146. As illustrated in FIG. 146(*b*), a tip end of the disposable arm 109 is exposed through the toilet seat 114. At such a position, the buttocks are wiped. Note that for effectively wiping moisture, the buttocks are carefully wiped without any damages by the wiping operation using image recognition processing of FIGS. 150 and 151 as described later. In the state illustrated in FIG. 146, careful wiping is realized by upper-to-lower, front-to-back, and right-to-left slight movement.

FIG. 147 is a front view when the right-to-left rails 102 are arranged on the bottom surface of the housing portion. Each member may be only disposed in the vertically-symmetrical pattern, and therefore, it is not necessary to describe arrangement of other members in detail. As described above, the right-to-left rails 102 may be provided below the warm-water cleansing device 113.

The disposable arm supply unit 112 is disposed on the right when facing the toilet bowl in FIGS. 144 and 147, but may be, needless to say, disposed on the left. In this case, each member may be disposed in a horizontally-symmetrical pattern.

FIG. 148 is a perspective view of an internal structure of the buttocks wiping device 100 in a case where the disposable arm supply unit 112 is disposed on the left. For the sake of clarifying the gripping state of the disposable arm 109, the housing portion of the wiping arm drive unit 118 is, in FIG. 148, illustrated with part of the housing portion being cut away. The wiping arm drive unit 118 is housed in the housing portion while the disposable arm 109 gripped by the holding unit 107 is exposed for wiping of the buttocks. After wiping, the holding unit 107 releases the gripped disposable arm 109, thereby naturally dropping the disposable arm 109. No moisture adheres to the holding unit 107 upon wiping, and it is almost not considered that the holding pressing unit 108 gets dirty due to accidental defecation and urination after wiping. Moreover, the disposable arm supply unit 112 is also kept clean. Thus, the buttocks wiping device held in a sanitary manner while executing wiping of the buttocks can be provided.

FIG. 149 is a flowchart of operation of the buttocks wiping device 100. Operation of the buttocks wiping device 100 will be reviewed below with reference to FIG. 149. First, the control unit 119 moves and opens the cover unit 116 (step S900). Subsequently, the control unit 119 causes the imaging unit 115 to acquire the image of the vicinity of the anus, thereby determining whether or not feces are adhered (step S901). When the feces are adhered, the control unit 119 closes the cover unit 116, and causes the warm-water cleansing device to perform cleansing. When the feces are not adhered, the holding unit 107 is driven according to an instruction from the control unit 119 such that the disposable arm 109 is gripped by the holding pressing unit 108 (step S901). In this state, the right-to-left rail drive motor 103, the front-to-back rail drive motor 104, and the upper-to-lower motor 106 may be driven to move the holding pressing unit 108 to a proper position.

Subsequently, the holding unit 107 uses the holding pressing unit 108 to hold one end of the base material portion of the disposable arm 109 (step 902). Subsequently, the right-to-left rail drive motor 103 moves the front-to-back rails 105 etc. to the left (the right in the case of the horizontally-symmetrical structure) on the right-to-left rails 102 (step S903). After movement to the center portion, the front-to-back rail drive motor 104 moves the upper-to-lower motor 106 etc. in the forward direction on the front-to-back rails 105 (step S904). Note that FIG. 148 illustrates an example where the upper-to-lower motor 106 is coupled to the front-to-back rails 105 through a coupling portion 106*a*.

After forward movement to a predetermined position, the upper-to-lower motor 106 moves the holding unit 107 to the upward direction (step S905). In this state, when the disposable arm 109 moves suddenly, e.g., the vicinity of the anus is damaged. For this reason, the disposable arm 109 may be moved slowly. When moved to the predetermined position, the disposable arm 109 comes into contact with the buttocks, and therefore, wiping can be performed.

At this point of time, the right-to-left rail drive motor 103, the front-to-back rail drive motor 104, and the upper-to-lower motor 106 cooperate with each other while the disposable arm 109 slightly moves up and down, back and forth, and right to left. In this manner, moisture is wiped (step S906). Although operation at the step S906 will be described later in detail with reference to FIG. 151, the control unit 119 controls the wiping arm drive unit 118 such that predetermined operation is performed in the case of not using the imaging unit 115.

Upon completion of wiping, the control unit 119 controls the holding unit 107 such that the disposable arm 109 gripped by the holding pressing unit 108 is released (step S907). This allows the disposable arm 109 to naturally drop. Subsequently, the control unit 119 instructs, e.g., each motor of the wiping arm drive unit 118 to return to an initial standby state, thereby returning each motor to the standby state (step S908). The standby state is a state at such a position that a subsequent disposable arm 109 can be held immediately, for example. Finally, the control unit 119 moves and closes the cover unit 116 (step S909).

FIG. 150 is a schematic view of an image of the buttocks acquired by the imaging unit 115. In FIG. 150, a black point indicates a water droplet, and a cross mark indicates the vicinity of the anus. Moreover, there are four black points above the anus, but these points indicate urine in the vicinity of the female urethra. The control unit recognizes water droplet (including urine) adhering locations based on the image acquired by the imaging unit 115. Because of an individual difference in the size of the buttocks, a location contacting the disposable arm 109 varies among individuals. However, from the image, it can be determined whether water droplets are present more in the right direction, the left direction, the forward direction, or the backward direction. Moreover, from the image, it can be also determined whether or not cleansing by the warm-water cleansing device is insufficient due to remaining adhered feces. This is because the shade of color of water droplet is different from that of feces. In this manner, the control unit can determine the water droplet adhering position and the presence or absence of adhered feces.

FIG. 151 is a flowchart of detailed operation at the step S906 of FIG. 149. First, the imaging unit 115 acquires the image of the buttocks (step S1001). Subsequently, the control unit 119 recognizes the water droplet position (step S1002). When water droplets are present more in the forward direction (or the backward direction), the control unit 119 controls the wiping arm drive unit 118 such that the disposable arm 109 moves in the forward direction (or the backward direction). When water droplets are present more in the left direction (or the right direction), the control unit 119 controls the wiping arm drive unit 118 such that the disposable arm 109 moves to the left (or the right). Thus, the wiping arm drive unit 118 slightly moves the disposable arm 109 back and forth, up and down, and right to left, thereby wiping moisture (step S1003).

Operation for wiping may be patterned according to the water droplet position, and the control unit 119 may control the wiping arm drive unit 118 based on the stored patterns. Specifically, the control unit 119 stores the patterns for wiping operation according to the water droplet position. The wiping operation is an operation pattern for the degree of front-to-back, right-to-left, and upper-to-lower movement. The control unit 119 determines a stored pattern closest to a recognized pattern, and causes the wiping arm drive unit 118 to execute the wiping operation in the closest pattern. For example, a method may be employed, in which determination is made in advance such that driving is made in an A pattern in a case where moisture is present more at the front and that driving is made in a B pattern in a case where moisture is present more in the right direction. Note that on a case-by-case basis, the control unit 119 may calculate a position relationship to move the disposable arm 109 to a proper position. Considering the case of utilization by a female, the control unit 119 first causes, in a case where a female mode has been selected, the disposable arm 109 to gently contact the vicinity of the urethra, and then, causes the disposable arm 109 to wipe water droplets in the vicinity of the anus. Note that wiping can be performed without use of the imaging unit 115. In the case of not using the imaging unit 115, the control unit 119 may control operation such that the wiping arm drive unit 118 moves as determined in advance. Note that the image acquired by the imaging unit 115 cannot be output to the outside, considering protection of privacy.

At the step S1003, when initially-scheduled wiping is completed, the control unit 119 again recognizes the image acquired by the imaging unit 115, and determines whether or not water droplets are no longer present (step S1004). In a case where the water droplets are still present, the processing returns to operation of S1003 again, thereby executing wiping. In a case where the water droplets are no longer present, the control unit 119 proceeds to the operation of releasing the gripped disposable arm 109.

Note that the mechanism for disposing the drive unit below the warm-water cleansing device as illustrated in FIGS. 143 to 148 is also applicable to other buttocks wiping devices employing the first and second techniques than the tip end tool for wiping moisture. FIG. 152 is a block diagram of a functional configuration of a buttocks wiping device 120 using a wiping arm. FIG. 153 is a perspective view of an internal structure of the buttocks wiping device 120. The same reference numerals as those of FIGS. 143 and 148 are used to represent elements with similar functions in FIGS. 152 and 153, and description thereof will not be described.

The buttocks wiping device 120 of the type using the wiping arm includes a wiping arm drive unit 118*a* for driving the wiping arm 4, a control unit 119*a* configured to control the wiping arm drive unit 118*a*, a paper supply unit 123, and the wiping arm 4. The wiping arm drive unit 118*a* can move the wiping arm 4 right to left, back and forth, and up and down according to an instruction from the control unit 119*a*. The paper supply unit 123 is a device configured to fold rolled toilet paper 125 and cut the toilet paper 125 by a cutting unit 124 while delivering the toilet paper 125, thereby placing the cut toilet paper on a pressing unit 4*a* at a tip end of the wiping arm 4. Note that the paper may be manually placed on the pressing unit 4*a*, and in this case, the paper supply unit 123 is not necessary.

As illustrated in FIG. 153, the wiping arm drive unit 118*a* is provided below a warm-water cleansing device. Upon wiping, the paper is placed on the pressing unit 4*a* by the paper supply unit 123, and a cover unit 116 is opened such that the wiping arm 4 is exposed between a toilet seat and a toilet bowl with the paper being attached. Note that FIG. 153 illustrates a state in which no paper is attached.

After exposure, the wiping arm drive unit 118*a* moves the wiping arm 4 back and forth, up and down, and right to left, thereby wiping the buttocks. In this state, the control unit 11*a* controls operation of the wiping arm drive unit 11*a* based on an image from an imaging unit 115, thereby carefully wiping moisture on the buttocks. Upon completion of wiping, the paper is dropped from the pressing unit 4*a*. In this manner, wiping is completed, and the wiping arm 4 returns to a standby position.

As described above, part or entirety of the wiping arm drive unit is disposed below the warm-water cleansing device, and therefore, downsizing of an entire size can be expected.

Another Embodiment for Second Technique: Thirteenth Embodiment

Next, another embodiment (a thirteenth embodiment) in the case of using the second technique will be described. The embodiment described herein relates to a buttocks wiping device configured such that part or entirety of a mechanism of a wiping arm drive unit 3 is disposed below a warm-water cleansing device and the buttocks can be wiped from the back.

FIG. 154 is a perspective view of the buttocks wiping device 1. FIG. 154 illustrates a raised portion 2 disposed below the warm-water cleansing device 15, the wiping arm drive unit 3 is housed in an arm-side housing portion 200 provided at the raised portion 2, and a paper supply unit 17 is housed in a paper-supply-side housing portion 201. In FIG. 154, an arm-side opening/closing unit 19*b* for opening/closing the arm-side housing portion 200 and a paper-supply-side opening/closing unit 19*a* configured to open/close the paper-supply-side housing portion 201 are not shown, but these housing portions can be opened/closed. The paper supply unit 17 has any of the structures described so far. The present embodiment is characterized by the structure of the wiping arm drive unit 3, and therefore, the wiping arm drive unit 3 will be described below in detail.

FIG. 155 is a perspective view of the paper supply unit 17 and the wiping arm drive unit 3 housed in the raised portion 2. FIG. 155 illustrates a state at an original position before wiping. The wiping arm drive unit 3 includes the wiping arm 4, a screw shaft 202, a rotary shaft 203, an exposure/upper-to-lower motor 204, a movable portion 606, a pulley 606*a*, an electromagnetic clutch 606*b* with a pulley, an electromagnetic clutch 606*c* with a pulley, a belt 207, and a rotatable portion (may be referred to as a "swingable portion," but referred to as a "rotatable portion" for the sake of legibility) 208. The wiping arm 4 has a pressing unit 4*a*. In the wiping arm 4, at least the pressing unit 4*a* is made of a flexible material. When the pressing unit 4*a* contacts the buttocks, the pressing unit 4*a* bends. Alternatively, an arm shaft portion of the wiping arm 4 may exhibit flexibility to bend upon contact.

The movable portion 606 is provided with a screw hole, and the screw shaft 202 penetrates the screw hole. For example, the screw hole may include balls such that the screw hole and the screw shaft 202 form a ball screw, but the present invention is not limited to above. Although not shown in the figure, the side of the screw shaft 202 close to the exposure/upper-to-lower motor 204 is attached to, e.g., a not-shown bearing coupled to the raised portion 2, and one end of the screw shaft 202 on the opposite side is rotatably attached to the raised portion 2 through, e.g., a bearing. The screw shaft 202 is attached to the electromagnetic clutch 606*b* with the pulley. A structure is made, in which when the electromagnetic clutch 606*b* with the pulley rotates, the screw shaft 202 rotates, and accordingly, the movable portion 606 slides. Note that as illustrated in FIG. 178 described later, a sliding rod 310 may penetrate the movable portion 606. The sliding rod 310 allows the movable portion 606 to slide without rattling. Note that the mechanism for sliding the movable portion 606 has been set forth merely as an example, and various well-known mechanisms may be used to slide the movable portion 606.

The movable portion 606 is in a U-shape, and a recessed portion of the U-shape includes the rotatable portion 208. The movable portion 606 and the rotatable portion 208 are provided with holes so that the rotary shaft 203 can penetrate the holes. The side of the rotary shaft 203 close to the exposure/upper-to-lower motor 204 is attached to, e.g., a not-shown bearing coupled to the raised portion 2, and one end of the rotary shaft 203 opposite to the exposure/upper-to-lower motor 204 is rotatably attached to the raised portion 2 through. e.g., a bearing. For the sake of easy understanding of the figure, the rotary shaft 203 is in a semi-cylindrical shape in this example, but may be in an elliptic cylindrical shape or a polygonal columnar shape. Moreover, a spline shaft (spline jiku in Japanese) or a ball spline is applicable as a mechanical element of the rotary shaft 203. The spline shaft is, e.g., a sliding shaft having a gear-shaped cross section or a sliding shaft having a cross section with a cutout. A bearing (a spline bearing, a spline nut) used for the spline shaft has, on the inside thereof, a raised portion formed in a gear shape to engage with the spline shaft or engage with the cutout. Thus, when the spline shaft rotates, the bearing also rotates. The wiping arm 4 may be fixed to the bearing. The ball spline is a bearing for a ball spline including balls and a sliding shaft having a cross section with a cutout. The wiping arm 4 may be fixed to the bearing of the ball spline. Note that it is not essential whether or not the balls are included.

The hole formed at the movable portion 606 for penetration of the rotary shaft 203 is in a cylindrical shape. In contrast, the hole formed at the rotatable portion 208 for penetration of the rotary shaft 203 is the same semi-cylindrical shape as that of the rotary shaft 203. Note that when the rotary shaft 203 is in the elliptic cylindrical shape, the hole formed at the rotatable portion 208 for penetration of the rotary shaft 203 is also in the elliptic cylindrical shape. When the rotary shaft 203 is in the polygonal columnar shape, the hole formed at the rotatable portion 208 for penetration of the rotary shaft 203 is also in the polygonal columnar shape. When the rotary shaft 203 is the spline shaft or the ball spline, the bearing of such an element forms part of the rotatable portion 208. In addition, the end portion processing for the rotary shaft 203 can be performed using other well-known procedures. The rotary shaft 203 and the rotatable portion 208 are not fixed to each other. The rotatable portion 208 is slidable along the rotary shaft 203. Thus, in association with sliding of the movable portion 606 along the screw shaft 202, the rotatable portion 208 is also slidable along the rotary shaft 203.

The electromagnetic clutch 606*c* with the pulley is attached to the rotary shaft 203. When the electromagnetic clutch 606*c* with the pulley rotates, the rotary shaft 203 rotates. The hole formed at the rotatable portion 208 is in the same shape as that of the rotary shaft 203, and therefore, the rotatable portion 208 rotates in association with rotation of the rotary shaft 203. Optimal shapes can be, as necessary, selected as the shapes of the holes of the rotary shaft 203 and the rotatable portion 208 suitable for sliding of the rotatable portion 208 and rotation of the rotatable portion 208 in association with rotation of the rotary shaft 203, and are not intended to limit the present invention. Note that the shape of the rotatable portion 208 is the cylindrical shape in this example, but the present invention is not limited to above. The shape of the rotatable portion 208 may be the polygonal columnar shape.

The wiping arm drive unit 3 described herein includes the slidable movable portion 606, the sliding mechanism (in this example, the screw shaft 202, the exposure/upper-to-lower motor 204, and various pulleys, electromagnetic clutches, and belts) for sliding the movable portion 606, the rotatable portion 208 configured to slide in association with sliding of the movable portion 606, and the rotation mechanism (in this example, the rotary shaft 203, the exposure/upper-to-lower motor 204, and various pulleys, electromagnetic clutches, and belts: may be referred to as a "swinging mechanism," but referred to as the "rotation mechanism" for the sake of legibility) for rotating the rotatable portion 208.

Since the wiping arm 4 is fixed to the rotatable portion 208, the wiping arm 4 can be moved up and down in association with rotation of the rotatable portion 208.

When a user instructs wiping, it is determined whether or not warm-water cleansing has been completed, and then, special paper 11*b* is supplied to below the anus by the paper supply unit 17. In this state, various types of detection such as detection of paper loading, opening/closing of the opening/closing unit, etc. as described so far can be also used for all of the embodiments, and therefore, description thereof will not be repeated below.

For exposing the wiping arm 4 upon wiping, a not-shown control unit actuates the exposure/upper-to-lower motor 204. In this state, the control unit turns on the electromagnetic clutch 606*b*, and turns off the electromagnetic clutch 606*c*. Thus, only the screw shaft 202 is rotated by rotation of the exposure/upper-to-lower motor 204. Consequently, the movable portion 606 moves to an exposure side. In association with movement of the movable portion 606 toward the exposure side, the rotatable portion 208 moves together, and therefore, the wiping arm 4 is exposed at an exposed position below the anus. The exposed position can be detected by, e.g., a motor detection unit attached to the exposure/upper-to-lower motor 204 or a contact sensor provided at the exposed position.

FIG. 156 is a perspective view of the paper supply unit 17 and the wiping arm drive unit 3 upon wiping. After movement to the exposed position, the control unit turns on the electromagnetic clutch 606*c*, and turns off the electromagnetic clutch 606*b*. Thus, only the rotary shaft 203 rotates. When the control unit rotates the exposure/upper-to-lower motor 204, the rotary shaft 203 rotates, and accordingly, the rotatable portion 208 rotates. In this manner, the wiping arm 4 inclines to the upward direction. Since the wiping arm 4 is configured such that the pressing unit 4*a* is made of the material exhibiting flexibility, the pressing unit 4*a* bends to fit the shape of the vicinity of the anus when contacting the buttocks through the special paper 11*b*. In this manner, the special paper 11*b* contacts the vicinity of the anus, thereby wiping moisture etc. Note that the arm shaft portion of the wiping arm 4 other than the pressing unit 4*a* may exhibit flexibility. Note that the control unit may execute, as necessary, wiping in such a manner that the movable portion 606 moves right to left or that the wiping arm 4 moves up and down. Note that, e.g., the number of rotations and the rotating speed of the exposure/upper-to-lower motor 204 are controlled by, e.g., a not-shown motor detection unit.

Upon completion of wiping, the control unit reversely rotates the exposure/upper-to-lower motor 204, thereby inclining the wiping arm 4 to the horizontal direction or the downward direction. Accordingly, the special paper 11*b* is dropped. Note that the control unit may provide, as necessary, vibration to the special paper 11*b* by slight right-to-left movement of the movable portion 606 or slight upper-to-lower movement of the wiping arm 4, thereby dropping the special paper 11*b*.

When a paper loading detection sensor 12*e* (not shown) detects that the special paper 11*b* has been dropped, the control unit turns on the electromagnetic clutch 606*c*, and actuates the exposure/upper-to-lower motor 204 to move the wiping arm 4 to horizontal. Subsequently, the electromagnetic clutch 606*c* is turned off, and the electromagnetic clutch 606*b* is turned on. Accordingly, the screw shaft 202 reversely rotates to return the movable portion 606 to the original position illustrated in FIG. 154.

As described above, the second technique is used while the wiping arm 4 is disposed below the warm-water cleansing device 15. With this structure, a more compact buttocks wiping device can be provided. Further, in the wiping arm drive unit described herein, exposure of the wiping arm 4 and upper-to-lower movement of the pressing unit 4*a* can be realized by a single motor. This can realize downsizing, as well as realizing cost reduction.

Note that in the present embodiment, rotation of the screw shaft is used as the method for sliding the movable body, but the present invention is not limited to above. The mechanism for sliding the movable table may be various mechanisms including a mechanism in which a movable table placed on rails is slid on the rails by a mechanism including a belt, a pulley, etc., a mechanism in which a movable table is slid by movement of drive wheels on rails, and a mechanism in which a movable table is slid by a mechanism such as a rack-and-pinion.

Note that motors for exposure and upper-to-lower movement may be separately provided. That is, the exposure motor may be used for the screw shaft 202, and the upper-to-lower motor may be used for the rotary shaft 203.

Note that in FIG. 154, a housing for properly housing the wiping arm drive unit 3 is provided at the side of the raised portion 2. The pressing unit 4*a* is exposed through the housing so that the pressing unit 4*a* can be visible. When the pressing unit 4*a* is dirty, the user can wipe or cleanse the pressing unit 4*a*. Moreover, the pressing unit 4*a* can be detached from the wiping arm 4 for replacement, or the wiping arm 4 can be detached from the rotatable portion 208 for replacement. With this structure, the wiping arm 4 can be held in a sanitary manner. Needless to say, the entirety of the wiping arm drive unit 3 illustrated in FIG. 154 may be, for downsizing, housed in the raised portion 2.

(Arrangement Positions in the Case of Using First and Second Techniques)

In the embodiments described so far, various methods for moving the wiping arm 4 by the wiping arm drive unit 3 have been described. However, variations of the method for moving the wiping arm 4 are conceivable. Thus, these methods for moving the wiping arm 4 will be collectively described herein. FIG. 157 is a schematic view collectively illustrating movement patterns of the wiping arm 4. No reference numerals are shown in FIG. 157. However, a chain line indicates a plan view of the toilet seat 7, the pressing unit 4*a* is indicated by a circular mark, and the wiping arm 4 is indicated by an elongated rectangular. For the sake of clarifying a movement path, a plurality of wiping arms 4 and a plurality of pressing units 4*a* are illustrated in a single figure.

In the case of using the first technique, the wiping arm 4 moves with the paper being placed on the pressing unit 4*a*. In the case of using the second technique, the paper is exposed on the paper loading guide 17*c*, and wiping is performed in such a manner that the pressing unit 4*a* moves upward from below the paper. In any techniques, a similar movement path of the wiping arm 4 is conceivable. Note that in addition to the embodiments (exposure from a toilet seat side) described in the present specification, a movement path of the paper loading guide 17*c* may be exposure from the back or front of the toilet seat, and is not limited to above. Note that in each figure illustrated in FIG. 157, the wiping arm drive unit 3 may be configured according to a modified point-symmetrical or line-symmetrical pattern.

FIGS. 157(*a*) to 157(*d*) illustrate a case where wiping is executed in such a manner that the wiping arm 4 is exposed/retracted by angular movement about a certain supporting point and the wiping arm 4 is, upon wiping, inclined upward by upper-to-lower movement of the wiping arm 4 about a base portion thereof as a supporting point. That is, the wiping arm drive unit 3 includes the mechanism for moving (angular movement and upper-to-lower movement) the wiping arm 4 at the base portion thereof in a biaxial direction. In (a) and (b), the supporting point is at the side of the toilet seat. In (c), the supporting point is diagonally at the back of the toilet seat. In (d), the supporting point is at the back of the toilet seat. Part or entirety of the supporting point and/or the wiping arm drive unit 3 may be in the raised portion 2, or may be outside the raised portion 2. Of the embodiments described so far, the embodiments illustrated in FIGS. 11A, 34, 35, 36, 51A, 61A, 76A, 94, 106A, 107, 108, 113, 114, 121, 132, 135A, etc. are according to this pattern.

FIGS. 157(*e*) to 157(*h*) illustrate a case where wiping is executed in such a manner that the wiping arm 4 is manually moved in the axial direction thereof and the wiping arm 4 is, upon wiping, inclined upward by upper-to-lower movement of the wiping arm 4 about the base portion thereof as the supporting point. That is, the wiping arm drive unit 3 includes the mechanism for moving (upper-to-lower movement) the wiping arm 4 at the base portion thereof along a single axis, and the mechanism for moving (slide movement) the entirety of the wiping arm 4 in an uniaxial direction. In (e), the case of sliding from the side of the toilet seat is illustrated. In (f), the case of sliding from the back of the toilet seat is illustrated. In (g), the case of sliding diagonally from the back of the toilet seat is illustrated. In (h), the case of sliding diagonally from the front of the toilet seat is illustrated. Part or entirety of the supporting point and/or the wiping arm drive unit 3 may be in the raised portion 2, or may be outside the raised portion 2. Of the embodiments described so far, the embodiments illustrated in FIGS. 1A, 23, 33, 37, 38, 40, 47, 50, etc. are according to this pattern.

FIGS. 157(*i*) and 157(*j*) illustrate a case where wiping is executed in such a manner that the wiping arm 4 slides in a direction perpendicular to the shaft of the wiping arm 4 and the wiping arm 4 is, upon wiping, inclined upward by upper-to-lower movement of the wiping arm 4 about the base portion thereof as the supporting point. That is, the wiping arm drive unit 3 includes the mechanism for moving (upper-to-lower movement) the wiping arm 4 at the base portion thereof along the single axis, and the mechanism for moving (slide movement) the entirety of the wiping arm 4 in the uniaxial direction. In (i), the case of sliding from the side of the toilet seat is illustrated. In (j), the case of sliding from the back of the toilet seat is illustrated. Part or entirety of the supporting point and/or the wiping arm drive unit 3 may be in the raised portion 2, or may be outside the raised portion 2. Of the embodiments described so far, the embodiments illustrated in FIG. 154 etc. are according to this pattern.

FIG. 157(*k*) illustrates the following case: wiping is executed in such a manner that the wiping arm 4 slides in the direction perpendicular to the axial direction of the wiping arm 4 and the wiping arm 4 is, upon wiping, inclined upward by upper-to-lower movement of the wiping arm 4 about the base portion thereof as the supporting point; and front-to-back movement of the wiping arm 4 is performed by sliding of the wiping arm 4 in the axial direction thereof upon wiping. That is, the wiping arm drive unit 3 includes a triaxial movement mechanism having the mechanism for moving (upper-to-lower movement) the wiping arm 4 at the base portion thereof along the single axis and the mechanism for moving (exposure and front-to-back slide movement) the entirety of the wiping arm 4 in the biaxial direction. Part or entirety of the supporting point and/or the wiping arm drive unit 3 may be in the raised portion 2, or may be outside the raised portion 2. Of the embodiments described so far, the embodiments illustrated in FIGS. 144, 148, 153 etc. are according to this pattern.

FIGS. 157(*l*) to 157(*o*) illustrate the following case: wiping is executed in such a manner that the wiping arm 4 slides in the direction perpendicular to the axial direction of the wiping arm 4 and the wiping arm 4 is, upon wiping, inclined upward by upper-to-lower movement of the wiping arm 4 about the base portion thereof as the supporting point; and the wiping arm 4 angularly moves at the base portion thereof. Such angular movement may be performed at a wiping position as illustrated in (l) and (m), or may be performed at the wiping position for exposing the wiping arm 4 as illustrated in (m) and (o). That is, the wiping arm drive unit 3 includes the triaxial movement mechanism having the mechanism for moving (upper-to-lower movement and angular movement) the wiping arm 4 at the base portion thereof along two axes and the mechanism for moving (slide movement) the entirety of the wiping arm 4 in the uniaxial direction. In (l), the case of sliding from the side of the toilet seat is illustrated. In (m), the case of sliding from the back of the toilet seat is illustrated. In (m) and (n), a case where the wiping arm 4 stands by at the side of the toilet seat and is exposed to the toilet bowl side by angular movement and slide movement is illustrated. The embodiments illustrated in FIGS. 157(*l*) to 157(*o*) can be implemented in such a manner that a motor for angular movement is attached to the coupling portion 106*a* instead of the front-to-back rails 105 and the front-to-back rail drive motor 104 in the embodiment illustrated in FIG. 153, for example. Such an arrangement position is not only below the warm-water cleansing device, but also at the side of the toilet seat.

As described above, various methods for moving the wiping arm by the wiping arm drive unit in the case of using the first and second techniques are conceivable, and other patterns than above are also conceivable. In any of biaxial movement and triaxial movement, all types of wiping arm drive units are included in the present invention as long as the wiping arm drive unit can move the wiping arm to the exposed position below the buttocks and can wipe the buttocks with the paper placed on the pressing unit of the wiping arm.

(Opening/Closing Unit)

The opening/closing unit with a simple structure will be described herein. FIG. 158 is a sectional view of the structure of the paper-supply-side opening/closing unit 19*a*. The paper-supply-side opening/closing unit 19*a* is rotatably attached to the raised portion 2 by a hinge portion 19*g*. A spring portion 19*i* is attached to the raised portion 2 and the paper-supply-side opening/closing unit 19*a* such that force constantly acts in a direction in which the paper-supply-side opening/closing unit 19*a* is closed. A rounded triangular raised portion 19*e* is provided inside the paper-supply-side opening/closing unit 19*a*.

In transition to a state upon start of movement as illustrated in FIG. 158(*b*) from a retracted state illustrated in FIG. 158(*a*), a leading end of the paper loading guide 17*c* comes into contact with the raised portion 19*e*, thereby pushing through the paper-supply-side opening/closing unit 19*a*. Subsequently, a movable frame 70*b* comes into contact with the raised portion 19*e*. Since the raised portion 19*e* is rounded, the movable frame 70*b* keeps pushing through the paper-supply-side opening/closing unit 19*a* and moving forward. As illustrated in FIG. 158(*c*), the paper-supply-side opening/closing unit 19*a* is opened with the raised portion 19*e* contacting the movable frame 70*b*.

For closing, the movable frame 70*b* and the raised portion 19*e* contacting each other are separated from each other, and then, the raised portion 19*e* and the paper loading guide 17*c* come into contact with each other. In this manner, the paper-supply-side opening/closing unit 19*a* is closed.

With the raised portion 19*e*, smooth opening/closing can be performed even when the shape of a lower portion of the paper supply unit 17 is complicated. Note that the raised portion 19*e* is not essential as long as the paper loading guide 17*c* can push through the paper-supply-side opening/closing unit 19*a*.

FIG. 159 is a plan view of the structure of the arm-side opening/closing unit 19*b*. FIG. 159(*a*) is a plan view when closed. The arm-side opening/closing unit 19*b* can be opened/closed by a hinge portion 19*h* provided at a lower portion of the raised portion 2, and the spring portion 19*i* constantly applies force in a direction in which the arm-side opening/closing unit 19*b* is closed. FIG. 159(*b*) illustrates a state when the wiping arm 4 is exposed by angular movement. A lower portion of the pressing unit 4*a* contacts a raised portion 19*f* while pushing through the arm-side opening/closing unit 19*b*. The raised portion 19*f* may be in a triangular shape with a rounded cross section. After the pressing unit 4*a* has contacted the raised portion 19*f*, an arm portion of the wiping arm 4 comes into contact with the raised portion 19*f*, and further pushes down the arm-side opening/closing unit 19*b*. FIG. 159(*c*) is a plan view of a state w en the wiping arm 4 is exposed.

Upon retraction of the wiping arm 4, the raised portion 19*f* contacts the arm portion, and then, contacts the lower portion of the pressing unit 4*a*. In this manner, the arm-side opening/closing unit 19*b* is closed.

With the raised portion 19*f*, smooth opening/closing can be performed even when the shape of a lower portion of the wiping arm 4 is complicated. Note that the raised portion 19*f* is not essential as long as the wiping arm 4 can push through the arm-side opening/closing unit 19*b*.

By opening/closing using such a simple opening/closing unit, a cost for the buttocks wiping device can be reduced.

Such an opening/closing unit rotatable at one side by the hinge portion is applicable to all of the embodiments described in the present specification.

(Variation of Thirteenth Embodiment)

FIG. 160A is a view of a variation of the thirteenth embodiment. In FIG. 160A, the wiping arm 4 is attached to the rotatable portion 208, and the pressing unit 4*a* used in other embodiments than the thirteenth embodiment is used. That is, the pressing unit 4*a* is rotatably attached to the wiping arm 4 by the hinge mechanism. FIG. 160B is a view of a state when the wiping arm 4 is exposed and moved upward. As illustrated in FIG. 160B, the pressing unit 4*a* can be held horizontal. Thus, even in the case of wiping the buttocks from the back, the pressing unit 4*a* can be held horizontal to wipe the moisture etc. Note that various raised shapes of the pressing unit 4*a* are conceivable, but the pressing unit 4*a* may be in an elongated raised shape.

Note that the wiping arm drive unit 3 illustrated in FIGS. 160A and 160B is not provided below the warm-water cleansing device, but for use for wiping the buttocks from the side, is provided at the side of the toilet bowl. Moreover, such a wiping arm drive unit 3 can be utilized not only for the second technique but also for the first technique.

(Variation of Drive Mechanism of Paper Loading Guide 17*c*)

FIG. 161 is a sectional view of a variation of the mechanism of the paper supply unit 17 for driving the paper loading guide 17*c*. In (a), the retracted state is illustrated. In (b), an exposed state is illustrated. A screw shaft 210 is rotatably attached to the rotary shaft of the paper supply motor 17*e* fixed to the raised portion 2. The paper loading guide 17*c* is provided with a screw hole 211. The screw shaft 210 penetrates the screw hole 211. The screw hole 211 may include balls, and therefore, the screw hole 211 and the screw shaft 210 may form a ball screw. The opening/closing unit 19*a* is rotatably attached to the raised portion 2 by a lower hinge. The special paper 11*b* is inserted through a paper injection port 17*a*. Alternatively, the special paper 11*b* is delivered by not-shown paper supply rollers. The paper loading guide 17*c* has such a shape that the not-shown pressing unit 4*a* can pass through when moving upward. A sliding rod (not shown) behind the screw shaft 210 also penetrates the paper loading guide 17*c*.

When the paper supply motor 17*e* rotates, the screw shaft 210 rotates, and the paper loading guide 17*c* moves forward along the screw shaft 210 and the not-shown sliding rod (FIG. 161(*b*)). Accordingly, the special paper 11*b* is exposed. When the special paper 11*b* is lifted by the upwardly-moving the pressing unit, the paper supply motor 17*e* reversely rotates to return the paper loading guide 17*c* to the original position. Then, the opening/closing unit 19*a* is closed.

As described above, the paper loading guide 17*c* may be moved by the sliding mechanism using rotation of the screw shaft.

(Variation of Wiping Arm Drive Unit 3)

FIG. 162A is a perspective view of a variation of the wiping arm drive unit 3 when the wiping arm 4 is retracted. In this variation, a common motor as the exposure/upper-to-lower motor 4 is shared as the exposure motor and the upper-to-lower motor. The mechanism of the wiping arm drive unit 3 described herein is used for such a type that the wiping arm slides in the direction of the arm shaft and moves up and down (FIGS. 157(*e*) to 157(*h*)). Such a mechanism can be used for any of the first and second techniques. FIG. 162B is a perspective view when the wiping arm 4 is exposed with the wiping arm 4 being inclined upward.

The screw shaft 202 and the rotary shaft 203 penetrate the movable portion 606. The screw hole for the screw shaft 202 forms a ball screw, for example. In contrast, the rotary shaft 203 is, e.g., a spline shaft, and the hole for penetration of the rotary shaft 203 is in a cylindrical shape. The rotatable portion 208 is rotatably attached to the movable portion 606. A worm wheel 213 is attached to one side of the rotatable portion 208. A worm 212 is provided with a hole to be engaged with the spline shaft, and the rotary shaft 203 penetrates the worm 212 such that the worm 212 engages with the worm wheel 213. Note that the rotary shaft 203 and the worm wheel 213 are not limited to above as long as similar advantageous effects can be provided.

The electromagnetic clutch 606*c* with the pulley is attached to the screw shaft 202. The electromagnetic clutch 606*c* with the pulley is attached to the rotary shaft 203. Rotation of the exposure/upper-to-lower motor 204 is transmitted to the screw shaft 202 and the rotary shaft 203 through the belt 207 and the pulley 606*a*.

Upon exposure, the electromagnetic clutch 606*b* is turned on, and the electromagnetic clutch 606*c* is turned off. When the exposure/upper-to-lower motor 204 rotates, the screw shaft 202 rotates. Thus, the movable portion 606 moves in the forward direction. After exposure, the electromagnetic clutch 606*c* is turned on, and the electromagnetic clutch 606*b* is turned off. Thus, when the worm 212 rotates, the worm wheel 213 rotates. Consequently, the wiping arm 4 inclines upward.

After wiping, the exposure/upper-to-lower motor 204 reversely rotates to move the wiping arm 4 downward, thereby dropping the special paper 11*b*. Subsequently, the exposure/upper-to-lower motor 204 rotates to move the wiping arm 4 to horizontal. Subsequently, the electromagnetic clutch 606*b* is turned on, and the electromagnetic clutch 606*c* is turned off. Then, the exposure/upper-to-lower motor 204 reversely rotates to return the movable portion 606 to the original position.

The wiping arm drive unit 3 illustrated in FIGS. 162A and 162B includes the slidable movable portion 606, the sliding mechanism (the screw shaft 202 etc.) for sliding the movable portion 606, the rotatable portion 208 configured to slide in association with sliding of the movable portion 606 and fixed to the wiping arm 4, and the rotation mechanism (the rotary shaft 203, the worm 212, the worm wheel 213, etc.) for rotating the rotatable portion 208.

As described above, the common motor can be shared as the upper-to-lower motor and the exposure motor.

Note that when two motors are utilized, the exposure motor may be attached to the screw shaft 202, and the upper-to-lower motor may be attached to the rotary shaft 203.

Fourteenth Embodiment

In the embodiments using the second technique as described so far the paper loading guide 17*c* is exposed from the side of the toilet seat 7. However, the paper loading guide 17*c* may be exposed from the back of the toilet seat 7. In the case of exposing the paper loading guide 17*c* from the back of the toilet seat 7, the paper loading guide 17*c* may be exposed by the technique of the paper supply unit 17 as described so far. However, the mechanism of the paper supply unit 17 described so far is not always a suitable mechanism for exposure from the back of the toilet seat. For this reason, in a fourteenth embodiment, a suitable mechanism for the case of exposing a paper loading guide 17*c* from the back of a toilet seat will be described. Further, a mechanism will be also described, in which a common motor is shared as an exposure motor 9, an upper-to-lower motor 8, and a paper supply motor 17*e* so that exposure and upper-to-lower movement of a wiping arm 4 and exposure of the paper loading guide 17*c* can be performed by the single motor.

FIG. 164 is a perspective view of a buttocks wiping device 1 of the fourteenth embodiment. In this embodiment, for the sake of clarifying the structure of a wiping arm drive unit 3, the wiping arm drive unit 3 is illustrated in an exposed state. Moreover, an opening/closing unit is not shown, and a raised portion 2 is kept opened. The opening/closing unit can be implemented using the techniques described so far. Note that a simple opening/closing unit as described in a sixteenth embodiment later can be also utilized. FIG. 165 is a perspective view of the wiping arm drive unit 3 and the paper loading guide 17*c*. FIG. 166 is a block diagram of a functional configuration of the buttocks wiping device 1. FIG. 167 is a perspective view of the state of the buttocks wiping device 1 when the paper loading guide 17*c* is exposed. FIG. 168 is a perspective view of the wiping arm drive unit 3 and the paper loading guide 17*c* when the paper loading guide 17*c* is exposed. FIG. 169A is a perspective view of the state of the buttocks wiping device 1 upon wiping. FIG. 169B is a perspective view of the wiping arm drive unit 3 and the paper loading guide 17*c* upon wiping. The same reference numerals as those of the thirteenth embodiment and the variations thereof are used to represent similar functions, and description thereof will not be repeated. Differences will be mainly described below. Note that in the fourteenth embodiment, a bearing portion 220 provided at the raised portion 2 is illustrated, and bearing portions of the screw shaft 202 and the rotary shaft 203 are clearly illustrated.

As illustrated in FIG. 165, the wiping arm drive unit 3 includes a drive motor 300. The drive motor 300 is similar to the exposure/upper-to-lower motor 204 described in the thirteenth embodiment. However, the drive motor 300 is also used for movement of the paper loading guide 17*c*, and therefore, the name thereof is described as the "drive motor 300." As in the thirteenth embodiment, the drive motor 300 can slide a movable portion 606, and can rotate a rotatable portion 208. In the fourteenth embodiment, the paper loading guide 17*c* is fixed to the movable portion 606. On such a point, the fourteenth embodiment is different from the thirteenth embodiment and the variations thereof.

When the movable portion 606 is slid by the drive motor 300, the paper loading guide 17*c* is exposed together with the movable portion 606 as illustrated in FIGS. 167 and 168. The paper loading guide 17*c* is provided with such a hole that a pressing unit 4*a* can pass through to the upward direction. Thus, when the rotatable portion 208 is rotated by the drive motor 300 upon wiping, special paper 11*b* is lifted to the upward direction as illustrated in FIGS. 169A and 169B. The buttocks are wiped in this manner. After wiping, the wiping arm 4 is lowered by the drive motor 300. In this state, the special paper 11*b* after wiping is placed on the paper loading guide 17*c* again.

For this reason, the special paper 11*b* needs to be dropped. A protrusion (not shown) is provided at an opening of the raised portion 2. When the movable portion 606 returns to a retracted position, the protrusion protrudes using, e.g., an electromagnetic solenoid, thereby contacting the special paper 11*b*. In this manner, the special paper 11*b* is dropped. Moreover, the shape of the paper loading guide 17*c* may be a shape easily dropping the special paper 11*b*. For example, the paper loading guide 17*c* may be in a double rod shape extending on both sides of the pressing unit 4*a* such that the special paper 11*b* is less dropped when exposed, but loses its balance when returned after wiping.

As illustrated in FIG. 166, an exposed position of the movable portion 606 is detected by an exposed position sensor 12*b*, and a control unit 13 stops operation of the drive motor 300. In a retracted state, the retracted position of the movable portion 606 is detected by a retracted position sensor 12*a*, and the control unit 13 stops operation of the drive motor 300. A motor detection unit 300*a* performs torque limitation or torque control, thereby controlling the pressing strength of the pressing unit 4*a* against the buttocks.

As described above, in the fourteenth embodiment, all of exposure of the paper loading guide 17*c*, exposure of the wiping arm 4, and upper-to-lower movement of the wiping arm 4 can be realized by the single motor, and a significant cost reduction effect can be expected.

Note that the motor for exposure of the wiping arm 4 and the motor for upper-to-lower movement of the wiping arm 4 may be, needless to say, separately provided. In this case, the common motor for exposure of the wiping arm 4 can be shared for exposure of the paper loading guide 17*c*, and therefore, the cost reduction effect can be expected.

Note that the not-shown protrusion is used for dropping the paper as described above, but a dropping method is not limited to above. FIG. 170 is a view of a structure in a case where a paper dropping portion 223 is provided at the raised portion 2. As illustrated in FIG. 170, a mechanism housing portion 222 is provided on an opposite side of a mechanism housing portion 211 in the raised portion 2 so that the movable portion 606 can move deeper inside. The paper dropping portion 223 is provided to protrude above an upper surface of the mechanism housing portion 222. For dropping the paper after wiping, the drive motor 300 moves the movable portion 606 to the mechanism housing portion 222. Then, the special paper 11*b* placed on the paper loading guide 17*c* comes into contact with the paper dropping portion 223, and then, is dropped. In this state, when the pressing unit 4*a* can lift the special paper 11*b* by upward movement of the wiping arm 4, the special paper 11*b* can be more reliably dropped. Only by such designing of the shape of the raised portion 2, the paper can be dropped, leading to cost reduction.

The requirements for the second technique will be considered by understanding of the fourteenth embodiment in relation to the second technique. With structural understanding of the fourteenth embodiment, the paper loading guide 17*c* functions as a paper supply unit for exposing the paper below the buttocks, and the mechanism for driving the paper supply unit includes the drive motor 300, the screw shaft 202, and the movable portion 606. Thus, the paper supply unit for exposing the paper below the buttocks is included in the fourteenth embodiment. Note that unlike the embodiments corresponding to the second technique as described so far, the paper loading guide 17*c* of the fourteenth embodiment moves together with the wiping arm 4. It can be understood that the paper supply unit for exposing the paper below the buttocks can be or cannot be provided separately from the wiping arm 4, supposing that the fourteenth embodiment is categorized into the second technique. In the fourteenth embodiment, the drive motor 300, the screw shaft 202, the movable portion 606, the rotatable portion 208, and the rotary shaft 203 function as the wiping arm drive unit 3. However, the drive motor 300, the screw shaft 202, and the movable portion 606 form the mechanism for exposing the wiping arm, and all of these elements are also used as the paper supply unit. Moreover, the drive motor 300, the screw shaft 202, the movable portion 606, the rotatable portion 208, and the rotary shaft 203 form the mechanism for wiping the buttocks by the wiping arm (wiping by upper-to-lower and right-to-left movement), but some of these elements are also used as the paper supply unit. As described above, the mechanism for moving (exposure and wiping operation) the wiping arm 4 by the wiping arm drive unit 3 and the mechanism for exposing a wiping material by the paper supply unit are partially or entirely shared. That is, it can understood that a drive unit for the paper supply unit and a drive unit for the wiping arm are not necessarily provided as separate units. Conceptual understanding of the second technique from the above-described consideration leads to the following conclusion.

The wiping arm has the pressing unit for pressing the wiping material against the buttocks, and the paper supply unit is configured to expose the wiping material below the buttocks. The buttocks are wiped in such a manner that the pressing unit pushes up the wiping material from below with the wiping material being exposed. The mechanism for driving the wiping arm and the mechanism for driving the paper supply unit are not necessarily separated from each other, and may be entirely or partially shared.

The fourteenth embodiment can be understood as described above, and as a result, fifteenth and sixteenth embodiments described below can be proposed as embodiments for implementing the second technique.

Fifteenth Embodiment

FIG. 17*l*A is a perspective view of a buttocks wiping device 1 of the fifteenth embodiment. In this embodiment, a toilet seat 7 and a warm-water cleansing device 15 are also illustrated. Note that a warm-water spray nozzle in the warm-water cleansing device 15 is not shown in the figure. Moreover, an opening/closing unit is not shown, and a raised portion 2 is kept opened. The techniques described so far can be used to implement the opening/closing unit. Note that the simple opening/closing unit as described in the sixteenth embodiment later can be also utilized. FIG. 17*l*B is a perspective view of the buttocks wiping device 1 diagonally from the left back side. FIG. 17*l*C is a block diagram of a functional configuration of the buttocks wiping device 1. FIG. 17*l*D is a flowchart of operation of the buttocks wiping device 1. FIG. 17*l*E is a flowchart of operation subsequent to FIG. 17*l*D. FIGS. 172A and 172B are perspective views of a structure including a wiping arm drive unit 3 and a paper loading guide 17*c*.

First, the structure of the buttocks wiping device 1 will be described. Note that the same reference numerals as those of the thirteenth embodiment, the variations thereof, and the fourteenth embodiment are used to represent similar elements in the fifteenth embodiment, and description thereof will not be repeated.

As illustrated in FIG. 17*l*A, a user places special paper 11*b* on the paper loading guide 17*c*. In this embodiment, the wiping arm drive unit 3 is in an exposed state, but is actually covered. The paper loading guide 17*c* may be exposed, or a lid may be provided on the paper loading guide 17*c*. Moreover, using a paper injection port 17*a* and paper supply rollers 17*b* as described above, the special paper 11*b* may be inserted into the paper injection port 17*a*, and may be delivered onto the paper loading guide 17*c* by the paper supply rollers 17*b*.

In the fourteenth embodiment, the paper loading guide 17*c* is fixed to the movable portion 606. However, in the fifteenth embodiment, the paper loading guide 17*c* is not fixed to a movable portion 606, and is movable alone. Specifically, as illustrated in FIG. 172B, the paper loading guide 17*c* bends in an L-shape at the back of the movable portion 606, and a screw shaft 301 and a sliding rod 302 penetrate the bent portion. The screw shaft 301 and the sliding rod 302 are attached to a bearing portion 220 on one side, and are attached to the raised portion 2 on the other side. The sliding rod 302 serves as a guide upon sliding. Thus, the sliding rod 302 is not necessarily rotatable, and may be fixed to the bearing portion 220 and the raised portion 2. A screw hole of the paper loading guide 17*c* for penetration of the screw shaft 301 includes balls. The screw hole, the balls, and the screw shaft 301 form a ball screw, and therefore, the paper loading guide 17*c* is slidable along the screw shaft 301 and the sliding rod 302. Note that the balls are not necessarily provided, and the screw shaft 301 may be a sliding screw or a trapezoidal screw.

As illustrated in FIGS. 172A and 172B, an electromagnetic clutch 606*d* with a pulley is attached to one end of the screw shaft 301. The electromagnetic clutch 606*d* cooperates, through a belt 207, with a pulley 606*e* attached to a rotary shaft of a drive motor 300. With this structure, when the drive motor 300 rotates, the pulley 606*e* rotates. When the electromagnetic clutch 606*d* is ON, the screw shaft 301 rotates. Accordingly, the paper loading guide 17*c* slides.

The paper loading guide 17*c* and the movable portion 606 are separated from each other as separate bodies. Thus, the movable portion 606 is also slidable separately from sliding of the paper loading guide 17*c* as described in the thirteenth embodiment. For sliding the paper loading guide 17*c*, the electromagnetic clutch 606*d* is turned on, and electromagnetic clutches 606*b*, 606*c* are turned off. For sliding the movable portion 606, the electromagnetic clutch 606*b* is turned on, and the electromagnetic clutches 606*c*, 606*d* are turned off. For rotating a rotatable portion 208, the electromagnetic clutch 606*c* is turned on, and the electromagnetic clutches 606*b*, 606*d* are turned off.

FIG. 173A is a perspective view of a state when the special paper 11*b* placed on the paper loading guide 17*c* is exposed. FIG. 173B is a perspective view of the structure including the wiping arm drive unit 3 and the paper loading guide 17*c* in the state of FIG. 173A. FIG. 174A is a perspective view of a state when the special paper 11*b* is lifted for wiping. FIG. 174B is a perspective view of the structure including the wiping arm drive unit 3 and the paper loading guide 17*c* in the state of the FIG. 174A. FIG. 175A is a perspective view of a state when the paper loading guide 17*c* is retracted during wiping. FIG. 175B is a perspective view of the structure including the wiping arm drive unit 3 and the paper loading guide 17*c* in the state of FIG. 175A.

Operation of the buttocks wiping device 1 will be described below with reference to FIGS. 17*l*D and 17*l*E. First, when the user uses an operation unit 35 to instruct wiping (S11000), a control unit 13 uses a warm-water cleansing sensor 12*c* to detect whether or not warm-water cleansing has been completed and whether or not a warm-water cleansing solution drips off from the nozzle (S1101). The control unit 13 can determine whether or not warm-water cleansing has been completed in such a manner that the cleansing checking sensor 12*c* detects whether or not a cleansing switch of the warm-water cleansing device 15 has been pressed. Determination on whether or not the warm-water cleansing solution drips off from the nozzle may be made in such a manner that a sensor configured to determine whether or not water dropping sound is lost is provided, that a sensor configured to detect water droplets is provided at a lower portion of the nozzle, or that LED light emitter and receiver are provided on both sides of the nozzle to determine whether or not water droplets no longer drop. Alternatively, various other sensors may be used for such determination. For the simplest structure, the following control may be made: the number of seconds for which water droplets are dropping from the nozzle is measured, and wiping begins after standby for the measured time after warm-water cleansing. If it is, at S1101, determined that warm-water cleansing has not been completed, the control unit 13 prompts, through a not-shown output unit, the user to perform warm-water cleansing. Note that in a case where wiping is instructed after completion of warm-water cleansing, the control unit 13 controls the warm-water cleansing device 15 not to operation even when the user has pressed a warm-water cleansing button.

Subsequently, the control unit 13 detects, using a paper loading guide sensor 17*i*, whether or not the special paper 11*b* is placed on the paper loading guide 17*c* (S1102). In a case where the paper is not placed on the paper loading guide 17*c*, the control unit 13 prompts, through the not-shown output unit, the user to place the special paper 11*b*.

When it is, at S1101 and S1102, detected that it is ready for wiping, the control unit 13 turns on the electromagnetic clutches 606*b*. 606*d*, and turns off the electromagnetic clutch 606*c* (S1103). Subsequently, the control unit 13 actuates the drive motor 300 (S1104). In this manner, the paper loading guide 17*c* and the wiping arm 4 are moved and exposed.

An exposed position sensor 12*b* (e.g., a contact switch or a non-contact sensor) is provided at exposed positions of the paper loading guide 17*c* and the movable portion 606. When the paper loading guide 17*c* and the movable portion 606 reach the exposed positions, the control unit 13 uses the exposed position sensor 12*b* to detect the exposed positions, thereby stopping the drive motor 300 (51105). Such a state is illustrated in FIGS. 173A and 173B.

Subsequently, the control unit 13 turns off the electromagnetic clutches 606*b*, 606*d*, and turns on the electromagnetic clutch 606*c* (S1106). The control unit 13 actuates the drive motor 300 to rotate the rotary shaft 203, thereby inclining the wiping arm 4 upward (S1107). At such timing, the control unit 13 turns on the paper loading detection sensor 12*e* (S1108). While the paper loading detection sensor 12*e* is ON, if paper loading on the pressing unit 4*a* is no longer detected due to dropping of the special paper 11*b*, such a state indicates that the special paper 11*b* is unexpectedly dropped in the middle. In the case of such dropping in the middle, the control unit 13 stops all types of operation, and returns the wiping arm 4 to a horizontal position. Then, the paper loading guide 17*c* is returned to a retracted position, and the wiping arm 4 is returned to a retracted position. Operation upon such an error will be described later with reference to FIG. 17*I*F.

After S1108, the control unit 13 turns off the paper loading guide sensor 17*i* (S1109). This is because the special paper 11*b* is no longer present on the paper loading guide 17*c* at this timing, and therefore, detection by the paper loading guide sensor 17*i* is no longer needed.

Suppose that the wiping arm 4 inclines upward without any errors. In this state, the control unit 13 detects the inclination angle of the wiping arm 4 from a signal from a motor detection unit 300*a*. When the wiping arm 4 inclines to a predetermined inclination angle, the control unit 13 detects that the wiping arm 4 reaches a wiping position (S1110). Note that a specific example of the motor detection unit 300*a* is similar to that described in the first embodiment. Note that arrangement of the motor detection unit 300*a* and various other sensors is not shown in the structural drawings.

Moreover, the control unit 13 detects a torque (the magnitude of wiping pressure) on the drive motor 300 from the signal from the motor detection unit 300*a*. In a case where the motor detection unit 300*a* detects not only the rotation angle but also the torque, two or more motor detection units 300*a* may be provided, needless to say. A specific example of torque detection has been already described, and therefore, description thereof will not be repeated. The control unit 13 recognizes a current torque from the signal from the motor detection unit 300*a*, thereby performing torque limitation. In this manner, the control unit 13 controls such that the pressing unit 4*a* is pressed against the buttocks with force more than necessary (S1111). For example, in the case of performing the torque limitation, when a torque equal to or greater than a predetermined torque is applied, the control unit 13 stops the drive motor 300 at this point. The position of the buttocks of the user is substantially fixed while the user is seating. When the pressing unit 4*a* contacts the buttocks with a certain level of force, such a state is taken as a state in which the pressing unit 4*a* and the buttocks closely contact each other. In the case of using a geared motor as the drive motor 300, the wiping arm 4 is held at a lifted position as long as a torque equal to or greater than a holding torque is not applied from the buttocks in a reverse direction. Thus, the drive motor 300 may be stopped at the stage of generating the torque equal to or greater than the predetermined torque. Such a state is illustrated in FIGS. 174A and 174B.

After the drive motor 300 has been stopped, the control unit 13 turns on the electromagnetic clutch 606*d*, and turns off the electromagnetic clutches 606*b*, 606*c* (S1112). The control unit 13 actuates and reversely rotates the drive motor 300, thereby returning the paper loading guide 17*c* to the retracted position (S1113). Such a state is illustrated in FIGS. 175A and 175B. A retracted position sensor 12*a* (e.g., a contact switch or a non-contact sensor) is provided at the retracted positions of the paper loading guide 17*c* and the movable portion 606. When the paper loading guide 17*c* and the movable portion 606 reach the retracted positions thereof, the control unit 13 uses the retracted position sensor 12*a* to detect the retracted positions, thereby stopping the drive motor 300 (S1114).

Subsequently, the control unit 13 turns off the electromagnetic clutches 606*b*, 606*d*, and turns on the electromagnetic clutch 606*c* (S1115). In this state, the control unit 13 performs torque control (S1116). That is, the torque detected by the motor detection unit 300*a* is recognized by the control unit 13. When the torque reaches equal to or greater than the predetermined torque, the control unit 13 performs reverse rotation of the drive motor 300. When the torque reaches equal to or less than the predetermined torque, the control unit 13 performs forward rotation of the drive motor 300. In this manner, the state of pressing the pressing unit 4*a* against the buttocks by the torque within a certain range is constantly brought. Alternately with torque control, the control unit 13 turns off the electromagnetic clutches 606*c*, 606*d*, and turns on the electromagnetic clutch 606*b* (S1115). Then, by forward-reverse repeat rotation of the drive motor 300, the control of slightly moving the pressing unit 4*a* right to left is performed (S1116). After such wiping operation has been performed only in a predetermined pattern, the control unit 13 proceeds to S1117.

Note that in the fifteenth embodiment, the single drive motor 300 is provided, and therefore, the electromagnetic clutches are switched while operation of the paper loading guide 17*c* and the wiping arm 4 is being controlled. With two or more motors, switching of the electromagnetic clutches can be reduced, and therefore, a feedback control response time can be shortened. Moreover, when a servomotor can be provided as the drive motor 300 for high-accuracy control, the response time can be shortened. Further, almost all of moisture etc. are wiped at the stage of S1111 even without performing the wiping operation with the above-described level of fineness, and therefore, one or both of torque control or slight right-to-left movement may be omitted. That is, operation of S1116 is not essential.

At S1117, the control unit 13 turns off the electromagnetic clutches 606*b*, 606*d*, and turns on the electromagnetic clutch 606*c* (S1117). Then, the control unit 13 reversely rotates the drive motor 300, thereby inclining the wiping arm 4 downward (S1118). When detected a lowered position based on the signal from the motor detection unit 300*a* (S1119), the control unit 13 stops the drive motor 300 (S1120). At this timing, the special paper 11*b* is dropped, and therefore, the control unit 13 turns off the paper loading detection sensor 12*e* (S1121). Note that a hinge structure including the pressing unit 4*a* and the wiping arm 4 is provided, and the pressing unit 4*a* also inclines in the case of inclining the wiping arm 4 downward. When the pressing unit 4*a* illustrated in, e.g., FIGS. 136 and 137 can be rotated at a T-shaped arm tip end, the pressing unit 4*a* can incline as described above. However, the present invention is not limited to above.

Subsequently, the control unit 13 performs forward rotation of the drive motor 300, thereby moving, based on the signal from the motor detection unit 300*a*, the wiping arm 4 to the horizontal position (S1122). Subsequently, the control unit 13 turns on the electromagnetic clutch 606*b*, and turns off the electromagnetic clutches 606*c*, 606*d* (S1124). Then, the control unit 13 performs reverse rotation of the drive motor 300 until the retracted positions are detected by sliding of the movable portion 606 and the wiping arm 4 (S1125), and then, stops the drive motor 300 (S1126). The control unit 13 is brought into a standby state for a subsequent wiping instruction.

As described above, in the fifteenth embodiment, movement of the paper loading guide 17*c* is realized by, e.g., the screw shaft 301, the electromagnetic clutch 606*d*, and the drive motor 300. Moreover, movement of the wiping arm 4 is realized by, e.g., the screw shaft 202, the electromagnetic clutch 606*b*, and the drive motor 300. Thus, the mechanism for moving the wiping arm 4 by the wiping arm drive unit 3 and the mechanism for exposing the special paper 11*b* by the paper loading guide 17*c* are partially shared. Such drive unit sharing leads to cost reduction.

Further, the paper loading guide 17*c* and the movable portion 606 are separately movable. Thus, the common drive unit can be shared while the paper loading guide 17*c* can be returned to the retracted position upon wiping. Thus, there is no interference of the paper loading guide 17*c* upon dropping of the special paper 11*b*, and therefore, the special paper 11*b* is smoothly dropped.

Again, a plurality of motors may be, needless to say, provided so that the screw shaft 301, the screw shaft 202, and the rotary shaft 203 can be rotated by the separate motors. Thus, the fifteenth embodiment is characterized in that the wiping arm drive unit 3 includes the slidable movable portion 606, the sliding mechanism for sliding the movable portion 606, the rotatable portion 208 configured to slide in association with sliding of the movable portion 606 and fixed to the wiping arm 4, and the rotation mechanism (the swinging mechanism) for rotating the rotatable portion 208 and that the paper supply unit is implemented by the paper loading guide 17*c* configured to slide separately from the movable portion 606. Specifically, the fifteenth embodiment is, in addition, characterized in that the common drive unit is shared such that the paper loading guide 17*c* slides separately from the movable portion 606 while being moved by the sliding mechanism for the movable portion 606.

FIG. 17*l*F is a flowchart of error processing in a case where the special paper 11*b* is no longer detected while the paper loading guide sensor 17*i* is activated (S1102 to S1109) and the paper loading detection sensor 12*e* is activated (S1108 to S1121). In a case where loading of the special paper 11*b* is no longer detected by at least either one of the paper loading guide sensor 17*i* or the paper loading detection sensor 12*e* (S1200*a*, S1200*b*) while the paper loading guide sensor 17*i* is activated (S1102 to S1109) and the paper loading detection sensor 12*e* is activated (S1108 to S1121), such a state indicates that the special paper 11*b* is dropped in the middle or is caught by somewhere. Thus, the control unit 13 turns off the electromagnetic clutches 606*b*, 606*d*, and turns on the electromagnetic clutch 606*c* (S1201). Then, the control unit 13 actuates the drive motor 300 until the motor detection unit 300*a* detects the horizontal position (S1202).

When the horizontal position is detected, the control unit 13 turns on the electromagnetic clutches 606*b*, 606*d*, and turns off the electromagnetic clutch 606*c* (S1203). Thus, the control unit 13 actuates the drive motor 300 until the retracted position sensor 12*a* detects the retracted position (S1204), and therefore, the wiping arm 4 and the paper loading guide 17*c* are returned to the retracted state before start of wiping.

Note that in other embodiments, when detected that no paper is placed on the paper loading guide 17*c*, the control unit 13 may return the paper loading guide 17*c* to the retracted position. Moreover, when detected that no paper is placed on the pressing unit 4*a*, the control unit 13 may return the wiping arm 4 to the retracted position.

Note that FIG. 176 is a perspective view of a state when the wiping arm 4 is, for dropping the paper, moved downward such that the special paper 11*b* contacts a paper dropping portion 303 provided below the paper loading guide. As described above, the paper loading guide 17*c* and the wiping arm 4 can be separately operated, and therefore, the paper loading guide 17*c* can be used as a section for dropping the paper.

Sixteenth Embodiment

A sixteenth embodiment has such a mechanism that a simple opening/closing unit is provided for the fifteenth embodiment. In this embodiment, the characteristics of the opening/closing unit will be described. Note that in the sixteenth embodiment, a sliding rod 310 is, for stable sliding of a movable portion 606 in a wiping arm drive unit 3, attached to a raised portion 2 and a bearing portion 220, and penetrates a hole punched at the movable portion 606. Moreover, the structure of the movable portion 606 is slightly changed for placement of a press-down portion 307 as described later.

FIG. 177 is a perspective view of an internal structure of a buttocks wiping device 1 of the sixteenth embodiment. In FIG. 177, the buttocks wiping device 1 includes, in addition to the structure in the fifteenth embodiment, a slide-type opening/closing unit 304, a hinge portion 304*a*, a hinge-type opening/closing unit 305, a hinge portion 305*a*, grooves 306, 308, and the press-down portion 307. The slide-type opening/closing unit 304 is made of, e.g., resin or metal exhibiting flexibility. The groove 306 is provided at the raised portion 2 such that the slide-type opening/closing unit 304 can be retracted. When the slide-type opening/closing unit 304 slides, the slide-type opening/closing unit 304 bends along the groove 306, and then, is inserted into the groove 306. Force in a closing direction is constantly applied in such a manner that a spring is built in the hinge portion 305*a* or that a spring (not shown) is attached to the hinge-type opening/closing unit 305 as in FIG. 158.

FIG. 178 is an enlarged perspective view of the internal structure. The movable portion 606 has such a size that the movable portion 606 slightly protrudes to the right with respect to a paper loading guide 17*c*. The hinge portion 304*a* is provided at a front right end of the movable portion 606. The opening/closing unit 304 is rotatably attached to the movable portion 606 by the hinge portion 304*a*. The press-down portion 307 is attached to a lower surface of the movable portion 606. A right end of the press-down portion 307 is positioned closer to the right than a right end of the paper loading guide 17*c*. The press-down portion 307 is configured to move together with movement of a movable table 305.

FIG. 179 is a perspective view of a state when movement of the movable portion 606 and the paper loading guide 17*c* begins such that the hinge-type opening/closing unit 305 begins to open. When the movable portion 606 slides, the slide-type opening/closing unit 304 together slides accordingly. The groove 308 is provided in a sliding path of the slide-type opening/closing unit 304 at a lower surface of the raised portion 2, and a lower portion of the slide-type opening/closing unit 304 is inserted into the groove 308. In association with movement of the movable portion 606, a right end of the slide-type opening/closing unit 304 is inserted into the groove 306. When the movable portion 606 slides, the right end of the press-down portion 307 presses the hinge-type opening/closing unit 305, and therefore, the hinge-type opening/closing unit 305 rotates about a hinge 305 as a supporting point. Note that the movable portion 606 may be exposed before the paper loading guide 17*c*. In this case, a position relationship between the right end of the movable portion 606 and the right end of the paper loading guide 17*c* may be different from that of the illustrated example.

In FIG. 179, the right end of the press-down portion 307 is closer to the right than the right end of the paper loading guide 17*c*, and therefore, the press-down portion 307 first comes into contact with the hinge-type opening/closing unit 305. This prevents special paper 11*b* from contacting the hinge-type opening/closing unit 305.

FIG. 180 is a perspective view of a state when the movable portion 606 has moved to a retracted position. As illustrated in FIG. 180, the slide-type opening/closing unit 304 is inserted into the groove 306. The press-down portion 307 has such a length that the hinge-type opening/closing unit 305 can be held even at an exposed position. This prevents closing of the hinge-type opening/closing unit 305. Note that when the hinge-type opening/closing unit 305 can be configured to turn over to both sides (e.g., a sliding door structure), the paper loading guide 17*c* can turn over the hinge-type opening/closing unit 305 upon retraction of the paper loading guide 17*c*, and therefore, pressing by the press-down portion 307 is not necessary.

FIG. 181 is a perspective view of a state while only the paper loading guide 17*c* is being retracted. FIG. 182 is a perspective view of a state when only the paper loading guide 17*c* is retracted. As described above, the press-down portion 307 allows retraction of the paper loading guide 17*c* without pushing of the hinge-type opening/closing unit 305 by the paper loading guide 17*c*. After FIG. 182, the movable portion 606 moves backward with the wiping arm 4 being held horizontal, and then, an opening formed at the raised portion 2 is closed by the slide-type opening/closing unit 304. Further, when the movable portion 606 moves backward to such a position that pressing of the press-down portion 307 is released, the hinge-type opening/closing unit 305 stands up to close the opening on the left.

As described above, in the sixteenth embodiment, the hinge-type opening/closing unit 305 configured to slide together with movement of the movable portion 606 to open/close the opening of the raised portion is used so that the opening can be opened/closed without use of, e.g., a drive motor or an electromagnet. Further, opening/closing can be reliably performed with a simple structure, and therefore, a waterproofing effect is improved in addition to cost reduction. In the case of the sixteenth embodiment, the hinge-type opening/closing unit 305 uses the press-down portion 307 to allow retraction of the paper loading guide 17*c* upon backward movement thereof even in the case of a simple single door structure (an opening way by turning over only to one side). Needless to say, a self-standing opening/closing unit with a double door structure (an opening way by turning over to both sides) can be implemented, but there is a probability that the mechanism of the hinge portion is complicated. Thus, a great effect of the press-down portion 307 allowing not only exposure but also retraction of the paper loading guide 17*c* even in the case of the single door structure is provided. As a result, the sixteenth embodiment describes a simplified structure including an opening/closing mechanism, and is an embodiment extremely effective for cost reduction.

Note that in this embodiment, the slide-type opening/closing unit 304 is made of the flexible material, but is not necessarily made of the flexible material as long as the slide-type opening/closing unit 304 is opened straight to the right. In this case, the groove 306 is provided straight to the right. In a case where the slide-type opening/closing unit 304 protrudes from the raised portion 2 when opened, a cover may be provided.

Note that in the case of using paper supply rollers, the special paper 11*b* can be placed on the paper loading guide 17*c* by the paper supply rollers, and therefore, the wiping arm drive unit 3 and the paper loading guide 17*c* can be retraced into the raised portion. With this structure, a portion exposed at the side of a toilet bowl can be reduced as much as possible.

Note that when the press-down portion 307 is taken as part of the movable portion 606, the movable portion 606 pushes through the hinge-type opening/closing unit 305 as described above, but the paper loading guide 17*c* may push through the hinge-type opening/closing unit 305.

Note that arrangement may be horizontally symmetrical, needless to say.

Note that the sixteenth embodiment has been described as arrangement at the back of a toilet seat, but may be similarly implemented as arrangement at the side of the toilet seat. In this case, the paper loading guide 17*c* is disposed below a warm-water cleansing device, and therefore, it is difficult to manually place the paper. However, the paper supply rollers may be used to deliver the paper, thereby placing the paper on the paper loading guide 17*c*.

Note that the opening/closing mechanism described in the sixteenth embodiment is also applicable to the thirteenth and fourteenth embodiments. That is, opening/closing can be performed with a similar structure when the hinge-type opening/closing unit 305 can be provided with the slide-type opening/closing unit 304 being provided at the right end of the movable portion 606 and the press-down portion 307 being provided at a left end of the movable portion 606 in FIGS. 155 and 165, for example. In the case of the fourteenth embodiment, the movable portion 606 may be formed larger than the paper loading guide 17*c* such that the movable portion 606 first opens the hinge-type opening/closing unit 305. With this structure, the special paper 11*b* does not contact the hinge-type opening/closing unit 305. Thus, it is sanitary while troubles such as paper displacement can be avoided.

(Opening/Closing Unit)

FIG. 183 is a perspective view of an arm-side opening/closing unit 19*b*. As illustrated in FIG. 183, the arm-side opening/closing unit 19*b* includes three hinge-type opening/closing units 19*b*-1, 19*b*-2, 19*b*-3. Each unit is rotatable about a lower hinge portion. Force in a direction in which each unit stands due to repulsive force is applied to the hinge-type opening/closing units 19*b*-1, 19*b*-2, 19*b*-3 in such a manner that a spring is built in each hinge portion or is directly attached to an opening/closing portion.

FIG. 184 is a perspective view of a state when the arm-side opening/closing unit 19*b* is opened. As illustrated in FIGS. 183 and 184, the middle hinge-type opening/closing unit 19*b*-2 is on the inside. Thus, when the hinge-type opening/closing unit 19*b*-2 turns over, the hinge-type opening/closing units 19*b*-1, 19*b*-3 on both sides also turn over. A strut portion of the wiping arm 4 is provided with a press-down portion 400. Thus, even when the wiping arm 4 is exposed, the hinge-type opening/closing unit 19*b*-2 is kept opened, and therefore, the hinge-type opening/closing units 19*b*-1, 19*b*-3 can be also kept opened. The arm-side opening/closing unit 19*b* described herein is effective in, e.g., the embodiment illustrated in FIG. 135A, but as necessary, can be utilized according to arrangement of the wiping arm 4.

(Variation of Type for Wiping from Back)

The thirteenth to sixteenth embodiments disclose the embodiments for wiping the buttocks from the back of the toilet seat. For these embodiments, a ball screw spline 401 realizing linear movement and rotation movement can be utilized. The ball screw spline has, at a shaft, a spiral ball screw groove 401 and a linear spline groove 402. The ball screw spline includes the type of overlapping a ball screw portion and a spline shaft portion each other, and the type of separating a ball screw portion and a spline shaft portion from each other. FIG. 185 is a view of the structure for wiping the buttocks from the back of the toilet seat by means of the overlapping-type ball screw spline 401.

The wiping arm drive unit 3 includes, for the ball screw spline 401, a ball screw nut 404, a pulley 404*b*, a belt 404*a*, a spline nut 405, a pulley 405*b*, a belt 405*a*, a motor (not shown) configured to rotate the pulley 404*b*, and a motor (not shown) configured to rotate the pulley 405*b*. Note that for sharing, each motor may be switchable by an electromagnetic clutch. The wiping arm 4 is attached to one end of the ball screw spline 401. Preparing for breakdown, a coupling portion between the wiping arm 4 and the ball screw spline 401 is detachable using a bolt etc. Note that the ball screw spline 401 is rotatably/slidably attached to the raised portion 2 by a not-shown table etc.

As illustrated in FIG. 185(*a*), when the pulley 404*b* rotates, the ball screw spline 401 slides, and therefore, the wiping arm 4 is exposed. As illustrated in FIG. 185(*b*), when the pulley 405*b* rotates, the ball screw spline 401 rotates, and the wiping arm 4 swings to face to the upward direction. For facing the wiping arm 4 to the downward direction or returning the wiping arm 4 to the retracted position, each element may be reversely rotated. As described in the thirteenth embodiment, the control method can be implemented by stoppage and the wiping operation based on detection of the exposed position, the retracted position, and the lifted and lowered positions and the torque control (limitation).

As described above, wiping of the buttocks from the back of the toilet seat can be also realized by means of the ball screw spline.

(Variation of Method for Sliding Paper Loading Guide 17*c*)

The paper loading guide 17*c* can be exposed by rotation of the screw shaft of the trapezoidal screw (the sliding screw), the ball screw, etc. However, FIG. 186 illustrates the case of rotating a nut 407 to expose the paper loading guide 17*c*. FIG. 186 is a sectional view of a mechanism in the case of rotating the nut 407 to expose the paper loading guide 17*c*. The nut 407 is rotated by driving of the paper supply motor (not shown). A screw shaft 406 is received by, e.g., a sliding bearing in the hole punched at the raised portion 2. Although a plan view is not provided, the paper loading guide 17*c* is, in parallel to the screw shaft 406, slid by a sliding shaft with movement of the paper loading guide 17*c* being restricted. When the nut 407 rotates, the screw shaft 406 moves forward by linear movement (FIG. 186(*a*)). The paper loading guide 17*c* is attached to a tip end of the screw shaft 406 so that the paper loading guide 17*c* can be exposed (FIG. 186(*b*)).

FIG. 187 is a plan view of the paper supply unit 17 utilizing the paper loading guide 17*c* illustrated in FIG. 186 and the wiping arm drive unit 3 utilizing the rotatable portion 208. When the screw shaft 202 rotates as illustrated in FIG. 187(*a*), the movable portion 606 and the rotatable portion 208 slide to expose the wiping arm 4. In addition, when the nut 407 rotates as illustrated in FIG. 187(*b*), the paper loading guide 17*c* is exposed. When the rotary shaft 203 rotates as illustrated in FIG. 187(*c*), the wiping arm 4 rotates to swing the pressing unit 4*a*.

(Swinging of Paper Loading Guide 17*c*)

FIG. 188 is a view of a structure in a case where the paper loading guide 17*c* is swung by a structure similar to those of the thirteenth to sixteenth embodiments. As illustrated in FIG. 188, a paper loading guide rotatable portion 409 is disposed between the rotatable portion 208 and the movable portion 606. A rotary shaft 408 is a member configured to slide the rotatable portion 409 while applying a torque to swing the rotatable portion 409, such as a hexagonal shaft or a spline shaft. As illustrated in FIG. 188(*a*), the paper loading guide 17*c* and the wiping arm 4 are, by rotation of the screw shaft 202, exposed in association with sliding of the movable portion 606. Subsequently, as illustrated in FIG. 188(*b*), the rotary shaft 408 is rotated by a not-shown motor so that the paper loading guide 17*c* can swing downward. With this structure, the paper can be dropped when the wiping arm 4 also swing downward after wiping.

(Structural Torque Limitation of Wiping Arm 4)

FIG. 189 is a sectional view for structurally illustrating limitation of the force of pushing up the buttocks by the wiping arm 4 in the thirteenth to sixteenth embodiments. FIG. 189(*a*) is a sectional view when the wiping arm 4 is held horizontal. FIG. 189(*b*) is a sectional view when the wiping arm 4 swings upward. FIG. 189(*c*) is a sectional view when the wiping arm 4 swings downward. As illustrated in the figure, when the wiping arm 4 swings upward (or downward), the shape of the movable portion 606 itself serves as a stopper to prevent further upward (downward) swinging. This prevents the wiping arm 4 from pushing up the buttocks with a torque more than necessary, leading to structural torque limitation.

(Installation in Toilet Bowl)

In the thirteenth to sixteenth embodiments, the wiping arm drive unit 3 is disposed below the warm-water cleansing device, and therefore, there is the probability of causing a problem on fixing of the buttocks wiping device and the toilet bowl. FIG. 190 is illustrated considering such a problem. FIG. 190 is a plan view when the movable portion 606 is fixed to the screw shaft 202 with flanged nuts 410 and the rotatable portion 208 is fixed to the rotary shaft 203 with flanged spline nuts 411. The raised portion 2 is provided with fixing holes 412. By selection of a proper member, the fixing holes 412 can be provided at the raised portion 2 as illustrated in FIG. 190, and therefore, the buttocks wiping device can be fixed to the toilet bowl.

FIG. 195 is a sectional view when the movable portion 606 and the rotatable portion 208 are arranged in the upper-to-lower direction. For disposing the paper loading guide 17*c* in the structure of FIG. 190 as in the fifteenth embodiment, the movable portion 606 and the rotatable portion 208 are arranged in the upper-to-lower direction such that the paper loading guide 17*c* is disposed on a back surface of the movable portion 606 as illustrated in FIG. 195. This can ensure a space for the fixing holes 412.

Note that in the present invention, other elements than the fixing hole may be used for fixing of the toilet bowl and the buttocks wiping device. In a case where alignment with fixing holes of the toilet bowl cannot be made well, the thickness of the raised portion 2 may be increased, or an intermediate member may be interposed between the toilet bowl and the raised portion 2, as necessary. In this manner, the toilet bowl, the intermediate member, the raised portion, and the warm-water cleansing device may be fixed in this order. A fixing method is not intended to limit the present invention.

Note that the base portion of the wiping arm 4 may be of a screw type so that the strut portion of the wiping arm 4 can be detached, for example. FIGS. 189, 190, and 194 illustrate the wiping arm 4 with the strut portion being detached.

(Shape of Pressing Unit 4*a*)

The shape of the pressing unit 4*a* is a matter to be designed as necessary to fit the shape of the vicinity of the anus, and the flexible material of the pressing unit 4*a* may allow deformation upon contact with the buttocks. In the case of using the first technique, the pressing unit 4*a* formed as large as possible can prevent unexpected dropping of the paper when the paper is placed on the pressing unit 4*a*. Thus, a shape illustrated in FIGS. 191 and 192 is conceivable as an example. FIGS. 191 and 192 are perspective views of the example of the shape of the pressing unit 4*a* in the case of using the flexible material.

As illustrated in FIG. 191, the pressing unit 4*a* includes a flexible portion 415 and rod-shaped side portions 413 provided respectively at both sides of the flexible portion 415, and the side portions 413 are attached to rotate from the flexible portion 415 by rotary portions 414. FIG. 191(*a*) illustrates a horizontal state, and FIG. 191(*b*) illustrates a state upon contact. As illustrated in FIG. 191(*b*), the flexible portion 415 bends due to flexibility thereof, and then, is pressed against the vicinity of the anus. Because of the presence of the side portions 413, the paper is less dropped when placed on the pressing unit 4*a*. With the rotary portions 415, the flexible portion 415 easily fits the vicinity of the anus.

Note that as illustrated in FIG. 192, the side portions 413 do not necessarily rotate. When half-discoid side portions 413 exhibiting flexibility can be provided as illustrated in FIG. 192, the pressing unit 4*a* can easily fit the vicinity of the anus. FIG. 192(*a*) illustrates the pressing unit 4*a* in the case of wiping the buttocks from the back, and FIG. 192(*b*) illustrates the pressing unit 4*a* in the case of wiping the buttocks from the side.

Note that needless to say, the side portions 413 exhibit flexibility.

The shape described herein has been set forth merely as an example of the shape reducing paper dropping and easily fitting the vicinity of the anus, and is not intended to limit the present invention.

(Variation of Opening/Closing Unit)

For the opening/closing unit provided at the raised portion, a well-known mechanism can be used to implement opening/closing on both of the wiping arm side and the paper supply unit side. Some variations are conceivable, but it is impossible to describe all of the variations. Thus, an opening/closing mechanism utilizing an electromagnetic solenoid will be described herein. FIG. 193 is a view of an opening/closing mechanism in the case of using an electromagnetic solenoid 416. Note that in this example, a slightly-larger stroke of a movable iron core 419 of the electromagnetic solenoid 416 is taken for the sake of clarifying a structure. In the case of an insufficient stroke, the stroke may be increased using a lever. Moreover, a push-in spring may be provided at the movable iron core 419, and may push up an arm portion 418 when an openable lid 417 is closed.

Upon pushing, the openable lid 417 is lifted and brought into a closed state by a hinge mechanism between the arm portion 418 and the iron core 419 and a relationship between a groove 417*a* provided at the openable lid 417 and the arm portion 418, as illustrated in FIG. 193(*a*). Upon pulling, the iron core 419 pulls the arm portion 418 and slides in a groove 418, as illustrated in FIG. 193(*b*). As a result, the openable lid 417 is pushed down and is brought into an open state.

As described above, the opening/closing unit can be also configured by the structure using the solenoid.

In addition, the following variation of the opening/closing unit is also available: a shutter is inserted into upper and lower grooves provided at the raised portion 2, and is opened/closed right to left by pushing/pulling using a solenoid. In this case, the stroke of the solenoid is insufficient. For this reason, when the stroke can be increased by a lever, the shutter can slide right to left along the upper and lower grooves of the raised portion 2. In this case, a groove (the groove as in 306 of FIG. 177) only for housing the shutter after movement thereof is provided at the raised portion 2.

Opening/closing can be also performed in the following manner: a flexible rack is attached to a lower or upper surface of a flexible plate-shaped member to form a shutter, the shutter is inserted into upper and lower grooves of the raised portion 2, and a pinion engaging with the flexible rack is rotated to move the shutter. In this case, a groove (the groove as in 306 of FIG. 177) only for housing the shutter after movement thereof is also provided at the raised portion 2. In the case of a linear opening, the flexible plate-shaped member and the flexible rack are not necessarily used.

(Embodiment for Exposure of Paper Loading Guide 17*c* by Angular Movement)

FIG. 194 is a plan view of a concept in the case of exposing the paper loading guide 17*c* by angular movement. As illustrated in FIG. 194, the paper loading guide 17*c* is attached to a tip of a paper loading guide arm 420, and the rotary shaft of the paper supply motor 17*e* is attached to a base of the arm 420. With this structure, when the paper supply motor 17*e* rotates, the paper loading guide 17*c* is exposed. In the present invention, the structure for exposing the paper loading guide 17*c* is not specifically limited to the paper supply unit 17. Other structures than those described in the present specification are conceivable, and all of the structures for exposing the paper loading guide 17*c* by the paper supply unit 17 are included in the scope of the present invention.

(Case of Implementing Wiping Arm Drive Unit 3 by Ball Screw Spline)

FIG. 196 is a front view in a case where the wiping arm drive unit 3 is implemented using the overlapping-type ball screw spline. FIG. 197 is a front view in a case where the wiping arm drive unit 3 is implemented using the separation-type ball screw spline. Although no motors are shown in the figure, two motors may be attached respectively to the pulleys 404*b*, 405*b*, or a common motor may be shared.

FIGS. 196(*a*) and 197(*a*) illustrate a case where the spline nut 405 is rotated through the pulley 405*b* and the belt 405*a*. In this case, the wiping arm 4 is, by angular movement thereof, exposed through a toilet seat hole. Note that description on the paper will not be made, but the paper may be placed on the pressing unit 4*a* as in the first technique or may be exposed by the paper loading guide as in the second technique.

FIGS. 196(*b*) and 197(*b*) illustrate a case where the ball screw nut 404 is rotated through the pulley 404*b* and the belt 404*a*. In this case, the wiping arm 4 moves upward, and the pressing unit 4*a* contacts the buttocks through the paper. FIGS. 196(*c*) and 197(*c*) illustrate a case where forward-reverse repeat rotation of the spline nut 405 is performed through the pulley 405*b* and the belt 405*a*. In this case, the wiping arm 4 angularly moves and swings, and the pressing unit 4*a* moves back and forth in the vicinity of the anus. With this structure, reliable wiping is performed.

The overlapping-type ball screw spline 401 illustrated in FIG. 196 is configured such that a spline groove 403 and the screw groove 402 overlap with each other, leading to downsizing. The separation-type ball screw spline 404 illustrated in FIG. 197 is configured such that the spline groove 403 and the screw groove 402 are separated from each other, and for this reason, is larger than the overlapping-type ball screw spline. However, cost reduction can be realized. The type of spline to be used may be determined as necessary. Note that in the present invention, balls are built in the ball screw nut and the spline nut used for the ball screw spline, and in a case where a product realizing a similar effect is developed without the built-in balls in the future, the present invention can be implemented by means of such a shaft. Moreover, such a shaft is included in the present invention. In the separation-type ball screw spline, the built-in balls are not essential as long as the spline nut can apply a torque to the shaft. Thus, as in a nut used for a trapezoidal screw (a sliding screw), the balls are not necessarily built in the ball screw nut. Thus, the presence or absence of the built-in balls is not intended to limit the present invention.

After wiping, the ball screw nut 404 and the spline nut 405 are reversely rotated such that the wiping arm drive unit 3 retracts the wiping arm 4. Note that the protrusion (not shown) for dropping the paper may be provided at the raised portion 2, thereby naturally dropping the paper right before retraction.

As described above, the wiping arm drive unit 3 includes, about a single shaft, the mechanism for angularly moving the wiping arm 4 and the mechanism for moving the wiping arm 4 up and down, and the ball screw spline 401 can be used as the single shaft for angular movement and upper-to-lower movement of the wiping arm 4. The ball screw spline is an established technology, and therefore, designing of the buttocks wiping device is facilitated.

Note that when the spline shaft can be moved up and down by a piston, the member provided only with the spline shaft groove can be utilized without formation of the ball screw groove.

Seventeenth Embodiment

FIG. 198A is a plan view of a state when a buttocks wiping device of a seventeenth embodiment is attached to a toilet bowl. FIG. 198B is a left side view of FIG. 198A. Note that a paper supply unit 17 is not shown. FIG. 198C is a right side view of FIG. 198A. Note that a wiping arm drive unit 3 is not shown. FIG. 198D is a front view of FIG. 198A. Note that a bearing, a seat, etc. are not shown.

The wiping arm drive unit 3 is similar to that of FIG. 196, except that an exposure motor 9 is attached to a spline nut 405*b*, an upper-to-lower motor 8 is attached to a ball screw nut 404*b*, and a wiping arm 4 is housed at the back of a toilet seat 7 (rotation upon exposure is in a direction opposite to that of FIG. 196). A protrusion 2*e* is provided at the back of the toilet seat 7. If paper remains on a pressing unit 4*a* upon retraction of the wiping arm 4, the paper comes into contact with the protrusion 2*e*, and is naturally dropped. Moreover, a base portion of the wiping arm 4 is fixed to a ball screw spline 401 by a bolt 421. For detaching the wiping arm 4, the bolt 421 is loosened so that the wiping arm 4 can be detached from the ball screw spline 401. Even if the wiping arm 4 is broken down in an exposed state, the bolt 421 is loosened so that the wiping arm 4 can be detached as an initial response. The present invention is not limited to the present embodiment as long as the wiping arm 4 can be detached.

The seventeenth embodiment discloses not only the mechanism for exposing a paper loading guide 17*c* by angular movement, but also the mechanism for adjusting the height of the paper loading guide 17*c* by upper-to-lower movement thereof. As illustrated in FIG. 198*c*, a paper loading guide arm 420 is attached to one end of the ball screw spline 401 by the bolt 421, and the paper loading guide 17*c* is attached to a tip of the paper loading guide arm 420. Upon exposure of the paper loading guide 17*c*, a paper supply motor 17*e* rotates to rotate the spline nut 405 through a pulley 405*b* and a belt 405*a*. In this manner, the ball screw spline 401 rotates so that the paper loading guide 17*c* can be exposed.

For adjusting the height of the paper loading guide 17*c*, the ball screw nut 404 is rotated so that the height of the paper loading guide 17*c* can be adjusted by upper-to-lower movement of the ball screw spline 401. The ball screw nut 404 may have a large radius or may be attached to a lever so that manual rotation of the ball screw nut 404 can be performed. Note that the lower limit of the pressing unit 4*a* is predetermined, and for this reason, the method for cutting a screw groove at the ball screw spline 401 may be adjusted such that the paper loading guide 17*c* does not move lower than the lower limit. Alternatively, a stopper may be provided such that the ball screw spline 401 does not move lower than the lower limit.

As described above, in the seventeenth embodiment, the height of the paper loading guide 17*c* can be adjusted by the mechanism for moving the ball screw spline 401 up and down. In the case of a user with buttock muscles sagging from the toilet seat 7, there is a probability that the paper loading guide 17*c* contacts the buttocks. For this reason, the height of the paper loading guide 17*c* can be adjusted such that the paper loading guide 17*c* does not contact the buttocks even with an individual difference.

Note that in the case of not using a height adjustment function or adjusting the height by another section, the paper loading guide 17*c* may be angularly moved utilizing only a spline shaft and a spline nut instead of the ball screw spline 401.

(Embodiment of Paper Supply Unit 17)

The mechanism for exposing the paper loading guide 17*c* by means of the screw shaft has been described with reference to FIGS. 186 and 187. An embodiment with further modification of such a mechanism will be described herein. FIG. 199 is a perspective view of one embodiment of the paper supply unit 17. FIG. 199 illustrates a state when the paper loading guide 17*c* is retracted.

In FIG. 199, a table 500 is, by a plurality of struts 501 and a screw shaft 502, attached to slide up and down in the raised portion 2. The screw shaft 502 penetrates a height adjustment nut 503. When the height adjustment nut 503 rotates, the table 500) moves up and down in association with such rotation. A drive mechanism of the paper supply unit 17 is disposed on the table 500, and therefore, the height of the paper loading guide 17*c* can be adjusted by the height adjustment nut 503.

Shaft tables 504*a*, 504*b* stand on the table 500. A screw shaft 505 and a sliding shaft 506 penetrate the shaft tables 504*a*. 504*b* in parallel to each other. Tip ends of the screw shaft 505 and the sliding shaft 506 are attached to a movable portion 507 in a fixed manner. The screw shaft 505 penetrates a nut 508 between the shaft table 504*a* and the shaft table 504*b*. The nut 508 communicates with a pulley 510 through a belt 509. The pulley 510 is coupled to the paper supply motor 17*e*. With this structure, the nut 508 rotates forward upon forward rotation of the paper supply motor 17*e*, and therefore, the movable portion 507 slidably moves forward along the screw shaft 505 and the sliding shaft 506. The nut 508 reversely rotates upon reverse rotation of the paper supply motor 17*e*, and therefore, the movable portion 507 slidably moves backward along the screw shaft 505 and the sliding shaft 506.

The paper loading guide 17*c* has grooves 507*b* on both sides. Guides 507*a* are inserted respectively into the grooves 507*b*. With this structure, the user can slide the paper loading guide 17*c* on the movable portion 507.

FIG. 200 is a perspective view of the paper supply unit 17 when the paper loading guide 17*c* slidably moves backward. For placing special paper 11*b* on the paper loading guide 17*c*, the user pulls out the paper loading guide 17*c* from the raised portion 2, and then, places the special paper 11*b*. Note that the special paper 11*b* is not necessarily used as long as the user neatly folds toilet paper to a predetermined size. The same applies to other embodiments employing the second technique. After placed the special paper 11*b* on the paper loading guide 17*c*, the user returns the paper loading guide 17*c* to the raised portion 2. Note that, e.g., a limit switch or a photo sensor may be used for determination on whether or not the paper loading guide 17*c* has returned to an original position, and an error message for not starting wiping operation may be notified in a case where the paper loading guide 17*c* has not been returned to the original position yet.

FIG. 201 is a perspective view of the paper supply unit 17 when the paper loading guide 17*c* is exposed. A paper-supply-side opening/closing unit 19*a* has a lower portion serving as a hinge, and the hinge is attached to the raised portion 2. Moreover, force in a closing direction is applied to the paper-supply-side opening/closing unit 19*a* by, e.g., a spring. The movable portion 507 is exposed after pushed through the paper-supply-side opening/closing unit 19*a*. Although the special paper 11*b* is not shown in the figure, the special paper 11*b* is exposed with the special paper 11*b* being placed on the paper loading guide 17*c*, and wipes the buttocks in such a manner that the pressing unit 4*a* moves upward from below a hollow-out portion of the paper loading guide 17*c*. When the special paper 11*b* is lifted, the paper supply motor 17*e* reversely rotates to move the paper loading guide 17*c* backward, and the paper loading guide 17*c* returns to the original position. The paper-supply-side opening/closing unit 19*a* is naturally closed by the spring force.

With the above-described structure of pulling out the paper loading guide 17*c* and placing the paper on the paper loading guide 17*c* by the user in addition to the mechanism for exposing the paper supply unit 17 by the screw shaft 505, the paper supply unit 17 can be downsized with a simple structure even in a case where the stroke of the screw shaft 505 cannot be ensured.

Such a simple height adjustment mechanism using the screw shaft is also applicable to the paper supply units 17 described in other embodiments. For example, in the case of the paper supply units 17 of the eighth, tenth, eleventh, and twelfth embodiments and the embodiment of FIG. 121, the table 500 may be provided on the raised portion 2, the paper supply unit 17 may be placed on the table 500, and the height may be adjusted by the screw shaft 502 and the height adjustment nut 503. In the case of the paper supply unit 17 of the embodiment of FIG. 135A, the table 500 may be placed on the fixing table 71*e*, and the height may be adjusted by the screw shaft 502 and the height adjustment nut 503. In the case of the paper supply unit 17 of the embodiment of FIG. 161, the illustrated structure may be constructed on the table 500, and the height may be adjusted by the screw shaft 502 and the height adjustment nut 503.

Moreover, the structure of pulling out the paper loading guide 17*c* is also applicable to the paper supply units 17 described in other embodiments. For example, in the case of the paper supply unit 17 of the embodiment of FIG. 135A, the paper loading guide 17*c* of FIG. 135A is taken as a movable portion, and therefore, the paper loading guide 17*c* may be separately and slidably placed on such a movable portion. In the case of the paper supply unit 17 illustrated in FIG. 161, the paper loading guide 17*c* of FIG. 161 is taken as a movable portion, and therefore, the paper loading guide 17*c* may be separately and slidably placed on such a movable portion. That is, the paper supply unit 17 is provided with the movable portion configured to move together with the paper loading guide 17*c* upon exposure thereof, and the paper loading guide 17*c* is slidable on such a movable portion. With this structure, the paper loading guide 17*c* can be pulled out at the point of use, and the paper can be placed on the paper loading guide 17*c*. Thus, the paper supply unit 17 can be downsized.

Note that instead of using the height adjustment nut 503, a screw hole may be formed at the table 500 so that the height of the table 500 can be adjusted by rotation of the screw shaft 502. In this case, for rotation of the screw shaft 502, a handle may be attached to a lower end of the screw shaft 502.

Note that adjustment of the height of the paper loading guide 17*c* of the paper supply unit 17 is not limited to adjustment using the screw shaft, and the height of the paper loading guide 17*c* upon exposure can be adjusted by adjustment of inclination of the paper supply unit 17. That is, the height of the paper loading guide 17*c* can be decreased by downward inclination of the paper supply unit 17, and can be increased by upward inclination of the paper supply unit 17. Alternatively, the structure of sandwiching a spacer between the paper supply unit 17 and the raised portion 2 may be employed. In this case, the table 500 may be configured liftable, and the height of the paper loading guide 17*c* may be adjusted by the height of the spacer interposed between the raised portion 2 and the table 500. Other mechanism for height adjustment are not limited in the present invention.

For the embodiments of the thirteenth to sixteenth embodiments, the mechanism can be also mounted on the table for height adjustment, and height adjustment can be performed by other methods.

(Position Relationship Between Wiping Arm 4 and Paper Loading Guide 17*c*)

FIG. 202 is a sectional view of a position relationship between the wiping arm 4 and the paper loading guide 17*c*. For example, in the case of using the thirteenth embodiment, the pressing unit 4*a* can be exposed with the wiping arm 4 being inclined diagonally downward as illustrated in FIG. 202 when the wiping arm 4 is exposed. In this case, even when the paper loading guide 17*c* is exposed around a slightly-lower position, collision between the paper loading guide 17*c* and the pressing unit 4*a* is avoided. Note that the same applies to all of the embodiments in which the wiping arm 4 can be exposed in the inclined state, and the above-described case is not limited only to the thirteenth embodiment. The wiping arm drive unit 3 may initially expose the wiping arm 4 in the inclined state. Alternatively, the wiping arm drive unit 3 may expose the wiping arm 4 in a temporal horizontal state, and at the stage of slightly exposing the wiping arm 4 through the toilet seat opening hole portion, move the wiping arm 4 to below the paper loading guide 17*c* with the wiping arm 4 being downwardly inclined.

As described above, the wiping arm drive unit 3 exposes the wiping arm 4 in a downwardly-inclined state upon exposure of the wiping arm 4, and therefore, the paper loading guide 17*c* can be positioned lower. Collision among the buttocks muscles and the paper loading guide 17*c* can be avoided.

(Variation of Paper Supply Unit 17)

FIG. 203 is a view of a variation of the paper supply unit 17. In FIG. 203, a sliding shaft 511 is provided not to move. Instead, a guide 512 is fixed to one end of the screw shaft 406, and the sliding shaft 506 penetrates the guide 512. With this structure, when the nut 407 rotates from the state illustrated in FIG. 203(*a*) to the state illustrated in FIG. 203(*b*), the guide 512 slides along the sliding shaft 506, and therefore, the paper loading guide 17*c* can move forward without swinging. Note that as illustrated in FIG. 203(*c*), the movable portion 507 may be fixed to the screw shaft 406 so that the paper loading guide 17*c* can be slidably pulled out on the movable portion 507.

Any other well-known mechanisms can be utilized as the mechanism for exposing the paper loading guide 17*c*. For example, a mechanism used in a CD-ROM drive is useful, and the mechanism utilized for exposing the paper loading guide 17*c* is not intended to limit the present invention.

(Buttocks Wiping Tool)

FIGS. 204A and 204B are perspective views of a buttocks wiping tool usable for manually wiping the buttocks. FIG. 204A illustrates original arrangement, and FIG. 204B illustrates arrangement upon wiping. The pressing unit 4*a* is rotatably attached to the tip end portion of the wiping arm 4. Although not specifically limited, the rotation mechanism has a T-shaped tip end, and is rotatable in the pressing unit 4*a*. The user manually places the paper (may be the special paper 11*b* or the toilet paper neatly folded by the user) on the pressing unit 4*a*. Moreover, a simple holding structure may be provided at the pressing unit 4*a*. For example, openable plates may be provided at the bottom surface of the pressing unit 4*a*, may sandwich the paper hanging toward the bottom with the paper being placed on the pressing unit 4*a*, and may stick together by permanent magnets. Alternatively, the pressing unit 4*a* may be made of flexible resin, and the paper may be inserted into a cutout formed at the flexible resin. In this case, the cutout may be formed on an upper side or a bottom side.

A rotary plate 609 is, as a wiping arm movement section for moving the wiping arm 4, provided on the raised portion 2, and a hinge portion 608 is fixed to the rotary plate 609. By movement of a lever 607, the wiping arm can be rotated and exposed, and can be moved up and down. After the paper has been attached to the pressing unit 4*a*, the lever 607 is used to expose the wiping arm 4 and incline the wiping arm 4 diagonally upward, thereby wiping the buttocks. The user may perform, as necessary, wiping by front-to-back movement of the wiping arm 4.

As described above, the buttocks can be wiped by means of a simple buttocks wiping tool. Note that the structure described herein has been set forth merely as an example, and any mechanisms may be employed as long as the mechanism can expose the wiping arm and move the wiping arm up and down. The buttocks wiping tool may be provided with a pliers-like mechanism for holding the paper on the pressing unit 4*a* or a mechanism for holding the paper in such a manner that two separated pressing units slide to contact each other by grabbing.

Note that the wiping arm drive unit described in the present specification may be used for a buttocks wiping device configured to wipe the buttocks in such a manner that a wiping material is attached by holding or insertion of the wiping material by a wiping portion of a wiping arm. That is, in the case of focusing only on the drive mechanism of the wiping arm drive unit, the invention is established without any limitations on whether or not the wiping arm is held.

Note that an electromagnetic solenoid may be, as a simple mechanism for paper attachment, used to close one of two separated pressing units. Alternatively, a section configured to open/close at a bottom surface of a pressing unit may be provided such that paper is attached with the paper being pinched by the opening/closing section. A pressing unit may be made of, e.g., flexible resin, a cutout may be formed at the resin, and paper may be attached to the pressing unit such that the paper is inserted into the cutout.

Note that various paper dropping methods are conceivable in the fourteenth to sixteenth embodiments. FIG. 205(*a*) is a sectional view for describing the method for dropping the paper by the protrusion 2*e* provided at the raised portion 2 and functioning as a dropping portion. The pressing unit 4*a* is positioned and exposed below the paper loading guide 17*c* (a dashed line of FIG. 205), but upon wiping, moves upward to around the toilet seat 7 to wipe the buttocks. When the wiping arm 4 is retracted after wiping, the wiping arm drive unit 3 inclines the wiping arm 4 to a position higher than the paper loading guide 17*c* and lower than the upper surface of the raised portion 2 in the vicinity of the opening of the raised portion 2. Then, the wiping arm drive unit 3 slides and retracts the wiping arm 4 in such a state. Further, the protrusions 2*e* are provided at positions higher than the paper loading guide 17*c*, and are provided at such an interval that the pressing unit 4*a* can move through between the protrusions 2*e*. Thus, upon retraction, the pressing unit 4*a* of the wiping arm 4 is retracted through between the protrusions 2*e* as indicated by a solid line of FIG. 205. Even if the paper remains on the pressing unit 4*a*, the remaining paper inevitably comes into contact with the protrusions 2*e* right before retraction, and therefore, is dropped. Note that two protrusions 2*e* are not necessarily provided, and a single protrusion 2*e* may be provided.

FIG. 205(*b*) is a plan view of a variation of the paper loading guide 17*c*, and FIG. 205(*c*) is a right side view of a state when the paper is dropped. The type described herein is described as the type of moving the paper loading guide 17*c* and the movable portion 606 together, but is also applicable to the type of separately moving the paper loading guide 17*c* and the movable portion 606. As illustrated in FIG. 205(*b*), a large hole of the paper loading guide 17*c* is formed. Specifically, the shape of the paper loading guide 17*c* is designed such that the special paper 11*b* is placed in a balanced manner on ends of the paper loading guide 17*c* and the pressing unit 4*a*. The wiping arm 4 is exposed in the state of FIG. 205(*b*). After completion of wiping, the wiping arm drive unit 3 moves the wiping arm 4 such that the wiping arm 4 inclines downward as illustrated in FIG. 205(*c*). The paper loading guide 17*c* has the hole with such a size that the special paper 11*b* cannot be placed in the balanced manner without the pressing unit 4*a*. Thus, when the wiping arm 4 inclines downward, the special paper 11*b* is dropped through such a hole. In this state, the pressing unit 4*a* of the wiping arm 4 also inclines, and therefore, the special paper 11*b* is dropped into the toilet bowl. The shape of the paper loading guide 17*c* is, as described above, designed such that the paper is not dropped when the pressing unit 4*a* is held horizontal, but is easily dropped when the pressing unit 4*a* inclines downward. Thus, it is not necessary to move the paper loading guide 17*c* only for paper dropping, leading to structure simplification and cost reduction. Note that in a case where the paper loading guide 17*c* is, e.g., a single rod portion provided only on the right side, only the single rod portion and the pressing unit 4*a* are moved when exposed with the paper being placed, and the pressing unit 4*a* lifts the paper for wiping. For dropping, the wiping arm 4 is moved downward such that the paper loses its balance and easily drops from the paper loading guide 17*c*. Moreover, the shape of the paper loading guide 17*c* may be, as necessary, designed such that the paper is reliably placed on the pressing unit 4*a* upon exposure while easily losing its balance upon dropping. Note that the present invention is not limited only to use of the special paper 11*b*, considering use of the paper neatly folded by the user. In the present specification, the embodiments using the special paper 11*b* also include wiping materials such as the rolled paper folded by the user.

Moreover, although described in the beginning, the aspects described in the present specification can be combined together, and the present invention is not limited only to the combination examples described above.

The present invention has been described above in detail. However, such description has been merely an example of the present invention in every respect, and is not intended to limit the scope of the present invention. Needless to say, various modifications and changes can be made without departing from the scope of the present invention.

INDUSTRIAL APPLICABILITY

The present invention relates to a buttocks wiping device, and is industrially applicable.

DESCRIPTION OF REFERENCE SIGNS

1 buttocks wiping device
2 raised portion/2*a* groove/2*b*, 2*c*, 2*d* housing portion/2*e* protrusion
3 wiping arm drive unit
4 wiping arm/4*a* pressing unit/4*a*-1 raised portion/4*a*-2 table portion
4*b* hinge portion/4*c* electromagnet/4*d* coupling portion/4*e* spring/4*f* attachment portion
4*g* rotary body/4*h* biaxial drive mechanism/4*i* pin/4*j* pin/4*k* bearing
4*l* bevel gear/4*m* bevel gear/4*n* worm wheel/4*o* worm
4*p* shaft/4*q* supporting portion/4*r* rotary portion/4*s* protrusion/4*t* protrusion
4*u* air hole/4*v* gripping portion
5 automatic paper supply unit/5*a* folding guide/5*b* cutting unit/5*c* paper feeding roller
5*d* holder/5*f* table
6 opening/closing unit/6*a* opening/closing checking sensor/6*b* gear/6*c* gear/6*d* opening/closing motor
6*e* rotary shaft/6*f* pinion/6*g* rack/6*h* holding guide
7 toilet seat/7*a* hole/7*b* lid
8 upper-to-lower motor/8*a* motor detection unit/8*b* rod/8*c* motor/8*d* circular plate
8*e* rotary table
9 exposure motor/9*a* motor detection unit/9*b* wire
10 rail/10*a* seat/10*b* seat/10*c* pulley/10*d* belt
10*e* coupling tool/10*f* pulley/10*g* pulley/10*h* upper sliding rod
10*i* lower sliding rod 10*j* screw shaft/10*k* shaft
11 toilet paper/11*a* paper/11*b* special paper/11*c* base material portion
11*d* water supply portion/11*e* rolled paper/11*f* special paper/11*g* joint portion
11*h* pressure-bonded toilet paper/11*i* bonded toilet paper
11*j* special paper/11*k* continuous folded special paper
12*a* retracted position sensor/12*b* exposed position sensor/12*c* cleansing checking sensor
12*d* remaining paper amount sensor/12*e* paper loading detection sensor
13 control unit
14 paper supply unit/14*a* paper injection port/14*b* caterpillar track/14*c* caterpillar track
14*d* paper feeding motor/14*e* sensor/14*f* sensor/14*g* upper roller
14*h* guide/14*i* lower roller/14*j* table/14*k* opening/14*l* delivery unit
14*m* sliding groove
15 warm-water cleansing device
16 sterilization/cleansing arm/16*a* exposure motor/16*b* upper-to-lower motor
16*c* sterilization/cleansing head/16*d* sterilization/cleansing nozzle/16*e* tank
16*f* pipe/16*g* lid detection sensor
17 paper supply unit/17*a* paper injection port/17*b* paper supply roller/17*c* paper loading guide
17*d* push-out portion/17*e* paper supply motor/17*f* coupling
17*g* paper supply sensor/17*h* paper delivery sensor/17*i* paper loading guide sensor
17*j* belt/17*k* groove
17*l* paper loading guide opening/17*m* motor detection unit
18 exposure/upper-to-lower motor/18*a* arm coupling portion/18*b* screw shaft/18*c* gear
18*d* first stopping portion/18*e* second stopping portion/18*f* third stopping portion
18*g* motor detection unit/18*h* lid/18*i* arm-side opening/18*j* arm movement opening
19*a* paper-supply-side opening/closing unit/19*b* arm-side opening/closing unit/19*c* opening/closing checking sensor
19*d* opening/closing checking sensor/19*e* raised portion/19*f* raised portion/19*g* hinge portion
19*h* hinge portion/19*i* spring portion
19*b*-1, 19*b*-2, 19*b*-3 hinge-type opening/closing unit
20*a* guide groove/20*b* arm portion/20*c* magnet
21*a* paper supply motor/21*b*, 21*c* electromagnetic clutch with pulley
21*d* pulley/21*e* winding portion/21*f* belt/21*g* pulley
21*h* pulley/21*i* belt/21*j* rail drive wheel
22 sterilization and/or cleansing unit
22*a* drainage path/22*b* nozzle or shower/22*c* defensive barrier/22*d* inclined surface
22*e* insertion port

23*a* electromagnetic valve/23*b* water pipe/23*c* cleansing/sterilization solution pipe
23*d* shower head/23*e* Venturi tube/23*f* tank
23*g* orifice/23*h* shower head lid/23*i* drainage groove
23*j* spraying unit/23*k* pump
24 restriction rod portion/24*a* restriction rod/24*b* restriction rod/24*c* restriction rod drive unit
24*d* restriction rod drive unit/24*e* movable plate/24*f* arm coupling portion/24*g* screw shaft
25 restriction rod motor/25*a* motor detection unit
26 bending position
27*a* bevel gear/27*b* bevel gear/27*c* bearing/27*d* bearing
27*e* link mechanism/27*f* free end/27*g* center shaft
28 gear box/28*a* belt
29 top/29*a* rotary shaft/29*b* extendable portion/29*c* hinge mechanism
30 paper stocker portion/30*a* friction plate/30*b* delivery roller/30*c* claw portion
30*d* drive unit/30*e* guide/30*f* holding portion
31 portable toilet with wiping function
32 housing portion/32*a* lid
33 paper loading guide opening
34 paper loading guide opening/closing unit/34*a* motor
35 operation unit
36 toilet bowl portion
37 paper supply unit housing
38 paper stocker portion
39 arm opening/closing unit/39*a* motor
40 paper supply unit internal mechanism
41 rising portion
42 rising portion
43 rotary portion
44 protrusion
45 forward drive portion
46 tip end raised portion
50 odor elimination device
51 lid of toilet bowl
52 pressure bonding unit/52*a* upper and lower rollers/52*b* bonding unit
53 cutting unit/53*a* cutter
70 motor frame/70*a* movable frame/70*b* movable frame/70*c* movable beam/70*d* movable beam
71*a* lower rail portion/71*b* lower rail portion/71*c* sliding table/71*d* sliding table
71*e* fixing table
72*a* upper rail portion/72*b* upper rail portion/72*c* fixing portion/72*d* fixing portion
73*a* lower rack/73*b* lower rack/73*c* lower pinion/73*d* lower pinion
73*e* lower rotary shaft/73*f* lower pulley
74*a* upper rack/74*b* upper rack/74*c* upper pinion/74*d* upper pinion
74*e* upper rotary shaft/74*f* upper pulley
75 belt
81 rotary table
82 upper-to-lower motor rotary shaft
83 ring plate/83*a* first groove
84 guide bracket/84*a* second groove/84*b* third groove/84*c* fourth groove
85 transmission portion
86*a* first free end/86*b* second free end
91 worm
92 worm wheel/92*a* transmission portion/92*b* transmission portion
93 exposure motor fixing portion
94 shaft holding plate
95*a* strut/95*b* strut
96 paper stocker portion/96*a* opening/96*b* cutting unit/96*c* paper feeding roller
100 buttocks wiping device
102 right-to-left rail
103 right-to-left rail drive motor
104 front-to-back rail drive motor
105 front-to-back rail
106 upper-to-lower motor
107 holding unit
108 holding tip end portion
109 disposable arm for wiping
110 disposable arm for standby
111 raised portion
112 disposable arm supply unit
113 warm-water cleansing device
114 toilet seat
115 imaging unit
200 arm-side housing portion
201 paper-supply-side housing portion
202 screw shaft
203 rotary shaft
204 exposure/upper-to-lower motor
205 paper supply unit/205*a* ball screw/205*b* paper stocker
205*c* paper feeding motor/205*d* pulley/205*e* paper feeding roller
205*f* free roller/205*g* paper feeding drive roller/205*h* paper feeding roller
205*i* slide/205*j* belt/205*k* paper loading table/205*l* motor detection unit
205*m* ball screw motor/205*n* motor detection unit/205*o* pulley
205*p* drawable portion
206*a* paper loading table detection unit/206*b* paper remaining amount detection unit/206*c* paper feeding detection unit
207 belt/207*a* belt
208 rotatable portion
210 screw shaft
211 ball screw
212 worm
213 worm wheel
220 bearing portion
221 mechanism housing portion
222 mechanism housing portion
223 paper dropping portion
300 drive motor/300*a* motor detection unit
301 screw shaft
302 sliding rod
303 paper dropping portion
304 slide-type opening/closing unit/304*a* hinge portion
305 hinge-type opening/closing unit/305*a* hinge portion
306 groove
307 press-down portion
308 groove
310 sliding rod
400 press-down portion
401 ball screw spline/402 screw groove/403 spline groove
404 ball screw nut/404*a* belt/404*b* pulley
405 spline nut/405*a* belt/405*b* pulley
406 screw groove/407 nut/408 rotary shaft
409 paper loading guide rotatable portion
410 flanged nut/411 flanged spline nut
412 fixing hole/413 side portion/414 rotary portion/415 flexible portion
416 electromagnetic solenoid/417 openable lid/417*a* groove
418 arm portion/418*a* groove/419 movable iron core
420 paper loading guide arm/421 bolt

500 table/501 strut/502 screw shaft/503 height adjustment nut
504*a*, 504*b* shaft table/505 screw shaft/506 sliding shaft
507 movable portion/507*a* guide/507*b* groove/508 nut/509 belt
510 pulley
511 sliding shaft/512 guide
606 movable portion/606*a*, 606*e* pulley
606*b*, 606*c*, 606*d* electromagnetic clutch with pulley
607 lever/608 hinge portion/609 rotary plate

The invention claimed is:

1. A buttocks wiping device for wiping buttocks with a wiping material, comprising:
a wiping arm including a pressing unit configured to press the wiping material against the buttocks;
a wiping arm drive unit configured to cause the wiping arm to move and perform wiping operation; and
a paper supply unit configured to expose the wiping material below the buttocks,
wherein the wiping arm drive unit drives the wiping arm such that the pressing unit pushes up, from below, the wiping material exposed by the paper supply unit;
the paper supply unit
includes a paper loading guide configured to place the wiping material, and
exposes the wiping material below the buttocks in such a manner that the paper loading guide is exposed with the wiping material being placed on the paper loading guide; and
the paper loading guide has such a shape that the pressing unit can passes upward from below.

2. The buttocks wiping device according to claim 1, wherein
after the wiping arm drive unit has caused the pressing unit to push up the wiping material, the paper supply unit returns the paper loading guide to a retracted position.

3. The buttocks wiping device according to any one of claim 1, wherein
the paper supply unit includes
a first movement mechanism configured to move the paper loading guide, and
a second movement mechanism configured to move the first movement mechanism itself.

4. The buttocks wiping device according to claim 1, wherein
the paper supply unit uses rotation of a screw shaft to move the paper loading guide.

5. The buttocks wiping device according to claim 1, wherein
the paper supply unit includes a paper supply roller configured to deliver the wiping material to the paper loading guide.

6. The buttocks wiping device according to claim 1, further comprising:
an automatic paper supply unit configured to set the wiping material onto the paper supply unit.

7. The buttocks wiping device according to claim 1, wherein
the paper supply unit includes a paper supply sensor configured to detect whether or not the wiping material has been set.

8. The buttocks wiping device according to claim 1, wherein
the paper supply unit includes
a paper supply roller configured to deliver the wiping material, and
a paper delivery sensor configured to detect whether or not the wiping material has been delivered from the paper supply roller.

9. The buttocks wiping device according to claim 1, wherein
when facing a toilet seat, the paper supply unit and the wiping arm drive unit are on an identical side in a right-to-left direction or on opposite sides in the right-to-left direction.

10. The buttocks wiping device according to claim 1, wherein
a plane including an opening for housing the paper supply unit is in a planer shape.

11. The buttocks wiping device according to claim 1, wherein
the paper supply unit includes a paper supply roller configured to deliver the wiping material onto the paper loading guide, and
a common motor is shared as a motor configured to expose the paper loading guide and a motor configured to rotate the paper supply roller.

12. The buttocks wiping device according to claim 1, wherein
the paper supply unit exposes the paper loading guide by angular movement.

13. The buttocks wiping device according to claim 1, wherein
the paper supply unit is able to adjust a height of the paper loading guide.

14. The buttocks wiping device according to claim 1, wherein
the paper supply unit includes a movable portion configured to move together with the paper loading guide when the paper loading guide is exposed, and
the paper loading guide is slidable on the movable portion.

15. The buttocks wiping device according to claim 1, wherein
when the wiping arm is exposed, the wiping arm drive unit inclines the wiping arm downward such that the pressing unit is positioned below the paper loading guide.

16. The buttocks wiping device according to claim 1, wherein
the wiping arm drive unit includes
a slidable movable portion,
a sliding mechanism configured to slide the movable portion,
a swingable portion fixed to the wiping arm and configured to slide in association with sliding of the movable portion, and
a swinging mechanism configured to swing the swingable portion, and
the paper loading guide is attached to the movable portion, and is moved by the sliding mechanism.

17. The buttocks wiping device according to claim 1, wherein
the wiping arm drive unit includes
a slidable movable portion,
a sliding mechanism configured to slide the movable portion,
a swingable portion fixed to the wiping arm and configured to slide in association with sliding of the movable portion, and
a swinging mechanism configured to swing the swingable portion, and the paper supply unit includes a paper loading guide sliding mechanism separated from the movable portion and configured to slide the paper loading guide.

18. The buttocks wiping device according to claim 1, wherein the paper supply unit includes a paper loading guide sliding mechanism configured to slide the paper loading guide.

19. The buttocks wiping device according to claim 1, wherein the wiping arm drive unit includes a slidable movable portion, a sliding mechanism configured to slide the movable portion, a swingable portion fixed to the wiping arm and configured to slide in association with sliding of the movable portion, and a swinging mechanism configured to swing the swingable portion, and the paper supply unit includes a paper loading guide swinging mechanism separated from the movable portion and configured to swing the paper loading guide.

20. The buttocks wiping device according to claim 1, wherein the paper supply unit includes a sensor configured to detect whether or not the paper loading guide has contacted a user, and in a case where the paper loading guide has contacted the user, stops or backwardly moves the paper loading guide.

21. A buttocks wiping device for wiping buttocks with a wiping material, comprising:

a wiping arm including a pressing unit configured to press the wiping material against the buttocks;

a wiping arm drive unit configured to cause the wiping arm to move and perform wiping operation; and a paper supply unit configured to expose the wiping material below the buttocks, wherein the wiping arm drive unit drives the wiping arm such that the pressing unit pushes up, from below, the wiping material exposed by the paper supply unit;

the paper supply unit includes a paper loading guide configured to place the wiping material, and exposes the wiping material below the buttocks in such a manner that the paper loading guide is exposed with the wiping material being placed on the paper loading guide; and the paper supply unit uses a rack-and-pinion mechanism to move the paper loading guide.

22. A buttocks wiping device for wiping buttocks with a wiping material, comprising:

a wiping arm including a pressing unit configured to press the wiping material against the buttocks;

a wiping arm drive unit configured to cause the wiping arm to move and perform wiping operation; and a paper supply unit configured to expose the wiping material below the buttocks, wherein the wiping arm drive unit drives the wiping arm such that the pressing unit pushes up, from below, the wiping material exposed by the paper supply unit;

the paper supply unit includes a paper loading guide configured to place the wiping material, and exposes the wiping material below the buttocks in such a manner that the paper loading guide is exposed with the wiping material being placed on the paper loading guide; and the paper supply unit includes a paper loading guide sensor configured to detect whether or not the wiping material is placed on the paper loading guide.

* * * * *